US006952294B2

(12) United States Patent
Ishikawa et al.

(10) Patent No.: US 6,952,294 B2
(45) Date of Patent: Oct. 4, 2005

(54) METHOD OF READING AN IMAGE, METHOD OF FORMING A COLOR IMAGE, DEVICE FOR FORMING A COLOR IMAGE, SILVER HALIDE COLOR PHOTOSENSITIVE MATERIAL, AND A DEVICE FOR PROCESSING A PHOTOSENSITIVE MATERIAL

(75) Inventors: Shun-ichi Ishikawa, Kanagawa (JP); Kazuhiko Matsumoto, Kanagawa (JP); Hidetoshi Kobayashi, Kanagawa (JP); Yoshiharu Yabuki, Kanagawa (JP); Hideaki Nomura, Kanagawa (JP); Tomoyoshi Hyodo, Kanagawa (JP); Takatoshi Ishikawa, Kanagawa (JP); Yoshio Ishii, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 856 days.

(21) Appl. No.: 09/725,934

(22) Filed: Nov. 30, 2000

(65) Prior Publication Data

US 2003/0035149 A1 Feb. 20, 2003

(30) Foreign Application Priority Data

| | | |
|---|---|---|
| Nov. 30, 1999 | (JP) | 11-340647 |
| Nov. 30, 1999 | (JP) | 11-341067 |
| Nov. 30, 1999 | (JP) | 11-341068 |
| Nov. 30, 1999 | (JP) | 11-341069 |
| Nov. 30, 1999 | (JP) | 11-341070 |
| Nov. 30, 1999 | (JP) | 11-341071 |
| Nov. 30, 1999 | (JP) | 11-341072 |
| Dec. 24, 1999 | (JP) | 11-367431 |
| Mar. 28, 2000 | (JP) | 2000-089320 |

(51) Int. Cl.[7] ..... H04N 1/46

(52) U.S. Cl. ..... 358/505; 358/1.9; 358/3.27; 358/509; 358/518; 358/471; 430/221; 430/256; 347/118; 250/317.1

(58) Field of Search ..... 358/505–509, 358/500, 515, 450, 471, 487, 503; 430/221, 201, 11, 256, 203–207, 9, 14, 502; 347/118; 250/317.1

(56) References Cited

U.S. PATENT DOCUMENTS

| | | | | | |
|---|---|---|---|---|---|
| 5,081,526 | A | * | 1/1992 | Yoshikawa | 358/503 |
| 5,389,503 | A | | 2/1995 | Evans et al. | 430/502 |
| 5,408,447 | A | * | 4/1995 | Cottrell et al. | 358/505 |
| 5,465,155 | A | | 11/1995 | Edgar | 358/500 |
| 5,519,510 | A | | 5/1996 | Edgar | 358/471 |
| 5,639,580 | A | * | 6/1997 | Morton | 430/11 |
| 5,700,630 | A | | 12/1997 | Inoue et al. | |
| 5,985,528 | A | | 11/1999 | Komamura et al. | |
| 5,988,896 | A | | 11/1999 | Edgar | 396/604 |
| 6,069,714 | A | | 5/2000 | Edgar | 358/487 |
| 6,210,871 | B1 | | 4/2001 | Ishii et al. | |

FOREIGN PATENT DOCUMENTS

| | | | |
|---|---|---|---|
| EP | 0 526 931 A1 | 2/1993 | |
| EP | 0 610 994 A2 | 8/1994 | |
| EP | 0 611 988 A2 | 8/1994 | |
| EP | 0 762 201 A1 | 3/1997 | |
| EP | 0 800 114 A2 | 10/1997 | |
| EP | 0 997 776 A1 | 5/2000 | |
| GB | 2 294 777 A | 5/1996 | |
| JP | 6-295035 | 10/1994 | |
| JP | 9-204031 | 8/1997 | G03C/8/40 |
| JP | 10-207010 | 8/1998 | |
| JP | 10-301241 | 11/1998 | G03C/5/29 |
| JP | 11-52528 | 2/1999 | G03C/7/407 |
| JP | 11-52532 | 2/1999 | G03D/3/00 |
| JP | 11-143045 | 5/1999 | G03D/5/00 |
| JP | 11-209125 | 8/1999 | C01G/5/02 |
| JP | 11-271941 | 10/1999 | G03C/7/42 |
| WO | WO 98/19216 A1 | 5/1998 | |

* cited by examiner

*Primary Examiner*—Edward L. Coles
*Assistant Examiner*—Heather D. Gibbs
(74) *Attorney, Agent, or Firm*—Sughrue Mion, PLLC

(57) ABSTRACT

The present invention relates to a method of reading an image, which comprises exposing a color photosensitive material having at least three photosensitive layers containing blue-, green- and red-photosensitive silver halide emulsions, respectively, on a transparent support, processing the exposed color photosensitive material at a processing temperature of 50° C. or more to form a silver image, and substantially reading the silver image.

42 Claims, 42 Drawing Sheets

METHOD OF READING AN IMAGE, METHOD OF FORMING A COLOR IMAGE, DEVICE FOR FORMING A COLOR IMAGE, SILVER HALIDE COLOR PHOTOSENSITIVE MATERIAL, AND A DEVICE FOR PROCESSING A PHOTOSENSITIVE MATERIAL

BACKGROUND OF THE INVENTION

1. Field of the Invention

The present invention relates to a method of reading an image, a method of forming a color image, a device for forming a color image, a silver halide color photosensitive material, and a device for processing a photosensitive material, and in particular to a method of reading an image for substantially reading a silver image, a method of forming a color image a device for forming a color image for maintaining the latitude of an exposed silver halide color photosensitive material and easily and rapidly giving an image having excellent saturation, and device for processing a photosensitive material for obtaining a color image easily and rapidly from an exposed color photosensitive material.

2. Description of the Related Art

The principles of color photography which is currently in wide use utilizes color reproduction by a subtractive process. General color negatives are provided with a transparent support, and thereon, photosensitive layers using a silver halide emulsion which is a photosensitive element having light sensitivity to a blue, green or red region. In these photosensitive layers, so-called color couplers for forming the respective complementary colors, that is, yellow, magenta and cyan coloring materials are contained in combination. A color negative film subjected to image-like light exposure by photographing is developed in a color developing solution containing an aromatic primary amine developing agent. In this step, the exposed silver halide grains are developed (i.e. reduced) with the developing agent, to form metal silver, and the simultaneously formed oxidized body of the developing agent is subjected to coupling reaction with the color couplers described above, to form the respective coloring materials. The metal silver (developed silver) formed by development and unreacted silver halide are removed by bleaching and fixing treatment respectively, whereby a coloring material image is obtained. A color photographic paper, which is a color photosensitive material wherein a photosensitive layer having a combination of a similar photosensitive wavelength region and coloring hue is coated on a reflective support, is irradiated optically via a color negative film after developing treatment, and then subjected to similar coloring development, bleaching and fixing treatment, whereby a color print comprising a coloring material image which reproduces an original scene can be obtained.

These systems are widely used at present, but there is demand for improving simplicity and easiness thereof. For example, Japanese Patent Application Laid-Open (JP-A) No. 6-266066 and JP-A No. 6-295035 disclose methods of forming an image by extracting image information showing image-like light exposure onto parts of each color of blue, red and green from color photographic elements of silver halide, that is, a silver image, without forming a coloring material image. According to this method, the photosensitive material can be designed without using a coloring material.

However, even if a color image is formed by applying this method to a commercial color photosensitive material, the resulting image is poor in sensitivity and has much noise. This problem is considered attributable to the qualities of the silver image obtained by development. That is, it is considered that a silver image suitable for reading cannot be formed by conventional development, and a color image formed on the basis of this silver image has much noise, thus bringing about low sensitivity.

In the market of color photography, the so-called color film paper system is conventionally used where an exposed color photosensitive material (hereinafter also called "color film") is developed in a processing laboratory, and the resulting image is printed onto a photographic paper to obtain a color print. In the color photography market observed in recent years, there are the following tendencies: (1) the dispersion of processing sites, that is, the shift from conventional intensive large processing laboratories (large laboratories) where color films collected from shops such as camera shops are developed, and the resulting color prints are returned via the camera shops to the customers, to processing laboratories in shops (mini laboratories) where customers' films are developed in the shops and the color prints are returned on the spot to the customers, and (2) the spread of digital photo images, that is, the spread of electronic recording of images on films after photographing or printing from electronically recorded digital image sources by the advent of digital mini laboratories where photo images are digitally handled. However, with respect to above (1), it is true that the time elapsed from receipt of color films from customers to return of finished prints to the customers is significantly reduced by dispersion of processing sites in mini-laboratories, but under the present circumstances, about 30 minutes is still necessary in which particularly 10 minutes or more is necessary for development of a film. Further, because the developing solution is handled, maintenance is troublesome and there is no room for simplification. With respect to above (2), digitalized service for film information is still time-consuming (e.g. a few days is required), and footholds for the service are limited.

Accordingly, there is demand for the realization of a system in which development onto various image media can be conducted rapidly and easily by significant simplification and rapidness not achieved in present color film paper systems and by converting color images obtained by development of a color film into digital image information.

As a method of meeting this need, International Publications WO 98/19216 and 98/25399 disclose methods in which a color film is subjected to black and white development and the resulting image is read by scanning with reflected light and transmitted light to obtain image information from which a color image is formed. In these methods, the color film is conveyed and simultaneously brought into contact with a developing solution and read successively by scanning, and thus there are disadvantages such as inadequate accuracy of image reading, significant noise in image information, a long treatment time, and a significant fluctuations in processing.

JP-A No. 6-266066 and JP-A No. 6-295035 disclose improved methods of improving reading accuracy by providing a reflective layer in a color film. However, the disclosed methods are not practical because general films distributed on the market cannot be used with these methods.

Further, JP-A No. 9-146447 and JP-A No. 9-204031 disclose methods of obtaining digital image information by scanning-reading an image developed by heating a film containing a developing agent. These methods achieve rapid and simplified development process, but similarly to the JP-A No. 6-266066 and JP-A No. 6-295035 mentioned above, suffer from the problem that general films cannot be used therewith.

JP-A No. 11-52528 discloses a method of obtaining digital image information by scanning reading an image without conducting bleaching treatment after coloring development. This method is a method in which development process is rapid and simplified, and general films can be used, thus solving both of the disadvantages described above. However, mono-focal cameras in the form of a film provided with a lens (e.g., UTSURUNDESU, a product produced by Fuji Photo Film Co., Ltd. and marketed in Japan are popular, and such a camera does not control exposure in a broad light exposure range for the photographed object. It is therefore necessary under the present circumstances that the color film must maintain a broad latitude capable of covering a wide photographing region, and under conditions such as over-exposure or under-exposure, this disclosed art is not satisfactory.

JP-A No. 11-18045 discloses a method of forming an image easily in which a fixing material having a layer containing a fixing agent is laid on a color photosensitive material subjected to a color development step, to dissolve and remove silver halide. This method is also an easy and simplified development method, but the developing solution is easily deteriorated. In particular, picture staining easily occurs in slack periods, and the qualities of the finished picture easily fluctuate. Thus, maintenance of processing stability is difficult.

Further, JP-A No. 9-222701, JP-A No. 10-301241, JP-A No. 11-143045 and JP-A No. 11-271941 disclose a contact heat conductive heating method, a warm air heating method, an infrared heating method and a microwave heating method after a developing solution is applied to a color photosensitive material. According to these methods, the amount of a developing solution can be reduced, and the development process can also be carried out.

The contact heat conductive heating method has excellent efficiency of heat conduction when the color photosensitive material can be contacted closely with a heating means, but there are the problems that the color photosensitive material and the heating means may be stained upon contacting the color photosensitive material with the heating means, and uneven development occurs when they cannot contact each other uniformly. In the warm air heating method and the microwave heating method, a color photosensitive material is heated without contacting any other material, thus lowering heating efficiency, making uniform heating often difficult and temperature control difficult. In the infrared heating method, there are none of the problems of temperature control in spite of non-contact heating, but the color photosensitive material may be fogged by near infrared radiations having wavelengths close to visible rays, and near infrared radiations have poor efficiency of transfer of energy. There is thus the problem that much time is required for heating.

As described above, there is demand on the market for a color image-forming system which is simple, rapid, can deal with digital image information, and provides image qualities comparable in saturation and latitude to general color prints, but this demand is not satisfied under the present circumstances.

In the color photosensitive material described above, an anti-halation layer is not provided, or if provided, an anti-halation layer of black colloidal silver is provided. If the anti-halation layer is not provided, image fading occurs due to halation, or deterioration of light shielding (generation of light fogging) is caused. In a color photosensitive material using black colloidal silver in the anti-halation layer, reading sensitivity or reading accuracy is lowered due to absorption of the black colloidal silver in the infrared region, upon reading of image information by infrared radiations. That is, there arise the severe problems that the absorption of the black colloidal silver in the infrared region becomes a background, which deteriorates the ability to identify the image information, or because of an increase in image density, it becomes difficult to read the image information, and the reading requires much time.

Further, the above-described prior art techniques of photoelectrically reading the image information on a developed film suffer from the problems that upon reading the image information, the absorption of an interlayer in the color photosensitive material becomes a background and reading accuracy is lowered, the fine colloidal silver grains result in noise which worsens resolution and lowers the ability to identify the image information, and due to an increase in image density, it becomes difficult to read the image and reading is time-consuming. Even if one of these problems can be solved, It is difficult to solve all of these problems, which thus is a deterrent to practical use.

SUMMARY OF THE INVENTION

An object of the present invention is to provide a method of reading an image and a method of forming a color image, wherein in reading a silver image obtained by developing a color photosensitive material after light exposure and forming a color image from the silver image information, a silver image suitable for reading can be formed and read to give a highly photosensitive color image.

Another object of the present invention is to provide a method of forming a color image, wherein image information having excellent sharpness can be read rapidly and accurately from a photographed color film, converted into digital image information and utilized.

A further object of the present invention is to provide a method of forming a color image and a device for forming a color image, wherein a color image having practical saturation even upon over-exposure can be obtained by maintaining the latitude of a photographed color film.

A further object of the present invention is to provide a method of forming a color image and a device for forming a color image, wherein digital color image information with less color turbidity can be obtained easily and rapidly from a photographed color film.

An additional object of the present invention is to provide a method of forming a color image and a device for forming a color image, which can output information from a photographed color film easily as a color print or onto various image-recording media such as mediator optical recording, magnetic recording, semiconductor element recording, and optical magnetic recording.

A further object of the present invention is to provide a method of forming a color image which is stable and has less deterioration in finished qualities even in slack periods.

A still further object of the present invention is to provide a device for treating a photosensitive material, wherein development process can be conducted rapidly and easily, and a stain- and fog-free image can be obtained from a general color film or a color paper and can be heat-developed efficiently and stably.

The objects described above can be achieved by the following means:

A first aspect of the present invention is a method of reading an image, which comprises the steps of: exposing a color photosensitive material having at least three photosensitive layers containing blue-, green- and red-photosensitive silver halide emulsions, respectively, on a transparent support; processing the exposed color photosensitive material at a processing temperature of 50° C. or more to form a silver image; and reading the silver image.

A second aspect of the present invention is a method of forming a color image, which comprises the step of forming a color image on the basis of the silver image information read by a method of reading an image comprising the steps of: exposing a color photosensitive material having at least three photosensitive layers containing blue-, green- and red-photosensitive silver halide emulsions, respectively, on a transparent support; processing the exposed color photosensitive material at a processing temperature of 50° C. or more to form a silver image; and reading the silver image.

A third aspect of the present invention is a method of forming a color image, which comprises the steps of: subjecting an exposed silver halide color photosensitive material to development process; reading image information photoelectrically from the obtained image; and converting the read image information into electrical digital image information, wherein (1) the silver halide color photosensitive material contains a decolorizable anti-halation dye, (2) the reading of image information comprises photoelectric reading of the first image information by using light reflected from the processed silver halide photosensitive material (also referred hereinafter as simply to "reflected light") and photoelectric reading of the second image information by light transmitted through the processed silver halide photosensitive material (also referred hereinafter as simply to "transmitted light"), and (3) the read first and second image information is converted into electrical blue, green and red digital image information.

A fourth aspect of the present invention is a method of forming a color image, which comprises the steps of: subjecting an exposed silver halide color photosensitive material to development process; reading image information photoelectrically from the obtained image; and converting the read image information into electrical digital image information, wherein (1) the silver halide color photosensitive material has at least one interlayer containing an infrared absorbing dye, (2) the reading of image information comprises photoelectric reading of the first image information by light reflected from and photoelectric reading of the second image information by light transmitted through the processed photosensitive material, and (3) the read first and second image information is converted into electrical blue, green and red digital image information.

A fifth aspect of the present invention is a silver halide color photosensitive material, for use in photoelectric reading of image information by light reflected from and photoelectric reading of image information by light transmitted through the silver halide color photosensitive material after being development processed, and converting the two kinds of read information into digital image information, which has at least one interlayer containing an infrared absorbing dye having a transmission density of at least 0.05.

A sixth aspect of the present invention is a silver halide color photosensitive material, which comprises on a support at least one silver halide emulsion layer, at least one interlayer containing an infrared absorbing dye having at a transmission density of at least 0.5, and an anti-halation layer containing a decolorizable anti-halation dye.

A seventh aspect of the present invention is a method of forming a color image, which comprises the steps of: subjecting an exposed silver halide color photosensitive material to development process; reading image information photoelectrically from the obtained image; and converting the read image information into electrical digital image information, wherein (1) the reading of image information comprises photoelectric reading of the first image information by using light reflected from and photoelectric reading of the second image information by using light transmitted through the silver halide color photosensitive material after being processed, (2) the silver halide color photosensitive material is subjected to clarification process between the operation of reading the first and second image information, and (3) the read first and second image information is converted into electrical blue, green and red digital image information.

An eighth aspect of the present invention is a device for forming a color image, which comprises a development process part for subjecting an exposed silver halide color photosensitive material to development process, a first image information reading part for photoelectric reading of the first image information by using light reflected from the obtained image, a second image information reading part for photoelectric reading of the second image information by using light transmitted through the image, a clarification process part for subjecting the silver halide color photosensitive material to clarification process between the first and second image information reading parts, and an arithmetic processing part for converting the read first and second image information into electrical blue, green and red digital image information.

A ninth aspect of the present invention is a method of forming a color image, which comprises the steps of: subjecting an exposed silver halide color photosensitive material to development process; reading image information photoelectrically from the obtained image; and converting the read image information into electrical digital image information, wherein (1) the reading of image information includes photoelectric reading of the first image information by light reflected from and photoelectric reading of the second image information by light transmitted through the processed photosensitive material, (2) the silver halide color photosensitive material is dried between the reading operation of the first and second image information, and (3) the read first and second image information is converted into electrical blue, green and red digital image information.

A tenth aspect of the present invention is a device for forming a color image, which comprises a development process part for subjecting an exposed silver halide color photosensitive material to development process, a first image information reading part for photoelectric reading of the first image information by light reflected from the obtained image, a second image information reading part for photoelectric reading of the second image information by light transmitted through the image, a heat drying part for drying the silver halide color photosensitive material between the first and second image reading parts, and an arithmetic processing part for converting the read first and second image information into electrical blue, green and red digital image information.

An eleventh aspect of the present invention is a method of forming a color image, which comprises the steps of: subjecting an exposed silver halide color photosensitive material to development process; reading image information photoelectrically from the obtained image; and converting the read image information into electrical digital image information, wherein (1) the development process is development process by applying a developing solution to the silver halide color photosensitive material and heating the photosensitive material, (2) the reading of image information includes photoelectric reading of the first image information by using light reflected from and photoelectric reading of the second image information by using light transmitted through the processed photosensitive material, and (3) the read first and second image information is converted into electrical blue, green and red digital image information.

A twelfth aspect of the present invention is a device for forming a color image, which comprises a conveying part for conveying an exposed silver halide color photosensitive material, a development process part arranged above the conveying part, a first image information reading part for photoelectric reading of the first image information by using light reflected from the image on the developed silver halide color photosensitive material, a second image information reading part for photoelectric reading of the second image information by using light transmitted through the image, and said development part includes a supplying part for supplying a developing solution to the silver halide color photosensitive material and a heating part for heating the silver halide color photosensitive material containing the supplied developing solution.

A thirteenth aspect of the present invention is a method of forming a color image, which comprises the steps of: subjecting an exposed silver halide color photosensitive material to development process; reading image information photoelectrically from the obtained image; and converting the read image information into electrical digital image information, wherein (1) the developing solution used in development process is composed of a developing agent-containing solution (also called developing agent solution) having a pH value of 7 or less and an alkali agent-containing solution (also called alkali agent solution), and (2) the development process is a development process by supplying the developing agent-containing solution and the alkali agent-containing solution to the silver halide color photosensitive material and heating the silver halide color photosensitive material to which the developing solution was supplied.

A fourteenth aspect of the present invention is a photosensitive material processing device for processing a photosensitive material in which an exposed color photosensitive material is subjected to development process by supplying a developing solution thereto and heating thereof to form an image, wherein a heating device for the heating is provided with a far infrared-light-emitting heater.

The feature of the third aspect described above lies in a method of forming a color image wherein (1) an exposed silver halide color photosensitive material is subjected to development process to form an image on each of the 3 photosensitive layers i.e. the front layer, the back layer and the interlayer therebetween, (2) then image elements of an image on the front and/or back photosensitive layer of the color photosensitive material are read photoelectrically by reflected light with an image scanner, to obtain electrical image information (referred to as the first image information), while image elements of an image on the photosensitive layers (including the intermediate photosensitive layer) not read by reflected light are read photoelectrically by transmitted light, to obtain electrical image information (referred to as the second image information), and (3) then the image information read by reflected light and transmitted light is subjected to arithmetic processing to obtain electrical blue, green and red digital image information, characterized in that a color photosensitive material containing a decolorizable anti-halation dye is used as the color photosensitive material. Either the first image information or the second image information may be read first.

To maintain the high resolution of the photosensitive material, the color photosensitive material should be provided with an anti-halation layer, but the conventionally used anti-halation layer contains black silver colloidal fine grains so that, due to the absorption of the silver grains in the anti-halation layer, the ability to distinguish the image from the background is lowered and highly accurate reading is not feasible, if it is attempted to obtain the image rapidly by reading the image photoelectrically just after the development step. This defect is particularly significant when the reading of image information is conducted using reflected light, and this is a severe problem particularly for a black and white photosensitive material whose image is also composed of silver grains. According to the present invention, this problem is essentially solved by using a decolorizable dye which loses its light absorptive power in a developing solution, in place of colloidal silver grains, as the light absorbing material for anti-halation.

A preferable mode of the third aspect described above is a method of improving the qualities of digital image information by further image processing of the resulting digital image information. By adding such image processing, output of the information to various color prints such as silver salt color prints and ink jet and color thermal transfer, storage of the information on various image recording media such as optical, magnetic and semiconductor elements, and utilization of the image there among are even more efficiently made possible.

When an image comprising silver developed by mere development process is read by reflected light, the reflection on the non-image part is high, and thus the S/N ratio of the image part and the non-image part is raised to achieve reading with less noise. However, when an image is read by transmitted light, high opaqueness in the non-image part causes a reduction in the S/N ratio of the image part and the non-image part, which worsens reading accuracy. On the other hand, an image in the intermediate photosensitive layer cannot be read by reflected light, and when read by transmitted light, the image can be read more accurately as the transparency of the non-image part is increased. Accordingly, reading accuracy during reading by either reflected light or transmitted light can be improved by using a decolorizable anti-halation dye in place of black colloid silver as a conventional light absorbing material in the anti-halation layer.

Another mode of the third aspect described above is a method of applying reading by reflected light to a photosensitive layer read highly accurately by reflected light. A method of extracting image information by reading the uppermost and lowermost photosensitive layers of the color photosensitive material respectively by reflected light and by reading the image in the interlayer therebetween by transmitted light can achieve good separation of each image information such that highly accurate image information can be obtained. The effect of this treatment where the first image information is read under the condition of highly accurate reading by reflected light is particularly significant for the qualities of an overexposed image such as in the case of photographing with an exposure-fixed camera such as the aforementioned camera "Utsurundesu".

In the third aspect described above, a mode using black and white development is also preferable. It is evident that the effect of the present invention contributes greatly to the improvement of image information readability for a black and white image composed of silver. If black and white development is used, there can be brought about advantages such as reduction in development time, prevention of staining with a developing solution, and easy management of a developing solution.

The decolorizable anti-halation dye used in the third aspect described above has a minimum absorbance of 0.2 or more in the visible range of 400 to 700 nm, and the ratio of the maximum to minimum absorbance is at least 5.

The feature of the fourth aspect described above lies in a method of forming a color image wherein (1) an exposed silver halide color photosensitive material is subjected to a development process to form an image on the 3 photosensitive layers (R, G and B photosensitive layers), (2) then image elements of an image on the front and/or back photosensitive layer of the color photosensitive material are read photoelectrically by reflected light with an image information reading unit such as an image scanner, to obtain electrical image information (referred to as the first image information), while image elements of an image on the photosensitive layers (including the intermediate photosensitive layer which is usually the G photosensitive layer) not read by reflected light are read photoelectrically by transmitted light, to obtain electrical image information (referred to as the second image information), and (3) then the image information read by reflected light and transmitted light is subjected to arithmetic processing to obtain electrical blue, green and red digital image information, characterized in that the interlayer of the color photosensitive material contains an infrared radiation absorbing coloring material.

The method wherein the color film is subjected to development process and an image is read from the film without being subjected to subsequent processing steps achieves a significant effect for simplification of development process of the color film and for reduction of the necessary time for development process. On the other hand, when the image information is read photoelectrically after the development step, the remaining fine grains of colloidal silver halide overlap with the image information on the other layers to cause light scattering by developed silver, thus making accurate reading difficult and causing a deterioration in factors affecting image quality such as resolution, color turbidity, and color reproducibility. According to the method of the present invention using a color film containing an infrared radiation absorbing coloring material in the interlayer, a photosensitive layer remains at the reading side rather than in the interlayer and the noise in the back is eliminated, whereby the qualities of the read image are improved to solve the present problem of enabling easy and rapid access to an image and ensuring the qualities of the image.

Further, when this color film contains not only the infrared radiation absorbing coloring material in the interlayer but also the decolorizable anti-halation dye to be decolored in the development process in place of fine grains of black silver in the anti-halation layer, the reading of the second image information by transmitted light can be conducted without the adverse effect of the anti-halation layer of high transmission density. The sensitivity and accuracy of reading of the second image information can be improved, whereby the object of the present invention can be further demonstrated. Further, functions which are dependent on the infrared radiation absorbency of the anti-halation layer, such as detection of a color film in a developer and adjustment of frame feeding in a camera, are performed by the interlayer containing the infrared radiation absorbing coloring material, thus eliminating the problem.

The method of forming a color image in the fourth aspect described above is a method not only making it possible to obtain an image easily and rapidly, but also improving the qualities of digital image information by further image processing of the resulting digital image information. By this image processing, output of the information to various color prints such as silver salt color prints and ink jet and color thermal transfer, storage of the information on various image recording media such as optical, magnetic and semiconductor elements, and utilization of the image thereamong are realized even more efficiently.

The feature of the seventh aspect described above lies in a method of forming a color image wherein (1) an exposed silver halide color photosensitive material is subjected to development process to form an image on the 3 photosensitive layers (R, G and B photosensitive layers), (2) then image elements of an image on one or more photosensitive layers of the color photosensitive material are read photoelectrically by reflected light with an image scanner, to obtain electrical image information (referred to as the first image information), while image elements of an image on one or more photosensitive layers including the other photosensitive layer are read photoelectrically by transmitted light, to obtain electrical image information (referred to as the second image information), and (3) then the first and second image information is subjected to arithmetic processing to obtain electrical blue, green and red digital image information, characterized in that the developed color photosensitive material is subjected to a clarification process between the operation of reading the first image information and the operation of reading the second image information.

When an image obtained by mere development process without conducting the conventional subsequent processes is read by reflected light, the reflection on the non-image part is high, and thus the S/N ratio of the image part and the non-image part is raised to achieve reading with less noise. However, when the image is read by transmitted light, high opaqueness in the non-image part causes a reduction in the S/N ratio of the image part and the non-image part, which worsens reading accuracy. On the other hand, the image in the intermediate photosensitive layer cannot be read sufficiently by reflected light, and when read by transmitted light, the image can be read more accurately as the transparency of the non-image part is increased.

The seventh and eighth aspects described above are characterized in that the first image information is read under the condition of highly accurate reading by reflected light, and after the color photosensitive material is subjected to a clarification process, the second image information is read under the condition of highly accurate reading by transmitted light. The accuracy of each reading is so high that the electrical blue, green and red digital image information obtained by conversion of the read information can have good qualities with high saturation in a broad light-exposure range. The effect of the clarification process is particularly significant for improvement of the qualities of an image upon over-exposure frequently caused in photographing by cameras such as the aforementioned "Utsurundesu".

In addition to fixing agents ordinarily used for silver halide photosensitive materials, a fixing agent selected from the compounds of the following general formulae [FI], [FII] and [FIII] is incorporated into the processing solution for the clarification process, whereby the rate of transparentization and degree of transparency are improved, thereby further improving the effect of the present invention on reading accuracy of digital image information, saturation of an image and facilitation of the process.

The electrical blue, green and red digital image information obtained by the method of forming a color image in the seventh, ninth, and eleventh aspects described above can be output into arbitrary output means such as color print, ink jet, magnetic and optical recording means.

In particular, this digital image information is further subjected to image processing for improvement of the characteristics of image qualities and for image modification, and the digital image information thus image-processed is applied to the image output means described above, whereby the effect of the present invention can be particularly demonstrated.

In the seventh, ninth, eleventh and fourteenth aspects described above, the image information may be read either in a scanning reading system by conveying the color photosensitive material and simultaneously reading it with a line sensor arranged perpendicular to the direction of conveying, or in a reading system using an area sensor for reading the entirely of an image frame simultaneously. In the latter case, a device provided with a reservoir in a conveying portion to suspend conveying of the film in a reading part during image reading is used. Further, by providing the device with the reservoir, a magenta coloring material image formed in the intermediate photosensitive layer and a cyan coloring material image formed in the red-photosensitive layer at the side of the support can also be read by one image reading device by changing the color sensitivity of a reading sensor.

The feature of the ninth aspect described above lies in a method of forming a color image wherein (1) an exposed silver halide color photosensitive material is subjected to development process to form an image on the respective photosensitive layers (R, G and B photosensitive layers), (2) then image elements of an image on one or more photosensitive layers are read photoelectrically by reflected light with an image scanner, to obtain electrical image information (referred to as the first image information), while image elements of an image on one or more photosensitive layers including the other photosensitive layer are read photoelectrically by transmitted light, to obtain electrical image information (referred to as the second image information), and (3) then the first and second image information is subjected to arithmetic processing to obtain electrical blue, green and red digital image information, characterized in that the developed color photosensitive material is heated and dried between the operation of reading the first image information and the operation of reading the second image information.

When the color photosensitive material is moistened with the processing solution, a dispersion of fine oil droplets containing a coupler is dispersed in the photosensitive layer. Because of the light scattering caused-thereby, the reflection on the non-image part on the front layer is so high that the ability to distinguish the non-image part from the image part is improved by reading with reflected light, such that highly accurate image reading can be achieved. When the color photosensitive material is dried, this light scattering disappears and the transparency of the non-image part is increased, and thus the ability to distinguish the non-image part from the image part by reading with transmitted light is improved. The present invention is characterized in that the accuracy of image reading is improved by sophisticatedly utilizing optical characteristics by drying and moistening the photosensitive layer.

That is, the method of the present invention is a method in which the first information on the front and/or back is read under the condition of high reading accuracy by reflected light, and after the color photosensitive material is dried by heating to raise transparency, the second image information on at least the interlayer is read under the condition of high reading accuracy by transmitted light, and the first and second image information is converted by arithmetic processing to obtain electrical blue, green and red digital image information. The effects of this method, wherein drying and moistening of the photosensitive layers are combined with the reading method, are the improvement of the accuracy of reading of image information, improvement of image saturation, and rapidness of the process. Further, the reading accuracy is maintained in a broad exposure range, so the effect is particularly significant for improvement of the qualities of an overexposed image which is easily obtained by photographing by exposure-fixed cameras such as "Utsurundesu".

The color photosensitive material applicable to the ninth aspect described above is not particularly limited, but it is preferably a color photosensitive material having a polyester support so as to be able to sufficiently endure rapid drying by intensive heating after reading of the first image information.

The eleventh aspect described above is characterized in that the means of heat development is incorporated into the easy and rapid image access method which utilizes the image information electrically extracted after the development without conducting the entire process of the development process of the photographed color photosensitive material. In this way, image extraction accuracy is improved and processes are carried out more rapidly and easily. That is, the eleventh aspect is a method of forming a color image wherein (1) an exposed silver halide color photosensitive material is subjected to development process to form an image on the 3 photosensitive layers, i.e. the front layer, the back layer and interlayer therebetween, (2) then image elements of an image on one or more photosensitive layers are read photoelectrically by reflected light with an image scanner, to obtain electrical image information (referred to as the first image information), while image elements of an image on one or more photosensitive layers including the other photosensitive layer are read photoelectrically by transmitted light, to obtain electrical image information (referred to as the second image information), and (3) then the first and second image information is subjected to arithmetic processing to obtain electrical blue, green and red digital image information, characterized in that the development process is conducted by using a step of supplying a developing solution to the color photosensitive material and a step of heating the color photosensitive material to which the developing solution was supplied.

By using a development process involving supplying a developing solution and heating the color photosensitive material to which the developing solution was supplied, there are the following advantages. First, the progress of development is limited to the heating time, so that the control of development conditions is easy, suitable photographic characteristics can be obtained by suppressing over-development or fogging, and performance is stable and less influenced by air temperature. Second, the photosensitive layer is dried by heating, which increases the transparency thereof, improving the accuracy of reading the image by transmitted light which is a limit to reading accuracy. Third, the developing solution is stored at ordinary temperatures except during heat treatment, so that the stability thereof over time is good. Thus, control of development is easy, and simple and inexpensive facilities suffice for the development.

The most important advantage is that in this development system, rapid heating and rapid termination of development (termination of development by drying the processing solution) are feasible, thus solving the problem of wet development of the silver halide photosensitive material and realizing rapid and dry treatment operation.

The reading of the image information is a method in which an image on the front layer and/or the back layer (which both provide high accuracy when reading with reflected light) is read photoelectrically by reflected light to provide the first image information, and at least the interlayer is photoelectrically read highly accurately by transmitted light while utilizing the advantage of high transparency by heating. The read information is converted by arithmetic processing into electrical blue, green and red digital image information. Because the transparency of the photosensitive layer is high, an over-exposed image can also be read in a broader range, and saturation is improved (that is, color turbidity is decreased). This effect of enlarging the exposure latitude is particularly significant for improvement of the qualities of an over-exposed image frequently caused in photographing with a mono-focal camera.

The color photosensitive material applicable to the eleventh, thirteenth, and fourteenth aspects described above is not particularly limited, and any general photographic color films on the market can be used. However, a color photosensitive material having a polyester support having high durability against rapid and high-temperature development is particularly preferable. Further, the polyester support can be made thin, thus bringing about the advantage of reducing the reading noise attributable to the support. A color photosensitive material having, among polyester supports, a polyethylene na-phthalate support (for example, an APS film) is preferable.

The thirteenth aspect described above is an easy and rapid image access method which utilizes image information electrically extracted after development without conducting the entire process of the development process of a photographed color photosensitive material, characterized in that the means of heat development is adopted to improve the image extraction and to effect processing more rapidly and easily, and a developing agent and an alkali agent in a composition of the developing solution are not mixed until just before development in order to improve their stability. That is, (1) a developing agent solution, which is stable due to neutral pH but has poor developing activity, and an alkali agent solution having the ability to activate development are supplied separately to an exposed color silver halide photosensitive material and then mixed as the composition of the developing solution, and the color photosensitive material containing the developing solution is developed by heating, (2) image elements of an image on each photosensitive layer are read photoelectrically with an image scanner, to obtain electrical image information, and (3) the obtained image information is subjected to arithmetic processing to obtain electrical blue, green and red digital image information. Due to these processes, the image information can be output to various color image means or stored on electrical, magnetic or optical recording media for later use.

By adopting the development process characterized by the two features of (1) separate supplying of the developing agent and the alkali agent in the developing solution and (2) heating of the color photosensitive material containing the developing solution, there are the following advantages. First, the progress of development is limited to the heating time, so the control of development conditions is easy, over-development and fogging are suppressed, and the influence of air temperature is minimized. Second, the photosensitive layer is dried by heating to increase transparency, thereby improving the accuracy of reading the image by transmitted light which limits to reading accuracy. Third, the developing solution is stored in a stable form until just before development and many modes are treatment of disposal type, so that development can be controlled easily and the processing facilities may be simple and inexpensive.

The most important advantage is that, in this development system, rapid heating and rapid termination of development (termination of development by heating) are feasible, thus solving the problem of wet development of the silver halide photosensitive material to realize rapid and dry treatment operation.

According to the thirteenth aspect described above, the development process is followed by a clarification process, thereby removing silver halide, which is a cause of noise for image materials and developed silver, as necessary. Consequently, the transparency of the developed film can be improved, and reading accuracy can be improved.

According to the method of forming a color image in the thirteenth aspect described above, the blue, green and red digital image information converted from the read image information is output directly or via arbitrary recording media such as magnetic or optical recording elements or semiconductor elements to various color printers for, for example color prints, inkjet prints and thermal photosensitive transfer prints, during which the image can be processed to further improve the qualities and utilization of the image.

In the thirteenth aspect described above, a coloring material image is obtained by using a color developing agent and can be read while making the image correspond to the wavelength of each coloring material. Thus, high-quality digital image information can be obtained with good resolution among the images and with less color turbidity.

According to the fourteenth aspect described above, a far infrared heater is provided as a heating means, whereby the color photosensitive material can be heated in a non-contact system thus preventing staining of the color photosensitive material. There is a great difference between the wavelengths of far infrared radiations and visible rays, and therefore the color photosensitive material is not fogged by exposure with far infrared radiations.

According to the fourteenth aspect described above, the heating means is regulated such that the surface temperature of the color photosensitive material is in the range of 50 to 90° C., whereby the color photosensitive material is heated suitably without deformation, and development is promoted. The surface temperature of the color photosensitive material is preferably 55 to 85° C., and more preferably 60 to 80° C.

When the surface temperature of the color photosensitive material is less than 50° C., development is not promoted, whereas when the surface temperature exceeds 90° C., the color photosensitive material may be deformed.

In the fourteenth aspect described above, the wavelength of the far infrared heater is 3 $\mu$m to 1 mm, and preferably 3 $\mu$m to 25 $\mu$m. If the wavelength is 3 $\mu$m to 1 mm, light of this wavelength is absorbed by resonance with the molecular vibration of water in the photosensitive layer, thus efficiently heating the color photosensitive material.

The far infrared heater may be a bar-shaped heater or a plate-shaped heater. For example, a straight heater or a far infrared irradiation hollow ceramic heater manufactured by AMK Inc may be used.

Further, as the color photosensitive material is heated, water contained in the photosensitive layer is evaporated. Thus, during heating, it is preferable to supply water to the color photosensitive material by a moistening means. For example, a steam generator or a mist generator can be used as the moistening means. The steam generator generates steam by heating water. As the mist generator, a spray nozzle device for spraying compressed water through narrow gaps (spray nozzles), an ultrasonic mist generator for forming mist by vibration with an ultrasonic wave generator, or a mist generator using a vibrator causing cavitations for jetting fine water can be used.

According to the fourteenth aspect described above, the means of heat development can be incorporated into the easy and rapid image access method of electrically extracting and utilizing image information just after the development step without conducting the entire process of development, when the method is applied to a color photosensitive material which has been photographed. The accuracy of image extraction is thereby improved, and extraction can be carried out more rapidly and easily. As the development step in this case, black and white development process may be used.

DESCRIPTION OF THE PREFERRED EMBODIMENTS

[First and Second Aspects]

Figure 1:
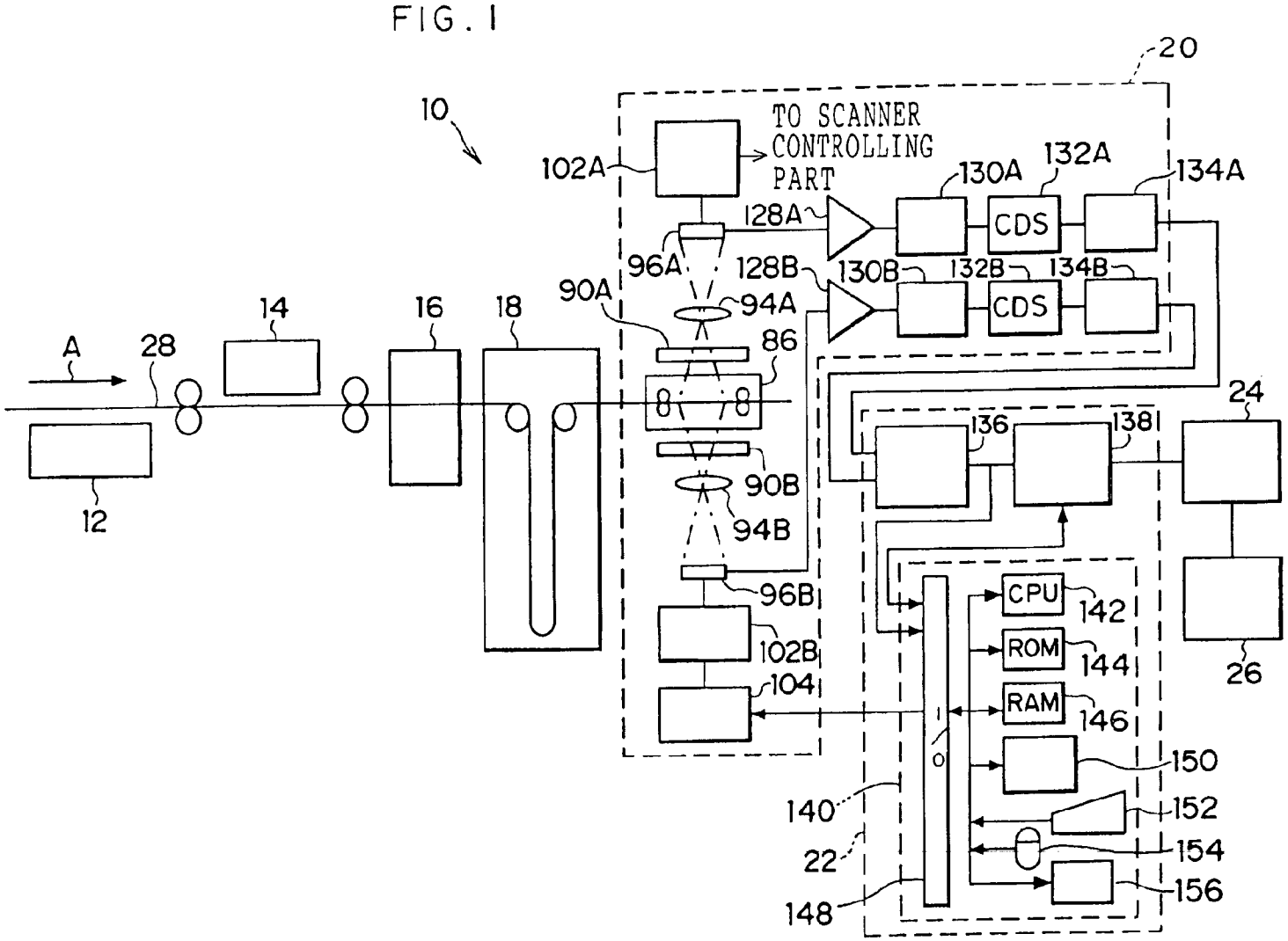
FIG. 1 is a diagram showing an image processing system according to the first and second aspects of the present invention.

Hereinafter, the first and second aspects of the present invention are described in more detail.

The method of reading an image according to the present invention involves developing a color photosensitive material after light exposure to form a silver image, and then reading the silver image by a scanner during or after development. The method of forming a color image according to the present invention involves digitalizing the read silver image information, image-processing the image data, and outputting to data into files or prints.

The photosensitive material used in the present invention comprises, on a support, at least three photosensitive layers which are a blue photosensitive layer (B layer) which is sensitive to blue light, a green photosensitive layer (G layer) which is sensitive to green light and a red photosensitive layer (R layer) which is sensitive to red light. These layers are generally arranged in the order of the red, green and blue photosensitive layers from the support side. However, other orders may be used depending on the object. For example, the orders described in paragraph 162 in JP-A No. 7-152129 may be used. Further, the photosensitive layers may be divided into a plurality of silver halide emulsion layers that are substantially identical in color sensitivity but have different degrees of light sensitivity.

Because a silver image after development is read in the present invention, each photosensitive layer in the photosensitive material contains at least photosensitive silver halide grains and a binder. However, a photosensitive material containing a coupler can also be used in the present invention. Further, a developing agent is preferably contained, but may be added from the outside. Hereinafter, the respective constitutional components are described.

The silver halide grains contained in the photosensitive material are added to the photosensitive layer in the form of a sensitized silver halide emulsion. The silver halide may be silver iodobromide, silver chloroiodobromide, silver bromide, silver chlorobromide, silver iodochloride, or silver chloride. The composition is selected depending on the characteristics to be imparted to the sensitized silver halide. That is, silver iodobromide or silver chloroiodobromide with a high content of silver bromide can be preferably used as ordinarily used in highly photosensitive materials for photographing. The content of silver iodide is preferably 20% or less. Further, for the purpose of utilizing rapid developing characteristics or utilizing low haze in a dispersion in gelatin in the photosensitive material, a so-called high silver chloride emulsion having a high silver chloride content can also be preferably used. When the high silver chloride emulsion is used, the content of silver halide in the halogen composition is preferably 60% or more, more preferably 80% or more, and most preferably 90% or more.

Although silver halide grains of various shapes can be used, the distribution of the sizes of these grains is preferably monodisperse. The mono-dispersibility of the grain sizes can be judged by the so-called coefficient of variation obtained by dividing the standard deviation of the statically obtained grain size by the average grain size. The coefficient of variation of the silver halide emulsion is preferably 40% or less. It is more preferably 30% or less, and most preferably 20% or less.

The silver halide emulsion is composed preferably of those grains in which tabular grains, which have a grain thickness of 0.2 $\mu$m or less and have an aspect ratio of 2 to 80 determined by dividing the diameter of the projected grain by the grain thickness, account for 50% of the entire projected area. The aspect ratio is more preferably 5 or more, more preferably 8 or more, and most preferably 12 or more. When relatively small grains having grain sizes of about 0.5 $\mu$m or less expressed in terms of the diameter of a sphere having the same volume as said grain are used, those grains having a degrees of flatness of 25 or more, as determined by dividing the aspect ratio by the grain thickness, are preferable.

Techniques of using these tabular grains of a high aspect ratio and characteristics thereof are disclosed in U.S. Pat. Nos. 4,433,048, 4,434,226, 4,439,520 and the like. Further, techniques of tabular grains of an ultrahigh aspect ratio and having a grain thickness of 0.07 $\mu$m or less are disclosed in U.S. Pat. Nos. 5,494,789, 5,503,970, 5,503,971 and 5,536,632, and European Patent Nos. 0699945, 0699950, 0699948, 0699944, 0701165 and 0699946.

With respect to the techniques of tabular grains of a high silver chloride emulsion, U.S. Pat. Nos. 4,399,215, 4,400,463 and 5,217,858 disclose photographic emulsions comprising plate-shaped high-silver-chloride grains having the (111) face as the major plane. On the other hand, U.S. Pat. Nos. 5,292,632 and 5,310,635 disclose photographic emulsions comprising plate-shaped high-silver-chloride grains having the (100) face as the major plane. These various plate-shaped emulsion grains can be preferably used.

For preparation of plate-shaped thin grains of a high aspect ratio, it is important to control the concentration of the binder, the temperature, the pH, the type of excess halogen ions, the concentration of the ions, and the rate of supplying a reaction solution at the time of forming cores. It is important that the rate of adding the reaction solution for growth of grains is regulated and also that an optimum binder is selected for the process of growth including formation of grains, so that the formed plate-shaped cores can grow not in the direction of thickness but selectively in the direction toward the peripheral edges of the plate-shaped cores. For this purpose, a gelatin of a low content of methionine or a gelatin having an amino group modified with phthalic acid, trimellitic acid or pyromellitic acid, is advantageous.

Further, when the silver halide grains which are used are in tabular form, it is preferable that the distribution of the grain thickness thereof has a low coefficient of variation. The coefficient of variation is preferably 40% or less, more preferably 30% or less, and most preferably 20% or less.

The silver halide grains are prepared to have various structures besides the forms described above. For example, the grains are composed of a plurality of layers having different halogen compositions.

Silver iodobromide grains used ordinarily in photographing materials are provided preferably with layers of different contents of iodine. For the purpose of regulating the development ability, it is possible to use the so-called core/shell grains having a higher content of iodine in the inside, wherein cores of a higher content of iodine covered with shells of a lower content of iodine. Or core/shell grains of a higher content of iodine in the outside may be used in which the cores are covered with shells of a higher content of iodine. The technique of covering cores of a lower content of iodine with a first shell of a higher content of iodine and then precipitating a second core of a lower content of iodine thereon is also known to impart high sensitivity. In the shell (corresponding to the fringes of outer edges of the tabular grains) precipitated on the high-iodine phase in this type of silver halide grains, a dislocation line based on irregular crystals is formed to contribute to achieving high sensitivity. For precipitation of the high-iodine phase, it is preferable to use a method of adding a solution of a water-soluble iodide, such as potassium iodide, singly or together with a solution of a water-soluble silver salt such as silver nitrate, a method of introducing fine silver iodide grains into the system, or a method of adding a compound (e.g. acetamide iodide) releasing iodide ions upon reaction with an alkali or a nucleophilic agent. Further, in the case of high-silver-chloride grains, a phase having a different halogen composition is preferably formed in the grains. A plurality of layers can be laminated in the form of concentric circles by changing the halogen composition during formation of the tabular grains. For example, a core (nucleus) of a higher content of silver bromide is arranged in the center of a grain around which a shell of a lower content of silver bromide can be formed. On the contrary, a shell of a higher content of silver bromide can be formed on a core of a higher content of silver chloride. Further, a plurality of shells may be formed around the core. Accordingly, regions of higher or lower contents of silver bromide can be formed in a donut form. By adding a very small amount of iodine to high-silver-chloride grains, the physical properties of the silver halide crystals can be changed significantly, and thus it is preferable to add iodine at an arbitrary concentration to the cores or shells described above. Preferably, a layer with a high content of silver bromide or silver iodide is provided on the outer periphery of the plate-shaped grain, or a layer with a high content of silver bromide or silver iodide is provided in a middle shell. In the shell (corresponding to the fringes of the outer edges of the tabular grains) precipitated on a layer of a high content of silver bromide or silver iodide, a conversion line based on irregular crystals is formed to contribute to achieving high sensitivity. In addition, epitaxial protrusions may be precipitated on the surfaces of the various host grains described above.

Further, the silver halide grains are doped preferably with polyvalent metal ions. The polyvalent metal ions can be introduced in the form of halide or nitrate into the grains during formation, but are preferably introduced in the form of a metal complex (halogeno complex, anmine complex, cyano complex, nitrosyl complex, or the like.) having a polyvalent metal ion as the central metal. Among these complexes, a metal complex for providing a transient and hollow electron trap in the sensitizing process is preferably contained.

The metal complex acting as a transient electron trap in the sensitizing process is a complex wherein a ligand such as cyanide ion capable of greatly splitting the d orbit in spectrochemical series is coordinated in a metal ion belonging to the first, second or third transition series. In the system of coordination, the complex is a hexadentate complex having 6 ligands coordinated in an octahedral form in which the number of cyan ligands is 4 or more. When not all of these 6 ligands of metal ions are cyan ligands, the remaining ligands can be selected from halide ions such as fluoride, chloride and bromide ions, inorganic ligands such as SCN, NCS and $H_2O$, and organic ligands such as pyridine, bipyridine, phenanthroline, imidazole, and pyrazol. Further, complexes in which organic ligands such as pyridine, bipyridine, phenanthroline, imidazole, and pyrazol account for half or more coordination sites can also be preferably used. Preferable central transition metals include iron, cobalt, ruthenium, rhenium, osmium, and iridium.

In the emulsion, a metal complex for providing a deep electron trap in the sensitizing process is preferably used in combination with the metal complex for providing a hollow electron trap in the sensitizing process described above. Examples of such metal complexes for providing a deep electron trap in these sensitizing processes include ruthenium, rhodium, palladium or iridium having a halide ion or thiocyanate ion as a ligand, ruthenium having one or more nitrosyl ligands, and chromium having a cyanide ion ligand.

In the silver halide grains, divalent anions of the so-called chalcogen elements such as sulfur, selenium, and tellurium are preferably doped in addition to the metal complexes described above. These dopants are also effective for achieving high sensitivity and modifying dependence on exposure conditions.

Preparation of the silver halide grains can be conducted on the basis of known methods, that is, those described by P. Glafkides *in Chimie et Phisique Photographique*, Paul Montel, 1967; G. F. Duffin, *Photographic Emulsion Chemistry*, Focal Press, 1966; and V. L. Zelikman et al., *Making and Coating of Photographic Emulsion*, Focal Press, 1964. That is, the silver halide grains can be prepared in various pH ranges by an acid process, a neutral process and an ammonia process. Further, as the method of feeding a water-soluble silver salt and a water-soluble halogen salt solution as the reaction solution, a method of mixing at one side or a method of simultaneous mixing can be used singly or in combination. Furthermore, a control double jet method for controlling addition of the reaction solution to maintain a desired pAg during the reaction is preferably used. In addition, a method of keeping the pH value constant during the reaction is also used. For formation of the grains, a method of controlling the solubility of silver halide by changing the temperature in the system, the pH or pAg value can also be used, and thioethers, thioureas and rhodan salts can also be used as the solvent. These examples are described in Japanese Patent Application Publication (JP-B) No. 47-11386, JP-A No. 53-144319, and the like.

Preparation of the silver halide grains is conducted usually by adding a solution of a water-soluble silver salt such as silver nitrate and a solution of a water-soluble halogen salt such as an alkali halide to a solution of a water-soluble binder such as gelatin under controlled conditions. After silver halide grains are formed, excess water-soluble salts are preferably removed. This process is called a desalting or water-washing step, and various means are used. For example, it is also possible to use a noodle-washing method in which a gelatin solution containing silver halide grains is gelled and cut into noodle-shaped strips and the water-soluble salts are washed out with cold water, or a precipitation method in which inorganic salts (e.g. sodium sulfate) consisting of polyvalent anions, anionic surfactants, anionic polymers (e.g. sodium polystyrene sulfonate), or gelatin derivatives (e.g. aliphatic acylated gelatin, aromatic acylated gelatin, aromatic carbamoyl gelatin etc.) are added to aggregate the gelatin to remove excess salts. The precipitation method is preferably used because excess salts can be rapidly removed. Also, a method of removing water-soluble salts by passing the reaction solution during or after formation of grains of a silver halide emulsion through an ultra-membrane is also preferable.

Usually, a chemically sensitized silver halide emulsion is preferably used. Chemical sensitization contributes to confer high sensitivity on the prepared silver halide grains and to confer stability to light exposure and storage stability thereon. In chemical sensitization, generally known sensitization techniques can be used singly or in combination. As the chemical sensitization method, a chalcogen sensitization method using a sulfur, selenium or tellurium compound is preferably used. These sensitizers used are compounds that, when added to the silver halide emulsion, release the above-described chalcogen element to form silver chalcogenide. Further, combined use of these compounds is also preferable in order to achieve higher sensitivity and to suppress fogging.

Further, a noble metal sensitization method using gold, platinum, iridium etc. is also preferable. In particular, a gold sensitization method using chloroauric acid singly or in combination with a gold ligand such as thiocyanate ions can achieve high sensitivity. When sensitization with gold is used in combination with sensitization with chalcogen, higher sensitivity can be achieved. Also preferably used is the so-called reduction sensitization method of using a compound having a suitable reducing ability during formation of grains, thus introducing reducing silver nuclei to achieve high sensitivity. A reduction sensitization method in which an alkynyl amine compound having an aromatic ring is added at the time of chemical sensitization is also preferable.

It is also preferable to use various compounds having absorptivity toward silver halide grains in order to control the reactivity in chemical sensitization. In particular, a method of adding a nitrogenous heterocyclic compound or a mercapto compound, or sensitizing coloring materials such as cyanine and merocyanine prior to sensitization with chalcogen or gold, is particularly preferable. Although the reaction conditions for chemical sensitization vary depending on the object, the temperature is 30 to 95° C., preferably 40 to 75° C., pH is 5.0 to 11.0, preferably 5.5 to 8.5, and pAg is 6.0 to 10.5, preferably 6.5 to 9.8. The techniques of chemical amplification are described in JP-A No. 3-110555, JP-A No. 5-241267, JP-A No. 62-253159, JP-A No. 5-45833, JP-A No. 62-40446 etc.

The photosensitive silver halide emulsion is subjected preferably to the so-called spectral sensitization for conferring sensitivity in a desired light wavelength range. In particular, photosensitive layers having sensitivity to blue, green and red lights are integrated in the color photosensitive material to reproduce colors true to the original. Such sensitivity is conferred by spectral sensitization of silver halide. Spectral sensitization makes use of the so-called spectrally sensitizing coloring material which is adsorbed into silver halide grains to confer sensitivity in their absorption wavelength range.

Example of these coloring materials include cyanine coloring material, merocyanine coloring material, complex cyanine coloring material, complex merocyanine coloring material, hollow polar coloring material, hemicyanine coloring material, styryl coloring material and hemioxanol coloring material. These examples are disclosed in U.S. Pat. No. 4,617,257, JP-A No. 59-180550, JP-A No. 64-13546, JP-A No. 5-45828 and JP-A No. 5-45834.

These spectrally sensitizing coloring materials may be used singly or in combination thereof. This combination is used for the purpose of controlling the distribution of spectrally photosensitive wavelengths or color-enhancing sensitization. A combination of coloring materials showing color-enhancing sensitizing action can achieve higher sensitivity than by using them alone. Further, a coloring material having no spectrally sensitizing action by itself, or a compound not substantially absorbing visible rays but having a color-enhancing sensitizing action, is also preferably used in combination. Diaminostilbene compounds can also be mentioned as coloring enhancers. These examples are described in U.S. Pat. No. 3,615,641, JP-A No. 63-23145, etc.

These spectrally sensitizing coloring materials and color-enhancing sensitizers may be added to the silver halide emulsion at any stage in the process of preparing the emulsion. Various methods of adding these compounds to the chemically sensitized emulsion at the time of preparation of the coating solution, adding them after, during or before chemical sensitization, adding them before desalting after formation of grains, or adding them during or before formation of grains may be used singly or in combination. Addition of these compounds in a step prior to chemical sensitization is preferable to achieve higher sensitivity. The amount of the spectrally sensitizing coloring materials or color-enhancing sensitizers is varied depending on the shape or size of the grains or photographic characteristics to be conferred, but is generally in the range of $10^{-8}$ to $10^{-1}$ mole, preferably $10^{-5}$ to $10^{-2}$ mole per mole of silver halide. These compounds can be added in the form of a solution in an organic solvent such as methanol or fluorine alcohol or a dispersion with a surfactant or gelatin in water.

For the purpose of preventing fogging and improving stability during storage, various stabilizers are preferably added to the silver halide emulsion. Preferable stabilizers include nitrogenous heterocyclic compounds such as azaindenes, triazoles, tetrazoles and purines and mercapto compounds such as mercaptotetrazoles, mercaptotriazoles, mercaptoimidazoles and mercaptothiaziazoles. These compounds are detailed by T. H. James in *The Theory of the Photographic Process*, Macmillan, 1977, pp. 396–399, as well as in references cited therein.

These anti-fogging agents or stabilizers may be added to the silver halide emulsion at any stage in the process of preparing the emulsion. Various methods of adding these compounds to the chemically sensitized emulsion at the time of preparation of the coating solution, adding them after, during or before chemical sensitization, adding them before desalting after formation of grains, or adding them during or before formation of grains may be used singly or in combination. The amount of these anti-fogging agents or stabilizers varies depending on the halogen composition in the silver halide emulsion or the purpose, but is generally in the range of $10^{-6}$ to $10^{-1}$ mole, preferably $10^{-5}$ to $10^{-2}$ mole per mole of silver halide.

The above-described photographic additives used in the sensitive material of the present invention described above are described in Research Disclosure (abbreviated hereinafter into RD) No. 17643 (December 1978), No. 18716 (November 1979) and No. 307105 (November 1989) and the corresponding parts are summarized below:

| Type of additive | RD17643 | RD18716 | RD307105 |
|---|---|---|---|
| Chemical sensitizer | p. 23 | p. 648, right col. | p. 866 |
| Sensitivity improver | | p. 648, right col. | |
| Spectral sensitizer<br>Color-enhancing sensitizer | pp. 23 to 24 | p. 648, right col.<br>to p. 649, right col. | pp. 866–868 |
| Brightening agent | p. 24 | p. 648, right col. | p. 868 |
| Anti-fogging agent<br>Stabilizer | pp. 24–26 | pp. 649, right col. | p. 868–870 |
| Light absorber | pp. 25–26 | pp. 649, right col. | p. 873 |

-continued

| Type of additive | RD17643 | RD18716 | RD307105 |
|---|---|---|---|
| Filter dye | | to page 650, left col. | |
| UV ray absorber | | | |
| Col. matter image stabilizer | p. 25 | p. 650, left col. | p. 872 |
| Hardener | p. 26 | p. 651, left col. | pp. 874–875 |
| Binder | p. 26 | p. 651, left col. | pp. 873 to 874 |
| Plasticizer, lubricant | p. 27 | p. 650, right col. | p. 876 |
| Coating aids, Surfactant | pp. 26 to 27 | p. 650, right col. | pp. 875 to 876 |
| Antistatic agent | p. 27 | p. 650, right col. | pp. 876 to 877 |
| Matting agent | | | pp. 878 to 879 |

As oxidizing agents, organic metal salts can be used in combination with photosensitive silver halide. Among these organic metal salts, organic silver salts are preferably used. The organic compounds which can be used for forming the oxidizing agents of organic silver salts include benzotriazoles, fatty acids etc. described in columns 52 to 53 etc. in U.S. Pat. No. 4,500,626. Acetylene silver described in U.S. Pat. No. 4,775, 613 is also useful. Two or more organic silver salts can be used in combination. The organic silver salts described above can be used in combination in an amount of 0.01 to 10 moles, preferably 0.01 to 1 mole per mole of the photosensitive silver halide. The total of the photosensitive silver halide and the organic silver salt applied is 0.15 to 10 g/m$^2$, preferably 0.1 to 4 g/m$^2$ in terms of the weight of silver.

The binder in a layer constituting the photosensitive material is preferably hydrophilic. Examples thereof include those described in Research Disclosure supra and pp. 71 to 75 in JP-A No. 64-13546. Specifically, transparent or semi-transparent hydrophilic binders are preferable, and examples thereof include, natural compounds including proteins and cellulose derivatives such as gelatin and gelatin derivatives and polysaccharides such as starch, gum Arabic, dextran and pluran, and synthetic polymeric compounds such as polyvinyl alcohol, polyvinyl pyrrolidone, and acrylamide polymers can be mentioned. Further, highly water-absorbing polymers described in U.S. Pat. No. 4,960,681, JP-A No. 62-245260 etc., that is, a homopolymer of a vinyl monomer having —COOM or —$SO_3M$ (M is a hydrogen atom or an alkali metal) or a copolymer of such vinyl monomers and/or other vinyl monomers (e.g., sodium methacrylate, ammonium methacrylate, Sumika Gel L-5H (Sumitomo Chemical Co., Ltd.)) can also be used. Two or more of these binders can also be used in combination. In particular, gelatin and the other binders described above are preferably used in combination. Further, the gelatin may be selected from lime-treated gelatin, acid-treated gelatin, and ash-freed gelatin with a reduced content of calcium etc., depending on various purposes, and a combination of plural kinds of gelatin is also preferably used. The amount of the binder coated per m$^2$ is preferably 20 g or less, more preferably 10 g or less.

The developing agent may be an agent for reducing photosensitive silver halide grains to generate a silver image, and a black and white developing agent is satisfactory, but a coloring developing agent whose oxidized body formed by silver development reacts with a coupler etc. to form a coloring material can also be used. As the developing agent, the compounds represented by the general formula (1), (2), (3) or (4) are preferably used because of excellent thermostability. Among these, the compounds of the general formula (1) or (2) are preferably used. Hereinafter, these developing agents are described in detail.

The compounds represented by the general formula (1) are compounds generally called sulfonamide phenol, which are known compounds in this field. Those having a ballast group containing 8 or more carbon atoms in at least one of the substituent groups $R_1$ to $R_5$ are preferable.

In the formulae, $R_1$ to $R_4$ represent a hydrogen atom, halogen atom (e.g., chlorine atom, bromine atom), alkyl group (e.g., methyl group, ethyl group, isopropyl group, n-butyl group, t-butyl group), aryl group (e.g., phenyl group, tolyl group, xylyl group), alkyl carbon amide group (e.g., acetyl amino group, propionyl amino group, butyroyl amino group), aryl carbon amide group (e.g., benzoyl amino group), alkyl sulfonamide group (e.g., methane sulfonyl amino group, ethane sulfonyl amino group), aryl sulfonamide group (e.g., benzene sulfonyl amino group, toluene sulfonyl amino group), alkoxy group (e.g., methoxy group, ethoxy group, butoxy group), aryloxy group (e.g., phenoxy group), alkyl thio group (e.g., methyl thio group, ethyl thio group, butyl thio group), aryl thio group (e.g., phenyl thio group, tolyl thio group), alkyl carbamoyl group (e.g., methyl carbamoyl group, dimethyl carbamoyl group, ethyl carbamoyl group, diethyl carbamoyl group, dibutyl carbamoyl group, piperidyl carbamoyl group, morpholinyl carbamoyl group), aryl carbamoyl group (e.g., phenyl carbamoyl group, methyl phenyl carbamoyl group, ethyl phenyl carbamoyl group, benzyl phenyl carbamoyl group), carbamoyl group, alkyl sulfamoyl group (e.g., methyl sulfamoyl group, dimethyl sulfamoyl group, ethyl sulfamoyl group, diethyl sulfamoyl group, dibutyl sulfamoyl group, piperidyl sulfamoyl group, morpholinyl sulfamoyl group), aryl sulfamoyl group (e.g., phenyl sulfamoyl group, methyl phenyl sulfamoyl group, ethyl phenyl sulfamoyl group, benzyl phenyl sulfamoyl group), sulfamoyl group, cyano group, alkyl sulfonyl group (e.g., methane sulfonyl group, ethane sulfonyl group), aryl sulfonyl group (e.g., phenyl sulfonyl group, 4-chlorophenyl sulfonyl group, p-toluene sulfonyl group), alkoxycarbonyl group (e.g., methoxycarbonyl group, ethoxycarbonyl group, butoxycarbonyl group), aryloxycarbonyl group (e.g., phenoxycarbonyl group), alkyl carbonyl group (e.g., acetyl group, propionyl group, butyroyl group), aryl carbonyl group (e.g., benzoyl group, alkyl benzoyl group), and acyloxy group (e.g., acetyloxy group, propionyloxy group, butyroyloxy group). In $R_1$ to $R_4$, $R_2$ and $R_4$ are preferably hydrogen atoms. The total of Hammett's constant σp values of $R_1$ to $R_4$ is preferably 0 or more. $R_5$ represents an alkyl group (e.g., methyl group, ethyl group, butyl group, octyl group, lauryl group, cetyl group, stearyl group), aryl group (e.g., phenyl group, tolyl group, xylyl group, 4-methoxyphenyl group, dodecyl phenyl group, chlorophenyl group, trichlorophenyl group, nitrochlorophenyl group, triisopropyl phenyl group, 4-dodecyloxyphenyl group, 3,5-di-(methoxycarbony) group), or heterocyclic group (e.g., pyridyl group).

The compounds represented by the general formula (2) are compounds generally called carbamoyl hydrazine. These are compounds known in this field. These compounds are preferably those having a ballast group containing 8 or more carbon atoms in $R_5$ or in a substituent group on the ring.

In the formula, Z represents an atomic group forming an aromatic ring. The aromatic ring formed by Z should be sufficiently electron-withdrawing to confer a silver developing activity on the compound. Accordingly, an aromatic ring forming a nitrogenous aromatic ring or having an electron-withdrawing group into the benzene ring thereof is preferably used. Preferably, such aromatic groups include a pyridine ring, pyrazine ring, pyrimidine ring, quinoline ring, quinoxaline ring etc. In the case of the benzene ring, the substituent groups thereof include an alkyl sulfonyl group (e.g. methane sulfonyl group, ethane sulfonyl group), halogen atom (e.g. chlorine atom, bromine atom), alkyl carbamoyl group (e.g. methyl carbamoyl group, dimethyl carbamoyl group, ethyl carbamoyl group, diethyl carbamoyl group, dibutyl carbamoyl group, piperidine carbamoyl group, morpholinocarbamoyl group), aryl carbamoyl group (e.g. phenyl carbamoyl group, methyl phenyl carbamoyl group, ethyl phenyl carbamoyl group, benzyl phenyl carbamoyl group), carbamoyl group, alkyl sulfamoyl group (e.g. methyl sulfamoyl group, dimethyl sulfamoyl group, ethyl sulfamoyl group, diethyl sulfamoyl group, dibutyl suflamoyl group, piperidyl sulfamoyl group, morpholyl sulfamoyl group), aryl sulfamoyl group (e.g. phenyl sulfamoyl group, methyl phenyl sulfamoyl group, ethyl phenyl sulfamoyl group, benzyl phenyl sulfamoyl group), sulfamoyl group, cyano group, alkyl sulfonyl group (e.g. methane sulfonyl group, ethane sulfonyl group), aryl sulfonyl group (e.g. phenyl sulfonyl group, 4-chlorophenyl sulfonyl group, p-toluene sulfonyl group), alkoxy carbonyl group (e.g. methoxycarbonyl group, ethoxycarbonyl group, butoxycarbonyl group), aryloxycarbonyl group (e.g. phenoxycarbonyl group), alkyl carbonyl group (e.g. acetyl group, propionyl group, butyroyl group) and aryl carbonyl group (e.g. benzoyl group, alkyl benzoyl group), and the total of Hammett's constant σup values of these substituent groups is preferably 1 or more.

The compounds represented by the general formula (3) are compounds generally called carbamoyl hydrazine. The compounds represented by the general formula (4) are compounds generally called sulfonyl hydrazine. Both compounds are those known in this field. These compounds preferably have a ballast group containing 8 or more carbon atoms in at least one of $R_5$ to $R_8$.

In the formula, $R_6$ represents an alkyl group (e.g. methyl group, ethyl group). X represents an oxygen atom, sulfur atom, selenium atom, or an alkyl- or aryl-substituted tertiary nitrogen atom, among which the alkyl-substituted tertiary nitrogen atom is preferable. $R_7$and $R_8$represent a hydrogen atom or substituent groups (including those mentioned above as the substituent groups on the benzene ring Z), and $R_7$ and $R_8$ may be bonded to each other to form a double bond or a ring. In the compounds of the general formulae (1) to (4), the compounds of the general formulae (1) and (2) are preferable from the viewpoint of biological stability.

In the foregoing, the respective groups of $R_1$ to $R_8$ include those having possible substituent groups, and the substituent groups include those enumerated above as the substituent groups on the benzene ring Z. Hereinafter, examples of the compounds represented by the general formulae (1) to (4) are shown, but these are not intended to limit the present invention.

D-1

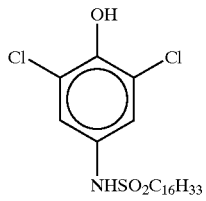

D-2

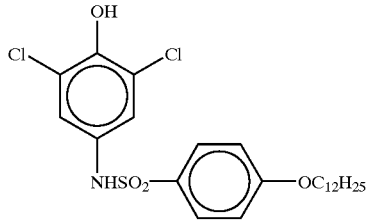

D-3

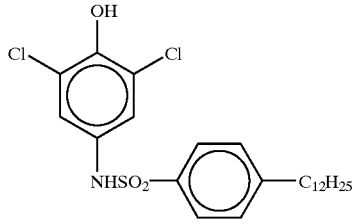

D-4

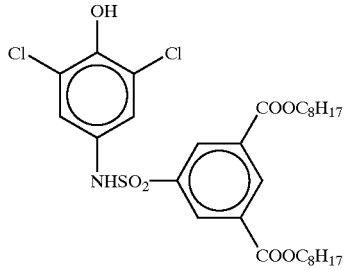

D-5

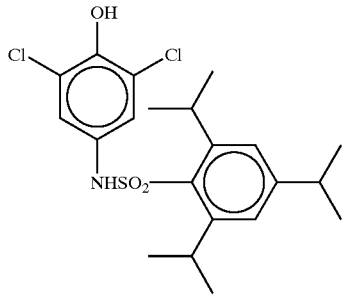

D-6

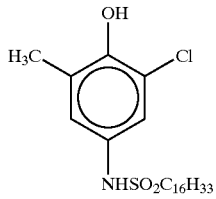

-continued
D-7
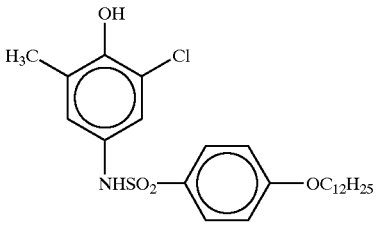
D-8
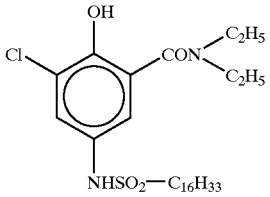
D-9
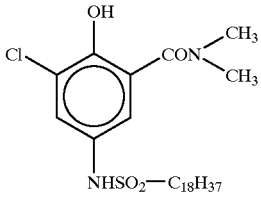
D-10
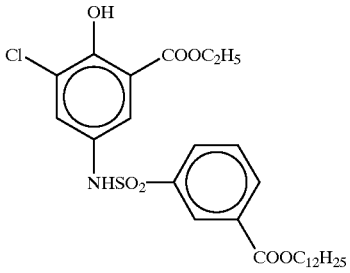
D-11
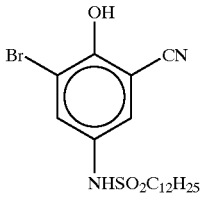
D-12
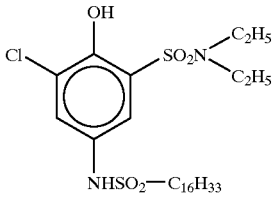
D-13
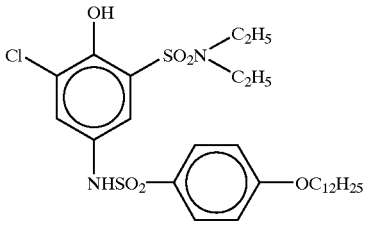
-continued
D-14
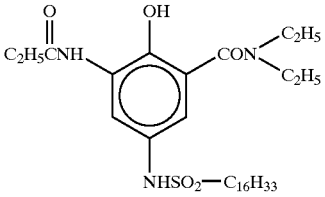
D-15
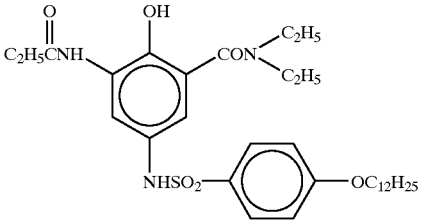
D-16
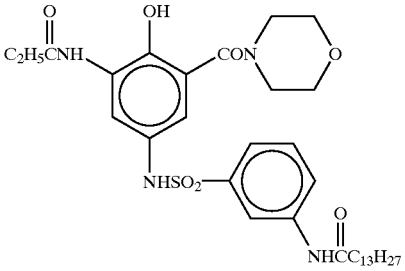
D-17
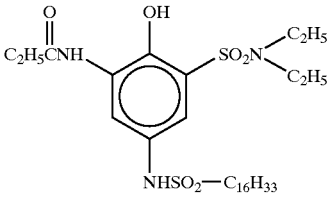
D-18
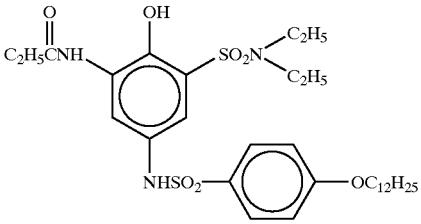
D-19
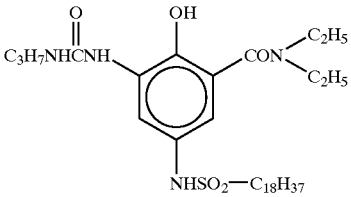
D-20
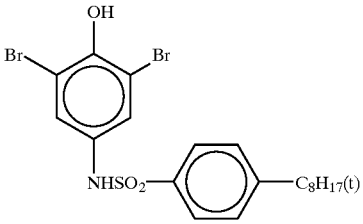

-continued
D-21
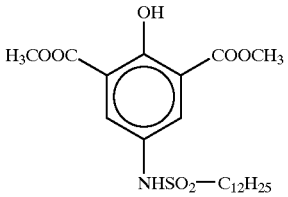
D-22
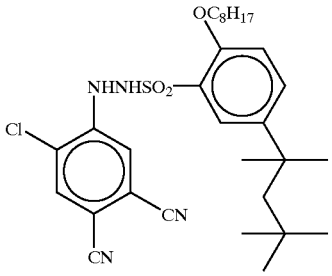
D-23
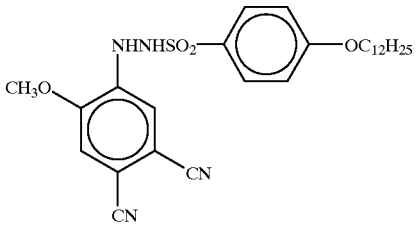
D-24
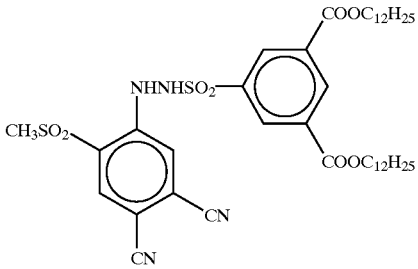
D-25
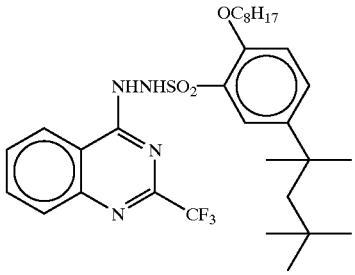
D-26
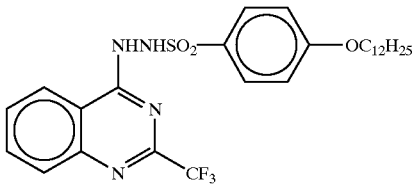
-continued
D-27
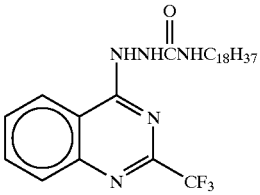
D-28
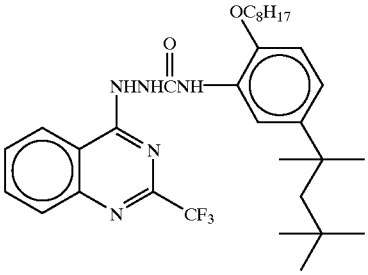
D-29
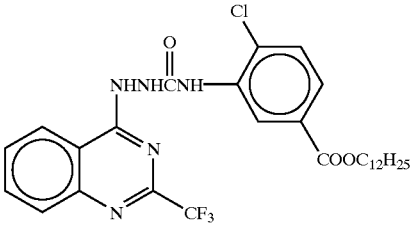
D-30
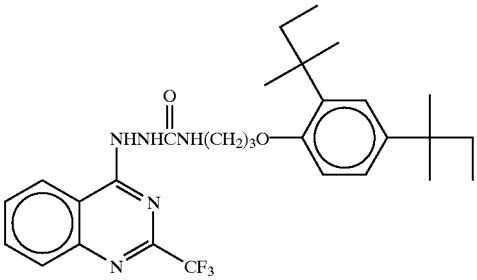
D-31
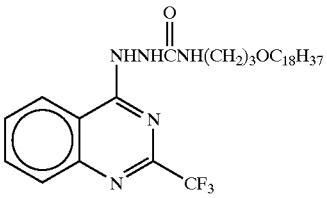
D-32
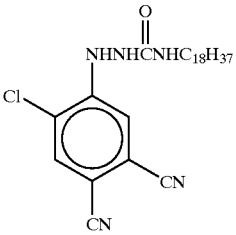

-continued
D-33
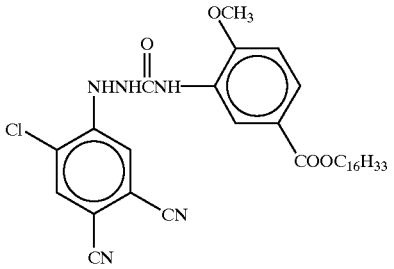
D-34
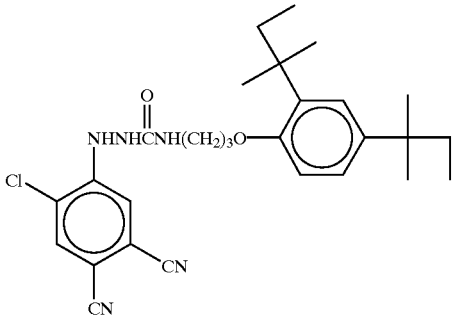
D-35
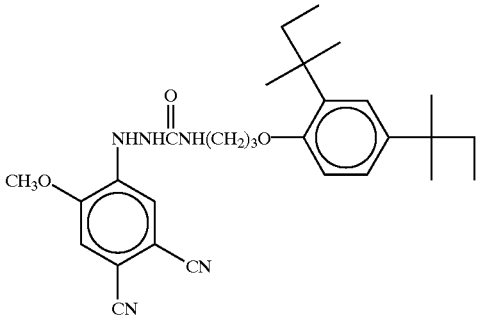
D-36
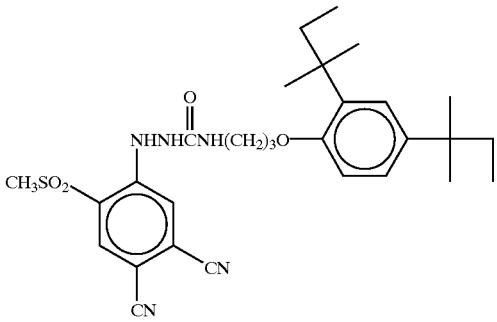
D-37
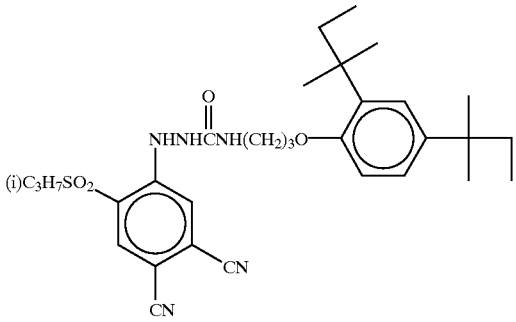
-continued
D-38
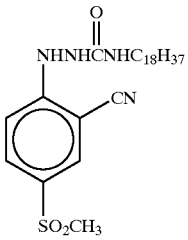
D-39
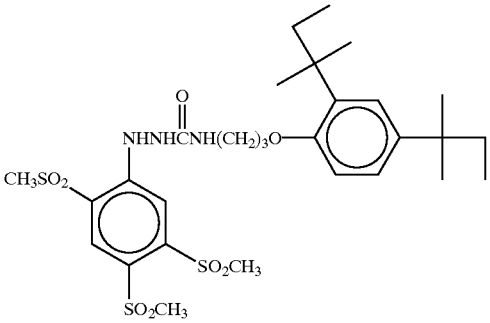
D-40
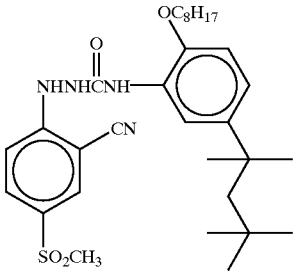
D-41
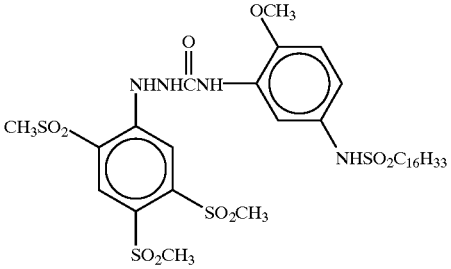
D-42
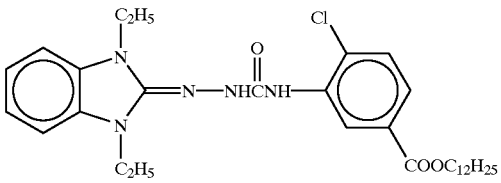
D-43
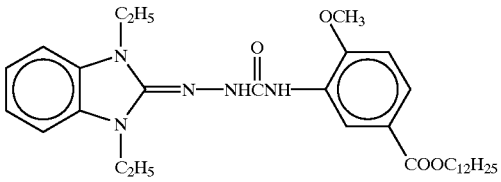

-continued
D-44
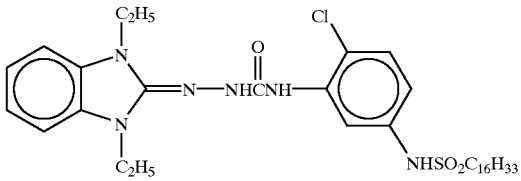
D-45
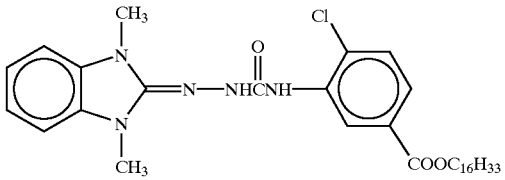
D-46
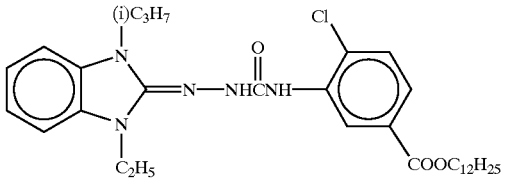
D-47
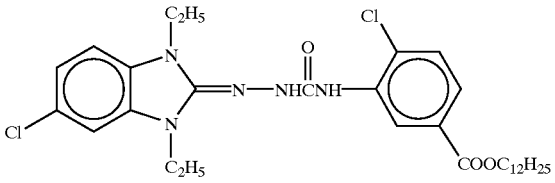
D-48
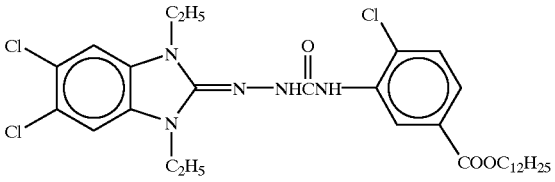
D-49
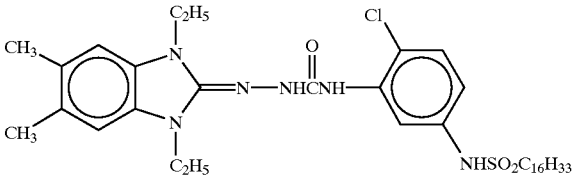
D-50
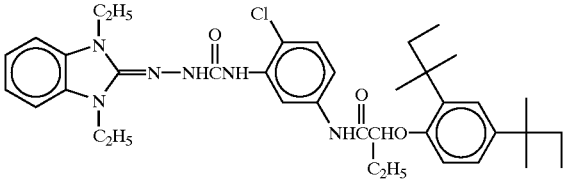
-continued
D-51
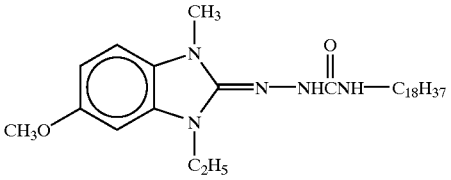
D-52
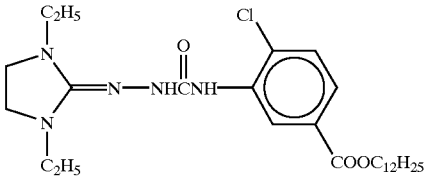
D-53
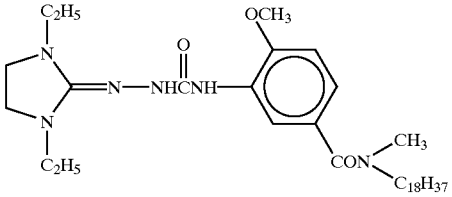
D-54
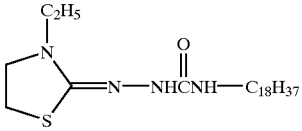
D-55
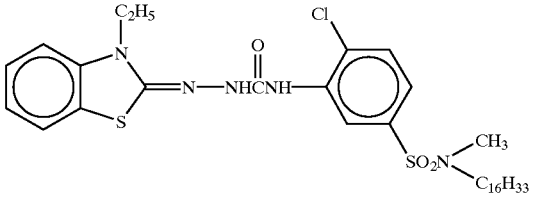
D-56
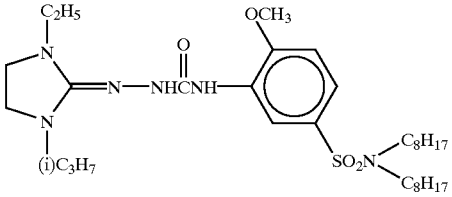
The compounds described above can be synthesized in general methods known to those having skill in the art. Simple synthetic routes are enumerated as follows:
Synthesis of the Developing Agent D-2
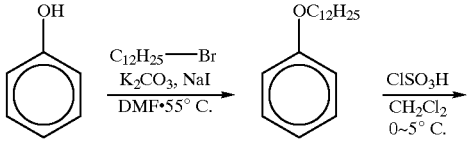

-continued

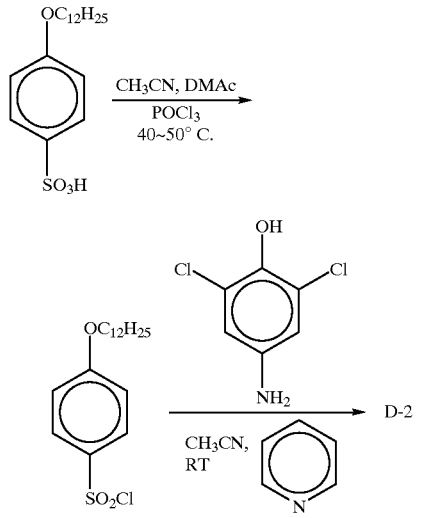

Synthesis of the Developing Agent D-27

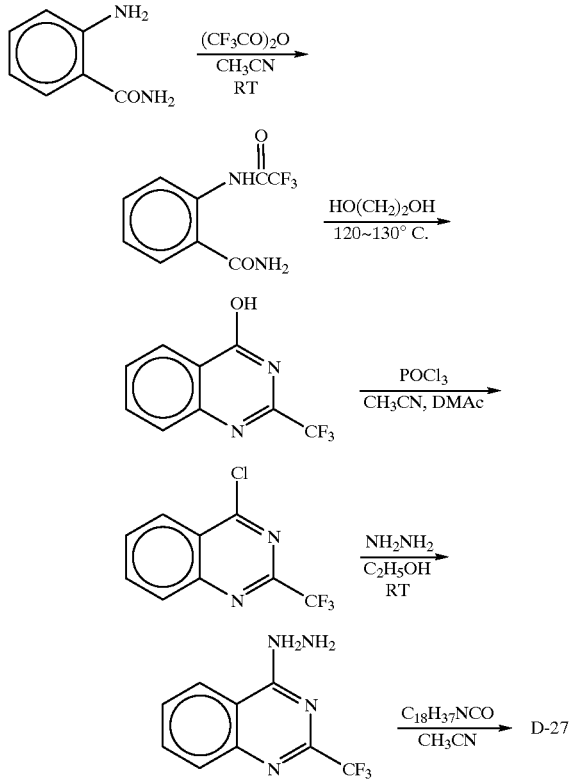

Synthesis of the Developing Agent D-42

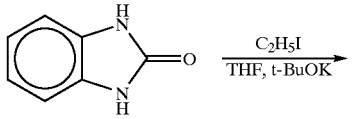

-continued

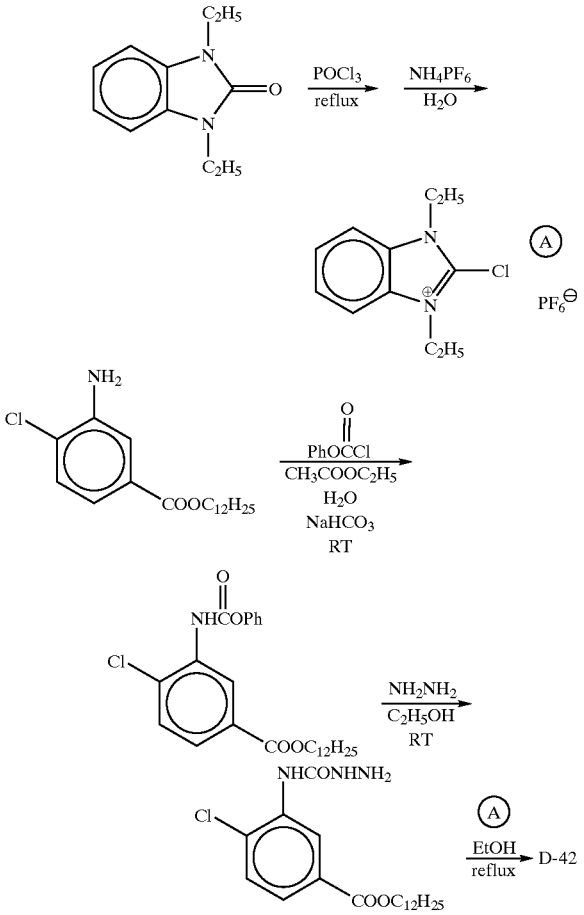

When a diffusion-resistant developing agent is used, an electron transferring agent and/or a precursor of an electron-transferring agent can be used in combination to promote the transfer of electrons between the diffusion-resistant developing agent and the developable silver halide. Those described in U.S. Pat. No. 5,139,919 supra and EU Patent Publication No. 418,743 are particularly preferably used. Further, methods of introducing it stably into a layer as described in JP-A No. 2-230143 and JP-A No. 2-235044 are preferably used. The electron transferring agent or precursors thereof can be selected from the developing agents or precursor thereof described above. The electron-transferring agent or precursors thereof are desirably those having higher transferability than that of the diffusion-resistant developing agent (electron donor). Particularly preferable electron-transferring agents are 1-phenyl-3-pyrazolidone or aminophenols. Further, the electron donor precursors described in JP-A No. 3-160443 are also preferably used. In addition, various reducing agents can be used in the interlayer and protective layer for the various purposes of preventing color mixture and improving color reproduction. Specifically, the reducing agents described in European Patent Publication No. 524,649, European Patent Publication No. 357,040, JP-A No. 4-249245, JP-A No. 2-46450 and JP-A No. 63-186240 can be preferably used. Further, the development inhibitor-releasing reducing compounds described in JP-B No. 3-63733, JP-A No. 1-150135, JP-A No. 2-46450, JP-A No. 2-64634, JP-A No. 3-43735 and European Patent Publication No. 451,833 are also used.

A developing agent precursor not having a reducing ability in itself but expressing a reducing ability by the action of a nucleophilic reagent or heating in the development process can also be used. For example, mention can be made of the indoaniline-based compounds described in U.S. Pat. No. 3,342,597, the Schiff base compounds in U.S. Pat. No. 3,342,599, Research Disclosure Nos. 14,850 and 15,159, the aldol compounds in Research Disclosure No. 13,924, the metal salt complexes in U.S. Pat. No. 3,719,492, and the urethane type compounds in JP-A No. 53-135628.

Moreover, the following reducing agents may be contained in the photosensitive material. As examples of the reducing agents, there are the reducing agents and precursors of reducing agents desclosed in columns 49 to 50 in U.S. Pat. Nos. 4,500,626, 4,839,272, 4,330,617, 4,590,152, 5,017,452, 5,139,919, pp. 17 to 18 in JP-A No. 60-140335, JP-A No. 57-40245, JP-A No. 56-138736, JP-A No. 59-178458, JP-A No. 59-53831, JP-A No. 59-182449, JP-A No. 59-182450, JP-A No. 60-119555, JP-A No. 60-128436, JP-A No. 60-128439, JP-A No. 60-198540, JP-A No. 60-181742, JP-A No. 61-259253, JP-A No. 62-244044, JP-A No. 62-131253, JP-A No. 62-131256, pp. 40 to 57 in JP-A No. 64-13546, JP-A No. 1-120553 and pp. 78 to 96 in European Patent No. 220,746A2. Further, a combination of various reducing agents disclosed in U.S. Pat. No. 3,039,869 can also be used.

The developing agent or the reducing agent may be contained in a development process solution which is then added to the photosensitive material, but is preferably contained initially in the photosensitive material in order to prevent the occurrence of uneven development. When the developing agent and the reducing agent are contained in the photosensitive material, their total amount is 0.0.1 [sic.] to 20 moles, particularly preferably 0.1 to 10 moles per mole of silver. The specific method of feeding the developing agent, that is, the development method, is described below.

In conventional photosensitive materials for forming color images, a coupler for forming a coloring material by reacting with an oxidized body of a coloring developing agent is contained along with the coloring developing agent, and the method of the present invention can also be applied to such coupler-containing photosensitive materials insofar as silver images can be read by reading with e.g. infrared radiations. The coupler may be a 4-equivalent coupler or a 2-equivalent coupler. Further, the diffusion-resistant group may form a polymer chain. Specific examples of couplers are detailed on pp. 291–334 and pp. 354 to 361 in *The Theory of the Photographic Process*, fourth ed., authored by T. H. James, JP-A No. 58-123533, JP-A No. 58-149046, JP-A No. 58-149047, JP-A No. 59-111148, JP-A No. 59-124399, JP-A No. 59-174835, JP-A No. 59-231539, JP-A No. 59-231540, JP-A No. 60-2950, JP-A No. 60-2951, JP-A No. 60-14242, JP-A No. 60-23474, JP-A No. 60-66249, JP-A No. 8-110608, JP-A No. 8-146552 and JP-A No. 8-146578.

For example, the combination of a p-phenylene diamine type developing agent and phenol or an active methylene coupler in U.S. Pat. No. 3,531,256, the combination of a p-aminophenol type developing agent and an active methylene coupler in U.S. Pat. No. 3,761,270 can be used. The combination of a sulfonamide phenol and a 4-equivalent coupler as described in U.S. Pat. No. 4,021,240 and JP-A No. 60-128438 is a preferable combination excellent in biological stability when contained in the photosensitive material. Further, a combination of a coupler and the sulfonamide phenol type developing agent described in JP-A No. 9-15806 or the hydrazine type developing agent described in Japanese Patent Application No. 7-49287 and JP-A No.8-234388 is also preferable.

Hydrophobic additives such as the coupler, the developing agent and the diffusion-resistant reducing agent can be introduced into the photosensitive material in a known method described in, for example, U.S. Pat. No. 2,322,027. In this case, the high-boiling organic solvents described in U.S. Pat. Nos. 4,555,470, 4,536,466, 4,536,467, 4,587,206, 4,555,476, 4,599,296, JP-B No. 3-62256 can be used in combination with low-boiling organic solvents having boiling points of 50 to 160° C. as necessary. Further, two or more of these coloring material donor compounds, diffusion resistant reducing agents and high-boiling organic solvents can be used in combination. The amount of the high-boiling organic solvent is 10 g or les, preferably 5 g or less, more preferably 1 g to 0.1 g relative to 1 g of the hydrophobic additive used. Further, its volume is 1 cc or less, preferably 0.5 cc or less, more preferably 0.3 cc or less relative to 1 g of the binder. The method of dispersion by polymers described in JP-B No. 51-39853 and JP-A No. 51-59943 and the method of addition in the form of a fine grain dispersion described in JP-A No. 62-30242 etc. can also be used. Besides the methods described above, those compounds substantially insoluble in water can be dispersed and contained as fine grains in a binder. For dispersing the hydrophobic compound in hydrophilic colloids, various surfactants can be used. For example, the surfactants mentioned in JP-A No. 59-157636, pp. 37 to 38, and Research Disclosure supra can be used. Further, the phosphate-based surfactants described in JP-A Nos. 7-56267 and 7-228589 and West Germany Published Patent No. 1,932,299A can also be used.

The photosensitive material can make use of compounds for activating development and simultaneously stabilizing images. Specific compounds are described in columns 51 to 52 in U.S. Pat. No. 4,500,626.

The silver halide, coupler, and developing agent described above may be contained in the same layer, but may be added in separate layers if they can be react with each other. For example, when a layer containing the developing agent and a layer containing silver halide are arranged as separate layers, the biological stability of the photosensitive material is improved. Further, various non-photosensitive layers such as protective layer, undercoat layer, interlayer, yellow filter layer and anti-halation layer may be provided between silver halide-containing layers or on the uppermost layer and the lowermost layer, and various assistant layers such as back layer can be provided at the opposite side to the support. Specifically, it is possible to provide the photosensitive material with the layer structure described above, the undercoat layer described in U.S. Pat. No. 5,051,335, the interlayer having a solid coloring material as described in JP-A No. 1-167838, JP-A No. 61-20943, the interlayer having a reducing agent or a DIR compound as described in JP-A No. 1-120553, JP-A No. 5-34884 and JP-A No. 2-64634, the interlayer having an electron transferring agent as described in U.S. Pat. Nos. 5,017,454, 5,139,919 and JP-A No. 2-235044, the protective layer having a reducing agent as described in JP-A No. 4-249245, or a combination of these layers. In the method of the present invention, a silver image is read from both sides of the photosensitive material by means of reflected light as described below, so the arrangement of a coloring layer having absorption in the wavelength range of light used for reading is not preferable because the S/N ratio is lowered for reading information. For example, a black anti-halation layer using silver colloids, not subjected to bleaching treatment, is not preferable because it has absorption in a wide wavelength range. A coloring layer using an organic dye is preferable because a layer not having absorption of infrared radiations can be designed to minimize its influence on reading.

Dyes which can be used in the yellow filter layer and anti-halation layer are preferably those which are decolored or removed upon development and do not contribute to density after the treatment. Decolorization or removal of the dyes in the yellow filter layer and anti-halation layer upon development means that the amount of the dyes remaining after the treatment is reduced to ⅓ or less, preferably 1/10 or less of the original amount thereof before application, and upon development, components in the dyes may be transferred from the photosensitive material to a material to be treated or may become colorless compounds upon reaction during development.

Specifically, examples include the dyes described in European Patent Application EP 549,489A and the dyes in ExF 2 to 6 in JP-A No. 7-152129. The solid-dispersed dyes described in JP-A No. 8-101487 can also be used. Further, a mordant and a binder may be treated with a dye. In this case, the mordant and dye may be those known in the field of photography, and the mordants described in columns 58 to 59 in U.S. Pat. No. 4,500,626, pages 32 to 41 in JP-A No. 61-88256, JP-A No. 62-244043, and JP-A No. 62-244036 can be mentioned. Further, a reducing agent and a compound which reacts with the reducing agent to release a diffusible coloring material are used so that a workable coloring material can be released with an alkali upon development and removed by transfer to the material to be treated. This is specifically described in U.S. Pat. Nos. 4,559,290, 4,783,396, European Patent No. 220,746A2, Published Technical Report No. 87-6119, as well as in columns 0080 to 0081 in Japanese Patent Application No. 6-259805.

Decolorizable leuco dyes can also be used, and specifically a photosensitive material of silver halide containing a leuco coloring material previously colored with a developer made of an organic acid metal salt is disclosed in JP-A No. 1-150,132. The leuco coloring material and the developer complex are decolored by heating or by reacting with an alkali agent. The leuco coloring material used may be known in the art, which is described by Moriga & Yoshida: "Senryo To Yakuhin" (Dyes and Chemicals) 9, page 84 (Kaseihin Kogyo Kyokai), "Shinban Senryo Binran" (New Dye Handbook) 2, page 242, Maruzen (1970), R. Garner, Reports on the Progress of Appl. Chem., 56, p. 199 (1971), "Senryo To Yakuhin" 19, page 230, (Kaseihin Kogyo Kyokai, 1974), "Shikizai" (Coloring Materials) 62, p. 288 (1989), "Senshoku Kogyo" (Dye Industry) 32, 208, etc. As the developer, not only acidic clay-based developers and phenol formaldehyde resin but also metal salts of organic acids are preferably used. As the metal salts of organic acids, metal salts of salicylic acid or its analogous acids, metal salts of phenol-salicylic acid-formaldehyde resin, and metal salts such as rhodan salt and xanthogenate are useful, and as the metal, zinc is particularly preferable. In the developers described above, oil-soluble zinc salicylates may be those described in U.S. Pat. Nos. 3,864,146, 4,046,941 and JP-B No. 52-1327.

The coating layer of the photosensitive material is preferably hardened by a hardener. Examples of such hardeners include those described in column 41 in U.S. Pat. Nos. 4,678,739, 4,791,042, JP-A No. 59-116655, JP-A No. 62-245261, JP-A No. 61-18942, JP-A No. 4-218044 etc. Specifically, aldehyde-based hardeners (formaldehyde etc.), aziridine-based hardeners, epoxy-based hardeners, vinyl sulfone-based hardeners (N,N'-ethylene-bis(vinyl sulfonyl acetamide)ethane etc.), N-methylol-based hardeners (dimethylol urea etc.) and boric acid, metaboric acid or polymer hardening agents (compounds described in JP-A No. 62-234157). These hardeners are used in an amount of 0.001 to 1 g, preferably 0.005 to 0.5 g per g of the hydrophilic binder.

In the photosensitive material, various anti-fogging agents or photographic stabilizers and precursors thereof can be used. Specifically, mention is made of the compounds described in the Research Disclosure supra, U.S. Pat. Nos. 5,089,378, 4,500,627, 4,614,702, pages 7 to 9, 57 to 71 and 81 to 97 in JP-A No. 64-13564, U.S. Pat. Nos. 4,775,610, 4,626,500, 4,983,494, JP-A No. 62-174747, JP-A No. 62-239148, JP-A No. 1-150135, JP-A No. 2-110557, JP-A No. 2-178650, and pages 24 to 25 in RD 17,643 (1978). The amount of these compounds is preferably $5\times10^{-6}$ to $1\times10^{-1}$ mole, more preferably $1\times10^{-5}\times5\times10^{-2}$ mole per mole of silver.

In the photosensitive material, various surfactants can be used for the purposes of facilitating coating, improving peelability, improving slip characteristics, preventing charging and promoting development. Examples of such surfactants are described on pages 136 to 138 in Known Technology No. 5 (published on Mar. 22, 1991, by Aztec Inc.), JP-A No. 62-173,463, JP-A No. 62-183,457 etc. The photosensitive material may contain organofluoro compounds for the purpose of preventing slip, preventing charging, improving peelability etc. Typical examples of the organofluoro compounds include the fluorine-based surfactants, oily fluorine-based compounds such as fluorine oil, or hydrophobic fluorine compounds including solid fluorine compound resin such as tetrafluorine ethylene resin described in columns 8 to 17 in JP-B No. 57-9053, JP-A No. 61-20944 and JP-A No. 62-135826.

The photosensitive material preferably has slip characteristics. A lubricant-containing layer is preferably arranged on both the photosensitive layer and the back layer. Preferable slip characteristics are 0.01 to 0.25 in terms of coefficient of dynamic friction. This value is determined by transferring a specimen against of a stainless steel sphere of 5 mm in diameter at a rate of 60 cm/min. (25° C., 60% RH). In this evaluation, almost the same value is obtained even if the counterpart material is replaced by the photosensitive layer. Usable lubricants include polyorganosiloxane, higher fatty acid amides, higher fatty acid metal salts, esters of higher fatty acids and higher alcohols, and the usable polyorganosiloxane includes polydimethyl siloxane, polydiethyl siloxane, polystyryl methyl siloxane, polymethyl phenyl siloxane etc. The layers to which these materials are added are preferably the outermost layer of the emulsion layer and the back layer. In particular, polydimethyl siloxane and esters having long alkyl group are preferable.

In the photosensitive material, antistatic agents are preferably used. The antistatic agents include polymers, cationic polymers and ionic surfactants, including carboxylic acids, carboxylates and sulfonates. The antistatic agents are most preferably at least one crystalline metal oxide having a grain size of 0.001 to 1.0 $\mu$m with a volume resistivity of $10^7$ Ω·cm or less, more preferably $10^5$ Ω·cm or less, selected from ZnO, $TiO_2$, $SnO_2$, $SnO_2$, $Al_2O_3$, $In_2O_3$, $SiO_2$, MgO, BaO, $MoO_3$ and $V_2O_5$, fine grains of composite oxides thereof (Sb, P, B, In, S, Si, C etc.) and fine grains of metal oxides in a sol form or composite oxides thereof. The content thereof in the photosensitive material is preferably 5 to 500 mg/m$^2$, more preferably 10 to 350 mg/m$^2$. The electrically conductive crystalline oxides or composite oxides thereof and the binder are used in a ratio of from 1/300 to 100/1, more preferably from 1/100 to 100/5.

The constitution (including the back layer) of the photosensitive material or the treated material described below can contain various polymer latexes for the purpose of improvements in the physical properties of film, such as dimensional stabilization, prevention of curling, prevention of adhesion, prevention of cracking on the film, prevention of pressure fluctuation etc. Specifically, any of the polymers described in JP-A No. 62-245258, JP-A No. 62-136648, JP-A No. 62-110066 etc. can be used. In particular, when polymer latexes having low glass transition points (40° C. or less) are used in the mordant layer, cracking in the mordant layer can be prevented, or when polymer latexes having high glass transition points are used in the back layer, the effect of preventing curling can be attained.

The matting agent is preferably contained in the photosensitive material. Although the layer to which the matting agent is added may be a layer either on the emulsion layer or on the back layer, the matting agent is added particularly preferably to the outermost layer at the emulsion side. The matting agent may be soluble or insoluble in the processing solution, and preferably the soluble and insoluble matting agents are used in combination. For example, polymethyl methacrylate, poly(methyl methacrylate/methacrylic acid=9/1 or 5/5 (molar ratio)), polystyrene grains etc. are preferable. The grain diameter is preferably 0.8 to 10 μm, the distribution of its grain diameters is preferably smaller, and the diameters of 90% of all grains are 0.9- and 1.1-times the average grain diameter. Further, fine grains of 0.8 μm or less are added simultaneously in order to improve matting properties, and examples thereof include polymethyl methacrylate (0.2 μm), poly(methyl methacrylate/methacrylic acid=9/1 (molar ratio), 0.3 μm), polystyrene grains (0.25 μm) and colloidal silica (0.03 μm). Specifically, these materials are described on page 29 in JP-A No. 61-88256. Besides, there are compounds such as benzoguanamine resin beads, polycarbonate resin beads, AS resin beads etc. described in JP-A No. 63-274944 and JP-A No. 63-274952. Besides, the compounds described in the Research Disclosure supra can be used.

The support used for the photosensitive material is a support which is transparent and endurable to treatment temperature. In general, photographic supports such as papers and synthetic polymers (films etc.) described on pages 223 and 240 in "Shashin Kogaku No Kiso—Ginen Shashin Hen" (Fundamentals of Photographic Engineering—Silver Halide Photograph", compiled by the Japanese Photographic Society, published by Corona Co., Ltd. (1979) can be mentioned. Specifically, polyethylene terephthalate, polyethylene napthalate, polycarbonate, polyvinyl chloride, polystyrene, polypropylene, polyimide, cellulose and modified cellulose thereof (e.g. triacetyl cellulose). Besides, the supports described on pages 29 to 31 in JP-A No. 62-253159, pages 14 to 17 in JP-A No. 1-161236, JP-A No. 63-316848, JP-A No. 2-22651, JP-A No. 3-56955 and U.S. Pat. No. 5,001,033 can be used.

When requirements for heat resistance and curling characteristics are particularly severe, the supports used for the photosensitive material are preferably those described in JP-A No. 6-41281, JP-A No. 6-43581, JP-A No. 6-51426, JP-A No. 6-51437, JP-A No. 6-51442, Japanese Patent Application Nos. 4-253545, 4-221538 and 5-21625 and JP-A Nos. 6-82961, 6-82960, 6-82959, 6-67346, 6-202277, 6-175282, 6-118561, 7-219129 and 7-219144 can be preferably used. Further, supports of styrene-based polymer mainly having a syndiotactic structure can also be preferably used.

To bond the support to the layer formed of the sensitive material, surface treatment is preferably conducted. The surface treatment includes surface-activating treatment such as chemical treatment, mechanical treatment, corona discharge treatment, flame treatment, UV ray treatment, high-frequency treatment, glow discharge treatment, active plasma treatment, laser treatment, mixed-acid treatment, ozone oxidizing treatment etc. The surface treatment is particularly preferably UV ray irradiation treatment, flame treatment, corona treatment or glow treatment. The undercoat layer coated may be a single layer or two or more layers. The binder for the undercoat layer includes not only copolymers produced from starting monomers selected from vinyl chloride, vinylidene chloride, butadiene, methacrylic acid, acrylic acid, itaconic acid and maleic anhydride, but also polyethylene imine, epoxy resin, grafted gelatin, nitrocellulose and gelatin. As compounds for swelling the support, there are resorcin and p-chlorophenol. The undercoat layer includes gelatin hardeners such as chromium salts (chromium alum etc.), aldehydes (formaldehyde, glutaraldehyde etc.), isocyanates, active halogen compounds (2,4-dichloro-6-hydroxy-S-triazine etc.), epichlorohydrin resin, and active vinyl sulfone compounds. The undercoat layer may contain $SiO_2$, $TiO_2$, inorganic fine grains, or fine grains of polymethyl methacrylate copolymers (0.01 to 10 μm) as the matting agent.

Further, the supports having a magnetic recording layer described in, for example, JP-A Nos. 4-124645, 5-40321 and 6-317875 and Japanese Patent Application No. 5-58221 are preferably used to record photographic information etc.

The polyester support preferably used in the photosensitive material having the above-described magnetic recording layer, as well as the photosensitive material, treatment, cartridge and examples, are described in more detail in Published Technical Report No. 94-6023 (Hatsumei Kyokai (Japan Institute of Invention and Innovation); Mar. 15, 1994).

Hereinafter, the film cartridge into which the color photosensitive material can be introduced is described. The major material of the cartridge used in this invention may be a metal or synthetic plastics. Preferable plastic materials are polystyrene, polyethylene, polypropylene, polyphenyl ether etc. Further, the cartridge in the present invention can contain various kinds of antistatic agents, and carbon black, metal oxide grains, nonionic, anionic, cationic and betaine surfactants or polymers can be preferably used. These cartridges rendered antistatic are described in JP-A No. 1-312537 and JP-A No. 1-312538. The photosensitive materials described above can also be used in a film unit provided with a lens described in JP-B No. 2-32615 and Japanese Utility Model Publication No. 3-39784.

The photosensitive material described above can be manufactured into a photographic film by cutting and perforation in the same manner as for conventional photographic films, and similar to 135 films, a single-lens reflex camera such as Nikon F4 or the film unit equipped with a lens described in JP-B No. 2-32615 and Japanese Utility Model Publication No. 3-39784 can be used for light exposure for photography. The photographic film may be accommodated in a film cartridge and introduced into a camera or a film unit equipped with a lens, and the film unit equipped with a lens may be directly accommodated as described in Dutch Patent No. 6708489. The photosensitive material can be exposed to light by a method of scanning exposure with a laser beam in addition to the photographic method.

After the photosensitive material is subjected to like image exposure and then treated to generate a silver image at a temperature of 50° C. or more. If the treatment temperature is less than 50° C., a silver image suitable for reading cannot be obtained. The treatment temperature is preferably 60° C. or more, and the upper limit of the treatment temperature is preferably 100° C. or less, more preferably 95° C. or less.

The treatment method includes heat development where a photosensitive material and a treatment material containing a base and/or a base precursor are attached and heated in the presence of water therebetween in an amount of 1/10- to 1-fold relative to the amount of water required for the maximum swelling of the whole coated film (excluding the back layer) constituting the photosensitive material and the treatment material; activator treatment where the photosensitive material is treated with an alkali processing solution; and liquid development for development with a processing solution containing a developing agent/base. In the method of the present invention, the treatment by heat development is preferable because the treatment can be stably conducted.

The heating treatment of the photosensitive material is known in this technical field, and thermally developed photosensitive materials and a process therefor are described in e.g. "Shashin Kogaku No Kiso "(Fundamentals of Photographic Engineering), pp. 553–555, published by Corona Co., Ltd. (1970), "Eizo Jyoho" (Image Information), p. 40, published in April, 1978, and Nabletts Handbook of Photography and Reprography seventh Ed. (Vna Nostrand and Reinhold Company), pp. 32 to 33, U.S. Pat. Nos. 3,152,904, 3,301,678, 3,392,020 and 3,457,075, GB Patent Nos. 1,131, 108and 1,167,777, and Research Disclosure, June issue, 1978, pp. 9–15 (RD-17029).

The activator treatment refers to a treatment method wherein the coloring developing agent is contained in the photosensitive material and the development process is conducted using a processing solution not the coloring developing agent. The processing solution in this case is characterized in that it does not contain the coloring developing agent contained in the conventional developing solution but may contain other components (e.g., an alkali, an auxiliary developing agent etc.). The activator treatment is disclosed in prior art literatures such as European Patent Nos. 545,491A1, 565,165A1 etc. The method of development with a developing agent/base is described in RD No. 17643, pp. 28 to 29, RD No. 18716, p. 651, left column to right column, and RD No. 307105, pp. 880 to 881.

Hereinafter, the treatment by heat development is described in detail.

In the treatment by heat development, a treatment material is used for supplying a base. The treatment material has a treatment layer containing a base or a base precursor. As the base, an inorganic or organic base can be used. The inorganic base includes the alkali metal or alkaline earth metal hydroxides desclosed in JP-A No. 62-209448 (e.g. potassium hydroxide, sodium hydroxide, lithium hydroxide, calcium hydroxide, magnesium hydroxide etc.), phosphates (e.g. dipotassium hydrogen phosphate, disodium hydrogen phosphate, ammonium sodium hydrogen phosphate, secondary or tertiary phosphate of calcium hydrogen phosphate), carboxylates (e.g. potassium carbonate, sodium carbonate, sodium hydrogen carbonate, magnesium carbonate etc.), borates (e.g. potassium borate, sodium borate, sodium metaborate etc.), organic acid salts (e.g. potassium acetate, sodium acetate, potassium oxalate, sodium oxalate, potassium tartrate, sodium tartrate, sodium malate, sodium palmitate, sodium stearate etc.), and the alkali metal or alkaline earth metal acetylides desclosed in JP-A No. 63-25208.

The organic base includes ammonia, aliphatic or aromatic amines (e.g. primary amine (e.g. methyl amine, ethyl amine, butyl amine, n-hexyl amine, cyclohexyl amine, 2-ethyl hexyl amine, allyl amine, ethylene diamine, 1,4-diaminobutane, hexamethylene diamine, aniline, anilidine, p-toluidine, α-naphthyl amine, m-phenylene diamine, 1,8-diaminonaphthalene, benzyl amine, phenetyl amine, ethanol amine, thallium etc.), secondary amine (e.g. dimethyl amine, diethyl amine, dibutyl amine, diallyl amine, N-methyl aniline, N-methyl benzyl amine, N-methyl ethanol amine, diethanol amine etc.), tertiary amine (e.g. compounds described in JP-A No. 62-170954, such as N-methyl morpholine or N-hydroxyethyl morpholine, N-methyl piperidine, N-hydroxyethyl piperidine, N,N'-dimethyl piperazine, N,N'-dihydroxyethyl piperazine, diazabicyclo[2,2,2]octane, N,N-dimethyl ethanol amine, N,N-dimethyl propanol amine, N-methyl diethanol amine, N-dimethyl dipropanol amine, triethanolamine, N,N,N',N'-tetramethyl ethylene diamine, N,N,N',N'-tetrahydroxyethyl ethylene diamine, N,N,N',N'-tetramethyl trimethylene diamine, N-methylpyrrolidine etc.), polyamine (diethylene triamine, triethylene tetramine, polyethylene imine, polyallyl amine, polyvinyl benzylamine, poly-(N,N-diethylaminoethyl methacrylate), poly-(N,N-dimethylvinyl benzylamine etc.), hydroxyl amines (e.g. hydroxylamine, N-hydroxy-N-methylaniline etc.), heterocyclic amines (e.g. pyridine, lutidine, imidazole, aminopyridine, N,N-dimethyl aminopyridine, indole, quinoline, isoquinoline, poly-4-vinylpyridine, poly-2-vinylpyridine etc.), amidines (e.g. monoamidine (e.g. acetoamidine, imidazothane, 2-methylimidazole, 1,4,5,6-tetrahydropyrimidine, 2-methyl-1,4,5,6-tetrahydropyrimidine, 2-phenyl-1,4,5,6-tetrahydropyrimidine, iminopyridine, diazabicyclononene, diazabicycloundecene (DBU) etc.), bis- or tris-[sic.] or tetra-amidine, guanidines (e.g. water-soluble monoguanidine (e.g. guanidine, dimethyl guanidine, tetramethyl guanidine, 2-aminoimidazoline, 2-amino-1,4,5-tetrahydropyrimidine etc.), mono- or bis-guanidine described in JP-A No. 63-70, 845, bis-, tris-[sic.] or tetra-guanidine, quaternary ammonium hydroxides (e.g. tetramethyl ammonium hydroxide, tetraethyl ammonium hydroxide, tetrabutyl ammonium hydroxide, trimethyl benzyl ammonium hydroxide, trioctyl methyl ammonium hydroxide, methyl pyridinium hydroxide etc.).

As the base precursor, base precursors of decarboxylation type, decomposition type, reaction type and complex salt forming type can be used. As described in European Patent Publication No. 210,660 and U.S. Pat. No. 4,740,445, it is effective to use a method of generating a base by a combination of a basic metal compound sparingly soluble in water as a base precursor and a compound (complex-forming compound) capable of reacting with metal ions constituting the basic metal compound to form a complex in water as the medium. In this case, preferably the basic metal compound sparingly soluble in water is added to the photosensitive material, while the complex-forming compound is added to the material to be treated, or vice versa.

The binder in the treatment layer can make use of the same hydrophilic polymer as in the photosensitive material. The treatment material is formed preferably into a hardened film by a hardener as is the case with the photosensitive material. The hardener may be the same as that used for the photosensitive material. A mordant can be contained in the treatment material for the purpose of transferring and removing dyes used in a yellow filter layer and an anti-halation layer in the photosensitive material. The mordant is preferably a polymer mordant. Examples thereof include polymers containing secondary and tertiary amino groups, polymers containing nitrogenous heterocyclic moieties, and polymers containing quaternary cationic groups thereof, and their molecular weights are 5000 to 20000, particularly 10000 to 50000. For example, mention can be made of the vinyl pyridine polymers and vinyl pyridinium cationic polymers disclosed in U.S. Pat. Nos. 2,548,564, 2,484,430, 3,148,061, and 6,756,814; the polymer mordants capable of being cross-linked with gelatin etc. disclosed in U.S. Pat. Nos. 3,625,694, 3,859,096, 4,128,538 and GB Patent 1277453; the aqueous sol mordants disclosed in U.S. Pat. Nos. 3,958,995, 2,721,852, 2,798,063, JP-A No. 54-115228, JP-A No. 54-145529 and JP-A No. 54-126027; the water-insoluble mordants disclosed in U.S. Pat. No. 3,898,088; the reactive mordants capable of being covalently bound to dyes disclosed in U.S. Pat. No. 4,168,976 (JP-A No. 54-137333); and the mordants disclosed in U.S. Pat. No. 3,709,690, 3,788,855, 3,642,482, 3,488,706, 3,557,066, 3,271,147, 3,271,148, JP-A No. 50-71332, JP-A No. 53-30328, JP-A No. 52-155528, JP-A No. 53-125 and JP-A No. 53-1024. Besides, the mordants described in U.S. Pat. Nos. 2,675,316 and 2,882,156 can be mentioned.

A development terminator is contained in the treatment material, and the development terminator may be allowed to work simultaneously with development. The development terminator is a compound for terminating development by rapidly neutralizing a base or reacting with a base after suitable development to decrease the concentration of the base, or a compound for interacting with silver and silver salts to inhibit development. Specifically, an acid precursor releasing an acid by heating, an electrophilic compound causing a substitution reaction with a coexistent base by heating, a nitrogenous heterocyclic compound, a mercapto compound and precursors thereof can be mentioned. More specifically, this is described on 31 to 32 in JP-A No. 62-253159. Further, a combination of zinc mercaptocarboxylate contained in the photosensitive material and the above-described complex-forming compound contained in the treatment material as described in JP-A No. 8-54705 is advantageous. Further, a printout inhibitor of silver halide is contained in the treatment material, and its function may be expressed simultaneously with development. Examples of such print-out inhibitors include the mono-halogen compounds disclosed in JP-B No. 54-164, the tri-halogen compounds disclosed in JP-A No. 53-46020, the compounds having halogens bound to aliphatic carbon atoms disclosed in JP-A No. 48-45228, and the polyhalogen compounds represented by tetrabromxylene disclosed in JP-B No. 57-8454. Further, development inhibitors such as 1-phenyl-5-mercaptotetrazole disclosed in GB Patent No. 1,005,144 are also effective. In addition, the biologen compounds disclosed in JP-A No. 8-184936 are also effective. The amount of the printout inhibitor used is preferably in the range of $10^{-4}$ mole to 1 mole per mole of Ag, more preferably $10^{-3}$ to $10^{-1}$ mole per mole of Ag.

In heat development with the treatment material, a small amount of water is preferably used for the purposes of promoting development, promoting transfer of a material to be treated, and promoting diffusion of unnecessary materials. Specifically, the photosensitive material or the treatment material is provided with water in a 1/10- to 1-fold amount relative to the amount of water required for the maximum swelling of the whole coated film excluding the back layers in both the photosensitive material and the treatment material, and then the photosensitive material is laid on the treatment material such that the photosensitive material is opposite the treatment layer, and these are heated for the predetermined time at the predetermined temperature described below. Water referred to herein may be any water generally used. Specifically, distilled water, tap water, well water, mineral water etc. can be used.

The state of the film upon swelling is instable, and the photosensitive material and the treatment material are attached to each other in a water-swollen state and heated, during which the amount of water is limited in the range described above, whereby local uneven coloration can be effectively prevented. The amount of water required for the maximum swelling is determined by immersing the photosensitive material or treatment material having the coating film in water, then measuring the thickness of the sufficiently swollen film, calculating the amount of the maximum swelling, and subtracting the weight of the coating film therefrom. Further, a method of measuring degrees of swelling is also described in Photographic Science Engineering, vol. 16, p. 449 (1972).

As the method of adding water, there is a method of immersing the photosensitive material or the treatment material in water and removing excess water by a squeeze roller. However, a method of adding a predetermined water to the photosensitive material or the treatment material by only coating is more preferable. A method of spraying water by a water coater including a plurality of water-jetting nozzles arranged linearly at predetermined intervals along a direction perpendicular to the direction of delivery of the photosensitive material or the treatment material and an actuator for dislocating the nozzles toward the photosensitive material or the treatment material in the passage of transfer is particularly preferable. The temperature of water added is preferably 30 to 60° C. Examples of the method of laying the photosensitive material on the treatment material include those, disclosed in JP-A No. 62-253159 and JP-A No. 61-147244.

As described above, the lower limit of the treatment temperature in heat development is 50° C. or more, more preferably 60° C. or more. The upper limit is preferably 250° C. or less, more preferably 150° C. or less. The treatment time is preferably 3 to 90 seconds, more preferably 5 to 60 seconds. As the heating method, there are methods of contacting with a heated block or plate, contacting with a hot plate, a hot presser, a hot roller, a hot drum, a halogen lamp heater, an infrared or far infrared lamp heater, or passing through a high-temperature atmosphere. As the method of laying the photosensitive material on the treatment material such that the photosensitive layer is opposite the treatment layer, the methods desclosed in JP-A No. 62-253159 and on page 27 in JP-A No. 61-147244 can be used.

Various heat development devices can be used for the heat development process. For example, the devices described in JP-A No. 59-75247, JP-A No. 59-177547, JP-A No. 59-181353, JP-A No. 60-18951, Utility Model Application No. 62-25944, JP-A Nos. 6-130509, 6-95338, 6-95267, 8-29955 and 8-29954 are preferably used. Further, commercial devices such as Pictostat 100, 200, 300, 330 and 50 and Pictorography 3000 and 2000 (Fuji Photo Film Co., Ltd.) can be used.

The photosensitive material or the treatment material may be in a form having an electrically conductive layer of a heating element as a heating means for heat development. The heating elements used for this heating may be those disclosed in JP-A No. 61-145544 etc.

In the method of the present invention, the information on a silver image generated by the treatment described above can be read without removing undeveloped silver halide or developed silver (i.e., without conducting the fixing step, bleaching step and washing step).

Hereinafter, an example of an image processing system applicable to the method of the present invention for reading a silver image, preparing digital image data and forming a color image is described. In this example, a color photographic film is subjected to black and white development in order to generate a silver image not containing the information on coloring material. In the case of black and white development, light sources of wavelengths for red light (R light), green light (G light) and blue light (B light) can be used, but in this example, the silver image is read by infrared light (IR light). When R, G and B lights are used to read the image without termination of development or under development, there arises the problem of sensitization of silver halide with reading light, but this problem can be solved by using R light.

FIG. 1 shows the whole constitution of the image processing system 10. As shown in FIG. 1, the image processing system 10 is composed of a magnetic information reading part 12, a standard light exposure part 14, a development part 16, a buffer part 18, a film scanner 20, an image processor 22, a printer part 24, and a processor part 26.

The image processing system 10 is for image processing by reading film images (silver images) recorded on a color photographic film such as negative film and reversal film (positive film) etc., to print the images after image processing on a photographic paper, and for example, film images on a photographic film of 135 size, a photographic film of 110 size and a photographic film on which a transparent magnetic layer is formed (photographic film of 240 size: the so-called APS film), photographic films of 120 size and 220 size (brownie size) can be subjects of processing. The photographic film 28 is transferred in the direction of the arrow A in FIG. 1 with the side of the emulsion layer (the side of the B photosensitive layer) facing up. In the image processing system, images may be formed on thermosensitive paper by heat, or images may be formed on recording media such as paper by xerography, ink jetting etc.

Figure 28:
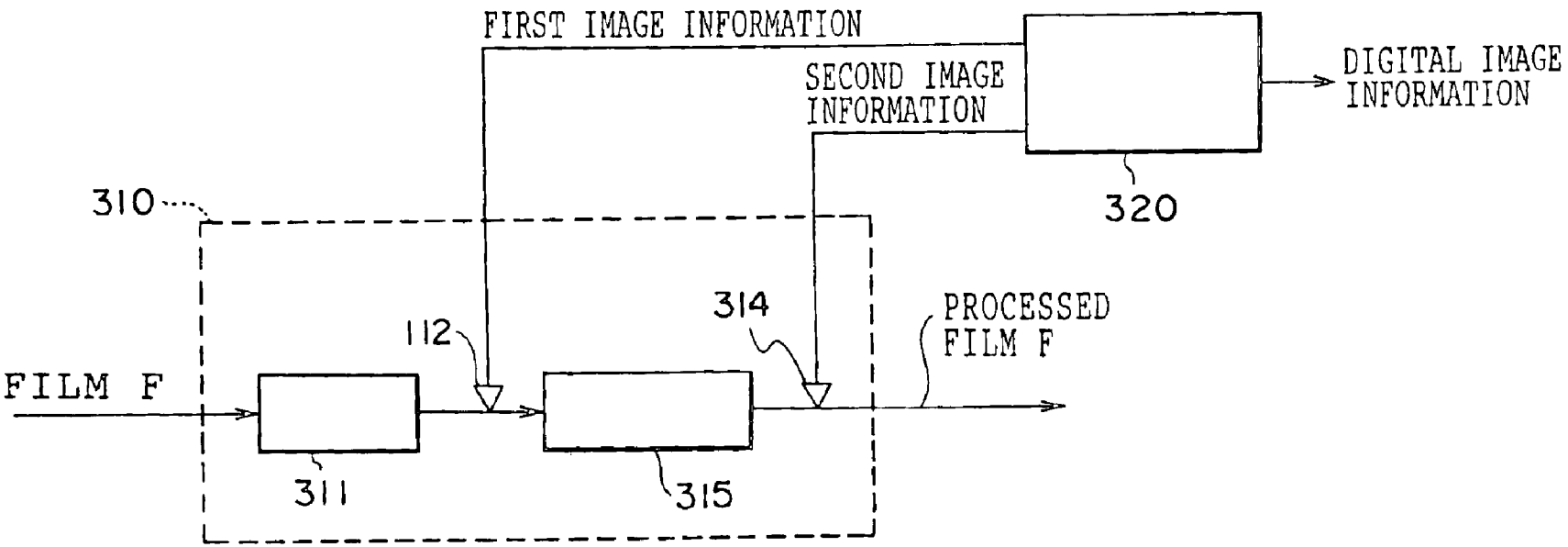
FIG. 28 is a block diagram schematically showing the flow of the processes in the ninth and tenth aspects of the present invention.

The magnetic information reading part 12 is used for reading magnetic information recorded on the magnetic layer 30 formed under image frame of an APS film 28A in the case where the photographic film 28 processed is the APS film shown in FIG. 28. This magnetic information also contains information on the film, such as information on film sensitivity, DX code etc.

Figure 2:
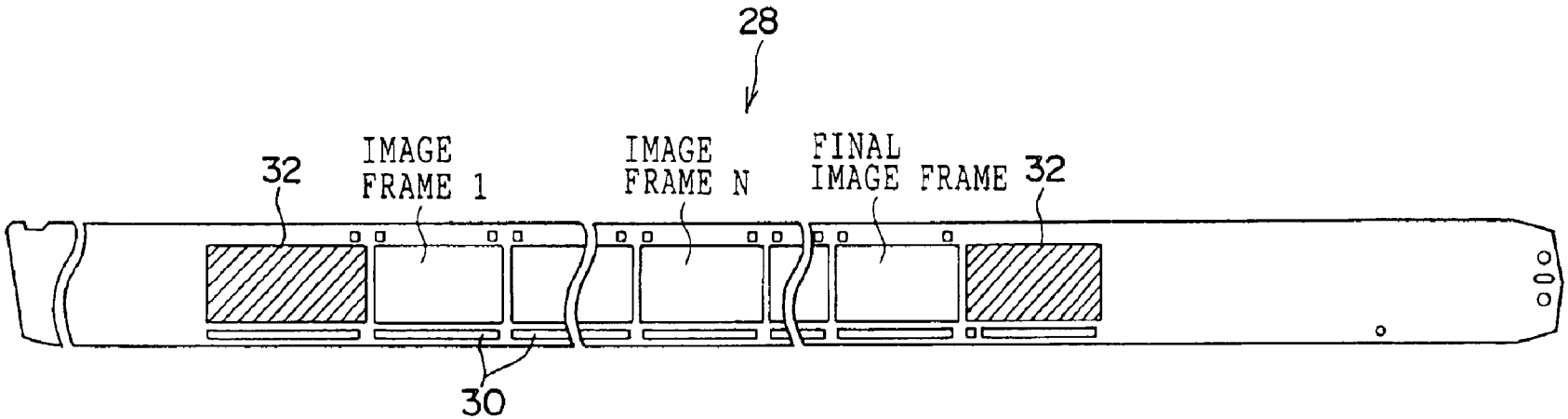
FIG. 2 is a plan view of an APS film.
Figure 3:
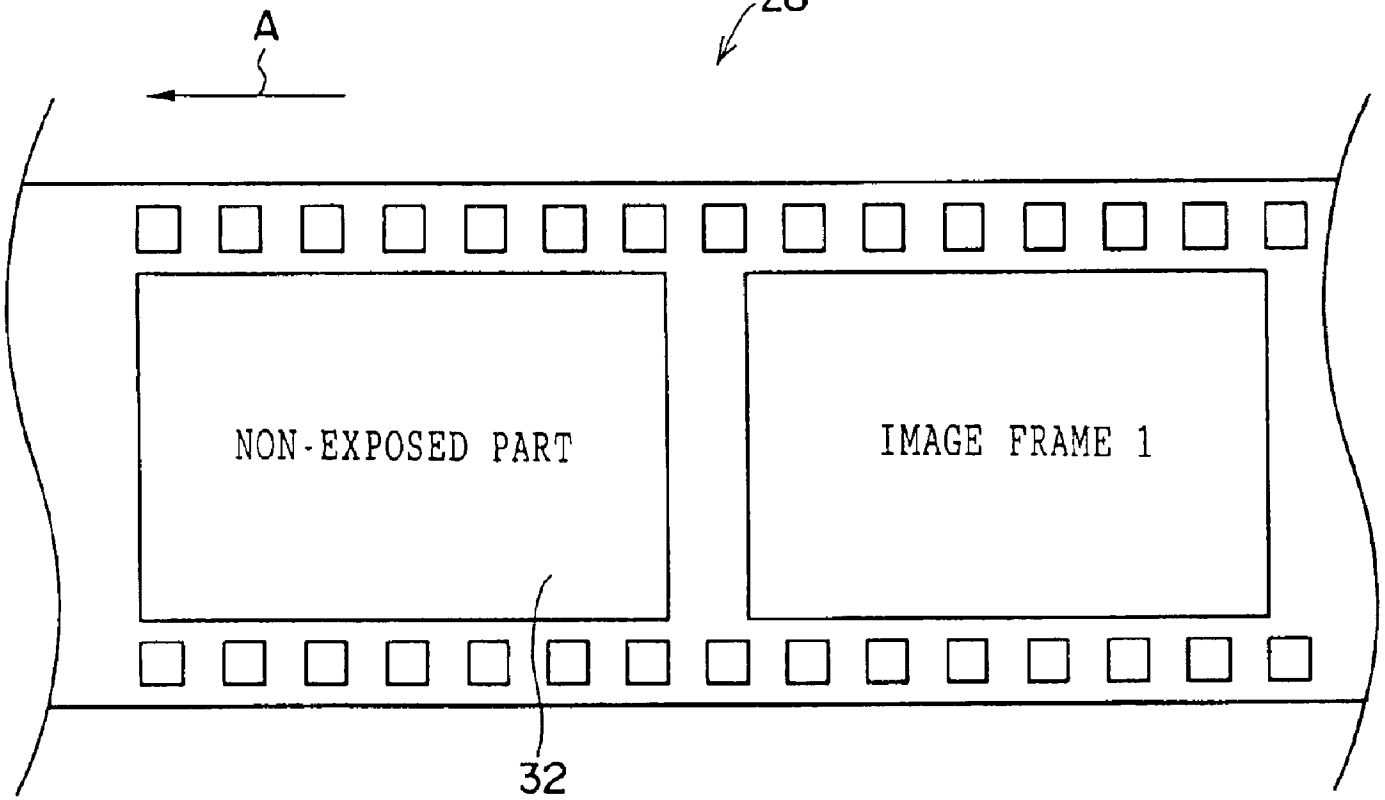
FIG. 3 is a plan view of a 135 film.

Further, the APS film 28A is provided in the top side and rear side thereof with a non-exposed area which can be arbitrarily used by the user as shown in FIG. 2, and this non-exposed area can be used as the standard light exposure part 32. Further, when the photographic film 28 is a photographic film of 135 size, the non-exposed part present in the top side or rear side of the film as shown in FIG. 3 can be used as the standard light exposure part 32.

The standard light exposure part 14 is for standard exposure of the standard light exposure part 32 to form image information used for determining image-processing conditions. Alternatively, data on read image frames is stored, and after the whole image frames are read, the image information on the standard light exposure region may be read to determine image processing conditions. However, if the image processing conditions are determined before reading the image frames, images can be processed while the image frames are read, and thus the standard light exposure part 32 at the top side of the photographic film 28 is subjected preferably to standard light exposure so that the image processing conditions can be determined before reading the image frames.

Figure 4:
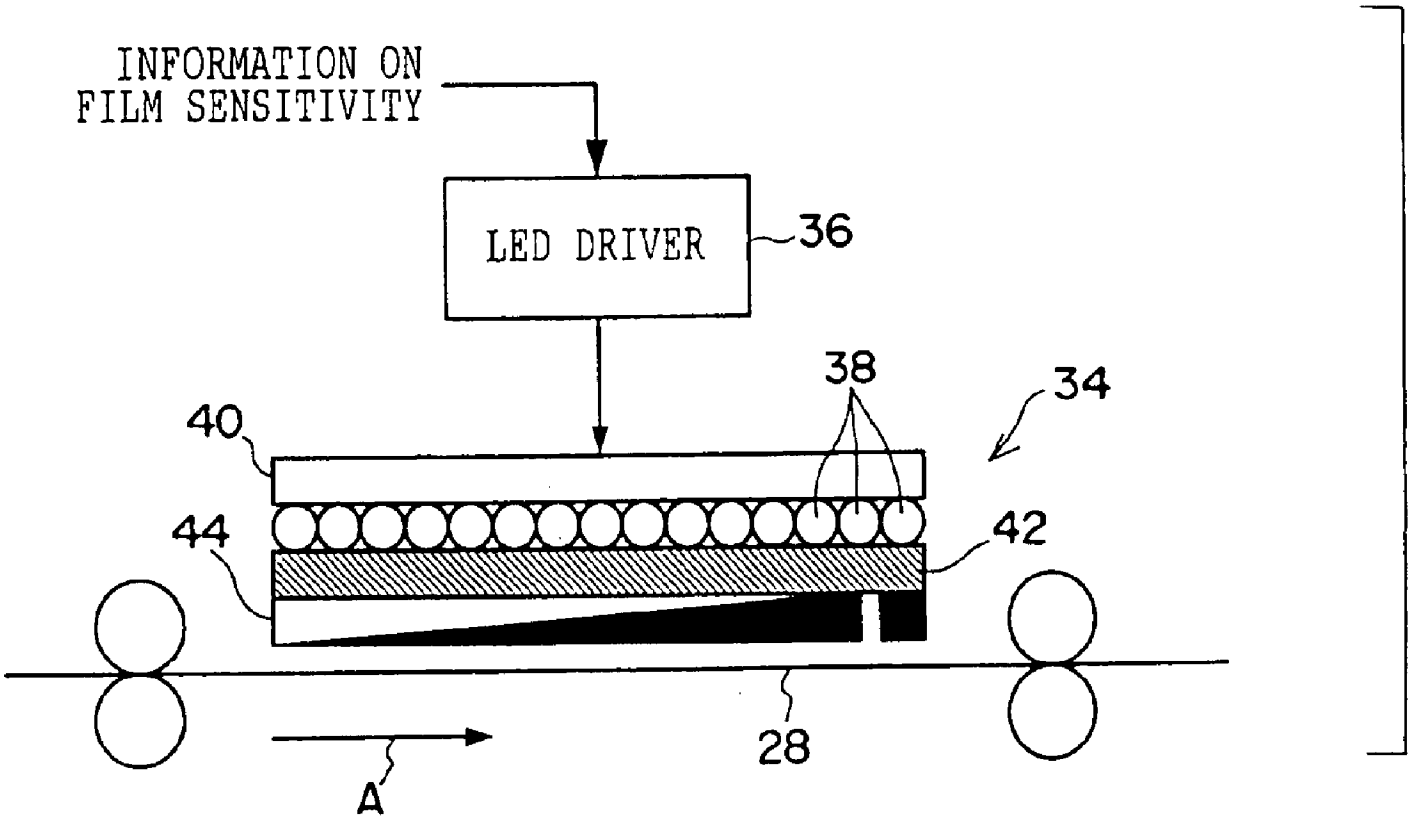
FIG. 4 is a schematic view of a standard light exposure part.

As shown in FIG. 4, the standard light exposure part 14 is composed of a light exposure part 34 and an LED driver 36. The light exposure part 34 is provided with a diffusion plate 42 in contact with LEDs below an LED substrate 40 having a plurality of LEDs 38 arranged thereon, and further provided at the side of light diffusion of the diffusion plate with a wedge 44 for generating the distribution of light density along the direction of delivery of the film.

Figure 5:
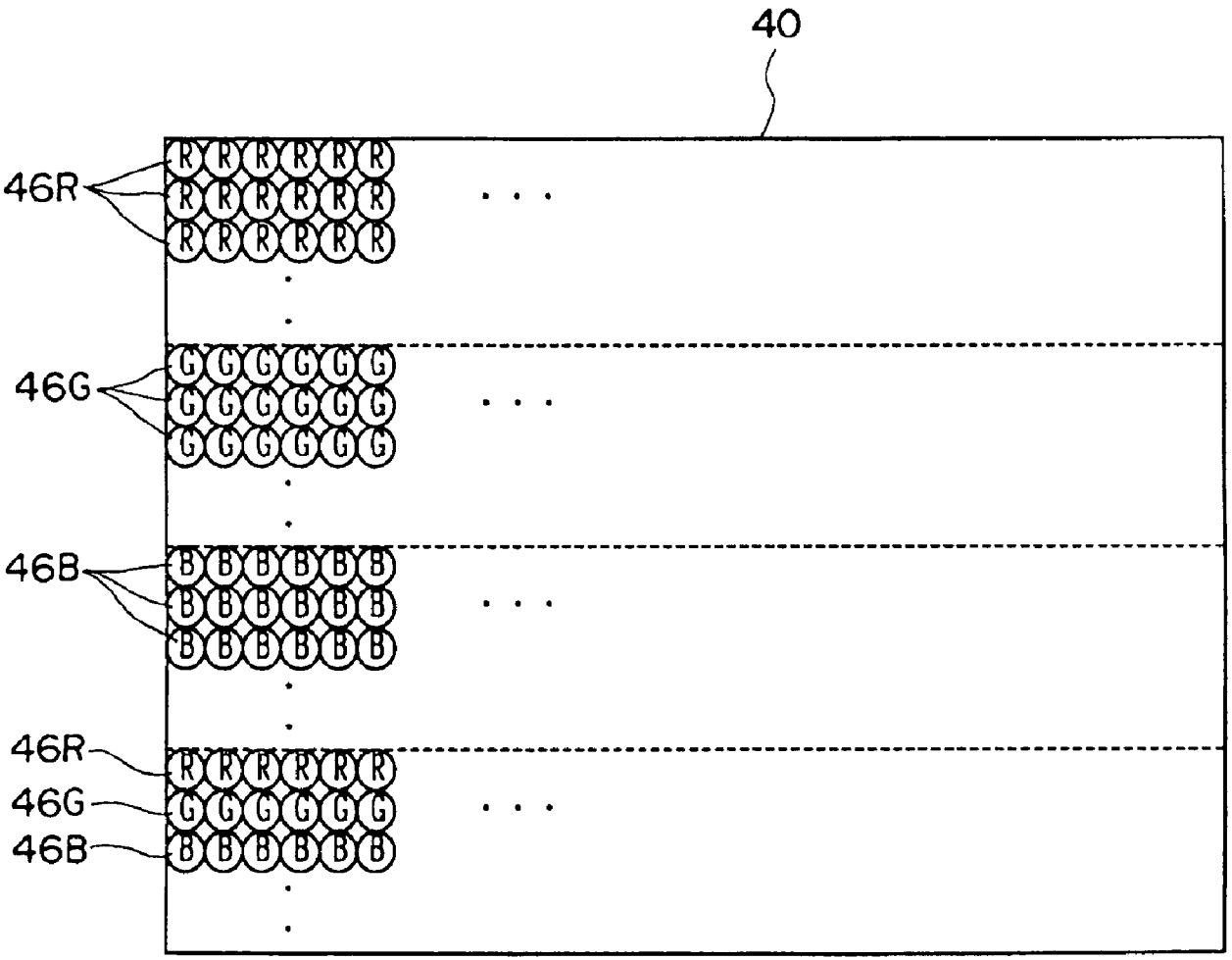
FIG. 5 is a plan view of an LED substrate.

The LED substrate 40 is divided into 4 regions as shown in FIG. 5, and in FIG. 5, LED 46R emitting red light (R light) is arranged in the highest region, LED 46G emitting green light (G light) is arranged in the second region from the top, LED 46B emitting blue light (B light) is arranged in the third region form the top, and LED 46R, LED 46G and LED 46B are alternately arranged in the lowest region. The number of LED 46R, LED 46G and LED 46B is determined preferably such that the balance among the amounts of light in the gray light exposure parts R, G, and B is near to the color temperature of standard daylight such as D65 etc.

The LED substrate 40 is connected to LED driver 36, and each LED 38 on the LED substrate 40 emits light uniformly by a predetermined electric current supplied from the LED driver 36. Further, the LED driver 36 receives the information on film sensitivity from e.g. the electric information-reading part 12, whereby the electric current supplied to each LED can be suitably regulated depending on the type of film.

The light emitted by each LED is diffused by the diffusion plate 42, and the photographic film 28 is irradiated with the light via the wedge 44. The wedge 44 is designed to change the amount of light irradiated on the photographic film 28 so that the amount of light is increased continuously from the upstream to downstream in the direction of delivery (direction of the arrow A) of the photographic film 28 as shown in FIG. 3. Alternatively, the amount of light may also be increased stepwise. Further, the upstream side in the direction of delivery of the photographic film 28 along the wedge 44 can be irradiated linearly in a roughly perpendicular direction to the direction of delivery as shown in line 48 in FIG. 6. Alternatively, the amount of exposure light may be changed by gradually increasing the electric current supplied to each LED along the direction of delivery without using the wedge 44.

Figure 6:
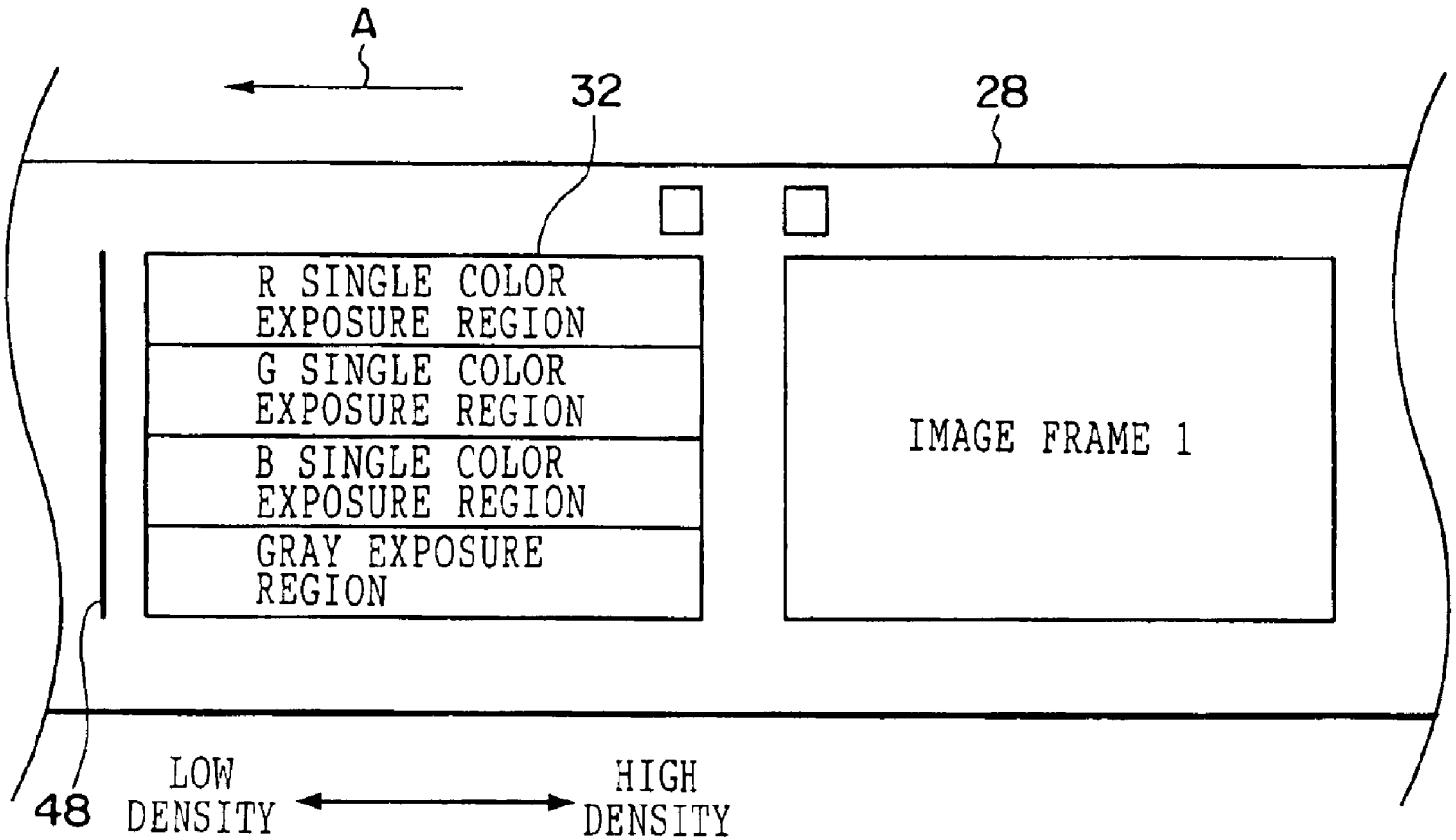
FIG. 6 is a schematic view of the standard light exposure part for APS film.

By the standard light exposure part 14 thus constituted, the standard light exposure part 32 in the photographic film 28 is subjected to standard light exposure with R light, G light, B light, and a gray light which is a mixed light of R light, G light and B light, as shown in FIG. 6. In addition, it is irradiated linearly in a roughly perpendicular direction to the direction of delivery of the photographic film 28. The line 48 is detected as trigger line whereby the standard light exposure of the standard light exposure part 32 can be detected.

Figure 7:
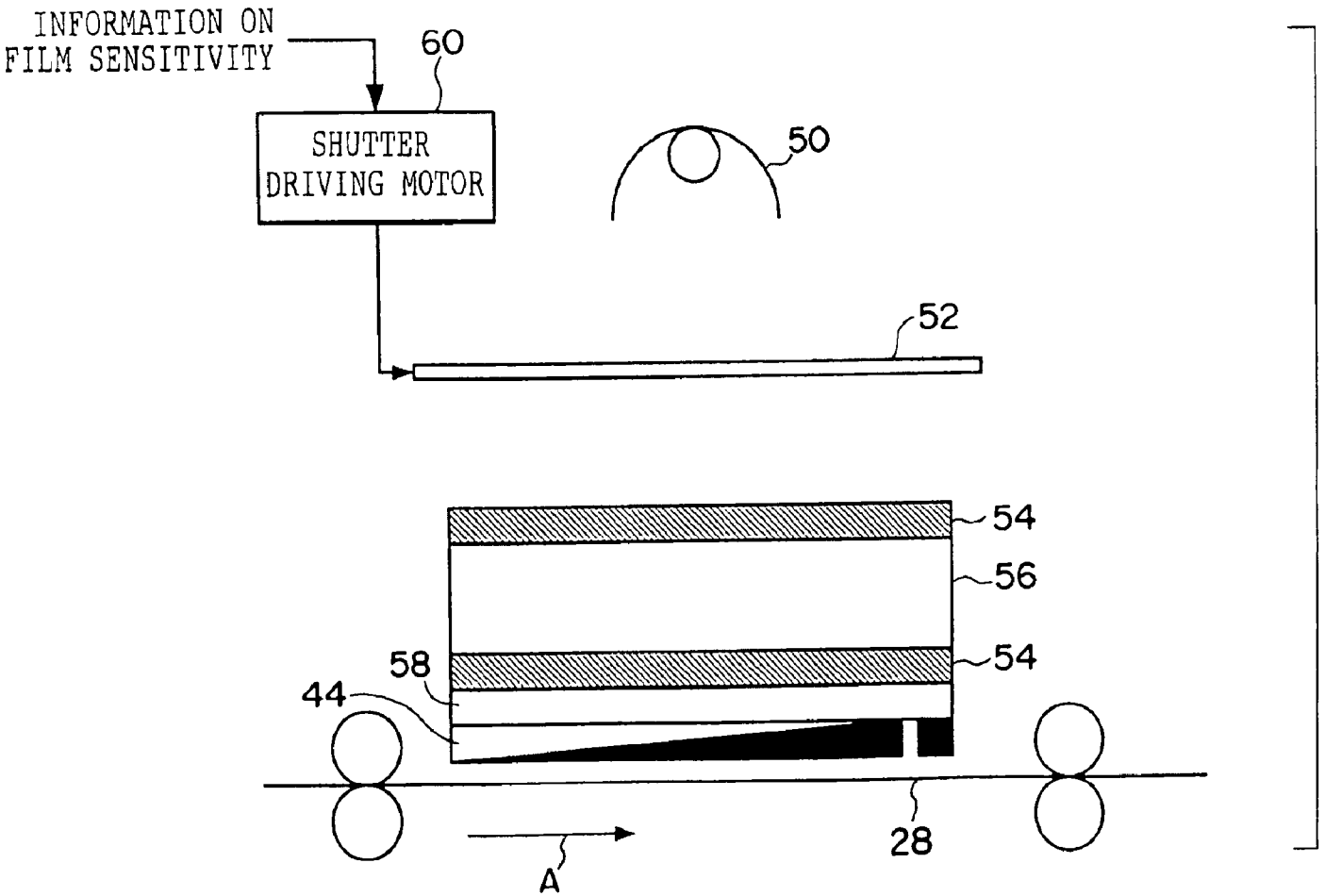
FIG. 7 is a schematic view showing another example of the standard light exposure part.

The standard light exposure part 14 may be constituted by use of a light source such as halogen lamp in place of LED, as shown in e.g. FIG. 7. The standard light exposure part 14 shown in FIG. 7 is provided with halogen lamp 50, and a shutter 52 is arranged at the light exposure side of the halogen lamp 50. Below the shutter 52, a diffusion box 56 having the diffusion plates 54 on both sides thereof, a color resolution filter 58 for resolving light into R light, G light and B light, and the wedge described above are arranged in this order.

The color separation filter 58 is composed of a filter permitting passage of only R light in incident light, a filter permitting passage of only G light in incident light and a filter permitting passage of only B light in incident light, and these are arranged in the sites corresponding to the LED arrangement in FIG. 5. In the site where LEDs 46R, 46G and 46B are alternately arranged, a color temperature conversion filter for making light having color temperature near to that of standard daylight such as D65 is preferably arranged. By using this, the same standard light exposure as in FIG. 6 can be conducted. Alternatively, correction may be conducted on the basis of the relationship between the color temperature of the halogen lamp and the color temperature of D65 without arranging the filter in order to reduce the cost.

Figure 8:
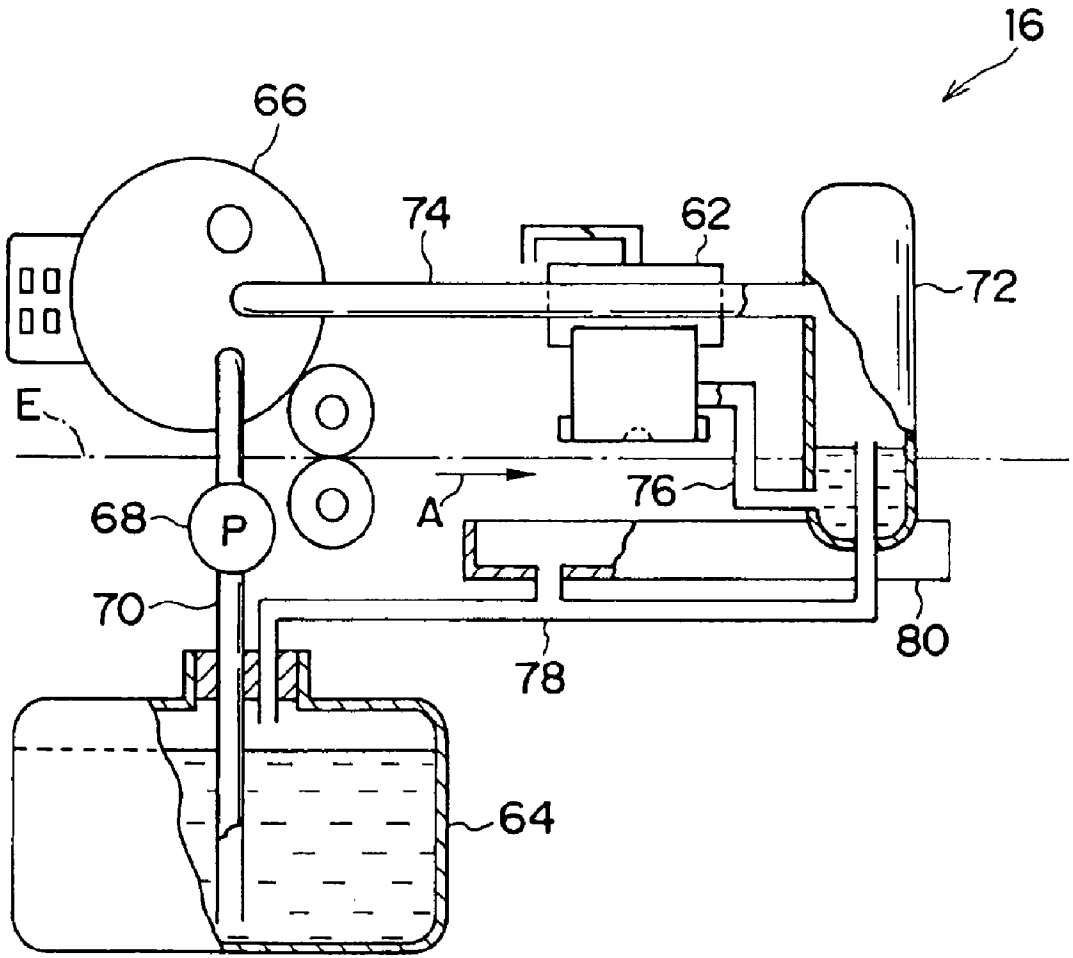
FIG. 8 is a schematic view of a developing part.

In the development part 16, black and white development is conducted by coating a developing solution for black and white development onto the photographic film 28. The development part 16 is provided with a jetting tank 62 for jetting a developing solution onto the photographic film 28, as shown in FIG. 8.

At the lower left side of the jetting tank 62, a developing solution bottle 64 for storing a developing solution to be fed to the jetting tank 62 is arranged, and filter 66 for filtering the developing solution is arranged over the developing solution bottle 64. A liquid-feeding pump 70 having a pump 68 arranged therein connects the developing solution bottle 64 to the filter 66. Further, a sub-tank 72 for storing the developing solution fed from the developing solution bottle 64 is arranged at the right side of the jetting tank 62, and the liquid feeding pipe 74 extends from the filter 66 to the sub-tank 72. Accordingly, when the pump 68 is actuated, the developing solution is sent from the developing solution bottle 64 to the filter 66, and simultaneously the developing solution filtered by passing through the filter 66 is sent to the sub-tank 72, and the developing solution is transiently stored in the sub-tank 72.

Further, the liquid feeding pipe 76 for connecting the sub-tank 72 to the jetting tank 62 is arranged therebetween, and the jetting tank 62 is filled with the developing solution sent via the filter 66, sub-tank 72, liquid feeding pipe 76 etc. by the pump 68 from the developing solution bottle 64. A tray 80 connected via a circulating pipe 78 to the developing solution bottle 64 is arranged in the lower part of the jetting tank 62, and the developing solution overflowing from the jetting tank 62 is collected in the tray 80 and returned via the circulating pipe 78 to the developing solution bottle 64. The circulating pipe 78 is connected to the sub-tank 72 by extending to the inside of the sub-tank 72 thereby returning an excess of the developing solution retained in the sub-tank 72 to the developing solution bottle 64.

Figure 9:
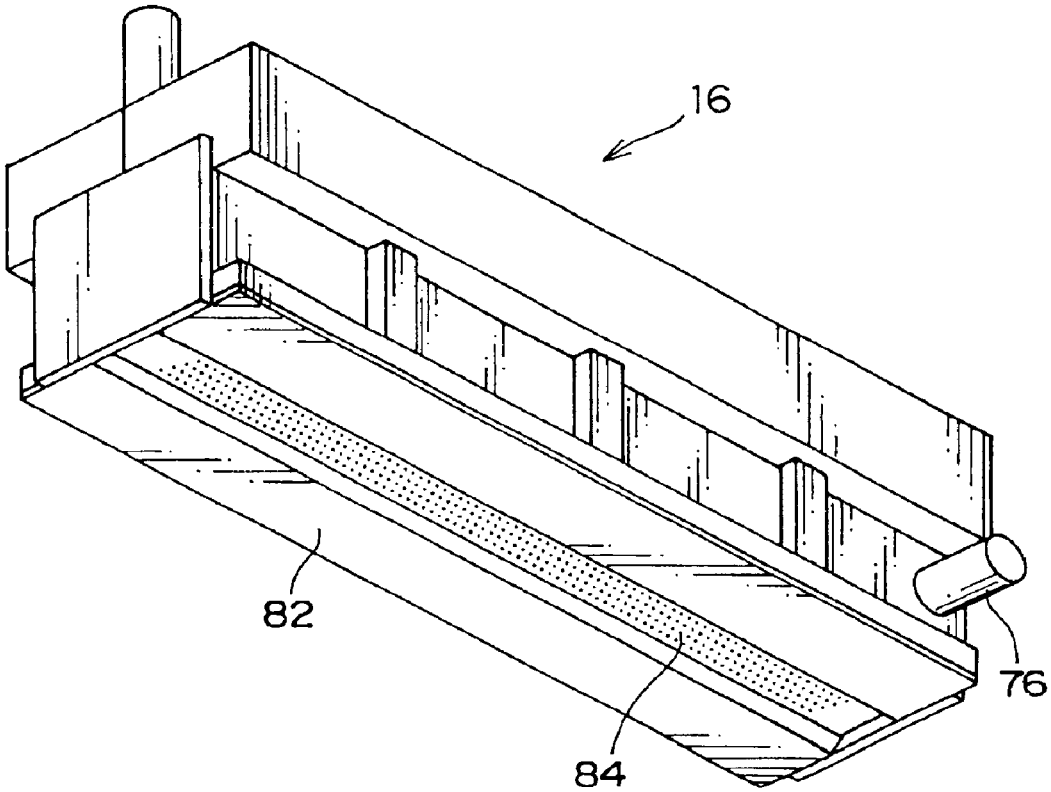
FIG. 9 is a diagram of a jet tank.
Figure 10:
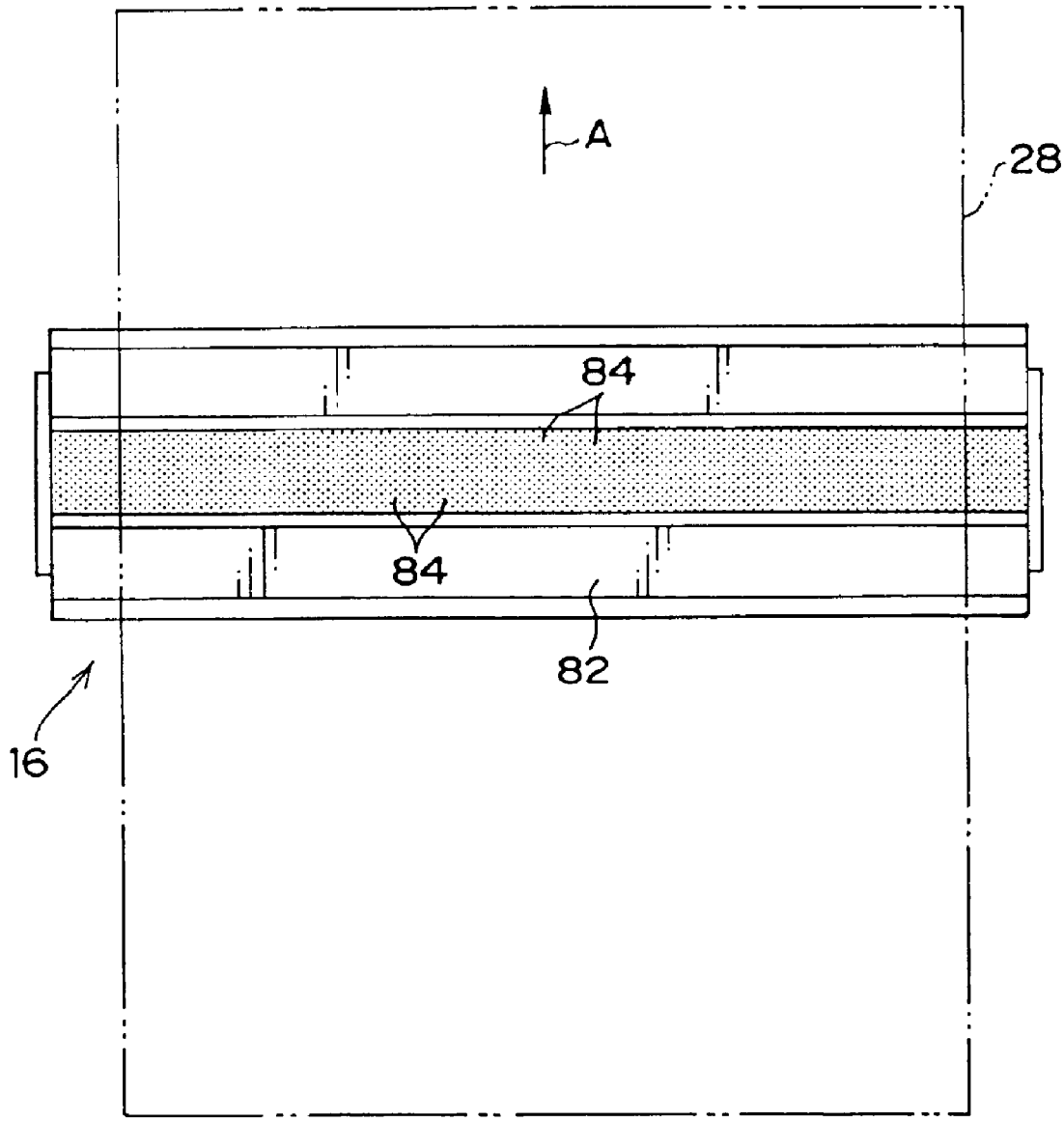
FIG. 10 is a bottom view of a jet tank.

Further, as shown in FIGS. 9 and 10, a part of the wall face of the jetting tank 62, which is opposite the delivery passage E for the photographic film 28, is provided with a nozzle plate 82 formed by bending an elastically deformable rectangular thin plate. As shown in FIGS. 9 and 10, the nozzle plate 82 is provided with a plurality of nozzle holes 84 (e.g. those having a diameter of dozens $\mu$m) at predetermined intervals along a direction perpendicular to the delivery direction A of the photographic film 28 and in the longer direction of the nozzle plate 82, and these nozzle holes are formed in the whole of the width direction of the photographic film 28, thus forming nozzle lines extending linearly. A plurality of such nozzle lines is arranged in a cross-stitched form in the nozzle plate 82.

That is, a plurality of nozzle lines formed by a plurality of linearly arranged nozzle holes 84 are arranged to extend in the longer direction of the jetting tank 62, and the developing solution filled in each jetting tank 62 can be released and jetted toward the photographic film 28 through the nozzle holes 84 constituting these nozzle lines. By jetting the developing solution from the jetting tank 62, the photographic film 28 delivered at an approximately constant rate is subjected to black and white development.

Figure 20:
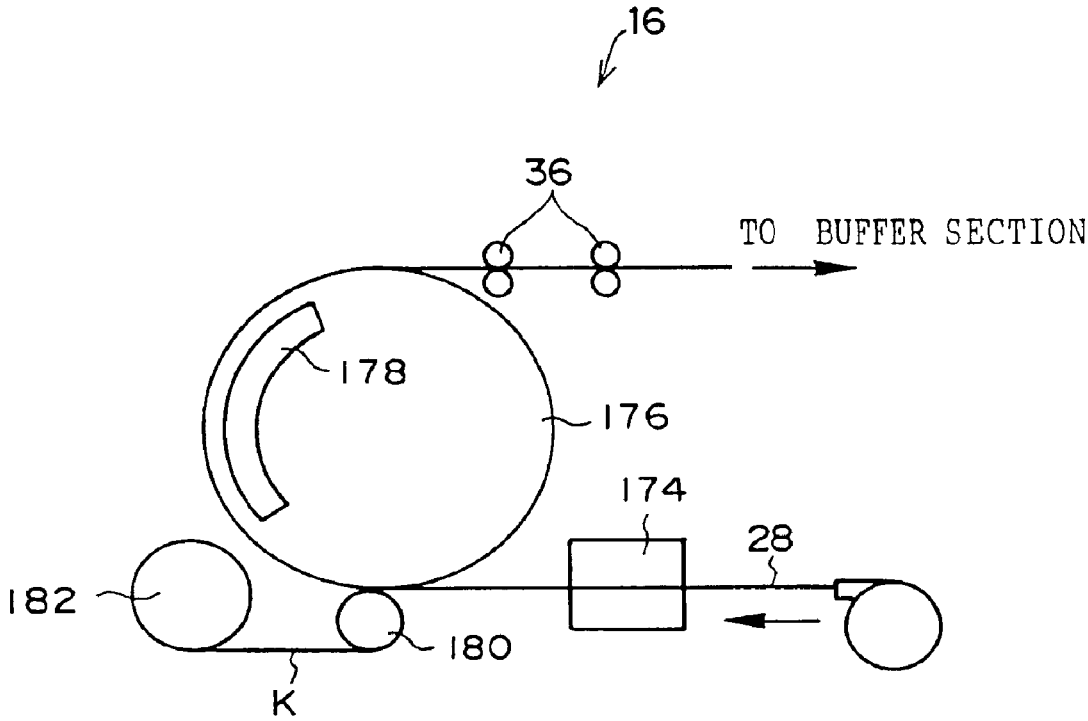
FIG. 20 is a schematic view showing another structure of the developing part.

In this example, the developing part 16 is constituted such that the developing solution is coated by jetting, but the developing part 16 may be constituted by use of the thermal developing unit described below. In this case, the developing agent is contained in the photosensitive material constituting the photographic film 28. As shown in FIG. 20, the developing part for heat development includes a water coater 174 at the downstream side in the direction of delivery, and at the further downstream side, a drum 176 and a delivery roller 180 are arranged. In this unit, the photographic film 28 passes through the water coater 174, and the film is then introduced into between the lower face of the drum 176 and the upper face of the delivery roller 180 and laid on a treatment member K fed from a feeding reel 182, and the film sandwiched between the treatment member K containing a base or a base precursor and the outer periphery of the drum 176 is delivered along the outer periphery of the drum 176. In the vicinity of the outer periphery at the left side of the drum 176, a heating part 178 is arranged, and the photographic film 28 laid on the treatment member K is heated for a predetermined time. Thereafter, the treatment member K is removed from the photographic film 28 at the top of the drum 176, and the photographic film 28, from which the treatment member K was removed, is delivered via a buffer part 18 to a film carrier 86 by a plurality of delivery rollers 36.

The buffer part 18 eliminates the difference between the rate of delivery of the photographic film 28 which is at an approximately constant rate in the developing part 16 and the rate of delivery of the photographic film 28 by the film carrier 86 described below. If the rate of delivery of the film in the developing part 16 and the rate of delivery of the film by the film carrier 86 are made identical, the buffer part can be omitted.

Figure 11:
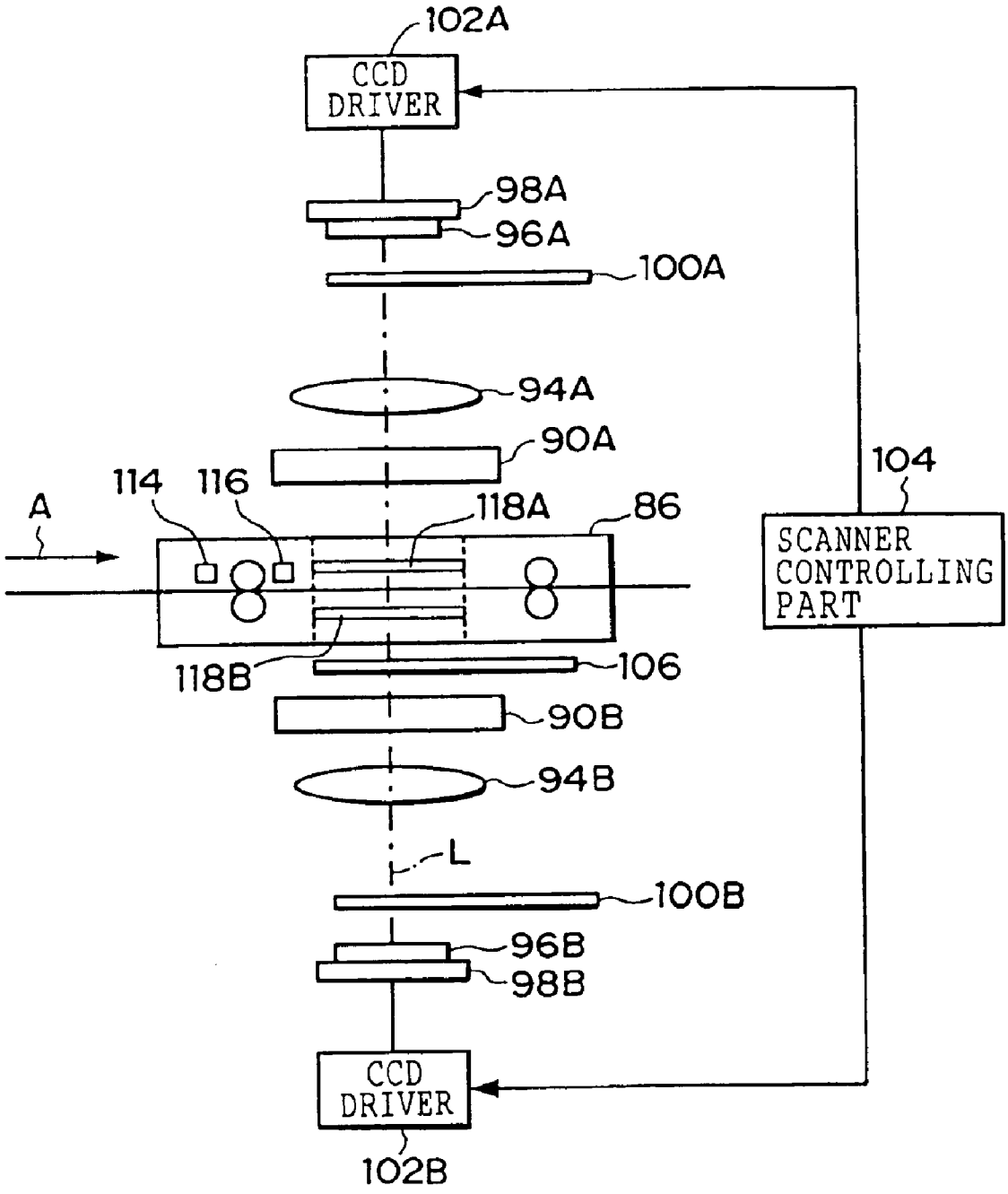
FIG. 11 is a schematic view of a film scanner.

The film scanner 12 reads images recorded in the photographic film 28 developed in the developing part 16, to output the image data obtained by this reading, and as shown in FIGS. 1 and 11, the scanner is provided with a film carrier 86.

Figure 12A:
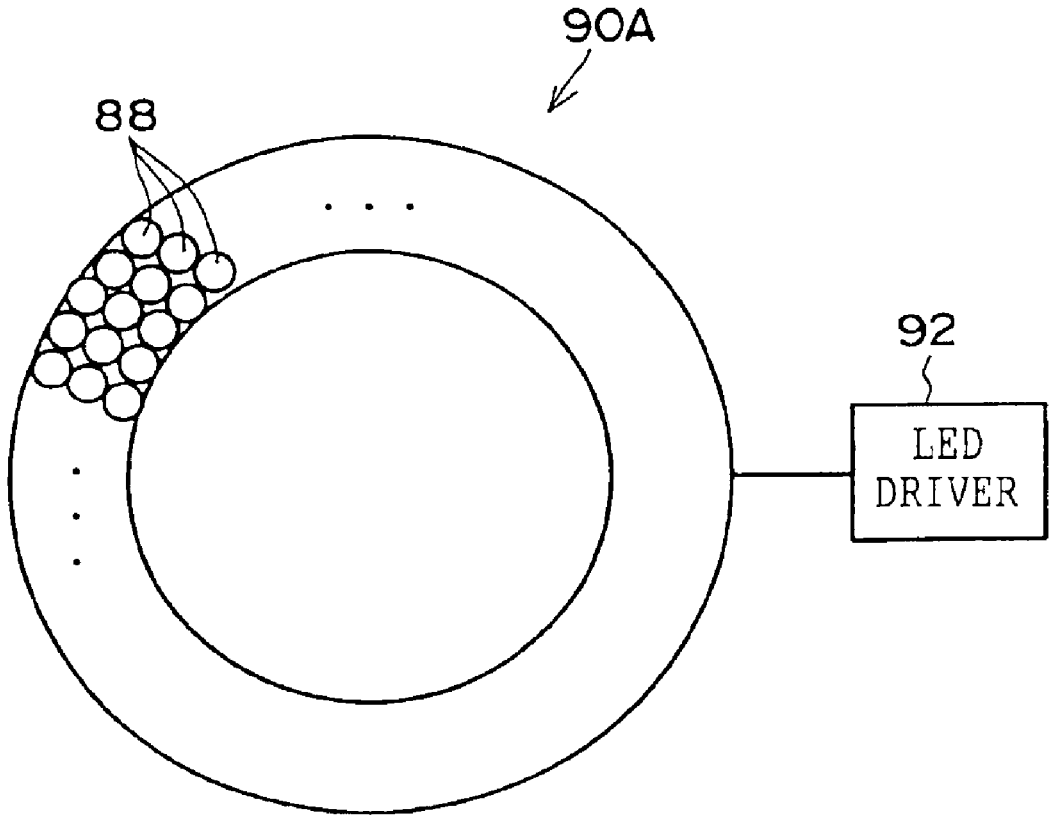
FIG. 12(A) is a bottom view of an illuminating device.
Figure 12B:
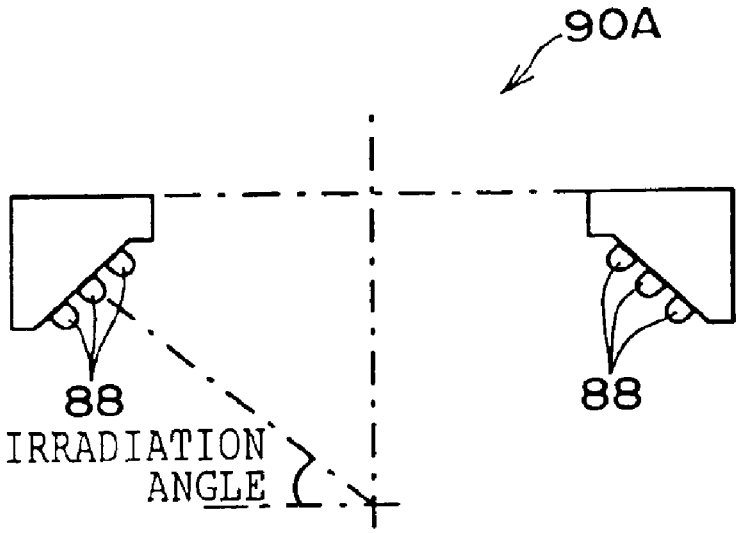
FIG. 12(B) is a side view of the illuminating device.
Figure 13:
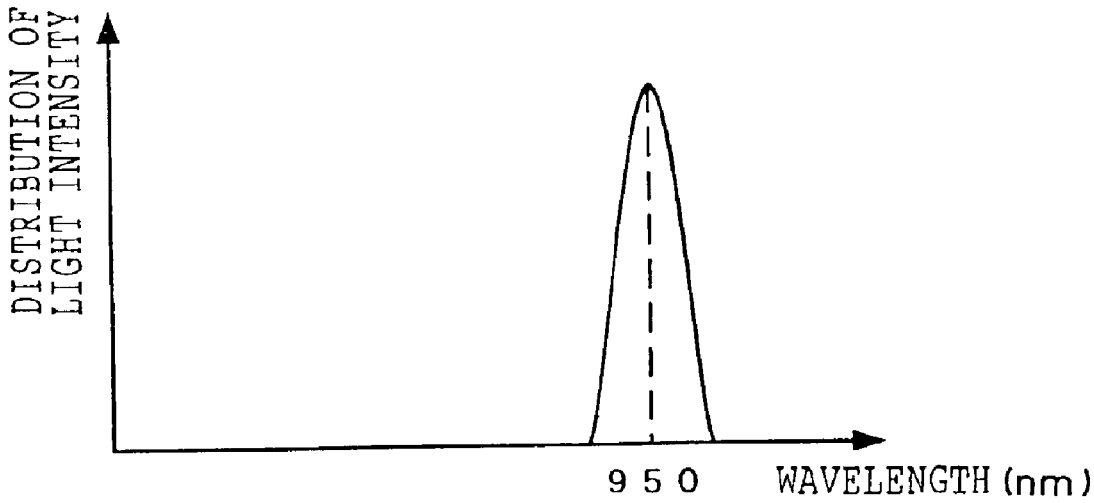
FIG. 13 is a diagram showing irradiation wavelength.

Over the film carrier 86, LEDs 88 are arranged in a ring form, as shown in FIG. 12, and an illuminating unit 90A for irradiating the photographic film 28 is arranged. The light from the illuminating unit 90A is a light (IR light) of infrared wavelength (with a central wavelength of about 950 nm) as shown in FIG. 13. The illuminating unit 90A is driven by a LED driver 92.

Figure 15:
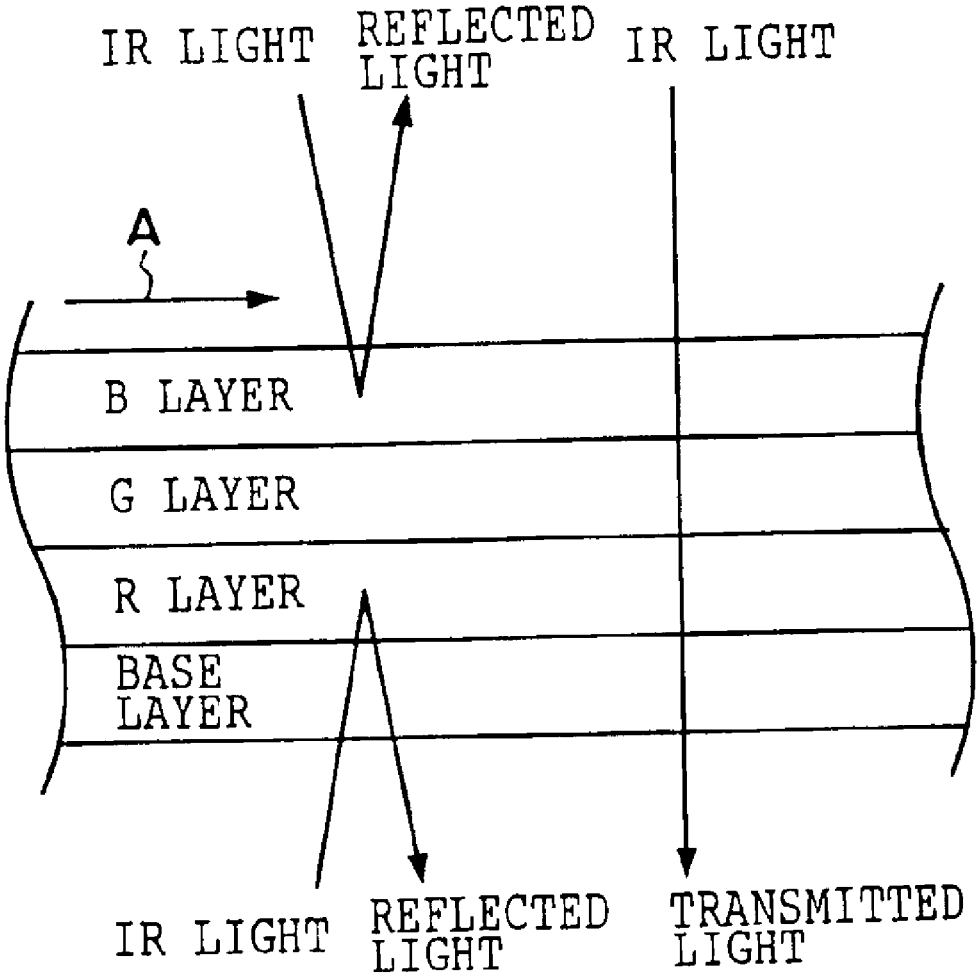
FIG. 15 is a drawing showing the reading of an image by IR light.

As shown in FIGS. 11 and 15, an image-forming lens 94A for making an image of light reflected from the B layer of the photographic film 28, and an area CCD 96A for detecting light reflected from the B layer of the photographic film, are arranged in this order along the optical axis L at the upper side of the illuminating unit 90A. The area CCD 96A is a monochromic CCD wherein a large number of CCD cells (photoelectrical conversion cells) each having sensitivity in the infrared range are arranged in a matrix form, and the light-receiving face is arranged to agree approximately at the image-forming point of the image-forming lens 94A. Further, the area CCD 96A is arranged in an image-sliding unit 98 A. In addition, a black shutter 100A is arranged between the area CCD 96A and the image-forming lens 94A.

The area CCD 96A is connected via a CCD driver 102A to a scanner controller 104. The scanner controller 104 is provided with CPU, ROM (e.g. ROM capable of re-writing a memory), RAM and an input-output port, and these are connected mutually via bus etc. to constitute the controller. The scanner controller 104 controls the working of each part in the film scanner 20. Further, the CCD driver 102A generates a driving signal for driving the area CCD 96A, to control the driving of the area CCD 96A.

At the lower side of the film carrier 86, the illuminating unit 90B, the image-forming lens 94B, the area CCD 96B arranged on the image-sliding unit 98B, and the CCD driver 102B are arranged in this order. These have the same constitutions as in the above-described illuminating unit 90A, the image-forming lens 94A, the area CCD 96A and the CCD driver 102A, respectively, but the area CCD 96B detects both reflected light reflected by the R layer of the photographic film 28 as shown in FIG. 15, out of the IR light irradiated on the photographic film 28 by the illuminating unit 90B, and transmitted light transmitted through the photographic film 28, out of the light irradiated on the photographic film 28 by the illuminating unit 90A.

A brightness-correcting ND filter 106 is arranged between the illuminating unit 90B and the film carrier 86. The brightness-correcting ND filter 106 is constituted such that a plurality of openings (5 openings in this embodiment) excluding one opening 110 provided in a turret 108 capable of rotating along the direction of the arrow B have ND filters 112A to 112D of different transmittances inserted therein respectively.

The film carrier 86 carries the photographic film 28 such that the center of the image recorded on the photographic 28 is positioned at a position (reading position) agreeing with the optical axis L.

Figure 16:
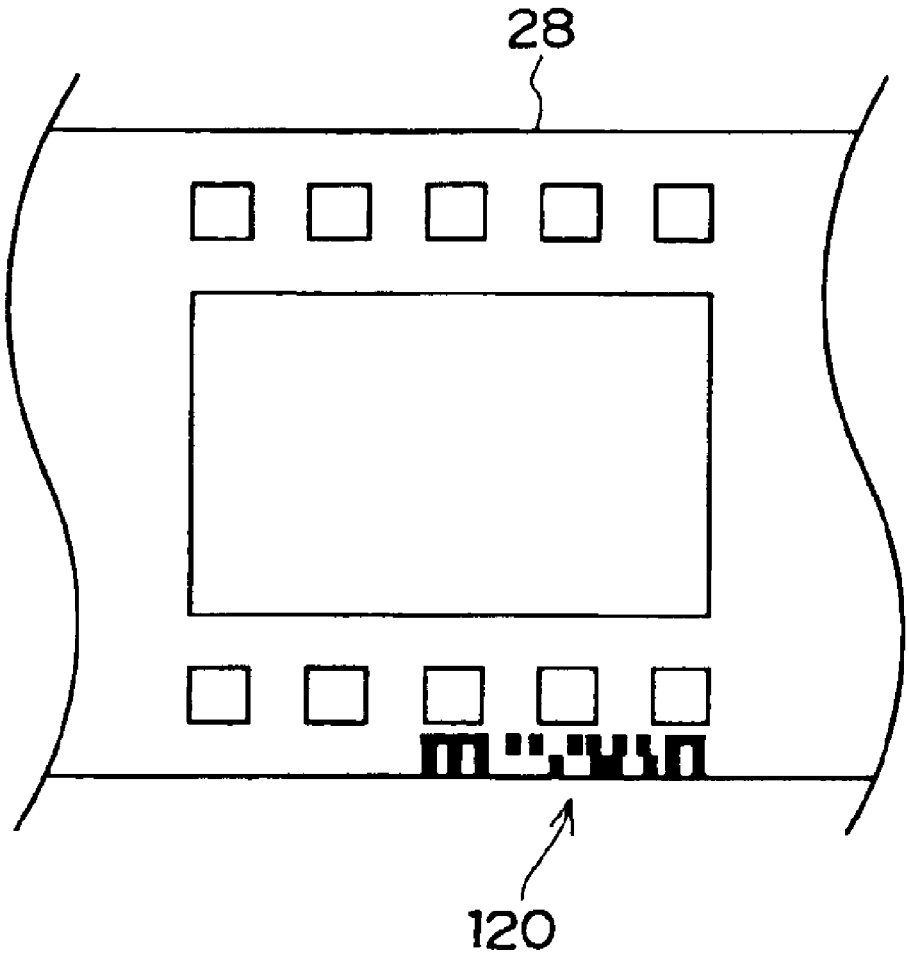
FIG. 16 is a drawing showing DX codes.

Further, the film carrier 86 is provided with a DX code reading sensor 114, a frame-detecting sensor 116, brightness correcting reflection standard plates 118A, 118B etc. The DX code-reading sensor 114 reads the DX code 120 optically recorded on the photographic film 28 of 135 size as shown in FIG. 16. The frame-detecting sensor 116 detects the image frame position of the photographic film 28. The center of the image is thereby positioned at a position agreeing with the optical axis L.

Figure 14A:
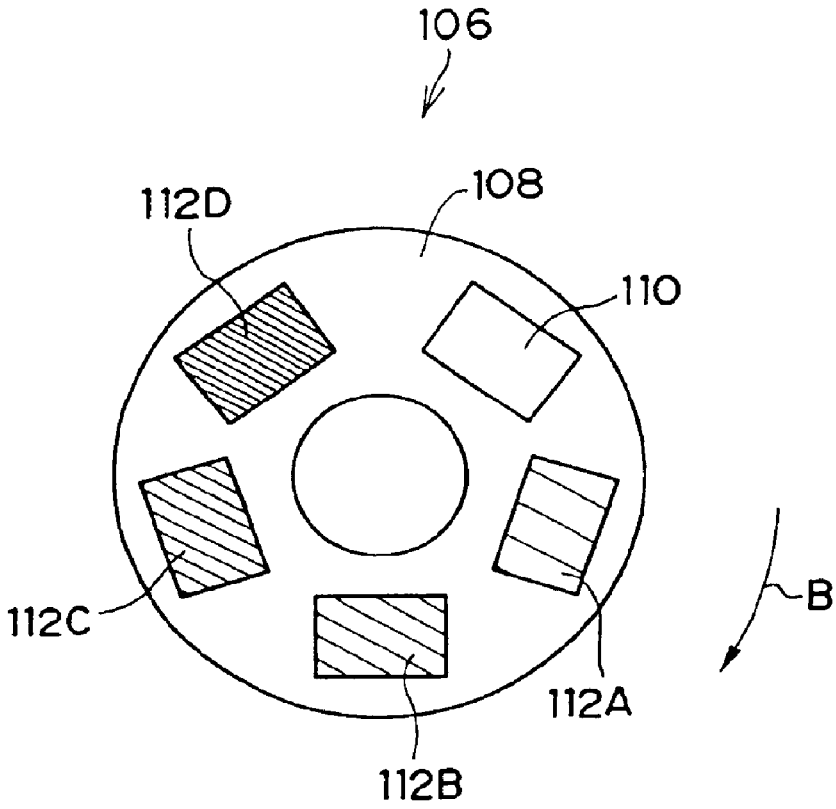
FIG. 14(A) is a plan view of a brightness correcting ND filter.
Figure 14B:
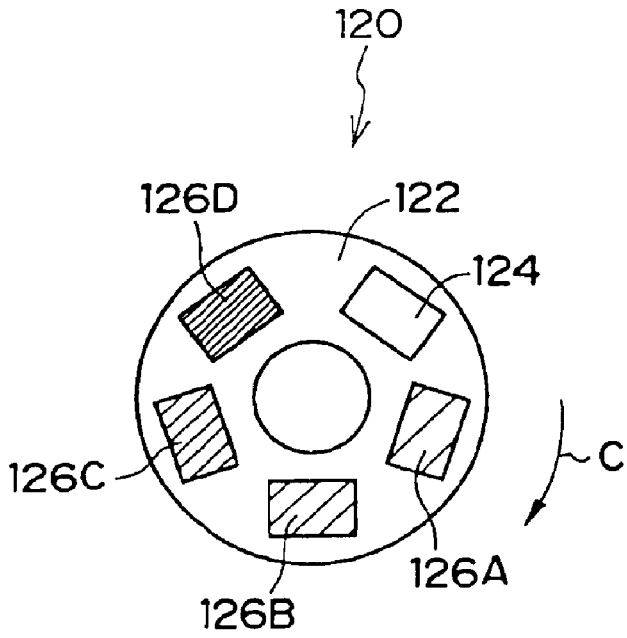
FIG. 14(B) is a plan view of a brightness correcting reflection plate.

The brightness correcting reflection plates 118A and 118B are arranged to be opposite to each other while sandwiching the photographic film 28 therebetween, and as shown in FIG. 14(B), the filter 120 is constituted such that a plurality of openings (5 openings in this embodiment) excluding one opening 124 provided in a turret 122 capable of rotating along the direction of the arrow C have reflection plates 126A to 126D of different transmittances inserted therein respectively.

The photographic film 28 is delivered by the film carrier 86 and positioned such that the center of the image is positioned at a position (reading position) agreeing with the optical axis L. Further, while the image is positioned at the reading position, the scanner controller 104 causes rotation of turrets 122 and 108 such that the opening 124 of the brightness correcting reflection plates 118A and 118B and the opening 110 of the brightness correcting ND filter are positioned on the optical axis L, and simultaneously the charging accumulation times t1 and t2 of the areas CCD 96A and 96B corresponding to predetermined reading conditions are set in the CCD drivers 102A and 102B respectively.

Figure 17:
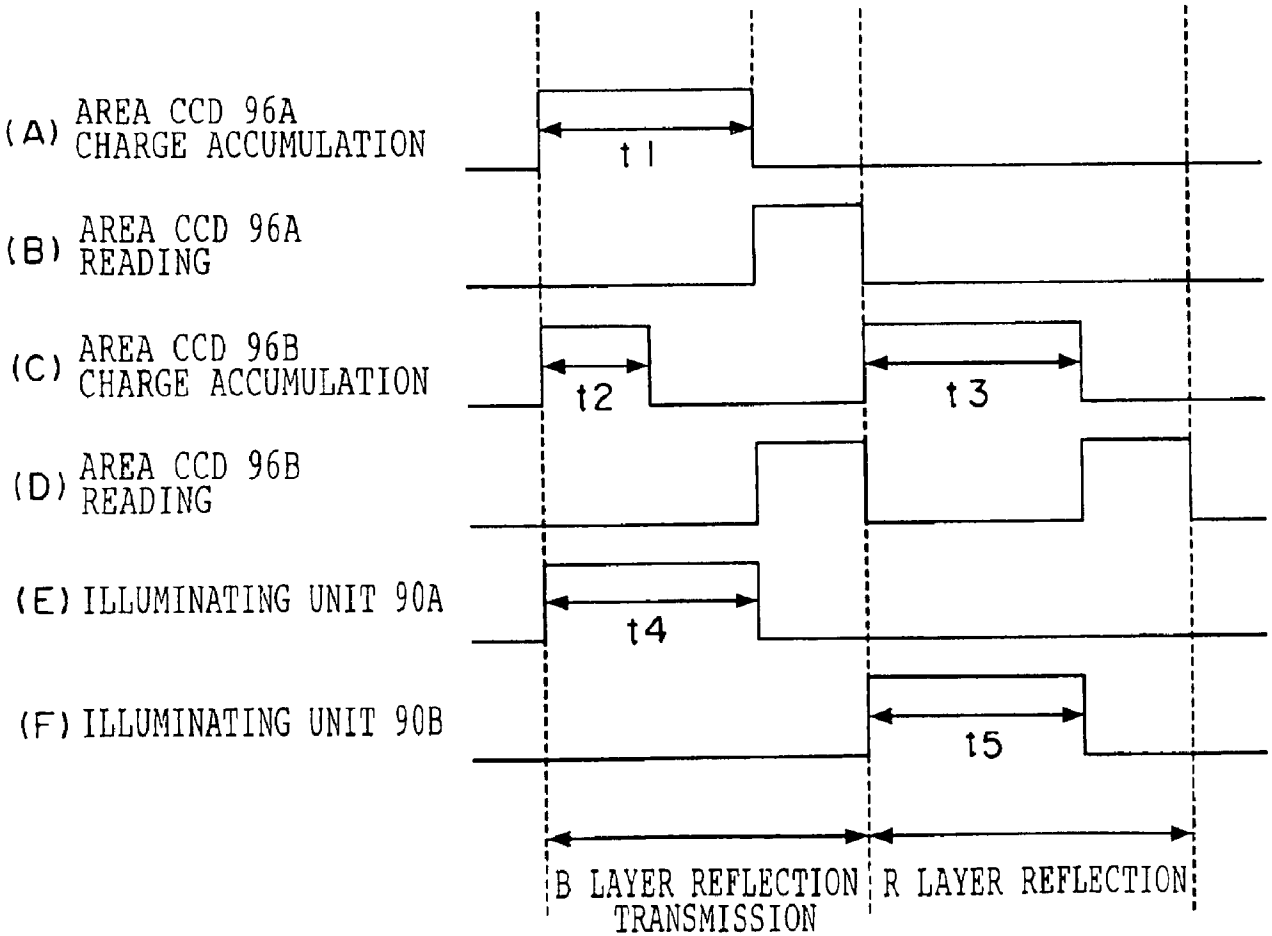
FIG. 17 is a timing chart showing the timing of reading of an image.

When the illuminating unit 90A is thereby lighted by the scanner controller 104 as shown in FIG. 17(E), the B layer in the photographic film 28 is irradiated with IR light, and the reflected light from the B layer in the photographic film 28 is detected by (and specifically, photoelectrically converted charges are accumulated in) the area CCD 96A as shown in FIG. 17(A), and the signal indicative of the quantity of reflected light is output from the area CCD 96A as shown in FIG. 17(B).

Further, the light transmitted through the photographic film 28 is simultaneously detected by the area CCD 96B as shown in FIG. 17(C), and the signal indicative of the quantity of transmitted light is output from the area CCD 96B as shown in FIG. 17(D).

When detection of the transmitted light and the reflected light from the B layer is finished, the illuminating unit 90B is lightened by the scanner controller 104 as shown in FIG. 17(F), and the base layer in the photographic film 28 is irradiated with IR light, and the light reflected from the R layer in the photographic film 28 is detected by the area CCD 96B as shown in FIG. 17(C), and the signal indicative of the quantity of reflected light is output from the area CCD 96B as shown in FIG. 17(D).

The amount of light irradiated by the illuminating units 90A and 90B and the lighting times t4, t5, and the charge accumulating times t1, t2 and t3 by the area CCDs 96A and 96B are set by set-up calculation by the controller 140 as described below.

A black anti-halation layer using silver colloids not subjected to bleaching treatment shows absorption in a broad wavelength range, thus extinguishing incident or outgoing light. When the photographic film 28 is provided with such an anti-halation layer, the layer constitution of the film or the composition of the anti-halation layer are judged, and depending on the film, the amount of light exposed on the film at the side of the support and the amount of light exposed on the film at the side of the emulsion layer are changed, for example by making the amount of light from the illuminating unit 90B for irradiating the photographic film 28 at the side of the support higher than the amount of light from the illuminating unit 90A for irradiating the photographic film 28 at the side of the emulsion layer. The transmittance of the anti-halation layer using silver colloids is about 20 to 50%, and if the same amount of light is irradiated on the film at the side of the support and the film at the side of the emulsion layer, the amount of light received in the area CCD at the side of the support is 4 to 25% of the amount of light received in the area CCD at the side of the emulsion layer. Accordingly, it is preferable that the amount of light from the illuminating unit 90B for irradiating the side of the support is e.g. 2- to 4-times higher than the amount of light from the illuminating unit 90A for irradiating the side of the emulsion layer.

The amount of light reflected by the B layer is varied depending on the amount of developed silver contained in the B layer (blue-photosensitive layer), that is, the amount of silver image in the B layer. Accordingly, photoelectric conversion of light reflected by the B layer corresponds to reading of image information on a yellow coloring material image obtained by color development in place of black and white development. Similarly, photoelectric conversion of light reflected by the R layer (red-photosensitive layer) corresponds to reading of the image information on a cyan coloring material image obtained by color development. Further, the photoelectric conversion of transmitted light corresponds to reading of an image where a yellow coloring material image, a magenta coloring material image in the green-photosensitive layer and a cyan coloring material image obtained by color development have been mixed. Accordingly, silver images on three kinds of photographic layers having blue sensitivity, green sensitivity and red sensitivity are read respectively.

The reading of an image by the areas CCD 96A and 96B may be conducted several times depending on degree of generation of the silver image. For example, while the image is positioned at the reading position, the illuminating units 90A and 90B are alternately lighted at predetermined intervals, and the same image is read several times. In cases wherein the image is read several times, the image preferably is read several times at increasing intervals. For example, the time is read 10 seconds, 20 seconds, 40 seconds, etc. after a developing process at a temperature of, for example, 60° C. has begun. Reading is preferably conducted two or more times in 3 minutes or less.

The silver density in the silver image increases in response to the amount of light exposure. If the silver density is too low, the image may not be readable. Reading of the image is also difficult if the silver density is too high. The same silver image is read several times as described above. Image data for parts with high silver density is read at the initial stages of development, and image data for parts with low silver density is read when development has progressed further. Thus, a synthetic image can be formed from a plurality of image data sets to obtain a better image than would be obtained by reading image data once.

Figure 18:
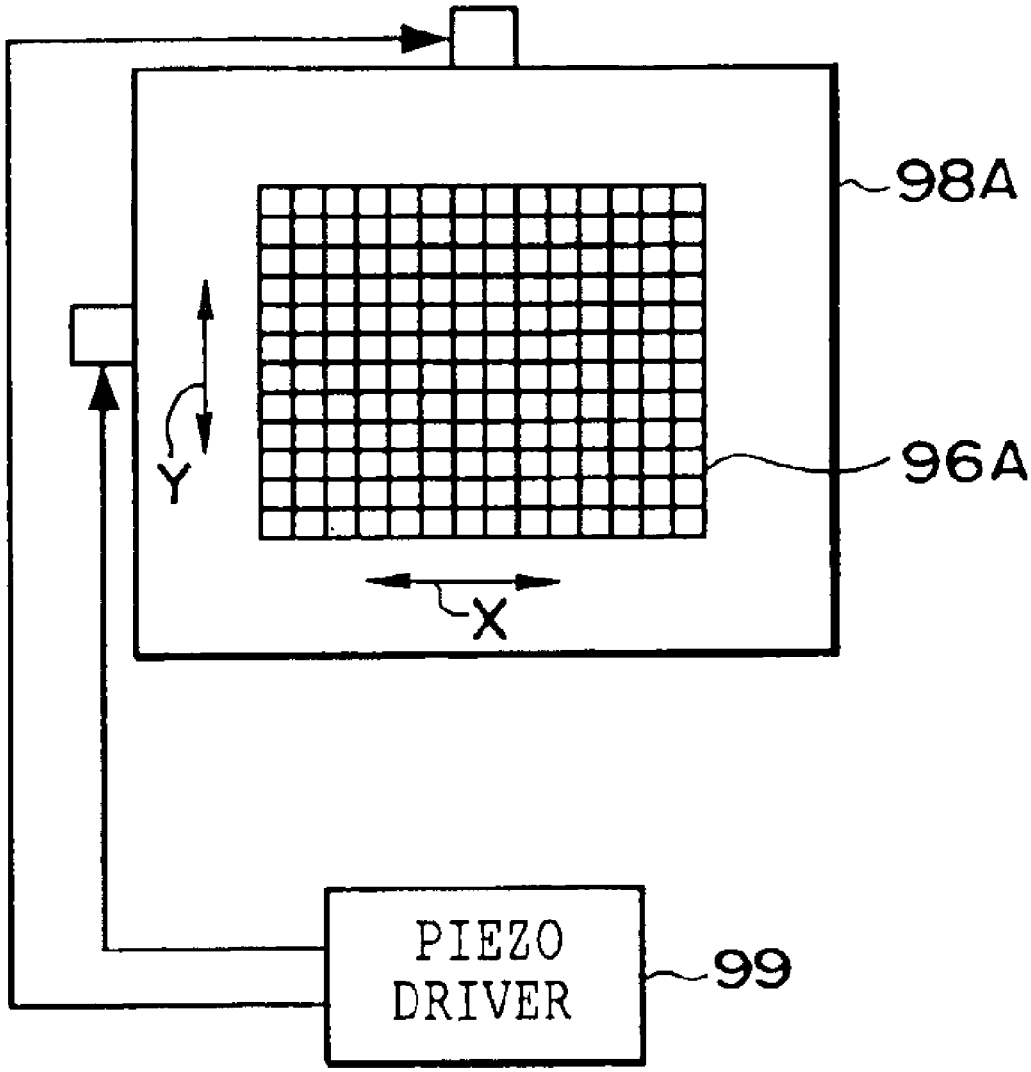
FIG. 18 is a schematic view showing an image sliding device.
Figure 19:
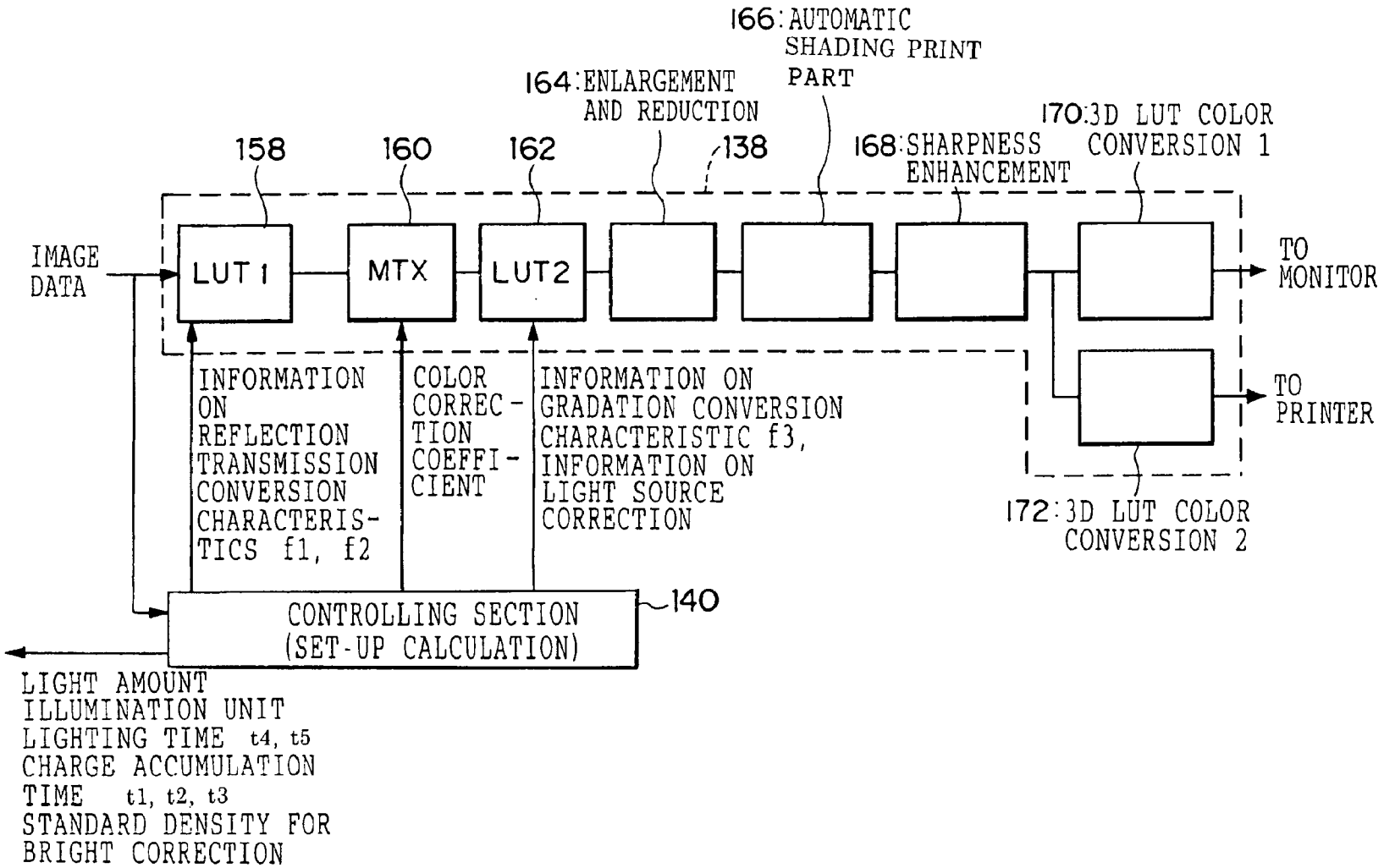
FIG. 19 is a schematic view of an image processing part.

Further, the area CCD 96A is arranged on the image-sliding unit 98A as shown in FIG. 18, and piezo elements 101X and 101Y, which are driven by a piezo driver 99, are connected to the image-sliding unit 98A. By this piezo driver 99, the piezo elements 101X and 101Y are vibrated in the X and Y directions of FIG. 18, respectively. Thus, the image-sliding unit 98A, and hence the area CCD 96A, can slide in the X and Y directions. As a request, the image can, for example, be read with four times as much resolution by sequentially moving the area CCD 96A half a pixel width in either of the X and Y directions. The area CCD 96B is similarly structured.

The present embodiment is structured such that light of the same wavelength (IR light with a central wavelength of about 950 nm) is irradiated from both the illuminating units 90A and 90B, but may be structured such that lights of different wavelengths (e.g. 850 nm and 1310 nm) are irradiated from the illuminating units 90A and 90B. In this case, reflected light and transmitted light can be detected simultaneously.

Output signals from the area CCDs 96A and 96B are amplified by amplification circuits 128A and 128B, respectively, and converted by A/D converters 130A and 130B into digital data that represent amounts of reflected light. The digital data into correlative double sampling circuits (CDS) 132A and 132B, respectively. In CDS 132A and 132B, feed-through data that represents levels of feed-through signals and image data that represents levels of signals of each image element are respectively sampled, and the feed-through data is subtracted from the image data for each image element. Calculation results (data corresponding accurately to the amount of charge accumulated in each CCD cell) is sequentially output as image data to an image processor 22.

The image data output from the CDS 132A and 132B are input into the brightness and darkness correction parts 134A and 134B, respectively. In the brightness and darkness correction parts 134A and 134B, the data is corrected for brightness and darkness by previously determined darkness correction data and brightness correcting data.

At the brightness and darkness correction part 134A, at the time when a light incidence side of the area CCD 96A is shielded by a black shutter 100A, data that is input to the brightness and darkness part (data representing a the darkness output level of each cell in the area CCD 96A) is stored as darkness correcting data for each cell in a memory (not shown). Darkness correction is conducted by subtracting the darkness output level from the input image data for each cell corresponding to each image element. Setting of the darkness correcting data can be conducted at a time of inspection of the device, at predetermined intervals, or at every scanning. Anyway, this setting is desirably conducted at such a frequency that fluctuations in darkness output levels can be compensated for. Darkness correction by the brightness and darkness correction part 134B can be conducted in the same manner as described above.

If image data of an image recorded on the photographic film 28 and subjected to conventional color development is corrected for brightness by the brightness and darkness correction part 134A, first, reflected light is read by the area CCD 96A using a white plate of high reflectance, and a gain for each cell determined on the basis of the input data and stored as the brightness correction data in an unillustrated memory. (variations in density between image elements represented by this data are attributable to variations in photoelectric conversion characteristics of the cells and to unevenness of a light source) Input image data of a frame image this is a subject of reading are corrected for each image element, on the basis of the gain determined for each cell. Brightness correction by the brightness and darkness correction part 134B can be conducted in the same manner as described above. Further, when transmitted light from the illuminating unit 90A is to be read and brightness-corrected, brightness correcting data is determined while the light of the illuminating unit 90A transmitted unhindered.

However, if the brightness correcting data is determined by use of a white plate or with light being transmitted unhindred, in cases where brightness correction is conducted for image data of an image recorded on the photographic film 28 and subjected to black and white development, the brightness correcting data is too bright as compared with the density of the image recorded on the photographic film 28, and suitable brightness correction cannot be conducted. Accordingly, it is preferable that the density of a non-exposed portion of the photographic film 28 is used as a standard density for brightness correction and that brightness correction is conducted after a reflection plate or filter having a density close to the standard density is located on the optical axis L. Consequently, suitable brightness correction of the photographic film 28 subjected to black and white development can be conducted. Selection of the standard density for brightness correction is conducted by a set-up calculation by the controller 140, described below.

The brightness correction may be conducted after the non-exposed portion of the photographic film 28 has been located on the optical axis. Accordingly, it becomes unnecessary to use the brightness correcting ND filter 106 or the brightness correcting reflection plates 118A and 118B, and costs can be reduced. In reading of the non-exposed portion, a charge accumulation time and an amount of light are predetermined, for approximation to a saturation point (brightest point at which linearity applies) of the area CCDs 96A and 96B, and an average when the non-exposed portion is read several times in this state is stored as brightness correcting data in a memory (not shown) In a case of reading at a high S/N level, pre-scanning is conducted for each frame, and the brightest point of the frame may be used for setting the charge accumulating time and the amount of light. Alternatively, the charge accumulating time and the amount of light may be determined on the basis of data read for the non-exposed position. If the film is judged to be an over-exposed negative after first scanning, scanning may be conducted again under brighter conditions (a longer accumulation time or an increased amount of light). Image data sets subjected to brightness and darkness correction processing in the brightness and darkness parts 134A and 134B are respectively output to the image processor 22.

The image processor 22 is provided with a frame memory 136, an image processing part 138 and a controller 140, as shown in FIG. 1. The frame memory has a capacity capable of storing image data from a frame image in each frame, and the input image data from the film scanner 20 is stored in the frame memory 136. The image data input to the frame memory 136 is subjected to image processing by the image processing part 138.

The image processing part 138 effects various kinds of image processing, according to processing conditions determined by the controller 140 and notified for each image.

The controller 140 is provided with a CPU 142, a ROM 144 (e.g., a ROM capable of re-writing a memory), a RAM 146, an input-output (I/O) port 148, a hard disk 150, a keyboard 152, a mouse 154 and a monitor 156. These are connected to each other via a bus to form the controller 140. On the basis of data read for a standard light exposure portion and input from the frame memory 136, the CPU 142 in the controller 140 conducts calculation (set-up calculation) of various parameters of image processing to be conducted in the image processing part 138, and output the parameters to the image processing part 138. This calculation is conducted in the following manner.

From both data read by reflected light and data read by transmitted light in an R single-color exposure region of the mixed color standard light exposure part 32, a conversion characteristic f1 for converting reflection density of R into transmission density of R is determined. As described above, the amount of light from each light exposure region is increased from the upstream side in the direction of delivery of the photographic film 28, and thus data of low to high density for each light exposure region can be obtained. Accordingly, the conversion characteristic f1 can provide a conversion curve for converting the reflection density of R into the transmission density of R, for example, by subtracting the data read by reflected light from the data read by transmitted light for each density zone. Thus, if the reflection density of R is $D_{HR}$ and the transmission density of R is $D_{TR}$, $D_{TR}$=f1 ($D_{HR}$).

In the CPU 142, a conversion characteristic f2 for converting reflection density of B into transmission density of B is determined from data read by reflected light and data read by transmitted light in a B single-color exposure region of the standard light exposure part 32. If the reflection density of R is $D_{HB}$ and the transmission density of R is $D_{TB}$, $D_{TB}$=f2 ($D_{HB}$).

In the controller 140, the data of the conversion characteristics f1 and f2 thus determined are output to an LUT (look-up table) 158 in the image processing part 138. In the LUT 158, the input that were data read for the R and B images are converted respectively by logarithmic conversion into reflection density data, and the converted reflection density data are converted into transmission density data by the conversion characteristics f1 and f2. The conversion of the data into transmission density by determining these conversion characteristics is conducted because light passes through the layer twice in interlayer density regions, thus making the reflection density about twice as high as the transmission density. Also, density is saturated in high density zones and the like, and accordingly there is a non-linear relationship between the reflection density and the transmission density Therefore, gray balance, etc. cannot be suitably corrected when a reading by reflected light is mixed with a reading by transmitted light.

Meanwhile, transmission reading data $D_{TG}$ for the G layer is included in transmission density data for the R, G and B layers in total. Therefore, $D_{TG}=D_{TRGB}-D_{TR}-D_{TB}$ wherein transmission reading data for the R, G and B layers in total is $D_{TRGB}$. This calculation is conducted by an MTX (matrix) circuit 160.

The reflection density of the R layer read from the base side and the reflection density of the B layer read from the emulsion layer side in a G single-color exposure region are zero if it is assumed that there is no mixed color. This assumption can be made because there is no developed silver in the R and B layers in the G single-color exposure region, so the R and B layers do not reflect at all. However, reflection reading data for the R and B layers is influenced by the lower layer (G layer in the present embodiment), thus generating mixed color and causing turbid color reproduction. Similarly, the reflection density of the B layer and the transmission density of the G layer in the R single-color exposure region and the transmission densities of the R and G layers in the B single-color exposure region are zero if it is assumed that there is no mixed color. However, in reality each layer is influenced by other layers to cause mixed color as described above.

Accordingly, the influence of mixed color can be eliminated by determining the transmission density of each layer in each single-color exposure region as described below. First, a mixed color coefficient that represents a degree of color mixing of color j in color i is calculated, wherein i and j can equal 1, 2 or 3, and 1 is R, 2 is G and 3 is B.

The data for the transmission densities of R, G and B in the absence of mixed color are signified by R, G and B, and R', G' and B' signify data for the transmission densities of R, G and B in the presence of mixed color in the following equations:

$$R'=R+a12\cdot G+a13\cdot B$$

$$G'=a21\cdot R+G+a23\cdot B$$

$$B'=a31\cdot R+a32\cdot G+B \tag{1}$$

$$\begin{pmatrix} R' \\ G' \\ B' \end{pmatrix} = \begin{pmatrix} 1 & a12 & a13 \\ a21 & 1 & a23 \\ a31 & a32 & 1 \end{pmatrix} \begin{pmatrix} R \\ G \\ B \end{pmatrix} \tag{2}$$

Mixed color coefficients a12 and a32 can be determined from the transmission density $D_{TR}$ of the R layer and the transmission density $D_{TB}$ of the B layer in the G single-color exposureg region. Similarly, mixed color coefficients a13 and a23 can be determined from the transmission density $D_{TR}$ of the R layer and the transmission density $D_{TG}$ of the G layer in the B single-color exposure region, and mixed color coefficients a21 and a31 can be determined from the transmission density $D_{TG}$ of the G layer and the transmission density $D_{TB}$ of the B layer in the R single-color exposure region.

In the CPU 142, the reverse matrix of equation (2) formed by the mixed coefficients described above is calculated to determine correction coefficients, to be output into the MTX circuit 160.

Alternatively, a discretionary color chart is exposed onto a film beforehand rather than conducting RGB single-color exposure. From data read and target values of color reproduction, the color correction coefficients may be optimized by a method of least squares or the like. That is, a subject for photography is successively photographed with the same camera using a commercial color negative film, to prepare an undeveloped film having a plurality of latent images (e.g., 2 frames) having the same design, and one frame is developed with a black and white developing solution and then dried without conducting bleaching, fixing or water washing, to obtain a black and white developed film. The other frame is developed with a color developing solution and then bleached, fixed, washed with water and dried to obtain a color development film. The color correction coefficients are determined using the image on this color development film as a target image.

The image recorded on the black and white developed film is read in three directions by a separately provided film scanner. That is, light (IR light in the present embodiment) is irradiated on an emulsion layer side and a support side the black and white developed film. From light reflected from each side, a reflected image of each of an upper photosensitive layer (B layer) and a the lower photosensitive layer (R layer) is read. A transmitted image, in which the B photosensitive layer, the R photosensitive layer, and an intermediate photosensitive layer (G layer) have been compounded, is read by the light transmitted through the black and white developed film. Image data Fr, Br and T for the reflected image of the B layer, the reflected image of the R layer, and the transmitted image of the RGB layers are derived, and coordinates of image elements are corrected such that the three images are superposed. In particular, the reflected image of the R layer is in reverse at the time of reading, so this image is superposed after being reversed superposition. Overlapping of the images is conducted by determining a standard point in each image and rotating and translating each image such that the coordinates of the standard points agree with each other. The data Fr, Br, and T, taken from the film scanner and coordinate-converted so as to superpose one another, are respectively linearly converted by a converter for converting gray scales linearly and then input as data Fr', Br' and T' into a regression arithmetic unit.

The image recorded on each photosensitive layer of the color-developed film is resolved as a transmitted image into three colors and read by a film scanner having the same sensitivity as the film scanner mentioned above. The read data R, G and B are respectively linearly converted by the converter and input into the regression arithmetic unit as data R', G' and B', which are the target values.

In the regression arithmetic unit, regression analysis is conducted to make the linearly converted 3-layer data Fr', Br' and T' agree with the target values R', G' and B' and calculate the color correscion coefficients. Because the data Fr', Br' and T' read from the black and white developed film are not separated into color components (RGB components), processing for separation thereof into color components, using, the colors of the image recorded on the color developed film as the standard is conducted.

That is, in the regression arithmetic unit, 10 parameters ai0 to ai9 are provided for the respective three colors R, G and B (i=1, 2 or 3, and 1 represents R, 2 represents G and 3 represents B), and parameters of a 3×10 matrix for converting Fr', Br' and T' into the target values R', G' and B' are determined by statistical calculation. Accordingly, a 3×10 determinant is obtained for the color correction coefficients.

$$\begin{pmatrix} R' \\ G' \\ B' \end{pmatrix} = \tag{3}$$

-continued $$\begin{pmatrix} a10 & a11 & a12 & a13 & a14 & a15 & a16 & a17 & a18 & a19 \\ a20 & a21 & a22 & a23 & a24 & a25 & a26 & a27 & a28 & a29 \\ a30 & a31 & a32 & a33 & a34 & a35 & a36 & a37 & a38 & a39 \end{pmatrix} \begin{pmatrix} Br' \\ T' \\ Fr' \\ Br' * Br' \\ T' * T' \\ Fr' * Fr' \\ Br' * T' \\ T' * Fr' \\ Fr' * Br' \\ 1 \end{pmatrix}$$

The equation (3) can be expressed as follows:

$$R' = a10*Br' + a11*T' + a12*Fr' + a13*Br'*Br' + a14*T'*T' + a15*Fr'*Fr' + a16*Br'*T' + a17*T'*Fr' + a18*Fr'*Br' + a19$$

$$G' = a20*Br' + a21*T' + a22*Fr' + a23*Br'*Br' + a24*T'*T' + a25*Fr'*Fr' + a26*Br'*T' + a27*T'*Fr' + a28*Fr'*Br' + a29$$

$$B' = a30*Br' + a31*T' + a32*Fr' + a33*Br'*Br' + a34*T'*T' + a35*Fr'*Fr' + a36*Br'*T' + a37*T'*Fr' + a38*Fr'*Br' + a39$$

In the above example, the parameter matrix was a 3×10 matrix, but the same may be a 3×3 or 3×9 matrix.

In the MTX circuit 160, each of data of R, G and B free of color mixing is calculated using the color correction coefficients determined by any of the methods described above and then output to the LUT 162. In the LUT 162, correction of gray balance and correction of contrast are conducted. The parameters for correction of gray balance and correction of contrast are determined in the CPU 142.

That is, a conversion characteristic f3 is determined from data read at a gray exposure region of the standard light exposure part 32 and a previously determined target gray density. However, in general photography, photos are taken using light sources with various color temperatures. Thus, the gray balance cannot be sufficiently corrected with the data read at the gray exposure region of the standard light exposure part 32. Accordingly, a light source correction coefficient for a light source for photography is estimated for each frame and output to the LUT 162. That is, in the LUT 162, the gray balance is corrected using the conversion characteristic f3 as the standard for tone conversion characteristics, and the tone balance is further corrected by correcting with the light source correction coefficient. Further, contrast of black and white development is different from contrast of standard color development, and thus contrast correction is conducted for correction thereof.

The image data after gray balance correction and contrast correction is enlarged or reduced at a predetermined magnification in an enlarging and reducing part 164, and then subjected to a shading printing process in an automatic shading print part 166 and subjected to a sharpness enhancing process in a sharpness enhancing part 168. The sharpness enhancing process may be conducted only on high-frequency components, and not on low-frequency components.

The image data thus subjected to image processing is converted into image data to be displayed on the monitor 154 by a 3-D (3-dimensional) LUT color converting part 170, and is simultaneously converted by a 3-D LUT converting part 172 into image data to be printed on photographic paper in a printer part 24.

The printer part 24 is composed of, for example, an image memory, R, G and B laser light sources, and a laser driver for controlling operation of the laser light sources (not shown in the drawings). Image data input for recording from the image processor 22 is temporarily stored in the image memory, and then read and used for modulation of R, G and B laser lights from the laser light sources. The laser lights from the laser light sources scan onto the photographic paper via a polygon mirror and an fθ lens, and the image is recorded on the photographic paper by light exposure. The photographic paper onto which the image has been recorded by light exposure is sent to a processor part 26 and subjected to coloring development, bleaching fixing, washing with water and drying. The image recorded by light exposure on the photographic paper is thereby mad visible.

An example wherein a silver image is formed by black and white development is described above. However, the silver image, whilst actually being a silver image, can include pigment image information, and 60% or more of image density can be derived from the developed silver. Consequently, the silver image may include the same pigment information as a color-developed color film.

In the case of a silver image containing the same pigment information as obtained by color-developing a color film, using infrared radiations, the silver image alone can be read without reading the pigment image. However, the pigment image may be read by an upper-layer light source for exposing the upper photosensitive layer to a color that is complementary to the pigment contained in the silver image in the upper photosensitive layer, a lower-layer light source for exposing the lower photosensitive layer to a light that is complementary to the contained in the silver image in the lower photosensitive layer, an interlayer light source for exposing the side of the upper photosensitive layer side or the lower photosensitive layer side to a color that is complementary to the coloring material contained in the silver image in the intermediate photosensitive layer, lights reflected from the upper and lower layers of the color photographic film, and a reading sensor for reading image information from a light transmitted through the color photographic film. Specifically, image information relating a cyan pigment image in the red photosensitive layer with the silver image is obtained by using R light and detecting the reflected light, image information relating image information of a magenta pigment image in the green photosensitive layer with the silver image can be obtained by using G light and detecting the transmitted light, and the image information relating a yellow pigment image in the blue photosensitive layer with the silver image can be obtained by using B light and detecting the reflected light.

[Third Aspect]

In the following description of a color image forming method of the present invention, a development method ordinarily used in the color photography market is called standard development, as opposed to the development method used in the present invention. In the color photography market, each processing laboratory accepts products (color photosensitive materials) of each company and conducts development process with a development process method that is substantially common worldwide. For example, formulas for color negative film are the CN16 series (designated by Fuji Photo Film Co., Ltd.), the C41 series (designated by Eastman Kodak Co., USA), and the CNK4 series (designated by Konica Corporation). In addition, formulas for color paper are the RA-4 series (designated by Eastman Kodak Co., USA), the CP-40 series (designated by Fuji Photo Film Co., Ltd.) and the CPK-4 series (designated by Konica Corporation). These are considered to be international standard processes even though they have different formula names (trade names). These are the details of standard development.

In general, "development process" includes "development process" in a broad sense, which refers to a series of steps for obtaining a stable image by developing a photosensitive material and fixing the image, or "development process" in a narrow sense, which refers only to the development step. The "development process" of the present invention refers to the latter, that is, the narrow meaning of "development process". The broad meaning of "development process" will be referred to "development process of a color film", but where the meaning is evident from the context, "development process" in the broad sense may also be called "development process".

Further, in the following description, development process and image processing, which are two different types of processing, are both referred to as "processing". However, where there is a possibility of confusion, the respective terms are distinguished as "development process" and "image processing".

The third aspect of the present invention is described in detail in the following order:

1. Sequence of the process of the color image-forming method of the present invention;
2. Anti-halation layer containing a decolorizable anti-halation dye;
3. Development process;
4. Reading of an image; and
5. Color photosensitive material used in the present invention and relevant supplementary description thereof.

Figure 21:
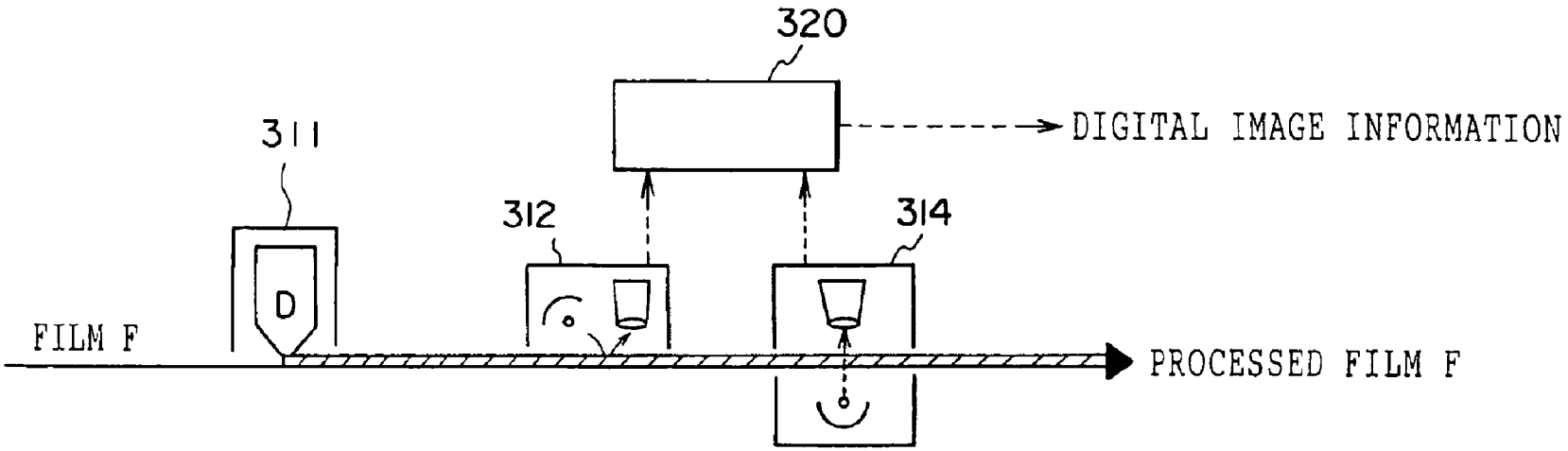
FIG. 21 is a block diagram schematically showing the flow of the processes of the third aspect of the present invention.

1. Sequence of the Process of the Color Image-forming Method of the Present Invention The outline of the sequence of the method of the present invention is described with reference to the drawings. FIG. 21 is a block diagram schematically showing the sequence of the process of the third aspect of the present invention.

In FIG. 21, an image forming unit includes a development process part 311 for development process, a first image information-reading part 312, which uses reflected light, a second image information-reading part 314, which uses transmitted light, and an image processing part 320 for processing the image information that is read. One first image information-reading part 312 is shown in the drawing but the same may be disposes at both the surface side and the back side of the film. A color film F is introduced into the image forming unit and subjected to development process in a development process part 311 thereby forming images on the three photosensitive layers: the front layer, the back layer and the interlayer therebetween. Although a hopper coating development (shown with slant lines) wherein a developer solution D is supplied to a film is shown in FIG. 21, various development systems can be used, as described below. Next, the image element constituting the image in film F is read photoelectrically by an image scanner in a reflection system (not shown) in the first image information-reading part 312, whereby first image information is obtained. The first image information is information on one or both of the uppermost photosensitive layer and the lowermost photosensitive layer of the film. In the case of information on only one layer, the photosensitive layer not read as the first image information is read by transmitted light in the next step. After reading the first image information, the image on the photosensitive layer in the color film F which was not subjected to first reading is read photoelectrically by an image scanner in a transmitted light system (not shown) and second image information is obtained in the second image information reading part 314. In FIG. 21, the first image information reading part 312, using reflected light, is disposed before the second image information reading part 314, using transmitted light, but this order may be changed. The first and second image informations thus obtained are electrically transmitted to the image processing part 320 in the form of time-series electrical signals, then converted into a digital signal to enable image processing and converted into electrical blue, green and red digital image information. The terms "first" and "second" for image information reading are used for the sake of convenience and refer to image information reading using reflected light and transmitted light respectively. However, there is no particular meaning in the "first" and "second" and the order of image reading is not limited.

The electrical digital image information obtained by the steps described above can be applied to only color image-forming means to obtain a color image.

As the color image-forming means, any means for converting the time-series electrical image signals into an image, for example: color prints using color photographic paper, an ink jet, or a heat-sensitive pigment transfer: a magnetic recording medium in the form of disk or tape; or an optical recording medium can be used. Free conversion between the digital image information and the printed image is a superior feature of the present invention.

In the color image forming method of the present invention, the development process of color film may be just development process that does not require post-processing such as silver removal and stabilization bathing, which are conventionally carried out after development process. Accordingly, the step of processing the color film is very easy and rapid, thus satisfying the object of the present invention.

In the present invention, the image can be obtained in the form of digital image information. Thus, storage of the color film after development is not necessary. However, if storage is necessary, a developed film which is capable of long-term storage similarly to a color film subjected to standard development processes such as processes for removal of silver, including bleaching and fixing processing, or bleaching fixing processing and stabilization bathing processing can be obtained after the image of the developed color film has been read.

There are various combinations for reading the first image information using reflected light and reading the second image information using transmitted light, and a preferable form can be selected depending on the objectives.

2. Anti-halation Layer Containing the Decolorizable Anti-halation Dye

Now, the anti-halation dye contained in the anti-halation layer of the color photosensitive material used in the present invention and thereby bringing out the significant effect of the present invention is described.

Dyes that are effective as the anti-halation dye are those that provide an anti-halation layer with a minimum absorbance of 0.2 or more in the wavelength range of 400 to 700 nm wherein a ratio of maximum absorbance to minimum absorbance is 5 or less. Preferable dyes are those having an absorbance of 0.3 or more, more preferably 0.5 or more, in the wavelength ranges of 420 to 470 nm, 530 to 570 nm and 610 to 640 nm, and particularly preferable dyes are those having an absorbance in the range of about 0.7 to 1.1 in the wavelength range of 420 to 640 nm.

The decolorizable anti-halation dye is a dye which is decolored by decomposition in color developing solutions such as a coloration developing solution or in various black and white developing solutions. The decolorization of the dye by the developing solution occurs because a part or the whole of the absorbance of the dye is lost by a decomposition and/or outflow of the dye, caused by a reaction of the dye with processing solution components such as an alkali, hydroxylamine and sulfite ions contained in the developing solution.

A dye which can be used as the decolorizable anti-halation dye is a dye showing a degree of decomposition of 50% or more based on quantification by extraction in a process where a photosensitive material using the dye in an anti-halation layer is subjected to a development reaction, and the degree of decomposition is preferably 70% or more, and more preferably 90% or more in view of color reproducibility. To measure the degree of decomposition of the dye, the dye is dissolved and extracted to prepare a calibration curve, the amount of the dye is determined by HPLC, and the degree of decomposition is determined according to the following equation:

Degree of decomposition=(amount of the dye remaining after development process)/(amount of the dye extracted before development process)

Further, the dye may be a combination of two or more dyes in order to satisfy optical absorption characteristics requirements.

Regardless of the structure, the dye referred to in the present invention is an organic or inorganic compound, but is preferably an organic compound in view of rapid decomposition reaction in the developing solution. Organic compounds such as organic dyes and inorganic compounds such as colloidal silver can be combined and used within the scope of the present invention.

It has been revealed that if a photosensitive material prepared using a dye that is not decomposed by the developing solution is subjected to coloring development and the image is to be read without bleaching, such a dye will not be sufficiently decomposed, and thus the absorption of the dye, silver colloids, etc. will remain such that the reading of image information is hindered. In particular, remaining yellow color has been revealed to be a significant obstruction to the reading of image information formed by a yellow coloring coupler.

The processing solution used in the present invention is not particularly limited but, for elimination of waste of fluid, it is preferable that the photosensitive material is processed with the processing solution in an amount that will soak into the photosensitive material. A method of supplying the processing solution to the photosensitive material is not particularly limited, but spraying or coating development is preferably used.

The structure of the dye used in the present invention is not particularly limited insofar as it has degradability with respect to the present invention. Preferable examples include pyrazolidine diones, isooxazolones, pyrazolopyridones, barbituric acids, pyrazolones, indane diones, pyridones, and chain-closed methylenes, and particularly preferable examples include pyrazolidine diones and isooxazolones. The pyrazolidine diones are disclosed in JP-A No. 3-208046, JP-A No. 3-167546 and JP-A No. 9-106041; the isoxazolones in JP-A No. 3-208044, JP-A No. 3-72340, JP-A No. 4-362634, JP-A No. 5-209133, JP-A No. 7-92613 and JP-A No. 8-6196; the pyrazolopyridones in JP-A No. 2-282244, JP-A No. 3-7931, JP-A No. 3-167546, JP-A No. 8-6196 and JP-A No. 9-106041; the barbituric acids in EP274723, JP-A No. 3-223747, JP-A No. 3-167546, JP-A No. 8-6196 and JP-A No. 9-106041; the pyrazolones in U.S. Pat. No. 4,092,168, JP-A No. 3-23441, JP-A No. 3-19544, JP-A No. 3-206441, JP-A No. 3-206442, JP-A No. 3-208043, JP-A No. 4-151651, JP-A No. 3-144438, JP-A No. 3-167546, JP-A No. 5-50345, JP-A No. 5-53241, JP-A No. 5-86056, JP-A No. 8-6196, JP-A No. 8-50345 and JP-B No. 55-155351; the indane diones in EP524593, JP-A No. 5-289239 and JP-A No. 8-6190; the pyridones in JP-A No. 55-155351, JP-A No. 4-37841, JP-A No. 2-277044 and JP-A No. 8-6196; and the chain-closed methylenes in JP-A No. 3-182742 and EP762198, respectively. However, these prior art specifications disclose neither the technical idea of finishing processing without conducting bleaching processing as in the present invention nor the technical idea of converting the image information of the thus processed photosensitive material into electrical image information. In addition, when processing is finished without bleaching processing, there is the problem of insufficient decomposition of the dye, but these specifications describe neither this technical problem nor a solution thereof.

The decolorizable anti-halation dye which can be preferably used in the present invention is a dye represented by the following general formula (I):

$$D—(X)_y \qquad (I)$$

wherein D represents a compound having a chromophore, X represents a dissociable proton bound to D directly or via a divalent linking group, or a group having said dissociable proton, and y is an integer from 1 to 7.

Hereinafter, the general formula (I) is described in more detail.

The compound having a chromophore, represented by D, can be selected from many dye compounds known in the art. These compounds include oxonole dye, merocyanine dye, cyanine dye, styryl dye, arylidene dye, azomethine dye, triphenyl methane dye, azo dye, anthoraquinone dye, indoaniline dye, etc.

When a compound represented by the general formula (I) is added to the silver halide photosensitive material of the present invention, the dissociable proton or group having a dissociable proton represented by X is characterized by being not dissociated, thus rendering the compound of the general formula (I) substantially water-insoluble and, in the step of development process of the material, the proton or group is characterized by being dissociated, thus rendering the compound of the general formula (I) substantially water-soluble. Examples of such groups include a carboxyl group, a sulfonamide group, an aryl sulfamoyl group, a sulfonyl carbamoyl group, a carbonyl sulfamoyl group, an enol group of an oxonole dye, and a phenolic hydroxyl group.

The divalent linking group between X and D may be an alkylene group, an arylene group, a heterocyclic residue, —CO—, —$SO_n$— (n is 0, 1 or 2), —NR— (R represents a hydrogen atom, an alkyl group or an aryl group), —O—, or a divalent group consisting of a combination of these linking groups, and these may further have substituent groups such as an alkyl group, an aryl group, an alkoxy group, an amino group, an acyl group, an acylamino group, a halogen atom, a hydroxyl group, a carboxyl group, a sulfamoyl group, a carbamoyl group or a sulfonamide group. Preferable examples—include $(CH_2)_n$— (n=1, 2 or 3), —$CH_2CH(CH_3)CH_2$—, 1,2-phenylene, 5-carboxy-1,3-phenylene, 1,4-phenylene, 6-methoxy-1,3-phenylene, —$CONHC_6H_4$—, etc.

y is preferably an integer of 1 to 5, and more preferably an integer of 1 to 3.

The compounds represented by the general formula (I) are preferably those represented by the general formulae (II) (III), (IV), (V) and (VI):

$$A^1{=}L^1{-}(L^2{=}L^3)_m{-}Q \qquad \text{General formula (II)}$$

$$A^1{=}L^1{-}(L^2{=}L^3)_n{-}A^2 \qquad \text{General formula (III)}$$

$$A^1{-}(L^1{=}L^2)_p{-}B^1 \qquad \text{General formula (IV)}$$

$$B^1{=}L^1{-}(L^2{=}L^3)_q{-}B^2 \qquad \text{General formula (V)}$$

$$B^2{-}(L^1{=}L^2)_r{-}Q \qquad \text{General formula (VI)}$$

wherein $A^1$ and $A^2$ each represent an acidic nucleus, $B^1$ represents a basic nucleus, $B^2$ represents an onium body of a basic nucleus, Q represents an aryl group or a heterocyclic group, $L^1$, $L^2$ and $L^3$ each represent a methine group, m is 0, 1 or 2, n and p each represent 0, 1, 2 or 3, q is 0, 1, 2, 3 or 4, and r is 1 or 2. However, the compounds of the general formulae (II) to (VI) have at least one dissociable group selected from the group consisting of a carboxyl group, a sulfonamide group, an aryl sulfamoyl group, a sulfonyl carbamoyl group, a carbonyl sulfamoyl group, an enol group of an oxonole dye, and a phenolic hydroxyl group in one molecule, and do not have any other water-soluble groups (e.g. a sulfo group or a phosphate group) The acidic nucleus represented by $A^1$ or $A^2$ is preferably a cyclic keto-methylene compound or a compound having a methylene group sandwiched between electron-withdrawing groups. Examples of cyclic keto-methylene compounds include 2-pyrazoline-5-one, rhodanine, hydantoin, thiohydantoin, 2,4-oxazolidine dione, isooxazolone, barbituric acid, thiobarbituric acid, indane dione, dioxopyrazolopyrolidine, hydroxypyridine, pyrazolizine dione, 2,5-dihydrofuran-2-one, and pyrroline-2-one. These may have substituent groups.

The compound having a methylene group sandwiched between electron-withdrawing groups can be represented by $Z^1CH_2Z^2$ wherein $Z^1$ and $Z^2$ each represent —CN, —$SO_2R^1$, —$COR^1$, —$COOR^2$, —$CONHR^2$, —$SO_2NHR^2$, —C[=$C(CN)_2$]$R^1$ or —C[=$(CN)_2$]$NHR^1$. $R^1$ represents an alkyl group, an aryl group or a heterocyclic group, $R^2$ represents a hydrogen atom and the groups represented by $R^1$, and each of these groups may have substituent groups.

Examples of the basic nucleus represented by $B^1$ include pyridine, quinoline, indolenine, oxazole, imidazole, thiazole, benzooxazole, benzoimidazole, benzothiazole, oxazoline, naphthooxazole, pyrrole, etc. Each of these groups may have substituent groups.

$B^2$is an onium body of the basic nucleus and includes onium bodies of the basic nuclei mentioned for $B^1$ as described above.

The aryl groups represented by Q include, for example, a phenyl group or a naphthyl group, each of which may have substituent groups. In particular, a phenyl group substituted with a dialkyl amino group, a hydroxyl group or an alkoxy group is most preferable. Examples of heterocyclic groups represented by Q include pyrrole, indole, furan, thiophene, imidazole, pyrazol, indolizine, quinoline, carbazole, phenothiazine, phenoxazine, indoline, thiazole, pyridine, pyridazine, thiadiazine, pyran, thiopyran, oxadiazole, benzoquinoline, thiadiazole, pyrrothiazole, pyrropyridazine, tetrazole, oxazole, coumalin, and coumarone. Each of these groups may have substituent groups.

The methine groups represented by $L^1$, $L^2$ and $L^3$ may have substituent groups, and the substituent groups may be combined to form a 5- or 6-member ring (e.g. cyclopentene, cyclohexene).

The substituent groups which the respective groups described above may have not particularly limited, except for groups permitting the compounds of the general formulae (I) to (VI) to be substantially dissolved in water at pH 5 to 7. Examples of substituent groups include a carboxyl group, a $C_{1-10}$ sulfonamide group (e.g. methane sulfonamide, benzene sulfonamide, butane sulfonamide, or n-octane sulfonamide), a $C_{0-10}$ sulfamoyl group (e.g. unsubstituted sulfamoyl, methyl sulfamoyl, phenyl sulfamoyl, or butyl sulfamoyl), a $C_{2-10}$ sulfonyl carbamoyl group (e.g. methane sulfonyl carbamoyl, propane sulfonyl carbamoyl, or benzene sulfonyl carbamoyl), a $C_{1-10}$ acyl sulfamoyl group (e.g. acetyl sulfamoyl, propionyl sulfamoyl, pivaloyl sulfamoyl, or benzoyl sulfamoyl), a $C_{1-8}$ linear or branched alkyl group (e.g. methyl, ethyl, isopropyl, butyl, hexyl, cyclopropyl, cyclohexyl, 2-hydroxyethyl, 4-carboxybutyl, 2-methoxyethyl, benzyl, phenethyl, 4-carboxybenzyl, or 2-diethylaminoethyl), a $C_{2-8}$ alkenyl group (e.g. vinyl or allyl), a $C_{1-8}$ alkoxy group (e.g. methoxy, ethoxy or butoxy), a halogen atom (e.g. F, Cl or Br), a $C_{0-10}$ amino group (e.g. unsubstituted amino, dimethylamino, diethylamino, or carboxyethylamino), a $C_{2-10}$ ester group (e.g. methoxycarbonyl), a $C_{1-10}$ amide group (e.g. acetamide or benzamide), a $C_{1-10}$ carbamoyl group (e.g. unsubstituted carbamoyl, methyl carbamoyl, or ethyl carbamoyl), a $C_{6-10}$ aryl group (e.g. phenyl, naphthyl, 4-carboxyphenyl, 3-carboxyphenyl, 3,5-dicarboxyphenyl, 4-methane sulfonamide phenyl, or 4-butane sulfonamide phenyl), a $C_{6-10}$ aryloxy group (e.g. phenoxy, 4-carboxyphenoxy, 3-methylphenoxy, or naphthoxy), a $C_{1-8}$ alkyl thio group (e.g. methyl thio, ethyl thio, or octyl thio), a $C_{6-10}$ aryl thio group (e.g. phenyl thio or naphthyl thio), a $C_{1-10}$ acyl group (e.g. acetyl, benzoyl, or propanoyl), a $C_{1-10}$ sulfonyl group (e.g. methane sulfonyl or benzene sulfonyl), a $C_{1-10}$ ureido group (e.g. ureido or methyl ureido), a $C_{2-10}$ urethane group (e.g. methoxycarbonyl amino or ethoxycarbonyl amino), a cyano group, a hydroxy group, a nitro group, a heterocyclic group (e.g. a 5-carboxybenzooxazole ring, a pyridine ring, a sulforane ring, a furan ring, a pyrrole ring, a pyrrolidine ring, a morpholine ring, a piperazine ring, or a pyrimidine ring), etc.

Examples of the compounds represented by the general formulae (I) to (VI) used in the present invention include, but are not limited to, the following compounds:

(I-1)

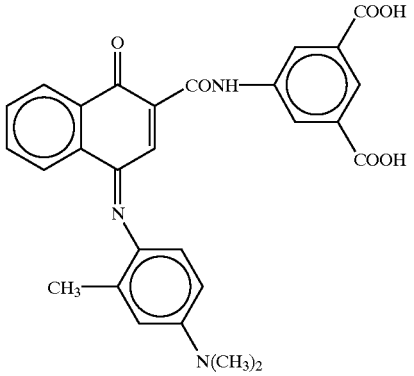

(I-2)

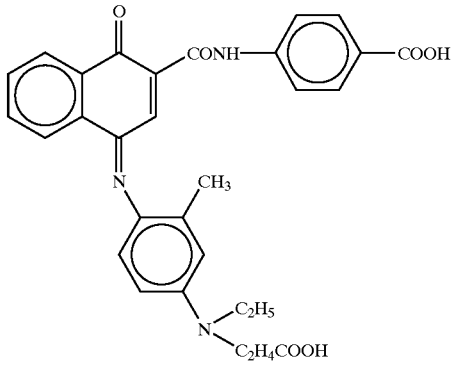

(I-3)

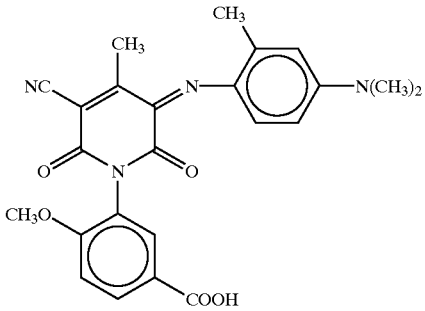

(I-4)

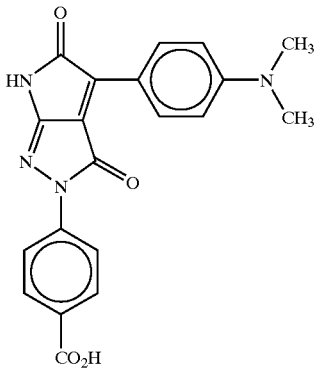

(I-5)

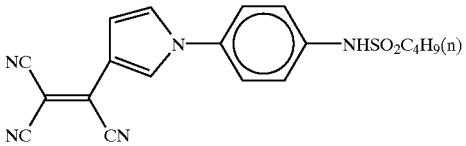

(I-6)

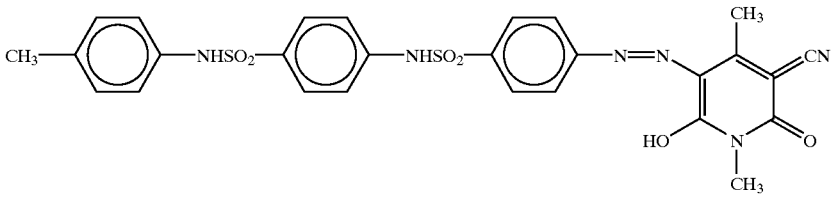

-continued
(I-7)
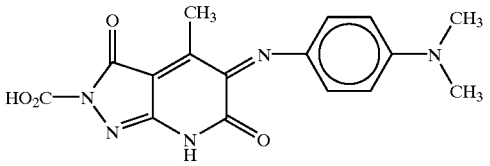
(I-8)
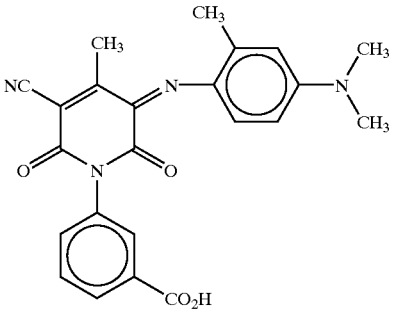
(II-1)
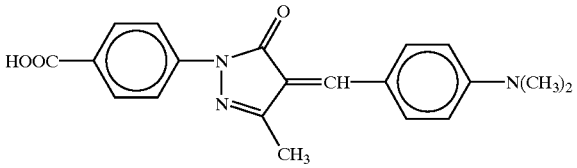
(II-2)
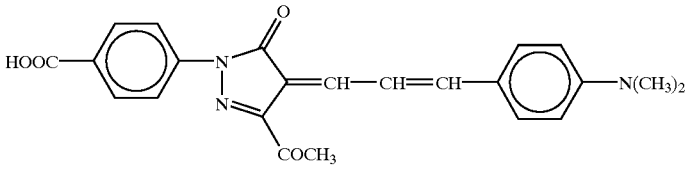
(II-3)
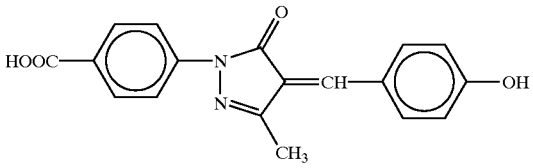
(II-4)
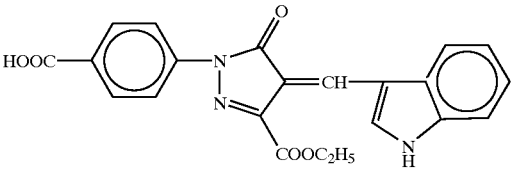
(II-5)
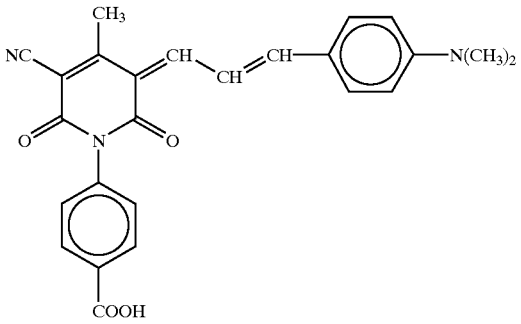
(II-6)
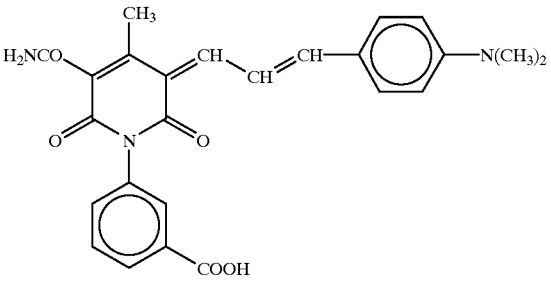
(II-7)
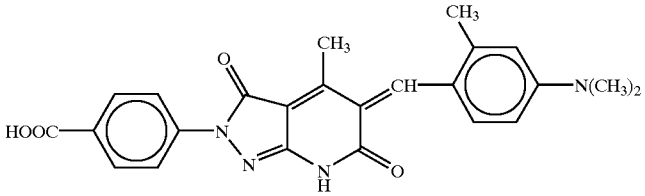
(II-8)
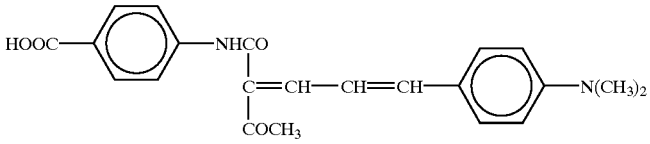

-continued
(II-9)
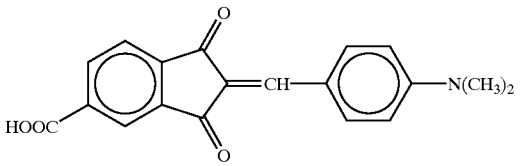
(II-10)
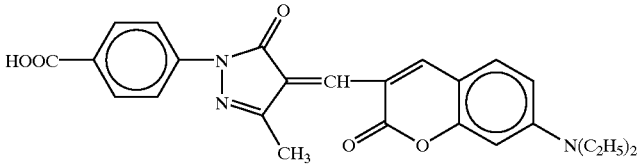
(II-11)
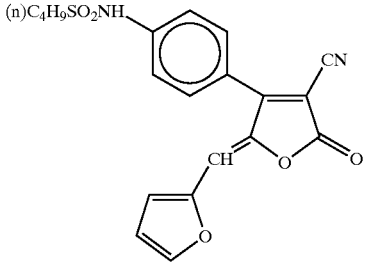
(II-12)
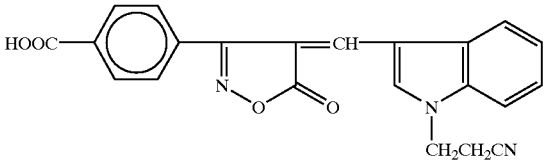
(II-13)
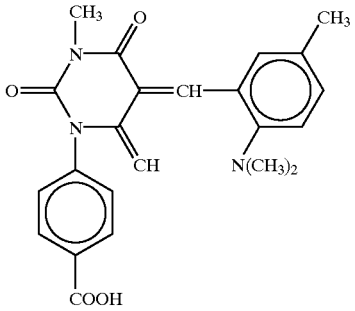
(II-14)
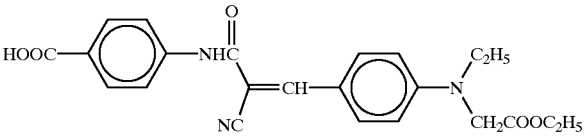
(II-15)
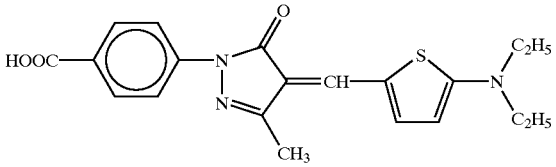
(II-16)
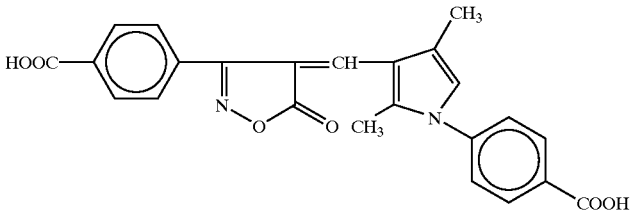
(II-17)
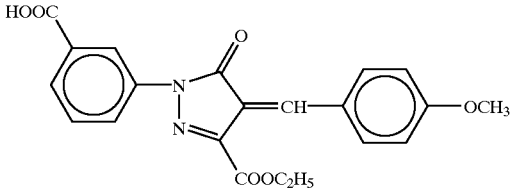
(II-18)
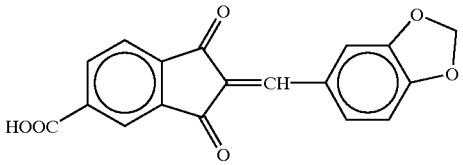

-continued
(II-19)
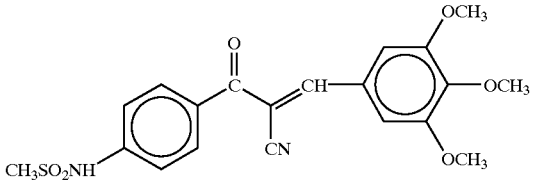
(II-20)
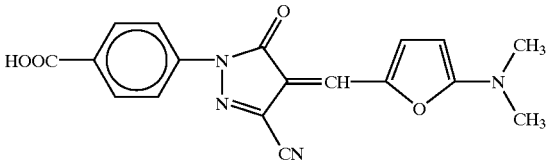
(II-21)
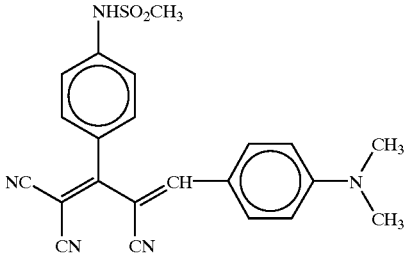
(II-22)
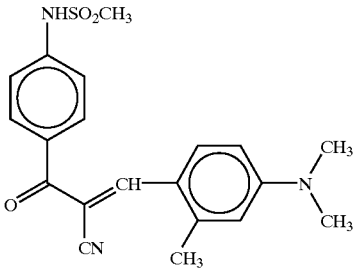
(II-23)
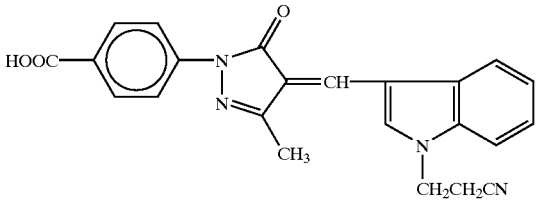
(II-24)
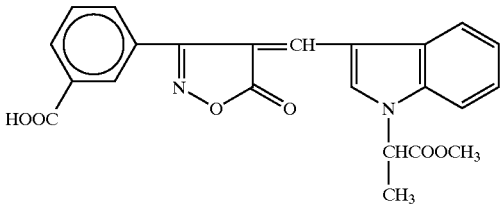
(II-25)
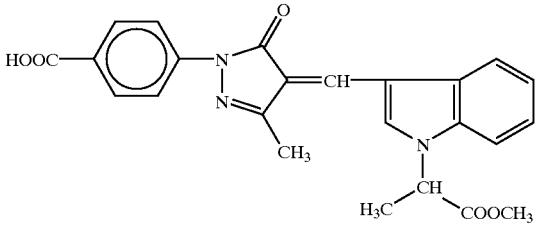
(II-26)
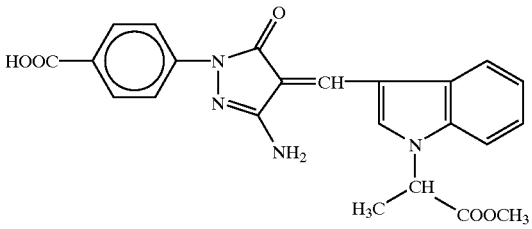
(II-27)
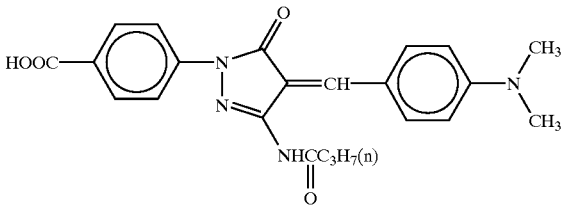
(II-28)
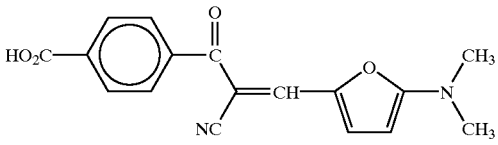
(II-29)
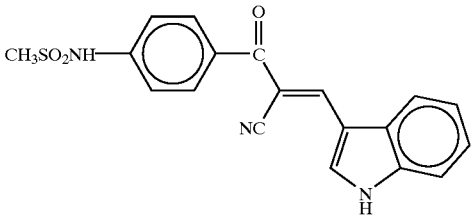

-continued
(II-30)
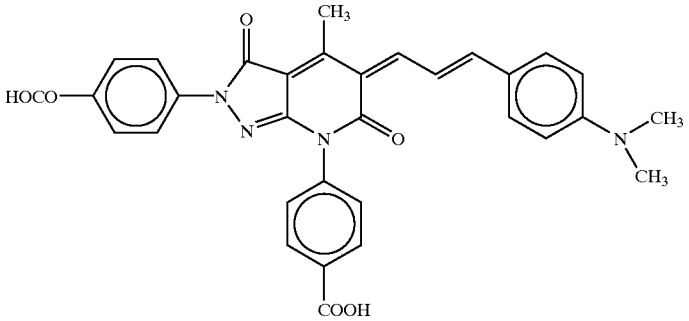
(II-31)
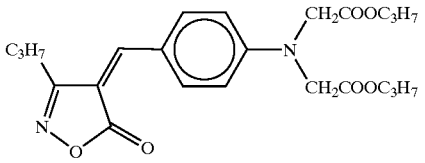
(III-1)
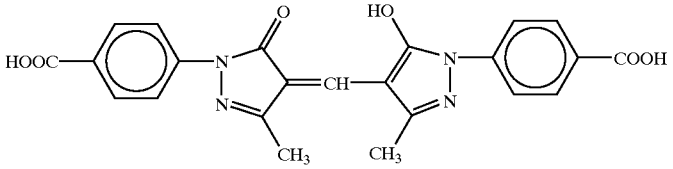
(III-2)
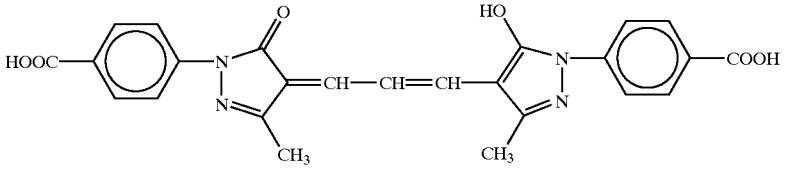
(III-3)
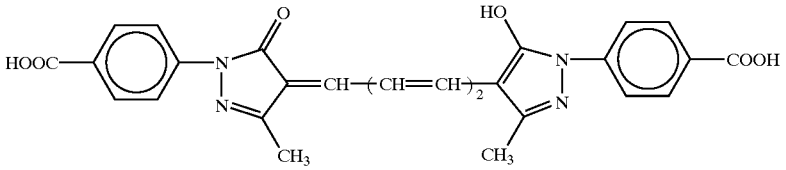
(III-4)
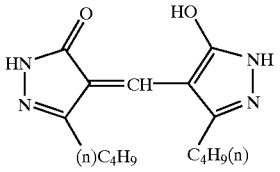
(III-5)
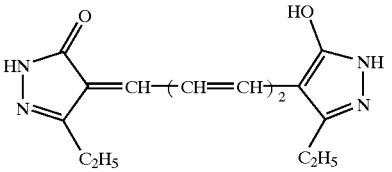
(III-6)
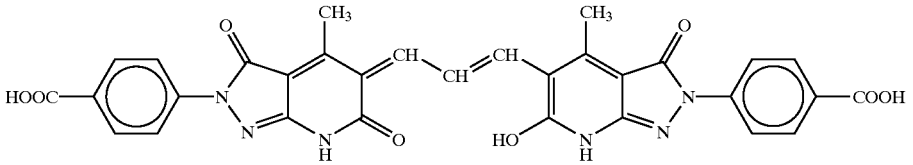
(III-7)
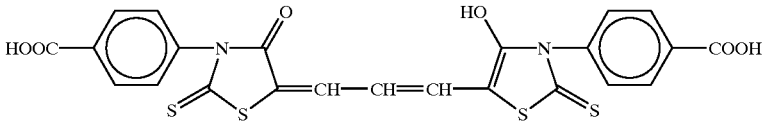

-continued
(III-8)
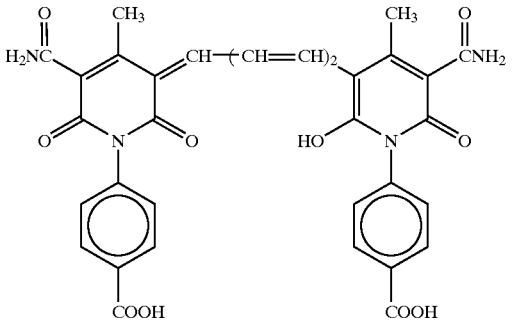
(III-9)
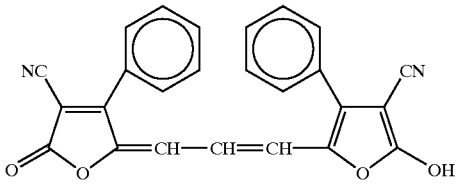
(III-10)
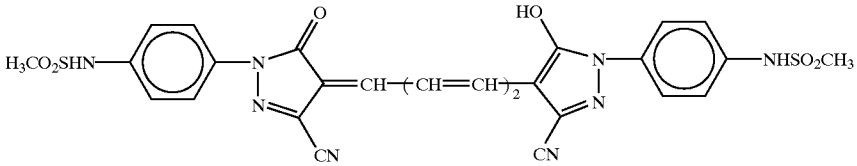
(III-11)
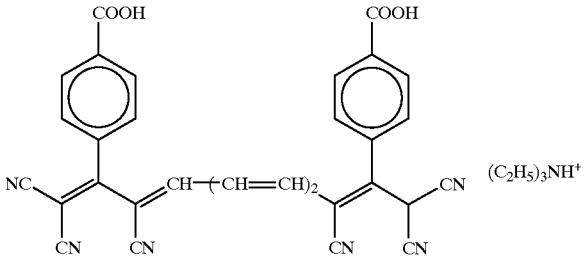
(III-12)
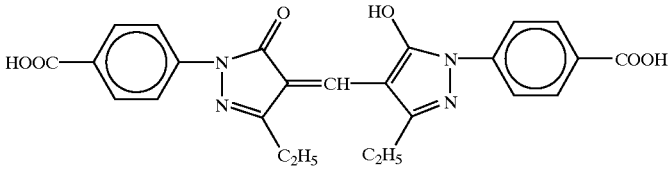
(III-13)
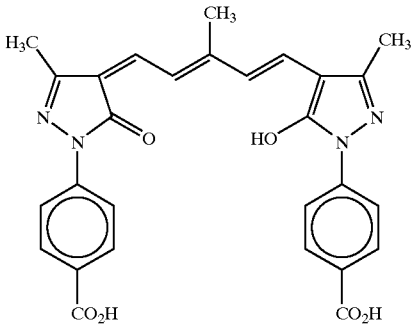
(III-14)
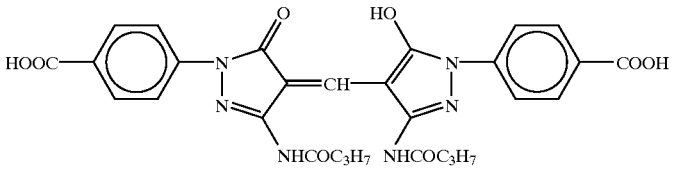

-continued
(III-15)
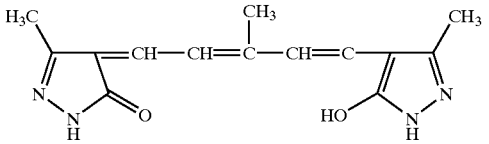
(III-16)
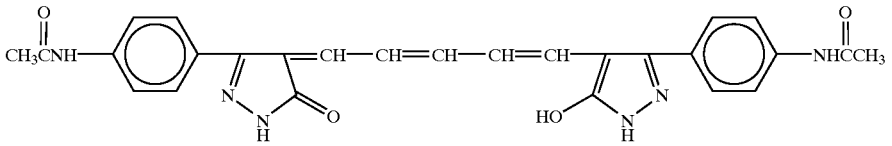
(III-17)
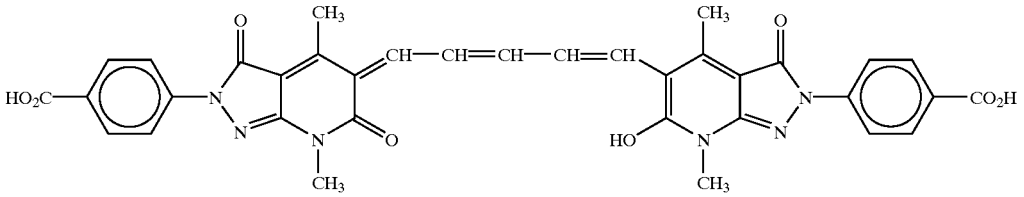
(III-18)
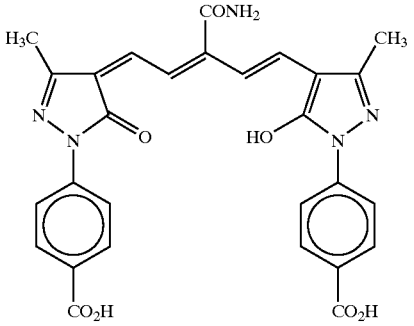
(III-19)
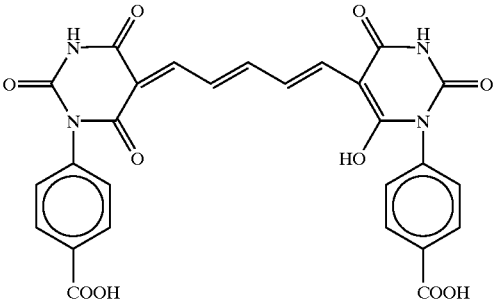
(III-20)
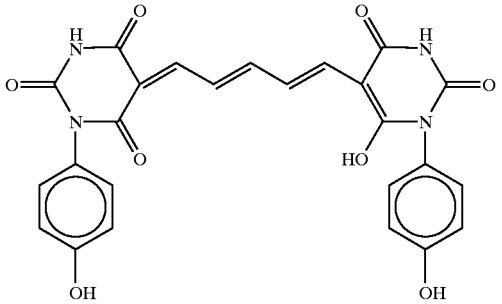
(III-21)
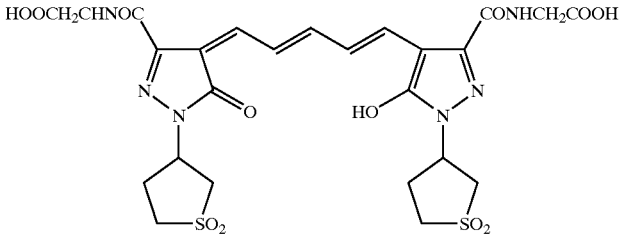
(IV-1)
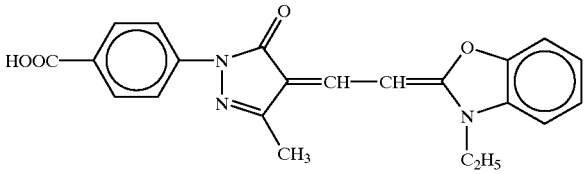

-continued
(IV-2)
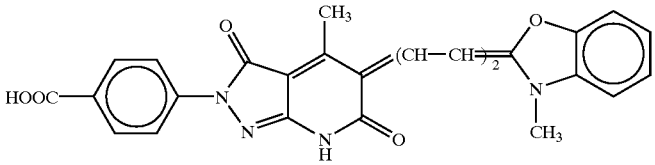
(IV-3)
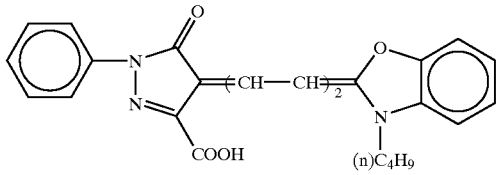
(IV-4)
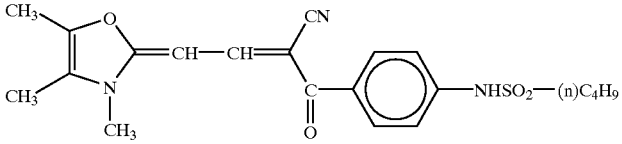
(IV-5)
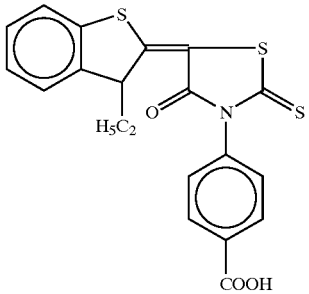
(IV-6)
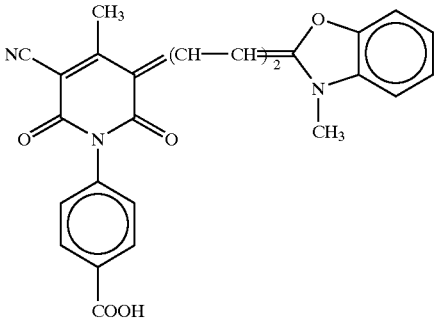
(IV-7)
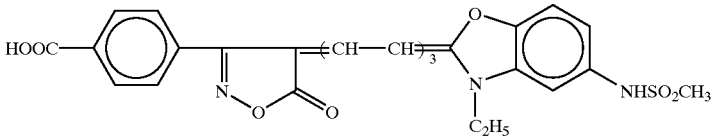
(IV-8)
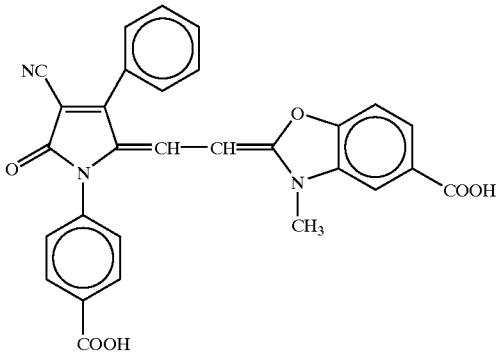
(IV-9)
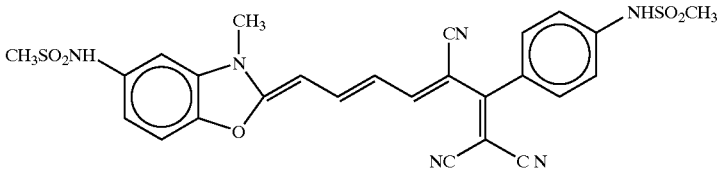

-continued (V-1)

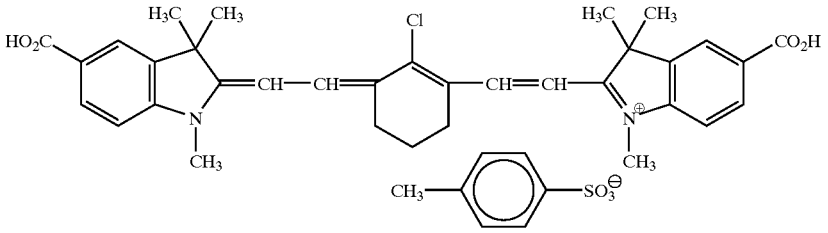

(V-2)

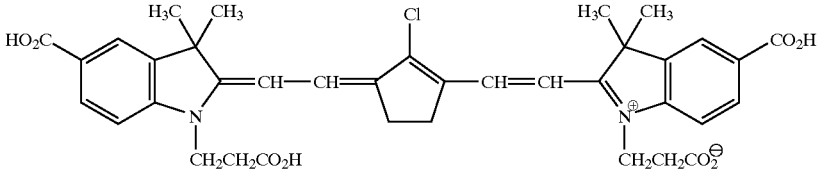

(V-3)

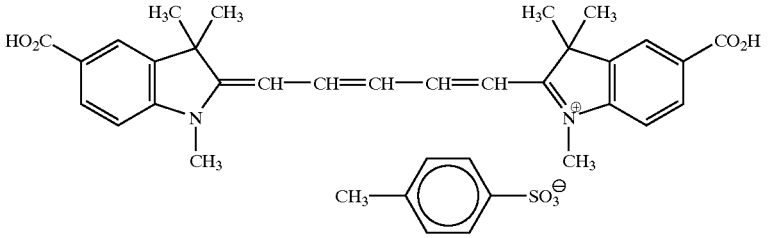

(VI-1)

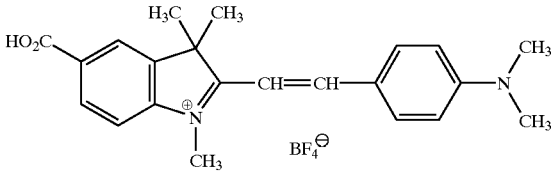

(VI-2)

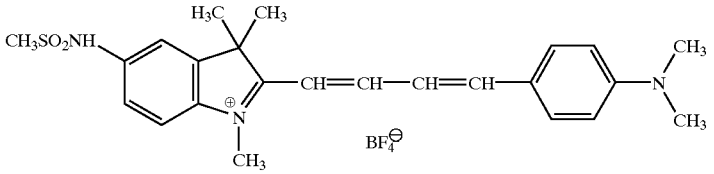

(VI-3)

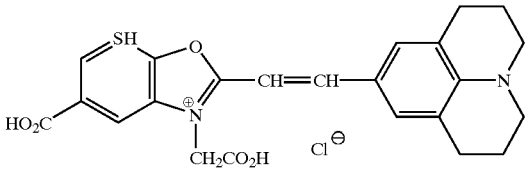

The dyes used in the present invention can be synthesized by methods (or methods analogous thereto) described in WO 88/04794, EP 274723A1, EP 276566, EP 299435, EP 696758A1, JP-A No. 52-92716, JP-A No. 55-155350, JP-A No. 55-155351, JP-A No. 61-205934, JP-A No. 48-68623, U.S. Pat. No. 2,527,583, 3,486,897, 3,746,539, 3,933,798, 4,130,429, 4,040,841, JP-A No. 2-282244, JP-A No. 3-7931, JP-A No. 3-167546, EP 330948A, EP 524598A, JP-A No. 3-223747, JP-A No. 7-168314, JP-A No. 55-120030, JP-A No. 63-27838, Japanese Patent Application No. 11-81889, and U.S. Pat. No. 3,984,246.

The dye represented by the general formula (I) is used as a solid dispersion of fine powder (fine crystal grains). The fine (crystal) grain solid dispersion of the dye can be prepared mechanically in the presence of a dispersant by known pulverization methods (e.g., ball mill, vibration ball mill, planetary ball mill, sand mill, colloid mill, jet mill or roller mill) in a suitable solvent as necessary. Further, the fine (crystal) grains of the dye can be obtained by dissolving the dye in a suitable solvent, by use of a dispersant, and then adding the solution to a poor solvent of the dye to precipitate fine crystals, or by controlling pH to dissolve the dye and then changing the pH to form fine crystals. The layer containing the fine powder of the dye is provided by dispersing the thus obtained fine (crystal) grains of the dye in a suitable binder to prepare a solid dispersion of almost uniform grains and then applying the same onto a desired support. Alternatively, the dye, in a dissociated state, is dissolved and applied in salt form, followed by acidic undercoating and/or overcoating, depending on the pKa of the dissociable group, thereby attaining dispersion and fixing at the time of application.

The binder described above is not particularly limited insofar as it is a hydrophilic colloid which can be used in the photosensitive emulsion layer or in the non-photosensitive layer. Usually gelatin or another natural polymer or synthetic polymer is used. For example, it is possible to use gelatin derivatives; grafted polymers of gelatin and other polymers; proteins such as albumin and casein; cellulose derivatives such as hydroxyethyl cellulose, hydroxymethyl cellulose, hydroxypropyl cellulose, carboxymethyl cellulose, ethyl cellulose, methyl cellulose, nitrocellulose, and cellulose sulfates; sugar derivatives such as dextrin, sodium alginate, pectin, and carboxymethyl starch; gum Arabic; polyalkylene oxide; polyvinyl alcohol; the modified polyvinyl alcohol described in JP-A No. 7-219113; polyvinyl alcohol partial acetal; polyvinyl butyral; poly-N-vinyl pyrrolidone; polyethyl oxazoline; polyvinyl methyloxazolidone; polyacrylic acid; polymethacrylic acid; acrylonitrile propane sulfonate copolymers; the polymer polymethacrylate described in EP 678770A2; copolymers of maleic acid or esters thereof and amide; and synthetic polymers of polysaccharides such as homopolymers or copolymers with polyacrylamide, polyvinylimidazole, polyvinyl pyrazol, etc. These can also be added at the time of dispersion.

As the dispersant, conventional surfactants can be used, the anionic surfactants and nonionic surfactants described in U.S. Pat. No. 4,006,025, JP-A No. 62-215272, JP-A No. 1-201655, JP-A No. 4-125548, U.S. Pat. No. 5,104,776, EP 678771A2, JP-A No. 63-11935, and JP-A No. 63-60446 can be used singly or in combination, and the amphoteric surfactants described in U.S. Pat. No. 3,542,581 and EP 569074A1 and the fluorine-containing surfactants described in EP 602428A1 can also be used. In particular, the anionic and/or nonionic surfactants are preferably used, and more preferably the anionic polymers described in JP-A No. 4-324858, the oligomer type polymers described in JP-A No. 60-158437 and JP-A No. 7-13300, and the nonionic polymers described in U.S. Pat. No. 3,860,425 can also be used. These can be added after dispersion. The amount of the dispersant is 1 to 200% by weight relative to the dye to be dispersed. Polymers and dispersants which can be added at the time of dispersion include, but are not limited to, the following compounds:

W-1

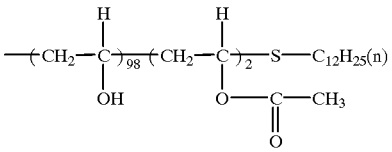

Degree of polymerization:300

W-2

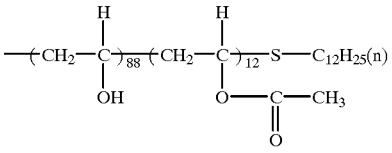

Degree of polymerization:300

-continued

W-3

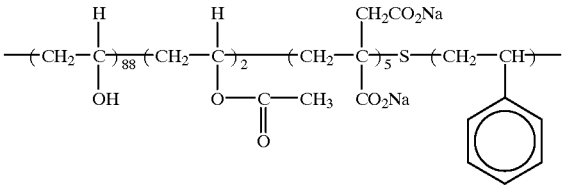

Degree of polymerization:300

W-4

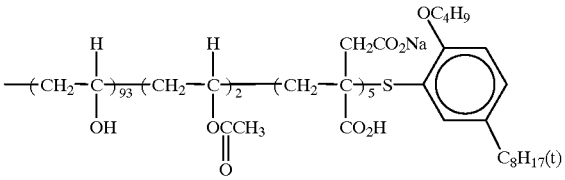

Degree of polymerization:400

W-5

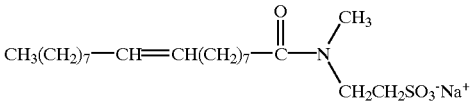

W-6

Blend of

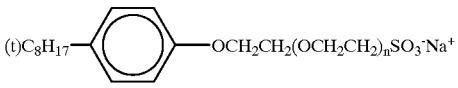

n = 1–3 and

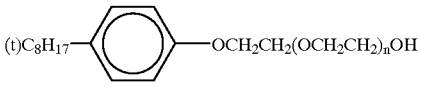

W-7

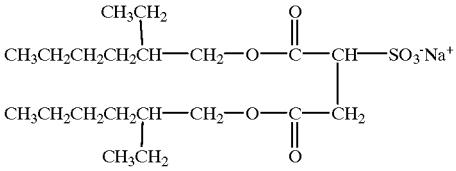

W-8

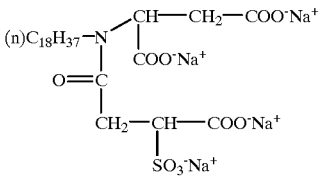

W-9

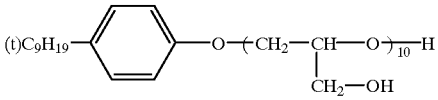

W-10

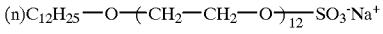

W-11

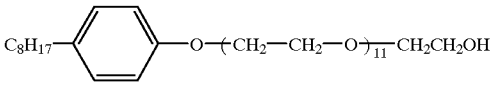

-continued
W-12
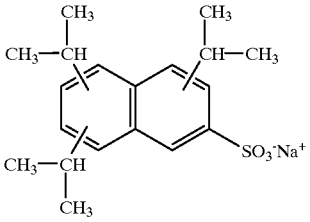
W-13
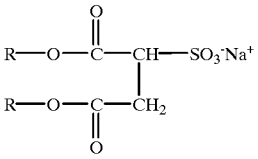
R = $CH(CH_3)C_4H_9$
W-14
R = 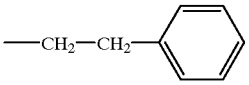
W-15
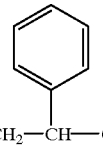
R = $—CH_2—CH(CH_3)—CH_3$
W-16
R = $—CH_2—CH(CH_2CH_3)C_3H_7$
W-17
R = $—(CH_2)_nCH_3$ (n = 2, 3 & 5)
W-18
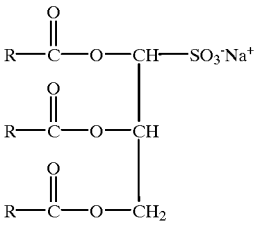
R = 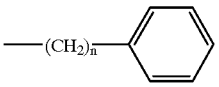
(n = 2–5)
W-19
$(n)C_{12}H_{25}—O—(CH_2—CH_2—O)_{22}—CH_2CH_2OH$
W-20
$(n)C_{12}H_{25}—O—(CH_2—CH_2—O)_{15}—CH_2—CH_2—SO_3^-Na^+$
W-21
$(n)C_{12}H_{25}—O—(CH_2—CH_2—O)_n—C(=O)—CH(CH_2—COO^-Na^+)—SO_3^-Na^+$
(n = 3–5)
W-22
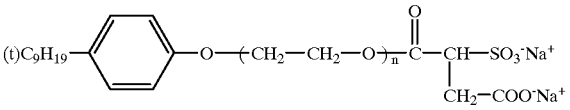
(n = 5–10)
W-23
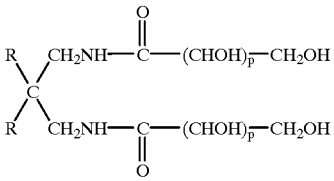
(p = 3 to 10)
W-24
R = $CH_3—(CH_2)_x—$
(x = 3 to 10)
W-25
R = 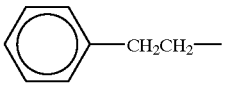
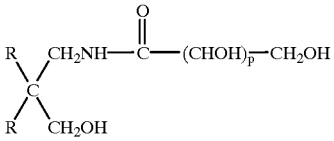
(p = 3 to 15)
W-26
R = $CH_3—(CH_2)_x—$
(x = 3 to 10)
W-27
R = 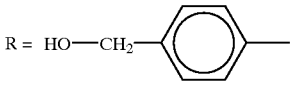
W-28
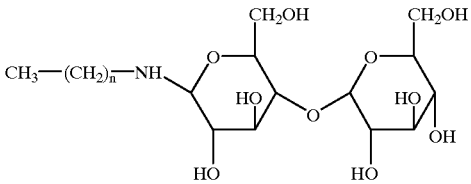
(n = 3 to 15)
W-29
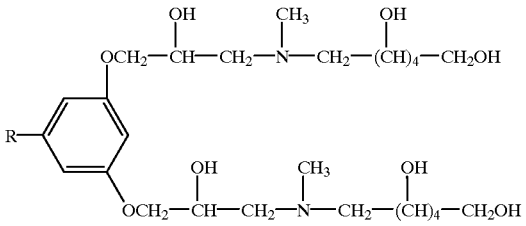
R = $(n)CH_3—(CH_2)_x—$
x = 1 to 3

-continued

W-30

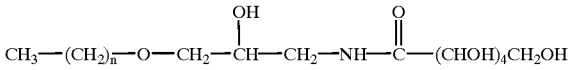

n = 3 to 15

W-31

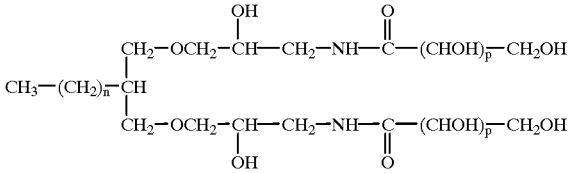

n = 2 to 12
p = 3 to 10

W-32

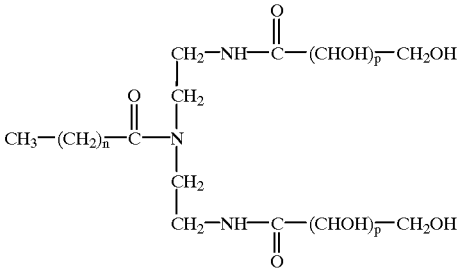

n = 2 to 12
p = 3 to 10

W-33

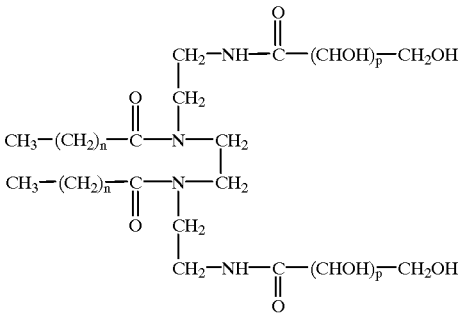

n = 2 to 18
p = 3 to 10

W-34

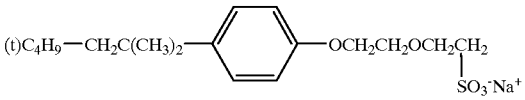

W-35

$CH_3—(CH_2)_{11}—SO_4^-Na^+$

W-36

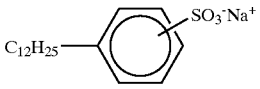

-continued

W-37

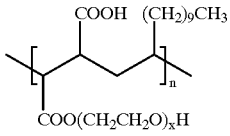

n = 10–20
p = 7–8

W-38

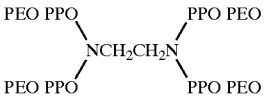

PEO = poly(ethylene oxide)
PPO = poly(propylene oxide)

W-39

$(PEO)_a—(PPO)_b—(PEO)_a$ a/(a + b) = 0.8 (weight ratio) average molecular weight of 11,400

W-40

$(PPO)_b—(PEO)_a—(PPO)_b$ a/(a + b) = 0.8 (weight ratio) average molecular weight of 8,600

(PEO: polyethylene oxide)
(PPO: polypropylene oxide)

W-41

$C_{12}H_{25}CONHCH_2CH_2OSO_3Na$

W-42

$C_{12}H_{25}SO_3Na$

W-43

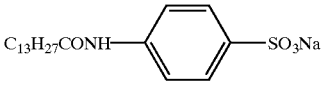

W-44

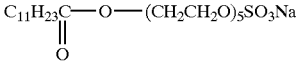

W-45

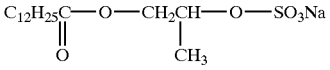

W-46

$C_{12}H_{25}OPO(ONa)_2$

W-47

$(C_{12}H_{25}O)_2POONa$

W-48

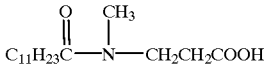

W-49

$C_{17}H_{35}COO(CH_2CH_2O)_{20}H$

W-50

$C_{12}H_{25}CO_2Na$

W-51

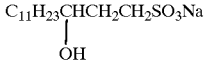

W-52

$C_{12}H_{25}O(CH_2)_4SO_3Na$

W-53

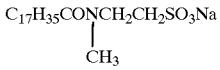

W-54

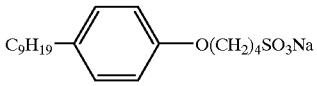

-continued

W-55

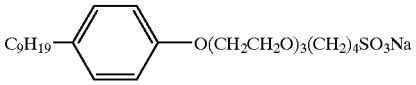

W-56

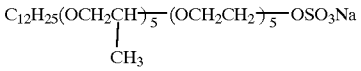

W-57

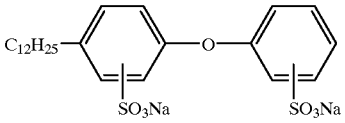

W-58 Sorbitan monolauate
W-59 Sorbitan monooleate
W-60 Sorbitan toll oil fatty ester
W-61 Sorbitan castor oil fatty ester
W-62 Polyoxyethylene olive oil fatty ester
W-63 Glycermonocaprylate
W-64 Glycermonooleate
W-65 Glycermonoisostearate
W-66 Diglycerylmonooleate
W-67 Polyoxyethylene glyceryl monooleate (n=1 to 6)
W-68 Polyoxyethylene sorbitol fatty ester (n=2 to 5)
W-69 Glyceryl monoalkyl ether (number of carbon atoms in the alkyl group is 8 to 18)
W-70 Polypropylene oxide
W-71 Polyoxyethylene sorbitan tristearate (n=30)

W-72

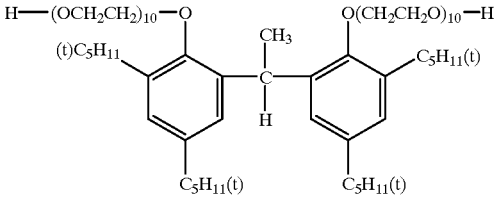

W-73

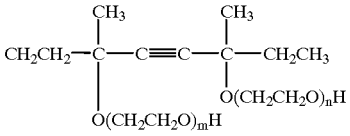

m + n = 20

W-74

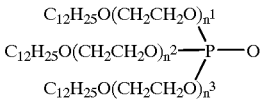

$n^1 + n^2 + n^3 - 4$

W-75

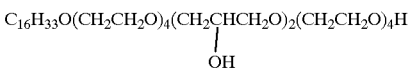

-continued

W-76

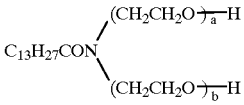

a + b = 15

W-77

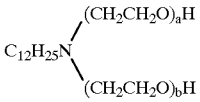

a + b = 20

W-78

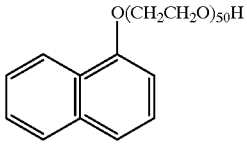

W-79

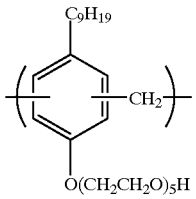

W-80

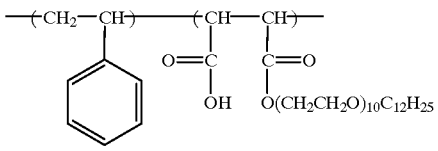

average molecular weight of 2000

W-81

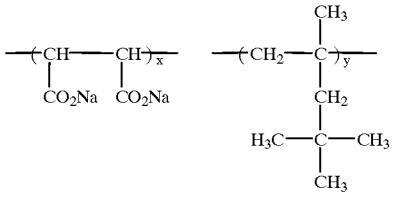

W-82

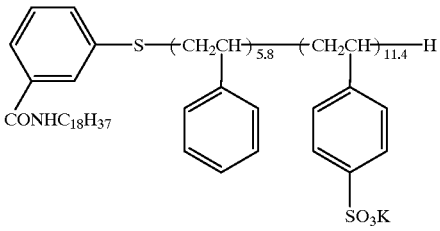

-continued
W-83
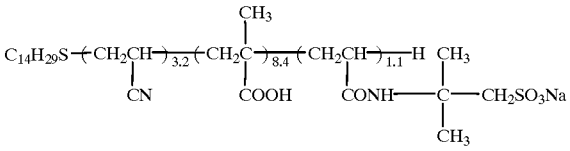
W-84
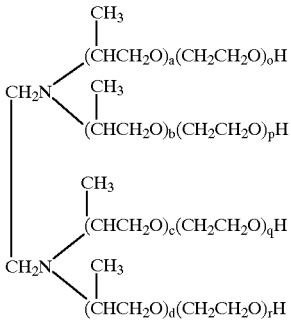
W-85
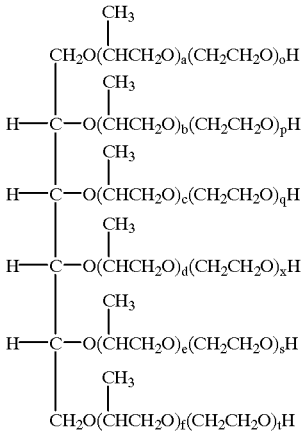
W-86
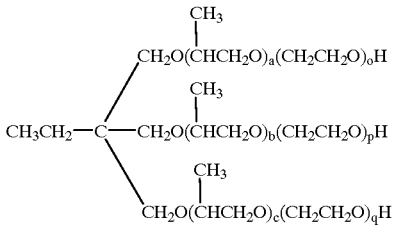
W-87
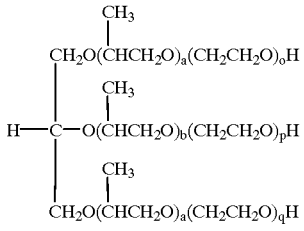
-continued
W-88
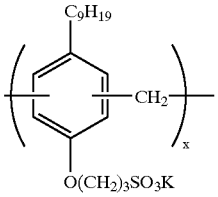
x ≒ 6
W-89
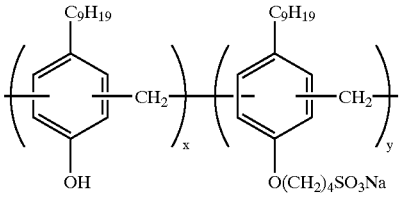
x:y = 55.45
W-90
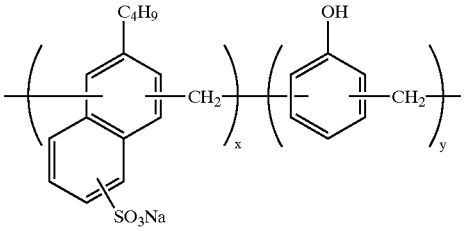
x/y = 70/30 (molar fraction)
number average molecular weight of 5300
W-91
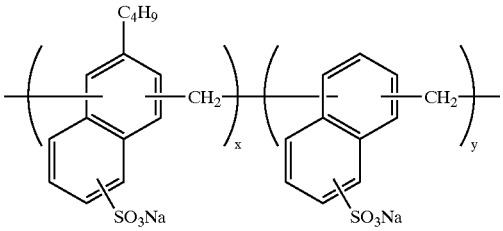
x/y = 75/25
(molar fraction)
number average molecular weight of 3900
W-92
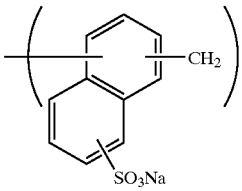
W-93
Carboxymethylcellulose
W-94
Polyvinylpyrrolidone layers such as in color negative photosensitive material; a magenta filter layer is disposed between the green-photosensitive silver halide layer and the red-photosensitive silver halide photosensitive layer; and an anti-halation layer is disposed between the support and the red-photosensitive silver halide photosensitive layer, and a dispersion of fine (crystalline) grains of the dyes represented by the general formula (I) in the present invention is preferably contained in these non-photosensitive layers. Further, a layer containing the above-described dispersion of fine (crystal) grains of the dyes represented by the general formula (I) may provided as a back layer on another support at the opposite side of the surface of the support coated with the silver halide photosensitive layer or with the non-photosensitive layer.

In the present invention, the layers (the anti-halation layer, the yellow filter layer, the magenta layer etc.) when the non-photosensitive layers are provided as the functional layers as described above, are composed preferably of a layer containing a dispersion of fine (crystal) grains of the dyes represented by the general formula (I). In this case, layers not called anti-halation layers such as yellow filter layer, magenta filter layer etc. constitute one embodiment of the present invention insofar as the dyes used in the present invention exhibit the same effect as in application to the anti-halation layer. The effect of the present invention is achieved for example by replacing fine grains of colloidal silver in the yellow filter layer by the decolorizable dyes used in the present invention.

The amount of the dispersion of fine (crystal) grains of the dyes represented by the general formula (I) added to the photosensitive material in the present invention is in the range of $5.0\times10^{-5}$ g to 5.0 g, preferably $5.0\times10^{-4}$ g to 2.0 g, more preferably $5.0\times10^{-3}$ to 1.0 g, per $m^2$ of the photosensitive material. Further, two or more dyes may be contained in the same layer, or one kind of dye may be used in a plurality of layers. Further, known dyes other than those of the present invention can be used as necessary.

By using the dispersion of fine (crystal) grains of the dyes represented by the general formula (I) above in the present invention, adverse influences such as desensitization of photographic properties due to diffusion of the dyes caused by insufficient fixing of the dyes to other layers, or the problem of deterioration of surface properties by remaining unnecessary absorption as residual color after development process due to insufficient decolorization can be solved by the so-called mordant method of fixing dye molecules by allowing a hydrophilic polymer having an opposite charge to conventionally known dissociated anionic dyes to be coexistent as a mordant in the same layer or by a method of using a dispersion of fine grains of an oil-soluble dye in water or in a gelatin solution by use of a high-boiling organic solvent or using a latex-dispersed dispersion.

3. Development Process

The development process can be used in any known methods and systems such as immersion development, coating development and spray development, regardless of the processing system, method and conditions.

In particular, a processing system of feeding a processing solution in just an amount necessary to soak into the photosensitive material is preferable because no waste fluid is generated. As the method of feeding a small amount of the solution, there is a method of immersing the photosensitive material in a processing solution and removing excess processing solution by a squeeze roller. As this method, the methods described in JP-A No. 9-15819, JP-A No. 9-15820 and JP-A No. 9-15822 are preferable. The method of feeding the processing solution is not particularly limited, but a coating process or spray process is preferably used.

As the coating process, known methods such as gravure process and reverse coating in a coating development system can be used, but the sheet treatment of substantially soaking the photosensitive material via a processing solution-carrying medium with the processing solution is a preferable system. As this method, the method described in Japanese Patent Registration No. 2655337 can be used. Felt, woven goods, and a metal having slits or pores, or the like may be used in the medium carrying the processing solution. Particularly, the methods of applying a processing solution by a sponge or a water-absorbing polymer described in JP-A No. 8-290088, JP-A No. 8-290087 and JP-A No. 9-138493 are preferable.

Another coating method is, the roller coating method and the iron bar coating method described in JP-A No. 59-18153, the method of water coating by use of a water-absorbing member described in JP-A No. 59-18354, or the devices and water described in JP-A No. 63-144,354, JP-ANo. 63-144, 355, JP-A No. 62-38,460, JP-A No. 3-210,555 etc. may be used.

In the coating process, it is often advantageous to confer viscosity on the processing solution because a necessary amount of the processing solution can be fed, and in light of this, the treatment of coating with a viscous solution is a preferable mode. As the agent for conferring viscosity on the processing solution, an organic or inorganic polymeric material which can be dissolved in the processing solution is used. Preferable viscosity-conferring agents include water-soluble cellulose derivatives such as hydroxy cellulose, cellulose acetate phthalate and carboxyethyl cellulose, various natural polymers such as starch, dextrin, alginic acid, peptin and polysaccharides, sugars such as galactose, sucrose and glucose, and water-soluble synthetic polymers such as polyvinyl alcohol and its partially crosslinked polymers, polyacrylate, polymethacrylate, butyl methacrylate or their copolymers.

The spray treatment is a method of treating the photosensitive material by spraying with the processing solution, and this method is advantageous in easy regulation of the amount of the sprayed processing solution in an amount capable of substantially soaking into the photosensitive material. Regardless of the method and system for spraying the processing solution and the number and shape of nozzles, the solution may be sprayed by moving a single movable nozzle or by use of a plurality of fixed nozzles. In addition, spraying may be conducted by moving the nozzle while the photosensitive material is fixed, or by moving the photosensitive material while the nozzle is fixed. A particularly preferable method among these is a method of spraying a processing solution by use of a processing solution-coating unit including a plurality of processing solution-spraying nozzles arranged linearly at regular intervals in a direction perpendicular to the direction of delivery of a photosensitive material or a treatment member, as well as an actuator for dislocating the nozzles toward the photosensitive material or the treatment member in the delivery thereof.

Hereinafter, the composition of the developing solution is described. The development can make use of either black and white development or color development, and a preferable developing solution can be selected depending on the object. Because the development activity of the black and white developing solution is strong, there are advantages that the development time can further be reduced, the fogging in a non-image part can be suppressed whereby image noise is reduced and the saturation in a color image can be raised, the developing solution is stable and hardly contaminated during development, and the management of the solution is easy. On the other hand, when a color developing solution is selected, the reading of images is made feasible by use of color images so that images of high saturation with less mixed color can be obtained.

The black and white developing solution can make use of a developing agent known in the art. The developing agent includes dihydroxy benzenes (e.g., hydroquinone, hydroquinone momosulfonate, catechol), 3-pyrazolidones (e.g. 1-phenyl-3-pyrazolidone, 1-phenyl-4-methyl-4-hydreoxymethyl-3-pyrazolidone, 1-phenyl-4,4-dihydroxymethyl-3-pyrazolidone), aminophenols (e.g. N-methyl-p-aminophenol, N-methyl-3-methyl-p-aminophenol, N-methyl-2-sulfoaminoaminophenol), ascorbic acid, erysorbic acid and isomers and derivatives thereof, and p-phenylene diamine salts also used as the color developing agent described below, can be used singly or in combination thereof. When these developing agents are used in the form of salt, their counter salts in the form of sulfate, hydrochloride, phosphate, and p-toluene sulfonate are used. The amount of these developing agents added is preferably $1\times10^{-5}$ to 2 mol per L of the developing solution.

The black and white developing solution can make use of a preservative as necessary. As the preservative, sulfites and bisulfites are generally used. The amount of these preservatives added is 0.01 to 1 mol/L, preferably 0.1 to 0.5 mol/L. Further, ascorbic acid is also an effective preservative, and its amount is preferably 0.01 to 0.5 mol/L. Besides, hydroxyamines, sugars, o-hydroxy ketones and hydrazines can also be used. The amount of these compounds added is not more than 0.1 mol/L.

The pH of the black and white developing solution is preferably 8 to 13, most preferably pH 9 to 12. Various buffer agents can also be used to maintain the pH. Preferable buffer agents include carbonates, phosphates, borates, 5-sulfosalicylates, hydroxybenzoates, glycine salts, N,N-dimethyl glycine salts, leucine salts, norleucine salts, guanine salts, 3,4-dihydrophenyl alanine salts, alanine salts, aminobutyrates, valine salts, lysine salts etc. In particular, the carbonates, borates, and 5-sulfosalicylates are preferably used in respect of their ability to keep the pH range described above and their low prices. These buffer agents are used in the form of an alkali metal salt of Na or K or an ammonium salt as a counter salt. These buffer agents can be used alone or in combination thereof. To achieve the desired pH, an acid and/or an alkali may be added.

As the acid, a water-soluble inorganic or organic acid can be used. The acid includes e.g. sulfuric acid, nitric acid, hydrochloric acid, acetic acid, propionic acid, ascorbic acid etc. Further, as the alkali, various hydroxides and ammonium salts can be added. The alkali includes e.g. potassium hydroxide, sodium hydroxide, ammonia water, triethanolamine, diethanolamine, etc.

The black and white developing solution preferably contains a silver halide solvent as a development promoter. For example, thiocyanate salts, sulfites, thiosulfates, 2-methylimidazole, and the thioether type compounds described in JP-A No. 57-63580 are preferable. The amount of these compounds added is preferably about 0.005 to 0.5 mol/L. Further, the development promoter includes various quaternary amines, polyethylene oxides, 1-phenyl-3-pyrazolidones, primary amines, N,N,N',N'-tetramethyl-p-phenylene diamine, etc.

In the step of black and white development in the present invention, various anti-fogging agents can be added for the purpose of preventing development fogging. The anti-fogging agents are preferably alkali metal halides such as sodium chloride, potassium chloride, potassium bromide, sodium bromide and potassium iodide, as well as organic anti-fogging agents. The organic anti-fogging agents include e.g. nitrogenous heterocyclic compounds such as benzotriazole, 6-nitrobenzimidazole, 5-nitrosoindazole, 5-methylbenzotriazole, 5-nitrobenzotriazole, 5-chlorobenzotriazole, 2-thiazolyl-benzimidazole, 2-thiazolylmethyl-benzimidazole and hydroxyazaindolizine, and mercapto-substituted heterocyclic compounds such as 1-phenyl-5-mercaptotetrazole, 2-mercaptobenzoimidazole, 2-mercaptobenzothiazole, and mercapto-substituted aromatic compounds such as thiosalicylic acid. These anti-fogging agents include those eluted from the color reversed photosensitive material during treatment and contained in these developing solutions.

Among these, the concentration of iodides added is about $5\times10^{-6}$ to $5\times10^{-4}$ mol/L. Further, bromides are preferable for preventing fogging, and their concentration is preferably 0.001 to 0.1 mol/L, more preferably 0.01 to 0.05 mol/L.

Further, the black and white developing solution of the present invention can contain a swelling inhibitor (e.g. inorganic salts such as sodium sulfate, potassium sulfate etc.) or a hard water-softening agent.

As the hard water-softening agent, it is possible to use compounds having various structures, such as aminopolycarboxylic acid, aminopolyphosphonic acids, phosphonocarboxylic acid, organic and inorganic phosphonic acids etc. The hard water-softening agent includes, but is not limited to, the following examples:

Ethylenediaminetetraacetatic acid, nitrilotriacetic acid, hydroxyethyliminodiacetic acid, propylenediaminetetraacetic acid, dimethylenetriaminepentaacetic acid, triethylenetetraminehexaacetic acid, nitrilo-N,N,N-trimethylene phosphonic acids, ethylenediamine-N,N,N',N'-tetramethylene phosphonic acids, and 1-hydroxyethylidene-1,1-diphosphonicacids. These hard water-softening agents may be used in combination thereof. The amount of these agents added is preferably 0.1 to 20 g/L, more preferably 0.5 to 10 g/L.

Further, various surfactants such as alkyl sulfonic acids, aryl sulfonic acids, aliphatic carboxylic acid, aromatic polycarboxylate polyalkylene imine etc. may be added.

When the color developing solution is used in the development process in the present invention, a color developing solution is used. The color developing agent is an aqueous alkaline solution based on aromatic primary amine-type color developing agent. As the color developing agent, a p-phenylene diamine-type compound is preferably used. Typical examples of such p-phenylene diamine-type compounds include 3-methyl-4-amino-N,N-diethyl aniline, 3-methyl-4-amino-N-ethyl-N-β-hydroxyethyl aniline, 3-methyl-4-amino-N-ethyl-N-β-methanesulfonamide ethyl aniline, 3-methyl-4-amino-N-ethyl-N-β-methoxyethyl aniline, and sulfates, hydrochlorides and phosphates thereof, as well as p-toluene sulfonate, tetraphenyl borate, and p-(t-octyl) benzene sulfonate. These developing agents may be used in combination thereof as necessary. The amount of these compounds added is preferably about 0.005 to 0.1 mol/L, more preferably about 0.01 to 0.05 mol/L.

The pH of the color developing solution is preferably 8 to 13, most preferably pH 10.0 to 12.5. Various buffer agents are used to maintain this pH.

The various buffer agents described above for the black and white developing solution can be used in the coloring developing solution. In particular, 5-sulfosalicylate, tetraborate and hydroxy benzoate are preferable as buffer agents for the color developing agent because of advantages such as excellent solubility, buffering performance in a high pH range of pH 10.0 or more, the absence of their adverse influence (stain) on photographic performance even upon addition to the color developing solution, and their low prices.

The amount of the buffer agent added to the color developing solution is preferably the amount described above for the black and white developing solution.

Further, various developing promoters may be used in combination as necessary in the color developing solution.

As the developing promoters, it is possible to use the various pyridium compounds, other cationic compounds, cationic dyes such as phenosafranine, and neutral salts such as thallium nitrate and potassium nitrate described in U.S. Pat. No. 2,648,604, JP-B No. 44-9503 and U.S. Pat. No. 3,171,247, the nonionic compounds such as polyethylene glycol or derivatives thereof and polythioethers described in JP-B No. 44-9304, U.S. Pat. Nos. 2,533,990, 2,531,832, 2,950,970 and 2,577,127, and the thioether type compounds described in U.S. Pat. No. 3,201,242.

Further, benzyl alcohol and its solvents such as diethylene glycol, triethanolamine, diethanolamine etc. can be used as necessary. However, in consideration of load on the environment, solubility in the solution and tar generation, it is preferable to minimize the amount of these solvents.

The color developing solution may also contain the same silver halide solvent as in the black and white developing solution. Examples include, thiocyanates, 2-methyl imidazole, and the thioether type compounds described in JP-A No. 57-63580.

The anti-fogging agent is usually added to the color developing solution, and the anti-fogging agent described above for the black and white developing solution also applies to this anti-fogging agent.

Various preservatives can also be used in the color developing solution in the present invention.

As typical preservatives, hydroxylamines and sulfites can be used. The amount thereof is about 0 to 0.1 mol/L.

There is the case where in the color-developing agent used in the present invention, an organic preservative can be used preferably in place of the hydroxylamine or sulfite ions described above.

The organic preservative refers to all organic compounds, which upon addition to the processing solution for the color photosensitive material, reduce the rate of deterioration of the aromatic primary amine color developing agent. That is, they are organic compounds having the function of preventing oxidation of the color developing agent with air etc. and particularly preferable organic preservatives include hydroxylamine derivatives (excluding hydroxylamine), hydroxamic acids, hydrazines, hydrazides, phenols, α-hydroxy ketones, α-aminoketones, sugars, monoamines, diamines, polyamines, quaternary ammonium salts, nitroxy radicals, alcohols, oximes, diamide compounds, and condensed cyclic amines. The amines described in JP-A No. 1-186939 and JP-A No. 1-187557, the alkanolamines described in JP-A No. 54-3532, the polyethylene imines described in JP-A No. 56-94349, and the aromatic polyhydroxy compounds described in U.S. Pat. No. 3,746,544 etc. may be used as necessary. In particular, it is preferable to add alkanolamines such as triethanolamine, dialkylhydroxyl amines such as N,N-diethyl hydroxyl amine and N,N-di(sulfoethyl)hydroxyl amine, hydrazine derivatives (excluding hydrazine) such as N,N-bis(carboxymethyl) hydrazine, or aromatic polyhydroxy compounds represented by sodium catechol-3,5-disulfonate.

The amount of these organic preservatives added is preferably 0.02 to 0.5 mol/L, more preferably 0.05 to 0.2 mol/L or thereabout, and as necessary, two or more organic preservatives may be used in combination.

Besides, the color developing solution in the present invention can contain organic solvents such as diethylene glycol and triethylene glycol; color material-forming couplers; competitive couplers such as citrazinic acid, J acid and H acid; nucleating agents such as sodium boron hydride; auxiliary developing agents such as 1-phenyl-3-pyrazolidone; the chelating agents (hard water-softening agents) described above for the black and white developing solution, and the surfactants described above for the black and white developing solution.

The development processing time is 5 seconds to 10 minutes, preferably 10 seconds to 2 minutes for black and white development, or 10 seconds to 10 minutes, preferably 20 seconds to 5 minutes for coloring development. The treatment temperature is 20 to 90° C., preferably 33 to 70° C. The development time refers to the time elapsed after the film is introduced into the development bath until it is introduced into the next bath (usually a rinse bath with water or a stabilizing solution). Accordingly, the development time in the case of coating process or spray process refers to the time elapsed after the film is coated (or sprayed) with the developing solution until the film is coated (or sprayed) with a next solution or immersed in the next chamber. The development process of the present invention may be not only a disposable process such as coating process or spray process but also immersion treatment using a development bath, where the both will be replenished filled if the amount of developing solution is reduced or if there is an overflow of development solution. In the latter case, the amount of the developing solution replenished is 100 to 5000 ml, preferably 200 to 2000 ml or thereabout per $m^2$ of the photosensitive material.

The development process is as described above, and when the photosensitive layer is processed with a solution containing a silver halide solvent (e.g. a fixing solution) or subjected to color development, the image may be read after the developed film is transparentized by treatment with a solution containing a silver halide solvent (e.g. a bleaching fixing solution) to which a silver bleaching agent was added in order to improve the accuracy of reading the image information in the present invention.

Further, from experience it was determined that when the water content in the photosensitive layer is reduced by heating the developed film, the transparency is increased thereby improving the accuracy of reading the image, and accordingly, heat drying (heating for securing rapidness) may be conducted prior to reading of the image. Further, the clarification process or heat drying treatment may be conducted between the first image information reading by reflected light and the second image information reading by transmitted light.

4. Reading of an Image

The aspect in which the image information stored in each photosensitive layer is read by reflected light and transmitted light is described. Reading of the image information may be any form insofar as the image information of the three photosensitive layers can be read, and in particular, the following form is preferable.

(1) The system wherein the development process is carried out in black and white development, and the first image information includes two kinds of image information, that is, the image information recorded on the uppermost photosensitive layer, obtained by reading the photosensitive material at front surface side and the image information recorded on the lowermost photosensitive layer, obtained by reading the photosensitive material at back surface, and the image information contained in the entire photosensitive layers which is read by transmitted light simultaneously as the second image information. This system utilizes the fact that the image information recorded on the uppermost photosensitive layer and the lowermost photosensitive layer of the photosensitive material can be read highly accurately by reflected light. This system is also advantageous in that the development process solution is highly active and stable and maintained relatively easily.

(2) The system of conducting development process is in a color developing solution in the above-described reading system. In this case, a sensor for reading the second image information is adjusted for a color image (usually magenta) recorded in the intermediate photosensitive layer, and the image information on the image in the intermediate photosensitive layer can be extracted selectively, so separation of each image information can be improved to provide image characteristics with high saturation.

(3) The system where the development process to which the photosensitive material is subjected is a color development process, the first image information is the information on either the uppermost or lowermost photosensitive layer of the photosensitive material, and the second image information is the image information read from the other uppermost or lowermost photosensitive layer of the photosensitive material and from the intermediate photosensitive layer. By use of the color developing solution, the reflected-light recording sensor can be adjusted for each coloring element image, and the separation of each image information is advantageous.

(4) When the reading of the first image information or the second image information is the reading of image information in a plurality of photosensitive layers, the same image reader may be used repeatedly, or a special image reader may be used for reading each information.

Hereinafter, the first image information reading part 312 and the second image information reading part 314 shown in FIG. 21 are described by reference to an example of the reading of a particularly black and white-developed film. The first image information reading part 312 is for reading an image by an image scanner using reflected light (reflection type image reading), and the second image information reading part 314 is for reading an image by an image scanner using transmitted light (transmission type image reading). The reflection type image reading and the transmission type image reading can be conducted in the following manner. That is, it is possible to use a line CCD-scanning system in which line CCD having light receiving elements arranged one-dimensionally is used to read the density of an image the image is being sub-scanned on a developed film and the density is converted electrical signal by line CCD, or an area CCD system in which an area CCD having light receiving elements arranged two-dimensionally is used to read the density of an image and the density is converted into electrical signal arranged in time series by electrical scanning from the area CCD.

Figure 22:
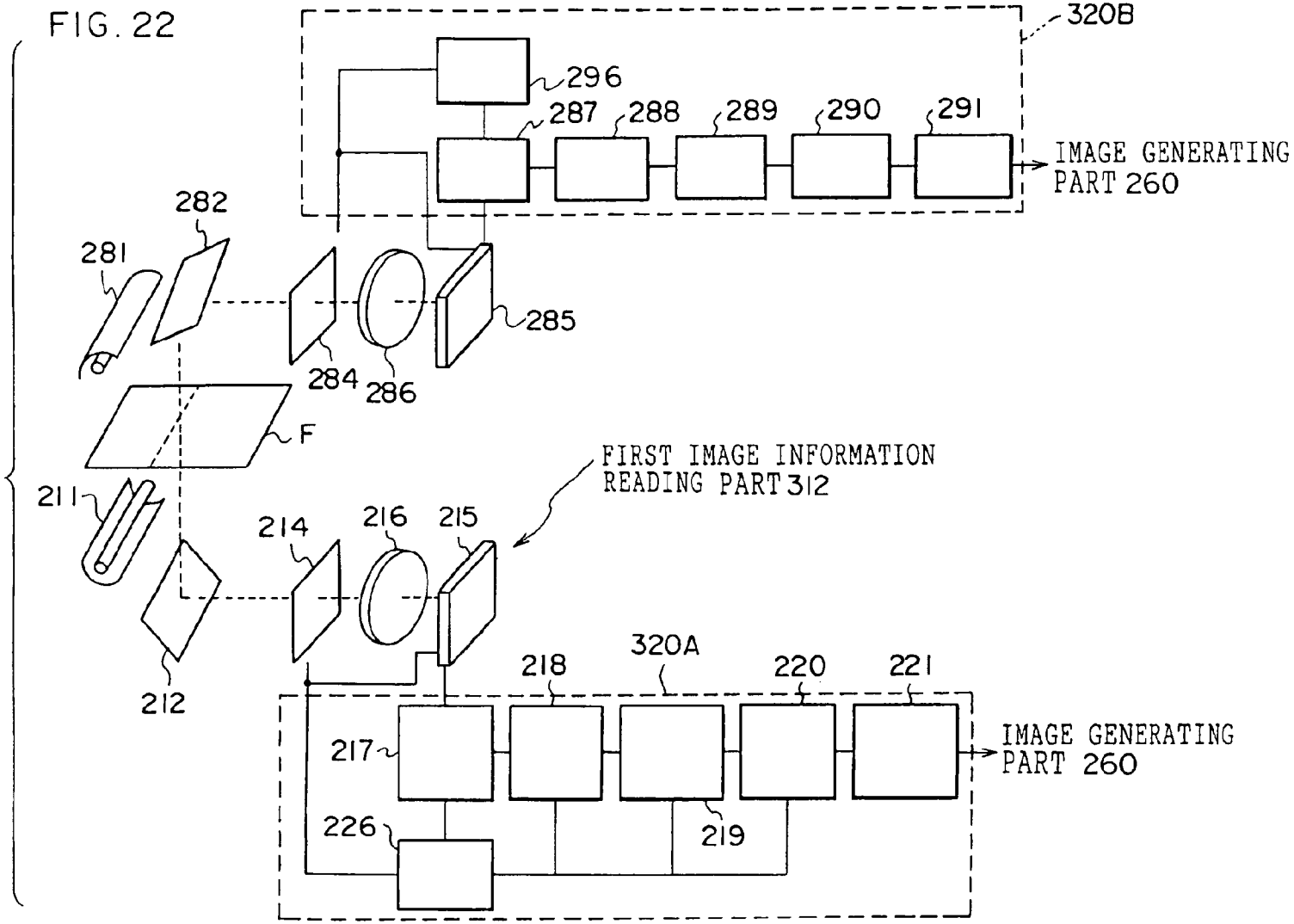
FIG. 22 is a block diagram schematically showing the structure of a first image reading part 312.

FIG. 22 shows schematic structure of the first image information reading part 312. Here, the reading of the image information stored in both the front and back photosensitive layers of film F is described. Accordingly, the first image information includes two kinds of image information. As shown in FIG. 22, the first image information reading part 312 is formed so as to be capable of detecting reflected light from the back side (the side of the support) and the front side (the side of the emulsion) of film F, whereby the color image can be photoelectrically read, and the first image information is thereby obtained. At the side of the support, the first image information reading part 312 includes a light source 211, a mirror 212 for reflecting light which is emitted by the light source 211 and reflected by the surface of F, a light regulating unit 214 capable of regulating the amount of light, a CCD area sensor 215 for detecting the reflected light photoelectrically, and a lens 216 for forming an image of the reflected light on the area sensor. At the side of the emulsion, the first image information reading part 312 includes a light source 281, a reflective mirror 282, a light-regulating unit 284, a CCD area sensor 285, and a lens 286.

As a general color negative film, film F is provided with red, green and blue color photosensitive layers respectively from the side of the support. Accordingly, the light source 211 irradiates the red color-photosensitive layer, and the light source 281 irradiates the blue color-photosensitive layer. Further, the CCD area sensor 215 receives reflected light from the red color-photosensitive layer, and the CCD area sensor 285 receives reflected light from the blue color-photosensitive layer. Accordingly, the first image information contains mainly red and blue image information. Here, "mainly" means that the reflected light may contain not only single color image information but also the image information from the adjacent layers, depending on light density and layer thickness.

The first image information obtained in the first image recording part 312 is fed to the image processing part 320 shown in FIG. 21. The image processing part 320 is composed of the image processing part 320A for digital conversion of one kind of the first image information, the image processing part 320B for digital conversion of the other kind of the first image information, and the image processing part 320C for converting the second image information into digital signal as described below. The image processing part 320A has an amplifier 217 for amplifying the image signal detected and formed photoelectrically by the CCD area sensor 215, an A/D converter 218 for digitalizing the image signal, a CCD correcting means 219 for correcting sensitivity fluctuation or dark current for each image for the signal digitalized by the A/D converter 218, a log converter 220 for converting the image data into density data, and an interface 221, and these are regulated by CPU 226. Similarly, the image processing part 320B has an amplifier 287 for amplifying the image signal detected and formed photoelectrically by the CCD area sensor 285, an A/D converter 288, a CCD correcting means 289, a log converter 290 and an interface 291, and these are regulated by CPU 296. The image processing part 320B is regulated in the same manner as in the image processing part 320A.

Figure 26:
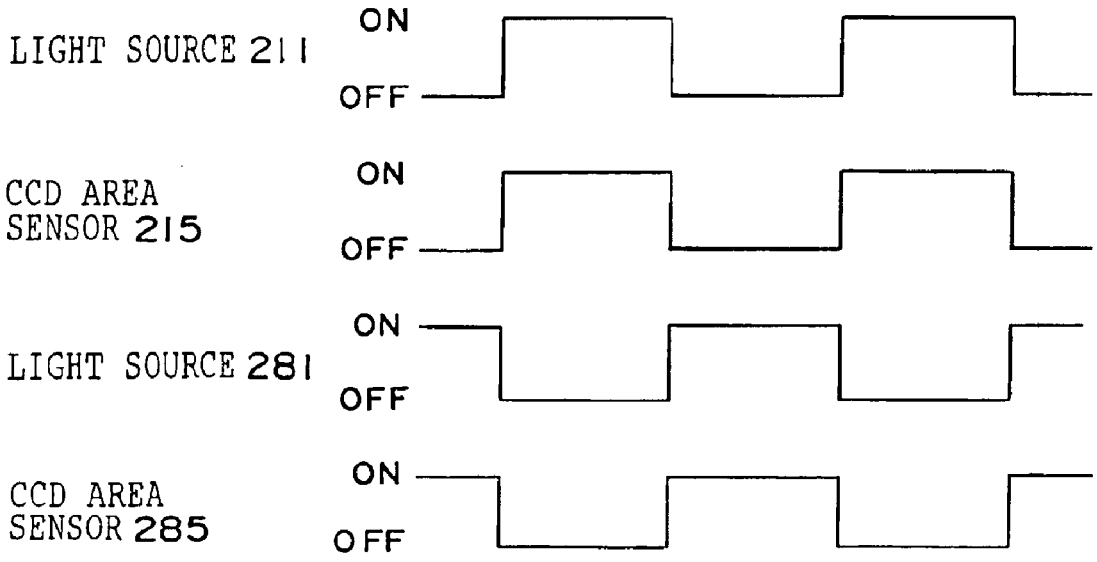
FIG. 26 is a drawing of timing showing a lighting pattern of light sources 211 and 281 in the first image information reading part 312.

FIG. 26 shows the timing of operation of the light sources 211 and 281 and CCD area sensors 215 and 285, and the light sources 211 and 285 are regulated so as to be alternately lighted by a controlling unit not shown in the drawing so that the back side and front side of film F are irradiated alternately. The CCD area sensors 215 and 285 operate in synchrony with the lighting of light sources 211 and 281, and simultaneously they operate so as not to receive light from the light source at the opposite side.

In the example shown in FIG. 22, the light sources 211 and 281 and CCD area sensors 215 and 285 are arranged so as to read the image information of film F at the same position, but may also be formed so as to read the image information of F at different positions (e.g. positions which are apart by one frame). That is, the light exposure positions of the light sources 211 and 281 are made different, and the focal positions of the CCD area sensors 215 and 285 are made different so as to take a picture on film F at different light exposure positions.

Further, the wavelengths of the light sources 211 and 281 are made different, and the CCD area sensors 215 and 285 may be formed so as to be sensitive and to respond to the wavelengths of the corresponding light sources. In this case, the CCD area sensors are not sensitive to light at the opposite side, and thus film F can be used for photography by simultaneously receiving light from the light sources 211 and 281 simultaneously.

Figure 23:
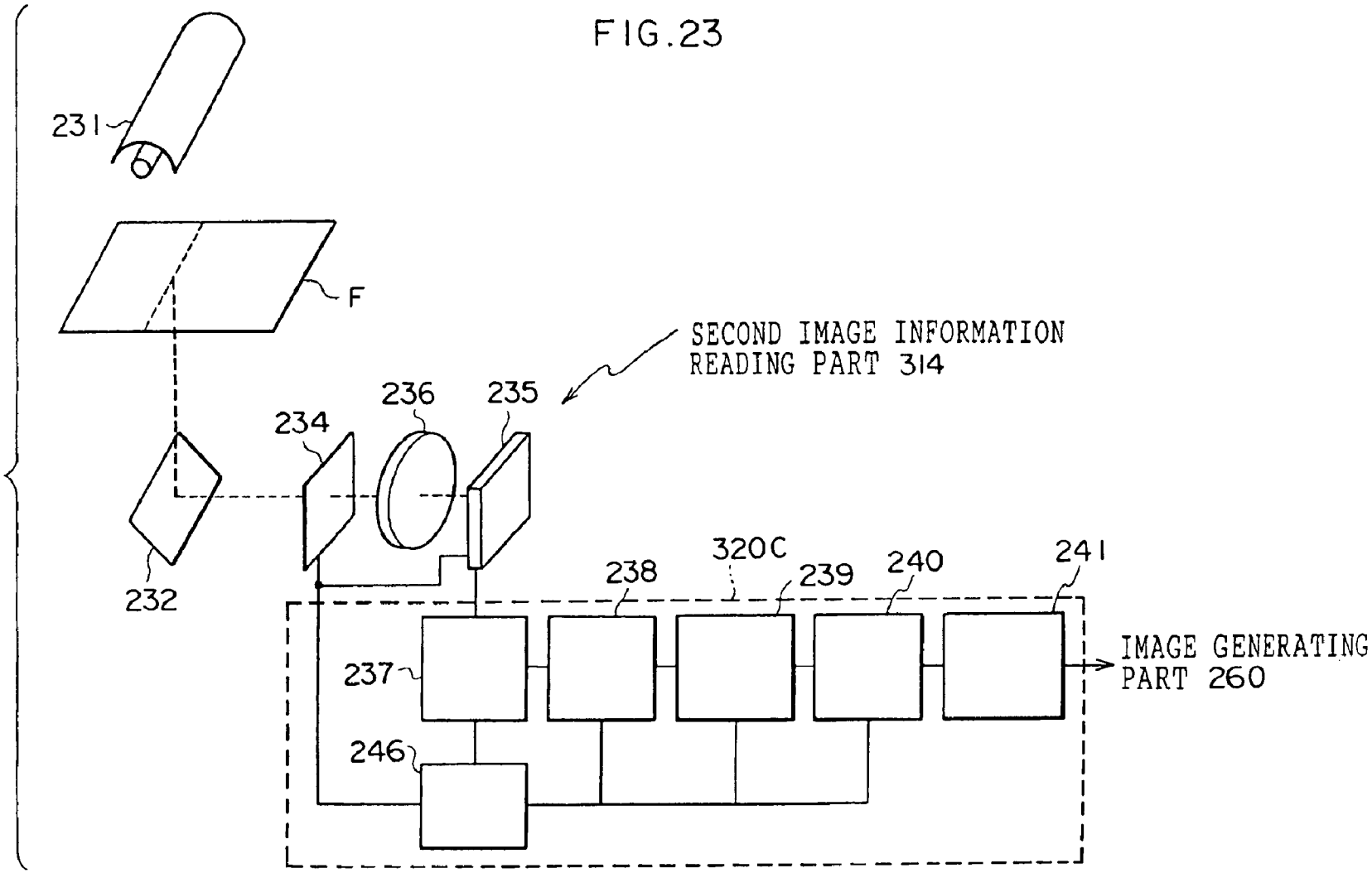
FIG. 23 is a block diagram schematically showing the structure of a second image reading part 314.

FIG. 23 shows an outline of the constitution of the second image information reading part 314. As shown in FIG. 23, the second image recording part 314 is formed to be capable of reading a color image photoelectrically by detecting light transmitted through film F by irradiating the film, and it has a light source 231 arranged at the surface side of film F, a reflection mirror 232 for reflecting light emitted by the light source 231 and transmitted through film F, a light-regulating unit 234 capable of regulating the amount of light, a CCD area sensor 235 for detecting transmitted light photoelectrically, and a lens 236 for making an image of the transmitted light on the area sensor. Alternatively, the light source 231 may be arranged at the backside of film F so as to detect the light transmitted from the backside. By irradiating film F by the light source 231, the CCD area sensor 235 receives transmitted light from each color-photosensitive layer. Accordingly, in the second color image information, red, green and blue image information is overlaid.

The second image information obtained in the second image information reading part 314 is fed to an image processing part 320C. The image processing part 320C has an amplifier 37 for amplifying the image signal detected and formed photoelectrically by the CCD area sensor 235, an A/D converter 238 for digitalizing the image signal, a CCD correcting means 239 for correcting sensitivity fluctuation or dark current for each image for the signal digitalized by the A/D converter 238, a log converter 240 for converting the image data into density data, and an interface 241, and these are regulated by CPU 246.

In the first and second image information reading parts 312 and 314, film F is transferred to permit the film face to be perpendicular to the optical axis, and then it is stopped in a predetermined position, and when the frame image is read, it is transferred by the image frame pitch.

In the area CCD in the first and second image information reading parts 312 and 314, a plurality of image elements for detecting light are arranged two-dimensionally along the length direction and the width direction of film F, and it has the function of accumulating charges depending on the light received by the whole image elements and can electrically read the (two-dimensional) frame image. The area CCD has been mainly described, but the line CCD can be used in place of the area CCD. When the line CCD is to be used, film F may not be required to be sent by image frame pitch and may be sent continuously. In the line CCD, a plurality of image elements for detecting light are arranged linearly along the width direction of film F and have the function of accumulating charges depending on the light received by the line image elements and electrically read the (one-dimensional) image.

Examples of the light source applicable to the first and second image information reading parts 312 and 314, include tungsten, fluorescent lamp, emission diodes, and laser light. In particular, the light sources 211 and 221 used in the first image information reading part 312 are preferably infrared light, and the light source 231 used in the second image information reading part 314 is preferably infrared light or laser light. The wavelength of the infrared light is from 800 to 1200 nm, preferably from 850 to 1100 nm.

The first and second image information read in the first and second image information reading parts 312 and 314 is input into an image generating part 260.

Figure 24:
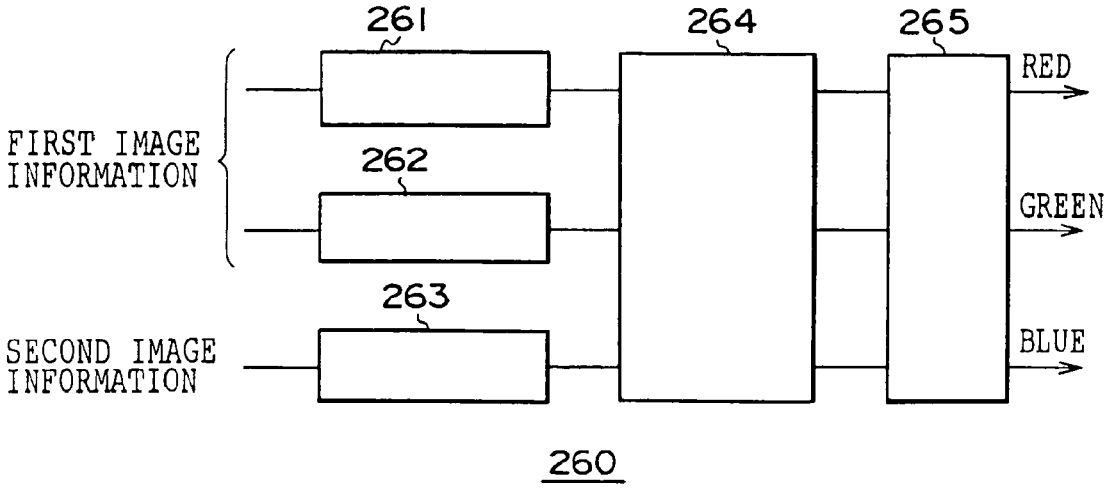
FIG. 24 is a block diagram schematically showing the structure of an image forming part 260.

FIG. 24 shows the structure of the image generating part 260, and has memories 261 and 262 for storing the first image information, a memory 263 for storing the second image information, a linearly converting part 264 for loading the red, green and blue image information contained in the first image information and the red, green and blue image information contained in the second image information with a predetermined factor by known linear conversion, and an adding part 265 for separating and deriving the red, green and blue single color image information by adding treatment based on the loaded result. Digital image data on each color obtained in the image generating part 260 is output into a digital image processing part 270.

Figure 25:
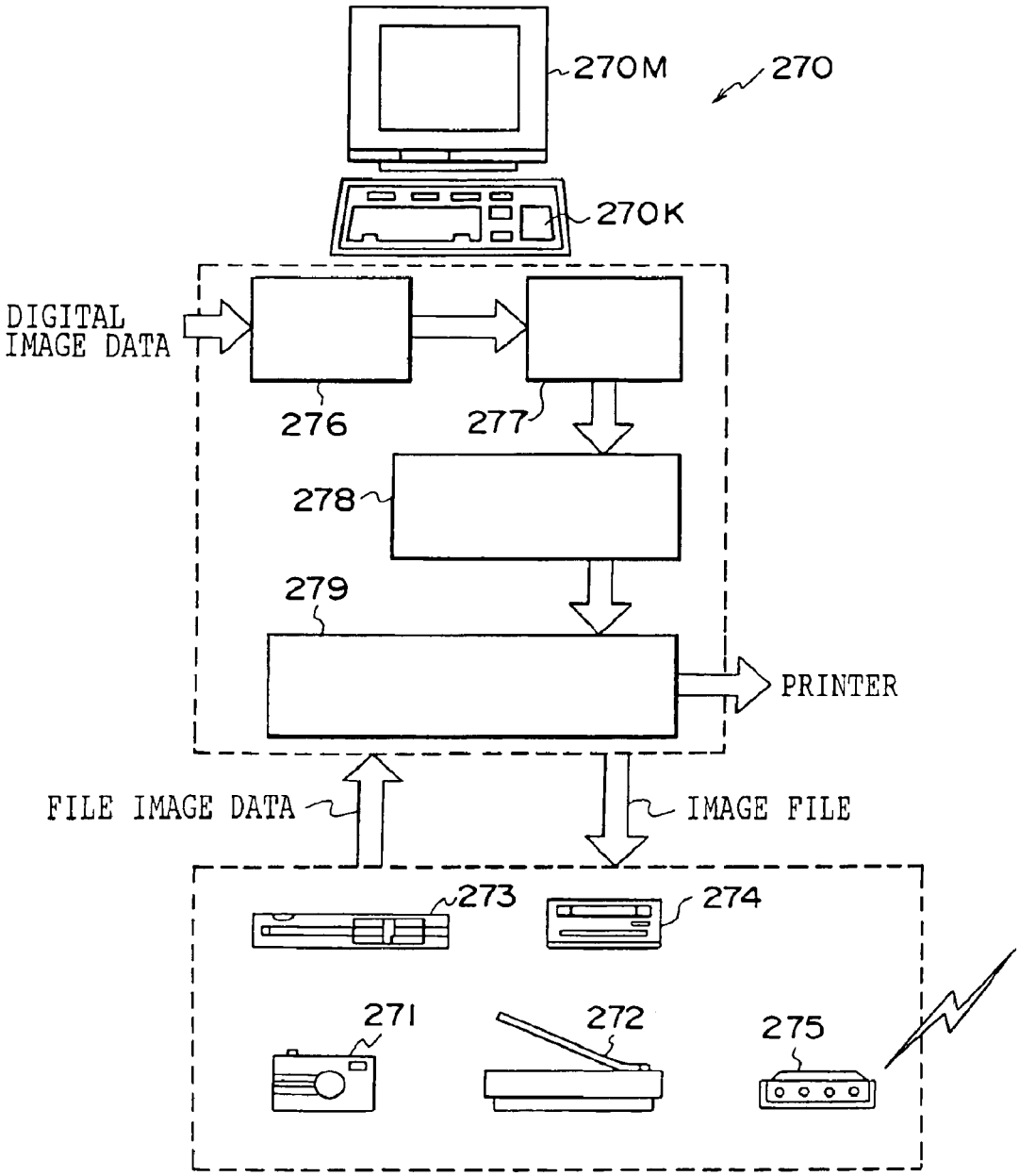
FIG. 25 is a block diagram schematically showing the structure of a digital image processing part 270.

FIG. 25 shows a schematic structure of the digital image processing part 270. The digital image processing part 270 can incorporate image data obtained by taking a picture by digital camera 271 etc., and the image data obtained by reading the transmitted or reflected manuscript etc. are formed by computer etc. and then stored on a recording medium, whereby the image data input via a floppy disk drive 273, an MO drive or CD drive 274 and the image data (image file data) input by communication via modem 275 can also be read.

The digital image processing part 270 stores the input digital image data in memory 276 and processes the image for various kinds of correction etc. in a color tone processing part 277, a hyper processing part 278 and a hyper sharpness processing part 279 etc., and then output as record image data into a printer not shown in the drawing. When the original image developed by this image operation or the read image is inferior in quality, the image is corrected for tone or saturation. Further, the digital image processing part 270 can store the image data subjected to digital image processing as image file data in memory media (e.g. FD, MO, CD) and output the data to the outside via a communication line.

Further, as the input device, keyboard 270K and monitor 270M are provided, and image incorporation and various kinds of image processing are possible by key operation on the keyboard 270K while looking at an indication on the monitor 270M.

In the image reading described above, the reading of an image on film F is described by reference to an example where the image is read twice from the front and back sides in the first image information reading part 312 and read once in the second image information reading part 314. This method is not limited to the reading of an image on the black and white developed film described above and can be applied to a color-developed film.

However, when an image on particularly a color-developed film is to be read, the wavelength of the light source 231 is regulated to achieve the density information of the photosensitive layer of desired color in the second image information-reading part 314, whereby the color image recorded on the interlayer can be selectively extracted.

Further, when an image on a color-developed film is to be read, the image information on either the front or back of the film is obtained by reading reflected light once, and the wavelength of the light source 231 is regulated to obtain the density information of the photosensitive layer of desired color, whereby the image information on the other layer and the interlayer in the film may be obtained by reading transmitted light twice.

In this case, when the image information carried on the red photosensitive layer at the side of the support of film F is read in the first image information reading part 312, the wavelength of the light source is first set so as to read the image information carried on the blue photosensitive layer positioned at the front side and then the wavelength of the light source is set so as to read the image information carried on the green photosensitive layer positioned in the center, in the second image information reading part 314. Accordingly, the first image information contains the red image information, while the second image information contains the blue and green image information.

Alternatively, when the image information carried on the blue photosensitive layer at the front side of film F is read in the first image information reading part 312, the wavelength of the light source is first set so as to read the image information carried on the red photosensitive layer positioned at the side of the support, and then the wavelength of the light source is set so as to read the image information carried on the green photosensitive layer positioned in the center, in the second image information reading part 314. Accordingly, the first image information contains the blue image information, while the second image information contains the red and green image information.

5. Photosensitive material used in the present invention and supplementary description relating thereto (1) Photosensitive Material The photosensitive material used in the present invention is a color photosensitive material used widely in the field of photography as described in connection with the objects and background of the present invention, and this photosensitive material is provided with at least one photosensitive layer on a support. A typical example is a photosensitive material of silver halide having at least one photosensitive layer comprising a plurality of silver halide emulsion layers having substantially the same color sensitivity but different degrees of sensitization on a support. The photosensitive layer is a unit photosensitive layer having color sensitivity to blue color, green color and red color, and in the multi-layer silver halide color photosensitive material, the unit photosensitive layer is arranged generally in the order of a red photosensitive layer, a green photosensitive layer and a blue photosensitive layer from the side of the support. However, this order of arrangement may be reversed, or the order of arrangement where a different photosensitive layer is sandwiched between layers of the same color sensitivity may be used. A non-photosensitive layer may be arranged between the silver halide photosensitive layers or on the uppermost and lowermost layers. These may contain the couplers, DIR compounds, color mixture inhibitors etc. described below. A plurality of silver halide emulsion layers constituting each unit photosensitive layer are constituted such that two layers, i.e. a high-sensitivity emulsion layer and a low-sensitivity emulsion layer, are arranged in this order at the side of the support, as described in DE 1,121,470 or GB 923,045. Alternatively, the low-sensitivity emulsion layer may be arranged apart from the support while the high-sensitivity emulsion layer is near to the support, as described in JP-A No. 57-112751, JP-A No. 62-200350, JP-A No. 62-206541 and JP-A No. 62-206543.

Specifically, these layers can be arranged in the following order from the opposite side of the support: low-sensitivity blue photosensitive layer (BL)/high-sensitivity blue photosensitive layer (BH)/high-sensitivity green photosensitive layer (GH)/low-sensitivity green photosensitive layer (GL)/high-sensitivity red photosensitive layer (RH)/low-sensitivity red photosensitive layer (RL); BH/BL/GL/GH/RH/RL; or BH/BL/GH/GL/RL/RH.

As described in JP-B No. 55-34932, the layers can also be arranged in the order of blue photosensitive layer/GH/RH/GL/RL from the opposite side of the support. Alternatively, as described in JP-A No. 56-25738 and JP-A No. 62-63936, the layers can also be arranged in the order of blue photosensitive layer/GL/RL/GH/RH from the opposite side of the support.

As described in JP-B No. 49-15495, 3 silver halide emulsion layers having different degrees of sensitization may be arranged in the order of a decreasing degree of sensitization toward the support as the upper layer, interlayer and undercoat layer, respectively. Alternatively, such 3 layers having different degrees of sensitization may be arranged in the order of moderate-sensitivity emulsion layer/high-sensitivity emulsion layer/low-sensitivity emulsion layer in the same color-photosensitive layer from the opposite side of the support as described in JP-A No. 59-202464.

Alternatively, these layers may be arranged in the order of high-sensitivity emulsion layer/low-sensitivity emulsion layer/moderate-sensitivity emulsion layer, or low-sensitivity emulsion layer/moderate-sensitivity emulsion layer/high-sensitivity emulsion layer. Four or more layers may also be arranged in any of the different orders shown above.

To improve color reproducibility, a donor layer (CL) having a lamination effect with a distribution of spectral sensitivity different for major photosensitive layers such as BL, GL and RL are preferably arranged adjacent or near to the major photosensitive layers as described in U.S. Pat. Nos. 4,663,271, 4,705,744, 4,707,436, JP-A No. 62-160448 and JP-A No. 63-89850.

The preferable silver halide used in the present invention is silver iodobromide, silver iodochloride or silver iodochlorobromide containing about 30 mol-% or less silver iodide. It is particularly preferably silver iodobromide or silver iodochlorobromide containing about 2 to 10 mol-% or less silver iodide is particularly preferable.

The silver halide grains in the photographic emulsion may be regular crystals in a cubic, octahedral, or tetradecahedral form, crystals in a irregular spherical or plate form, those having crystalline defects such as twin plane or in composite forms thereof.

The silver halide grains may be as fine as about 0.2 $\mu$m or less, or as coarse as about 10 $\mu$m or less in diameter in the projected area, and they may be in a polydisperse or monodisperse emulsion.

The photographic silver halide emulsion which can be used in the present invention can be produced using any methods described in e.g. Research Disclosure (abbreviated hereinafter to RD) No. 17643 (December 1978), pp. 22–23, Emulsion preparation and types; RD No. 18716 (November 1979), p. 648; RD No. 307105 (November 1989), pp. 863–865; P. Glafkides, Chimie et Phisique Photographiques, Paul Montel, 1967; G. F. Duffin, Photographic Emulsion Chemistry, Focal Press, 1966; and V. L. Zelikman, et al., Making and Coating Photographic Emulsion, Focal Press, 1964.

The monodisperse emulsions disclosed in U.S. Pat. Nos. 3,574,628, 3,655,394 and GB 1,413,748 are also preferable.

Further, plate like grains having an aspect ratio of 3 or more can also be used in the present invention. The plate like grains can be prepared easily by methods described by Cutoff in Photographic Science and Engineering, vol. 14, pp. 248–257 (1970); U.S. Pat. Nos. 4,434,226, 4,414,310, 4,433,048, 4,439,520 and GB 2,112,157.

The crystals may be in a uniform structure or different in halogen composition between the inside and outside, or layer-structured. A silver halide different in halogen composition may be joined by epitaxial joining, or joined to compounds such as rhodan silver and lead oxide other than silver halides. Further, a mixture of grains of various crystalline shapes may be used.

The emulsion described above may be a surface latent image type for forming a latent image mainly on the surface and/or an internal latent image type for forming a latent image in the grains, but should be a negative-working emulsion. The emulsion of internal latent image type may be the core/shell-type internal latent image type emulsion described in JP-A No. 63-264740, and a process for producing the same is described in JP-A No. 59-133542. The thickness of this emulsion is varied depending on the development process etc., but is preferably 4 to 40 nm, more preferably 5 to 20 nm.

As the silver halide emulsion, an emulsion subjected to physical aging, chemical aging and spectral sensitization is generally used. Additives used in these steps are described in RD No. 17643, RD No. 18716 and RD No. 307105, and their relevant parts are summarized in the table below.

In the color photosensitive material used in the present invention, two or more photosensitive silver halide emulsions which are different in at least one of features such as grain size, grain size distribution, halogen composition, grain shape and sensitivity can be mixed and used in the same layer.

The silver halide grains overdeveloped thereon as described in U.S. Pat. No. 4,082,553, or the silver halide grains or colloidal silver overdeveloped therein as described in U.S. Pat. No. 4,626,498 and JP-A No. 59-214852 are applied preferably to the photosensitive silver halide emulsion layer and/or the substantially non-photosensitive hydrophilic colloidal layer. The silver halide grains overdeveloped thereon or therein are those grains capable of uniform (non-image-like) development regardless of a light-exposed part or a non-exposed part of the photosensitive material, and a process for producing the same is described in U.S. Pat. No. 4,626,498and JP-A No. 59-214852. The silver halide for forming cores in the core/shell silver halide grains overdeveloped therein may be different in halogen composition. The silver halide overdeveloped therein or thereon may use silver chloride, silver chlorobromide, silver iodobromide, or silver chloroiodobromide. The average grain size of these overdeveloped silver halide grains is preferably 0.01 to 0.75 $\mu$m, more particularly 0.05 to 0.6 $\mu$m. Further, the grains may have a regular shape in a polydisperse emulsion but preferably in a monodisperse emulsion (at least 95% (by weight or number) of the silver halide grains have grain diameters within ±40% of the average grain diameter).

In the color photosensitive material, fine grains of non-photosensitive silver halide are preferably used. The fine grains of non-photosensitive silver halide are those not sensitized upon image-like light exposure for obtaining a coloring material image and not substantially developed in the development process, and they are preferably not previously overdeveloped. The content of silver bromide in the fine grains of silver halide is 0 to 100 mol-%, and silver chloride and/or silver iodine may be contained as necessary. Preferably, silver iodine is contained in an amount of 0.5 to 10 mol-%. The fine grains of silver halide have an average grain diameter (average diameter, in the projected area, of their corresponding spherical grains) of preferably 0.01 to 0.5 $\mu$m, more preferably 0.02 to 0.2 $\mu$m.

The fine grains of silver halide can be prepared in the same manner as for conventional photosensitive silver halide. The optical sensitization or spectral sensitization of the surfaces of the silver halide grains is not necessary. However, before these are added to a coating solution, known stabilizers such as triazole-type, azaindene-type, benzothiazolium-type or mercapto-type compounds or zinc compounds have preferably been added. Colloidal silver can be contained in a layer containing the fine grains of silver halide.

The amount of silver coated on the color photosensitive material used in the present invention is preferably 6.0 g/m$^2$ or less, most preferably 4.5 g/m$^2$ or less.

The photographic additives which can be used in the color photosensitive material are also described in RD, and their relevant parts are shown in the following table.

| Type of additive | RD17643 | RD18716 | RD307105 |
|---|---|---|---|
| 1. Chemical sensitizer | p. 23 | p. 648, right col. | p. 866 |
| 2. Sensitivity improver | | p. 648, right col. | |
| 3. Spectral sensitizer, Color-enhancing sensitizer | pp. 23 to 24 | p. 648, right col. to p. 649, right col. | pp. 866–868 |
| 4. Brightening agent | p. 24 | p. 647, right col. | p. 868 |
| 5. Light absorber filter dye, UV absorber | pp. 25–26 | pp. 649, right col. to page 650, left col. | p. 873 |
| 6. Binder | p. 26 | p. 651, left col. | pp. 873 to 874 |
| 7. Plasticizer, lubricant | p. 27 | p. 650, right col. | p. 876 |
| 8. Coating aids, surfactant | pp. 26 to 27 | p. 650, right col. | pp. 875 to 876 |
| 9. Antistatic agent | p. 27 | p. 650, right col. | pp. 876 to 877 |
| 10. Matting agent | | | pp. 878 to 879 |

The color photosensitive material can make use of various coloring material-forming couplers, but the following couplers are particularly preferable.

Yellow couplers: Couplers represented by formulae (I) and (II) in EP 502,424A; couplers (particularly Y-28 on page 18) represented by formulae (1) and (2) in EP 513,496A; couplers represented by formula (I) in claim 1 in EP 568,037A; couplers represented by the general formula (I) on pp. 45 to 55 in column 1 in U.S. Pat. No. 5,066,576; couplers represented by the general formula (I) in column 0008 in JP-A No. 4-274425; couplers (particularly D-35 on page 18) described in claim 1 on page 40 in EP 498,381A1; couplers (particularly Y-1 (page 17), Y-54 (page 41)) represented by formula (Y) on page 4 in EP 447,969A1; and couplers (particularly II-17, 19 (column 17), II-24 (column 19)) represented by formulae (II) to (IV) in lines 36 to 58 in column 7 in U.S. Pat. No. 4,476,219.

Magenta couplers: JP-A No. 3-39737, L-57 (lower right column on page 11), L-68 (lower right column on page 12), L-77 (lower right column on page 13); EP 456,257, A-4, -63 (page 134), A-4, -73, -75 (page 139); EP 486,965, M-4, -6 (page 26), M-7 (page 27); EP 571,959A, M-45 (page 19); JP-A No. 5-204106, M-1 (page 6); and JP-A No. 4-362631, M-22 in column 0237.

Cyan couplers: JP-A No. 4-204843, CX-1, 3, 4, 5, 11, 12, 14, 15 (pages 14 to 16); JP-A No. 4-43345, C-7, 10 (page 35), 34, 35 (page 37), (I-1), (I-27) (pages 42 to 43); and couplers represented by the general formula (Ia) or (Ib) in claim 1 in JP-A No. 6-67385.

Polymer couplers: P-1, P-5 (page 11) in JP-A No. 2-44345.

Couplers with a coloring material having a suitable diffusing ability are preferably those described in U.S. Pat. No. 4,366,237, GB 2,125,570, EP 96,873B and DE 3,234,533.

Couplers for correcting the unnecessary absorption of coloring material are preferably yellow colored cyan couplers (particularly YC-86 on page 84) represented by formulae (CI), (CII), (CIII) and (CIV) on page 5 in EP 456,257A1, yellow colored magenta couplers ExM-7 (page 202), EX-1 (page 249) and EX-7 (page 251) described in the EP supra, magenta colored cyan couplers CC-9 (column 8), CC-13 (column 19) in U.S. Pat. No. 4,833,069, and colorless masking couplers in (2) (column 8) in U.S. Pat. No. 4,837,136 or represented by formula (A) in claim 1 (particularly, exemplified compounds on pages 36 to 45) in WO 92/11575.

Couplers releasing photographically useful groups include the following compounds. Development inhibitor-releasing compounds: the compounds (particularly T-101 (page 30), T-104 (page 31), T-113 (page 36), T-131 (page 45), T-144 (page 51), T-158 (page 58)) represented by formulae (I), (II), (III) and (IV) on page 11 in EP 378,236A1, the compounds (particularly D-49 (page 51)) represented by formula (I) on page 7 in EP 436, 938A2, the compounds (particularly (23) (page 11)) represented by formula (1) in EP 568,037A, and the compounds (particularly I-(1) on page 29) represented by formulae (I), (II) and (III) on pages 5 to 6 in EP 440,195A2: Bleaching promoter-releasing compounds, the compounds (particularly (60) and (61) on page 61) represented by formulae (I) and (I') on page 5 in EP 310,125A2 and the compounds (particularly (7) (page 7)) represented by formula (I) in claim 1 in JP-A No. 6-59411: Ligand-releasing compounds, the compounds (particularly compounds in lines 21 to 41 in column 12) represented by LIG-X in claim 1 in U.S. Pat. No. 4,555,478: Leuco coloring material-releasing compounds, Compounds 1 to 6 in columns 3 to 8 in U.S. Pat. No. 4,749,641: Fluorescent coloring material-releasing compounds, the compounds (particularly Compounds 1 to 11 in columns 7 to 10) represented by COUP-DYE in claim 1 in U.S. Pat. No. 4,774,181: Development promoters or fogging agent-releasing compounds, the compounds (particularly (I-22) in column 25) represented by formulae (1), (2) and (3) in column 3 in U.S. Pat. No. 4,656,123 and ExZK-2in lines 36to 38 on page 75 in EP 450,637A2: Compounds which upon elimination, release a group for forming coloring material, the compounds (particularly Y-1 to Y-19 in columns 25 to 36) represented by formula (I) in claim 1 in U.S. Pat. No. 4,857,447.

As additives other than the couplers, the following compounds are preferable:

Dispersion media of oil-soluble organic compounds, P-3, 5, 16, 19, 25, 30, 42, 49, 54, 55, 66, 81, 85, 86 and 93 (pages 140 to 144) in JP-A No. 62-215272: Lattices for immersing oil-soluble organic compounds, lattices described in U.S. Pat. No. 4,199,363: Scavengers of oxidized developing agents, the compounds (particularly I-, (1), (2), (6), (12) (columns 4 to 5)) represented by formula (I) in lines 54 to 62 in column 2 in U.S. Pat. No. 4,978,606 and the compounds (particularly compound 1 (column 3)) of the formulae in lines 5 to 10 in column 2 in U.S. Pat. No. 4,923,787: Stain-preventing agents, the compounds of formulae (I) to (III) in lines 30 to 33 on page 4, particularly I-47, 72, III-1, 27 (pages 24 to 48) in EP298321A: Anti-fading agents, A-6, 7, 20, 21, 23, 24, 25, 26, 30, 37, 40, 42, 48, 63, 90, 92, 94, 164 (pages 69 to 118) in EP 298321A, II-1 to III-23, particularly III-10, in columns 25 to 38 in U.S. Pat. No. 5,122,444, I-1 to III-4, particularly II-2, on pages 8 to 12 in EP 471347A, A-1 to A-48, particularly A-39, 42, in columns 32 to 40 in U.S. Pat. No. 5,139,931: Materials for reducing the amount of a color-enhancing agent or a mixed color inhibitor, I-1 to II-15, particularly I-46 in EP 411324A: Hormaline scavengers, SCV1 to 28, particularly SCV-8 on pages 24 to 29 in EP 477932A: Hardeners, H-1, 4, 6, 8, 14 on page 17 in JP-A No. 1-214845, the compounds (H-1 to H-54) represented by formulae (VII) to (XII) in columns 13 to 23 in U.S. Pat. No. 4,618,573, the compounds (H-1 to H-76), particularly H-14, represented by formula (6) in lower right column on page 8 in JP-A No. 2-214852, and the compounds described 1 in claim in U.S. Pat. No. 3,325,287: Precursors of development inhibitors, P-24, 37, 39 (pages 6 to 7) in JP-A No. 62-168139, the compounds described in claim 1, particularly Compounds 28 and 29 in column 7 in U.S. Pat. No. 5,019,492: Preservatives and antifungus agents, I-1 to III-43, particularly II-1, 9, 10, 18, III-25 in columns 3 to 15 in U.S. Pat. No. 4,923,790: Stabilizers and anti-fogging agents or restrainers, I-1 to (14), particularly I-1, 60, (2), (13), in columns 6 to 16 in U.S. Pat. No. 4,923,793, Compounds 1 to 65, particularly 36, in columns 25 to 32 in U.S. Pat. No. 4,952,483: Chemical sensitizers, triphenyl phosphine selenide, and Compound 50 in JP-A No. 5-40324: Dyes, a-1 to b-20, particularly a-1, 12, 18, 27, 35, 36, and b-5 on pages 15 to 18 and V-1 to 23, particularly V-1, on pages 27 to 29 in JP-A No. 3-156450, F-I-1 to F-II-43, particularly F-I-11 and F-II-8 on pages 33 to 55 in EP 445627A, III-1 to 36, particularly III-1, 3 on pages 17 to 28 in EP 457153A, a fine crystal dispersion of Dye-1 to Dye-124 on pages 8 to 26 in WO 88/04794, Compounds 1 to 22, particularly Compound 1, on pages 6 to 11 in EP 319999A, Compounds D-1 to D-87 (pages 3 to 28) represented by formulae (1) to (3) in EP 519306A, Compounds 1 to 22 (columns 3 to 10) represented by formula (I) in U.S. Pat. No. 4,268,622, Compounds (1) to (31) (columns 2 to 9) represented by formula (I) in U.S. Pat. No. 4,923,788: UV absorbers, Compounds (18b) to (18r), 101 to 427 (pages 6 to 9) represented by formula (1) in JP-A No. 46-3335, Compounds (3) to (66) (pages 10 to 44) represented by formula (I) and Compounds HBT-1 to 10 (page 14) represented by formula (III) in EP 520938A, and Compounds (1) to (31) (columns 2 to 9) represented by formula (1) in EP 521823A.

The present invention can be applied to various color photosensitive materials such as general or movie color negatives, color reversal films for slides or TV, and color positives, but the application to general color negative films is particularly suitable for the object of the present invention. Further, the application to a film unit equipped with a lens as described in JP-B No. 2-32615 and Japanese Utility Model Publication No. 3-39784 is also suitable.

Suitable supports which can be used in the present invention are described on page 28 in RD No. 17643 supra, or in right column on page 647 to left column on page 648 in RD No. 18716, or on page 879 in RD No. 307105.

In the photosensitive material of the present invention, the thickness of all hydrophilic colloidal layers at the side of the emulsion layer is preferably 28 $\mu$m or less, particularly preferably 23 μm or less, more preferably 18 μm or less, most preferably 16 μm or less. The film swelling rate $T_{1/2}$ is preferably 30 seconds or less, more preferably 20 seconds or less. $T_{1/2}$ is defined as the time elapsed for film thickness to reach ½ of the saturated film thickness, wherein the saturated film thickness refers to 90% of the maximum thickness of the film after treatment in a coloring developing solution at 30° C. for 3 minutes and 15 seconds. The film thickness is the thickness of a film measured at 25° C. under a relative humidity of 55% (2 days), and $T_{1/2}$ can be measured by use of a swelling meter described by A. Green et al. in Phtogr. Sci. Eng., vol. 19, 2, pp. 124–129. $T_{1/2}$ can be regulated by adding a hardener to gelatin as a binder or by changing conditions with time after coating. The degree of swelling is preferably 150 to 400%. The degree of swelling can be calculated from the maximum thickness of the swollen film under the conditions described above by use of the formula: (maximum thickness of the swollen film−thickness of the film)/thickness of the film.

The color photosensitive material used in the present invention is provided preferably with a hydrophilic colloidal layer (referred to as back layer) at the other side of the emulsion layer such that the total thickness of the film after drying is 2 to 20 μm. This back layer preferably contains the above-described light absorbers, filter dyes, UV absorbers, antistatic agents, hardeners, binders, plasticizers, swelling agents, coating aids and surfactants. The degree of swelling of this back layer is preferably 150 to 500%.

A magnetic recording layer is often contained in the color photosensitive material used in the present invention.

The magnetic recording layer is formed by coating a support with an aqueous dispersion or an organic-solvent dispersion containing magnetic grains dispersed in binders.

Ferromagnetic iron oxides such as $\gamma Fe_2O_3$, Co-coated $\gamma Fe_2O_3$, Co-coated magnetite, Co-containing magnetite, ferromagnetic chromium dioxide, ferromagnetic metals, ferromagnetic alloys, hexagonal Ba ferrite, Sr ferrite, Pb ferrite and Ca ferrite may be used for the magnetic particles. Co-coated ferromagnetic iron oxides such as Co-coated $\gamma Fe_2O_3$ are preferable. The shape may be needle, granular, spherical, cubic, plate etc.

The magnetic recording layer and other backing layers may have functions such as improvement of lubricating properties, regulation of curling, prevention of charging, prevention of adhesion and grinding of ahead. For this purpose, non-spherical inorganic grains are preferably added, and suitable grains are composed of oxides such as aluminum oxide, chromium oxide, silicon dioxide, titanium dioxide, silicon carbide etc., carbides such as silicon carbide, titanium carbide etc., and fine grains of diamond etc. These abrasives may be treated thereon with a silane coupling agent or a titanium coupling agent. These grains may be added to the magnetic recording layer or provided as an overcoat (e.g. a protective layer, a lubricant layer etc.) on the magnetic recording layer. The binder used therein may be the one described above, preferably the same binder as in the magnetic recording layer. The photosensitive material having a magnetic recording layer is described in U.S. Pat. Nos. 5,336,589, 5,250,404, 5,229,259, 5,215,874 and EP 466, 130.

Hereinafter, cellulose acetate and polyester supports for the color photosensitive material are described. The photosensitive material, treatment, cartridges and examples described below are detailed in Published Technical Report, Technical Report No. 94-6023, Hatsumei Kyokai (Japan Institute of Invention and Innovation) Mar. 15, 1994.

The polyester is made from diol and aromatic dicarboxylic acid as essential components, and the aromatic dicarboxylic acid includes 2,6-, 1,5-, 1,4- and 2,7-naphthalenedicarboxylic acid, terephthalic acid, isophthalic acid and phthalic acid, and the diol includes diethylene glycol, triethylene glycol, cyclohexane dimethanol, bisphenol A and bisphenol. Their polymerized polymer includes homopolymers such as polyethylene terephthalate, polyethylene naphthalate, polycyclohexane dimethanol terephthalate etc. Particularly preferably is a polyester containing 50 to 100 mol-% 2,6-naphthalene dicarboxylic acid. In particular, polyethylene 2,6-naphthalate is preferable. The average molecular weight is in the range of about 5,000 to 200,000. The Tg of the polyester of the present invention is 50° C. or more, more preferably 90° C. or more.

The polyester support is subjected to heat treatment at a temperature of 40° C. or more to less than Tg, more preferably at a temperature of Tg minus 20° C. or more to less than Tg, in order to prevent curling. Heat treatment may be conducted at a predetermined temperature within this range, and heat treatment may be conducted under cooling. The time for this heating treatment is 0.1 to 1500 hours, more preferably 0.5 to 200 hours. The support may be heat-treated in the form of a roll or a running web. The surface of the support may be made uneven (e.g. by coating electrically conductive inorganic fine grains such as tin oxide and antimony oxide) to improve surface conditions. Preferably, its edge is slightly protruded by knurling to prevent reflection at a cutting of a wound core. The heat treatment may be conducted at any stage after manufacturing of the support, after surface treatment, after coating of a back layer (an antistatic agent, a lubricant etc.), or after coating of the undercoat layer. The heat treatment is conducted preferably after coating of an antistatic agent.

An UV absorber may be kneaded in this polyester. To prevent light piping, commercial dyes or coloring materials for polyesters, such as Diaresin (Mitsubishi Chemical Industries Ltd) and Kayaset (Nippon Kayaku Co., Ltd.) can be kneaded therein to achieve the object.

To bond the support to the layer constituting the photosensitive material, surface treatment is preferably conducted directly or after coating of an undercoat layer. The surface treatment includes surface-activating treatment such as chemical treatment, mechanical treatment, corona discharge treatment, flame treatment, UV ray treatment, high-frequency treatment, glow discharge treatment, active plasma treatment, laser treatment, mixed-acid treatment, ozone oxidizing treatment etc. The surface treatment is particularly preferably UV ray irradiation treatment, flame treatment, corona treatment or glow treatment.

The undercoat layer coated may be a single layer or two or more layers. The binder for the undercoat layer includes not only copolymers produced from starting monomers selected from vinyl chloride, vinylidene chloride, butadiene, methacrylic acid, acrylic acid, itaconic acid and maleic anhydride, but also polyethylene imine, epoxy resin, grafted gelatin, nitrocellulose and gelatin. As compounds for swelling the support, there are resorcin and p-chlorophenol. The undercoat layer includes gelatin hardeners such as chromium salts (chromium alum etc.), aldehydes (formaldehyde, glutaraldehyde etc.), isocyanates, active halogen compounds (2,4-dichloro-6-hydroxy-S-triazine etc.), epichlorohydrin resin, and active vinyl sulfone compounds. Inorganic fine grains such as silicon dioxide, titanium dioxide and alumina, and fine grains of polymethylmethacrylate copolymers (0.01 to 10 μm) may be contained as a matting agent.

In the present invention, antistatic agents are preferably used. The antistatic agents include polymers containing carboxylic acids, carboxylates and sulfonates, cationic polymers and ionic surfactant compounds.

The antistatic agent is most preferably at least one crystalline metal oxide having a grain size of 0.001 to 1.0 μm with a volume resistivity of $10^7$ Ω·cm or less, more preferably $10^5$ Ω·cm or less, selected from zinc oxide, silicon dioxide, titanium dioxide, alumina, indium oxide, magnesium oxide, barium oxide, manganese oxide and vanadium oxide, as well as fine grains of complex oxides thereof (Sb, P, B, In, S, Si, C etc.) and fine grains of metal oxides in a sol form or composite oxides thereof. The content thereof in the photosensitive material is preferably 5 to 500 mg/$m^2$, more preferably 10 to 350 mg/$m^2$. The electrically conductive crystalline oxides or composite oxides thereof and the binder are used in a ratio of from 1/300 to 100/1, more preferably from 1/100 to 100/5.

The color photosensitive material preferably has slip characteristics. A layer containing a slip agent (lubricant) is preferably used in both the photosensitive layer and the back layer. Preferable slip characteristics are 0.01 to 0.25 in terms of coefficient of dynamic friction. This value is determined by transporting a specimen against a stainless steel sphere of 5 mm in diameter at a rate of 60 cm/min. (25° C., 60% RH). In this evaluation, almost the same value is obtained even if the counterpart material is replaced by the photosensitive layer.

Usable lubricants include polyorganosiloxane, higher fatty acid amides, higher fatty acid metal salts, esters of higher fatty acids and higher alcohols, and the usable polyorganosiloxane includes polydimethyl siloxane, polydiethyl siloxane, polystyryl methyl siloxane, polymethyl phenyl siloxane etc. The layers to which these materials are added are preferably the outermost layer of the emulsion layer and the back layer. In particular, polydimethyl siloxane and esters having long alkyl group are preferable.

The matting agent is preferably contained in the color photosensitive material. Although the layer to which the matting agent is added may be a layer either on the emulsion layer or on the back layer, the matting agent is added particularly preferably to the outermost layer at the emulsion side. The matting agent may be soluble or insoluble in the processing solution, and preferably the soluble and insoluble matting agents are used in combination. For example, polymethyl methacrylate, poly(methyl methacrylate/methacrylic acid=9/1 or 5/5 (molar ratio)), polystyrene grains etc. are preferable. The grain diameter is preferably 0.8 to 10 μm, the distribution of its grain diameters is preferably smaller, and the diameters of 90% of all grains are 0.9- and 1.1-times the average grain diameter. Further, fine grains of 0.8 μm or less are added simultaneously in order to improve matting properties, and examples thereof include polymethyl methacrylate (0.2 μm), poly(methyl methacrylate/methacrylic acid=9/1 (molar ratio), 0.3 μm), polystyrene grains (0.25 μm) and colloidal silica (0.03 μm).

Hereinafter, the film cartridge for the color photosensitive material used in the present invention is described. The major material of the cartridge used in this invention may be a metal or synthetic plastics.

Preferable plastic materials are polystyrene, polyethylene, polypropylene, polyphenyl ether etc. Further, the cartridge in the present invention can contain various kinds of antistatic agents, and carbon black, metal oxide grains, nonionic, anionic, cationic and betaine surfactants or polymers can be preferably used. These cartridges rendered antistatic are described in JP-A No. 1-312537 and JP-A No. 1-312538. Particularly, their resistance at 25° C. under 25% RH is preferably $10^{12}$Ω or less. The plastic cartridges are produced usually from plastics containing carbon black and pigments kneaded therein to confer light shielding properties. The cartridge may have the size of 135 at present, or for miniaturization of a camera, it is effective to reduce the 25 mm diameter of the 135 size cartridge to 22 mm or less. The case of the cartridge preferably has a volume of 30 $cm^3$ or less, more preferably 25 $cm^3$ or less. The weight of plastics used in the cartridge and cartridge case is preferably 5 to 15 g.

Further, the cartridge may be a cartridge for delivering a film by rotating a spool. The top of a film may be accommodated in the main body of the cartridge, and the spool spindle is rotated in the direction of film delivery, whereby the top of the film can be delivered to the outside through the port of the cartridge. These are disclosed in U.S. Pat. Nos. 4,834,306 and 5,226,613. The photographic film used in the present invention may be the so-called raw film before development or a photographic film after development process. Further, a raw film and a photographic film after development process may be accommodated in the same new cartridge or in different cartridges.

The development process of the color photosensitive material is as described above, and the development process can be conducted in a usual manner as described on pages 28 to 29 in RD No. 17643 supra, in left column to right column on page 651 in RD No. 18716, and on pages 880 to 881 in RD No. 307105.

In the present invention, de-silver treatment is unnecessary, but when a developed film is to be stored, the developed color negative can be obtained by removing silver in a usual manner and washing with water or stabilization treatment after reading of a second image.

De-silver treatment is conducted using a bleaching solution and a fixing solution, or a bleaching fixing solution. The compounds and treatment conditions described in JP-A No. 4-125558, page 4, lower left column, line 16 to page 7, lower left column, line 6 can be applied to the processing solution having a bleaching ability (the bleaching solution or the bleaching fixing solution). The bleaching agent preferably has an oxido-reduction potential of 150 mV or more, and specifically the bleaching solutions described in JP-A No. 5-72694 and JP-A No. 5-173312 are preferable, and particularly 1,3-diaminopropane tetraacetate, and the ferric complex salt of a compound in Example 1 on page 7 in JP-A No. 5-173312 are preferable.

For improving the biodegradability of the bleaching agent, the ferric complex salts of compounds described in JP-A No. 4-251845, JP-A No. 4-268552, EP 588,289, EP 591,934, and JP-A No. 6-208213 are preferably used as the bleaching agent. The concentration of these bleaching agents is preferably 0.05 to 0.3 mole per L of a solution having a bleaching ability, more preferably 0.1 to 0.15 mole particularly for the purpose of reducing the discharge to the environment. When the solution having a bleaching ability is a bleaching solution, a bromide is contained preferably in an amount of 0.2 to 1 mole/L, particularly 0.3 to 0.8 mole/L.

Besides, a pH buffering agent is preferably contained in the bleaching solution, and particularly dicarboxylic acids with less smell, such as succinic acid, maleic acid, malonic acid, glutaric acid, adipic acid etc. are preferably contained. Further, the known bleaching promoters described in JP-A No. 53-95630, RD No. 17129 and U.S. Pat. No. 3,893,858 are also preferably used.

The compounds or treatment conditions described in JP-A No. 4-125558, page 7, lower left column, line 10 to page 8, lower right column, line 19 can be applied to the processing solution having a fixing ability.

As described in JP-A No. 1-224762, p-toluene sulfinate or sulfinic acid is also preferably used to improve preservation.

In the solution having a bleaching ability or the solution having a fixing ability, ammonium is preferably used as cation from the viewpoint of improving the ability to remove silver, but for the purpose of reducing environmental pollution, it is preferable that ammonium is added in a smaller amount or not added at all.

From the viewpoint of improving preservation, a free chelating agent not forming a metal complex is preferably added to the bleaching fixing solution or fixing solution, and such a chelating agent is preferably a biodegradable chelating agent described in connection with the bleaching solution.

A description on page 12, lower right column, line 6 to page 13, lower right column, line 16 in JP-A No. 4-125558 supra can be applied preferably to the steps of water washing and stabilization. Particularly from the viewpoint of keeping the working atmosphere, it is preferable that azolyl methylamines described in EP 504,609 and EP 519,190 and N-methylol azoles described in JP-A No. 4-362943 are used in place of formaldehyde in the stabilization solution, or the magenta coupler is dimerized to form a solution of a surfactant not containing an image stabilizer such as formaldehyde.

Further, the stabilization solution described in JP-A No. 6-289559 can be preferably used to reduce the adhesion of dust to the magnetic recording layer applied onto the photosensitive material.

The processing agent used in the present invention is preferably the one described on page 3, right column, line 15 to page 4, left column, line 32 in Published Technical Report, Technical Report No. 94-4992, published by Hatsumei Kyokai. Further, the processor used therefor is preferably a film processor described on page 3, right column, lines 22 to 28 in the Published Technical Report supra.

The processing agent, the automatic processor and the evaporation correcting system preferably used for carrying out the present invention are described in detail on page 5, right column, line 11 to page 7, right column, bottom line in the Published Technical Report supra.

The developing agent used in the present invention and the optionally used processing agents for removal of silver and stabilization may be supplied in the form of liquids having concentrations to be used or concentrated liquids, or may be any forms such as granules, powder, tablets, pastes, milky liquids etc. By way of example, these processing agents include the liquid accommodated in a low-oxygen-permeable vessel in JP-A No. 63-17453, the vacuum-packed powder or granules in JP-A No. 4-19655 and JP-A No. 4-230748, the granules containing a water-soluble polymer in JP-A No. 4-221951, the tablets in JP-A No. 51-61837 and JP-A No. 6-102628, and the treatment paste in JP-A No. 57-500485, and these can be preferably used, but for easy handling, these are preferably used in the form of liquids having the concentrations to be used.

In the vessel for accommodating these processing agents, polyethylene, polypropylene, polyvinyl chloride, polyethylene terephthalate and nylon are used singly or as a composite material. These are selected to meet the required level of oxygen permeability. For easily oxidized solutions such as coloring developing solution, low-oxygen-permeable materials are preferable, and specifically composite materials of polyethylene terephthalate, polyethylene and nylon are preferable. These materials have a thickness of 500 to 1500 $\mu$m and their oxygen permeability for use in vessels is preferably 200 ml/m$^2$·24 hrs.Pascal or less.

The color photosensitive material used in the present invention is suitable as a negative film for an advanced photo system (referred to hereinafter as AP system), and the film is processed in an AP system format such as in NEXIA A, NEXIA F and NEXIA H (ISO 200/100/400) produced by Fuji Photo Film Co., Ltd. (referred to hereinafter as Fuji Film) and accommodated into a special cartridge. These cartridge films for AP system are used after introduced into cameras for AP system such as Epion series (Epion 300Z etc.) produced by Fuji Film. Further, the color photosensitive material of the present invention is also suitable for films equipped with a lens, such as Fuji Color "Utsurundesu, Super Slim".

These systems are preferably Fuji Film Minilabo Champion Super FA-298/FA-278/FA-258/FA-238 and Fuji Film Digital Labosystem Frontier. In the Frontier system, a scanner & an image processor SP-1000 and a laser printer & a paper processor LP-1000P or a laser printer LP-100OW are used. A detacher used in the detaching step and a re-attacher used in the re-attaching step are preferably Fuji Film DT200/DT100 and AT200/AT100, respectively.

The AP system can also be viewed in a photo joy system based on Fuji Film digital image workstation Aladdin 1000. For example, the AP system cartridge film after development is introduced directly into Aladdin 1000, or image information on a negative film, a positive film and a print is input by a 35 mm film scanner FE-550 or a flat head scanner PE-550, and the resulting digital image data can be easily processed and edited. The data can be output as print in an existing laboratory unit by a digital color printer NC-550AL in a light-fixing thermal photosensitive color print system or by pictography 3000 in a laser irradiating heat development transfer system, or via a film recorder. Further, Aladdin 1000 can also output the digital information directly into a floppy disk or a Zip disk, or via a CD writer to CD-R.

In a home, a photograph can be viewed on TV by merely introducing an AP-system cartridge film after development into a photo player Ap-1 produced by Fuji Film, or by introducing it into a photo scanner AS-1 produced by Fuji Film, its image information can be incorporated rapidly and continuously into a personal computer. Further, the photo vision FV-10/FV-5 produced by Fuji Film can be used to input the information on a film, a print or any other materials into a personal computer. Further, the image information recorded on a floppy disk, a Zip disk, CD-R or a hard disk can be processed and viewed on a personal computer by use of the application software Photo Factory produced by Fuji Film. To output high-quality prints, digital color printer NC-2/NC-2D in a light-fixing thermal photosensitive color print system, manufactured by Fuji Film, is preferable.

To accommodate an AP-system cartridge film after development, Fuji Color pocket albums AP-5 Pop L, AP-1 Pop L, AP-1 Pop KG or cartridge file 16 are preferable.

[Fourth, Fifth and Sixth Aspects]

The fourth, fifth and sixth aspects of the present invention are described in more detail in the following order:

1. Scheme of the process of the color image-forming method of the present invention;
2. Interlayer containing an infrared radiation absorbing coloring material;
3. Anti-halation layer containing a decolorizable dye;
4. Development process;
5. Reading of an image; and
6. Color photosensitive material used in the present invention and supplementary description relating thereto.

1. Scheme of the Process of the Color Image-forming Method of the Present Invention The scheme of the process of the color image-forming method of the present invention is essentially the same as "1.

Scheme of the process of the color image-forming method of the present invention" in the third aspect described above, and only different features are described.

In the present invention, the reading by reflected light can be applied to the uppermost and lowermost photosensitive layers. By the infrared absorbing action of the interlayer, background noise upon reading of an image by reflected light is removed, and thus the ability to identify the image by reflected light upon reading of the uppermost photosensitive layer and the lowermost photosensitive layer of the photosensitive material is improved, and this is also convenient for separation and extraction of the image information on the interlayer therebetween by reading with transmitted light, whereby the highly accurate image information can be obtained. The effect of this treatment for reading the first image information under the condition for highly accurate reading by reflected light is significant particularly for improvement of the qualities of an over-irradiated image frequently produced in photographing by an exposure-fixed camera.

Further, in the present invention, infrared radiations can be used for reading the first image information by reflected light. Because the infrared radiation-absorbing coloring material in the interlayer eliminates noise in the inside of the interlayer, and thus the effect of selectively extracting the information in the photosensitive layer at the front side can be preferably demonstrated effectively.

In the present invention, the interlayer containing the infrared radiation-absorbing coloring material is arranged both on the lower side of the blue-photosensitive layer and on the upper side of the red-photosensitive layer, so that the uppermost blue-photosensitive layer and the lowermost red-photosensitive layer of the photosensitive material can be read respectively in a noise-free state to improve reading accuracy.

In the present invention, the spectrum region of infrared radiations for reading the first image information and the absorption wavelength range of infrared radiation-absorbing coloring material in the interlayer may be overlapped so that reading can be conducted under the spectral condition for the significant effect of eliminating background noise upon image reading.

When a color film containing the infrared radiation-absorbing coloring material in the interlayer further contains a decolorizable dye in the anti-halation layer, it is possible to improve not only the sensitivity and accuracy of reading the first image information by reflected light, but also the sensitivity and accuracy of reading the second image information by transmitted light, so the object of this invention can be further demonstrated. The anti-halation layer contains fine black grains of silver halide and is usually black (neutral color) and capable of significantly absorbing light, thus not only exhibiting the action of eliminating a halation light but also responding to an infrared radiation sensor for detecting a film in a developer or for frame-sending regulation of a film in a camera at the time of photographing. However, this colloidal silver should be removed later in the step of removing silver after the development process. When the present invention is applied to a color film containing fine black grains of colloidal silver in the anti-halation layer, the second image information is read in the form of highly overlaid transmission density in the anti-halation layer, thus limiting the reading sensitivity and reading accuracy.

A color film wherein the fine grains of colloidal silver in the anti-halation layer are replaced by a decolorizable dye which is deprived of light absorptivity in the development process is also known in recent years, but the original object of the anti-halation layer containing the decolorizable dye is to relieve the loading of de-silver treatment and to reduce the de-silver time, and when the image reading of the present invention described above is applied to the color film having this anti-halation layer, the sensitivity and accuracy of reading the second image information by transmitted light can be improved, but there arises the problem that the ability to detect the photosensitive material in a developing machine, or the function of regulating the frame-sending of a film piece in a camera, is lowered.

However, when a color film containing the infrared radiation absorbing coloring material in the interlayer and the decolorizable dye in the anti-halation layer is applied to the method of forming a color image in the present invention, the image information is not overlaid on the transmission density of the anti-halation layer upon reading of the second image information by reading the image by transmitted light, and for reading of the first image information by reflected light, the interlayer containing the infrared radiation-absorbing coloring material improves the qualities of the read image as described above, and thus the reading of both the first and second image information can be conducted highly accurately, and the digital image information converted from the read image can have high qualities. In addition, there is none of the above problem that the ability to detect the photosensitive material in a developing machine, or the function of regulating the frame-sending of a film piece in a camera, is lowered.

In the present invention, black and white development may be used. In the case of black and white image composed of silver, the ability to identify the image is improved by the reflective silver image on the front layer and by eliminating background noise caused by light absorption, thus improving the accuracy. When black and white development is used, advantages such as reduction in development time, prevention of staining of the developing solution and easy management of the developing solution can be achieved, and thus the improvement of image qualities, simplification of the image-forming operation, and the rapid operation can be simultaneously achieved.

Further, when a light in a longer wavelength region than the light absorption region of the infrared radiation absorbing coloring material in the interlayer is used as light for reading of the second image information in a mode of using infrared radiations for reading of the second image information, the absorption of the infrared radiation absorbing coloring material can be eliminated thereby improving the reading accuracy and increasing the reading rate. To demonstrate this effect, the absorption maximum of the infrared radiation absorbing coloring material in the interlayer is preferably apart by 20 to 400 nm from the maximum wavelength of the light for reading. When 2 or more infrared radiation absorbing coloring materials are used in combination, each coloring material preferably satisfies the relationship described above. When both the maximum wavelengths are apart by less than 20 nm, reading accuracy is lowered because of overlapping of the absorption regions, while when they are apart by 400 nm or more, reading accuracy is also lowered because of a reduction in the sensitivity of the reading device.

To permit the color photosensitive material to demonstrate the effect described above, the infrared radiation absorbing coloring material added to the interlayer has an absorbance of 0.05 or more, preferably 0.2 or more, or 4.0 or less, preferably 2.0 or less in the light absorption range. Further, from the viewpoint of securing resolution, the thickness of the interlayer should be smaller for better performance, so the requirement of the interlayer for satisfying both the requirements is a silver halide color photosensitive material having an interlayer containing at least 0.05 mmole/$m^2$ infrared radiation absorbing coloring material having a molecular absorption factor of at least $1\times10^3$ $cm^2$/mole, and the infrared radiation absorbing coloring material has a molecular absorption factor of $2\times10^4$ to $5\times10^7$ $cm^2$/mole, and the amount thereof coated onto the interlayer is 0.2 to 5.0 mmole/$m^2$. The amount of the coated coloring material necessary for giving the same density can be reduced when the coloring material has a higher molecular absorption factor.

If the absorbance of the infrared radiation absorbing coloring material exceeds the above-described range, the sensitivity is lowered, and if its amount is lower than this range, the effect of the invention cannot be achieved.

2. Interlayer Containing an Infrared Radiation Absorbing Coloring Material

Now, the infrared radiation-absorbing coloring material which is contained in the interlayer of the silver halide color photosensitive material used in the present invention thereby bringing about the significant effect on the object of the present invention is described.

This infrared radiation absorbing coloring material is characterized in that it is dispersed in the form of fine solid grains in a silver halide emulsion layer or in a hydrophilic colloidal layer, in such a state that it is substantially not removed by a processing solution of the silver halide photosensitive material. The infrared radiation absorbing coloring material has the maximum absorption wavelength in the infrared region of 700 to 1200 nm. The maximum absorption wavelength is preferably 800 to 1100 nm. The maximum absorption wavelength is determined not by measuring the coloring material in a solution form, but by measuring the coloring material-containing silver halide photosensitive material by means of a spectrophotometer.

The infrared radiation absorbing coloring material in the silver halide photosensitive material is in the form of fine solid grains which are substantially not removed by a processing solution of the silver halide photosensitive material. In the silver halide photosensitive material of the present invention, the phrase "substantially not removed" means that after the photosensitive material is immersed for 45 seconds at 35° C. in BR (Briton-Robinson) buffer, pH 10.0, the remaining degree of the absorbance in the absorption maximum wavelength is 80% or more. Further, in the method of forming a color image in the present invention, the phrase "substantially not removed" means that after the image-forming treatment, the remaining degree of the absorbance in the absorption maximum wavelength is 80% or more. The remaining degree is preferably 90% or more, more preferably 95% or more, most preferably 97% or more. To raise the remaining degree, an insoluble compound substantially insoluble in the processing solution, particularly in the developing solution, may be selected as the infrared radiation absorbing coloring material described below. Whether the infrared radiation absorbing coloring material is insoluble or not may be examined easily using the BR buffer described above. In the present invention, the coloring material or pigment having the above definition can be used as the infrared radiation absorbing coloring material. Generally, the coloring material classified into coloring material is preferably used. Even a water-soluble infrared radiation-absorbing coloring material easily eluted into the processing solution can be used in the present invention if it is subjected to process (e.g. a laking process) for preventing elution into the processing solution.

The average grain diameter of the solid fine grains is preferably 0.005 to 10 μm, further preferably 0.01 to 5 μm, more preferably 0.01 to 2.0 μm, most preferably 0.02 to 0.7 μm. The content of the coloring material in the solid fine grains is 80% by weight or more, more preferably 90% by weight or more, most preferably 100% by weight. The solid fine grains of the coloring material are used in an application amount preferably in the range of 0.001 to 1 g/$m^2$, more preferably 0.005 to 0.5 g/$m^2$.

As the infrared radiation-absorbing coloring material which can be used in the present invention, any coloring material (or dye) can be used insofar as when the coloring material is used in the interlayer in the color photosensitive material, it has absorption in the infrared wavelength range described above, the ratio of removal during treatment satisfies the criteria described above, it can be added as a solid dispersion to the photosensitive material in the method described above, and the photographic qualities of the photosensitive material are not adversely affected. For example, cyanine dyes, particularly dihydroperimidine squalilium dyes such as heptamethine cyanine dye and indotricarbocyanine dye can be used. Specific examples thereof include the coloring materials described in JP-A No. 9-5913, JP-A No. 9-96891, JP-A No. 10-204310, JP-A No. 10-231435, and JP-A No. 8-95197. As typical coloring materials preferably applied to the present invention, the coloring materials described in JP-A No. 9-96891 can be mentioned.

The infrared radiation-absorbing coloring material preferably used in the present invention is a cyanine dye represented by the following general formula (VII).

The general formula (VII)

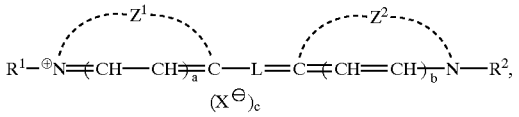

In the general formula (VII), $Z^1$ and $Z^2$ may be condensed to form a ring and represent a non-metallic atomic group forming a 5- or 6-member nitrogenous heterocyclic ring. Examples of the nitrogenous heterocyclic ring and condensed ring include oxazole ring, isooxazole ring, benzoxazole ring, naphthoxazole ring, thiazole ring, benzothiazole ring, naphthothiazole ring, indolenine ring, benzoindolenine ring, imidazole ring, benzoimidazole ring, naphthoimidazole ring, quinoline ring, pyridine ring, pyrropyridine ring, flopyrrole ring, indolysine ring, imidazoquinoxaline ring and quinoxaline ring. The nitrogenous heterocyclic ring is more preferably a 5-member ring than a 6-member ring. A benzene ring or naphthalene ring condensed with a 5-member nitrogenous heterocyclic ring is more preferable. The indolenine ring and benzoindolenine ring are the most preferable.

The nitrogenous heterocyclic ring and rings condensed therewith may have substituent groups. Examples of such substituent groups include alkyl group having 10 or less carbon atoms, more preferably 6 or less carbon atoms (e.g., methyl, ethyl, propyl, butyl, isobutyl, pentyl, hexyl), alkoxy group having 10 or less carbon atoms, more preferably 6 or less carbon atoms (e.g., methoxy, ethoxy), aryloxy group having 20 or less carbon atoms, preferably 12 or less carbon atoms (e.g., phenoxy, p-chlorophenoxy), halogen atom (Cl, Br, F), alkoxycarboxyl group having 10 or less carbon atoms, preferably 6 or less carbon atoms (e.g., ethoxycarbonyl), and cyano, nitro and carboxyl. The carboxyl may form a salt with a cation. The carboxyl may form an intramolecular salt with N'. Preferable substituent groups are chlorine atom (Cl), methoxy, methyl and carboxyl. If the nitrogenous heterocyclic ring is substituted with carboxyl, the transfer of the maximum absorption wavelength to the longer wavelength side is significant upon dispersion thereof in solid fine grains. However, the carboxyl-substituted compounds are hydrophilic and easily eluted into a processing solution. To prevent removal of the carboxyl-substituted compound by a processing solution, the treatment for lake formation as described below is effective. Further, introduction of a $C_3$ or more alkyl group or a phenyl group into $R^1$, $R^2$ or L in the general formula (VII) is effective for prevention of elution into a processing solution. On the other hand, carboxyl-free compounds promote the transfer of the maximum absorption wavelength to the longer wavelength side, so it is preferable to prolong the dispersion time for preparation of the solid fine grains.

In the general formula (VII), $R^1$ and $R^2$ each represent an alkyl group, alkenyl group and aralkyl group. The alkyl group is preferable, and an unsubstituted alkyl group is more preferable. The number of carbon atoms in the alkyl group is preferably 1 to 10, more preferably 1 to 6. Examples of the alkyl group include methyl, ethyl, propyl, butyl, isobutyl, pentyl and hexyl. The alkyl group may have substituent groups. Examples of the substituent groups include halogen atoms (Cl, Br, F), alkoxycarbonyl group having 10 or less carbon atoms, preferably 6 or less carbon atoms (e.g., methoxycarbonyl, ethoxycarbonyl), as well as hydroxyl. The number of carbon atoms in the alkenyl group is preferably 2 to 10, more preferably 2 to 6. Examples of the alkenyl group include 2-pentenyl, vinyl, allyl, 2-butenyl and 1-propenyl. The alkenyl group may have substituent groups. Examples of the substituent groups include halogen atoms (Cl, Br, F), alkoxycarbonyl group having 10 or less carbon atoms, preferably 6 or less carbon atoms (e.g., methoxycarbonyl, ethoxycarbonyl), as well as hydroxyl. The number of carbon atoms in the aralkyl group is preferably 7 to 12. Examples of the aralkyl group include benzyl and phenethyl. The aralkyl group may have substituent groups. Examples of the substituent groups include halogen atoms (Cl, Br, F), alkyl group having 10 or less carbon atoms, preferably 6 or less carbon atoms (e.g., methyl) and alkoxy group having 10 or less carbon atoms, preferably 6 or less (e.g., methoxy).

In the general formula (VII), L is a linking group having 5, 7 or 9 methine groups having double bonds conjugated therein. The number of methine groups is 7 (heptamethine compound) or 9 (nonamethine compound), more preferably 7. The methine group may have substituent groups. However, the methine group having substituent groups is a methine group in the center (at the meso-position). The substituent groups on the methine group are alkyl group, halogen atom and aryl group.

The number of carbon atoms in the alkyl group is preferably 1 to 10, more preferably 1 to 6. Examples of the alkyl group include methyl, ethyl, propyl, butyl, isobutyl, pentyl and hexyl. The alkyl group may have substituent groups. Examples of the substituent groups include halogen atoms (Cl, Br, F), alkoxycarbonyl group having 10 or less carbon atoms, preferably 6 or less carbon atoms (e.g., methoxycarbonyl, ethoxycarbonyl), as well as hydroxyl.

The number of fluorine, chlorine and bromine atoms is included in the number of carbon atoms in the halogen atom described above. The number of carbon atoms in the aryl group is preferably 6 to 12. Examples of the aryl group include phenyl and naphthyl.

The aryl group may have substituent groups. Examples of the substituent groups include alkyl group having 10 or less carbon atoms, preferably 6 or less carbon atoms (e.g., methyl, ethyl, propyl, butyl, isobutyl, pentyl, hexyl) and alkoxy group having 10 or less carbon atoms, preferably 6 or less carbon atoms (e.g., methoxy, ethoxy).

A methine group at the meso-position and a methine group adjacent to the meso-position may be combined with each other via an alkylene group, to form a 5- or 6-member ring. Further, when a hydrogen atom is present at the meso-position, methine groups at positions adjacent to the meso-position may be combined with each other via an alkylene group, to form a 5- to 7-member ring. Examples of rings formed by methine groups at the meso-position or at positions adjacent thereto include cyclopentene ring, cyclohexane ring and cycloheptene ring. These rings may have substituent groups, and examples of the substituent groups include $C_{1-4}$ alkyl groups such as methyl group, ethyl group, propyl group, isopropyl group, n-butyl group and t-butyl group, as well as phenyl group.

In the general formula (VII), a, b and c each represent 0 or 1. Preferably, a and b are 0. Generally, c is 1. However, if an anionic substituent group such as carboxyl forms an intramolecular salt with N', c is 0. In the general formula (VII), X is an anion. Examples of the anion are halide ions ($Cl^-$, $Br^-$, $I^-$), p-toluene sulfonate ions, ethyl sulfate ions, $PF_5^-$, $BF_4^-$ and $ClO_4^-$.

Examples of cyanine dyes preferably used as the infrared radiation-absorbing coloring material in the present invention are as follows.

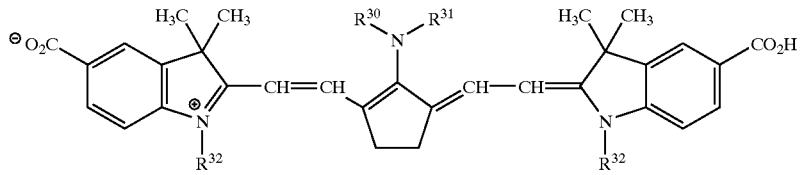

| Compound | $R^{30}$ | $R^{31}$ | $R^{32}$ |
|---|---|---|---|
| (1) | Phenyl | Phenyl | $CH_3$ |
| (2) | Phenyl | $CH_3$ | $CH_3$ |

-continued
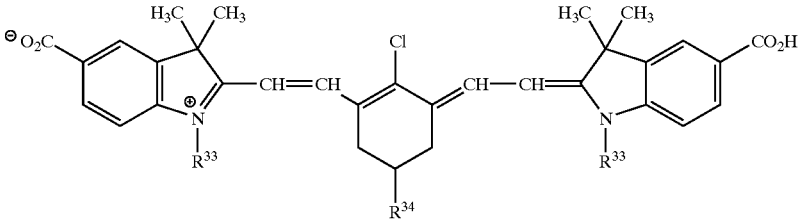
| Compound | $R^{33}$ | $R^{34}$ |
|---|---|---|
| (3) | $(n)C_4H_9$ | $CH_3$ |
| (4) | $(n)C_4H_9$ | Phenyl |
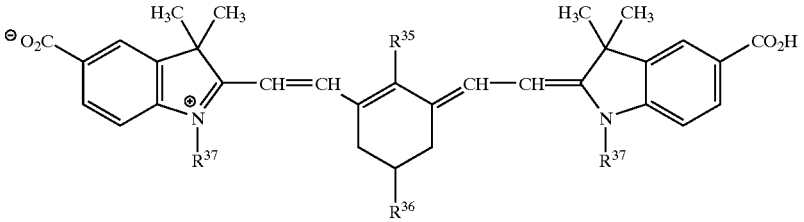
| Compound | $R^{35}$ | $R^{36}$ | $R^{37}$ |
|---|---|---|---|
| (5) | 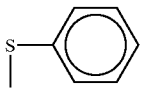 | $CH_3$ | $CH_3$ |
| (6) | 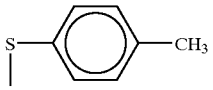 | Phenyl | $CH_3$ |
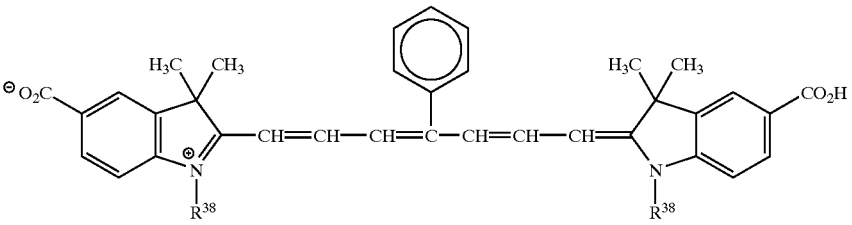
| Compound | $R^{38}$ |
|---|---|
| (7) | $CH_3$ |
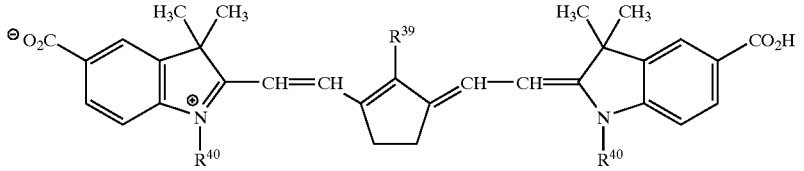
| Compound | $R^{39}$ | $R^{40}$ |
|---|---|---|
| (8) | 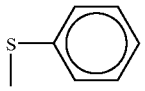 | $(n)C_4H_9$ |

-continued
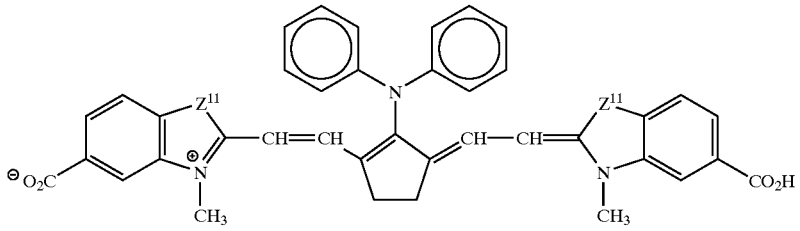
| Compound | $Z^{11}$ |
|---|---|
| (9) | O |
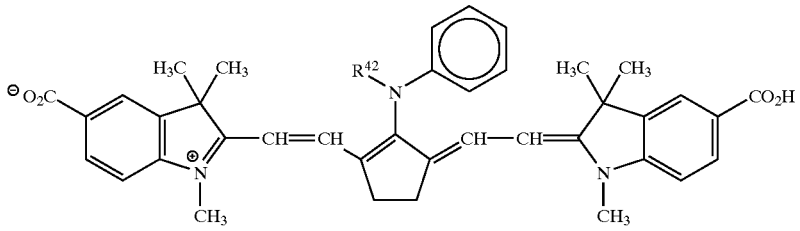
| Compound | $R^{42}$ |
|---|---|
| (10) | $H_3C—SO_2$ \ |
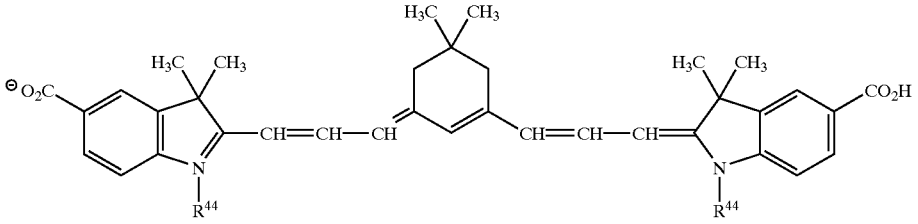
| Compound | $R^{44}$ |
|---|---|
| | $CH_3$ |
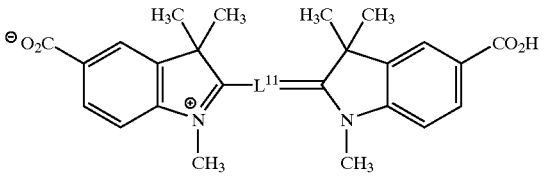
| Compound | $L^{11}$ |
|---|---|
| (12) | 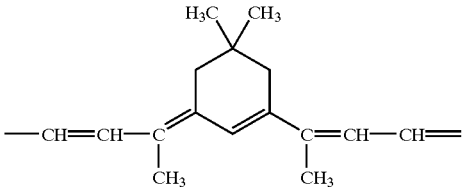 |

-continued
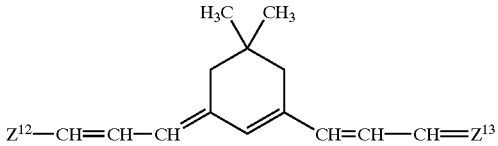
| Compound | $Z^{12}$ | $Z^{13}$ |
|---|---|---|
| (13) | 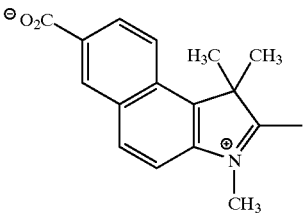 | 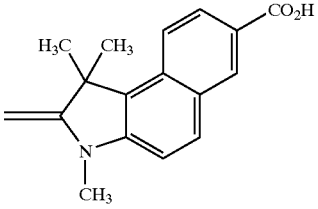 |
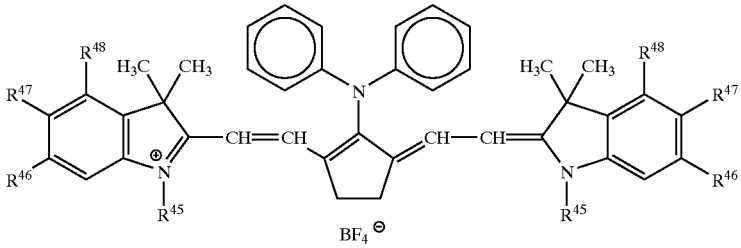
| Compound | $R^{45}$ | $R^{46}$ | $R^{47}$ | $R^{48}$ |
|---|---|---|---|---|
| (14) | $CH_3$ | H | H | H |
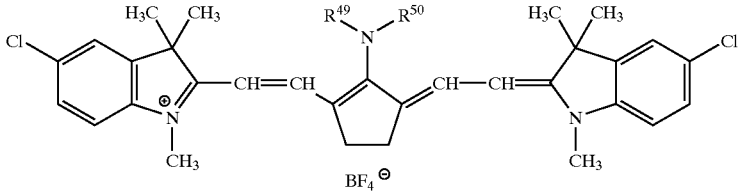
| Compound | $R^{49}$ | $R^{50}$ |
|---|---|---|
| (15) | $CH_3$ | phenyl |
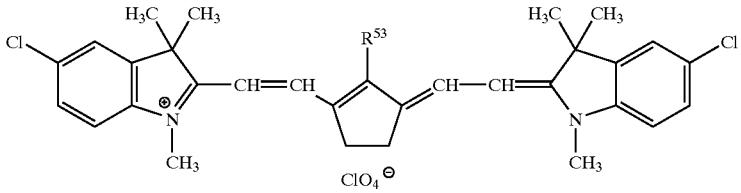
| Compound | $R^{53}$ |
|---|---|
| (16) | Cl |

-continued

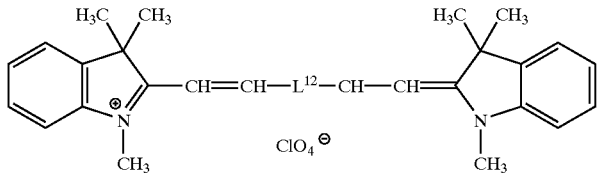

| Compound | $L^{12}$ |
|---|---|
| (17) | 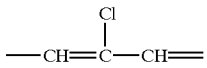 |
| (18) | 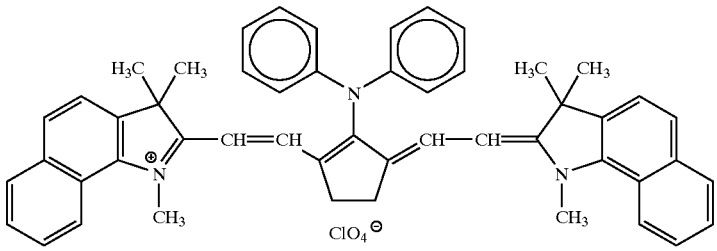 |
| (19) | 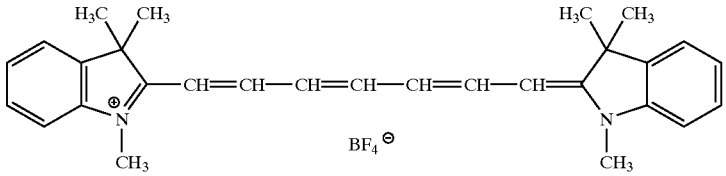 |
| (20) | 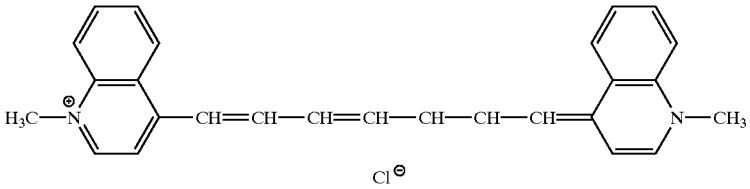 |

The cyanine dyes can be synthesized with reference to the following synthesis examples. Similar synthesis methods are also described in U.S. Pat. Nos. 2,095,854, 3,671,648, JP-A No. 62-123252, and JP-A No. 6-43583.

Synthesis Example 1

Synthesis of Compound (1)

9.8 g of 1,2,3,3-tetramethyl-5-carboxyindolenium p-toluene sulfonate, 6 g of 1-[2,5-bis(anilinomethylene) cyclopentylidene]-diphenyl anilinium tetrafluoroborate, 100 ml of ethyl alcohol, 5 ml of acetic anhydride and 10 ml of triethylamine were stirred for 1 hour at a temperature of 100° C., and the precipitated crystals were separated by filtration. The crystals were subjected to re-crystallization by 100 ml of methyl alcohol to obrain 7.3 g of compound (1).

Melting point: 270° C. or more.

λmax: 809.1 nm

ϵ: $1.57\times10^5$ (dimethyl sulfoxide)

The cyanine dyes described above may be converted into lake for use as lake cyanine dyes. Preferable lake cyanine dyes are shown by the following general formula (VIII).

$$(D)—A_m \cdot Y_n \qquad \text{formula (VIII)}$$

In the general formula (VIII), D is a backbone of the cyanine dyes shown by the general formula (VII).

In the general formula (VIII), A is an anionic dissociable group bound as a substituent group to D. Examples of the anionic dissociable group include carboxyl, sulfo, phenolic hydroxyl, sulfonamide group, sulfamoyl, and phosphono. Carboxyl, sulfo and sulfonamide groups are preferable. Carboxyl is particularly preferable. In the general formula (VIII), Y is a cation for making lake from cyanine dyes. Examples of inorganic cations include alkaline earth metal ions (e.g. $Mg^{2+}$, $Ca^{2+}$, $Ba^{2+}$, $Sr^{2+}$), transition metal ions (e.g., $Ag^{+}$, $Zn^{2+}$) and other metal ions (e.g., $Al^{3+}$). Examples of organic cations include ammonium ion, amidinium ion and guanidium ion. Divalent or trivalent cations are preferable. In the general formula (VIII), m is an integer of 2 to 5. m is preferably 2, 3 or 4. In the general formula (VIII), n is an integer of 1 to 5 necessary for charge balance. In general, n is 1, 2 or 3. The lake cyanine dye maybe in the form of a complex salt. Examples of preferable lake cyanine dyes are shown below.

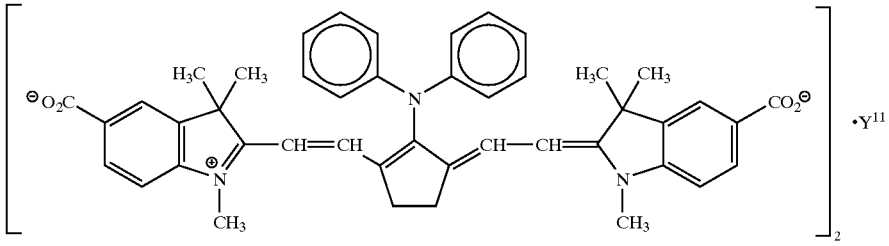

| Compound | $Y^{11}$ | Compound | $Y^{11}$ | Compound | $Y^{11}$ |
|---|---|---|---|---|---|
| (21) | $Ca^{2\oplus}$ | (22) | $Ba^{2\oplus}$ | (23) | $Mg^{2\oplus}$ |
| (24) | $Sr^{2\oplus}$ | (25) | $Zn^{2\oplus}$ | | |

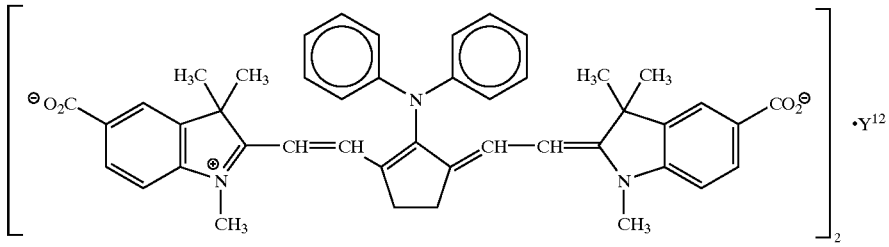

Compound $Y^{12}$ (26)

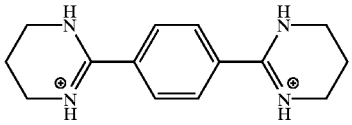

(27)

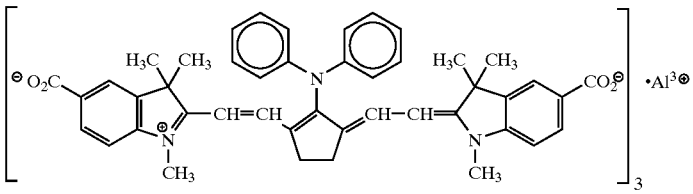

(28)

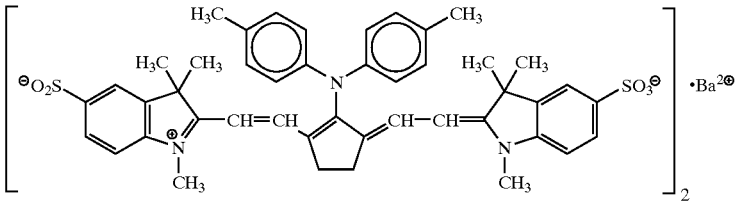

In the present invention, the infrared radiation-absorbing coloring material is used in the form of solid fine grains. For making the solid fine grains, known dispersing machines can be used. Examples of the dispersing machines include a ball mill, vibration ball mill, planetary ball mill, sand mill, colloid mill, jet mill and roller mill. The dispersing machines are described in JP-A No. 52-92716 and International Patent Publication 88/074794. Vertical or horizontal medium dispersing machines are preferable. Dispersion may be conducted in the presence of a suitable medium (e.g., water, alcohol). A dispersing surfactant is preferably used. As the dispersing surfactant, anionic surfactants (described in JP-A No. 52-92716 and International Patent Publication 88/074794) are preferably used. As necessary, anionic polymers, nonionic surfactants or cationic surfactants may be used.

The method of dispersing the infrared radiation-absorbing coloring materials and the materials such as surfactants used for dispersion as mentioned above will be described in detail below because they are substantially identical with the dispersion method and materials for the decolorizable dyes described in the next item (item 3).

After the infrared radiation-absorbing coloring material is dissolved in a suitable solvent, its poor solvent is added to prepare powder in the form of fine grains. A dispersing surfactant may be used in this case too. Alternatively, the pH may be regulated to dissolve the coloring material, and then the pH may be changed to prepare fine crystals of the coloring material. When a lake dye is used, a dye corresponding to (D)—$A_n$ of the general formula (VIII,) is dissolved at a suitable pH value, and then a water-soluble salt of cations corresponding to Y in the general formula (VIII) may be added to cause precipitation of fine crystals of the lake dye.

The infrared radiation-absorbing coloring material is added to the silver halide emulsion layer or the non-photosensitive hydrophilic colloid layer in the silver halide photosensitive material. The non-photosensitive hydrophilic colloid layer includes a back layer, a protective layer, and an undercoat layer (for the support). The coloring material is added preferably to the back layer or the protective layer, and more preferably to the protective layer. The infrared radiation-absorbing coloring material may be used in combination with other coloring materials. Such other coloring materials are described on page 17 of JP-A No. 2-103536. Gelatin is most preferable as the hydrophilic colloid used in the silver halide emulsion layer or hydrophilic colloid layer. Lime-treated gelatin, acid-treated gelatin, oxygen-treated gelatin, gelatin derivatives and modified gelatin are used. Lime-treated gelatin and acid-treated gelatin are preferable. Other utilizable hydrophilic colloids are described on page 18 of JP-A No. 6-67338.

In the present invention, by using the fine (crystal) grain dispersion of coloring materials of the general formulae (VII) and (VIII) described above, adverse influences on the photographic properties, such as reduced sensitivity, due to diffusion of the dyes caused by insufficient fixing of the dyes to other layers, and the problem of deterioration of facial properties due to unnecessary absorption remaining as residual color after development process due to insufficient decolorization, can be solved by the so-called mordant method of fixing dye molecules by having a hydrophilic polymer having an opposite charge to conventionally known dissociated anionic dyes to be coexistent as a mordant in the same layer, or by a method of using a dispersion of fine grains of an oil-soluble dye in water or in a gelatin solution by use of a high-boiling organic solvent or using a latex-dispersed dispersion.

3. Anti-halation Layer Containing a Decolorizable Anti-halation Dye

Description of the decolorizable anti-halation dye preferably used in the anti-halation layer in the color photosensitive material to which the present invention is applied, thereby achieving a significant effect with respect to the object of the present invention, is omitted because it is the same as in the "2. Anti-halation layer containing a decolorizable anti-halation dye" in the third aspect described above.

4. Development Process

Description of the development process is omitted because it is the same as "3. Development process" in the third aspect described above.

5. Reading of an Image

The reading of an image is essentially the same as "4. Reading of an image" in the third aspect described above, and only different features are described hereinafter.

The light sources applicable to the first and second image information parts 312 and 314 include tungsten, fluorescent lamps, fluorescent diodes and laser light, and in particular, an infrared light source (wavelength: 800 to 1200 nm, preferably 850 to 1100 nm) is preferable. This is because the color photosensitive material of the present invention is provided with an interlayer having an infrared radiation absorbing coloring material, and when image information is read using reflected light, background noise is eliminated by its infrared radiation absorbing action, thus improving image identification accuracy. Further, when the image information is read by transmitted light, the wavelength of the light source is set to be in a longer wavelength range than the light absorption region of the infrared radiation absorbing coloring material, whereby the absorption of the infrared radiation absorbing coloring material can be eliminated to improve image reading accuracy.

6. Photosensitive Material Used in the Present Invention and Supplementary Description Related Thereto The photosensitive material used in the present invention and supplementary description related thereto are essentially the same as "5. Photosensitive material used in the present invention and supplementary description related thereto" in the third aspect described above, and thus only different features are described.

The interlayer containing an infrared radiation absorbing coloring material is preferably disposed between the blue photosensitive light layer group and the green photosensitive light layer group and/or between the green photosensitive light layer group and the red photosensitive light layer group, but the arrangement is not limited to these examples.

The anti-halation layer containing the decolorizable anti-halation dye is preferably disposed between the undercoat layer coating layer at the side of the photosensitive layer of the support and the silver halide emulsion layer (usually red photosensitive light layer) nearest to the support. However, the position of the anti-halation layer is not limited to the same, and for example, it may be disposed on the surface of the support opposite to the emulsion layer.

[Seventh and Eighth Aspects]

The seventh and eighth aspects of the present invention are described in more detail in the following order:

1. Scheme of the process of the color image-forming method of the present invention;
2. Development process;
3. Clarification process;
4. Reading of an image; and
5. Color photosensitive material used in the present invention and supplementary description related thereto 1. Scheme of the Color Image-forming Method of the Present Invention The scheme of the color image-forming method of the present invention is the same as "1. Scheme of the process of the color image-forming method of the present invention" in the third aspect described above, and only different features are described.

Figure 27:
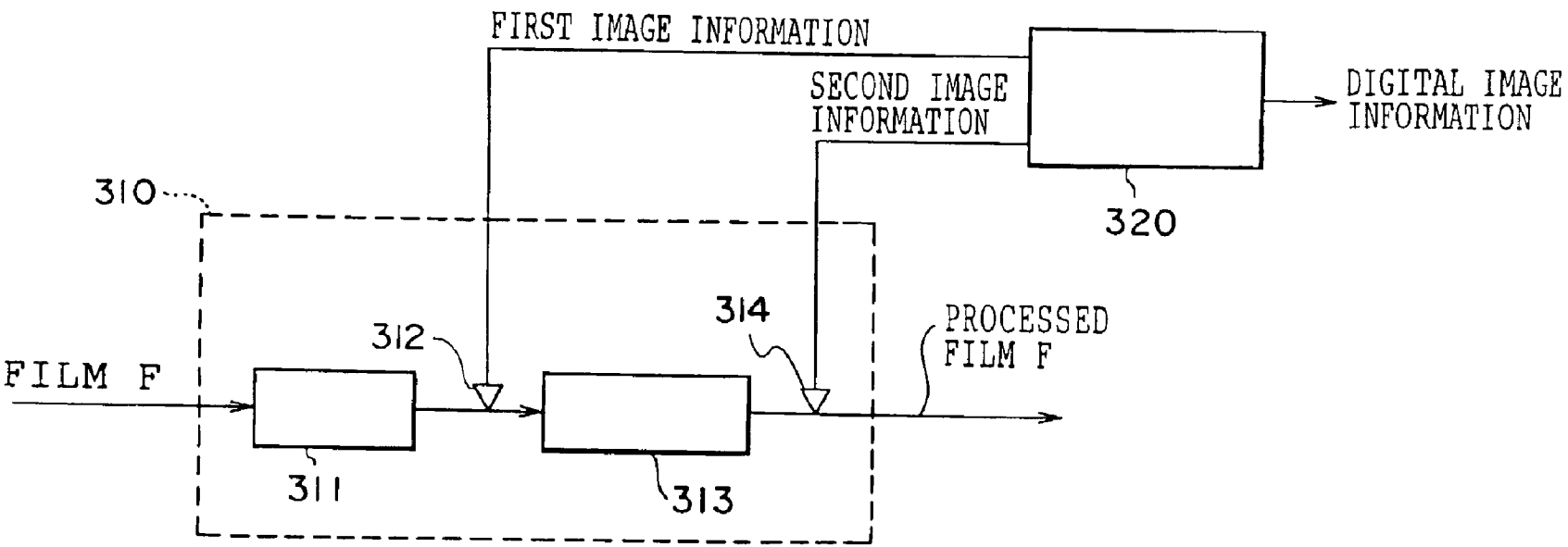
FIG. 27 is a block diagram schematically showing the flow of the processes in the seventh and eighth aspects of the present invention.

FIG. 27 is a block diagram schematically showing the scheme of the process in the seventh and eighth aspects of the present invention.

In FIG. 27, a film treating and image reading part 310 includes of a developing part 311, a first image information reading part 312 using reflected light, a clarification process part 313, and a second image information reading part 314 using reflected light. Color film F is introduced into the image forming device and transferred to the film treating and image reading part 310. Development process is conducted in the developing treatment part 311, and an image is formed on each photosensitive layer (R, G, B). Then, image elements constituting the image are read photoelectrically by an image scanner (not shown) in a reflection light system in the first image information reading part 312, to obtain first image information. The color film F after the reading of the first image information is subjected to clarification process in the clarification process part 313, to make the non-image part transparent to reduce the transmission density. In the color film F having improved image contrast of the transmission density due to the clarification process of the non-image part, the image is read photoelectrically by an image scanner (not shown) in a reflection light system in the second image reading part 314, to obtain second image information. The obtained first and second image information are electrically sent in the form of a time-series electrical signal to the image processing part 320, then converted into digital signals so as to permit image processing, and converted into electrical digital image information of blue, green and red.

2. Development Process

Description of the development process is omitted because it is the same as "3. Development process" in the third aspect described above.

3. Clarification Process

In the present invention, the clarification process refers to the treatment of dissolution and removal of silver halide in the non-developed layer in the developed photosensitive material. Accordingly, there are many parts substantially common with the fixing treatment of a silver halide photosensitive material, but as opposed to a fixing treatment which is conducted for the purpose of securing long stability by fixing image qualities, the object of the clarification process in the present invention is to improve the transmissibility of the non-image part thus improving accuracy of image reading. Thus, these treatments may have different detailed features depending on their objects.

The method and system of the clarification process can make use of various known methods and systems such as immersion treatment, coating treatment and spray treatment. The above description in the development process applies to the details of the clarification processing.

Further, the treatment temperature and treatment time are the same as in described in the development process above.

As the clarification processing solution, the fixing solution used in development process of usual black and white or color photographic materials can be used as it is or after a viscosity-conferring agent is added thereto according to the treatment system. However, addition of a transparentization promoter is preferable for improving the rate of transparentization and the degree of transparency. As the transparentization promoter, known fixing agents such as thiocyanates, imidazoles and thioethers are effective, among which transparentization promoters having a greater effect are fixing agents represented by the general formulae [FI], [FII] and [FIII] below.

[FI]

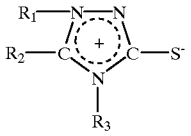

wherein $R_1$, $R_2$ and $R_3$ represent a hydrogen atom, alkyl group, cycloalkyl group, alkenyl group, alkynyl group, aralkyl group, aryl group, heterocyclic group, amino group, acylamino group, sulfonamide group, ureido group, sulfamoyl amino group, acyl group, thioacyl group, carbamoyl group and thiocarbamoyl group. $R_1$ and $R_3$ shall not simultaneously be hydrogen atoms.

[FII]

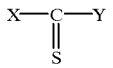

wherein X and Y represent an alkyl group, alkenyl group, aralkyl group, aryl group, heterocyclic group, $—N(R_{11})R_{12}$, $—N(R_{13})N(R_{14})R_{15}$, $—OR_{16}$ and $—SR_{17}$. X and Y may form a ring. X and/or Y are a carboxylic acid or a salt thereof, sulfonic acids or a salt thereof, phosphonic acids or a salt thereof, or a group substituted with at least one amino group, ammonium group or hydroxyl group. $R_{11}$, $R_{12}$, $R_{13}$, $R_{14}$ and $R_{15}$ represent a hydrogen atom, alkyl group, alkenyl group, aralkyl group, aryl group and heterocyclic group, and $R_{16}$ and $R_{17}$ represent a hydrogen atom, cation, alkyl group, alkenyl group, aralkyl group, aryl group and heterocyclic group.

[FIII]

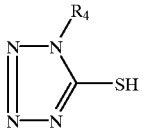

wherein $R_4$ represents a hydroxyalkyl group.

Hereinafter, the compounds of the general formula [FI] are described in more detail. The alkyl group, cycloalkyl group, alkenyl group, alkynyl group, aralkyl group and aryl group which are $R_1$, $R_2$ and $R_3$ are preferably those having 1 to 10 carbon atoms, and are particularly preferably a hydrogen atom or an alkyl group having 1 to 5 carbon atoms. These groups may be substituted with various kinds of substituent groups, and preferable substituent groups include a hydroxyl group, amino group, sulfonate group, carboxylate group, nitro group, phosphate group, halogen atom, alkoxy group, mercapto group, cyano group, alkylthio group, sulfonyl group, carbamoyl group, carbonamide group, sulfonamide group, acyloxy group, sulfonyloxy group, ureido group, and thioureido group. Further, at least one of $R_1$, $R_2$ and $R_3$ is preferably an alkyl group substituted with a water-soluble group. Here, "water-soluble group" refers to a hydroxyl group, amino group, sulfonate group, carboxylate group, or phosphate group, and the number of carbon atoms in the alkyl group is preferably 1 to 4. In particular, sulfonate group and carboxylate group are preferable. Further, it may have two or more substituent groups. The compounds of the general formula [FI] include, but are not limited to, the following compounds.

FI-1

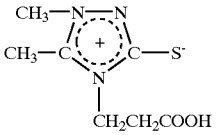

FI-2

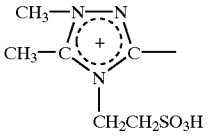

-continued
FI-3
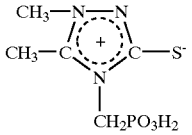
FI-4
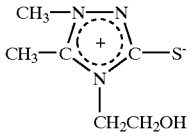
FI-5
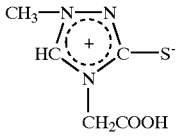
FI-6
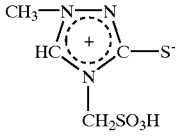
FI-7
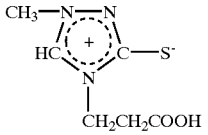
FI-8
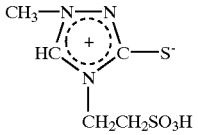
FI-9
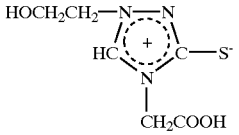
FI-10
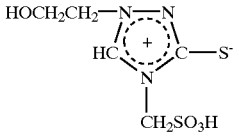
FI-11
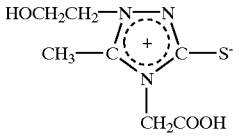
FI-12
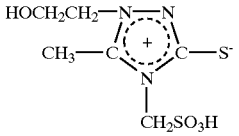
-continued
FI-13
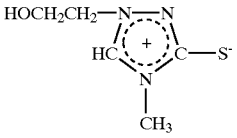
FI-14
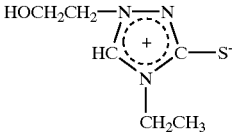
FI-15
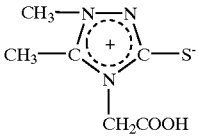
FI-16
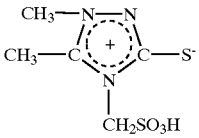
FI-17
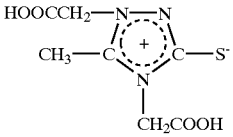
FI-18
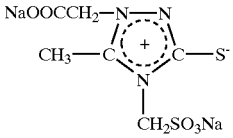
FI-19
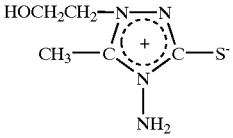
FI-20
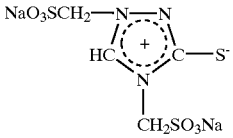
FI-21
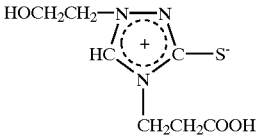
FI-22
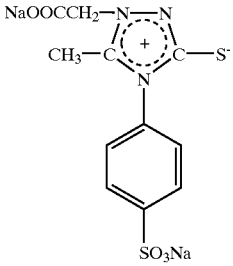

-continued
FI-23
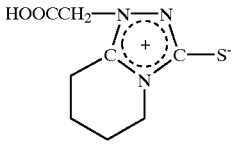
FI-24
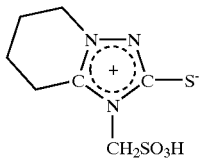
FI-25
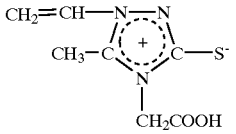
FI-26
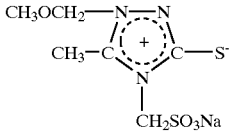
FI-27
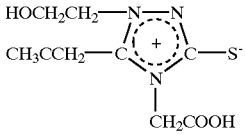
FI-28
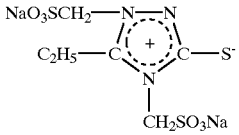
FI-29
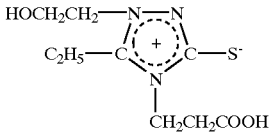
FI-30
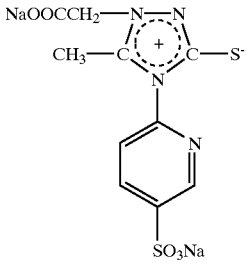
FI-31
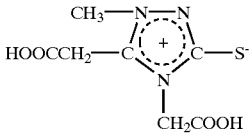
-continued
FI-32
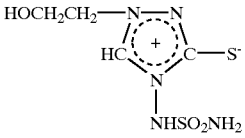
FI-33
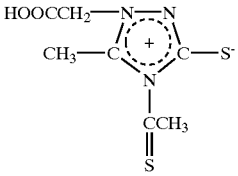
FI-34
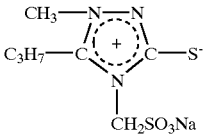
FI-35
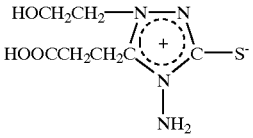
FI-36
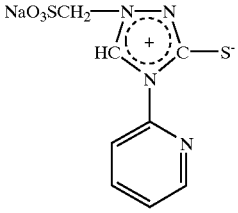
FI-37
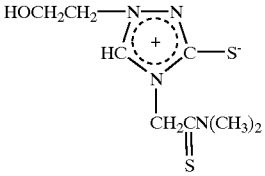
FI-38
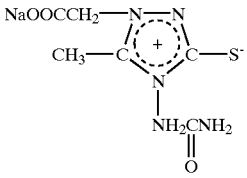
FI-39
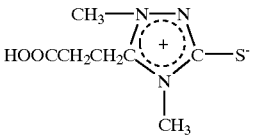
FI-40
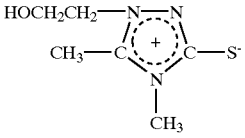

-continued

FI-41

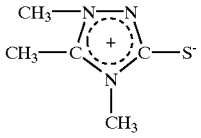

FI-42

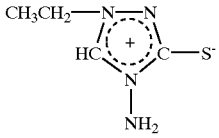

FI-43

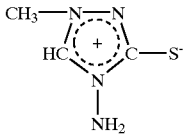

FI-44

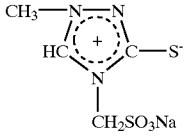

FI-45

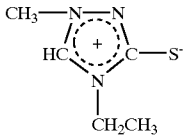

FI-46

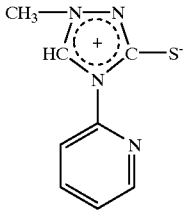

FI-47

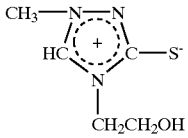

FI-48

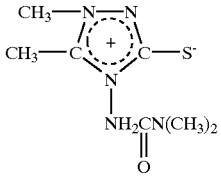

FI-49

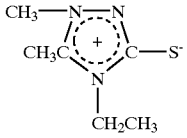

FI-50

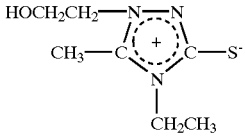

The compounds of the general formula [FI] in the present invention can be synthesized by the methods described in J. Heterocyclic Chem., 2, 105 (1965), J. Org. Chem., 32, 2245 (1967), J. Chem. Soc., 3799 (1969), JP-A No. 60-87322, JP-A No. 60-122936, JP-A No. 60-117240, JP-A No. 4-143757 or the like. When the compounds are used singly as a fixing agent in a fixing solution or a bleaching fixing solution, the amount thereof is preferably 0.03 to 3 moles/L, preferably 0.05 to 2 moles/L.

The compounds of the general formula [FII] in the present invention are described in detail. In the general formula [FII], the alkyl group, alkenyl group, aralkyl group, aryl group and heterocyclic group represented by X, Y, $R_{11}$, $R_{12}$, $R_{13}$, $R_{14}$, $R_{15}$, $R_{16}$ and $R_{17}$ include the following examples. That is, they are substituted or unsubstituted $C_{1-10}$ alkyl groups (e.g., methyl group, ethyl group, propyl group, hexyl group, isopropyl group, carboxyethyl group, sulfoethyl group, aminoethyl group, dimethyl aminoethyl group, phosphonopropyl group, carboxymethyl group, hydroxyethyl group), substituted or unsubstituted $C_{2-10}$ alkenyl groups (e.g., vinyl group, propinyl group, 1-methylvinyl group), substituted or unsubstituted $C_{7-12}$ aralkyl groups (e.g., benzyl group, phenethyl group, 3-carboxyphenyl methyl group, 4-sulfophenyl ethyl group), substituted or unsubstituted $C_{6-12}$ aryl groups (e.g., phenyl group, naphthyl group, 4-carboxyphenyl group, 3-sulfophenyl group), substituted or unsubstituted $C_{1-10}$ heterocyclic groups (e.g., preferably 5- to 6-member rings such as pyridyl group, furyl group, thienyl group, imidazolyl group, pyrrolyl group, pyrazolyl group, pyrimidinyl group, xynolyl group, piperidyl group and pyrolydyl group).

In the general formula [FII], the cation groups represented by $R_{16}$ and $R_{17}$ represent alkali metals and ammonium. X and Y may form a ring. Examples of the ring formed by X and Y are an imidazoline-2-thione ring, imidazolizine-2-thione ring, thiazoline-2-thione ring, thiazolidine-2-thione ring, oxazoline-2-thione ring, oxazolidine-2-thione ring, pyrrolidine-2-thione ring, or benzo-condensed derivatives thereof.

However, X and/or Y shall be substituted with at least one member selected from carbonic acid or salts thereof (e.g., alkali metal salts, ammonium salts), sulfonic acids or salts thereof (e.g., alkali metal salts, ammonium salts), phosphonic acids or salts thereof (e.g. alkali metal salts, ammonium salts), amino groups (e.g., unsubstituted amino group, dimethylamino group, methylamino group, dimethyl amino group hydrochlorides), and ammonium groups (e.g., trimethyl ammonium group, dimethyl benzyl ammonium group), and hydroxyl group.

Further, the alkyl group, alkenyl group, aralkyl group, aryl group and heterocyclic group may be substituted. Examples of the substituent groups include the following. Examples of Typical substituent groups are an alkyl group, aralkyl group, alkenyl group, alkynyl group, aryl group, alkoxy group, aryloxy group, acylamino group, ureido group, urethane group, sulfonylamino group, sulfamoyl group, carbamoyl group, sulfonyl group, sulfinyl group, alkyloxycarbonyl group, aryloxycarbonyl group, acyl group, acyloxy group, alkylthio group, arylthio group, halogen atom, cyano group, nitro group and the like. These groups may be further substituted. When two or more substituent groups are present, they may be the same or different.

Particularly preferable compounds of the general formula [FII] are represented by the following general formula [FIV]:

[FIV]

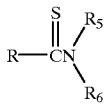

wherein R is represents a $C_{1-10}$ alkyl group, $C_{0-10}$ —$N(R_{20})R_{21}$, or $C_{0-10}$ —$N(R_{22})N(R_{23})R_{24}$; $R_5$, $R_6$, $R_{20}$, $R_{21}$, $R_{22}$, $R_{23}$ and $R_{24}$ each represent a hydrogen atom or an alkyl group, provided that at least one of R, $R_5$, $R_6$, $R_{20}$, $R_{21}$, $R_{22}$, $R_{23}$ and $R_{24}$ represents an alkyl group substituted with a member selected from the group consisting of carboxylic acids or salts thereof, sulfonic acids or salts thereof, phosphonic acids or salts thereof, amino group, ammonium group and hydroxyl group. In the general formula [FIV], R is more preferably $C_{0-6}$ —$N(R_{20})R_{21}$ or $C_{0-6}$ —$N(R_{22})N(R_{23})R_{24}$. $R_5$, $R_6$, $R_{20}$, $R_{21}$, $R_{22}$, $R_{23}$ and $R_{24}$ each represent a hydrogen atom or an alkyl group. However, at least one of $R_5$, $R_6$, $R_{20}$, $R_{21}$, $R_{22}$, $R_{23}$ and $R_{24}$ represents an alkyl group substituted with a member selected from the group consisting of carboxylic acids or salts thereof and sulfonic acids or salts thereof.

Hereinafter, the compounds of the general formula [FII] in the present invention are shown specifically, but to these examples the present invention is not limited.

FII-1

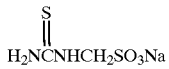

FII-2

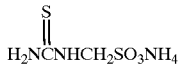

FII-3

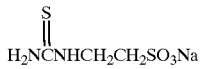

FII-4

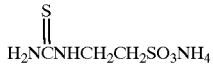

FII-5

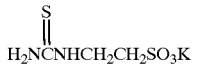

FII-6

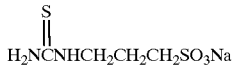

FII-7

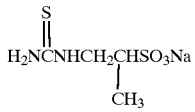

FII-8

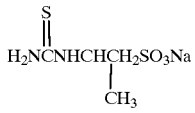

FII-9

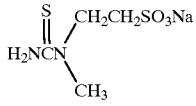

-continued

FII-10

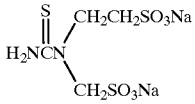

FII-11

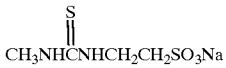

FII-12

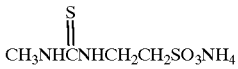

FII-13

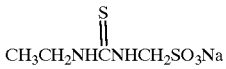

FII-14

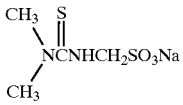

FII-15

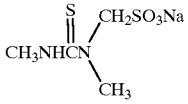

FII-16

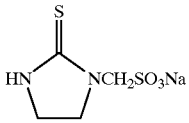

FII-17

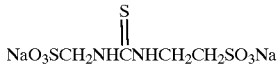

FII-18

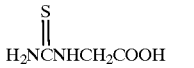

FII-19

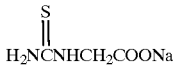

FII-20

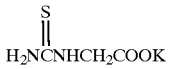

FII-21

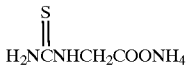

FII-22

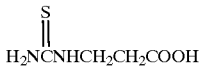

FII-23

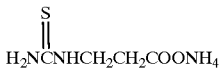

FII-24

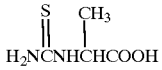

FII-25

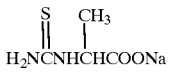

-continued
FII-26
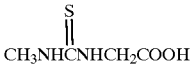
FII-27
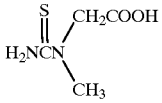
FII-28
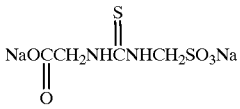
FII-29
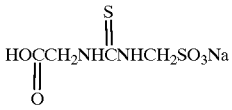
FII-30
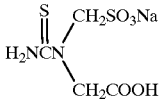
FII-31
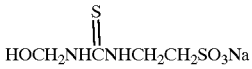
FII-32
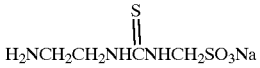
FII-33
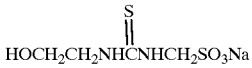
FII-34
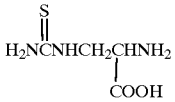
FII-35
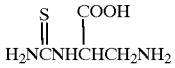
FII-36
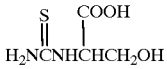
FII-37
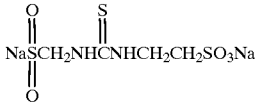
FII-38
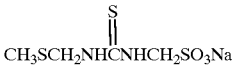
FII-39
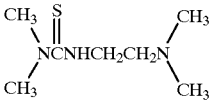
-continued
FII-40
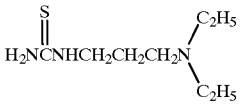
FII-41
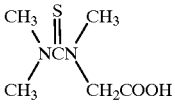
FII-42
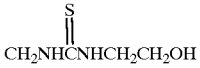
FII-43
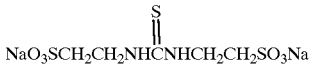
FII-44
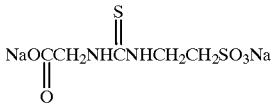
FII-45
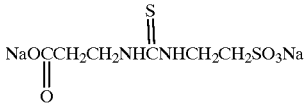
FII-49
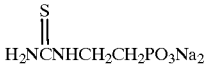
FII-50
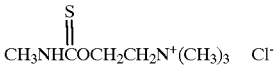
FII-51
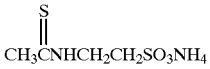
FII-52
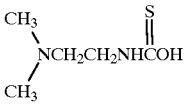
FII-53
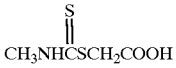
FII-54
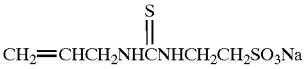
FII-55
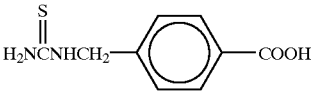
FII-56
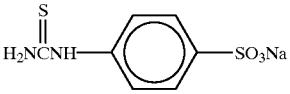
FII-57
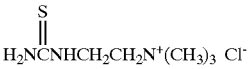

-continued
FII-58
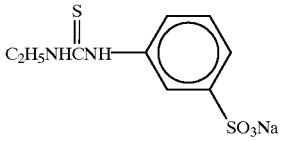
FII-59
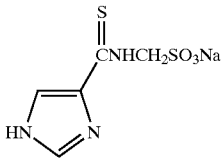
FII-60
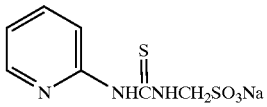
FII-61
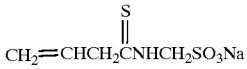
FII-62
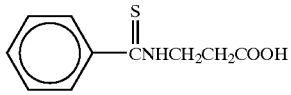
FII-63
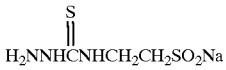
FII-64
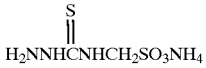
FII-65
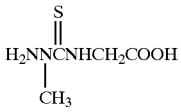
FII-66
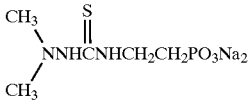
FII-67
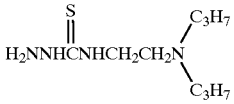
FII-68
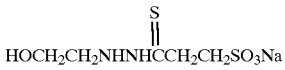
FII-69
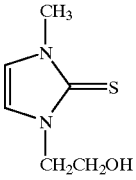
-continued
FII-70
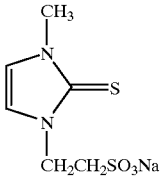
FII-71
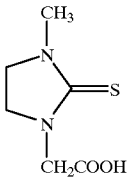
FII-72
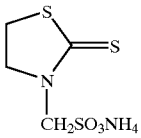
FII-73
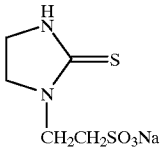
FII-74
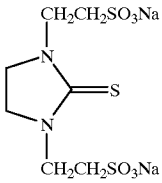
FII-75
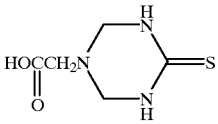
FII-76
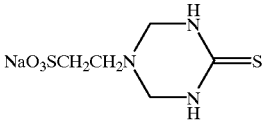
FII-77
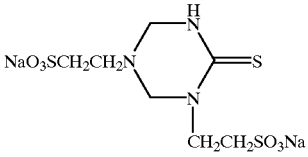
FII-78
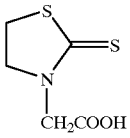

-continued

FII-79

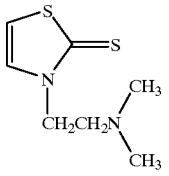

FII-80

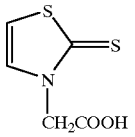

FII-81

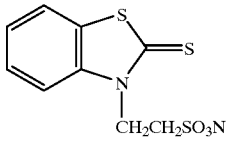

FII-82

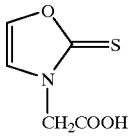

FII-83

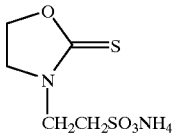

FII-84

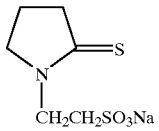

FII-85

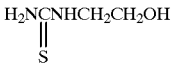

FII-86

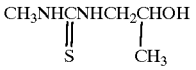

The compounds represented by the general formula [FII] in the present invention can be synthesized by methods known in the art, for example, with reference to J. Org. Chem., vol. 24, 470–473 (1959), J. Heterocycl. Chem., vol. 4, 605–609 (1967), Journal of Japanese Pharmacological Society, vol. 82, 36–45 (1962), JP-B No. 39-26203, JP-A No. 63-229449, and OLS-2,043,944.

The alkyl moiety in the hydroxyalkyl group represented by $R_4$ in the general formula [FIII] is a lower alkyl group containing 1 to 9 carbon atoms, and $R_4$ is preferably a hydroxyethyl group, hydroxypropyl group or hydroxybutyl group.

When the compounds of the general formulae [FI], [FII] and [FIII] above are used as the fixing agent in the clarification solution, they are preferably used in an amount of 0.03 to 3moles/L, more preferably 0.05 to 2 moles/L. Further, they may be used in combination with thiosulfate, and when used in combination, are used in a molar ratio of 0.05 to 0.3, preferably 0.07 to 0.25 or thereabout to the amount of the thiosulfate added. Although the amount thereof is naturally varied depending on the amount of the thiosulfate used, these compounds are used specifically in an amount of 0.001 to 0.5 mole/L, more preferably 0.05 to 0.3 mole/L. The two or more compounds of the general formulae [FI], [FII] and [FIII] in the present invention may be used in combination, and when a plurality of these compounds are used, their total amount is most preferably within the range described above when they are not used in combination with thiosulfate, or within the above-described ratio to thiosulfate when they are used in combination with thiosulfate.

The clarification processing solution can contain a wide variety of known organic acids (e.g. glycolic acid, succinic acid, maleic acid, malonic acid, citric acid, sulfosuccinic acid, acetic acid etc.), organic bases (e.g. imidazole, dimethyl imidazole etc.), or the compounds such as 2-picolinic acid represented by the general formula (A-a) or the compounds such as kojic acid represented by the general formula (B-b) in JP-A No. 9-211819. The amount of these compounds added is 0.005 to 3.0 moles, more preferably 0.05 to 1.5 moles per L of the clarification processing solution.

Preferably, the clarification processing solution contains a fixing agent contained in a usual fixing solution. Examples of known fixing agents include thiosulfates such as sodium thiosulfate and ammonium thiosulfate, thiocyanates such as sodium thiocyanate and ammonium thiocyanate, thioether compounds such as ethylene bisthioglycolic acid, 3,6-dithia-1,8-octane diol, and water-soluble silver halide dissolving agents such as thiourea, and they can be used singly or in combination thereof.

The pH range of the clarification processing solution used in the method of forming a color image in the present invention is preferably 3 to 10, more preferably 4 to 9. If the pH is lower than this range, deterioration of the processing solution and formation of leuco-derivatives from the cyan coloring material are easily promoted. On the other hand, if the pH is higher than said range, staining easily occurs.

To control the pH, hydrochloric acid, sulfuric acid, nitric acid, bicarbonate, ammonia, caustic potassium, caustic sodium, sodium carbonate, potassium carbonate etc. can be added.

Further, the clarification processing solution can include various kinds of defoaming agents, surfactants, and organic solvents such as polyvinyl pyrrolidone, methanol etc.

Preferably, the clarification processing solution includes, as preservatives, sulfite ion-releasing compounds such as sulfites (e.g., sodium sulfite, potassium sulfite, ammonium sulfite etc.), bisulfites (e.g., ammonium bisulfite, sodium bisulfite, potassium bisulfite etc.), metabisulfites (e.g., potassium metabisulfite, sodium metabisulfite, ammonium metabisulfite etc.), and aryl sulfinic acids such as p-toluene sulfinic acid, m-carboxybenzene sulfinic acid. These compounds are contained preferably in an amount of about 0.02 to 1.0 mole/L in terms of the amount of sulfite ions or sulfinate ions.

As other preservatives, ascorbic acid, carbonyl bisulfate adducts, or carbonyl compounds may be added.

Further, a buffer agent, a hard water-softening agent, an anti-fungus agent etc. may be added thereto.

The clarification processing solution may be disposable solution or may be a replenishable solution. In the case of treatment with the a replenishable solution, the amount of the solution replenished is 20 to 250 ml, preferably 30 to 100 ml, more preferably 15 to 60 ml per $m^2$ of the photosensitive material.

4. Reading of an Image

The reading of an image is the same as in "4. Reading of an image" in the third aspect described above, and thus description thereof is omitted.

5. Photosensitive Material Used in the Present Invention and Supplementary Description Related Thereto The photosensitive material used in the present invention and supplementary description related thereto are the same as in "5. Photosensitive material used in the present invention and supplementary description related thereto" in the third aspect described above, and thus this description is omitted.

[Ninth and Tenth Aspects]

The ninth and tenth aspects of the present invention are described specifically in the following order:

1. Scheme of the process of the color image-forming method of the present invention;
2. Development process;
3. Heat development;
4. Reading of an image; and
5. Color photosensitive material used in the present and supplementary description relating thereto related thereto 1. Scheme of the Process of the Color Image-forming Method of the Present Invention The scheme of the process of the color image-forming method of the present invention is essentially the same as "1. Scheme of the process of the color image-forming method of the present invention" in the third aspect described above, and thus only different features are described.

FIG. 28 is a block diagram schematically showing the scheme of the process in the ninth and tenth aspects of the present invention.

In FIG. 28, a film treating and image reading part 310 includes a developing part 311, a first image information reading part 312 using reflected light, a heat drying part 315, and a second image information reading part 314 using reflected light. Color film F is introduced into the image forming device and conveyed to the film treating and image reading part 310, and development process is conducted in the developing treatment part 311, and an image is formed on each photosensitive layer (R, G, B). Then, image elements in image(s) on the front and/or back photosensitive layers are read photoelectrically by an image scanner (not shown) in a reflection light system in the first image information reading part 312, to obtain first image information. The color film F after the reading of the first image information is dried in the heat drying part 315, to make the non-image part transparent to reduce transmission density. In the color film F having improved image contrast of transmission density due to the clarification process of the non-image part, an image in the remaining photosensitive layer is read photoelectrically by an image scanner (not shown) in a reflection light system in the second image reading part 314, to obtain second image information. The obtained first and second image information is electrically sent in the form of time-series electrical signal to the image processing part 320, then converted into digital signals so as to permit image processing, and converted into electrical digital image information of blue, green and red.

2. Development Process

Description of the development process is omitted because it is the same as "3. Development process" in the third aspect described above.

3. Heat Drying

The color film after development process and reading of the first image is sent to a heating and drying step. Although drying by a known arbitrary method and system can be selected, the following methods are preferable: (1) a method of drying by passing warm air or steam, (2) a system of radiation heat drying with infrared radiations or the like, (3) a system of contact electrical heat drying by heating with a heat roller, and (4) a system of electromagnetic wave heat drying by irradiation of microwaves.

The blast drying system is a system where the surface of a color film and the back thereof are dried by exposure to warm air or steam. Impediment drying by use of nozzles for efficient blowing is preferable. In particular, a ceramic warm air heater is also preferably used. The rate of feeding air in this case is preferably 4 to 20 $m^3$/min, more preferably 6 to 10 $m^3$/min. A thermostat for preventing overheating of the ceramic warm air heater is actuated preferably by heat conduction, and the position of attachment thereof is preferably at the downwind or windward side through a heat dissipating fin or a heat conductive part. In addition, a method of drying with steam is also preferable.

The air temperature is 40 to 100° C., preferably 50 to 90° C.

The infrared heating system is a system where non-contact heating is conducted by a lamp such as a tungsten lamp having many near infrared radiation components or by a ceramic heater or electric heater for irradiating far infrared radiations. The wavelength of the near infrared heater is in the range of 0.8 $\mu$m to 1.0 mm, and in particular, heating with heat rays having a wavelength range of 2500 to 25000 nm by a far infrared heater is preferable. The temperature of the surface of the heater for irradiating near infrared radiations or far infrared radiations is about 50 to 300° C., and the temperature of the surface of a color film is 30 to 120° C., preferably 40 to 100° C. for drying.

As the electric heater for irradiating infrared radiations, a bar-shaped (straight) heater using a bar-shaped electrical heating resistor such as ceramic or Nichrome wires or a facial radiation heater having electrical heating bars bent to be sufficiently contacted with one another in a plate form is used. Further, a panel heater using a plate-shaped electrical resistor may also be used.

The contact heating system is a system where a heated heat roller is pressed on the surface or the back of a color film. The heat roller referred to herein is formed by a roller using a metal having good thermal conductivity (e.g. aluminum, stainless steel, iron, copper etc.) or a plastic material (e.g. bakelite) equipped therein with a heat source (e.g. a metallic resistant heating element, a halogen lamp etc.) capable of controlling the temperature for heating the outer periphery thereof. This conveying roller has a suitably heated outer periphery with the outermost peripheral part coated with a material such as Teflon or silicon rubber which distributes heat uniformly without adhering to the film. The heat roller for the present invention preferably has a diameter of 12 to 80 mm and a length of 5 to 110 cm.

The surface temperature of the heat roller is 40 to 150° C., more preferably 50 to 100° C. The heat roller may be arranged preferably in a staggered arrangement or in an opposing arrangement, particularly in an opposing arrangement.

In the electromagnetic heat drying system, microwave heating is usually used. As the vibration device for microwaves, a magnetron, claistron or a traveling-wave tube for electron vibration is used. In particular, a magnetron is preferable for the purpose of the present invention. Microwave heating by a vibration wavelength of 915 or 2450 MHz (megahertz), particularly 2450 MHz (megahertz), is preferable.

For the uniform distribution of microwaves on the surface of the color film, light exposure is conducted preferably by rotating or moving the color film and/or the vibration source. A system where the color film is conveyed and exposed to light successively by a plurality of arranged vibration sources is also preferably used.

Although any of the heating systems described above can be preferably used in the present invention, in particular, the warm-air heating system, steam heating system, infrared drying system and electromagnetic heating system are preferable because these are non-contact types which do not cause staining and have easy maintenance. In particular, the far infrared heating system and steam heating system are preferable.

A combination of these systems can be used for more rapid and uniform heating.

Hereinafter, actual heat drying is exemplified, but the form of the heat drying used in the present invention is not limited to the following example.

Figure 29:
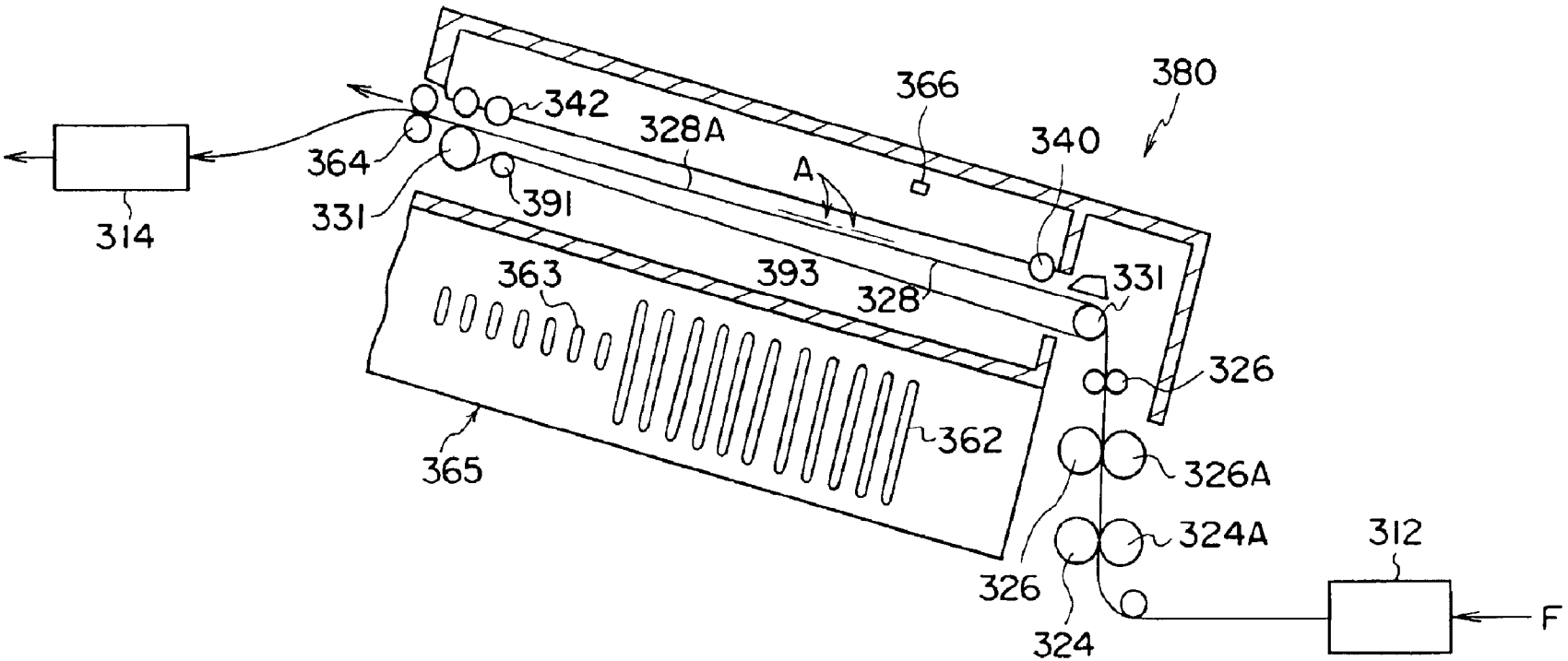
FIG. 29 is a schematic diagram showing one mode of the drying method in the present invention by using blast drying in combination with contact heat drying.

FIG. 29 is a schematic structural view illustrating an example in which blast drying by warm air is combined with contact heat drying by a heat roller. The heat drying part 380 includes (1) a contact heating part including counter rollers 324 and 325 which are opposite to heat rollers 324A and 325A and a counter roller 326 for conveying and (2) a blast drying part 393 including a slit opening 321 for blowing warm air, a belt conveyer 328 driven in the counterclockwise direction in FIG. 29 by a motor (not shown), a tension roller 391 applying tension to the belt, a linear portion 328A positioned at the upper side of the roller 331 driving the belt conveyer 328 and serving as a conveying portion for conveying the film F, thin slits 362 and 363 for taking in air, and a warm air heating part 365 including an air heating heater (not shown).

The action of the drying part wherein blast drying is combined with contact heat drying by a heat roller is as follows: A color film subjected to image reading by reflected light in the first image reading part 312 is sent to the heat drying part 380, then heated by contact with heat rollers 324A and 325A, carried by the belt conveyer 328 via the counter guide roller 326 and sent to the blast drying chamber 393. In the blast drying part, air is introduced through slits 362 and 363, and the film is heated at a predetermined temperature in the warm air heating chamber 365. From a nozzle (air-blowing port shown as lines by arrows A) close to the belt conveyer upper face 328A, air is blown onto the color film on the belt conveyer by a blast pipe which is not shown in the drawing. The color film is thus dried by contact heating and warm air heating to make the non-image part transparent, and then sent via the counter roller 364 and the drying part 380 to the second image reading part 314.

In the warm air drying part 393, some of the warm air jetted from the nozzle shown as the lines at the top of arrows A is discharged through an opening provided slantingly upward in an attachment portion of the roller 364, while the majority of warm air is returned to the warm air heating chamber 365, mixed with fresh air, and circulated while being heated.

In the above-described example of the drying device wherein the contact heating system is combined with the warm air blowing system as shown in FIG. 29, rapid drying is feasible as compared with drying by warm air only or by contact heating only. The reason that rapid drying is feasible is probably that the drying resistance of a boundary film can be efficiently eliminated during the constant-rate drying period and falling-rate drying period. Air flow removes the boundary film to generate a turbulent state, and as air flow is increased, the boundary film becomes thin, and the effect of heat conduction is increased to achieve effective constant-rate drying. Accordingly, when the mass velocity is 1000 $kg/m^2 \cdot hr$ or more, the effect can be obtained, and the rate is preferably 1100 $kg/m^2 \cdot hr$ or more, and more preferably 1200 $kg/m^2 \cdot hr$ or more. The upper limit is preferably 4000 $kg/m^2 \cdot hr$ or less because of the limitations of the device. In this case, "mass velocity" is used in the usual meaning. That is, the mass velocity is expressed as the product of the density of warm air ($kg/m^2$), the ratio of the opening of the blowing nozzle (the ratio of the heat receiving unit area to the sum of the areas of the nozzles or slits arranged therein), wind velocity (m/sec) and hour/second conversion factor (3600 sec/hr). In this case, the heat receiving area refers to an area opposite to (i.e. equal to) the color film in the blast drying part.

The temperature of the heater roller is preferably 40 to 120° C., more preferably 50 to 100° C. In blast drying, mass velocity is predominant for drying and the influence of temperature is low. Thus, a temperature in the broad range from room temperature to 150° C. can be used, but a preferable blast temperature is 40 to 120° C., more preferably 50 to 100° C.

Figure 30:
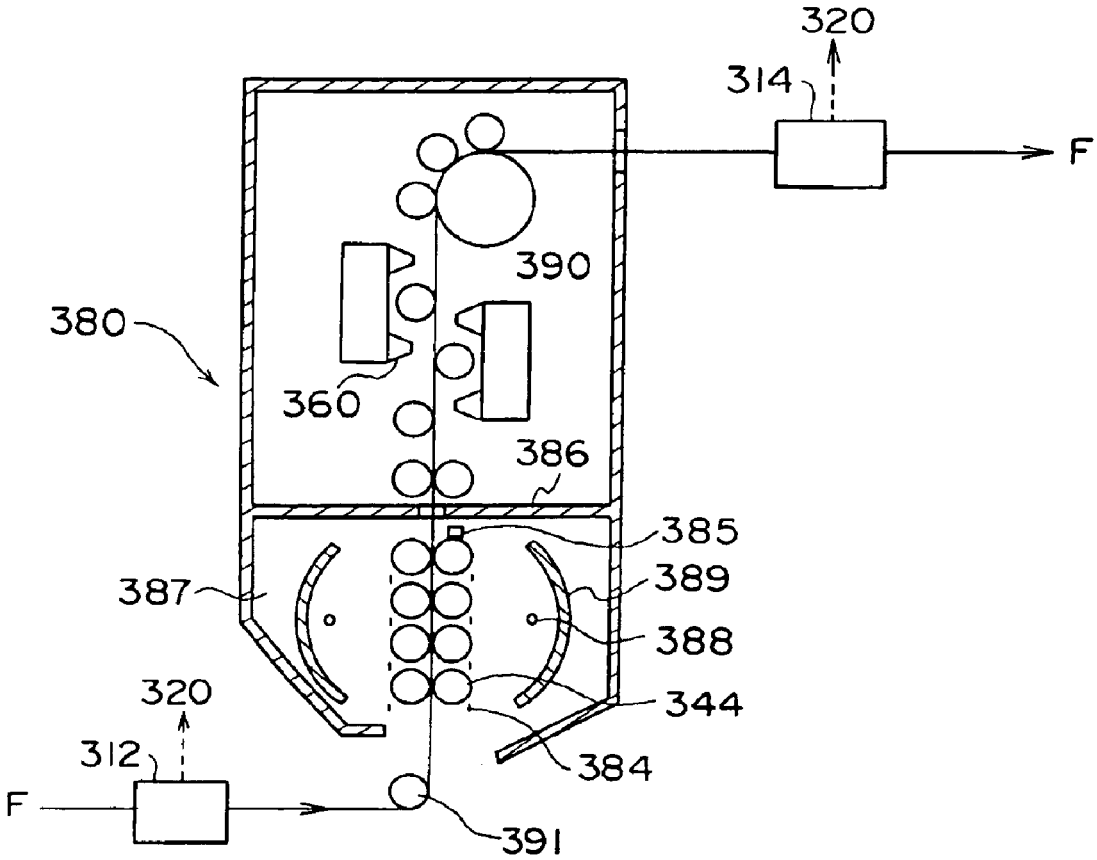
FIG. 30 is a schematic diagram showing one mode of the drying method in the present invention by using infrared heat drying in combination with contact heat drying.

FIG. 30 is an outline of a structure of another heating system where infrared radiation heating is combined with heat roller contact heating.

The color film F, after reading of the image by reflected light in the first image reading part 312, passes through a plurality of heat rollers 344. The pair of heat rollers 344 also serve as conveying rollers so that film F is subjected to contact heating while being conveyed upward in the casing of the heating part 380. Further, radiation heating is applied to the film by a far infrared lamp 388 and a reflection plate 389 arranged around the lamp. The heating part 380 is divided by a shielding plate 386 into a heating part 387 and a state-regulating chamber 390. A shielding plate (not shown) at the inlet of the heating part 387 to which film F is sent, and a shielding plate 386 at the top of the heating part 387, suppress dissipation of heat in the heating part.

A temperature sensor 384 is disposed at the inlet of the heating part 387, and a temperature sensor 385 is disposed at the outlet.

In the state-regulating chamber 390 above the upper shielding plate 386 in the heating part 387, warm air is sent from dry air nozzle 360 and blown perpendicularly onto film F thereby regulating the state of the dried photosensitive material. A part of the warm air blown from the dry air nozzle 360 is introduced into the heating part 387 via a blast port not shown in the drawing, to dehumidify the heating part 387. Warm air blown through the dry air nozzle 360 is supplied by sucking fresh air from the outside of the device through an air-introducing hole (not shown) formed in the casing of the drying part 380

In the heating part 387, an inlet temperature sensor 384 and an outlet temperature sensor 385 for detecting the temperature of the heating part 387 are arranged respectively at the upstream side and the inlet side from the center in the direction of conveying of film F. The two temperature sensors 384 and 385 (e.g., thermistor, thermocouple etc.) are connected to a controller (not shown) for controlling output of the heat rollers 344 and a far infrared lamp 388, so as to maintain the heating part 387 at a predetermined temperature.

Next, operation of the drying device in the present embodiment is described. A film having passed through the first image reading part 312 is sent by a pair of conveying rollers to the heating part 387 positioned at the side of the inlet of the drying part 380. In the heating part 387, the film F is subjected to contact heating while being conveyed upward by a pair of heat rollers 344 also serving as conveying rollers. The heating temperature of a pair of heat rollers at the side of the inlet is set preferably higher than the heating temperature of a pair of heat rollers at the downstream side.

When film F is heated by a heater, it is heated by contact heating with the heat rollers as described above, and simultaneously, film F is heated by irradiation with heat (infrared radiations) emitted by a far infrared lamp 388, whereby heat drying by radiation is conducted along with contact heating. Thereafter, the film F is sent to a state-regulating chamber 390 above a shielding plate 386, and after the state of film F is regulated by warm air blown toward the film through drying air nozzle 360 in the chamber, the film is sent to the second image reading part 314.

With respect to the removal of water in the process described above, the film F sent to the heating part 387 receives contact heating from the heat roller 344 and radiation heating from the IR lamp, and water adhering to the surface is evaporated. In the former part of the heating part 387, almost all of the quantity of heat applied to film F is removed as evaporation latent heat, and the surface temperature of film F is kept at lower temperature than the temperature of the heat roller. Thereafter, the film F is sent to the latter region of the heating part. At this stage, the quantity of heat applied is higher than the latent heat for removal of water by evaporation, and thus the surface temperature of film F is increased (falling-rate drying). The infrared radiation lamp raises the temperature of the inside of the photosensitive layer to promote diffusion of water, thus delaying the transfer to falling-rate drying with a lower rate of evaporation and thereby effecting efficient drying.

In the present embodiment, the film F can be dried rapidly and efficiently. Further, the heating used in this example is not only high-temperature heating but also short heating, so there is neither an increase in the unit of the consumed energy nor an increase in noise and costs.

4. Reading of an Image

The reading of an image is the same as "4. Reading of an image" in the third aspect described above, and thus, description thereof is omitted.

5. Photosensitive Material Used in the Present Invention and Supplementary Description Relating Thereto The photosensitive material used in the present invention and supplementary description related threto are the same as in "5. Photosensitive material used in the present invention and supplementary description related thereto" in the third aspect described above, and only different features are described.

The color photosensitive material used in the present invention may be a photosensitive material having any known support, and in particular, a photosensitive material having a cellulose triacetate and polyester support, particularly a polyester support, is preferable. In the present invention, heat drying is conducted after reading of the first image information, and rapid and strong drying is desired, so a polyester support which is sufficiently stable with respect to heating temperature is preferable.

[Eleventh and Twelfth Aspects]

The eleventh and twelfth aspects of the present invention are described in detail in the following order.

1. Scheme of the process of the color image-forming method of the present invention;
2. Development process;
3. Reading of an image; and
4. Color photosensitive material used in the present invention and supplementary description related thereto 1. Scheme of the Process of the Color Image-gorming Method of the Present Invention The scheme of the process of the color image-forming method of the present invention is the same as in "1. Scheme of the process of the color image-forming method of the present invention" in the third aspect described above, and only different features are described.

Figure 31:
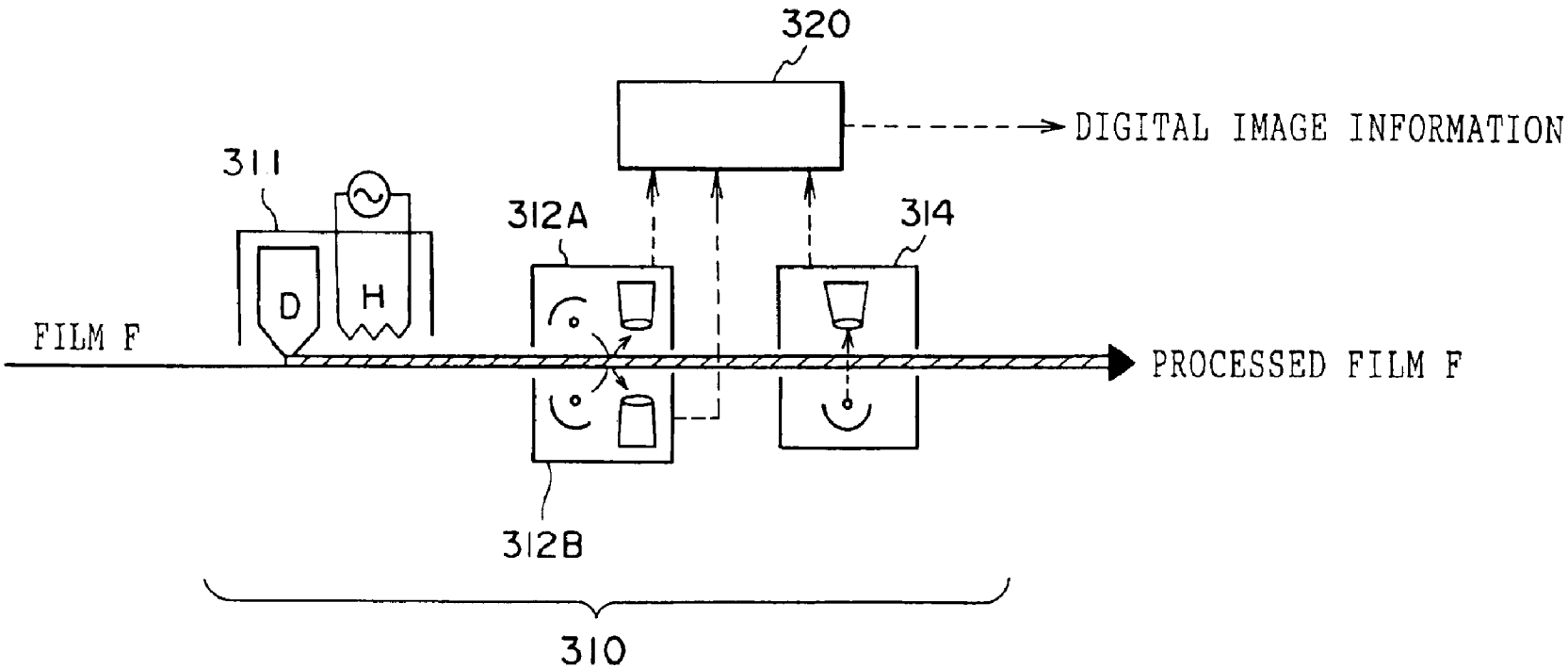
FIG. 31 is a block diagram schematically showing the flow of the processes in the eleventh and twelfth aspects of the present invention.

FIG. 31 is a block diagram schematically showing the scheme of the process of the eleventh and twelfth aspects of the present invention.

In FIG. 31, the film treating and image reading part 310 includes of a developing part 311, the first image information reading parts 312A and 312B using reflected light, and the second image information reading part 314 using transmitted light. The position of the first image information reading parts 312A and 312B and the position of the second image information reading part 314 may be switched so that an image may be read first by transmitted light. Color film F is introduced into the image-forming device and then sent to the film treating and image reading part 310 and subjected to development process in the developing treatment part 311. An image is thereby formed on each of 3 photosensitive layers, that is, the surface, back and intermediate photosensitive layers. The development part 311 includes a developer solution-supplying device D and a heating device H. In the developing solution-supplying device D, a developing solution is supplied to color film F. The color film F having the developing solution supplied thereto is heated in the heating device H, whereby development is substantially initiated. The color film F after heat development is sent to the first image information reading parts 312A and 312B, and the image elements forming the image are read by an image scanner (not shown) in a reflection light system, to obtain the first image information. In FIG. 1, the first image information reading part 312 is shown with the image information reading part 312A for reading the image from the front side and the image reading part 312B for reading the image from the back side, but it is not always necessary to read both faces, and there are also cases where one of the faces is read. The color film F after the reading of the first image information is sent to the second image information reading part 314, where the image is read photoelectrically by an image scanner (not shown) in a reflection light system, to obtain second image information. The obtained first and second image information is electrically sent in the form of time-series electrical signals to the image processing part 320, converted into digital signals so as to permit image processing, and converted into electrical digital image information of blue, green and red.

2. Development Process

The development process is essentially the same as "3. Development process" in the third aspect described above, and thus only different features are described.

In the present invention, the "development process by heating the photosensitive material having the developing solution supplied thereto" means development process where development is substantially initiated by heating because the desired rate of development cannot be achieved at the temperature (usually, room temperature) of the developing solution to be supplied. Accordingly, this development process is not so-called high temperature development where a high-temperature developing solution is applied to the photosensitive material. For the progress of this form of development, the temperature of the heated photosensitive layer having the developing solution supplied thereto is higher preferably by 5° C. or more, more preferably by 10° C. or more, than the temperature of the developing solution to be supplied.

Specifically, the following systems can be mentioned as the method of supplying the developing solution to the photosensitive layer and the method of heating the photosensitive material having the developing solution supplied thereto, but these are not intended to limit the mode of the present invention.

(1) A system where the developing solution is supplied to the photosensitive material, and then the photosensitive material having the developing solution absorbed therein is heated.

(2) A system where the photosensitive material is heated by placing it on a heated plate or exposing it to warm air or heat radiation, and a developing solution which is not heated is supplied to the face of the photosensitive material, and upon supplying the developing solution, heat development is initiated.

(3) The photosensitive material is immersed in a developing tank, and in the case of a small heat capacity, the photosensitive material is rapidly heated as it is, and in other cases, the photosensitive material is rapidly heated after developing solution has been supplied thereto after the photosensitive material has been removed from the developing tank.

(4) The photosensitive layer side surface of the photosensitive material is laid on a development treating sheet having a developing solution included therein, and then heated in that state.

As shown by the modes described above, the developing solution is not exposed to high temperature until development is initiated, so the developing solution is not deteriorated and handling thereof is easy. The means of preventing oxidation thereof due to air in a container such as treatment tank for storing the developing solution may be simple. Besides, there are brought about the above-described advantages, that is, the progress of development is regulated by the amount of the developing solution supplied, fogging at an image generating part is suppressed until heating is finished so that the progress of development is easily regulated, image reading accuracy is high, and an image with less color fogging can be obtained.

The amount of the developing solution by coating treatment is usually 10 to 100 ml/m$^2$, and preferably 15 to 50 ml/m$^2$, although this amount varies depending on the concentration of the developing solution and the amount of silver in the photosensitive material.

The spray treatment is a method of treating the photosensitive material by spraying it with the processing solution This method is advantageous in that the amount of the sprayed processing solution can be easily adjusted to an amount capable of substantially soaking into the photosensitive material. Further, the amount of the sprayed solution is made higher than the necessary amount of the solution, and the excess of the developing solution flowing down from the applied surface may be utilized again by circulation.

A development sheet in the form of a sheet or a development web in the form of a roll, in which a layer carrying a developing solution (such as a sponge layer having a developing solution absorbed therein) is provided on a support, can also be preferably used. The developing solution-containing layer in the development sheet or development web is laid on the photosensitive layer of the photosensitive material so that the developing solution is fed to the photosensitive layer. In the present invention, it is preferable to heat the materials in this superposed state.

A conventional method of immersing the photosensitive material in a development bath can also be used. In this case, there is a method of heating the photosensitive material after it is pulled up out from the development bath, or a method of heating the development bath itself when the chamber is a thin tank having a very small amount of the developing solution. In the latter case, the heat capacity of the developing solution is small, and thus, a system in which the progress of development is terminated upon a rapid reduction in temperature after heating is preferable, and the developing solution is preferably disposed of after being used once.

Hereinafter, the heating means is described. Although a heating means of a known arbitrary method and system can be selected, the following methods are preferable: (1) a blast heating system by warm air or steam, (2) a heating system with infrared radiations or the like, (3) a system of contact electrical heating by heating with a heat roller, and (4) a system of electromagnetic wave heating by irradiation of microwaves.

The blast heating system is a system where the surface of a color film, or as necessary, the back thereof, is heated by exposure to warm air or steam. Impediment heating by use of nozzles for efficient blowing fresh air is preferable. In particular, a ceramic warm air heater is also preferably used. The rate of feeding air in this case is preferably 4 to 20 m$^3$/min, and more preferably 6 to 10 m$^3$/min. A thermostat for preventing overheating of the ceramic warm air heater is actuated preferably by heat conduction, and the position of attachment thereof is preferably at the downwind or windward side through a heat dissipating fin or a heat conductive part. In addition, a method of heating with steam is also preferable.

The air temperature is 40 to 100° C., preferably 50 to 90° C.

The infrared heating system is a system where non-contact heating is conducted by a lamp such as a tungsten lamp having may near infrared radiation components or by a ceramic heater or electric heater for irradiating far infrared radiations. The wavelength of the near infrared heater is in the range of 0.8 $\mu$m to 1.0 mm, and in particular, heating with heat rays having a wavelength range of 2500 to 25000 nm by a far infrared heater is preferable. The temperature of the surface of the heater for irradiating near infrared radiations or far infrared radiations is about 50 to 300° C., and the temperature of the surface of a color film is 40 to 100° C., preferably 50 to 80° C. for heating.

As the electric heater for irradiating infrared radiations, a bar-shaped (straight) heater, which uses using a bar-shaped electrical heating resistor such as ceramic or Nichrome wires, or a facial radiation heater, which has electrical heating bars bent to be sufficiently contacted with one another in a plate form, is used. Further, a panel heater using a plate-shaped electrical resistor such as ceramic may also be used.

The contact heating system is a system where a heated heat roller is pressed on the surface or the back of a color film. The heat roller referred to herein is a roller using a metal having good thermal conductivity (e.g. aluminum, stainless steel, iron, copper etc.) or a plastic material (e.g. bakelite) equipped therein with a heat source (e.g. a metallic resistant heating element, a halogen lamp etc.) capable of controlling temperature for heating the outer periphery thereof. This conveying roller has a suitably heated outer periphery, with the outermost peripheral part coated with a material such as Teflon or silicon rubber which distributes heat uniformly without adhering to the film. The heat roller for the present invention preferably has a diameter of 12 to 80 mm and a length of 3 to 110 cm.

The surface temperature of the heat roller is 40 to 150° C., more preferably 50 to 100° C. The heat rollers may be arranged preferably in a staggered arrangement or in an opposing arrangement, particularly an opposing arrangement.

Heating drum development using a heat drum in place of the heat roller can also be used in the present invention, but description thereof is omitted because there is no substantial difference from the heat roller heating system except for a large diameter of the drum and use of one drum.

In the electromagnetic wave heating system, microwave heating is usually used. As the vibration device for microwaves, a magnetron, claistron or a traveling-wave tube for electron vibration is used, and in particular, a magnetron is preferable for the purpose of the present invention. Microwave heating by a vibration wavelength of 915 or 2450 MHz (megahertz), particularly 2450 MHz (megahertz), is preferable.

For the uniform distribution of microwaves on the surface of the color film, light exposure is conducted preferably by rotating or moving the color film and/or the vibration source. A system where the color film is conveyed and exposed to light successively by a plurality of arranged vibration sources is also preferably used.

Although any of the heating systems described above can be preferably used in the present invention, in particular, the warm-air heating system and infrared radiation heating system are preferable because they are non-contact types which do not cause staining and are easily maintained. In particular, the steam heating system and far infrared radiation heating system are preferable.

A combination of these systems can be used for more rapid and uniform heating.

Hereinafter, actual heat drying is exemplified, but the form of the heat drying used in the present invention is not limited to the following example.

Figure 32:
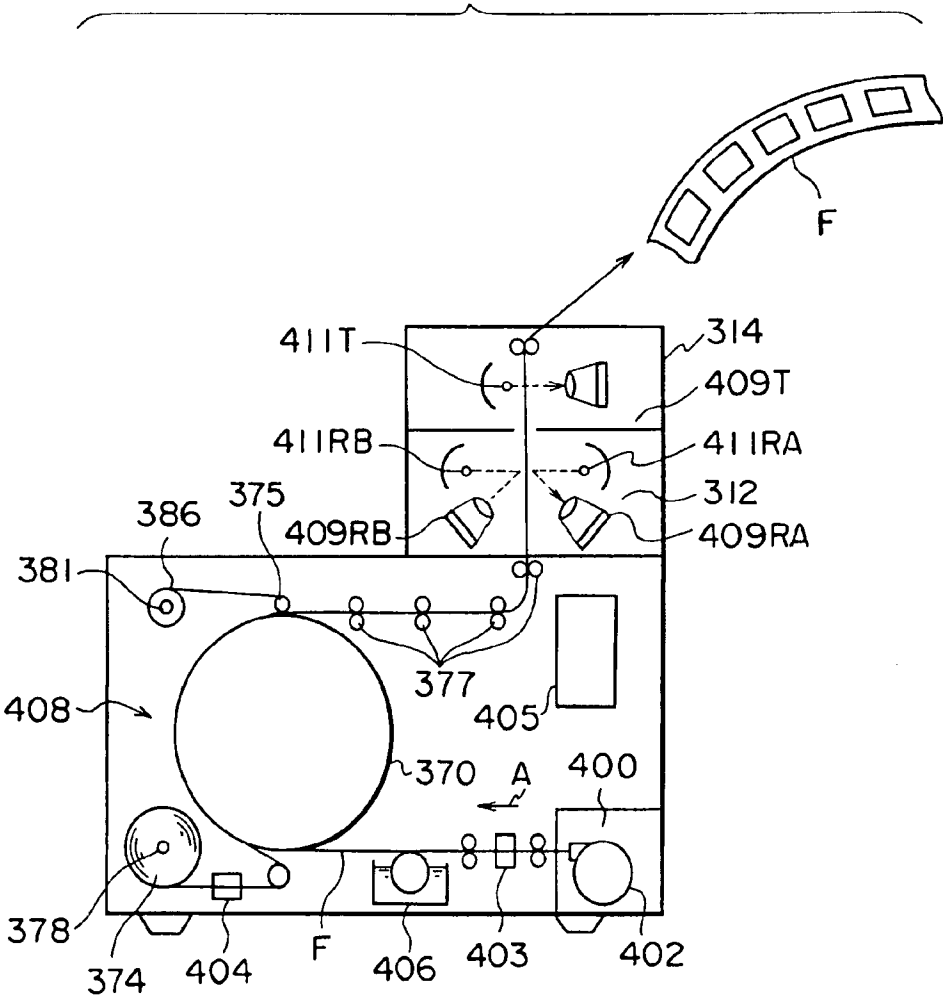
FIG. 32 is a schematic diagram showing a color image forming device used in one mode of the color image forming method of the present invention, wherein coating heat development is conducted by using coating application in combination with a heating drum.

FIG. 32 is an outline of a structure where the feeding of a viscous developing solution by roller coating is combined with contact heating by a heating drum. Both the constitution of the device and the development action on a film in the device are described. Color film F is joined to a delivery leader in a film joining chamber 400 and then sent in the direction of arrow A via a film detecting member 403. The photosensitive layer side (lower side) of color film F is coated with a developing solution by a roller in a viscous liquid-containing liquid bath 406. A cover film 374 for preventing uneven distribution of water in the direction of depth of the photosensitive layer, which uneven distribution is caused by rapid drying of the surface of the film upon heating, is sent from a cover film roll 378 and then laid on the coated face of roller-coated film F. In this state, the laminated materials are trained halfway round a heating drum 370 in the clockwise direction as shown in the drawing, to reach a peeling roller 375. The film F is heated and developed, during which evaporation is prevented so that there is no loss in heat due to evaporation latent heat, whereby the film F is heated uniformly in the direction of depth of the photosensitive layer to permit development to proceed effectively. The cover film is wound on a winding roller 381 via the peeling roller 375. After the cover film is removed, the film F is separated from the heating drum 370. Once heating is thus finished, development is terminated and simultaneously the film begins to be dried by evaporation of water through the surface. Then, the film F is sent to the first image reading parts 312A and 312B by a guide roller 377, and the reflected image on both surfaces of the film is read by reading sensors 409RA/409RB by means of reading light sources 411RA and/or 411RB. After reading of the first image information, film F is sent to the second image information reading part 314, and the transmitted image is read by a reading sensor 409T by means of a reading light source 411T. In the present embodiment, the surface temperature of the heat drum is 50 to 120° C., and the temperature is preferably 80 to 100° C. Further, the developing solution contains a viscosity-imparting agent as described below, and is a color or black and white developing solution having the composition as described below.

Figure 33:
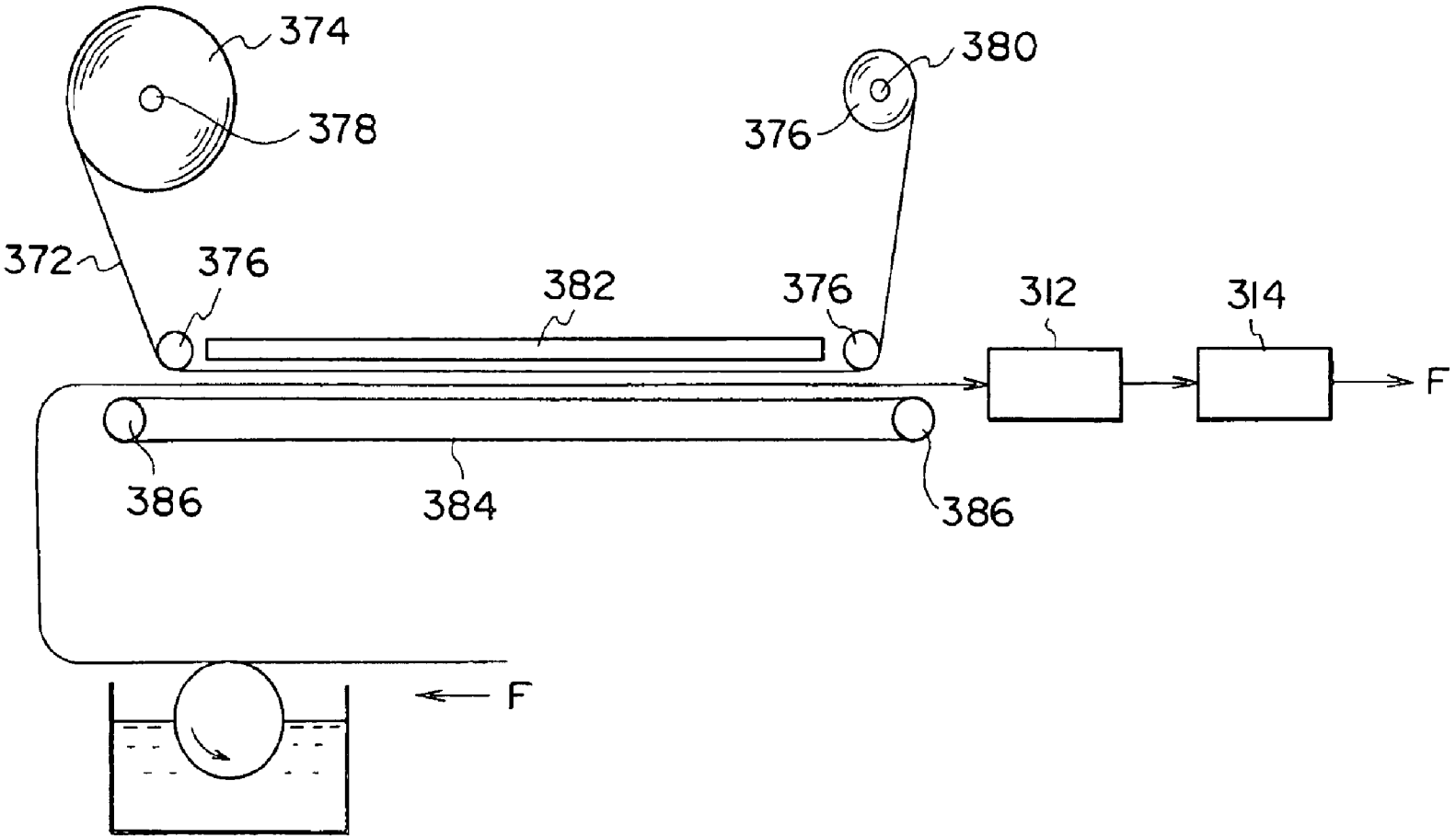
FIG. 33 is a schematic diagram showing a color image forming device used in one mode of the color image forming method of the present invention by using a processing solution web in combination with contact heating.

FIG. 33 shows an outline of a structure where the web treatment, which is used in the present invention and uses a development process web, is combined with contact heating. The roll of a treatment web 374 having the developing solution included therein is attached to a delivery roll 378. Color film F is conveyed in the direction of the arrow by a belt conveyer 384 trained in an endless manner between rollers 386. The film is coated with water by a roller coater in a lower part in FIG. 33, and is then contacted with the treatment web and simultaneously heated by a plate-shaped electric heater 382, to effect development. Tension rollers 386 at both ends provide tension suitable for delivering the film to the belt conveyer 382. Out of guide rollers 376 at both ends of the electric heater 382, the guide roller 376 at the side of the inlet permits the photosensitive layer of the film to be brought into contact with the treatment web, and the web film is removed from the color film by the roller 376 at the side of the outlet and then wound on a winding roller 381. The developing time is limited to the time during which the electric heater is contacted with the color film. The developed film is discharged from a contact heating part 382 and sent to the first image information reading parts 312A and 312B and then to the second image information reading part 314.

In the contact heating system using the treatment web described in FIG. 33, the temperature of the heating plate 182 is preferably from 50 to 100° C., more preferably from 60 to 90° C.

Figure 34:
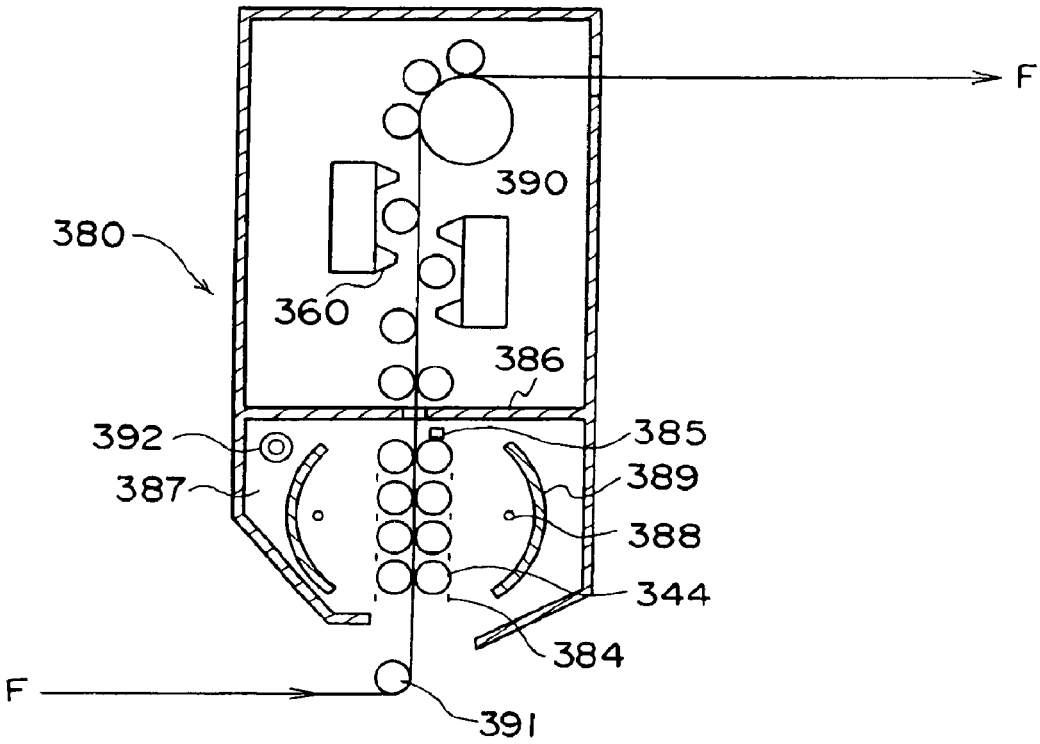
FIG. 34 is a schematic diagram showing one mode of a heating part for carrying out heat development in the present invention by using infrared radiation heating in combination with contact heating.

FIG. 34 shows an outline of a structure in another heating system wherein far infrared heating is combined with heat roller contact heating. A developing solution-feeding part combined with the heating part in FIG. 34 may be formed in any manner, and the structure of only the heating part is shown in this drawing.

Color film F to which the developing solution was supplied passes through a plurality of heat rollers 344. Because a pair of heat rollers 344 also serve as conveying rollers, film F is subjected to contact heating and simultaneously conveyed upward in the casing of the heating chamber 380. Further, electromagnetic wavelength heating is applied to the film by a far infrared lamp 388 and a reflection plate 389 arranged around the lamp. The heating chamber 380 is divided by a shielding plate 386 into a heating part 387 and a state-regulating chamber 390. A shielding plate (not shown) at the inlet of the heating part 387 to which film F is sent, and a shielding plate 386 at the top of the heating part 387, suppress dissipation of heat in the heating part.

A temperature sensor 384 is provided at the inlet of the heating part 387, and a temperature sensor 385 is provided at the outlet. In another mode, the heating part 387 is kept preferably at a high temperature with steam supplied through a jetting hole 392 so that development is not terminated.

In the state-regulating chamber 390 disposed above the upper shielding plate 386 in the heating part 387, warm air is sent from warm air nozzle 360 and blown perpendicularly onto film F, thereby regulating the state of the dried photosensitive material. A part of the warm air blown from the warm air nozzle 360 is introduced into a heating part 387 via a blast port (not shown in the drawing), to dehumidify the heating part 387. Warm air blown through the warm air nozzle 360 is supplied by sucking fresh air from the outside of the device through an air-introducing hole (not shown) formed in the casing of the drying part 387.

In the heating part 387, an inlet temperature sensor 384 for detecting the temperature of the heating part 387 is provided at the upstream side and the inlet side from the center in the direction of conveying of film F. This temperature sensor 384 (e.g., a thermistor, thermocouple etc.) is connected to a controller (not shown) for controlling the temperature of the heat rollers 344 and a far infrared lamp 388 so as to keep the heating part 387 at a predetermined temperature.

Next, operation of the drying device in the present embodiment is described. The film having passed through the first image reading parts 312A and 312B is sent by a pair of conveying rollers to the side of inlet of the heating part 387. In the heating part 387, the film F is subjected to contact heating while being conveyed upward by a pair of heat rollers 344 also serving as conveying rollers. The heating temperature of a pair of heat rollers at the side of the inlet is set preferably higher than the heating temperature of a pair of heat rollers at the downstream side.

When the film F is heated by a heater, it is heated by contact heating with the heat rollers as described above, and simultaneously, film F is heated by irradiation with far infrared radiations emitted by a far infrared lamp 388. Heat drying by radiation is thereby conducted along with contact heating. Thereafter, film F is sent to a state-regulating chamber 390 over a shielding plate 386, and after the state of film F is regulated by warm air blown toward the film through drying air nozzle 360 in the chamber, the film is sent to the first image reading parts 312A and 312B and then to the second image reading part 314.

In both of the cases of FIGS. 33 and 34, the surface of the color film is contacted with air in the heating step so that, as the development reaction proceeds, water is reduced and the surface is dried, whereby scattering of light on the photosensitive layer is decreased and transparency is increased, to bring about conditions preferable for reading by transmitted light. There adding by reflected light is not hindered by drying, and thus after the heat development, the film can be subjected to the first and second image reading without any additional treatment.

In the present embodiment, film F can be heated rapidly and efficiently, and after the heating time has elapsed, the film can be returned rapidly to room temperature (ambient temperature) without heat inertia time. In addition to the advantages described above, the heating used in this example is not only high-temperature heating but also short heating, so there is neither an increase in the unit of the consumed energy nor an increase in noise and costs.

The development process time is 3 seconds to 1 minute, preferably 5 seconds to 60 seconds for black and white development, or 5 seconds to 2 minutes, preferably 10 seconds to 2 minutes for coloring development. The treatment temperature in the respective embodiments is described above, but the general heat development temperature in this system is in the range of 20 to 100° C., preferably 33 to 90° C.

The development process is as described above, and the reading of image information and the image processing of the read information are described below.

3. Reading of an Image

Reading of an image is essentially the same as "4. Reading of an image" in the third aspect described above, and thus, only the different features are described.

In FIG. 31, the position of the first image information reading parts 112A and 112B and the position of the second image information reading part 114 may be different from those in FIG. 1. That is, the second image information reading section 114 may be arranged upstream of the first image information reading parts 112A and 112B.

Figure 35:
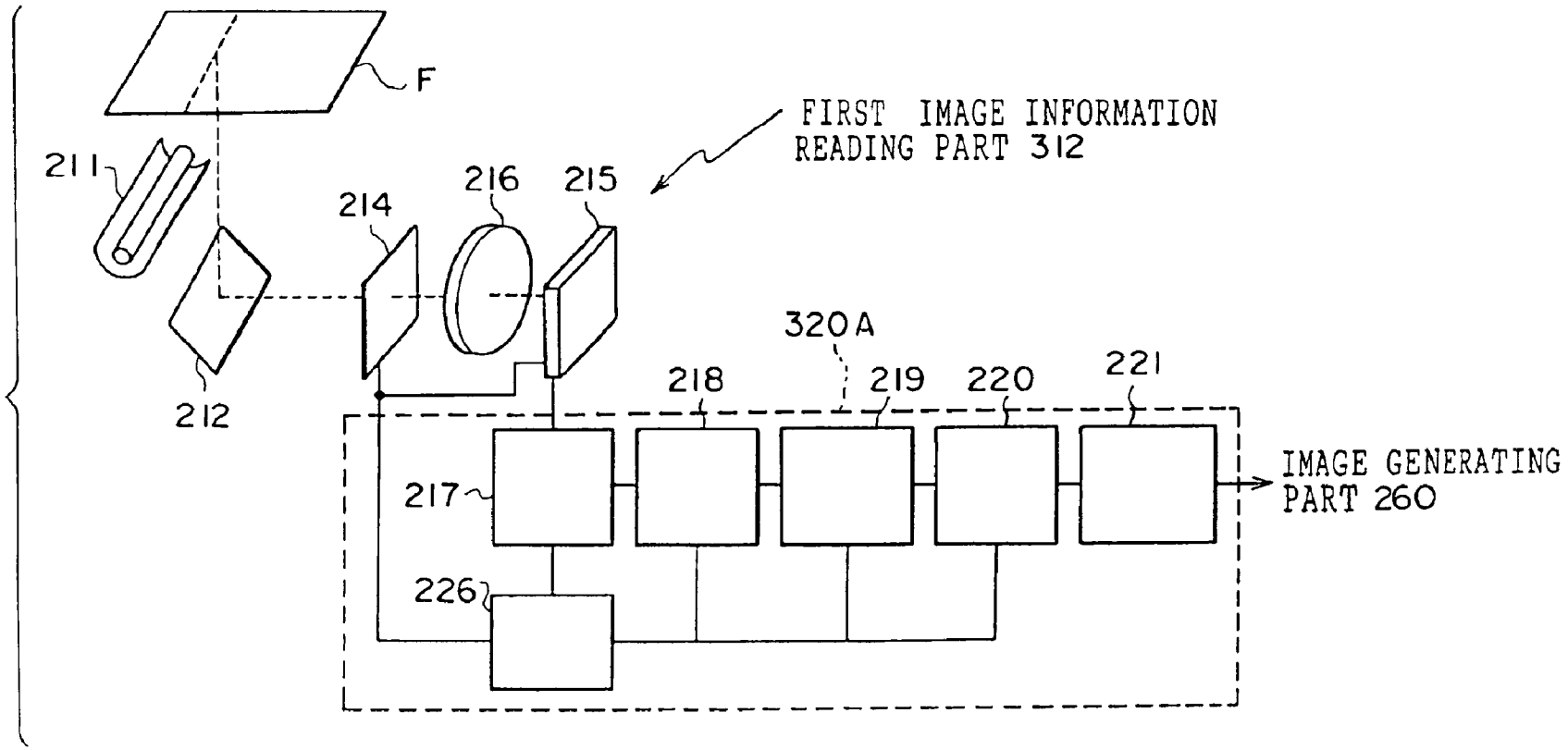
FIG. 35 is a block diagram schematically showing the structure of the first image information recording part 312.

FIG. 35 shows an outline of the structure of the first image information reading parts 312A and 312B forming the first image information reading part 312. In the following description, the first image information reading part 312 reads an image photoelectrically by reflected light from either of the front and back of film F, so one kind of first image information is read. Accordingly, if two kinds of first information are to be read by reading the image photoelectrically by reflected light from the surface and back sides of the film F, the reading optical system shown in the drawing may be provided at the surface and back sides of film F. As shown in FIG. 35, the first image information reading part 312 is formed to be capable of reading the image photoelectrically by detecting reflected light from the front side of film F (at the side of the emulsion) after exposure to light, whereby the first image information is obtained. The first image information reading part 312, at the side of the emulsion, has a light source 211, a mirror 212 for reflecting light which was emitted by the light source 211 and reflected from the surface of film F, a light-regulating unit 214 capable of regulating the amount of light, a CCD area sensor 215 for detecting reflected light photoelectrically, and a lens 216 for making an image of the reflected light on the area sensor.

The first image information obtained by the first image information reading part 312 is supplied to the image processing part 320 shown in FIG. 31. The image processing part 320 is composed of an image processing part 320A for converting the first image information into digital signals and an image processing part 320C for converting the second image information described below into digital signals. If reading by reflected light is conducted twice at the front and back sides of film F, an image processing part is further added for converting the other kind of first image information into digital signals. The image processing part 320A has an amplifier 217 for amplifying the image signal detected and formed photoelectrically by the CCD area sensor 215, an A/D converter 218 for digitalizing the image signal, a CCD correcting means 219 for correcting sensitivity fluctuation or dark current for each image for the signal digitalized by the A/D converter 218, a log converter 220 for converting the image data into density data, and an interface 221. These elements are regulated by CPU 226.

In the structure shown in FIG. 31, an image on the film at different positions is by arranging a plurality of light sources in the first image information reading parts 312A and 312B and the second information reading part 314. In particular, in black and white development, the image on film F can be read photoelectrically by obtaining reflected light and transmitted light by use of a single light source emitting infrared radiations. In this case, a CCD sensor for reading reflected light is disposed at the same side as in the light source, while a CCD sensor for reading transmitted light is disposed at the side of the film F opposite to the side at which the light source is provided. The image on film F is read by simultaneously actuating the 2 CCD sensors synchronously with lighting of the light source.

The first and second image information read in the first and second image information reading parts 312A, 312B and 314 is input to an image forming part 260.

Figure 36:
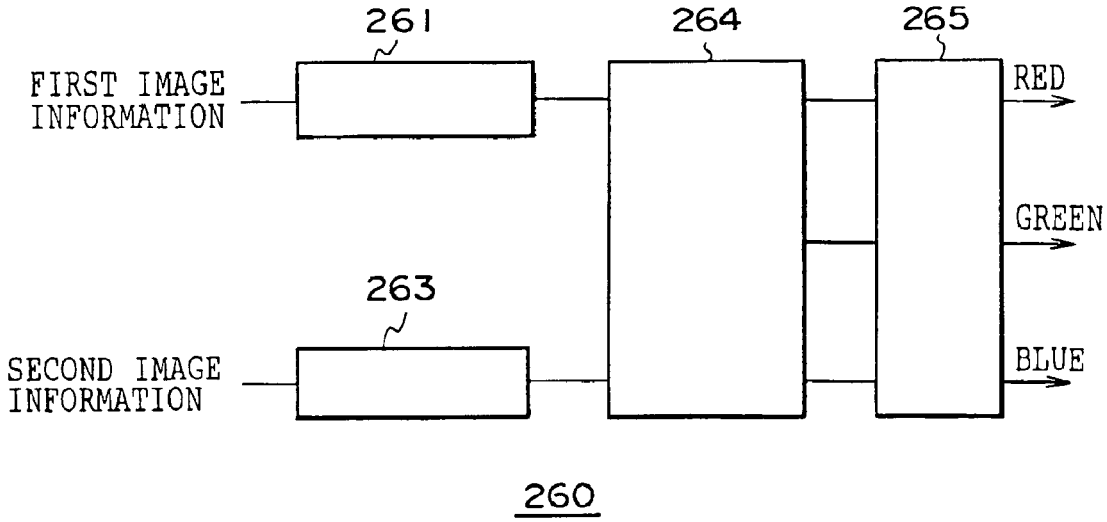
FIG. 36 is a block diagram showing an image forming part 260.

FIG. 36 shows the structure of the image forming part 260, and has a memory 261 for storing the first image information, a memory 263 for storing the second image information, a linearly converting section 264 for weighting the red, green and blue image information contained in the first image information and the red, green and blue image information contained in the second image information with predetermined factors by known linear conversion, and an adding part 265 for separating and deriving the red, green and blue monochromic image information by an adding treatment based on the weighted result. Digital image data on each color obtained in the image forming section 260 is output to a digital image processing part 270.

In the image reading described above, the image on film F is read once by reflection in the first image information reading parts 312A and 312B and once by transmission in the second image information reading part 314. This system can be applied to either black and white development or coloring development. In black and white development, the SN ratio of the obtained signal is worsened, but can be compensated for by reading the image twice at the front and back sides of the film in the first image information reading parts 312A and 312B.

4. Photosensitive Material Used in the Present Invention and Supplementary Description Related Thereto The photosensitive material used in the present invention and supplementary description related thereto are essentially the same as in "5. Photosensitive material used in the present invention and supplementary description relating thereto" in the third aspect described above, and only different features are described.

In the present invention, heat drying is conducted after reading of the first image information, and rapid and efficient drying is desirable. Thus, a polyester support sufficiently stable at the heating temperature is desirable.

[Thirteenth Aspect]

The thirteenth aspect of the present invention is described specifically in the following order:

1. Process scheme for the color image-forming method of the present invention;
2. Development process;
3. Clarification process;
4. Reading an image, and image processing including conversion thereof into digital image information; and
5. Color photosensitive material used in the present invention and supplementary description relating thereto 1. Process Scheme for the Color Image-forming Method of the Present Invention The process scheme for the color image-forming method of the present invention is essentially the same as in "1. Process scheme for the color image-forming method of the present invention" described above in the third aspect, and only differing features are described.

Figure 37:
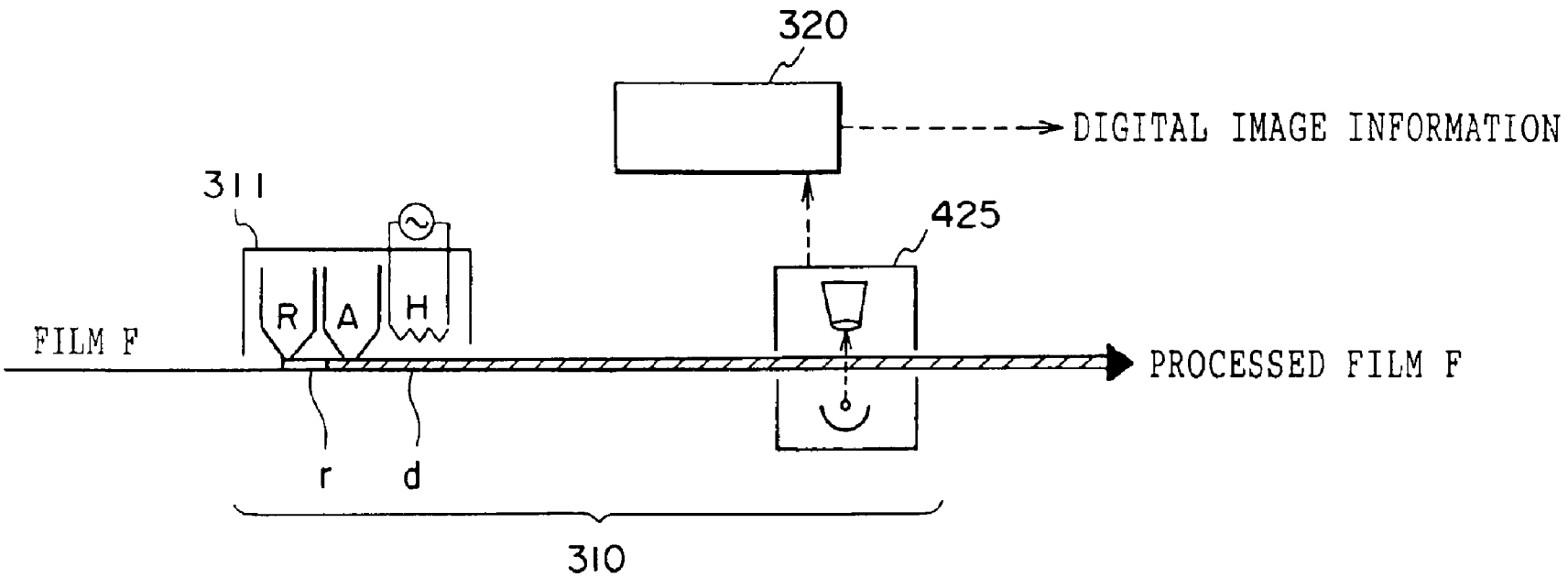
FIG. 37 is a block diagram schematically showing the flow of the processes in the thirteenth aspect of the present invention.

FIG. 37 is a block diagram schematically showing the process scheme for the thirteenth aspect of the present invention.

In FIG. 37, the film treating and image reading part 310 includes a developing part 311 and an image information reading part 425. Color film F is introduced into the image-forming device and then sent to the film treating and image reading part 310 and subjected to development process in the developing treatment part 311, and an image is formed on each of 3 photosensitive layers, that is, the surface, back and intermediate photosensitive layers. The development part 311 includes a developer solution-feeding device and a heating device H. The developing solution-feeding device includes a device R for feeding a major developing solution, with a pH value of 7 or less, and a device A for feeding an alkali agent solution, and the developing agent solution and/or the alkali agent solution containing other components constituting the developing solution. When these solutions are fed in a regulated ratio from the devices R and A to the color film F, these solutions are mixed to form the composition of the developing solution. Color film F to which the developing solution was fed in the form of the developing agent solution and the alkali agent solution is heated in the heating device H, whereby development is substantially initiated. The color film F after heat development is sent to the image information reading part 425, and the image elements comprising the image are read by an image scanner (not shown), to provide image information. In FIG. 37, the image information reading part 425 schematically shows a system of reading by reflected light, but reading of the image is preferably conducted by a combination of reading by reflected light and reading by transmitted light. The image information is electrically sent in the form of time-series electrical signals to the image processing part 320, converted into digital signals so as to permit image processing, and converted into electrical digital image information of blue, green and red color components.

In the method of forming a color image according to the present invention, the development process of a color film may be mere development process and does not require post-treatments such as silver removal and bathing, conventionally carried out after development process. Accordingly, the step of treating the color film is very easy and rapid. Additionally, the developing solution is supplied in the form of a developing agent solution and an alkali agent solution which are not mixed until just before development, and can thus be stored in stable forms, so that the developing solution does not deteriorate, image qualities are maintained, the storage and management of the developing agent is easy, thus satisfying the object of the present invention in respect of rapidness, convenience and image qualities.

2. Development Process

The development process is essentially the same as described above in "2. Development process" in the eleventh and twelfth aspects, and only differing features are described.

First, the system of feeding the developing solution is described (the developing agent solution and the alkali agent solution), that is, a specific form of development process, and then the heating system is described.

The system of feeding the developing solution to the photosensitive layer of a color film can make use of various systems known in the art. For the developing agent solution, systems such as the following may be used: an immersion treatment system of immersing the color film in the developing agent solution, a coating system of coating the developing agent solution onto the surface of the color film, a spraying system of spraying the developing agent solution on the surface of the color film, and/or sheet treatment (or web treatment) of diffusing and feeding the solution by bringing a web or sheet impregnated with the developing agent solution into contact with the surface of the color film. For the alkali agent solution, the coating system, spraying system or sheet treatment (or web treatment) is preferable.

Various combinations of these 4 feeding systems for the developing agent solution and these 3 feeding systems for the alkali agent solution may be used, and the feeding systems for the developing agent solution and the alkali agent solution may be the same or different.

The color film to which the developing agent was fed is then subjected to heat treatment.

The developing solution is divided into the stable developing agent solution and the alkali agent solution, and these are not exposed to high temperature such as in high-temperature development, so the developing solution does not deteriorate, handling is more convenient, and techniques to preventing oxidation thereof with air in a container such as a stock tank for storing the developing solution can be simplified. Along with the above-described advantages, development progress is regulated by the feed amount of the developing solution, fogging of the image generating part is suppressed until heating is finished so that development progress is easily regulated, image reading accuracy is greater, and resulting in an image with less color fogging.

The spray treatment is a method of treating the photosensitive material by spraying with the processing solution. This method is advantageous due to easy regulation of the amount of the sprayed processing solution in an amount capable of substantially soaking into the photosensitive material. A preferable spray amount is the same as for coating treatment. In the present invention, the developing agent solution and the alkali agent-containing solution can be supplied via different nozzles and spray-coated through the same head.

A development sheet in the form of a sheet or a development web in the form of a roll provided on a support with a layer carrying a processing solution, such as a polymer layer or a sponge layer having a developing solution absorbed therein can also be preferably used. The processing solution-containing layer in the development sheet or development web is laid on the photosensitive layer of the photosensitive material so that the processing solution is fed to the photosensitive layer. In the present invention, it is preferable to heat these laid materials. The treating layer of the treating member (sheet or web) preferably comprises a water-soluble polymer as a layer carrying the processing solution. Examples are those described in Research Disclosure (RD) 17643, p. 27, RD 18716, p. 651, RD 307105, pp. 873–874, and JP-A No. 64-13,546, pp. 71–75. Among these, gelatin or a combination of gelatin and a water-soluble material (e.g. polyvinyl alcohol, modified polyvinyl alcohol, cellulose derivatives, acrylamide polymers etc.) is preferable.

Then, the method of dividing the components for comprising the developing solution into the developing agent solution and the alkali agent solution is described. The dividing method is conducted in the following manner for achieving storage stability for the processing solution.

(1) Improvement of Storage Stability by Dividing the Components into 2 Solutions The developing agent solution contains a developing agent and a preservative and has a pH value of 7 or less to reduce oxidization from air, and the alkali agent solution contains an alkali agent for conferring development activity. The other components comprising the development solution are contained in the developing agent solution and/or the alkali agent solution so as not to prevent deterioration by interaction with other components, chemical change by air oxidation, or precipitation. Accordingly, the developing agent in the present invention is formed to be highly stable as compared with one-pack developing agents.

The developing agent solution is preferably at pH 0.1 to 6.0, and more preferably at pH 0.5 to 3.0.

(2) Use of a Base Precursor

Because the developing solution is composed of 2 liquids, the alkali agent in the alkali agent solution may be not only an alkali compound itself but also a base precursor for generating an alkali agent upon reaction with constituent components in the developing agent solution. In a particularly preferable combination, there is a system wherein a basic metal compound is contained in the developing agent solution, while a complex-forming compound for releasing a base by complex-forming reaction with a metal ion of the basic metal compound in the presence of water is contained in the alkali agent solution. This complex-forming compound is called a base precursor. By mixing the developing agent solution with the alkali agent solution, a base is released to raise the pH, thus initiating development along with heating action.

The pH thereof before use is not particularly limited, but pH 3 to 9 is suitable.

The system of using the base precursor is described below in more detail.

The development process may use either black and white development or coloring development, and a preferable development solution can be selected depending on the object. The black and white developing solution has advantages in that the development time can further be reduced because of high development activity, the fogging in a non-image part can be suppressed whereby image noise is reduced and the saturation in a color image can be increased, the developing solution is stable and hardly contaminated during development, and management of the solution is easy. On the other hand, when a color developing solution is selected, the reading of images is made feasible by use of color images so that images of high saturation with less mixed color can be obtained.

The pH of the black and white developing agent solution is 7 or less, preferably 0.1 to 6, and upon mixing with an alkali agent solution, the pH becomes 9 to 13, preferably 9.5 to 12.5.

The alkali agent solution using a base precursor is described in further detail. This solution can be combined with any black and white and color developing agent solutions.

As the compound forming a complex with a metal ion, a chelating agent known in analytical chemistry can be used. For example, aminopolycarboxylic acids (including salts thereof) such as ethylene diamine tetraacetic acid, aminophosphonic acids (including salts), pyridine carboxylic acids (including salts thereof) and picolinic acid are used. The complex-forming compound is preferably used in a salt form after neutralization with a base. Particularly, guanidines, amidines etc. are preferable.

The amount of these compounds added to the alkali agent solution is 1 to 10 moles, more preferably 1 to 5 moles per mole of silver applied onto a color film that is used.

Further, the developing agent solution also contains a stoichiometrically equivalent amount of the basic metal compound. A system where a part or all of the alkali agent in this alkali agent solution is replaced by a base precursor is preferable because the processing solution has excellent stability over time during storage, and further coating treatment and sheet or web treatment can be simple and easy in operation.

Further, the alkali agent solution containing the base precursor may contain a surfactant, an anti-fogging agent, a complex-forming compound, an anti-fungus agent and antimicrobial agent, and this alkali agent solution may be composed exclusively of a base precursor and water, depending on the desired function.

The development process time (including the time in the system using a base precursor) is 3 seconds to 1 minute, preferably 5 seconds to 60 seconds for black and white development, or 5 seconds to 2 minutes, preferably 10 seconds to 2 minutes for coloring development. The treatment temperature in individual embodiments is described above, but the general heat development temperature in this system is in a range from 20 to 100° C., preferably 33 to 90° C.

Hereinafter, actual examples of the heating development are described, but these examples are not intended to limit the form of the heating development used in the present invention.

Figure 38:
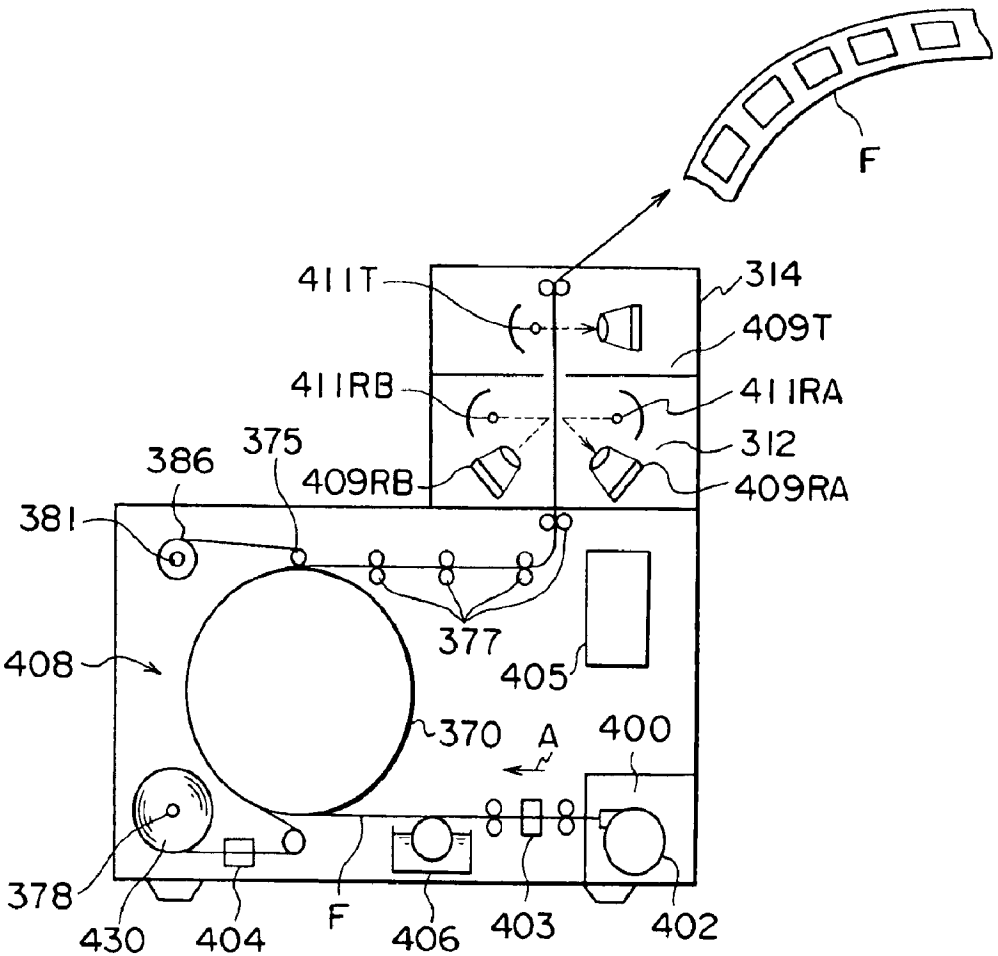
FIG. 38 is a schematic diagram showing a color image-forming device by a heating drum used in one embodiment of the color image forming method of the present invention.

FIG. 38 shows an outline of a structure wherein contact heating by a heating drum is combined with feeding of the viscous developing agent solution by roller coating and the feeding of the alkali agent solution by web treatment. Both the components of the device and the development action on a film in the device are described. Color film F is joined to a delivery leader in a film joining chamber 400 and then sent in the direction of arrow A via a film detecting member 403, and color film F with the photosensitive layer side (lower side) thereof in contact with the roller is coated with a developing solution in a viscous liquid-containing bath 406. An alkali agent web 430 is sent from a delivery roller 378, then impregnated with an alkali agent in an alkali agent solution bath 404 and laid on the color film such that the side impregnated with the alkali agent is brought into contact with the photosensitive layer of the color film, and in this state, it extends approximately halfway around a heating drum 370 in the clockwise direction as shown in the drawing, to reach a peeling roller 375. Meanwhile, film F is heated and developed, during which evaporation is prevented so reduce heat loss due to latent evaporation heat, whereby film F is heated uniformly in the direction of depth of the photosensitive layer to permit development to proceed effectively. The web containing the alkali agent is wound on a winding roller 381 via the peeling roller 375. After the alkali agent web is removed, film F is separated from the heating drum 370, and once heating is finished, development is terminated and simultaneously film drying is initiated by evaporation of water through the surface. Thereafter, film F is sent to an image reading part by a guide roller 377. The number of the image reading part may be 1, but in the mode shown in FIG. 38, the film is sent to the first image information reading part 312, and its reflected image on both surfaces of the film is read by reading sensor 409RA and/or 409RB by means of reading light sources 411RA and/or 411RB. After reading of the first image information, film F is sent to the second image information reading part 314, and the transmitted image is read by a reading sensor 409T by means of a reading light source 411T. In this embodiment, the surface temperature of the heat drum is 50 to 120° C., and the temperature is more preferably 80 to 100° C. Further, the developing solution contains a viscosity-conferring agent as described below, which is a color or black and white developing solution having the composition as described above.

In this embodiment, film F can be heated rapidly and efficiently, and after the heating time is elapsed, the film can be returned rapidly to room temperature (ambient temperature) without heat inertia time. In addition to the advantages described above, the heating used in this example is not only high-temperature heating but also relatively short, so there is neither an increase in energy consumption, nor an increase in noises and costs.

3. Clarification Process

The clarification process is essentially the same as described above in "3. Clarification process" in the seventh and eighths aspects, so only differing features are described.

The composition of the processing solution for clarification process is substantially identical with the composition to that of the fixing solution as described below, but in the case of treatment with color developing solution, a bleaching agent is preferably contained in the clarification processing solution, so that both the developed silver and the remaining silver halide can be removed in a similar manner to the bleaching fixing solution.

The clarification processing solution can make use of a known fixing agent, that is, thiosulfates such as sodium thiosulfate and ammonium thiosulfate, thiocyanates such as sodium thiocyanate and ammonium thiocyanate, thioether compounds such as ethylene bisthioglycolic acid, 3,6-dithia-1,8-octane diol, and water-soluble silver halide dissolving agents such as thiourea, and these can be used singly or in combination thereof. Further, a special bleach fixing solution comprising a combination of a fixing agent and a large amount of a halide, such as potassium iodide described in JP-A No. 55-155354, can also be used. In the present invention, thiosulfates, particularly ammonium thiosulfate, are preferably used. The amount of the fixing agent is preferably in the range of 0.3 to 2 moles/L, more preferably 0.5 to 1.0 mole/L.

Further, a chelating agent, a defoaming agent, an antifungus agent etc. may be added as necessary to the clarification processing solution.

The treatment time for clarification process in the present invention is 5 to 240 seconds, and more preferably 10 to 60 seconds. The treatment temperature is 25 to 90° C. and more, preferably 30 to 80° C. Further, the amount thereof supplemented per $m^2$ of a color film is 20 to 250 ml, more preferably 30 to 100 ml, and most preferably 15 to 60 ml.

A particularly preferable mode of the clarification process in the present invention is a mode of using a fixing treatment sheet or a bleach fixing treatment sheet. Hereinafter, this mode is described, but since the fixing treatment sheet is substantially the same as the bleach fixing treatment sheet, except that a bleaching agent is not contained, the bleaching fixing treatment sheet is described. Further, there is no functional difference, except for shape between the bleach fixing treatment sheet and the treating web having a sheet in the form of a film roll, so the following description also applies to the fixing treatment web and the bleaching fixing treatment web.

In the present invention, a treatment layer as the treatment member in the bleaching fixing treatment sheet uses a water-soluble polymer as a binder. Examples thereof include those described in Research Disclosure (RD) 17643, page 27, RD 18716, page 651, RD 307105, pp. 873–874, and JP-A No. 64-13,546, pp. 71–75. Among these, gelatin or a combination of gelatin and other water-soluble binders (e.g. polyvinyl alcohol, modified polyvinyl alcohol, cellulose derivatives, acrylamide polymers etc.) is preferable.

The bleaching fixing treatment sheet is formed into a hard film with a hardener. Examples of the hardener includes the hardeners described in U.S. Pat. No. 4,678,739, column 41, U.S. Pat. No. 4,791,042, JP-A No. 59-116,655, JP-A No. 62-245,261, JP-A No. 61-18,942, JP-A No. 4-218,044 etc. Specifically, aldehyde-type hardeners (formaldehyde etc.), azilidine type hardeners, epoxy type hardeners, vinyl sulfone type hardeners (N,N'-ethylene-bis(vinylsulfonyl acetamide) ethane etc.), N-methylol type hardeners (dimethylol urea etc.), boric acid, metaboric acid or polymeric hardeners (and also compounds described in JP-A No. 62-234,157).

These hardeners are used in an amount of 0.001 to 1 g, preferably 0.005 to 0.5 g per g of a hydrophilic binder.

In the bleaching fixing treatment sheet, there may be a protective layer, an undercoating layer, a back layer, and a variety of other auxiliary layers.

Further, the bleaching fixing treatment sheet is provided preferably with a treatment layer on a continuous web. The continuous web is in such a form that the bleach fixing treatment sheet is considerably longer than the longer side of the corresponding photosensitive material to be treated with the treatment member in the present invention at the time of the bleach fixing treatment, so that the web can be used for continuously treating a plurality of photosensitive materials without being partially cut for use in the bleach fixing treatment. Generally, the bleach fixing treatment sheet is 5 to 1000 times as long as the width thereof. The width of the bleach fixing treatment sheet is arbitrary, but preferably longer than the width of the corresponding photosensitive material.

The thickness of the support used in the bleaching fixing treatment sheet is arbitrary, but a thinner support is preferable, and the thickness of 4 to 120 $\mu$m is particularly preferable. The thickness of the support is most preferably 40 $\mu$m or less, and in this case, the amount of the bleaching fixing treatment sheet per unit volume becomes greater, so that a roll of the bleaching fixing treatment sheet may be made more compact. A support that is transparent and endurable to treatment temperature is used. In general, photographic supports such as papers and synthetic polymers (films etc.) described on pages 223 and 240 in "Shashin Kogaku No Kiso—Ginen Shashin Hen" (Fundamentals of Photographic Engineering—Silver Halide Photograph", compiled by the Japanese Photographic Society, published by Corona Co., Ltd. (1979) can be used. Specifically, polyethylene terephthalate, polyethylene naphthalate, polycarbonate, polyvinyl chloride, polystyrene, polypropylene, polyimide, cellulose and modified cellulose thereof (e.g. triacetyl cellulose).

With respect to copolymers, copolymers of naphthalene dicarboxylic acid units and ethylene glycol units, as well as copolymers of units of terephthalic acid, bisphenol A and cyclohexane dimethanol, are also preferable.

In the case of polymer blends, polyesters such as polyethylene terephthalate (PET), polyallylate (PAr), polycarbonate (PC), polycyclohexane dimethanol terephthalate (PCT) etc. are blended preferably from the viewpoint of compatibility.

After the bleach fixing treatment, the photosensitive material is removed from the bleaching fixing treatment member and used for reading of its image information directly or after drying.

The method of laying the photosensitive material on the bleach fixing treatment sheet after development process includes the methods described in JP-A No. 62-253,159 and JP-A No. 61-147,244.

4. Reading of an Image

The reading of an image is essentially the same as described above in "4. Reading of an image" in the third aspect, and thus only differing features only are described.

The reading of an image used in the present invention may be in any modes by which the image information on the threed photosensitive layers in the film can be read. In Particular, the following modes are preferable.

(1) Reading by Transmitted Light

The image information recorded in each photosensitive layer in the photosensitive material is read by transmitted light, and on the basis of the image information in the transmitted light, the image information recorded in each photosensitive layer is obtained.

(2) Reading by Reflected Light

The image information stored in the photosensitive layers at the uppermost and lowermost sides of the photosensitive material is read in reflected light, and on the basis of the image information by the reflected light, the image information recorded in the whole of the photosensitive layers is obtained.

(3) Reading by Transmitted Light/reflected Light

This is a combination of reading by transmitted light and reading by reflected light. In this case, there are the following methods: 1) the method in which the image information recorded on both the front and back layers is obtained by reading the image twice by reflected light, and the image information recorded on the interlayer in the photosensitive material is obtained by reading the image by transmitted light and 2) the method in which the image information recorded on either of the front or back layer is obtained by reading the image once by reflected light, and the image information stored in the other photosensitive layer in the photosensitive material is obtained by reading the image twice by transmitted light.

Among these, the method 1) can be applied to black and white development and coloring development. In particular, in the case of coloring development, the image information stored in the interlayer is read by adjusting the wavelength of a light source to that of the interlayer in the photosensitive material. The method 2) can be applied particularly to coloring development, wherein the wavelength of a light source is set such that the image information recorded in the photosensitive layer other than the photosensitive layer read in reading by reflected light, is read by reading the image twice by transmitted light. In this case, when the image information (e.g. red) carried on the photosensitive layer at the side of the support is read by reading reflected light, the wavelength of the light source for first reading by transmitted light is set to read the image information (blue) carried on the photosensitive layer positioned at the front side, and the wavelength of the light source for a second reading by transmitted light is set to read the image information (green) carried on the photosensitive layer positioned in the middle. Alternatively, when the image information (e.g. blue) carried on the uppermost photosensitive layer positioned at the front side of the photosensitive material is read by reading reflected light, the wavelength of the light source for first reading by transmitted light is set to read the image information (red) carried on the lowermost photosensitive layer positioned at the side of the support, and the wavelength of the light source for a second reading by transmitted light is set to read the image information (green) carried on the photosensitive layer positioned in the middle.

The reading by reflected light and transmitted light described above, can be conducted in the following manner. Specifically, it is possible to use a line CCD-scanning system in which a line CCD having light receiving elements arranged one-dimensionally is used to read the density of an image while sub-scanning of the image on a developed film and the density is converted in an electrical signal by the line CCD. Alternatively, an area CCD system may be used in which an area CCD having light receiving elements arranged two-dimensionally is used to read the density of an image and the density is converted into an electrical signal arranged in time series by electrical scanning by the area CCD.

Figure 39:
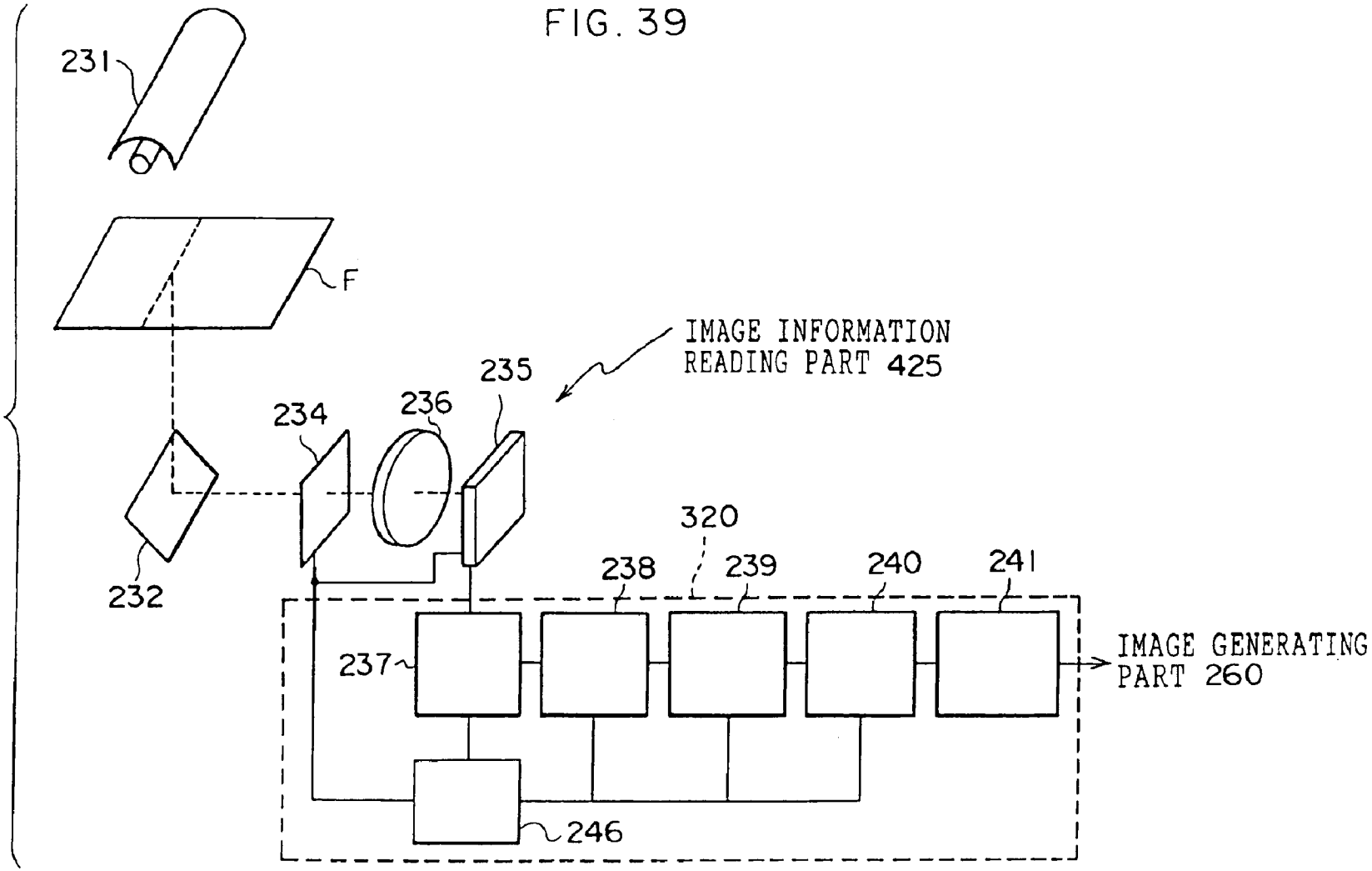
FIG. 39 is a block diagram schematically showing the structure of an image information reading part 425.

An example is described where the image information reading part 425 shown above in FIG. 37 is read by transmitted light and by using an area CCD. FIG. 39 shows an outline of the components the image in formation reading part 425. As shown in FIG. 39, the image information reading part 425 is capable of reading a color image photoelectrically by detecting light transmitted through film F exposed to light, and has a light source 231 arranged at the back side of film F, a reflection mirror 232 for reflecting light emitted from the light source 231 and transmitted through film F, a light-regulating unit 234 capable of regulating the amount of light, a CCD area sensor 235 for detecting transmitted light photoelectrically, and a lens 236 for creating an image with the transmitted light on the area sensor. Alternatively, the light source 231 may be arranged at the front side of film F so as to detect the light transmitted from the front side.

The digital image information obtained in the image information reading part 425 is fed to an image processing part 320. The image processing part 320 has an amplifier 237 for amplifying the image signal detected and formed photoelectrically by the CCD area sensor 235, an A/D converter 238 for digitizing the image signal, a CCD correcting means 239 for correcting sensitivity fluctuation or dark current for each image for the signal digitized by the A/D converter 238, a log converter 240 for converting the image data into density data, and an interface 241, which are all regulated by CPU 246.

In the area CCD in the image reading part 425, a plurality of image elements for detecting light are arranged two-dimensionally along the length and width directions of film F, and has the function of accumulating charges depending on the light received by the whole image elements and can electrically read the (two-dimensional) frame image. The area CCD has been mainly described, but the line CCD can be used in place of the area CCD. In the line CCD, a plurality of image elements for detecting light are arranged linearly along the width direction of film F and have the function of accumulating charges depending on the light received by the line image elements and electrically read the (one-dimensional) image.

As the light source applicable to the image information reading part 425, infrared radiations or laser rays are preferable. The wavelength of infrared radiations is 800 to 1200 nm, preferably 850 to 1100 nm.

5. Photosensitive Material Used in the Present Invention and Supplementary Description Relating Thereto The photosensitive material used in the present invention and supplementary description relating thereto are essentially the same as described above in "5. Photosensitive material used in the present invention and supplementary description relating thereto" in the third aspect, and only different features are described.

In the present invention, heat drying is conducted after reading of the first image information, and because rapid and efficient drying is desirable, the support is preferably sufficiently stable to at the heating temperature.

[Fourteenth Aspect]

The fourteenth aspect of the present invention is described in detail in the following order.

1. Process scheme for the color image-forming method;
2. Development process;
3. Reading of an image; and
4. Color photosensitive material used in the present invention and supplementary description relating thereto 1. Process Scheme of the Color Image-forming Method The process of the color image-forming method is the same as described above in "1. Scheme of the process of the color image-forming method of the present invention" in the third aspect, and only differing features are described.

Figure 40:
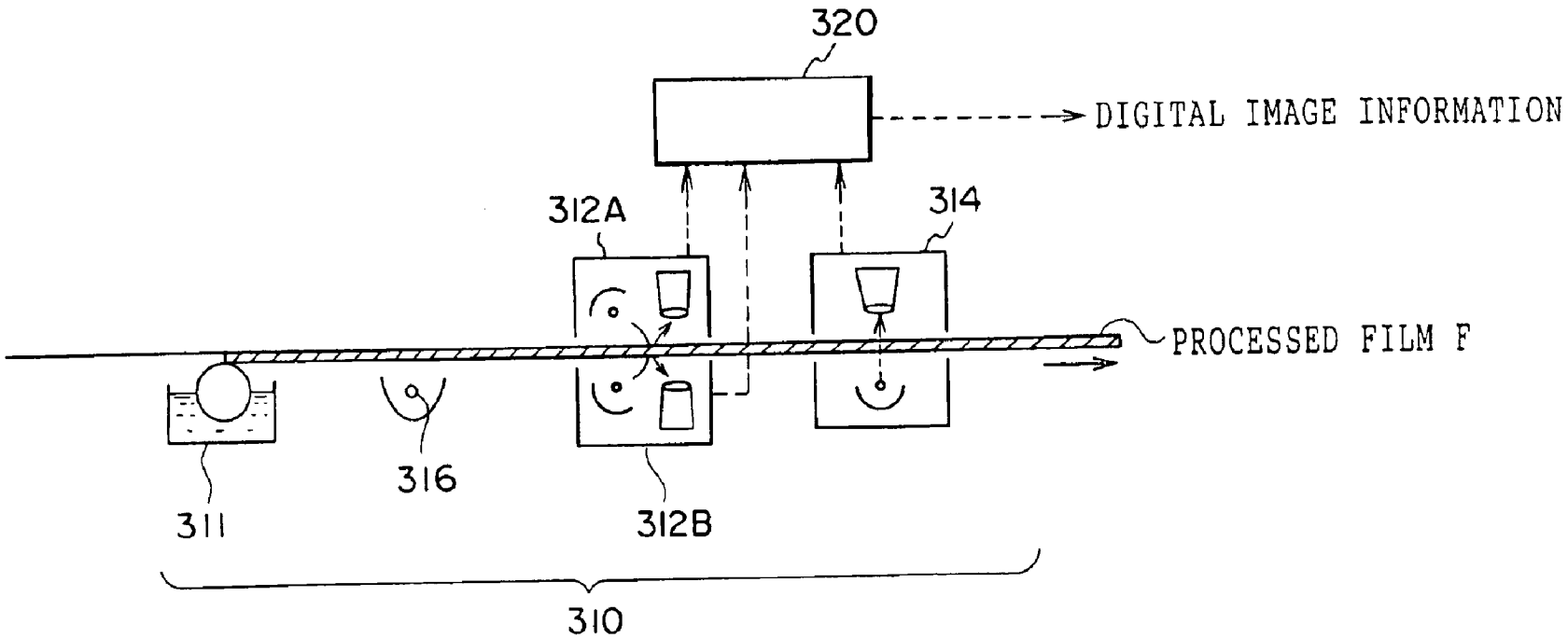
FIG. 40 is a block diagram schematically showing the flow of the processes in the fourteenth aspect of the present invention.

FIG. 40 is a block diagram schematically showing the process scheme of the fourteenth aspect of the present invention.

In FIG. 40, the film development treating and image reading part 310 comprises of a developing part 311 for an exposed developing color film F, a heating part 316 for heating color film F, first image information reading parts 312A and 312B using reflected light, and a second image information reading part 314 using transmitted light. The position of the first image information reading parts 312A and 312B and the position of the second image information reading part 314 may be exchanged so that the image may be read first by transmitted light. Further, either of the first image information reading parts 312A and 312B using reflected light or the second image information reading part 314 using transmitted light may be used.

Color film F is introduced into the image forming device and transferred to the film treating and image reading part 310 and subjected to development process in the developing treatment part 311, and an image is formed on the 3 photosensitive layers, that is, the front layer, back layer, and interlayer therebetween. In the development part 311, the developing solution is applied by, for example, by a roller onto the surface of the photosensitive layer (lower side). A heating device 316 substantially initiates development of the color film F, having the developing solution fed thereto, by heating.

The color film F after heat development is then sent to the first image information reading parts 312A and 312B, and the image elements forming the image are read by an image scanner (not shown) in a reflection light system, to obtain the first image information. In FIG. 40, the first image information reading part 312 shows an image information reading part 312A for reading the image from the back side, and an image reading part 312B for reading the image from the front side, but it is not always necessary to read both sides, as there are cases where only one side is read. The color film F after reading of the first image information is sent to the second image information reading part 314, where the image is read photoelectrically by an image scanner (not shown) in a transmission light system, to give the second image information. The first and second image information obtained is transmitted in the form of time-series electrical signals to the image processing part 320, converted into digital signals so as to permit image processing, and converted into electrical digital image information of blue, green and red.

Figure 41:
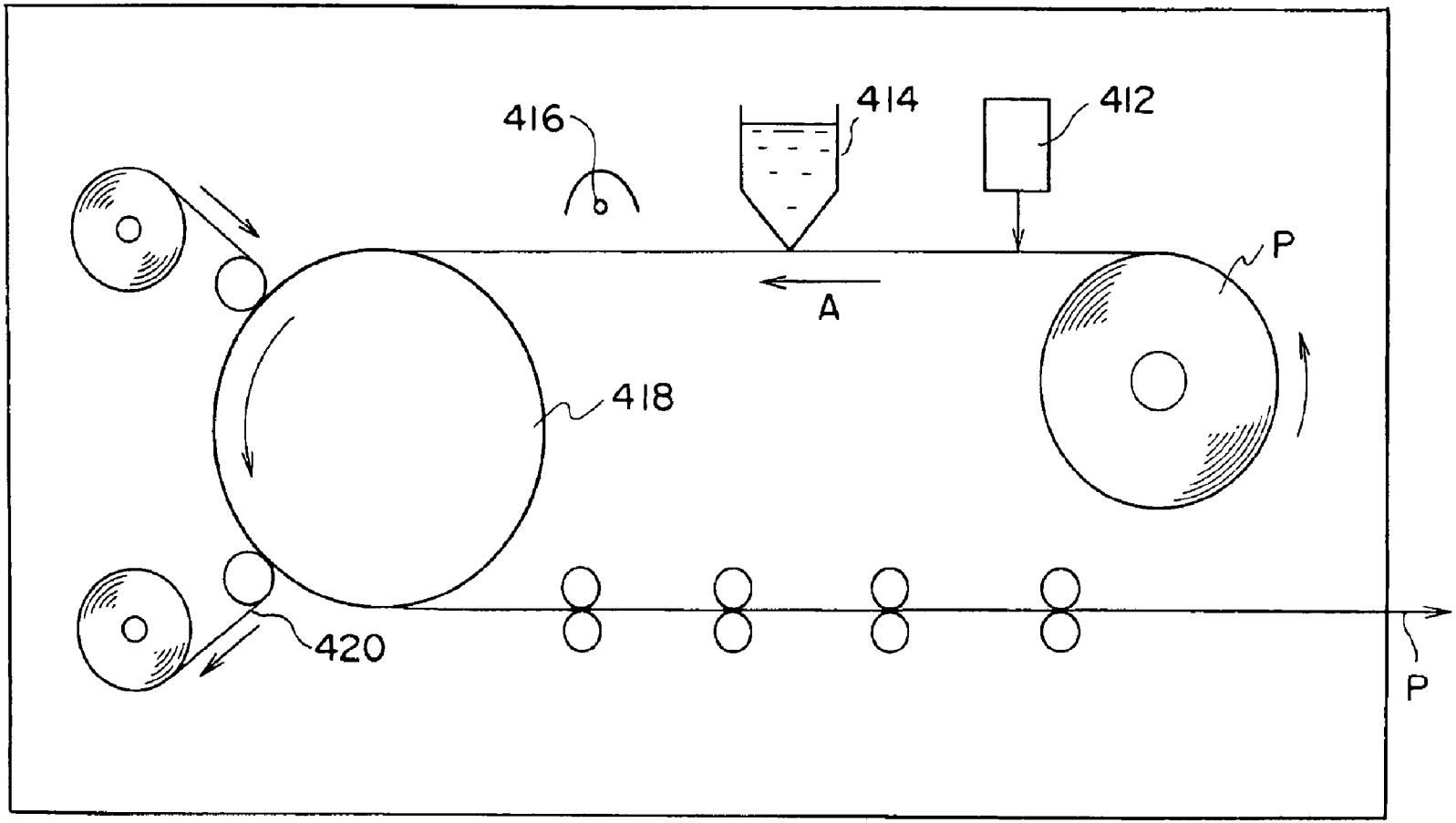
FIG. 41 is a schematic structural diagram showing a photosensitive material-treating device of the present invention.

Further, application of the present invention to a color paper is schematically shown in FIG. 41.

Color paper P wound in the form of a roll is subjected to digital light exposure by a digital light exposure device 412 and then coated with the developing solution in a development part 414, and then heated by a far infrared heater 416. Then, color paper P is wound on the peripheral surface of a heating drum 418, while its developed side is placed in contact with a bleach fixing sheet 420 and subjected to bleaching fixing treatment heat by a heating drum 418.

When the present invention is applied to a color paper, the development process of the color paper is also significantly simplified. Further, the bleach fixing sheet etc. can be used during treatment to provide a film with a sense of dryness.

2. Development Process

The development process is essentially the same as described above in "2. Development process" in the eleventh and twelfth aspects, and thus only differing features are described.

Specifically, the following systems can be used as the method of feeding the developing solution to the photosensitive layer and the method of heating the photosensitive material having the developing solution fed thereto, but these are not intended to limit the mode of the present invention:

(1) A system where the developing solution is fed to the photosensitive material, and then the sensitized material, having the developing solution absorbed therein, is heated.

(2) A system where the photosensitive material is heated by exposing it to far infrared radiations, and the developing solution not heated is fed on to the face of the photosensitive material, and upon feeding the developing solution thereto, heat development is initiated.

(3) The photosensitive material is immersed in a development bath, and the photosensitive material having the developing solution fed thereto is rapidly heated as such in the case of a small heat capacity, or after removal from the development bath in an other case.

(4) The surface of the photosensitive material at the side of the photosensitive layer is laid on a development treating sheet, having a developing solution included therein, and then heated in this state.

Hereinafter, the heating method is described. The heating method makes use of a far infrared heater. The far infrared heater is preferably capable of heating by heat rays with wavelengths of 3 μm to 1 mm. The surface temperature of the heater for irradiating far infrared radiations is about 50 to 300° C., and the surface of the color film is heated at 50 to 90° C., preferably 50 to 80° C.

Figure 42:
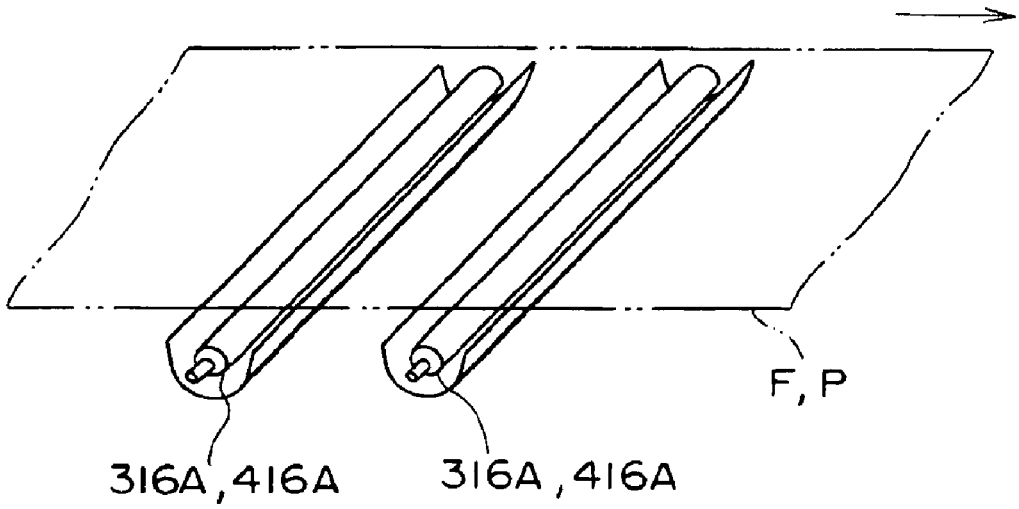
FIG. 42 is a perspective view showing a bar-shaped far infrared heater used in the present invention.
Figure 43:
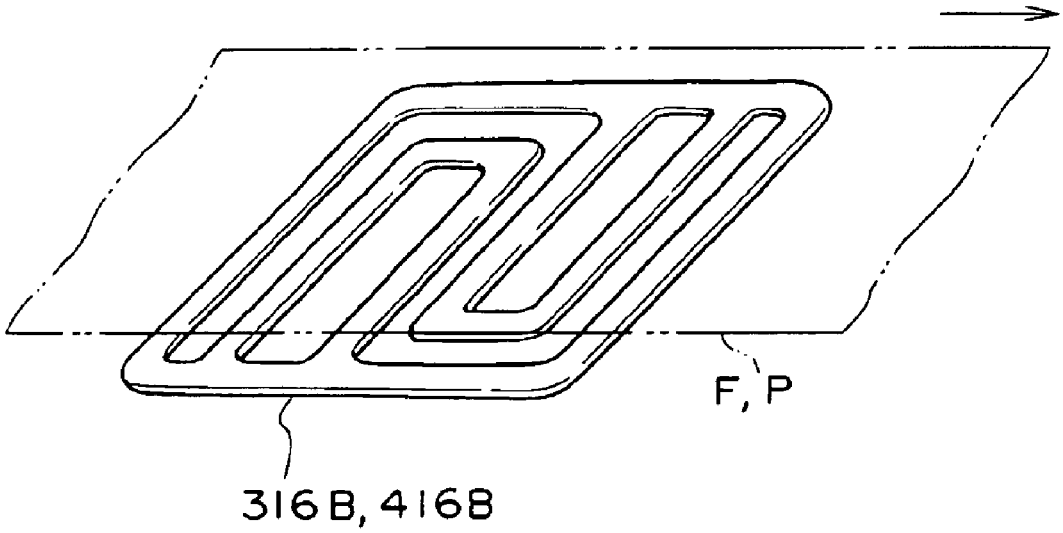
FIG. 43 is a perspective view showing a facial radiating far infrared heater used in the present invention.

As the electric heater for irradiating infrared radiations, bar-shaped (straight) far infrared heaters 316A, 416A (see FIG. 42) using bar-shaped electrical heating resistances such as ceramic or Nichrome wires, or facial radiation heaters 316B, 416B (see FIG. 43) having electrical heating bars bent to be sufficiently in contact with one another in a plate form are used. As shown in FIG. 42, a plurality of bar-shaped heaters are preferably arranged in parallel, such that their axial direction is perpendicular to the direction of delivery of the film. Further, a panel heater using a plate-shaped electrical resistance may also be used.

3. Reading of an Image

The description of the reading of an image is omitted because it is the same as described above in "3. Reading of an image" in the eleventh and twelfth aspects.

4. Photosensitive Material Used in the Present Invention and Supplementary Description Relating Thereto The photosensitive material used in the present invention and supplementary description relating thereto are essentially the same as described above in "5. Photosensitive material used in the present invention and supplementary description relating thereto" in the third aspect, and thus only differing features are described.

The print material is described. The shape of silver halide grains contained in a photographic emulsion preferably used for printing may be regular crystalline shapes such as cubic, tetradecahedral or octahedral shapes, or shapes with irregular crystal habits such as spheres, plates etc., or combined shapes thereof.

A set of parallel faces perpendicular to the direction of thickness of the flat tabular grains is referred to as the major face. In the present invention, a photographic emulsion containing the flat tabular grains having the {111} face as the major face or the {100} face as the major face is preferably used.

For formation of the {111} plate grains, a method of using various crystalline-phase regulators is disclosed, and for example, compounds (Compound Nos. 1 to 42) disclosed in JP-A No. 2-32 are preferable.

The high silver chloride grains refer to grains having a silver halide content of 80 mol-% or more, and 95 mol-% or more of the grains are preferably silver halide. The grains of the present invention preferably have the so-called core/shell structure consisting of a core portion and a shell portion around the core portion. 90% or more of the core portion is preferably silver halide. The core portion may be composed further of two or more portions different in halogen composition. The ratio of the shell portion to the whole grain volume is preferably 50% or less, and more preferably 20% or less. The shell portion is preferably silver iodochloride or silver iodobromochloride. Preferably, the shell portion contains 0.5 to 13 mol-% iodine, and more preferably 1 to 13 mol-%. The content of silver iodine in the whole grains is preferably 5 mol-% or less, and more preferably 1 mol-% or less.

The silver bromine content is preferably higher in the shell portion than in the core portion. The silver bromide content is preferably 20 mol-% or less, and more preferably 5 mol-% or less.

Although the average grain size of the silver halide grains (corresponding to the diameter of grains having the same volume as the silver halide grains) used in the photosensitive material for photographic paper is not particularly limited, it is preferably 0.1 to 0.8 μm, and more preferably 0.1 to 0.6 μm. The diameter of the flat tabular grains is preferably 0.2 to 1.0 μm in terms of the diameter of a sphere having the same volume as said grain. The diameter of the silver halide grain refers to the diameter of a sphere having the same area as the projected area of said grain in an electron microphotography. The thickness is 0.2 μm or less, preferably 0.15 μm or less, and more preferably 0.12 μm or less.

The distribution of the sizes of the silver halide grains may be polydisperse or monodisperse, preferably monodisperse. The coefficient of variation of the diameter of the flat plate-shaped grain accounting for 50% or more in the whole projected area is preferably 20% or less in terms of the diameter of a sphere having the same volume as the grain. It is ideally 0%.

In the present invention, heat drying is conducted after reading of the first image, but because rapid and efficient heating is desired, a polyester support sufficiently stable at the heating temperature is preferable.

EXAMPLES

The present invention is more specifically explained by the following examples, but it should be noted that the present invention is not limited to these examples.

Example A-1

A mixture of 0.37 g of gelatin having an average molecular weight of 15,000, 0.37 g of oxidation-treated gelatin, 0.7g of potassium bromide, and 930 ml of distilled water was placed in a reaction vessel, and thereafter the temperature of the mixture was raised to 40° C. To this solution, which was vigorously stirred, there was added 30 ml of an aqueous solution containing 0.34 g of silver nitrate and 30 ml of an aqueous solution containing 0.24 g of potassium bromide over a period of 30 seconds. After the completion of the addition, the reaction mixture was kept at 40° C. for 1 minute, and the temperature was then raised to 75° C. and the reaction mixture was ripened. Next, 27.0 g of gelatin, whose amino group had been modified with trimellitic acid, was added together with 200 ml of distilled water. After that, 100 ml of an aqueous solution containing 23.36 g of silver nitrate and 80 ml of an aqueous solution containing 16.37 g of potassium bromide were added to the reaction mixture over a period of 36 minutes in such a manner that the flow rate of the addition was gradually increased. After the completion of the addition, the reaction mixture was kept at 63° C. for 2 minutes, and the temperature was then lowered to 45° C. Further, 250 ml of an aqueous solution containing 83.2 g of silver nitrate and an aqueous solution containing potassium iodide and potassium bromide at a molar ratio of the former to the latter of 3:97 (having a potassium bromide concentration of 26%) was added to the reaction mixture over a period of 60 minutes in such a manner that the flow rate of the addition was gradually increased and that the silver potential after the reaction became −50 mV with respect to a saturated calomel electrode. Furthermore, 75 ml of an aqueous solution containing 18.7 g of silver nitrate and a 21.9% potassium bromide aqueous solution were added to the reaction mixture over a period of 10 minutes in such a manner that the silver potential of the reaction mixture became 0 mV with respect to a saturated calomel electrode. After the completion of the addition, the temperature of the reaction mixture was kept at 75° C. for 1 minute, and the temperature of the reaction mixture was then lowered to 40° C. Next, the pH of the reaction mixture was adjusted to 9.0 by the addition of 100 ml of an aqueous solution containing 10.5 g of sodium p-iodoacetamidobenzenesulfonate monohydrate. After that, 50 ml of an aqueous solution containing 4.3 g of sodium sulfite was added. After the completion of the addition, the reaction mixture was kept at 40° C. for 3 minutes and the temperature was then raised to 55° C. Next, the pH of the reaction mixture was adjusted to 5.8. After that, 0.8 mg of sodium benzenethiosulfinate, 0.04 mg of potassium hexachloroiridate (IV), and 5.5 g of potassium bromide were added. After the addition, the temperature of the reaction mixture was kept at 55° C. for 1 minute. Next, 180 ml of an aqueous solution containing 44.3 g of silver nitrate and 160 ml of an aqueous solution containing 34.0 g of potassium bromide and 8.9 mg of potassium hexacyanoferrate (II) were added to the reaction mixture over a period of 30 minutes. The temperature of the reaction mixture was then lowered, and a desalting treatment was performed by a standard method. After the desalting treatment, gelatin was added to the reaction mixture so that a gelatin concentration became 7% by weight and the pH was adjusted to 6.2.

The emulsion obtained was made up of hexagonal tabular grains having an average grain size expressed in an equivalent-sphere diameter of about 1.29 μm, a variation coefficient of grain size distribution of 19%, an average grain thickness of 0.13 μm, and an average aspect ratio of 25.4. This emulsion was designated as emulsion A.

An emulsion B, made up of hexagonal tabular grains having an average grain size expressed in an equivalent-sphere diameter of about 0.85 μm, an average grain thickness of 0.11 μm, and an average aspect ratio of 17.5, and an emulsion C, made up of hexagonal tabular grains having an average grain size expressed in an equivalent-sphere diameter of about 0.52 μm, an average grain thickness of 0.09 μm, and an average aspect ratio of 11.3, were prepared by the same procedure as in the emulsion A except that the amount of the silver nitrate and the amount of the potassium bromide to be added at the initial stage of the nucleus formation were changed so as to change the number of nuclei to be formed. However, the amount added of the potassium hexachloroiridate (IV) and the amount added of the potassium hexacyanoferrate (II) were changed in reverse proportion to the grain volume, while the amount added of the sodium p-iodoacetamidobenzenesulfonate monohydrate was changed in proportion to the grain peripheral length.

After the addition of 5.6 ml of a 1% potassium iodide aqueous solution to the emulsion A at 40° C., the spectral sensitization and the chemical sensitization of this emulsion were performed by the addition thereto of the following red-photosensitive spectral sensitizing dye in an amount of $4.4\times10^{-4}$ mol, compound I, potassium thiocyanate, chloroauric acid, sodium thiosulfate, and mono (pentafluorophenyl)diphenylphosphine selenide. After the chemical sensitization, a stabilizer S was added. The amounts of the chemical sensitizers were adjusted so that the level of the chemical sensitization of the emulsion was optimized. The emulsion after the spectral sensitization and the chemical sensitization described above was designated as red-photosensitive emulsion Ar. Similarly, the emulsion B and the emulsion C were subjected to the spectral sensitization and the chemical sensitization; and an emulsion Br and an emulsion Cr were obtained. However, the amounts added of the spectral sensitizers were changed in proportion to the grain surface area, while the amounts of the chemical sensitizers were adjusted so that the level of the chemical sensitization of the emulsions was optimized.

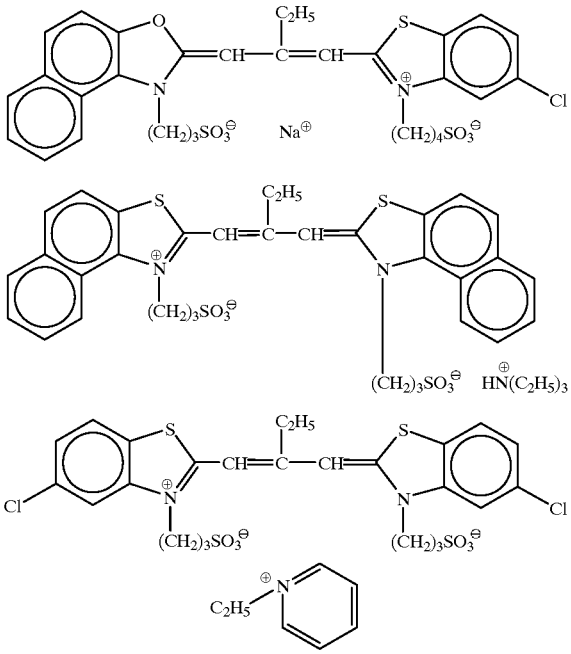

4:1:5 (molar ratio) blend of red-photosensitive spectral sensitizing dye

Compound I

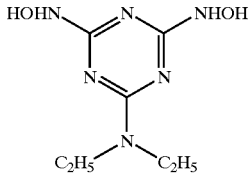

Stabilizer S (blend of the following)

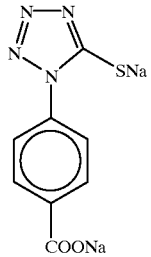

2 x $10^{-4}$ mol/mol Ag for the emulsion A

-continued

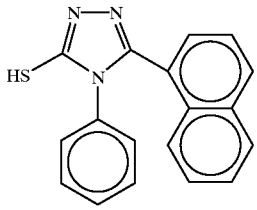

8 x $10^{-5}$ mol/mol Ag

Similarly, green-photosensitive emulsions Ag, Bg, and Cg as well as blue-photosensitive emulsions Ab, Bb, and Cb were prepared by changing the spectral sensitizers.

Spectral sensitizing dye I for green-photosensitive emulsion

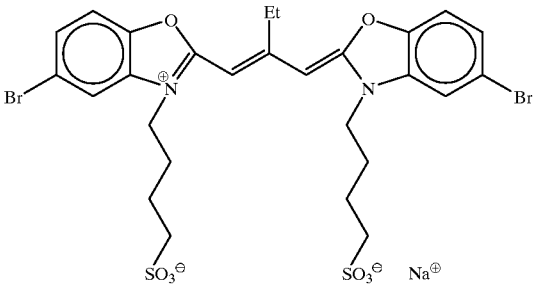

Spectral sensitizing dye II for green-photosensitive emulsion

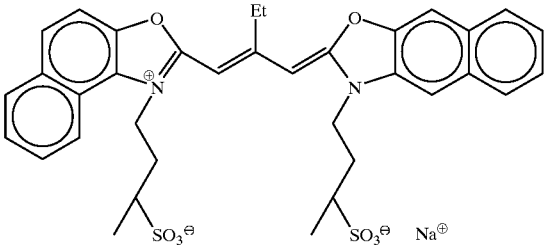

Spectral sensitizing dye III for green-photosensitive emulsion

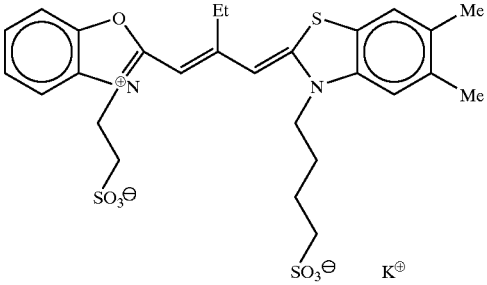

75:18:7 (molar ratio) blend of the above

Blue-photosensitive spectral sensitizing dye

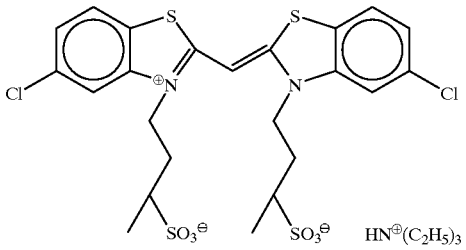

Next, a dispersion of zinc hydroxide to be used as a base precursor was prepared. That is, 31 g of zinc hydroxide powder having a primary grain size of 0.2 $\mu$m, 1.6 g of carboxymethylcellulose and 0.4 g of sodium polyacrylate as dispersants, 8.5 g of lime-treated ossein gelatin, and 158.5 ml of water were mixed together, and the resulting mixture was dispersed in a mill using glass beads. After the dispersing operation, 188 g of a dispersion of zinc hydroxide was obtained by separating the glass beads therefrom by filtration.

Further, an emulsified dispersion containing a coupler and an incorporated developing agent was prepared.

First, an emulsified dispersion containing a cyan coupler and an incorporated developing agent was prepared in the following way. That is, 10.78 g of the cyan coupler (a), 8.14 g of the developing agent (b), 1.05 g of the developing agent (c), 0.15 g of the anti-fogging agent (d), 8.27 g of the organic high-boiling solvent (e), and 38.0 ml of ethyl acetate were dissolved at 40° C. The resulting solution was mixed into 150 g of an aqueous solution containing 12.2 g of lime-treated gelatin and 0.8 g of sodium dodecylbenzenesulfonate (f) as a surfactant; and the mixture was subjected to emulsification and dispersion by using a dissolver-type mixer at 10,000 rpm over a period of 20 minutes. After the dispersing operation, distilled water in an amount to make 300 g of the total amount of the dispersion was added and blending was carried out at 2,000 rpm for 10 minutes.

Cyan coupler (a)

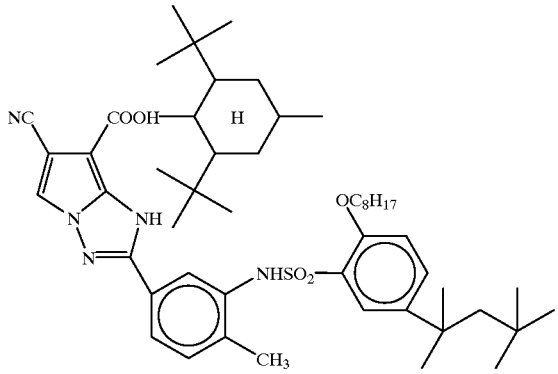

-continued

Developing agent (b)

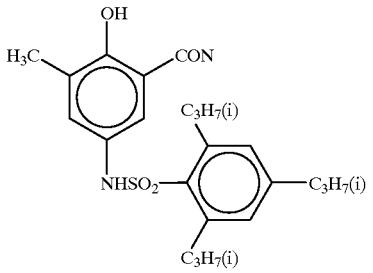

Developing agent (c)

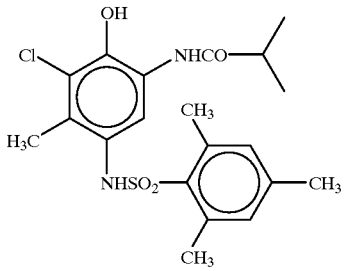

Anti-fogging agent (d)

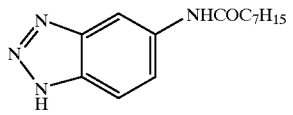

Organic high-boiling solvent (e)

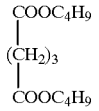

Surfactant (f)

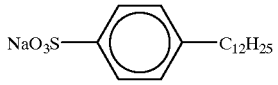

Second, an emulsified dispersion containing a magenta coupler and an incorporated developing agent was prepared in the following way. Specifically, 7.75 g of the magenta coupler (q), 1.12 g of the magenta coupler (r), 8.13 g of the developing agent (b), 1.05 g of the developing agent (c), 0.11 g of the anti-fogging agent (d), 7.52 g of the organic high-boiling solvent (e), and 38.0 ml of ethyl acetate were dissolved at 60° C. The resulting solution was mixed into 150 g of an aqueous solution containing 12.2 g of lime-treated gelatin and 0.8 g of sodium dodecylbenzenesulfonate (f) as a surfactant; and the mixture was subjected to emulsification and dispersion by using a dissolver-type mixer at 10,000 rpm over a period of 20 minutes. After the dispersing operation, distilled water in an amount to make 300 g of the total amount of the dispersion was added and blending was carried out at 2,000 rpm for 10 minutes.

Magenta coupler (q)

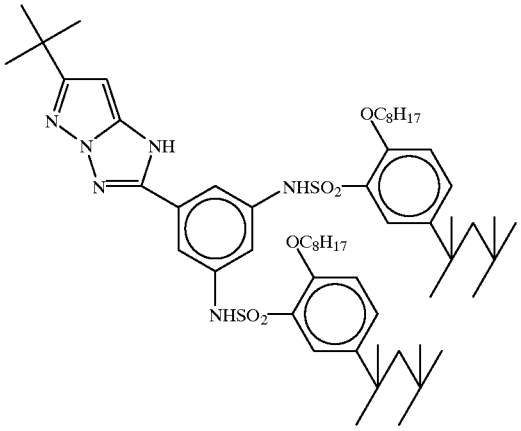

Magenta coupler (r)

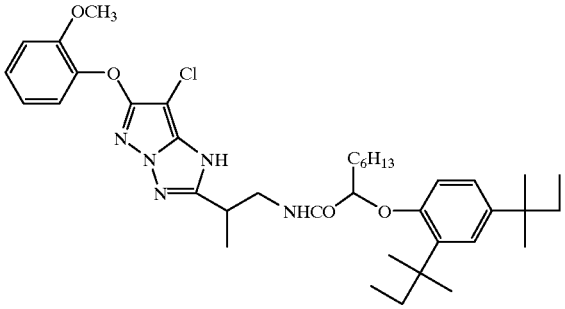

Third, an emulsified dispersion containing a yellow coupler and an incorporated developing agent was prepared in the following way. Specifically, 8.95 g of the yellow coupler (m), 7.26 g of the developing agent (n), 1.47 g of the developing agent (c), 0.28 g of the anti-fogging agent (o), 18.29 g of the organic high-boiling solvent (p), and 50 ml of ethyl acetate were dissolved at 60° C. The resulting solution was mixed into 200 g of an aqueous solution containing 18.0 g of lime-treated gelatin and 0.8 g of sodium dodecylbenzenesulfonate (f) as a surfactant; and the mixture was subjected to emulsification and dispersion by using a dissolver-type mixer at 10,000 rpm over a period of 20 minutes. After the dispersing operation, distilled water in an amount to make 300 g of the total amount of the dispersion was added and blending was carried out at 2,000 rpm for 10 minutes.

Yellow coupler (m)

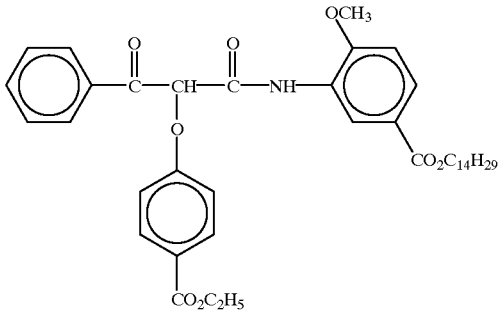

-continued

Developing agent (n)

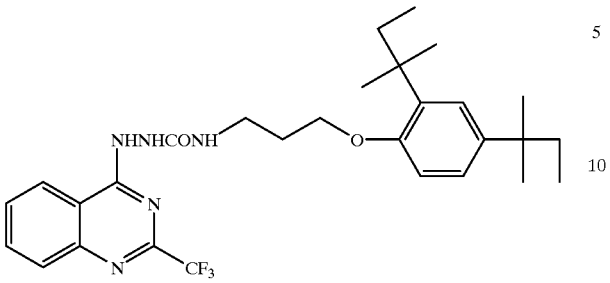

-continued

Anti-fogging agent (o)

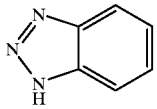

Organic high-boiling solvent (p)

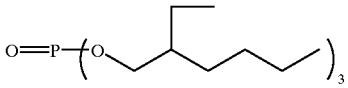

Furthermore, dispersions of dyes for coloring layers as antihalation layers were prepared in a similar way. Dyes and organic high-boiling solvents used for dispersing the dyes are indicated below.

Cyan dye (g)

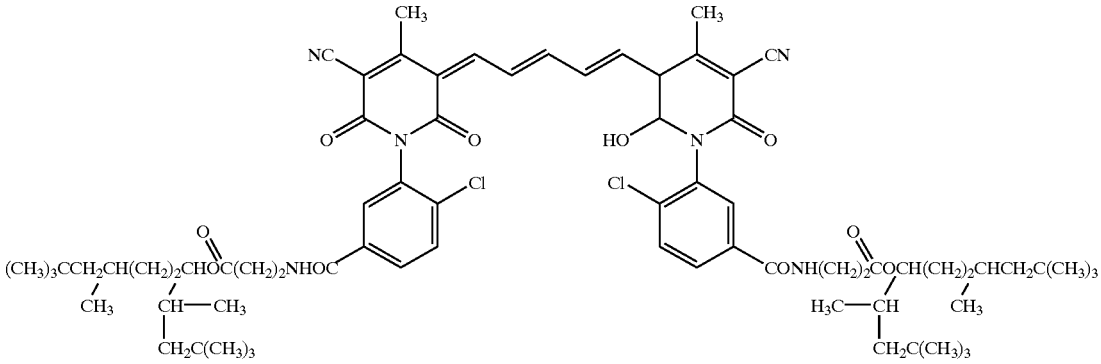

Organic high-boiling solvent (h)

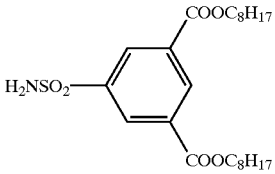

Yellow dye (t)

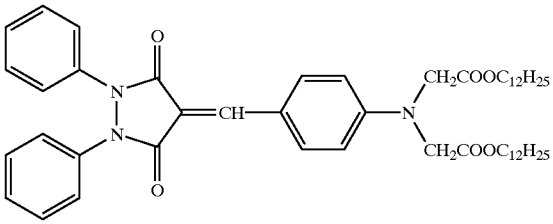

Organic high-boiling solvent (u)

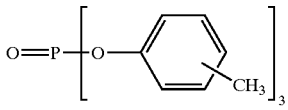

1:1 blend of Enpara K65 manufactured in Ajinomoto Co.

Magenta dye (v)

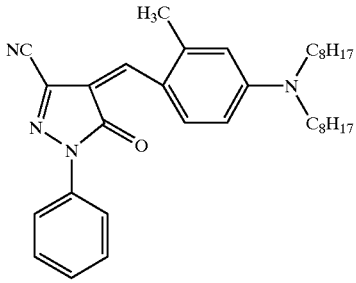

Formal in scavenger (s)

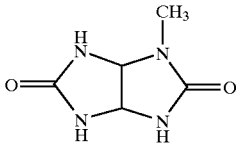

By combining these dispersions with the silver halide emulsions prepared previously, the composition shown in Tables 1 to 5 was applied onto a support. In this way, a multilayer, photographic, photosensitive material was prepared. The sample thus prepared was designated as sample A101.

TABLE 1

| Name of layer | Components | Sample A101 |
|---|---|---|
| Protective layer | Lime-treated gelatin | 914 |
| | Matting agent (silica) | 50 |
| | Surfactant (i) | 30 |
| | Surfactant (j) | 40 |
| | Water-soluble polymer (k) | 15 |
| | Hardener (l) | 110 |
| Interlayer | Lime-treated gelatin | 461 |
| | Surfactant (j) | 5 |
| | Zinc hydroxide | 340 |
| | Formalin scavenger (s) | 300 |
| | Water-soluble polymer (k) | 15 |
| Yellow-forming layer (a layer having high sensitivity) | Lime-treated gelatin | 1750 |
| | Emulsion (calculated in terms of Ab coating weight of silver) | 525 |
| | Yellow coupler (m) | 298 |
| | Developing agent (n) | 242 |
| | Developing agent (c) | 50 |
| | Anti-fogging agent (d) | 5.8 |
| | Anti-fogging agent (o) | 9.5 |
| | Organic high-boiling solvent (p) | 500 |
| | Surfactant (f) | 27 |
| | Water-soluble polymer (k) | 1 |

TABLE 2

Continued from Table 1

| Name of layer | Components | Sample A101 |
|---|---|---|
| Yellow-forming layer (a layer having high sensitivity) | Lime-treated gelatin | 1400 |
| | Emulsion (calculated in terms of Bb coating weight of silver) | 211 |
| | Yellow coupler (m) | 277 |
| | Developing agent (n) | 225 |
| | Developing agent (c) | 46 |
| | Anti-fogging agent (d) | 5.3 |
| | Anti-fogging agent (o) | 8.8 |
| | Organic high-boiling solvent (p) | 566 |
| | Surfactant (f) | 25 |
| | Water-soluble polymer (k) | 2 |
| Yellow-forming layer (a layer having high sensitivity) | Lime-treated gelatin | 1400 |
| | Emulsion (calculated in terms of Cb coating weight of silver) | 250 |
| | Yellow coupler (m) | 277 |
| | Developing agent (n) | 225 |
| | Developing agent (c) | 46 |
| | Anti-fogging agent (d) | 5.3 |
| | Anti-fogging agent (o) | 8.8 |
| | Organic high-boiling solvent (p) | 566 |
| | Surfactant (f) | 25 |
| | Water-soluble polymer (k) | 2 |
| Interlayer (yellow filter layer) | Lime-treated gelatin | 560 |
| | Surfactant (f) | 15 |
| | Surfactant (j) | 24 |
| | dye (t) | 85 |
| | Organic high-boiling solvent (u) | 85 |
| | Zinc hydroxide | 125 |
| | Water-soluble polymer (k) | 15 |

TABLE 3

Continued from Table 1

| Name of layer | Components | Sample A101 |
|---|---|---|
| Magenta-forming layer (a layer having high sensitivity) | Lime-treated gelatin | 781 |
| | Emulsion (calculated in terms of Ag coating weight of silver) | 892 |
| | Magenta coupler (q) | 80 |
| | Magenta coupler (r) | 12 |
| | Developing agent (b) | 85 |
| | Developing agent (c) | 11 |
| | Anti-fogging agent (d) | 1.2 |
| | Organic high-boiling solvent (e) | 79 |
| | Surfactant (f) | 8 |
| | Water-soluble polymer (k) | 8 |
| Magenta-forming layer (a layer having medium sensitivity) | Lime-treated gelatin | 659 |
| | Emulsion Bg | 669 |
| | Magenta coupler (g) | 103 |
| | Magenta coupler (r) | 15 |
| | Developing agent (b) | 110 |
| | Developing agent (c) | 14 |
| | Anti-fogging agent (d) | 1.5 |
| | Organic high-boiling solvent (e) | 102 |
| | Surfactant (f) | 11 |
| | Water-soluble polymer (k) | 14 |
| Magenta-forming layer (a layer having low sensitivity) | Lime-treated gelatin | 711 |
| | Emulsion Cg | 235 |
| | Magenta-coupler (q) | 274 |
| | Magenta-coupler (r) | 40 |
| | Developing agent (b) | 291 |
| | Developing agent (c) | 38 |
| | Anti-fogging agent (d) | 3.9 |
| | Organic high-boiling solvent (e) | 269 |
| | Surfactant (f) | 29 |
| | Water-soluble polymer (k) | 14 |

TABLE 4

Continued from Table 1

| Name of layer | Components | Sample A101 |
|---|---|---|
| Interlayer (magenta filter layer) | Lime-treated gelatin | 850 |
| | Surfactant (f) | 15 |
| | Surfactant (j) | 24 |
| | Dye (v) | 200 |
| | Organic high-boiling solvent (h) | 200 |
| | Formalin scavenger (s) | 300 |
| | zinc hydroxide | 2028 |
| | Water-soluble polymer (k) | 15 |
| Cyan-forming layer (a layer having high sensitivity) | Lime-treated gelatin | 842 |
| | Emulsion Ar | 1040 |
| | Cyan coupler (a) | 64 |
| | Developing agent (b) | 75 |
| | Developing agent (c) | 6 |
| | Anti-fogging agent (d) | 0.9 |
| | Organic high-boiling solvent (e) | 49 |
| | Surfactant (f) | 5 |
| | Water-soluble polymer (k) | 18 |
| Cyan-forming layer (a layer having medium sensitivity) | Lime-treated gelatin | 475 |
| | Emulsion Br | 602 |

TABLE 4-continued

| Name of layer | Components | Sample A101 |
|---|---|---|
| | Cyan coupler (a) | 134 |
| | Developing agent (b) | 102 |
| | Developing agent (c) | 13 |
| | Anti-fogging agent (d) | 1.9 |
| | Organic high-boiling solvent (e) | 103 |
| | Surfactant (f) | 10 |
| | Water-soluble polymer (k) | 15 |

TABLE 5

| Name of layer | Components | Sample A101 |
|---|---|---|
| Cyan-forming layer (a layer having low sensitivity) | Lime-treated gelatin | 825 |
| | Emulsion (calculated in terms of Cr coating weight of silver) | 447 |
| | Cyan coupler (a) | 234 |
| | Developing agent (b) | 179 |
| | Developing agent (c) | 23 |
| | Anti-fogging agent (d) | 3.3 |
| | Organic high-boiling solvent (e) | 179 |
| | Surfactant (f) | 17 |
| | Water-soluble polymer (k) | 10 |
| Antihalation layer | Lime-treated gelatin | 440 |
| | Surfactant (f) | 14 |
| | Dye (g) | 260 |
| | Organic high-boiling solvent (h) | 260 |
| | Water-soluble polymer (k) | 15 |

Transparent PET base (96$\mu$)
Figures indicate coating weights (mg/m$^2$)

Surfactant (i)

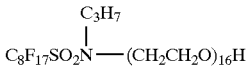

Surfactant (j)

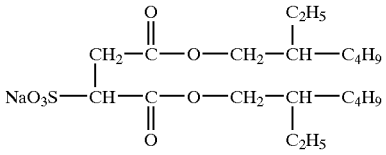

Water-soluble polymer (k)

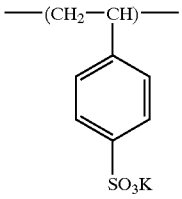

Hardener (l)

A multilayer, photographic, photosensitive material was prepared by the same procedure as in the preparation of the sample A101, except that the color coupler was eliminated from the emulsified dispersion used for each layer in the preparation of the sample A101; and the multilayer, photographic, photosensitive material thus prepared was designated as sample A102. Further, a photographic, photosensitive material was prepared by the same procedure as in the preparation of the sample A101, except that the developing agent was eliminated from the emulsified dispersion used for each layer in the preparation of the sample A101; and the multilayer, photographic, photosensitive material thus prepared was designated as sample A103. Furthermore, a photographic, photosensitive material was prepared by the same procedure as in the preparation of the sample A103, except that the dispersion of zinc hydroxide, which was used for the formation of the interlayer, was eliminated in the preparation of the sample A103; and the multilayer, photographic, photosensitive material thus prepared was designated as sample A104.

In addition, processing materials P-1 and P-2, as shown in Tables 6 and 7, were prepared.

TABLE 6

Construction of Processing Material P-1

| Layer construction | Components | Coating weight (mg/m$^2$) |
|---|---|---|
| The fourth layer protective layer | Acid-treated gelatin | 220 |
| | Water-soluble polymer (y) | 60 |
| | Water-soluble polymer (w) | 200 |
| | Additive (x) | 80 |
| | Potassium nitrate | 16 |
| | Matting agent (z) | 10 |
| | Surfactant (r) | 7 |
| | Surfactant (aa) | 7 |
| | Surfactant (ab) | 10 |
| The third layer interlayer | Lime-treated gelatin | 240 |
| | Water-soluble polymer (w) | 24 |
| | Hardener (ac) | 180 |
| | Surfactant (f) | 9 |
| The second layer base-generating layer | Lime-treated gelatin | 2100 |
| | Water-soluble polymer (w) | 360 |
| | Water-soluble polymer (ad) | 700 |
| | Water-soluble polymer (ae) | 600 |
| | Organic high-boiling solvent (af) | 2120 |
| | Additive (ag) | 20 |
| | Guanidine picolinate | 2613 |
| | Potassium quinolinate | 225 |
| | Sodium quinolinate | 192 |
| | Surfactant (r) | 24 |
| The first layer subbing layer | Lime-treated gelatin | 247 |
| | Water-soluble polymer (y) | 12 |
| | Surfactant (f) | 14 |
| | Hardener (ac) | 178 |

Transparent support (63 $\mu$m)

TABLE 7

Construction of Processing Material P-2

| Layer construction | Components | coating weight (mg/m$^2$) |
|---|---|---|
| The fifth layer protective layer | Acid-treated gelatin | 490 |
| | Matting agent (z) | 10 |
| The fourth layer interlayer | Lime-treated gelatin | 240 |
| | Hardener (ac) | 250 |
| The third layer solvent layer | Lime-treated gelatin | 4890 |
| | Silver halide solvent (ah) | 5770 |
| The second layer interlayer | Lime-treated gelatin | 370 |
| | Hardener (ac) | 500 |
| The first layer subbing layer | Lime-treated gelatin | 247 |
| | Water-soluble polymer (y) | 12 |
| | Surfactant (r) | 14 |
| | Hardener (ac) | 178 |
| | Transparent support (63 $\mu$m) | |

Water-soluble polymer (y): κ-carrageenan
Water-soluble polymer (w): Sumikagel L-5H (manufactured by Sumitomo Chemical Co., Ltd.)
Additive (x)

TABLE 7-continued

Construction of Processing Material P-2

| Layer construction | Components | coating weight (mg/m²) |
|---|---|---|

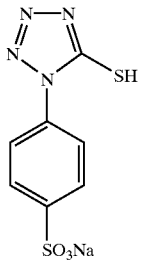

Matting agent (z): SYLOID 79
(manufactured by Fuji-Davidson Chemical Co., Ltd.)
Surfactant (aa)

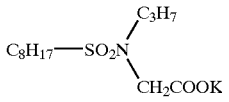

Surfactant (ab)

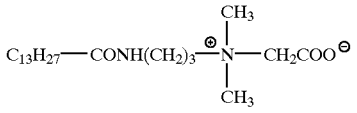

Hardener (ac)

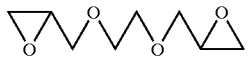

Water-soluble polymer (ad): Dextran (molecular weight: 70,000)
Water-soluble polymer (ae): MP Polymer MP 102
(manufactured by Kuraray Co., Ltd.)
Surfactant (r)

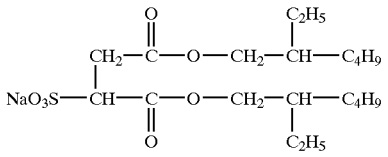

Organic high-boiling solvent (af): EMPARA 40
(from Ajinomoto Co. Ltd.)
Additive (ag)

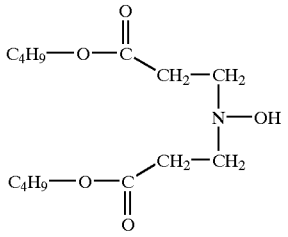

silver halide solvent (ah)

TABLE 7-continued

Construction of Processing Material P-2

| Layer construction | Components | coating weight (mg/m²) |
|---|---|---|

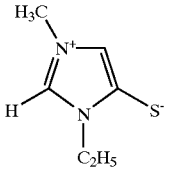

A test piece was cut out of the photosensitive material sample A104 and loaded in a 35 mm single-lens reflex camera. After that, a color chart manufactured by Macbeth Corp. was photographed at a shutter speed of 1/100 second under daylight illumination photographing conditions (having a color temperature of 5500K). After photographing, the test piece was processed according to CN-16 standard processing which is a development process step for color negative films and is manufactured by Fuji Photo Film Co., Ltd. After the processing, the test piece was read using inputting machines (i.e., color scanner), SP1500, of Frontier 350 which is a digital miniature laboratory; and a standard negative-positive conversion treatment was carried out. In this way, RGB image data of the photographic subject was obtained. By using the gray step portions of the image information thus obtained, image density and noise corresponding thereto were obtained. In this way, an S/N ratio was also obtained. The S/N ratio is a ratio of the standard deviation of the variation of pixels to the average of densities in an image patch corresponding to 18% gray.

Next, a test piece cut out of the same sample, A104, was exposed in the same way and subjected to development process for 4 minutes at 20° C. using a black-and-white development process solution according to the following prescription. After the development process, the test piece was subjected to a stopping treatment (30 seconds) by acetic acid (3%), rinsed with water, and dried. In this way, a sample having silver images recorded was obtained.

(Composition of Black-and-white Development Process Solution)

| | |
|---|---|
| Metol | 2 g |
| Anhydrous sodium sulfite | 50 g |
| Hydroquinone | 4 g |
| Anhydrous sodium carbonate | 6 g |
| Potassium bromide | 0.75 g |
| Total after the addition of water | 1000 ml |

In the sample A104 after the black-and-white development process, the degree of blackening observed on the sample side remote from the support was larger than the degree of blackening observed from the back of the support in the portions recorded with blue light. In contrast, the degree of blackening observed on the back of the support was larger in the portions recorded with red light.

Using the test piece after the processing, 3 densities, i.e., reflection density on the front (i.e., emulsion layer side), reflection density on the back (i.e., support side), and transmission density, were read out by using as a light source the infrared light having a maximum wavelength of 950 nm and the spectral distribution shown in FIG. 13 by using an apparatus having the same film scanner, image processing device, and printer as those shown in FIG. 1. As a result, three kinds of information, i.e., image information Fr (front reflection), Br (back reflection), and T (transmission), were obtained. Based on the information thus obtained, 3×10 matrix coefficients (a10~a39) were determined according to the following formula by least square approximation such that the RGB signal values became as close as possible to the color image information previously obtained by using the sample A104, and were converted into color information. In this way, R',G', and B' density information was obtained. Also for the image information, image density and noise corresponding thereto was obtained by using the gray step portions. In this way, an S/N ratio was obtained.

$$R'=a10*Br+a11*T+a12*Fr+a13*Br*Br+a14*T*T+a15*Fr*Fr+a16*Br*T+a17*T*Fr+a18*Fr*Br+a19$$

$$G'=a20*Br+a21*T+a22*Fr+a23*Br*Br+a24*T*T+a25*Fr*Fr+a26*Br*T+a27*T*Fr+a28*Fr*Br+a29$$

$$B'=a30*Br+a31*T+a32*Fr+a33*Br*Br+a34*T*T+a35*Fr*Fr+a36*Br*T+a37*T*Fr+a38*Fr*Br+a39$$

These results are shown in Table 8. As shown in Table 8, although color images could be reproduced, the S/N ratios were remarkably low.

TABLE 8

| Sample A104 | S/N ratio |
|---|---|
| CN-16 color development | 0.25 |
| B/W development | 0.64 |

Next, the same test was conducted by using the multilayer photosensitive material A103. The results are shown in Table 9. The results were the same as the results obtained by using the sample A104.

TABLE 9

| Sample A103 | S/N ratio |
|---|---|
| CN-16 color development | 0.23 |
| B/W development | 0.63 |

Color image information was obtained by using the sample A104 and the sample A103 according to the same procedure as before, except that the black-and-white development process was changed such that the development process temperature was 60° C. and the processing time was 40 seconds. The results are shown in Table 10. It can be seen that, when the development process temperature was 60° C., the S/N ratio evidently increases.

TABLE 10

| | Sample A104 S/N ratio | Sample A103 S/N ratio |
|---|---|---|
| B/W development (60° C.) | 0.41 | 0.42 |

Next, a test was conducted using the sample A101. Under the same conditions as in the previous experiment that used the sample A104, a color chart manufactured by Macbeth Corp. was photographed. After photographing, the test piece was processed according to standard processing by CN-16, manufactured by Fuji Photo Film Co., Ltd. As a result, as in the case where the sample A104 was processed according to standard processing by CN-16, a negative color take-up effect was obtained, and similar color images were reproduced by conversion using a color scanner. By using the gray step portions of the color image thus obtained, image density and noise corresponding thereto were obtained, and an S/N ratio was obtained.

Next, the sample after photographing under the same condition as before was subjected to development process for 4 minutes at 20° C. using the black-and-white development process solution having the composition shown previously. After the development process, the test piece was subjected to a stopping treatment (30 seconds) by acetic acid (3%), rinsed with water, and dried. In this way, a sample having silver images recorded was obtained. Using the test piece after the processing, three kinds of information, i.e., image information Fr (front reflection), Br (back reflection), and T (transmission), were read out by the same method as in the case of the sample A104. If necessary, the information thus obtained was subjected to linear conversion. After that, 3×10 matrix coefficients were determined by least square approximation such that the RGB signal values become as close possible to the color image information previously obtained by using the sample A104 and were converted into color information. In this way, R',G', and B' density information was obtained. Despite silver images being used, the image information thus obtained reproduced color information. Also with this image information, image density and noise corresponding thereto was obtained by using the gray step portions, and an S/N ratio was obtained.

Next, the same sample A101 was subjected to black-and-while development process under different conditions, i.e., at 60° C. for 40 seconds. After that, according to the previously described procedure, color image information and noise corresponding thereto were obtained, and an S/N ratio was obtained.

Furthermore, the surface of the same sample A101, after photographing under the same condition, was supplied with warm water at 40° C. at a rate of 20 ml/m$^2$ and put together face-to-face with the film surface of the processing material P1. After that, heat development was carried out by using a heat drum at 83° C. for 17 seconds. When the processing material was peeled off, dye images and silver images, corresponding to exposure, were formed in the test piece as a photosensitive material.

Using this sample, three kinds of information, i.e., image information Fr (front reflection), Br (back reflection), and T (transmission), were obtained by the same method as in the case of the sample A104. After that, 3×10 matrix coefficients were determined by least square approximation such that the RGB signal values become as close as possible to the color image information already obtained by using the sample A104 and were converted into color information. In this way, R',G', and B' densities information was obtained. Also with this image information, image density and noise corresponding thereto were obtained by using the gray step portions, and an S/N ratio was obtained.

Next, the sample A102 after photographing under the same condition as before was subjected to development process for 4 minutes at 20° C. using the black-and-white development process solution having the composition shown previously. After the development process, the test piece was subjected to a stopping treatment (30 seconds) by acetic acid (3%), rinsed with water, and dried. In this way, a sample having silver images recorded was obtained. Using the test piece after the processing, three kinds of information, i.e., image information Fr (front reflection), Br (back reflection), and T (transmission), were read out by the same method as in the case of the sample A104. After that, 3×10 matrix coefficients were determined as described above by least square approximation such that the RGB signal values become as close as possible to the color image information already obtained by using the sample A104 and were converted into color information. In this way, R',G', and B' density information was obtained. Also with this image information, image density and noise corresponding thereto was obtained by using the gray step portions, and an S/N ratio was obtained.

Next, the same sample A102 was subjected to black-and-while development process under a different conditions, i.e., at 60° C. for 40 seconds. After that, according to the previously described procedure, color image information and noise corresponding thereto was obtained, and an S/N ratio was obtained.

Furthermore, the surface of the same sample A102, after photographing under the same condition, was supplied with warm water at 40° C. at a rate of 20 ml/m$^2$ and put together face to face with the film surface of the processing material P-1. After that, heat development was carried out by using a heat drum at 83° C. for 17 seconds. When the processing material was peeled off, dye images and silver images, corresponding to exposure, were formed in the test piece as a photosensitive material.

Using this sample, three kinds of information, i.e., image information Fr (front reflection), Br (back reflection), and T (transmission), were obtained by the same method as in the case of the sample A104. After that, 3×10 matrix coefficients were determined by least square approximation such that the RGB signal values become as close as possible to the color image information already obtained by using the sample A104 and were converted into color information. In this way, R',G', and B' density information was obtained. Also with this image information, image density and noise corresponding thereto was obtained by using the gray step portions, and an S/N ratio was obtained.

The results are shown in Table 11.

TABLE 11

| | Sample A101 S/N ratio | Sample A102 S/N ratio |
|---|---|---|
| CN-16 color development | 0.24 | — |
| B/W development (20° C. for 4 minutes) | 0.62 | 0.58 |
| B/W development (60° C. for 40 seconds) | 0.38 | 0.34 |
| Development by being placed together (83° C. for 17 seconds) | 0.29 | 0.26 |

From the results, it is apparent that, in comparison with the development process in which the developing solution is supplied from exterior of a photosensitive material, the S/N ratio is further increased when heat development is carried out using an incorporated developing agent in the presence of a small amount of water by placing a photosensitive material and a processing material containing a base precursor face to face and thereafter heating these materials to 83° C.

Example A-2

A test piece was cut from the sample A101 prepared in Example A-1 and loaded in a camera. After that, a standard subject that comprised a mannequin and a Macbeth color chart was photographed. For the photographing, two exposure conditions, i.e., a normal condition of ISO 800 and a condition of over-aperture by 4 scales, were adopted. After photographing, the test piece was processed by using a black-and-white developing solution at 20° C. After the processing, the images of developed silver were read out as in Example A-1. The read-out was performed by arranging a scanner such that the reading-out could be made at points of time, i.e., at 1 minute, 2 minutes, and 4 minutes, respectively, after the start of the development process.

Using three kinds of information, i.e., image information Fr (front reflection), Br (back reflection), and T (transmission), obtained at respective points of time, color images were reproduced as in Example A-1, wherein two kinds of color images were prepared. The first color image was one reproduced by using the data read out only at the point of time of four minutes. The second color image was one produced by a synthesis weighted in such a manner that the density of the image at the point of time of two minutes was divided into three regions, wherein the region whose negative density was the highest comprised a higher proportion of the data obtained at one minute of development process while the region whose negative density was the lowest comprised a higher proportion of the data obtained at four minutes of development process.

Similarly, the sample A101 was used for photographing the same standard subject and subjected to black-and-white development process under different conditions, i.e., at 60° C., and images of developed silver were read out. The read-out was performed by arranging a scanner such that the reading-out could be made at points of time, i.e., at 10 seconds, 20 seconds, and 40 seconds, respectively, after the start of the development process.

Using three kinds of information, i.e., image information Fr (front reflection), Br (back reflection), and T (transmission), obtained at respective points of time, color images were reproduced as in Example A-1, wherein two kinds of color images were prepared. The first color image was one reproduced by using the data read out only at the point of time of 40 seconds. The second color image was one produced by a synthesis weighted in such a manner that the density of the image at the point of time of 20 seconds was divided into three regions, wherein the region whose negative density was the highest comprised a higher proportion of the data obtained at 10 seconds of development process while the region whose negative density of negative was the lowest comprised a higher proportion of the data obtained at 40 seconds of development process.

The comparison of the results thus obtained led to the following conclusion. In all cases where different developing solutions were used, in comparison with the images reproduced by using only the data read out at the final stage, the images, produced by a synthesis from the data at three stages and weighted as described above, exhibited better S/N ratios and gradation in overexposure in particular. The latter images, obtained by development process at 60° C., had excellent S/N ratios and better quality.

Example B-1

1. Preparation of a Color Negative Film Sample

A cellulose triacetate film, which had been coated with a subbing layer, was further coated with the following layers successively so as to prepare a color negative sample B101, that is, a multilayer, color photosensitive material.

(Composition of the Photosensitive Layers)

The main materials for use in the layers are classified into the following.

| | |
|---|---|
| ExC: cyan coupler | UV: ultraviolet absorber |
| ExM: magenta coupler | HBS: high-boiling solvent |
| ExY: yellow coupler | H: gelatin-hardener |
| ExS: sensitizing dye | |

Figures for components indicate coating weights expressed in $g/m^2$, with the proviso that figures for silver halides indicate coating weights calculated in terms of silver. Figures for sensitizing dyes indicate coating amounts expressed in moles per mole of silver halide contained in the same layer.

(Sample B101)

| The first layer (the first antihalation layer) | |
|---|---|
| black colloidal silver silver | 0.155 |
| silver iodobromide emulsion P silver | 0.01 |
| gelatin | 0.87 |
| ExC-1 | 0.002 |
| ExC-3 | 0.002 |
| Cpd-2 | 0.001 |
| HBS-1 | 0.004 |
| HBS-2 | 0.002 |
| **The second layer (the second antihalation layer)** | |
| black colloidal silver silver | 0.066 |
| gelatin | 0.407 |
| ExM-1 | 0.050 |
| ExF-1 | $2.0 \times 10^{-3}$ |
| HBS-1 | 0.074 |
| solid-dispersed dye ExF-2 | 0.015 |
| solid-dispersed dye ExF-3 | 0.020 |
| **The third layer (interlayer)** | |
| silver iodobromide emulsion O | 0.020 |
| ExC-2 | 0.022 |
| poly(ethyl acrylate) latex | 0.085 |
| gelatin | 0.294 |
| **The fourth layer (low-speed red-photosensitive emulsion layer)** | |
| silver iodobromide emulsion A silver | 0.323 |
| ExS-1 | $5.5 \times 10^{-4}$ |
| ExS-2 | $1.0 \times 10^{-5}$ |
| ExS-3 | $2.4 \times 10^{-4}$ |
| ExC-1 | 0.109 |
| ExC-3 | 0.044 |
| ExC-4 | 0.072 |
| ExC-5 | 0.111 |
| ExC-6 | 0.003 |
| Cpd-2 | 0.025 |
| Cpd-4 | 0.025 |
| HBS-1 | 0.17 |
| gelatin | 0.80 |
| **The fifth layer (medium-speed red-photosensitive emulsion layer)** | |
| silver iodobromide emulsion B silver | 0.28 |
| silver iodobromide emulsion C silver | 0.54 |
| ExS-1 | $5.0 \times 10^{-4}$ |
| ExS-2 | $1.0 \times 10^{-5}$ |
| ExS-3 | $2.0 \times 10^{-4}$ |
| ExC-1 | 0.14 |
| ExC-2 | 0.026 |
| ExC-3 | 0.020 |
| ExC-4 | 0.12 |
| ExC-5 | 0.016 |
| ExC-6 | 0.007 |
| Cpd-2 | 0.036 |
| Cpd-4 | 0.028 |
| HBS-1 | 0.16 |
| gelatin | 1.18 |

-continued

| The sixth layer (high-speed red-photosensitive emulsion layer) | |
|---|---|
| silver iodobromide emulsion D silver | 1.47 |
| ExS-1 | $3.7 \times 10^{-4}$ |
| ExS-2 | $1.0 \times 10^{-5}$ |
| ExS-3 | $1.8 \times 10^{-4}$ |
| ExC-1 | 0.18 |
| ExC-3 | 0.07 |
| ExC-6 | 0.029 |
| ExC-7 | 0.010 |
| ExY-5 | 0.008 |
| Cpd-2 | 0.046 |
| Cpd-4 | 0.077 |
| HBS-1 | 0.25 |
| HBS-2 | 0.12 |
| gelatin | 2.12 |
| **The seventh layer (interlayer)** | |
| Cpd-1 | 0.089 |
| solid-dispersed dye ExF-4 | 0.030 |
| HBS-1 | 0.050 |
| poly(ethyl acrylate) latex | 0.83 |
| gelatin | 0.84 |
| **The eighth layer (a layer providing an interimage effect to red-photosensitive layers)** | |
| silver iodobromide emulsion E silver | 0.560 |
| ExS-6 | $1.7 \times 10^{-6}$ |
| ExS-10 | $4.6 \times 10^{-4}$ |
| Cpd-4 | 0.030 |
| ExM-2 | 0.096 |
| ExM-3 | 0.028 |
| ExY-1 | 0.031 |
| HBS-1 | 0.085 |
| HBS-3 | 0.003 |
| gelatin | 0.58 |
| **The ninth layer (low-speed green-photosensitive emulsion layer)** | |
| silver iodobromide emulsion F silver | 0.39 |
| silver iodobromide emulsion G silver | 0.28 |
| silver iodobromide emulsion H silver | 0.35 |
| ExS-4 | $2.4 \times 10^{-5}$ |
| ExS-5 | $1.0 \times 10^{-4}$ |
| ExS-6 | $3.9 \times 10^{-4}$ |
| ExS-7 | $7.7 \times 10^{-5}$ |
| ExS-8 | $3.3 \times 10^{-4}$ |
| ExM-2 | 0.36 |
| ExM-3 | 0.045 |
| HBS-1 | 0.28 |
| HBS-3 | 0.01 |
| HBS-4 | 0.27 |
| gelatin | 1.39 |
| **The tenth layer (medium-speed green-photosensitive emulsion layer)** | |
| silver iodobromide emulsion I silver | 0.45 |
| ExS-4 | $5.3 \times 10^{-5}$ |
| ExS-7 | $1.5 \times 10^{-4}$ |
| ExS-8 | $6.3 \times 10^{-4}$ |
| ExC-6 | 0.009 |
| ExM-2 | 0.031 |
| ExM-3 | 0.029 |
| ExY-1 | 0.006 |
| ExM-4 | 0.028 |
| HBS-1 | 0.064 |
| HBS-3 | $2.1 \times 10^{-3}$ |
| gelatin | 0.44 |
| **The eleventh layer (high-speed green-photosensitive emulsion layer)** | |
| silver iodobromide emulsion I silver | 0.19 |
| silver iodobromide emulsion J silver | 0.80 |
| ExS-4 | $4.1 \times 10^{-5}$ |
| ExS-7 | $1.1 \times 10^{-4}$ |
| ExS-8 | $4.9 \times 10^{-4}$ |
| ExC-6 | 0.004 |
| ExM-1 | 0.016 |
| ExM-3 | 0.036 |

-continued

| | |
|---|---|
| ExM-4 | 0.020 |
| ExM-5 | 0.004 |
| ExY-5 | 0.003 |
| ExM-2 | 0.013 |
| Cpd-3 | 0.004 |
| Cpd-4 | 0.007 |
| HBS-1 | 0.18 |
| poly(ethyl acrylate) latex | 0.099 |
| gelatin | 1.11 |
| The twelfth layer (yellow filter layer) | |
| yellow colloidal silver silver | 0.047 |
| Cpd-1 | 0.16 |
| solid-dispersed dye ExF-5 | 0.020 |
| solid-dispersed dye ExF-6 | 0.020 |
| oil-soluble dye ExF-7 | 0.010 |
| HBS-1 | 0.082 |
| gelatin | 1.057 |
| The thirteenth layer (low-speed blue-photosensitive emulsion layer) | |
| silver iodobromide emulsion K silver | 0.18 |
| silver iodobromide emulsion L silver | 0.20 |
| silver iodobromide emulsion M silver | 0.07 |
| ExS-9 | $4.4 \times 10^{-4}$ |
| ExS-10 | $4.0 \times 10^{-4}$ |
| ExC-1 | 0.041 |
| ExC-8 | 0.012 |
| ExY-1 | 0.035 |
| ExY-2 | 0.71 |
| ExY-3 | 0.10 |
| ExY-4 | 0.005 |
| Cpd-2 | 0.10 |
| Cpd-3 | $4.0 \times 10^{-3}$ |
| HBS-1 | 0.24 |
| gelatin | 1.41 |
| The fourteenth layer (high-speed blue-photosensitive emulsion layer) | |
| silver iodobromide emulsion N silver | 0.75 |
| ExS-9 | $3.6 \times 10^{-4}$ |
| ExC-1 | 0.013 |
| ExY-2 | 0.31 |
| ExY-3 | 0.05 |
| ExY-6 | 0.062 |
| Cpd-2 | 0.075 |
| Cpd-3 | $1.0 \times 10^{-3}$ |
| HBS-1 | 0.10 |
| gelatin | 0.91 |

-continued

| | |
|---|---|
| The fifteenth layer (first protective layer) | |
| silver iodobromide emulsion O silver | 0.30 |
| UV-1 | 0.21 |
| UV-2 | 0.13 |
| UV-3 | 0.20 |
| UV-4 | 0.025 |
| F-18 | 0.009 |
| HBS-1 | 0.12 |
| HBS-4 | $5.0 \times 10^{-2}$ |
| gelatin | 2.3 |
| The sixteenth layer (second protective layer) | |
| H-1 | 0.40 |
| B-1 (having a diameter of 1.7 $\mu$m) | $5.0 \times 10^{-2}$ |
| B-1 (having a diameter of 1.7 $\mu$m) | 0.15 |
| B-3 | 0.05 |
| S-1 | 0.20 |
| gelatin | 0.75 |

In addition, as needed, in order to improve storability, processability, pressure resistance, fungi and bacteria resistance, antistatic property, and coatability, each layer contains Z-1~Z-5, B-4~B-6, F-1~F-18, an iron salt, a lead salt, a gold salt, a platinum salt, a palladium salt, an iridium salt, a ruthenium salt, or a rhodium salt. When the sample was prepared, calcium in an amount of $8.5\times10^{-3}$ g as an aqueous solution of calcium nitrate was added per mole of silver halide to the coating liquid for forming the eighth layer; and calcium in an amount of $7.9\times10^{-3}$ g as an aqueous solution of calcium nitrate was added per mole of silver halide to the coating liquid for forming the eleventh layer.

The AgI content, grain size, surface iodine content, etc. of each of the above-listed emulsions indicated by symbols are shown in Table 12. The surface iodine content can be examined by XPS in the following way. A sample was cooled to −115° C. in a vacuum of less than $1\times10^{-6}$ Pa; and the sample was irradiated with MgKa as a prove X ray at an X-ray source voltage of 8 kV and an X-ray current of 20 mA so as to carry out the measurements of Ag3d5/2, Br3d, and I3d5/2 electrons. The integrated intensities of the peaks were calibrated by sensitivity factors. Based on these intensity ratios, the surface iodine content was obtained.

TABLE 12

| Name of emulsion | Average iodine content (mol %) | Variation coefficient relating to inter-grain iodine distribution | Average grain diameter (equivalent-sphere diameter; $\mu$m) | Variation coefficient of equivalent-sphere diameters (%) | Diameter of projected area (equivalent-circle diameter; $\mu$m) | Diameter/thickness ratio | Surface iodine content (mol %) | Shape of grain |
|---|---|---|---|---|---|---|---|---|
| Emulsion A | 3.9 | 20 | 0.37 | 19 | 0.40 | 2.7 | 2.3 | Tabular grain |
| Emulsion B | 5.1 | 17 | 0.52 | 21 | 0.67 | 5.2 | 3.5 | Tabular grain |
| Emulsion C | 7.0 | 18 | 0.86 | 22 | 1.27 | 5.9 | 5.2 | Tabular grain |
| Emulsion D | 4.2 | 17 | 1.00 | 18 | 1.53 | 6.5 | 2.8 | Tabular grain |
| Emulsion E | 7.2 | 22 | 0.87 | 22 | 1.27 | 5.7 | 5.3 | Tabular grain |
| Emulsion F | 2.6 | 18 | 0.28 | 19 | 0.28 | 1.3 | 1.7 | Tabular grain |
| Emulsion G | 4.0 | 17 | 0.43 | 19 | 0.58 | 3.3 | 2.3 | Tabular grain |
| Emulsion H | 5.3 | 18 | 0.52 | 17 | 0.79 | 6.5 | 4.7 | Tabular grain |
| Emulsion I | 5.5 | 16 | 0.73 | 15 | 1.03 | 5.5 | 3.1 | Tabular grain |
| Emulsion J | 7.2 | 19 | 0.93 | 18 | 1.45 | 5.5 | 5.4 | Tabular grain |
| Emulsion K | 1.7 | 18 | 0.40 | 16 | 0.52 | 6.0 | 2.1 | Tabular grain |
| Emulsion L | 8.7 | 22 | 0.64 | 18 | 0.86 | 6.3 | 5.8 | Tabuiar grain |
| Emulsion M | 7.0 | 20 | 0.51 | 19 | 0.82 | 5.0 | 4.9 | Tabular grain |
| Emulsion N | 6.5 | 22 | 1.07 | 24 | 1.52 | 7.3 | 3.2 | Tabular grain |
| Emulsion O | 1.0 | — | 0.07 | — | 0.07 | 1.0 | — | Homogeneous structure |
| Emulsion P | 0.9 | — | 0.07 | — | 0.07 | 1.0 | — | Homogeneous structure |

In table 12:

(1) emulsions L~O were subjected to reduction sensitization by using thiourea dioxide and thiosulfonic acid according to examples of JP-A No. 2-191938;

(2) emulsions A~O were subjected to gold sensitization, sulfur sensitization, and selenium sensitization, in the presence of the spectral sensitizing dye described in the formation of each photosensitive layer and sodium thiocyanate, according to examples of JP-A No. 3-237450;

(3) when tabular grains were prepared, low-molecular-weight gelatin was used according to examples of JP-A No. 1-158426; and (4) dislocation lines such as those described in JP-A No. 3-237450 were observed by using a high-pressure electron microscope.

Preparation of Dispersions of Organic, Solid-dispersed Dyes:

ExF-2 was dispersed in the following way. Specifically, 21.7 ml of water, 3 ml of a 5% aqueous solution of sodium p-octylphenoxyethoxyethoxyethanesulfonate, and 0.5 g of a 5% aqueous solution of p-octylphenoxy polyoxyethylene ether (having a degree of polymerization of 10) were placed in a 700 ml pot mill. After the addition of 5.0 g of ExF-2 and 500 ml of zirconium oxide beads (having a diameter of 1 mm) into the pot mill, the contents were dispersed for 2 hours. For the dispersing operation, a vibration-type ball mill, model BO manufactured by Chuo Koki Co., Ltd., was used. After the dispersing operation, the contents were taken out and added into 8 g of a 12.5% aqueous solution of gelatin, and the beads were removed by filtration. In this way, a dye dispersion in gelatin was obtained. The average grain diameter of the dye grains was 0.44 μm.

In a similar way, solid dispersions of ExF-3, ExF-4, and ExF-6 were obtained. The average grain diameters of the dye grains were 0.24 μm, 0.45 μm, and 0.52 μm, respectively. ExF-5 was dispersed by the microprecipitation dispersing method described in Example 1 of European Patent Application Laid-Open No. (EP) 549,489A. The average grain diameter was 0.06 μm.

A solid dispersion of ExF-8 was dispersed in the following way. Water and 70 g of Z-2 were added to 1400 g of an ExF-8 wet cake containing 30% water and the resulting mixture was stirred. Furthermore, 70 g of ExF-8 was added and the resulting mixture was stirred. In this way, a slurry having an ExF-8 concentration of 30% was prepared. After that, the slurry was fed to ULTRAVISCOMILL (UVM-2) manufactured by Imex Corp. loaded with 1700 ml of zirconia beads having an average grain diameter of 0.5 mm, and the slurry was ground for 8 hours at a peripheral speed of 10 m/sec and a flow rate of 0.5 L/min.

The compounds used for the formation of the above-listed layers are indicated below.

ExC-1

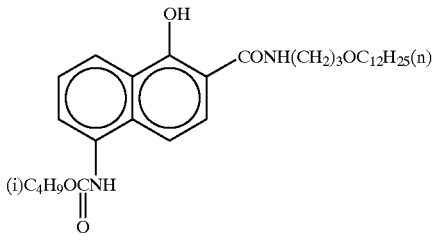

ExC-2

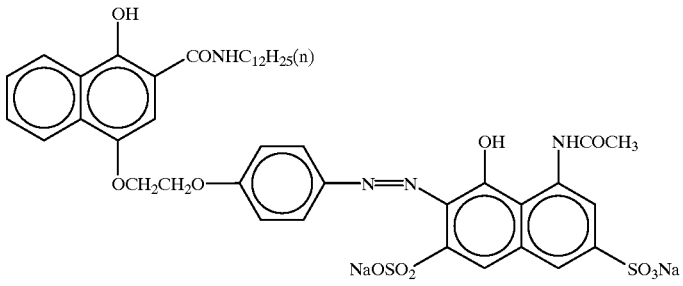

ExC-3

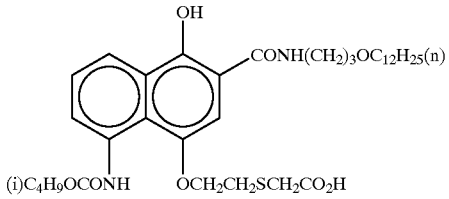

ExC-4

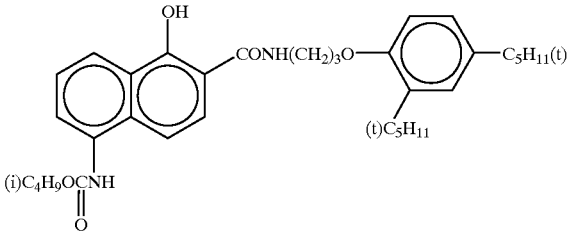

-continued
ExC-5
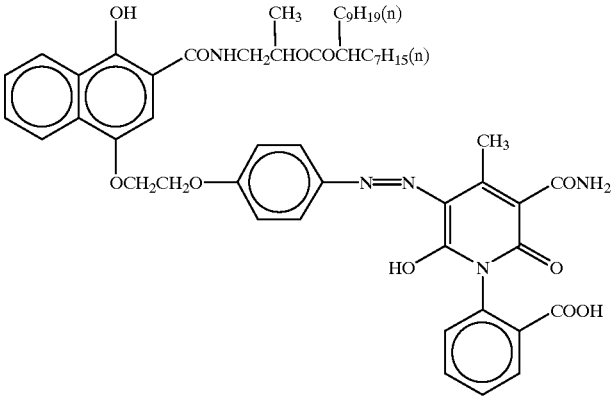
ExC-6
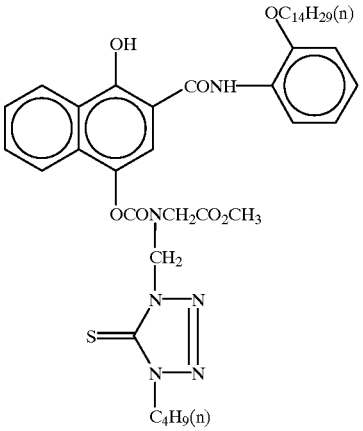
ExC-7
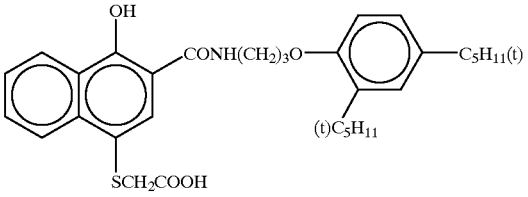
ExC-8
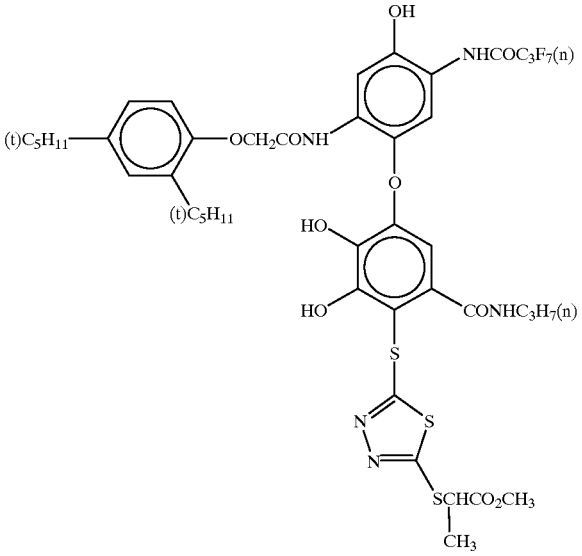

-continued
ExM-1
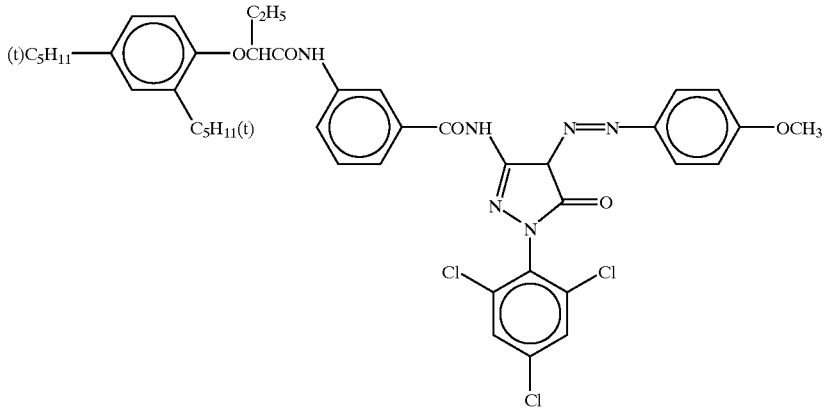
ExM-2
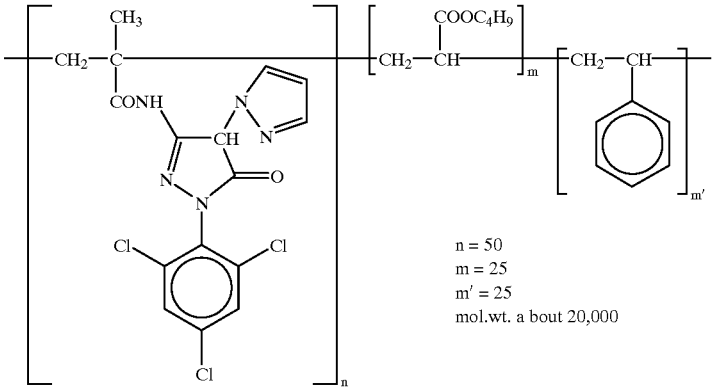
ExM-3
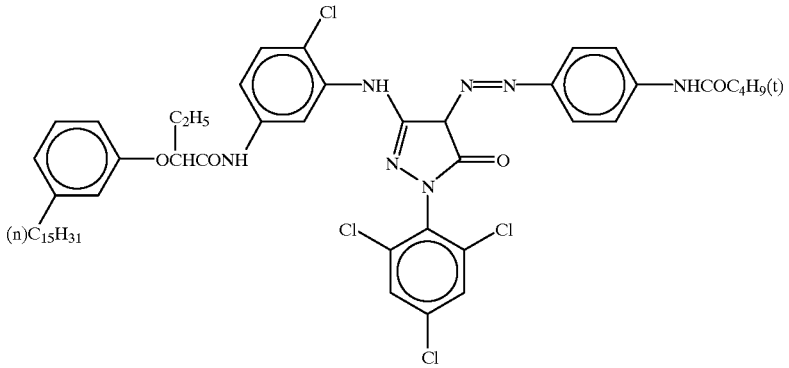
ExM-4
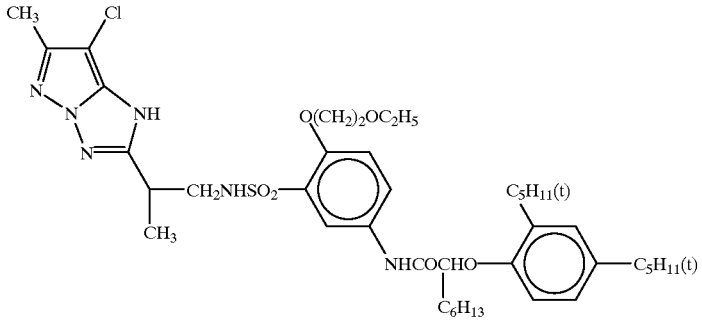

-continued
ExM-5
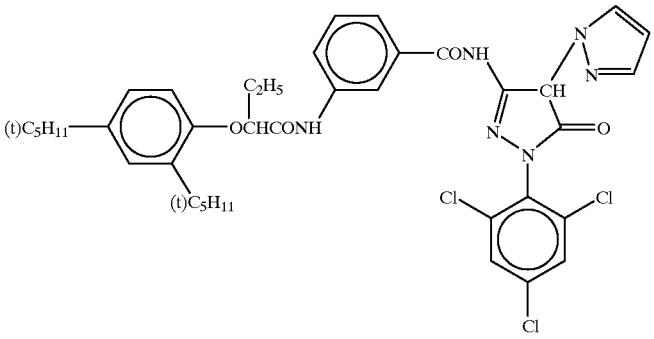
ExY-1
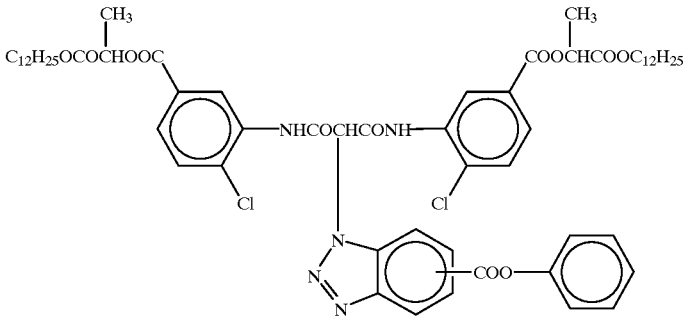
ExY-2
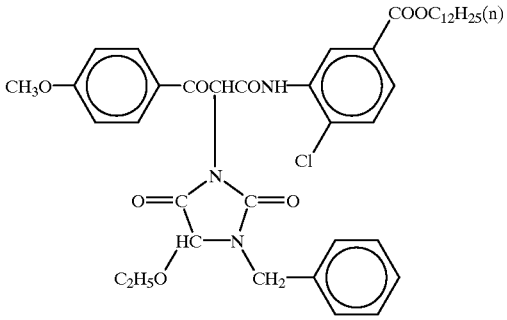
ExY-3
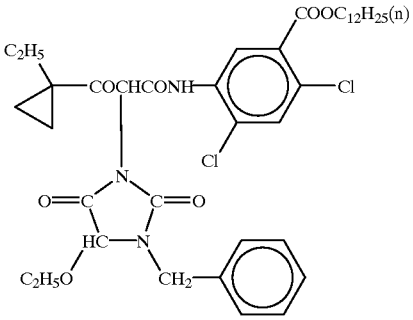
ExY-4
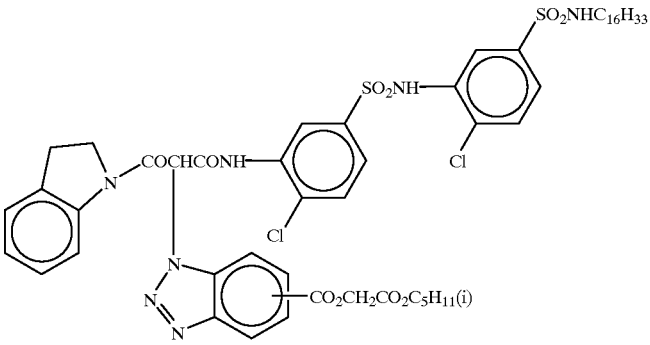

-continued
ExY-5
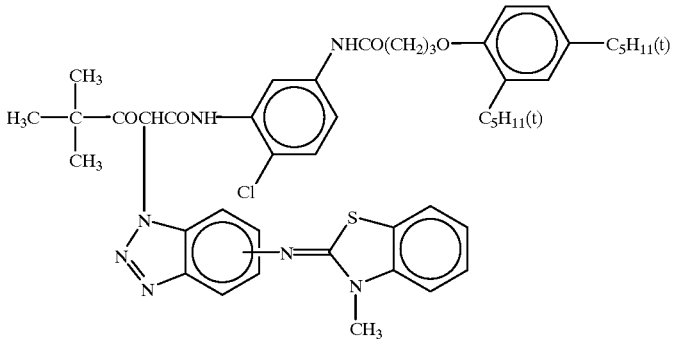
ExY-6
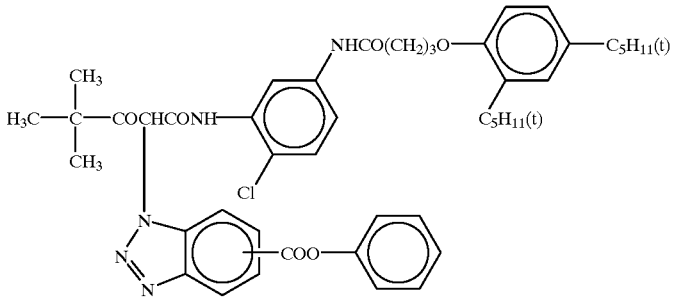
ExF-1
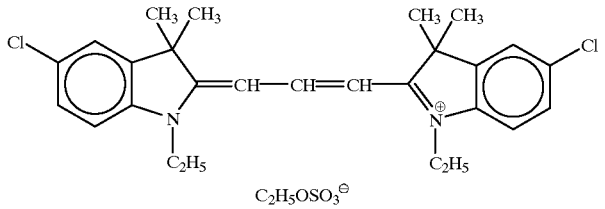
ExF-2
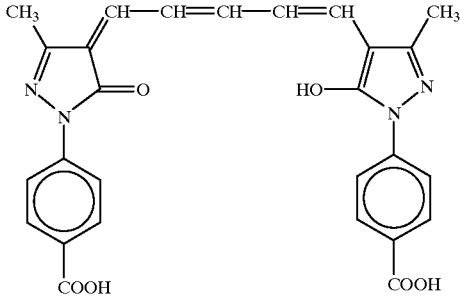
ExF-3
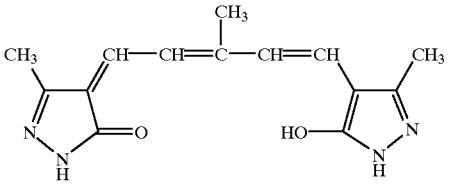
ExF-4
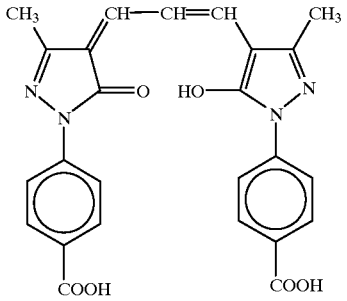
ExF-5
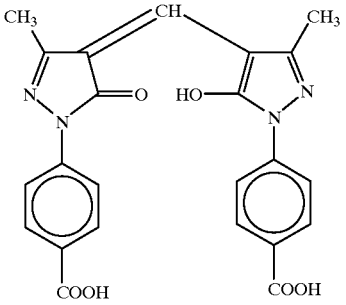

-continued
ExF-6
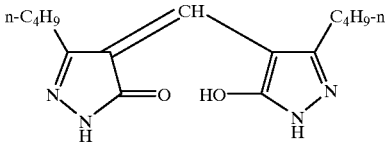
ExF-7
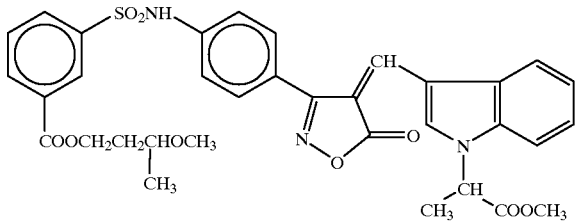
ExF-8
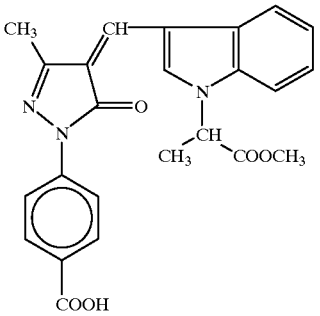
Cpd-1
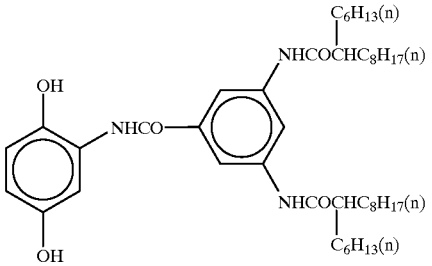
Cpd-2
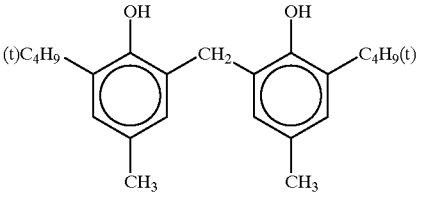
Cpd-3
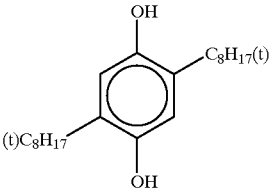
Cpd-4
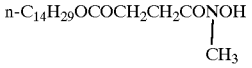
UV-1
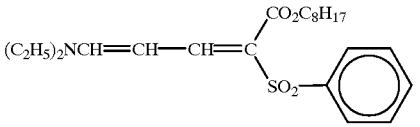
UV-2
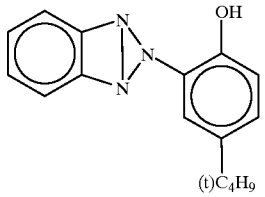
UV-3
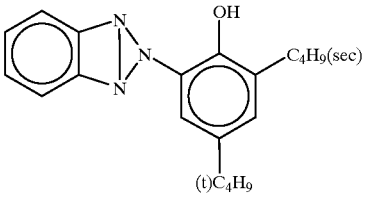
UV-4
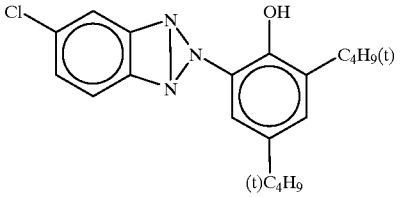
HBS-1
tricresyl phosphate -continued
HBS-2
di-n-butyl phthalate
HBS-3
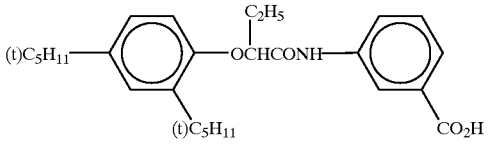
HBS-4
Tri (2-ethylhexyl) phosphate
ExS-1
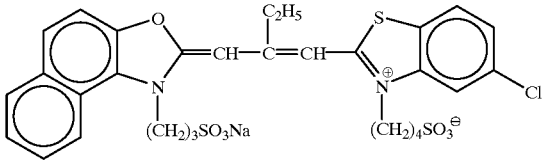
ExS-2
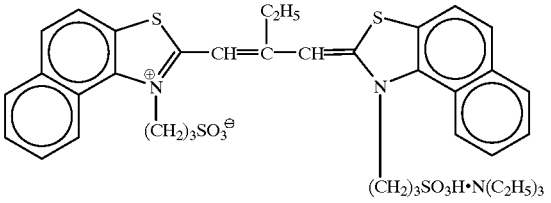
ExS-3
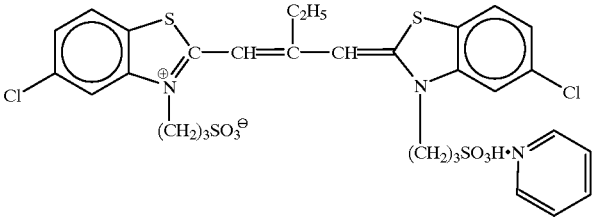
ExS-4
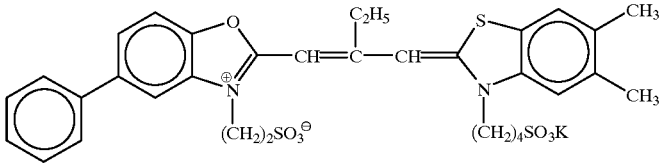
ExS-5
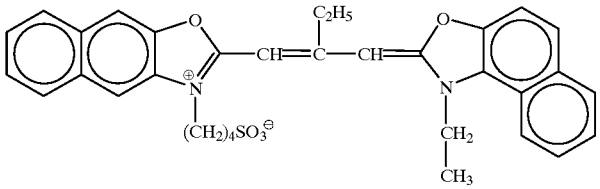
ExS-6
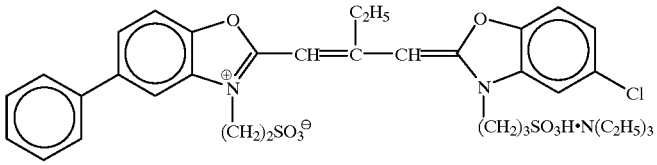
ExS-7
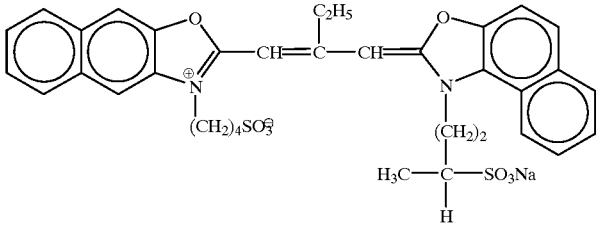

-continued
ExS-8
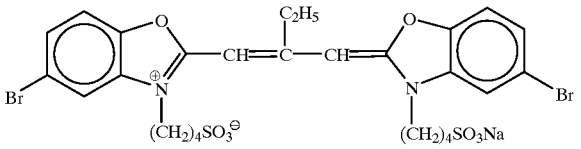
ExS-9
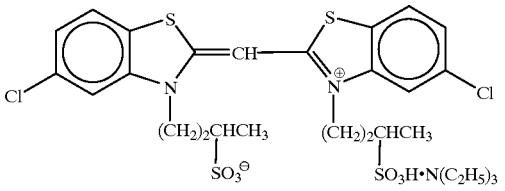
ExS-10
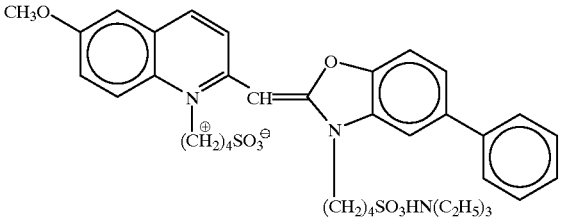
ExS-11
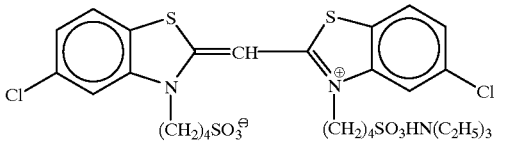
S-1
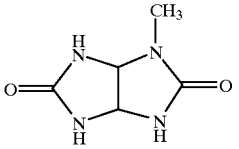
H-1
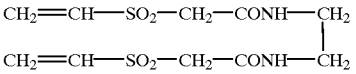
B-1
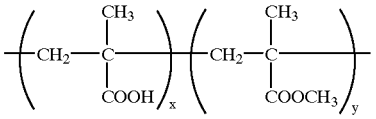
x/y = 10/90 (weight ratio)
average molecular weight:
about 35,000
B-2
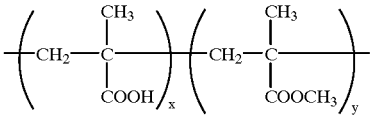
x/y = 40/60 (weight ratio)
average molecular weight:
about 20,000
B-3
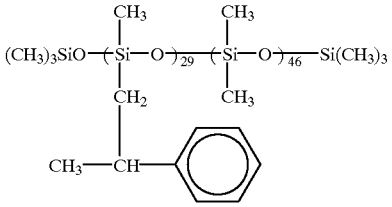
(molar ratio)
average molecular weight:
about 8,000
B-4
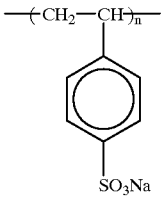
average molecular weight: about 750,000
B-5
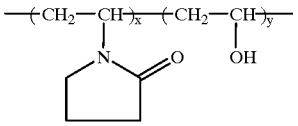
x/y = 70/30 (weight ratio)
average molecular weight:
about 17,000
B-6
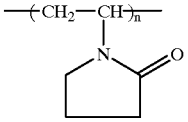
average molecular weight:
about 10,000
Z-1
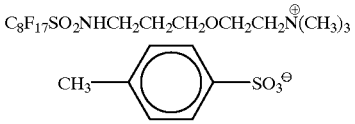

-continued
Z-2
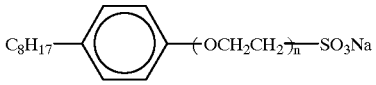
n = 2~4
Z-3
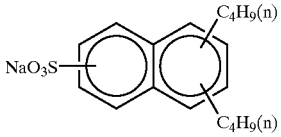
Z-4
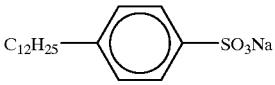
Z-5
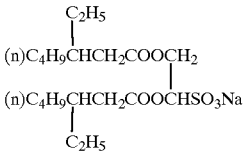
F-1
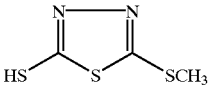
F-2
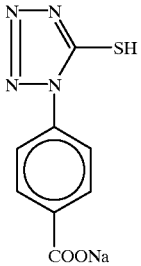
F-3
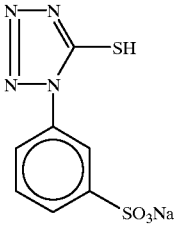
F-4
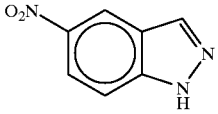
F-5
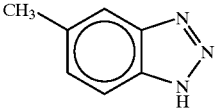
F-6
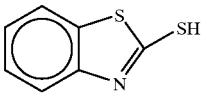
F-7
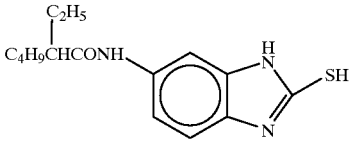
F-8
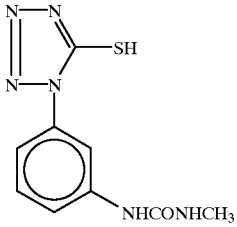
F-9
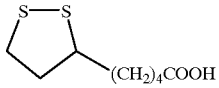
F-10
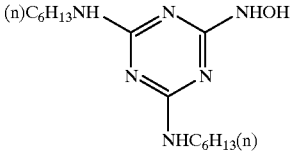
F-11
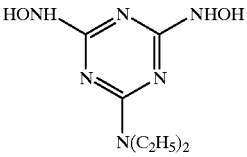
F-12
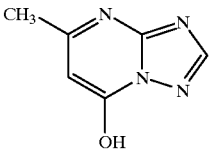

-continued

F-13

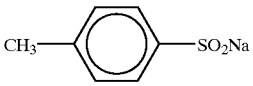

F-14

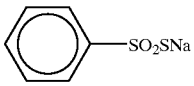

F-15

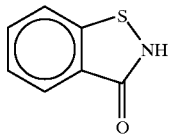

F-16

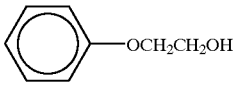

F-17

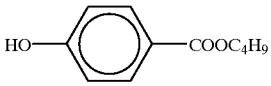

F-18

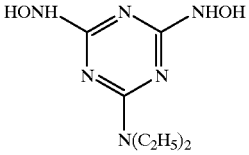

(Samples B102~B114)

As shown in Table 13, some dyes were selected from infrared-absorbing dyes indicated as exemplary compounds and from conventionally known infrared-absorbing dyes. These selected dyes were added, as shown in Table 14, to both or any one of the seventh layer (i.e., an interlayer between a group of red-photosensitive layers and a group of green-photosensitive layers) and the twelfth layer (i.e., a yellow filter layer between a group of green-photosensitive layers and a group of blue-photosensitive layers) of Sample B101. In this way, Samples B101~B114 were prepared. The amount added was 20 mg/m$^2$ for each layer. Each of the selected infrared-absorbing dyes was added in a form of a solid dispersion to the photosensitive material samples. The solid dispersion was prepared by the method described below.

Table 13 lists Samples B201~B209 prepared by coating with solid dispersions of dyes which were produced by this method and shows the dye retention percentages of these samples after processing by an automatic developing processor and after immersion in a BR buffer solution.

TABLE 13

| Sample number | Infrared-absorbing dye | $\lambda_{max}$ of sample after being coated | Dye retention percentage after processing by an automatic developing processor | Dye retention percentage after immersion in a BR buffer solution |
|---|---|---|---|---|
| B201 | (1) | 922 nm | 95% | 97% |
| B202 | (3) | 911 mm | 93% | 94% |
| B203 | (9) | 947 nm | 96% | 97% |
| B204 | (20) | 913 nm | 97% | 99% |
| B205 | (26) | 900 nm | 95% | 96% |
| B206 | (e) | 870 nm | 10% | 15% |
| B207 | (b) | 888 nm | 40% | 76% |
| B208 | (a) | 730 nm | 83% | 93% |
| B209 | (f) | 820 nm | 45% | 80% |

Samples B101~B114 were processed into the shape of 135-24Ex (i.e., an ordinary 35 mm film loaded in a patrone for 24 exposures) in compliance with ISO 1007 and used in the following tests.

Reference Example 1

<Preparation of Dispersions of Solid Grains>

A method of preparing a solid dispersion of an infrared-absorbing dye and a method of measuring the dye retention percentage in the coated layers after processing are shown below.

(Preparation of Dispersions of Solid Grains of a Dye)

The infrared-absorbing dyes shown in Table 13 were handled as wet cakes in order to protect the dyes as much as possible from being dried. 15 g of a 5% aqueous solution of carboxymethylcellulose was added to the wet cake in an amount equivalent to 2.5 g of dry solid components and well mixed together to produce a slurry having a total weight of 63.3 g. After that, 100 cc of glass beads having diameters of 0.8~1.2 mm and the slurry were placed in a dispersing machine (1/16G, sand grinder mill, manufactured by Imex Corp.). After the slurry was dispersed for 12 hours, water in an amount to produce a dye concentration of 2% was added. In this way, a dispersion of the dye was prepared.

(Preparation of Coated Samples)

A coating liquid having the following composition was applied onto a polyethylene terephthalate film which had been coated with a subbing layer, and thus a coated sample was prepared.

| | |
|---|---|
| (Coating liquid) | |
| gelatin | 3 g/m$^2$ |
| dispersion of solid grains of an infrared-absorbing dye (exemplary compound) | 25 mg/m$^2$ |
| 1,2-bis(vinylsulfonylacetamide) ethane (hardener) | 56 mg/m$^2$ |
| compound A | 20 mg/m$^2$ |

Compound A

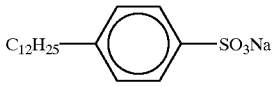

(Assessment of Coated Samples)

Using a spectrophotometer (U-2000, manufactured by Hitachi Ltd.), the values of maximum absorption wavelengths ($\lambda_{max}$) were obtained by measuring spectral absorption of the coated samples. Next, the coated samples were processed by an automatic development processor (FPM 9000, manufactured by Fuji Photo Film Co., Ltd.); and the dye retention percentage was obtained from the ratio between the absorption at $\lambda_{max}$ before the processing and the absorption at $\lambda_{max}$ after the processing. Further, the coated samples were immersed in a BR (Briton-Robinson) buffer solution having a pH value of 10.0 at 35° C. for 45 seconds; and the dye retention percentage was obtained from the ratio between the absorption at $\lambda_{max}$ before the immersion and the absorption at $\lambda_{max}$ after the immersion. The results are shown in Table 13.

(e)

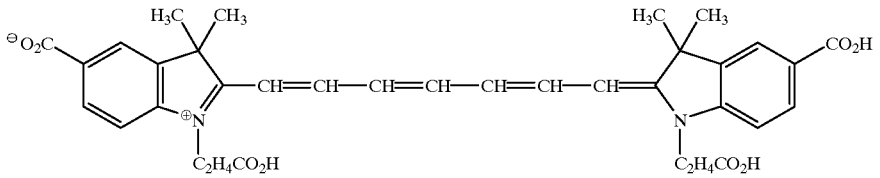

(1-8 described in JP-A No.3-138640)

(b)

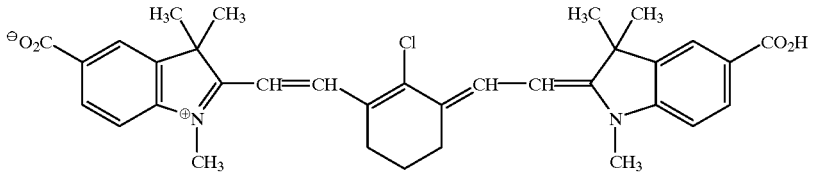

(1-9 described in JP-A No.3-138640)

(a)

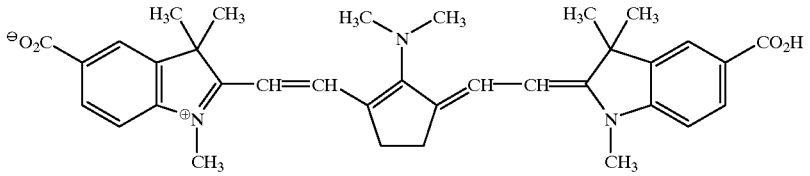

(1-10.described in JP-A No.3-138640)

(f)

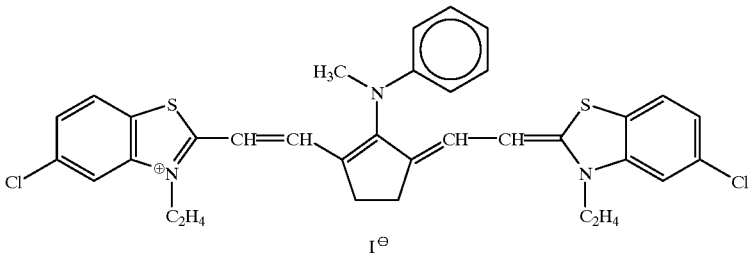

(1-9 described in JP-A No.1-266536)

The exemplary compounds (1), (3), (9), (20), and (26), which are infrared-absorbing dyes, all exhibited infrared absorption wavelengths and high dye retention percentages, which are desirable.

2. Development Process

As an apparatus for the development process and reading image information according to the method of the present invention, use was made of an experimental development processor which was equipped with an image-reading device and which was obtained by remodeling an automatic development processor (FP-363SC, manufactured by Fuji Photo Film Co., Ltd.) in the following way, including attaching thereto an image-reading device. By using the experimental development processor, the image processing and reading of image information were carried out according to the development specification described below. That is, the bleaching tank of the automatic development processor (FP-363SC, manufactured by Fuji Photo Film Co., Ltd.) was converted into a rinsing tank; a transfer passageway, which takes out the film from the rinsing tank and feeds the film to a first image-reading zone via a reservoir, was provided; and the first image-reading zone was linked to another reservoir and a second image-reading zone.

In the above-mentioned apparatus, the film flows in the following way. That is, the color film is developed in the developing tank. After that, the film is rinsed with water in the first rinsing tank, and fed from the first rinsing tank by means of a transfer mechanism. Via a reservoir, the film then arrives at the first image-reading zone in which the first image information reading of the cyan images in the red-photosensitive layer is carried out from the back of the film by using reflected light. After this readout, the film is fed by means of a transfer mechanism via another reservoir to the second image-reading zone in which the second image information reading of the green-photosensitive layer and the blue-photosensitive layer is carried out by using transmitted light.

In the method of the present invention, the color film after being read, may be disposed. The color film after being read may be used as digital image information, or otherwise a color print or the like may be output from the color film after being read. In addition, the color film after being read may be preserved as a development-processed film. For this purpose, in the above-described experimental apparatus, the original stabilizing tank (2) is converted into a bleach-fixing tank and is filled with a bleach-fixing solution, while the stabilizing tank (3) is filled with a stabilizing solution. Accordingly, a development-processed film having the same image quality as that of a development-processed film obtained in a commercial color laboratory can also be obtained by desilvering the film after being read in the bleach-fixing tank, stabilizing the images of the desilvered film in the stabilizing tank, and passing the stabilized film through the drying zone. However, in this case, the developing tank needs to use a standard color developing solution or a developing solution similar thereto.

The samples B101~B114 were processed according to the following processing specification.

(Processing steps)

| step | processing time | processing temperature | replenished amount* | tank capacity |
|---|---|---|---|---|
| color development | 3 minutes and 5 seconds | 38.0° C. | 20 ml | 10.3 L |
| first rinse | 25 seconds | 38.0° C. | 10 ml | 3.6 L |
| transfer via a reservoir | | | | |
| the first readout of images | | | | |
| transfer via a reservoir | | | | |
| the second readout of images | | | | |
| [if necessary, the following additional processing may be made (outside of the scope of the present invention)] | | | | |
| bleach-fixing | 13 seconds | 38.0° C. | 5 ml | 1.9 L |
| stabilization | 13 seconds | 38.0° C. | 30 ml | 1.9 L |
| drying | 30 seconds | 60° C. | | |

* The replenished amount is based on a photosensitive material having a width of 35 mm and a length of 1.1 m (corresponding to one roll of 24 Ex.).

The compositions of the processing solutions are described below.

| | tank solution (g) | |
|---|---|---|
| | replenisher | solution (g) |
| (color developing solution) | | |
| diethylenetriamine-pentaacetic acid | 2.0 | 4.0 |
| sodium 4,5-dihydroxybenzene-1,3-disulfonate | 0.4 | 0.5 |
| hydroxylamine | 10.0 | 15.0 |
| sodium sulfite | 4.0 | 9.0 |
| diethylene glycol | 10.0 | 17.0 |
| potassium carbonate | 39.0 | 59.0 |
| ethyleneurea | 3.0 | 5.5 |
| potassium bromide | 1.4 | — |

-continued

| | tank solution (g) | |
|---|---|---|
| | replenisher | solution (g) |
| 2-methyl-4-[N-ethyl-N-(β-hydroxyethyl) amino]aniline sulfuric acid salt | 4.7 | 11.4 |
| water to make | 1.0 L | 1.0 L |
| pH (controlled by potassium hydroxide and sulfuric acid) | 10.05 | 10.25 |

The following is not within the scope of the present invention but is used for additional processing.

| (bleach-fixing solution) | | |
|---|---|---|
| 1,3-diaminopropanetetraacetic acid ferric ammonium salt monohydrate | 120 g | 180 g |
| ammonium bromide | 50 g | 70 g |
| ammonium thiosulfate (750 g/L) | 280 ml | 1000 ml |
| ammonium hydrogensulfite aqueous solution (72%) | 20 g | 80 g |
| imidazole | 5 g | 45 g |
| 1-mercapto-2-(N,N-dimethylaminoethyl) tetrazole | 1 g | 3 g |
| succinic acid | 30 g | 50 g |
| maleic acid | 40 g | 60 g |
| water to make | 1.0 L | 1.0 L |
| pH (controlled by aqueous ammonia and nitric acid) | 4.6 | 4.0 |

| (stabilizing solution) | common to tank solution and replenisher solution |
|---|---|
| sodium p-toluenesulfonate | 0.03 g |
| p-nonylphenoxy polyglycidol (average degree of polymerization of glycidol: 10) | 0.4 g |
| ethylenediamine-tetraacetic acid disodium salt | 0.05 g |
| 1,2,4-triazole | 1.3 g |
| 1,4-bis(1,2,4-triazole-1-yl-methyl)piperazine | 0.75 g |
| 1,2-benzoisothiazoline-3-one | 0.10 g |
| water to make | 1.0 L |
| pH | 8.5 |

[Referential Example (Standard Development Process)]

In order to show that the quality of the images obtained by the method described in Example B-1 was equivalent to the quality of the images obtained by general-purpose processing usually adopted in the market of color photography, development process as a referential example was also carried out by the standard processing described previously. The standard processing was carried out by the following development processor for color negative according to the following processing specification. That is, an automatic development processor, FP-363SC, manufactured by Fuji Photo Film Co., Ltd., was used as the automatic development processor; and the processing steps and the compositions of the processing solutions were as follows.

(Processing Steps)

| step | processing time | processing temperature | replenished amount* | tank capacity |
|---|---|---|---|---|
| color development | 3 minutes and 5 seconds | 38.0° C. | 20 ml | 10.3 L |
| bleaching | 50 seconds | 38.0° C. | 5 ml | 3.6 L |
| fixing (1) | 50 seconds | 38.0° C. | — | 3.6 L |
| fixing (2) | 50 seconds | 38.0° C. | 7.5 ml | 3.6 L |
| stabilization (1) | 20 seconds | 38.0° C. | — | 1.9 L |
| stabilization (2) | 20 seconds | 38.0° C. | — | 1.9 L |
| stabilization (3) | 20 seconds | 38.0° C. | 30 ml | 1.9 L |
| drying | 1 minute and 30 seconds | 60° C. | | |

*The replenished amount is based on a photosensitive material having a width of 35 mm and a length of 1.1 m (corresponding to one roll of 24 Ex.).

The stabilizing solution was in a state of a counter-current flow of (3)→(2)→(1); and the piping for the fixing solution was also in a state of a counter-current flow of (2)→(1). The amount of carryover of the developing solution to the bleaching step, the amount of carryover of the bleaching solution to the fixing step, the amount of carryover of the fixing solution to the water-rinsing step were 2.5 ml, 2.0 ml, and 2.0 ml, respectively, based on a photosensitive material having a width of 35 mm and a length of 1.1 m. The crossover time periods were 6 seconds each. Each crossover time was included in the processing time of the preceding step.

The compositions of the processing solutions are described below.

| | tank solution (g) | |
|---|---|---|
| | replenisher | solution (g) |
| (color developing solution) | | |
| diethylenetriamine-pentaacetic acid | 2.0 | 4.0 |
| sodium 4,5-dihydroxybenzene-1,3-disulfonate | 0.4 | 0.5 |
| hydroxylamine | 10.0 | 15.0 |
| sodium sulfite | 4.0 | 9.0 |
| diethylene glycol | 10.0 | 17.0 |
| potassium carbonate | 39.0 | 59.0 |
| ethyleneurea | 3.0 | 5.5 |
| potassium bromide | 1.4 | — |
| 2-methyl-4-[N-ethyl-N-(β-hydroxyethyl)amino]aniline sulfuric acid salt | 4.7 | 11.4 |
| water to make | 1.0 L | 1.0 L |
| pH (controlled by potassium hydroxide and sulfuric acid) | 10.05 | 10.25 |
| (bleaching solution) | | |
| 1,3-diaminopropanetetraacetic acid ferric ammonium salt monohydrate | 128 | 180 |
| ammonium bromide | 50 | 70 |
| succinic acid | 30 | 50 |
| imidazole | 20 | 30 |
| maleic acid | 40 | 60 |
| water to make | 1.0 L | 1.0 L |
| pH (controlled by aqueous ammonia) | 4.4 | 4.0 |
| (fixing solution) | | |
| ammonium hydrogensulfite aqueous solution (72%) | 20 | 80 |
| ammonium thiosulfate (750 g/L) | 280 ml | 1000 ml |
| imidazole | 5 | 45 |
| 2-(N,N-dimethyl) ethylaminomercaptotetrazole | 1.0 | 3.0 |
| ethylenediamine-tetraacetic acid | 8 | 12 |
| water to make | 1.0 L | 1.0 L |
| pH (controlled by aqueous ammonia and acetic acid) | 7.0 | 7.0 |

| (stabilizing solution) | common to tank solution and replenisher solution (g) |
|---|---|
| sodium p-toluenesulfonate | 0.03 |
| p-nonylphenoxy polyglycidol (average degree of polymerization of glycidol: 10) | 0.4 |
| ethylenediamine-tetraacetic acid disodium salt | 0.05 |
| 1,2,4-triazole | 1.3 |
| 1,4-bis(1,2,4-triazole-1-yl-methyl)piperazine | 0.75 |
| 1,2-benzoisothiazoline-3-one | 0.10 |
| water to make | 1.0 L |
| pH | 8.5 |

3. Reading Out of Images and Image Processing

Using Samples B101~B114, the first and second image information read out in the first and second image information-reading zones 312 and 314 illustrated in FIG. 21 was formed into positive images in the digital image-processing zone 270 illustrated in FIG. 25, and the positive images were output to a printer. The radiation light for reading the first image information was light having a transmission band wavelength region of 900 to 990 nm emitted from a tungsten lamp source combined with a chromium-deposited interference filter. A reading device, comprising a tungsten halogen lamp combined with red, blue, and green filters for a color image densitometer, was used for reading the second image information; and the images of the intermediate photosensitive layers were measured by using a green filter.

As an example of commercially available inputting machines capable of converting images for input into electric image signals and forming positive images by inputting the signals, a high-speed scanner/image processing workstation, SP-1000 (manufactured by Fuji Photo Film Co., Ltd.), was used. As an example of commercially available outputting machines, A laser printer/paper processor, LP-1000P (manufactured by Fuji Photo Film Co., Ltd.), was used. As for SP-1000, the program software was altered so that the above-described image processing could be carried out.

For the purpose of standard processing, MINI LABO PP-1257V, which is now generally used as a surface exposure system, was used. This apparatus is a printer processor usually employed currently in the market. It is mounted with a printer based on a simultaneous whole image exposure system, printing on a sheet of color paper with light transmitted through a color negative after being developed and adjusting color balance and exposure amount for printing by controlling the filters.

For printing the films after development of Samples B101~B114 and Referential Example (according to standard processing), FUJI COLOR PAPER SUPER FA Type D, which is commercially available as color paper, was used. For development process, a color paper processing prescription, CP-48S, and processing solutions therefor (all manufactured by Fuji Photo Film Co., Ltd.) were used.

4. Methods for Testing Photographic Properties

The photographic properties were assessed by the following 3 tests.

(1) Image Sharpness

The test for image sharpness was conducted by MTF frequency responsiveness to rectangular wave in accordance with a JIS method.

In the test, the response characteristic values at frequencies of 40 lines/mm and 8 lines/mm were used as criteria for the sharpness.

(2) Sensory Evaluation

By using each experimental film, snapshots of a person were taken against a gray wall background under the illumination of a standard light source C described in ISO 5800 (method for measuring the sensitivity of color negative films) by three levels of exposure amounts, i.e., a standard exposure amount, an underexposure by ½, and an overexposure at 4 times the standard exposure amount. After that, development process was carried out according to the processing condition described above to thereby prepare negative films for evaluation.

Next, prints of color images were obtained from the above-described negative images. The overall image qualities, attaching importance to color and gradation, of the color prints for evaluation, were assessed by ten persons specialized in photography evaluation. The rating was made by the following 5 point-method and averages were used as the criteria.

| | Point |
|---|---|
| very poor and unacceptable | 1 |
| slightly poor and unacceptable | 2 |
| relatively poor but acceptable | 3 |
| relatively good and desirable | 4 |
| very desirable | 5 |

5. Test Results

The test results are shown in Table 14.

TABLE 14

| | Infrared-absorbing dye* | | Image sharpness | | Image qualities (sensory evaluation) | | | |
|---|---|---|---|---|---|---|---|---|
| | | | | | 2 grades less | | 4 grades | |
| Sample | seventh layer | twelfth layer | 8 lines/mm | 40 lines/mm | in aperture scale | Standard | greater in aperture scale | Remarks |
| B101 | — | — | 80 | 16 | 2.5 | 3.0 | 2.0 | Comparative example |
| B102 | (1) | — | 85 | 23 | 3.0 | 3.5 | 2.5 | Present invention |
| B103 | (9) | — | 85 | 22 | 2.5 | 3.0 | 2.5 | Present invention |
| B104 | (26) | — | 85 | 22 | 3.0 | 3.5 | 2.5 | Present invention |
| B105 | — | (1) | 85 | 24 | 3.0 | 3.0 | 3.0 | Present invention |
| B106 | — | (9) | 85 | 20 | 3.0 | 3.0 | 3.0 | Present invention |
| B107 | (1) | (1) | 88 | 25 | 3.5 | 3.5 | 3.0 | Present invention |
| B108 | (3) | (3) | 88 | 25 | 3.5 | 3.5 | 3.5 | Present invention |
| B109 | (9) | (9) | 85 | 24 | 3.5 | 4.0 | 4.0 | Present invention |
| B110 | (20) | (20) | 85 | 24 | 3.5 | 4.0 | 3.5 | Present invention |
| B111 | (26) | (26) | 85 | 24 | 3.5 | 3.5 | 3.5 | Present invention |
| B112 | (a) | (a) | 80 | 20 | 3.0 | 3.0 | 3.0 | Present invention |
| B113 | (e) | (e) | 78 | 19 | 3.0 | 3.5 | 3.0 | Present invention |
| B114 | (f) | (f) | 78 | 20 | 3.0 | 3.0 | 2.5 | Present invention |
| (B101) | — | — | 85 | 21 | 3.0 | 3.5 | 3.0 | Referential example |

Note:

*the number in parenthesis infrared-absorbing dye column indicates the number of the exemplary compound.

As can be seen from Table 14, Sample B101 of Comparative Example containing no infrared-absorbing dye exhibits inferior image sharpness and unsatisfactory results of image qualities by sensory evaluation. This is presumably caused by the remaining silver fine grains that are found in the sample after being developed. By contrast, Samples B102~B114, which used infrared-absorbing dyes listed as the exemplary compounds, exhibited better results than the Comparative Example for all of the evaluation items and provided satisfactory image qualities particularly in sensory evaluation. Sample B112, which used the conventionally known infrared-absorbing dye (a) whose absorption wavelength (730 nm) is shorter than the range desirable for use in the present invention, exhibited slightly poor resolution relative to Samples B102~B111. Samples B113 and B114, which used the conventionally known infrared-absorbing dye (e) or (f) whose dye retention percentage is lower than the range desirable for use in the present invention, exhibited slightly poorer resolution relative to Samples B102~B111 and slightly poorer results by sensory evaluation due to color muddiness or the like. However, all of these samples had better results in sensory evaluation and resolution relative to Sample B101 containing no infrared-absorbing dye.

In comparison with the sample obtained by standard development process of Sample B101 illustrated as a referential example considered to represent average market quality of market, the samples of the present invention show that the method of the present invention could achieve simplicity and rapidity aimed while at least maintaining image qualities, if not enhancing image qualities, despite the omission of post-steps of the development process.

Example B-2

The testing procedure of Example B-1 was repeated, except that the color development process was replaced by the following black-and-white development process and the wavelengths of the light for reading the second image information were obtained by using a chromium-deposited interference filter having a transmission wavelength region in 1100 to 1180 nm.

The processing, reading step, and compositions of the processing solutions are as follows.

(Processing Steps)

| step | processing time | processing temperature | replenished amount* | tank capacity |
|---|---|---|---|---|
| black-and-white development | 60 seconds | 38.0° C. | 10 ml | 10.3 L |
| rinse (water bath) | 13 seconds | 38.0° C. | 10 ml | 3.6 L |
| transfer via a reservoir | | | | |
| the first readout of images | | | | |
| transfer via a reservoir | | | | |
| the second readout of images | | | | |

| [black-and-white developing solution] | [tank solution] |
|---|---|
| nitro-N,N,N-trimethylenesulfonic acid pentasodium salt | 1.5 g |
| diethylenetriamine-pentaacetic acid pentasodium salt | 2.0 g |
| sodium sulfite | 30 g |
| potassium hydroquinonemonosulfonate | 20 g |
| potassium carbonate | 15 g |
| potassium hydrogencarbonate | 12 g |
| 1-phenyl-4-methyl-4-hydroxymethyl-3-pyrazolidone | 1.5 g |
| potassium bromide | 2.5 g |
| potassium thiocyanate | 1.2 g |
| potassium iodide | 2.0 mg |
| diethylene glycol | 13 g |
| water to make | 1000 ml |
| pH | 9.60 |

The pH was controlled by sulfuric acid or potassium hydroxide.

The results are shown in Table 15. Table 15 indicates that, despite black-and-white development, Example B-2 provides image qualities approximately equivalent to those of Example B-1. Accordingly, it was found that, when black-and-white development was applied to the color image forming method of the present invention, the advantages were easy control of the developing solution, reduced tendency to produce smudges during development process, and shorter development time in addition image qualities not inferior to image qualities obtained by using a color developing solution.

TABLE 15

| | Infrared-absorbing dye* | | Image sharpness | | Image qualities (sensory evaluation) | | | |
|---|---|---|---|---|---|---|---|---|
| | | | | | 2 grades less | | 4 grades | |
| Sample | seventh layer | twelfth layer | 8 lines/mm | 40 lines/mm | in aperture scale | Standard | greater in aperture scale | Remarks |
| B101 | — | — | 75 | 15 | 2.0 | 2.5 | 2.5 | Comparative example |
| B102 | (1) | — | 85 | 23 | 2.5 | 3.5 | 2.5 | Present invention |
| B103 | (9) | — | 85 | 22 | 2.5 | 3.0 | 2.5 | Present invention |
| B104 | (26) | — | 85 | 22 | 3.0 | 3.5 | 3.0 | Present invention |
| B105 | — | (1) | 85 | 24 | 3.0 | 3.0 | 3.0 | Present invention |
| B106 | — | (9) | 85 | 20 | 3.0 | 3.0 | 3.0 | Present invention |
| B107 | (1) | (1) | 88 | 25 | 3.5 | 3.5 | 3.0 | Present invention |
| B108 | (3) | (3) | 88 | 25 | 3.5 | 3.5 | 3.5 | Present invention |
| B109 | (9) | (9) | 85 | 24 | 3.5 | 3.5 | 4.0 | Present invention |
| B110 | (20) | (20) | 85 | 24 | 3.5 | 4.0 | 3.5 | Present invention |
| B111 | (26) | (26) | 85 | 24 | 3.5 | 3.5 | 3.5 | Present invention |
| B112 | (a) | (a) | 80 | 20 | 2.5 | 3.0 | 2.5 | Present invention |
| B113 | (e) | (e) | 78 | 19 | 3.0 | 3.0 | 3.0 | Present invention |
| B114 | (f) | (f) | 78 | 20 | 2.5 | 3.0 | 2.5 | Present invention |

Note: the number in parenthesis in the infrared-absorbing dye column indicates the number of the exemplary compound.

Example B-3

For Sample B102, the procedure for color development process in Example B-1 was changed such that the first readout of images was carried out only for the red-photosensitive layer (i.e., cyan image layer), and the blue-photosensitive layer (i.e., yellow image layer) was read by transmitted light using an image-reading device equipped with a blue filter. A color print with little color muddiness was obtained and the sensory evaluation result of the color print thus obtained was approximately equivalent to that of Example B-1

Example B-4

Sample B115 was prepared by the same procedure as in the preparation of Sample B102, except that the black colloidal silver of the first layer of Sample B102 was replaced by 0.2 mmol/$m^2$ of the exemplary dye (III-3) and the black colloidal silver of the second layer of Sample B102 was replaced by 0.1 mmol/$m^2$ of the exemplary dye (III-3). Sample B115 was tested according to the same method as in Example B-1. The results are shown in Table 16.

Table 16 shows the results of the samples of the present invention. According to the results, Sample B115, which uses an interlayer containing an infrared-absorbing dye and an antihalation layer wherein black colloidal silver grains are replaced by a decolorization-type dye, exhibits better image sharpness and clearly better image qualities in sensory evaluation in a wide exposure range from underexposure to overexposure, relative to Sample B102 which uses an antihalation layer containing black colloidal silver grains.

TABLE 16

| | Image sharpness | | Image qualities (sensory evaluation) | | |
|---|---|---|---|---|---|
| | | | 2 grades minus in | | 4 grades plus in |
| Sample | 8 lines/mm | 40 lines/mm | aperture scale | Standard | aperture scale |
| B102 | 85 | 23 | 3.0 | 3.5 | 2.5 |
| B115 | 90 | 26 | 3.5 | 4.0 | 3.0 |

Example C-1

1. Preparation of a Color Negative Film Sample

A color negative film sample C101 was prepared by the same method as in the preparation of Sample B101 , except that the first layer (i.e., the first antihalation layer) and the second layer (i.e., the second antihalation layer) of Sample B101 prepared in Example B-1 were changed to the following construction.

| The first layer (the first antihalation layer) | | |
|---|---|---|
| black colloidal silver | silver | 0.163 |
| silver iodobromide emulsion P | silver | 0.01 |
| gelatin | | 0.87 |
| ExC-1 | | 0.002 |
| ExC-3 | | 0.002 |
| Cpd-2 | | 0.001 |
| HBS-1 | | 0.004 |
| HBS-2 | | 0.002 |

-continued

| The second layer (the second antihalation layer) | | |
|---|---|---|
| black colloidal silver | silver | 0.066 |
| gelatin | | 0.407 |
| ExM-1 | | 0.050 |
| ExF-1 | | $2.0 \times 10^{-3}$ |
| HBS-1 | | 0.074 |

Samples C101 was processed into a shape of 135-24Ex (i.e., an ordinary 35 mm film loaded in a patrone for 24 exposures) in compliance with ISO 1007 and used in the following tests.

(Samples C102~C111)

Samples C102~C110 were prepared by the same method as in the preparation of Sample C101, except that the black colloidal silver (0.163 g/$m^2$) of the first layer (i.e., the first antihalation layer) and the black colloidal silver (0.069 g/$m^2$) of the second layer (i.e., the second antihalation layer) of Sample C101 were replaced, respectively, by some of the decolorization-type antihalation dyes illustrated as exemplary compounds as shown in Table 17. The amounts added of the decolorization-type antihalation dyes were 0.2 mmol/$m^2$ for the first layer (i.e., the first antihalation layer) and 0.1 mmol/$m^2$ for the second layer (i.e., the second antihalation layer).

In addition, a sample containing neither colloidal silver nor decolorization-type antihalation dye was prepared and this sample was designated as Sample C111.

Each of the above-mentioned exemplary compounds was added as a dispersion of solid grains. The dispersion of solid grains of the exemplary compound (III-6) was prepared in the following way. Solid dispersions of other exemplary compounds were also prepared in accordance with this method.

<Preparation of a Dispersion of Solid Fine Grains>

A wet cake of the decolorization-type antihalation dye (III-6) in an amount equivalent to a net weight of 240 g, 48 g of a dispersing aid W-38, and water in an amount required to make 4000 g in total were used. These materials were charged into a "flow-type sand grinder mill" (UVM-2)" (manufactured by Imex Co. Ltd.) loaded with 1.7 L of zirconia beads (having a diameter of 0.5 mm) and ground for 2 hours at a flow rate of 0.5 L/min and a peripheral speed of 10 m/s. The dispersion obtained as a product was diluted with water so that the concentration of the compound became 3% by weight. The dispersion was subjected to a heat treatment at 90° C. for 10 hours and a dispersion aid W-2, which is a dispersion aid to be added after dispersing step, was added in an amount equivalent to 3% by weight of the decolorization-type antihalation dye.

Sample C101 and Samples C102~C111 were processed into the shape of 135-24Ex (i.e., an ordinary 35 mm film loaded in a patrone for 24 exposures) in compliance with ISO 1007 and used in the following tests.

2. Development Process

Development process was carried out in the same way as in Example B-1.

In addition, In order to show that the quality of the images obtained by the method of the present invention was equivalent to the quality of the images obtained by general-purpose processing usually adopted in the color photography market, development process as a referential example was also carried out by the standard processing which was the same procedure as in Example B-1.

3. Reading Out of Images and Image Processing

Reading out of images and image processing were carried out according to the same procedure as for Example B-1.

4. Methods for Testing Photographic Properties

The photographic properties were assessed by the following four tests.

(1) Image Sharpness

The test for image sharpness was conducted by MTF frequency responsiveness to rectangular waves in accordance with a JIS method.

In the test, the response characteristic values at frequencies of 40 lines/mm and 8 lines/mm were sought. The relative values obtained by taking the response characteristic value for Sample C101 (antihalation layer of colloidal silver) as 100% were used as criteria for the sharpness.

(2) Image Readout Time

Frames after photographing were continuously read by evenly including frames of three levels of exposure amounts for the following sensory evaluation, and the readout time was measured. The average was used as the speed of readout. The shorter the readout time, the quicker the image processing.

(3) Sensory Evaluation

By using each experimental film, snapshots of a person were taken against a gray wall background illuminated by a standard light source C described in ISO 5800 (method for measuring the sensitivity of color negative films) at three levels of exposure, i.e., a standard exposure amount, an underexposure by ½, and an overexposure at 4 times the standard exposure amount. After that, development process was carried out according to the processing condition altered as described above to thereby obtain color prints for evaluation. The overall image qualities of the color prints for evaluation were assessed by 10 persons specialized in photography evaluation. The rating was made by the following 5 point-method and averages were used as the criteria.

| | Point |
|---|---|
| very poor and unacceptable | 1 |
| slightly poor and unacceptable | 2 |
| relatively poor but acceptable | 3 |
| relatively good and desirable | 4 |
| very desirable | 5 |

(4) Evaluation of Light-screenability

Each photosensitive sample was loaded in a patrone (i.e., a cartridge). In this state, the back of the photosensitive material in the tongue portion of the patrone (i.e., a slit-like opening for pulling out the film) was irradiated with white light (tungsten lamp light) of 5000 lux for 5 minutes. After that, the photosensitive material was subjected to color development process without being exposed. Then, the length in mm sensitized by the light incident on the photosensitive material by the light-piping phenomenon of the support was measured and this length was used as a criterion for light-screenability.

5. Test Results

The test results are shown in Table 17.

The results of the light-screenability test are not shown in Table 17. Sample C111 of the Comparative Example exhibited fogging due to light-piping in the range of about 13 cm from the port of the patrone. But Samples C101~C111 all exhibited approximately the same light-screenability, and any fogging due to light-piping that would cause a problem in actual use was not found in these samples.

TABLE 17

| Sample | Light-screening material[1] in AH layer (exemplary compound) | Image sharpness[2] 8[2] | Image sharpness[2] 40[2] | Readout time (sec/frame)[3] | Image quality (sensory evaluation) 2 grades less in aperture scale | Image quality (sensory evaluation) Standard exposure | Image quality (sensory evaluation) 4 grades greater in aperture scale | Remarks |
|---|---|---|---|---|---|---|---|---|
| C101 | Black silver colloid | 100 | 100 | 7 | 3.0 | 3.0 | 3.0 | Comparative example |
| C102 | III-3 | 100 | 105 | 4 | 3.2 | 3.1 | 3.1 | Present invention |
| C103 | III-6 | 100 | 100 | 3.5 | 3.5 | 3.4 | 3.0 | Present invention |
| C104 | III-19 | 102 | 105 | 3 | 3.5 | 3.4 | 3.3 | Present invention |
| C105 | II-30 | 100 | 102 | 3 | 3.2 | 3.3 | 3.1 | Present invention |
| C106 | III-6/II-1(8/2) | 102 | 102 | 3 | 3.5 | 3.5 | 3.4 | Present invention |
| C107 | III-6/II-11(8/2) | 102 | 105 | 2.5 | 3.4 | 3.4 | 3.3 | Present invention |
| C108 | III-6/II-15(8/2) | 105 | 106 | 2.5 | 3.4 | 3.3 | 3.2 | Present invention |
| C109 | III-6/II-1(8/2) | 105 | 104 | 2.5 | 3.1 | 3.1 | 3.0 | Present invention |
| C110 | II-30/III-19(6/4) | 100 | 102 | 2.5 | 3.4 | 3.2 | 3.1 | Present invention |
| C111 | — | 65 | 62 | 3 | 2.9 | 2.8 | 2.5 | Comparative Example |
| (C101) | Black silver colloid | 100 | 100 | — | 3.0 | 3.5 | 3.0 | Referential example[4] |

Notes:
[1]AH layer: antihalation layer
[2]Spatial frequency responsiveness expressed in cycle/mm
[3]Readout time for one frame
[4]Sample C101 was developed by a standard method and a print was produced using a printer processor based on a surface exposure system.

As can be seen from Table 17, Samples C102~C111 of the present invention using decolorization-type antihalation dyes exhibits image sharpness and sensory evaluation results equivalent to those of the referential sample C101 comprising an antihalation layer of black silver colloid. In addition, the light-screenability was also on the same level, though not shown in Table 17. That is to say, the samples of the present invention show the function of the antihalation layer not inferior to that of the antihalation layer using conventional colloidal silver. The samples of the present invention are superior in the readout time of image frames and enable simple and quick development process. In addition, it was shown that the method of the present invention could achieve the simplicity and rapidity aimed, while at least maintaining image qualities, if not enhancing the image qualities, in comparison with the referential example considered to represent average market qualities.

Example D-1

1. Preparation of Color Negative Samples

A color negative film sample D101 was prepared by the same method as the method employed for the preparation of the color negative film sample B101 in Example B-1.

Sample D101 was processed into a shape of 135-24Ex (i.e., an ordinary 35 mm film loaded in a patrone for 24 exposures) in compliance with ISO 1007 and used in the following tests.

2. Development Process (1) Development Process of Example D-1

As an apparatus for the development process and reading image information according to the method of the present invention, use was made of an experimental development processor equipped with an image-reading device which was obtained by remodeling an automatic development processor (FP-363SC, manufactured by Fuji Photo Film Co., Ltd.) in the following way including attaching thereto an image-reading device. By using the experimental development processor, the image processing and reading of image information were carried out according to the development specification described below. That is, the automatic development processor (FP-363SC, manufactured by Fuji Photo Film Co., Ltd.) was remodeled as follows. A tank for coating a stopper solution, a reservoir, and a first image-reading zone were provided between the color developing tank and the fixing tank (1). The fixing tank (1) was used as a clarification tank, and a tank for coating rinsing water, a reservoir, and a second image-reading zone were provided after the fixing tank (2).

In the above-mentioned apparatus, the film flows in the following way. That is, the color film is developed in the developing tank. After that, development is stopped in the tank for coating by a stopper solution, and fed from this tank by means of a transfer mechanism. Via a reservoir, the film then arrives at the first image-reading zone in which the first image information reading is carried out. After this reading, the film is a gain fed by means of a transfer mechanism to a processing zone and immersed in a clarification tank. After undergoing the transparentization treatment in the clarification tank, the film is rinsed in the tank for coating rinsing water. After the rinsing, the film is fed from the tank for coating rinsing water by means of a transfer mechanism and arrives via a reservoir at the second image-reading zone in which the second image information is read out.

In the method of the present invention, the color film after being read may be discovered. The color film after being read may be used as digital image information, or a color print or the like may be output from the color film after being read. In addition, the color film after being read may be preserved as a development-processed film. For this purposes, in the above-described experimental apparatus, the original stabilizing tanks (1)~(2) are converted into bleach-fixing tanks and are filled with a bleach-fixing solution, while the stabilizing tank (3) is filled with a stabilizing solution. Accordingly, a development-processed film having the same image quality as that of a development-processed film obtained in a commercial color laboratory can also be obtained by desilvering the film after being read in the bleach-fixing tank, stabilizing the images of the desilvered film in the stabilizing tank, and passing the stabilized film through the drying zone. However, in this case, the developing tank needs to use a standard color developing solution or a developing solution similar thereto.

The processing in Example D-1 was carried out according to the following processing specification.

(Processing Steps)

| step | processing time | processing temperature | replenished amount* | tank capacity |
|---|---|---|---|---|
| color development | 3 minutes and 5 seconds | 38.0° C. | 20 ml | 10.3 L |
| stopping** | 10 seconds | 38.0° C. | 10 ml | coating |
| the first readout of images | | | | |
| clarification tank | 50 seconds | 38.0° C. | 7.5 ml | 3.6 L |
| water-rinsing** | 10 seconds | 38.0° C. | 10 ml | coating |
| the second readout of images | | | | |
| bleach-fixing | 30 seconds | 38.0° C. | 200 ml | 1.9 L |
| stabilization (1) | 20 seconds | 38.0° C. | — | 1.9 L |
| stabilization (2) | 20 seconds | 38.0° C. | 30 ml | 1.9 L |
| drying | 30 seconds | 60° C. | | |

*The replenished amount is based on a photosensitive material having a width of 35 mm and a length of 1.1 m space (corresponding to one roll of 24 Ex.).

**Stopping and water-rinsing are carried out by coating by means of a water-absorbent roller.

The compositions of the processing solutions are described below.

(Color Developing Solution)

The same color developing solution as that in Example B-1 was used.

| (stopping solution) | (common to tank solution and replenisher solution) |
|---|---|
| acetic acid | 30 g |
| water to make | 1.0 L |
| pH (controlled by potassium hydroxide and sulfuric acid) | 2.5~3.5 |

| (clarification solution) tank solution | replenisher | solution |
|---|---|---|
| ammonium thiosulfate (750 g/L) | 280 ml | 1000 ml |
| ammonium hydrogensulfite aqueous solution (72%) | 20 g | 80 g |

-continued

| | | |
|---|---|---|
| imidazole | 5 g | 45 g |
| 1-mercapto-2-(N,N-dimethylaminoethyl)tetrazole | 1 g | 3 g |
| ethylenediaminetetraacetic acid | 8 g | 12 g |
| water to make | 1 L | 1 L |
| pH (controlled by aqueous ammonia and nitric acid) | 7.0 | 7.0 |

The following is not within the scope of the present invention but is used for additional processing.

| | | |
|---|---|---|
| monohydrate | 0.08 | 0.13 |
| ethylenediaminetraacetic acid iron (III) ammonium salt dihydrate | 0.10 | 0.17 |
| ammonium thiosulfate (700 g/L) | 300 ml | 495 ml |
| ammonium iodide | 2.0 g | — |
| arnmonium sulfite | 0.10 | 0.17 |
| metacarboxybenzenesulfinic acid | 0.05 | 0.09 |
| succinic acid | 0.10 | 0.17 |
| water to make | 1.0 L | 1.0 L |
| pH (controlled by aqueous ammonia and nitric acid) | 6.0 | 5.5 |
| (rinsing water) | common to tank solution and replenisher solution | |

Tap water was charged into a mixed bed-type column loaded with an H-type strongly acidic cation-exchange resin (AMBERLITE IR-120B, manufactured by Rohm & Haas Corp.) and an OH-type strongly basic anion-exchange resin (AMBERLITE IRA-400, manufactured by Rohm & Haas Corp.) to reduce the content of calcium and magnesium ions to a value below 3 mg/L. After that, 20 mg/L of sodium dichloroisocyanurate and 150 mg/L of sodium sulfate were added. The pH of the resulting solution was in a range of 6.5 to 7.5.

(Stabilizing Solution)

The same stabilizing solution as that in Example B-1 was used.

(2) Development Process of Comparative Example D-1

The development process was carried out by using the same image development process apparatus and in the same way as in Example D-1 of the present invention, except that the film was dried without the implementation of the readout of the image information and image processing. A print was produced using a printer processor based on a surface exposure system that is described later.

(3) Development Process of Comparative Example D-2

The development process was carried out using the same development apparatus and in the same way as in Example D-1 of the present invention, except that the transparentization treatment was omitted, and a print was produced.

(4) Referential Example (Standard Development Process)

In order to show that the quality of the images obtained by the method described in the present invention was equivalent to the quality of the images obtained by general-purpose processing usually adopted in the color photography market, development process, development process as a referential example was also carried out by the standard processing in the same way as for Example B-1.

3. Reading Out of Images and Image Processing

The first and second image information read out in the first and second image information-reading zones 312 and 314 illustrated in FIG. 22 and FIG. 23 was formed into positive images in the digital image-processing zone 270 illustrated in FIG. 25, and the positive images were output to a printer.

In Example D-1 of the present invention and Comparative Example D-2, as an example of commercially available inputting machines capable of converting images for input which were prepared in the way described above into electric image signals and forming positive images by inputting the signals, a high-speed scanner/image processing workstation, SP-1500 (manufactured by Fuji Photo Film Co., Ltd.), was used. As an example of commercially available outputting machines, a laser printer/paper processor, LP-1500SC (FRONTIER 350, manufactured by Fuji Photo Film Co., Ltd.), was used. As for SP-1000, the program software was altered so that the above-described image processing could be carried out.

In the standard processing and Comparative Example D-1, MINI LABO PP-1257V, which is now generally used as a surface exposure system, was used. This apparatus is a printer processor usually employed in the market currently. It is mounted with a printer based on a simultaneous whole image exposure system, prints on a sheet of color paper with light transmitted through a color negative after being developed and adjusts color balance and exposure amount for printing by controlling filters.

For printing the films after being developed from Sample D-1 of the present invention, Comparative Example D-1, Comparative Example D-2, and Referential Example (according to standard processing), FUJI COLOR PAPER SUPER FA Type D, which is commercially available as color paper, was used. For development process, a color paper processing prescription, CP-48S, and processing solutions therefor (all manufactured by Fuji Photo Film Co., Ltd.) were used.

4. Methods for Testing Photographic Properties

By using each experimental film, snapshots of a person were taken against a gray wall background under the illumination of a standard light source C described in ISO 5800 (method for measuring the sensitivity of color negative films) at three levels of exposure amounts, i.e., a standard exposure amount, an overexposure at 16 times the standard exposure amount, and an overexposure at 64 times the standard exposure amount. After that, development process was carried out according to the processing condition altered as described below to thereby prepare photographic originals of images for input.

The overall image qualities, attaching importance to the smoothness of image granularity and color, of the images for evaluation, were assessed by ten persons specialized in photography evaluation. The rating was made by the following 5 point-method and averages were used as the criteria.

| | Point |
|---|---|
| very poor and unacceptable | 1 |
| slightly poor and unacceptable | 2 |
| relatively poor but acceptable | 3 |
| relatively good and desirable | 4 |
| very desirable | 5 |

5. Test Results

The test results are shown in Table 18.

TABLE 18

| Processing | Ateps included in the processing | | Exposure amount when photographing | | |
|---|---|---|---|---|---|
| | Transparentization | Image processing | Standard exposure | 4 grades greater in aperture scale | 6 grades greater in aperture scale |
| Present invention D-1 | Yes | Yes | 3.9 | 3.8 | 3.6 |
| Comparative Example D-1 | No | No | 1.0 | 1.0 | 1.0 |
| Comparative Example D-2 | No | Yes | 3.3 | 3.1 | 1.5 |
| Referential example | Standard development process | No | 3.8 | 3.6 | 3.2 |

As can be seen from Table 18, in the negative of Comparative Example D-1 in which only the development process was performed, non-image portions were opaque and had a high density and therefore almost no image was obtained in color prints, although reflected images could be visually observed on the surface of the color film in the reading zone. Comparative Example D-2, made by adding image processing to Comparative Example D-1, provided improved images but the image quality was still significantly insufficient. The insufficiency was remarkable in the extreme overexposure range, i.e., 6 grades greater in aperture scale. Example D-1 of the present invention, in which image processing was performed by reading the second image information after carrying out the transparentization treatment, was found to exhibit image quality approximately equivalent to or better than that of the referential example according to the standard processing. Example D-1 of the present invention has a smaller number of steps and is superior to the standard processing in simplicity and quickness.

The color film of Example D-1 of the present invention, which had undergone a series of processing steps including development, transparentization, and readout of image information (this film may be disposed in the present invention), were further subjected to bleach-fixing and stabilization in a bath. After that, as in the referential example, a color print was prepared by using MINI LABO PP-1257V (manufactured by Fuji Photo Film Co., Ltd.) based on as a surface exposure system. The image quality evaluation results of the print were virtually equivalent to the evaluation results of the referential example. Accordingly, it was shown that the color film of Example D-1 of the present invention enabled the preservation of the film by carrying out the desilvering and processing with a stabilizing solution.

Example D-2

(1) Example D-2 of the Present Invention

A test was conducted by using the same color negative film sample, apparatus, and method as in Example D-1 of the present invention, except that the color developing step and the clarification step in Example D-1 were replaced by the following black-and-white developing step, readout of images, clarification step, and treatment prescriptions therefor. The processing, reading step, and specifications of the prescriptions are as follows.

(Processing Steps)

| step | processing time | processing temperature | replenished amount* | tank capacity |
|---|---|---|---|---|
| black-and-white development | 90 seconds | 38.0° C. | 10 ml | 10.3 L |
| stopping | 10 seconds | 38.0° C. | 10 ml | coating |
| the first readout of images | | | | |
| clarification tank | 50 seconds | 38.0° C. | 5 ml | 3.6 L |
| water-rinsing | 10 seconds | 38.0° C. | 10 ml | coating |
| the second readout of images | | | | |

[Black-and-white Developing Solution]

The same black-and-white developing solution as in Example B-1 was used.

[Stopping Solution]

The same stopping solution as in Example D-1 was used.

| [clarification solution] | [tank solution] |
|---|---|
| ammonium thiosulfate | 80 g |
| sodium sulfite | 5.0 g |
| sodium hydrogensulfite | 5.0 g |
| water to make | 1000 ml |
| pH | 6.60 |

The pH was controlled by acetic acid or ammonia water.

The replenisher solution is the same as the freshly filled tank solution (i.e., replenishment using the mother solution)

[Water for Water-rinsing]

The same rinsing water as in Example D-1 was used.

(2) Comparative Example D-3

Comparative Example D-3 was obtained by the same method as in Example D-2 of the present invention, except that the transparentization treatment of Example D-2 of the present invention was not implemented.

After the processing, the samples of Example D-2 of the present invention and Comparative Example D-3 were subjected to the evaluation of image qualities by the same method as in Example D-1.

The results are shown in Table 19.

TABLE 19

| Processing | Steps included in the processing: Transparentization | Steps included in the processing: Image processing | Exposure amount when photographing: Standard exposure | Exposure amount when photographing: 4 grades greater in aperture scale | Exposure amount when photographing: 6 grades greater in aperture scale |
|---|---|---|---|---|---|
| Present invention D-2 | Yes | Yes | 4.2 | 4.0 | 4.0 |
| Comparative Example D-3 | No | Yes | 2.8 | 2.4 | 1.6 |

As shown in Table 19, the sample of Example D-2 of the present invention exhibited a satisfactory image quality equivalent to that of the referential example shown in Table 18. On the other hand, Comparative Example D-3 gave very unsatisfactory evaluation results.

The comparison between Example D-1 of the present invention using a color developing solution shown in Table 18 and Example D-2 of the present invention using a black-and-white developing solution shown in Table 19 makes it clear that the use of the black-and-white developing solution speeds the development process and provides better image quality evaluation results due to reduced fogging level. As an additional advantage, it was found by a long-term experiment that the stability of the developing solution was greater despite lower amounts of replenishment.

Example D-3

(1) Examples D-3~D-12

In Examples D-3~D-12 of the present invention, the processing time for transparentization in Example D-1 was reduced to one half of that in Example D-1 (i.e., 50 seconds→25 seconds). The tests for Examples D-4~D-12 of the present invention were conducted by the same method as in Examples D-1 of the present invention, except that the amount of ammonium thiosulfate as the fixing agent of the clarification solution of Example D-3 of the present invention was changed to the equimolar amount of the fixing agents shown in Table 20, and the results were assessed.

The results are shown in Table 20.

TABLE 20

| Test number | Fixing agent | Exposure amount when photographing: Standard exposure | Exposure amount when photographing: 4 grades greater in aperture scale | Exposure amount when photographing: 6 grades greater in aperture scale |
|---|---|---|---|---|
| Present invention D-3 | Ammonium thiosulfate | 3.9 | 3.8 | 3.6 |
| Present invention D-4 | FI-1 | 4.3 | 4.2 | 4.2 |
| Present invention D-5 | FI-5 | 4.4 | 4.3 | 4.2 |
| Present invention D-6 | FI-37 | 4.1 | 4.0 | 3.9 |
| Present invention D-7 | FII-1 | 4.1 | 4.0 | 3.8 |
| Present invention D-8 | FII-3 | 4.1 | 4.1 | 3.9 |
| Present invention D-9 | FII-42 | 4.0 | 3.9 | 3.7 |
| Present invention D-10 | FII-85 | 4.2 | 4.1 | 4.0 |
| Present invention D-11 | FII-86 | 4.1 | 4.0 | 4.0 |
| Present invention D-12 | FIII($R_4$ = $CH_2CH_2OH$) | 3.9 | 3.9 | 3.7 |

As shown in Table 20, samples of Examples D-4~D-12 of the present invention achieved better results than Example D-3 of the present invention, indicating that the mode, in which a desirable fixing agent of the present invention is added by the clarification solution, contributes to acceleration of the transparentization treatment and achieves desirable results. Specifically, even if the treatment is more rapid, the image qualities are prevented from deteriorating, or improve. In addition, the comparison with the referential example of Table 18 indicates that the image qualities are virtually equivalent to the case where standard development was used.

Example E-1

1. Preparation of Color Negative Film Samples

<Preparation of Emulsions>

(Preparation of Em-A)

1200 milliliters (hereinafter indicated as mL) of an aqueous solution containing 1.0 g of low-molecular-weight gelatin, having a molecular weight of 15,000 and 1.0 g of KBr was kept at 35° C. and vigorously stirred. Thereafter, the following was added this solution. 30 mL of an aqueous solution containing 1.9 g of $AgNO_3$ and 30 mL of an aqueous solution containing 1.5 g of KBr and 0.7 g of low-molecular-weight gelatin having a molecular weight of 15,000 over a period of 30 seconds by a double-jet method so as to form nuclei. In this case, the excess concentration of KBr was kept at a constant value. After that, 6 g of KBr was added and the temperature raised to 75° C. And, the reaction mixture was ripened at that temperature. After the completion of the ripening, 35 g of succinated gelatin was added, and pH adjusted to 5.5. Next, 150 mL of an aqueous solution containing 30 g of $AgNO_3$ and an aqueous solution of KBr were added over a period of 16 minutes by a double-jet method. During the addition, the silver potential was kept at −25 mV with respect to a saturated calomel electrode. Further, to the reaction mixture there were added an aqueous solution containing 110 g of $AgNO_3$ and an aqueous solution of KBr by a double jet method over a period of 15 minutes in such a manner that the flow rate of the addition was gradually increased to a final flow rate that was 1.2 times the initial flow rate. Simultaneously, an AgI fine grain emulsion having grain sizes of 0.03 $\mu$m was added in such a manner that the flow rate of the addition gradually increased so that the silver iodide content became 3.8%, while and the silver potential was kept at −25 mV. Furthermore, 132 mL of an aqueous solution containing 35 g of $AgNO_3$ and an aqueous solution of KBr were added by a double jet method over a period of 7 minutes while controlling the addition of the aqueous solution of KBr so that the silver potential became −20 mV upon completion of the addition. After the completion of the addition, the temperature of the reaction mixture was lowered to 40° C. Then, the following compound 1 in an amount equivalent to 5.6 g of KI was added. In addition, 64 mL of a 0.8M sodium sulfite aqueous solution was added. After completion of the addition, the pH of the reaction mixture was raised to 9.0 by adding an aqueous solution of NaOH, and keeping the reaction mixture at that pH for 4 minutes to thereby cause the abrupt formation of iodide ions. After that, the pH was reduced to 5.5. Then, after the temperature of the reaction mixture was returned to 55° C., 1 mg of sodium benzenethiosulfonateU was added and 13 g of lime-treated gelatin having a calcium concentration of 1 ppm was added. After the completion of the addition, 250 mL of an aqueous solution containing 70 g of $AgNO_3$ and an aqueous solution KBr were added over a period of 20 minutes while keeping the potential at 30 mV. At this time, yellow prussiate in an amount of $1.0\times10^{-5}$ mole per mole of silver was added. After washing with water, 80 g of lime-treated gelatin having a calcium concentration of 1 ppm was added, and pH was adjusted to 5.8, and pAg adjusted to 8.7 at 40° C.

Compound 1

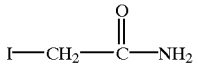

The calcium, magnesium, and strontium contents of the emulsion described above were measured by ICP emission spectral analysis and were found to be 15 ppm, 2, ppm, and 1 ppm, respectively.

The temperature of the emulsion was raised to 56° C. For the purpose of the formation of shells, a pure AgBr fine emulsion having grain sizes of 0.05 $\mu$m in an amount equivalent to 1 g of Ag was added to the emulsion. Next, the sensitizing dyes 1, 2, and 3, each as a dispersion of solid fine grains, were added in amounts of $5.85\times10^{-4}$ mole, $3.06\times10^{-4}$mole, and $9.00\times10^{-6}$mole, respectively, per mole of silver. According to the requirements for the preparation of the dispersions of solid fine grains shown in Table 21, the dispersions of solid fine grains of the sensitizing dyes 1, 2, and 3 were prepared by the steps of dissolving an inorganic salt in an ion-exchanged water and thereafter adding a sensitizing dye and dispersing the sensitizing dye using the blades of a dissolver at 2000 rpm for 20 minutes at 60° C. When the adsorption of the sensitizing dye reached 90% of the adsorbed amount to be attained at equilibrium, calcium nitrate was added such that the calcium concentration became 250 ppm. The amount of the adsorbed dye was obtained by separating the solid layer from the liquid layer by centrifugal precipitation and measuring the difference between the amount of the sensitizing dye initially added and the amount of the sensitizing dye in the supernatant liquid. After the addition of the calcium nitrate, the optimum sensitization of the emulsion was performed by adding thereto potassium thiocyanate, chloroauric acid, sodium thiosulfate, N,N-dimethylselenourea, and the following compound 4. The N,N-dimethylselenourea was added in an amount of $3.40\times10^{-6}$ mole per mole of silver. After the completion of the chemical sensitization, the following compounds 2 and 3 were added. In this way, Em-A was prepared.

TABLE 21

| Sensitizing dye | Amount of sensitizing dye | $NaNO_3/Na_2SO_4$ | Water | Dispersing time | Dispersing temperature |
|---|---|---|---|---|---|
| 1 | 3 parts by weight | 0.8 part by weight/3.2 parts by weight | 43 parts by weight | 20 minutes | 60° C. |
| 2 | 4 parts by weight | 0.6 part by weight/2.4 parts by weight | 42.8 parts by weight | 20 minutes | 60° C. |
| 3 | 0.12 parts by weight | | | | |

Sensitizing dye 1

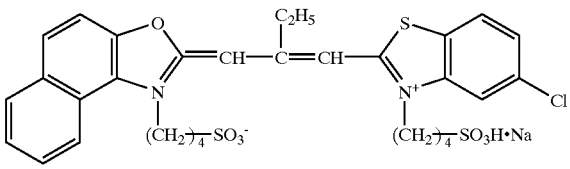

TABLE 21-continued
| Sensitizing dye | Amount of sensitizing dye | $NaNO_3/Na_2SO_4$ | Water | Dispersing time[5] | Dispersing temperature |
|---|---|---|---|---|---|
Sensitizing dye 2
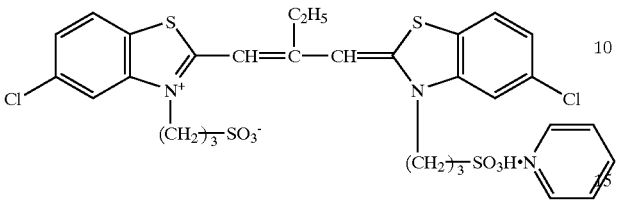
Sensitizing dye 3
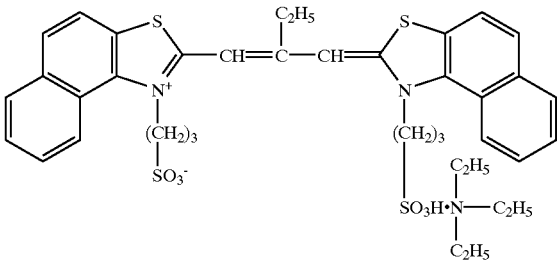
Compound 2
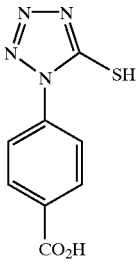
Compound 3
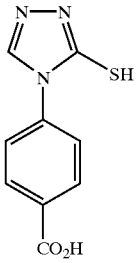
Compound 4
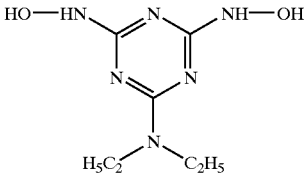

(Preparation of Em-B)

Em-B was prepared in the same way as in the preparation of Em-A, except that the amount of KBr to be added after the formation of nuclei was changed to 5 g, the succinated gelatin was replaced by trimellitated gelatin whose trimellitation percentage was 98% and which had a methionine content of 35 g mol per gram and a molecular weight of 100,000, the compound 1 was replaced by the following compound 6, the amount of compound 6 added was changed to an amount equivalent to 8.0 g of KI, the amounts of the sensitizing dyes 1, 2, and 3 to be added prior to the chemical sensitization were changed to $6.50\times10^{-4}$ mole, $3.40\times10^{-4}$ mole, and $1.00\times10^{-5}$ mole, respectively, and the amount of N,N-dimethylselenourea to be added at the time of chemical sensitization was changed to $4.00\times10^{-6}$ mole.

Compound 6

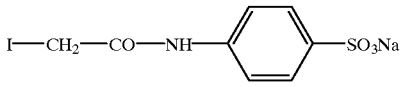

(Preparation of Em-C)

Em-C was prepared in the same way as in the preparation of Em-A, except that the amount of KBr to be added after the formation of nuclei was changed to 1.5 g, the succinated gelatin was replaced by phthalated gelatin whose phthalation percentage was 97% and which had a methionine content of 35 μmol per gram and a molecular weight of 100,000, compound 1 was replaced by the following compound 7, the amount added of compound 7 was changed to an amount equivalent to 7.1 g of KI, the amounts of the sensitizing dyes 1, 2, and 3 to be added prior to the chemical sensitization were changed to $7.80\times10^{-4}$ mole, $4.08\times10^{-4}$ mole, and $1.20\times10^{-5}$ mole, respectively, and the amount of N,N-dimethylselenourea to be added at the time of chemical sensitization was changed to $5.00\times10^{-6}$ mole.

Compound 7

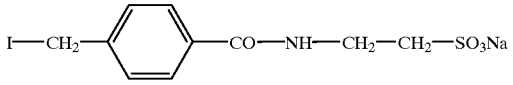

(Preparation of Em-E)

1200 mL of an aqueous solution containing 1.0 g of low-molecular-weight gelatin having a molecular weight of 15,000 and 1.0 g of KBr was kept at 35° C. and vigorously stirred. Thereafter the following was added to this solution. 30 mL of an aqueous solution containing 1.9 g of $AgNO_3$, and 30 mL of an aqueous solution containing 1.5 g of KBr and 0.7 g of low-molecular-weight gelatin having a molecular weight of 15,000 over a period of 30 seconds by a double-jet method so as to form nuclei. In this case, the excess concentration of KBr was kept at a constant value. After that, 6 g of KBr was added and the temperature raised to 75° C., and the reaction mixture ripened at that temperature. After the completion of the ripening, 15 g of succinated gelatin and 20 g of the above-described trimellitated gelatin were added, and pH adjusted to 5.5. Next, 150 mL of an aqueous solution containing 30 g of $AgNO_3$ and an aqueous solution of KBr were added over a period of 16 minutes by a double-jet method. During the addition, the silver potential was kept at −25 mV with respect to a saturated calomel electrode. To the reaction mixture there were further added an aqueous solution containing 110 g of $AgNO_3$ and an aqueous solution of KBr by a double jet method over a period of 15 minutes in such a manner that the flow rate of the addition gradually increased to a final flow rate that was 1.2 times the initial flow rate. Simultaneously, an AgI fine grain emulsion having grain sizes of 0.03 μm was added in such a manner that the flow rate of the addition gradually increased so that the silver iodide content became 3.8%, while keeping the silver potential at −25 mV. Furthermore, 132 mL of an aqueous solution containing 35 g of $AgNO_3$ and an aqueous solution of KBr were added by a double jet method over a period of 7 minutes while controlling the addition of the aqueous solution of KBr so that the potential became −20 mV upon completion of the addition. After the completion of the addition, the potential was adjusted to 30 mV by the addition of an aqueous solution of KBr. Then, 1 mg of sodium benzenethiosulfonate was added, and 13 g of lime-treated gelatin having a calcium concentration of 1 ppm. After that, while continuously adding an AgI fine grain emulsion having grain sizes (equivalent-sphere diameters) of 0.008 μm in an amount equivalent to 8.0 g of KI. The AgI fine grain emulsion was prepared, immediately prior to adding, by pre-mixing an aqueous solution of low-molecular-weight gelatin having a molecular weight of 15,000, an aqueous solution of $AgNO_3$, and an aqueous solution of KI in another chamber having a magnetic coupling induction-type stirrer described in JP-A No. 10-43570, 250 mL of an aqueous solution containing 70 g of $AgNO_3$ adding an aqueous solution of KBr over a period of 20 minutes while keeping the potential at 30 mV. At this time, yellow prussiate in an amount of $1.0\times10^{-5}$ mole per mole of silver was added. After washing with water, 80 g of lime-treated gelatin having a calcium concentration of 1 ppm was added, pH adjusted to 5.8, and pAg adjusted to 8.7 at 40° C.

The calcium, magnesium, and strontium contents of the emulsion described above were measured by ICP emission spectral analysis and were found to be 15 ppm, 2, ppm, and 1 ppm, respectively.

Chemical sensitization was carried out in the same way as in the chemical sensitization of Em-A, except that the sensitizing dyes 1, 2, and 3 were changed to the following sensitizing dyes 4, 5, and 6 and the amounts added thereof were $7.73\times10^{-4}$ mole, $1.65\times10^{-4}$ mole, and $6.20\times10^{-6}$ mole, respectively. In this way, Em-E was prepared.

Sensitizing dye 4

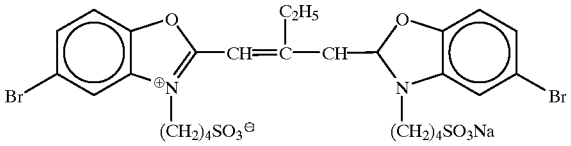

Sensitizing dye 5

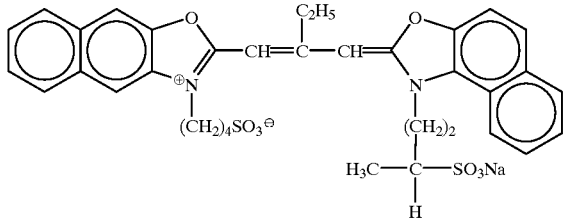

-continued

Sensitizing dye 6

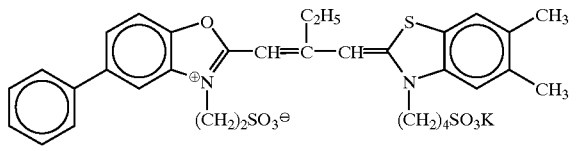

(Preparation of Em-F)

1200 mL of an aqueous solution containing 1.0 g of low-molecular-weight gelatin having a molecular weight of 15,000 and 1.0 g of KBr was kept at 35° C. and vigorously stirred. To this solution, there were added 30 mL of an aqueous solution containing 1.9 g of $AgNO_3$, and 30 mL of an aqueous solution containing 1.5 g of KBr and 0.7 g of low-molecular-weight gelatin having a molecular weight of 15,000 over a period of 30 seconds by a double-jet method so as to form nuclei. In this case, the excess concentration of KBr was kept at a constant value. After that, 5 g of KBr was added and the temperature raised to 75° C., and the reaction mixture ripened at that temperature. After the completion of the ripening, 20 g of succinated gelatin and 15 g of phthalated gelatin were added, and pH adjusted to 5.5. Next, 150 mL of an aqueous solution containing 30 g of $AgNO_3$ and an aqueous solution of KBr were added over a period of 16 minutes by a double-jet method. During the addition, the silver potential was kept at −25 mV with respect to a saturated calomel electrode. To the reaction mixture there further were added an aqueous solution containing 110 g of $AgNO_3$, and an aqueous solution of KBr by a double jet method over a period of 15 minutes in such a manner that the flow rate of the addition was gradually increased to a final flow rate that was 1.2 times the initial flow rate. Simultaneously, an AgI fine grain emulsion having grain sizes of 0.03 $\mu$m was added in such a manner that the flow rate of the gradually increased so that the silver iodide content became 3.8%, while keeping the silver potential at −25 mV. Furthermore, 132 mL of an aqueous solution containing 35 g of $AgNO_3$ and an aqueous solution KBr were added by a double jet method over a period of 7 minutes. After the potential was adjusted to 30 mV by the addition of an aqueous solution of KBr, an AgI fine grain emulsion having grain sizes of 0.03 $\mu$m in an amount equivalent to 9.2 g of KI was added. Then, 1 mg of sodium benzenethiosulfonate was added, and 13 g of lime-treated gelatin having a calcium concentration of 1 ppm. After the completion of the addition, 250 mL of an aqueous solution containing 70 g of $AgNO_3$ and an aqueous solution of KBr were added over a period of 20 minutes while keeping the potential at 30 mV. At this time, yellow prussiate in an amount of $1.0\times10^{-5}$mole per mole of silver was added. After washing with water, 80 g of lime-treated gelatin having a calcium concentration of 1 ppm was added, pH adjusted to 5.8, and pAg adjusted to 8.7 at 40° C.

The calcium, magnesium, and strontium contents of the emulsion described above were measured by ICP emission spectral analysis and were found to be 15 ppm, 2, ppm, and 1 ppm, respectively.

Chemical sensitization was carried out in the same way as in the chemical sensitization of Em-B, except that the sensitizing dyes 1, 2, and 3 were changed to the sensitizing dyes 4, 5, and 6 and the amounts added thereof were $8.50\times10^{-4}$ mole, $1.82\times10^{-4}$ mole, and $6.82\times10^{-5}$ mole, respectively. In this way, Em-F was prepared.

(Preparation of Em-G)

1200 mL of an aqueous solution containing 1.0 g of low-molecular-weight gelatin having a molecular weight of 15,000 and 1.0 g of KBr was kept at 35° C. and vigorously stirred. To this solution, there were added 30 mL of an aqueous solution containing 1.9 g of $AgNO_3$ and 30 mL of an aqueous solution containing 1.5 g of KBr and 0.7 g of low-molecular-weight gelatin having a molecular weight of 15,000 over a period of 30 seconds by a double-jet method so as to form nuclei. In this case, the excess concentration of KBr was kept at a constant value. After that, 1.5 g of KBr was added, the temperature raised to 75° C., and, the reaction mixture ripened at that temperature. After the completion of the ripening, 15 g of the above-described trimellitated gelatin and 20 g of the above-described phthalated gelatin were added, and pH adjusted to 5.5. Next, 150 mL of an aqueous solution containing 30 g of $AgNO_3$, and an aqueous solution of KBr were added over a period of 16 minutes by a double-jet method. During the addition, the silver potential was kept at −25 mV with respect to a saturated calomel electrode. Further, to the reaction mixture there were added an aqueous solution containing 110 g of $AgNO_3$ and an aqueous solution of KBr by a double jet method over a period of 15 minutes in such a manner that the flow rate of the addition gradually increased to final flow rate that was 1.2 times the initial flow rate. Simultaneously, an AgI fine grain emulsion having grain sizes of 0.03 $\mu$m was added in such a manner that the flow rate of the addition gradually increased so that the silver iodide content became 3.8%, while keeping the silver potential at −25 mV. Furthermore, 132 mL of an aqueous solution containing 35 g of $AgNO_3$ and an aqueous solution of KBr were added by a double jet method over a period of 7 minutes. The addition of the aqueous solution of KBr was controlled so that the potential became 30 mV. An AgI fine grain emulsion having grain sizes of 0.03 $\mu$m in an amount equivalent to 7.1 g of KI was added. Then, 1 mg of sodium benzenethiosulfonate was added, and 13 g of lime-treated gelatin having a calcium concentration of 1 ppm. After the completion of the addition, 250 mL of an aqueous solution containing 70 g of $AgNO_3$ and an aqueous solution of KBr were added over a period of 20 minutes while keeping the potential at 30 mV. At this time, yellow prussiate in an amount of $1.0\times10^{-5}$ mole per mole of silver was added. After washing with water, 80 g of lime-treated gelatin having a calcium concentration of 1 ppm was added, pH adjusted to 5.8, and pAg adjusted to 8.7 at 40° C.

The calcium, magnesium, and strontium contents of the emulsion described above were measured by ICP emission spectral analysis and were found to be 15 ppm, 2, ppm, and 1 ppm, respectively.

Em-G was prepared in the same way as in the preparation of Em-C, except that the sensitizing dyes 1, 2, and 3 were changed to the sensitizing dyes 4, 5, and 6 and the amounts added thereof were $1.00\times10^{-3}$ mole, $2.15\times10^{-4}$ mole, and $8.60\times10^{-5}$ mole, respectively.

(Preparation of Em-J)

Em-J was prepared in the same way as in the preparation of Em-B, except that the sensitizing dyes to be added prior to the chemical sensitization were changed to the following sensitizing dyes 7 and 8 and the amounts added were $7.65\times10^{-4}$ mole and $2.74\times10^{-4}$ mole, respectively.

Sensitizing dye 7

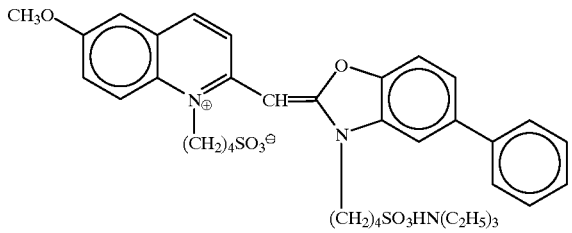

Sensitizing dye 8

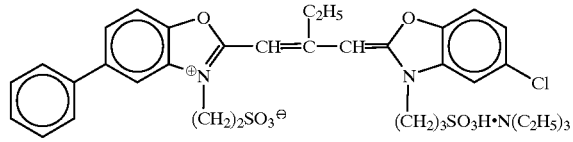

(Preparation of Em-L)

(Preparation of silver bromide seed crystal emulsion) A silver bromide tabular grain emulsion was prepared, made up of grains whose average equivalent-sphere diameter was 0.6 μm had an average aspect ratio of 9.0, and contained 1.16 mol of silver and 66 g of gelatin per kg of emulsion.

(Growth Step: 1)

0.3 g of a modified silicone oil was added to 1250 g of an aqueous solution containing 1.2 g of potassium bromide and succiniated gelatin whose succination percentage was 98%. To the resulting mixture was added the above-described silver bromide tabular grain emulsion containing 0.086 mol of silver. After that, the reaction mixture was kept at 78° C. and stirred. To the reaction mixture there further were added an aqueous solution containing 18.1 g of silver nitrate, and the above-described 0.037 μm silver iodide fine grain emulsion in an amount equivalent to 5.4 mol of silver. Simultaneously, an aqueous solution of potassium bromide was added by a controlled double jet method to achieve a pAg of 8.1.

(Growth Step: 2)

2 mg of sodium benzenethiosulfonate was then added. After that, 0.45 g of 3,5-disulfocatechol di-sodium salt and 2.5 mg of thiourea dioxide were added.

Furthermore, an aqueous solution containing 95.7 g of silver nitrate and an aqueous solution of potassium bromide were added by a double jet method over a period of 66 minutes in such a manner that the rate of the addition gradually increased. At this time, the above-described 0.037 μm silver iodide fine grain emulsion in an amount equivalent to 7.0 mol of silver to was added. At this time, the amount of potassium bromide in the above-mentioned double jet was controlled so that pAg became 8.1. After the completion of the addition, 2 mg of sodium benzenethiosulfonate was added.

(Growth Step: 3)

An aqueous solution containing 19.5 g of silver nitrate and an aqueous solution of potassium bromide were added by a double jet method over a period of 16 minutes. At this time, the amount of the aqueous solution of potassium bromide was controlled so that pAg became 7.9.

(Addition of a Slightly Soluble Silver Halide Emulsion: 4)

After the pH of the host grains described above was adjusted to 9.3 by an aqueous solution of potassium bromide, 25 g of the above-described 0.037 μm silver iodide fine grain emulsion was rapidly within 20 seconds added to the host grains.

(Formation of the Outermost Shell Layer: 5)

Furthermore, an aqueous solution containing 34.9 g of silver nitrate was added over a period of 22 minutes.

The emulsion thus obtained was composed of tabular grains having an average aspect ratio of 9.8, an average equivalent-sphere diameter of 1.4 μm, and an average silver iodide content of 5.5 mol %.

[Chemical Sensitization]

After the emulsion was washed with water, succiniated gelatin, whose succination percentage was 98%, and calcium nitrate were added to the emulsion, pH adjusted to 5.8, and pAg was adjusted to 8.7 at 40° C. The temperature of the emulsion was then raised to 60° C., and $5\times10^{-3}$ mol of 0.07 μm silver iodide fine grain emulsion was added. Twenty minutes later, the following sensitizing dyes 9, 10, and 11 were added. After that, this emulsion was chemically sensitized to an optimal point by the addition of potassium thiocyanate, chloroauric acid, sodium thiosulfate, N,N-dimethylselenourea, and compound 4. Twenty minutes before the completion of the chemical sensitization, compound 3 was added. Upon completion of the chemical sensitization, the following compound 5 was added. The phrase "chemically sensitized to an optimal point" as used herein means that the amounts added of the sensitizing dyes and the compounds were selected from the range of $10^{-1}$ to $10^{-8}$ mol per mol of silver halide so as to maximize the sensitivity when exposed at 1/100 second.

Sensitizing dye 9

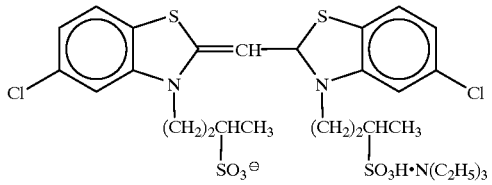

Sensitizing dye 10

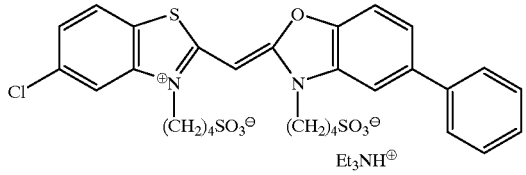

Sensitizing dye 11

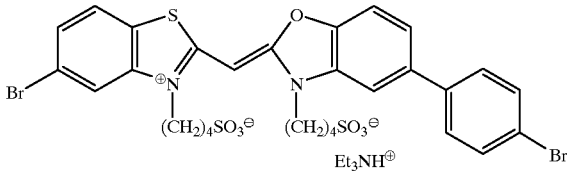

Compound 5

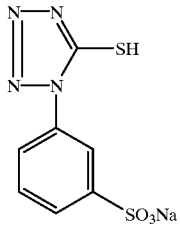

(Preparation of Em-O)

A gelatin aqueous solution (composed of 1250 mL of distilled water, 48 g of deionized gelatin, and 0.75 g of KBr) was placed in a reaction vessel equipped with a stirrer, and the temperature of the solution kept at 70° C. To this solution, there were added 276 mL of an $AgNO_3$ aqueous solution (containing 12.0 g of $AgNO_3$) and a KBr aqueous solution having an equimolar concentration, over a period of 7 minutes by a controlled double-jet method while keeping the pAg at 7.26. After that, the temperature was lowered to 68° C., and 7.6 mL of a thiourea dioxide (0.05 wt %) aqueous solution was added.

Next, 592.9 mL of an $AgNO_3$ aqueous solution (containing 108.0 g of $AgNO_3$) and a blend of a KBr aqueous solution having an equimolar concentration and a KI (2.0 mol % KI) aqueous solution, were added over a period of 18 minutes and 30 seconds by a controlled double-jet method while keeping the pAg at 7.30. Further, 5 minutes before the completion of the addition, 18.0 mL of a thiosulfonic acid (0.1 wt %) aqueous solution was added.

The grains thus obtained were cubic grains having an average equivalent-sphere diameter of 0.19 $\mu$m, and an average silver iodide content of 1.8 mol %.

Em-O underwent desalting and water-washing by an ordinary flocculation method and was dispersed again. After that, pH was adjusted to 6.2 and pAg adjusted to 7.6 at 40° C.

Next, Em-O underwent the following spectral and chemical sensitization.

The following sensitizing dye 10, sensitizing dye 11, and sensitizing dye 12 in respective amounts of $3.37\times10^{-4}$ mol, $8.82\times10^{-4}$ mol of KBr, $8.83\times10^{-5}$ mol of sodium thiosulfate, $5.95\times10^{-4}$ mol of potassium thiocyanate, and $3.07\times10^{-5}$ mol of potassium chloroaurate, per mol of silver respectively, were added, and ripening carried out at 68° C. The time period for the ripening was adjusted so as to maximize the sensitivity when exposed at 1/100 second.

Sensitizing dye 12

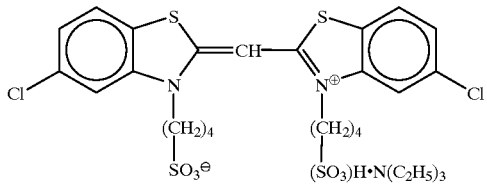

(Em-D, H, I, K, M, N)

For the preparation of tabular grains, low-molecular-weight gelatin was used according to the examples described in JP-A No. 1-158426. And, according to the examples described in JP-A No. 3-237450, gold sensitization and sulfur sensitization were carried out in the presence of the spectral sensitizing dyes and sodium thiocyanate described in Table 22. Emulsions Em-D, Em-H, Em-I, and Em-K contain optimal amounts of Ir and Fe. According to the examples described in JP-A No. 2-191938, Emulsions Em-M and Em-N underwent reduction sensitization using thiourea dioxide and thiosulfonic acid at the time of grain preparation.

TABLE 22

| Name of emulsion | Sensitizing dye | Amount added (mol/mol Ag) |
|---|---|---|
| Em-D | Sensitizing dye 1 | $5.44 \times 10^{-4}$ |
| | Sensitizing dye 2 | $2.35 \times 10^{-4}$ |
| | Sensitizing dye 3 | $7.26 \times 10^{-6}$ |
| Em-H | Sensitizing dye 8 | $6.52 \times 10^{-4}$ |
| | Sensitizing dye 13 | $1.35 \times 10^{-4}$ |
| | Sensitizing dye 6 | $2.48 \times 10^{-5}$ |
| Em-I | Sensitizing dye 8 | $6.09 \times 10^{-4}$ |
| | Sensitizing dye 13 | $1.26 \times 10^{-4}$ |
| | Sensitizing dye 6 | $2.32 \times 10^{-5}$ |
| Em-K | Sensitizing dye 7 | $6.27 \times 10^{-4}$ |
| | Sensitizing dye 8 | $2.24 \times 10^{-4}$ |
| Em-M | Sensitizing dye 9 | $2.43 \times 10^{-4}$ |
| | Sensitizing dye 10 | $2.43 \times 10^{-4}$ |
| | Sensitizing dye 11 | $2.43 \times 10^{-4}$ |
| Em-N | Sensitizing dye 9 | $3.28 \times 10^{-4}$ |
| | Sensitizing dye 10 | $3.28 \times 10^{-4}$ |
| | Sensitizing dye 11 | $3.28 \times 10^{-4}$ |

Sensitizing dye 13

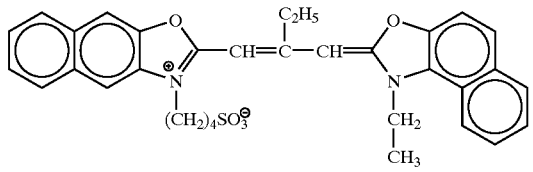

TABLE 23

| Name of emulsion | Average iodine content (mol %) | Equivalent-sphere diameter (μm) | Aspect ratio | Equivalent-circle diameter (μm) | Grain thickness (μm) | Shape |
|---|---|---|---|---|---|---|
| Em-A | 4 | 0.92 | 14 | 2 | 0.14 | Tabular |
| Em-B | 5 | 0.8 | 12 | 1.6 | 0.13 | Tabular |
| Em-C | 4.7 | 0.51 | 7 | 0.85 | 0.12 | Tabular |
| Em-D | 3.9 | 0.37 | 2.7 | 0.4 | 0.15 | Tabular |
| Em-E | 5 | 0.92 | 14 | 2 | 0.14 | Tabular |
| Em-F | 5.5 | 0.8 | 12 | 1.6 | 0.13 | Tabular |
| Em-G | 4.7 | 0.51 | 7 | 0.85 | 0.12 | Tabular |
| Em-H | 3.7 | 0.49 | 3.2 | 0.58 | 0.18 | Tabular |
| Em-I | 2.8 | 0.29 | 1.2 | 0.27 | 0.23 | Tabular |
| Em-J | 5 | 0.8 | 12 | 1.6 | 0.13 | Tabular |
| Em-K | 3.7 | 0.47 | 3 | 0.53 | 0.18 | Tabular |
| Em-L | 5.5 | 1.4 | 9.8 | 2.62 | 0.27 | Tabular |
| Em-M | 8.8 | 0.64 | 5.2 | 0.85 | 0.16 | Tabular |
| Em-N | 3.7 | 0.37 | 4.6 | 0.55 | 0.12 | Tabular |
| Em-O | 1.8 | 0.19 | — | — | — | Cubic |

Dislocation lines such as those described in JP-A No. 3-237450 were found when tabular grains of Table 23 were observed under a high-voltage electron microscope.

The method of preparing a color negative film is described below.

1) The First Layer and Subbing Layer

The both sides of a 90 μm-thick polyethylene naphthalate support were subjected to a glow discharge treatment under a condition of a treating atmospheric pressure of 0.2 Torr (26.6 Pa) an $H_2O$ partial pressure of 75% in the treating atmospheric pressure, a discharge frequency of 30 kHz, an output of 2500 W, and a treating intensity of 0.5 kV·A·minute/$m^2$. A coating liquid having the following composition was applied at a coating weight of 5 mL/$m^2$ as the first layer onto the support by the bar-coating method described in JP-A No. 58-4589. an electroconductive fine grain dispersion liquid (i.e., a 10% aqueous dispersion of $SnO_2/Sb_2O_5$ grains which are secondary aggregates having an average grain diameter of 0.05 μm composed of primary grains having an average grain

| | |
|---|---|
| diameter of 0.005 μm | 50 parts by weight |
| gelatin | 0.5 part by weight |
| water | 49 parts by weight |
| polyglycerol polyglycidyl ether | 0.16 part by weight |
| polyoxyethylene (degree of polymerization: 20) sorbitan monolaurate | 0.1 part by weight |

After being coated with the first layer, the support was wound on a stainless steel core having a diameter of 20 cm and subjected to a thermal treatment at 110° C. (Tg of the PEN support: 119° C.) for 48 hours as an annealing treatment for thermal hysteresis. After that, a coating liquid having the following composition was applied by a bar-coating method at a coating weight of 10 mL/$m^2$ as the subbing layer for emulsions onto the side of the support opposite to the first layer side.

| | |
|---|---|
| Gelatin | 1.01 parts by weight |
| salicylic acid | 0.30 part by weight |
| resorcinol | 0.40 part by weight |
| polyoxyethylene (degree of polymerization:20) nonylphenyl ether | 0.11 part by weight |
| water | 3.53 parts by weight |
| methanol | 84.57 parts by weight |
| n-propanol | 10.08 parts by weight |

Furthermore, the second and third layers, described later, were applied successively onto the first layer. Onto the side opposite to these layers, photosensitive layers, having compositions described later, were applied as multilayers. In this way, a color negative film was prepared.

2) The Second Layer (Transparent Magnetic Recording Layer)

(1) Dispersing of Magnetic Powder 1100 parts by weight of Co-coated ν—$Fe_2O_3$ powder (average length of major axes: 0.25 μm, $S_{BET}$: 39 $m^2$/g, Hc: 831 Oe, σr: 77.1 emu/g, σr: 37.4 emu/g), 220 parts by weight of water, and 165 parts by weight of a silane coupling agent [3-polyoxyethynyl(degree of polymerization: 20)oxypropyltrimethoxysilane] were well kneaded in an open kneader for 3 hours. This coarsely dispersed viscous liquid was dried at 70° C. for one day so as to remove water, and thereafter thermally treated at 110° C. for one hour. In this way, surface-treated magnetic grains were prepared.

Further, a mixture according to the following prescription was kneaded in an open kneader for 4 hours.

| | |
|---|---|
| Surface-treated magnetic grains described above | 855 g |
| Diacetylcellulose | 25.3 g |
| Methyl ethyl ketone | 136.3 g |
| Cyclohexanone | 136.3 g |

After that, a mixture according to the following prescription was finely dispersed in a sand mill (i.e., 1/G sand mill) at 2,000 rpm for 4 hours. The media were glass beads having a diameter of 1 mm.

| | |
|---|---|
| Kneaded liquid described above | 45 g |
| diacetylcellulose | 23.7 g |
| methyl ethyl ketone | 127.7 g |
| Cyclohexanone | 127.7 g |

Furthermore, an intermediate liquid containing the magnetic grains was prepared according to the following prescription.

(2) Preparation of an Intermediate Liquid Containing the Magnetic Grains

| | |
|---|---|
| The above-described liquid containing finely dispersed magnetic grains | 674 g |
| diacetylcellulose solution (a 4.34%-solids solution in a solvent mixture comprising methyl ethyl ketone/cyclohexanone (1/1)) | 24280 g |
| Cyclohexanone | 46 g |

The components listed above were mixed and stirred by a disperser to thereby prepare an intermediate liquid containing the magnetic grains.

An α-alumina abrasive dispersion liquid was prepared according to the following prescription.

(a) SUMICORUMDUM AA-1.5 (Having an Average Diameter of Primary Grains of 1.5 μm and a Specific Surface Area of 1.3 $m^2/g$)

Preparation of a Dispersion Liquid of Grains

| | |
|---|---|
| SUMICORUMDUM AA-1.5 | 152 g |
| silane coupling agent KBM 903 (manufactured by Shin-Etsu Chemical Co., Ltd.) | 0.48 g |
| diacetylcellulose solution (a 4.5%-solids solution in a solvent mixture comprising methyl ethyl ketone/cyclohexanone (1/1)) | 227.52 g |

A mixture according to the above-described prescription was finely dispersed in a ceramic-coated sand mill (i.e., 1/G sandmill) at 800 rpm for 4 hours. The media were zirconia beads having a diameter of 1 mm.

(b) Dispersion Liquid of Colloidal Silica (Fine Grains)

"MEK-ST" manufactured by Nissan Chemical Co., Ltd. was used.

The dispersion liquid comprised methyl ethyl ketone as a dispersing medium and colloidal silica grains having an average diameter of primary grains of 0.015 μm. The content of solid components was 30%.

(3) Preparation of a Coating Liquid for the Second Layer

| | |
|---|---|
| The above-described liquid intermediate liquid containing magnetic grains | 19053 g |
| diacetylcellulose solution (a 4.5%-solids solution in a solvent mixture comprising methyl ethyl ketone/cyclohexanone (1/1)) | 264 g |
| Colloidal silica dispersion liquid "MEK-ST" [dispersion liquid b] (content of solid components: 30%) | 128 g |
| AA-1.5 dispersion liquid [dispersion liquid a] | 12 g |
| a diluted solution of MILLIONATE MR-400 (manufactured by Nippon Polyurethane Co., Ltd.) (a 20%-solids solution in a solvent mixture comprising methyl ethyl ketone/cyclohexanone (1/1)) | 203 g |

-continued

| | |
|---|---|
| methyl ethyl ketone | 170 g |
| Cyclohexanone | 170 g |

The components listed above were mixed and stirred to thereby prepare a coating liquid. The coating liquid was coated at a rate of 29.3 $mL/m^2$ by means of a wire bar. The drying was carried out at 110° C. The thickness as a magnetic layer after drying was 1.0 μm.

3) The Third Layer (i.e., A Layer Containing a Slicking Agent Composed of a Higher Fatty Acid Ester)

(1) Preparation of an Undiluted Dispersion Liquid of a Slicking Agent

The following compounds were dissolved at 100° C. to prepare a liquid A. The liquid A was added to the following liquid B and the resulting mixture was dispersed in a high-pressure homogenizer to thereby prepare an undiluted dispersion liquid of a slicking agent.

| | |
|---|---|
| Liquid A | |
| the following compounds $C_6H_{13}CH(OH)(CH_2)_{10}COOC_{50}H_{101}$ | 399 parts by weight |
| the following compound $n\text{-}C_{50}H_{101}O(CH_2CH_2O)_{16}H$ | 171 parts by weight |
| cyclohexanone | 830 parts by weight |
| Liquid B | |
| Cyclohexanone | 8600 parts by weight |

(2) Preparation of a Dispersion Liquid of Spherical Inorganic Grains

A dispersion liquid of spherical inorganic grains [c1] was prepared according to the following prescription.

| | |
|---|---|
| isopropyl alcohol | 93.54 parts by weight |
| silane coupling agent KBM 903 (manufactured by Shin-Etsu Chemical Co., Ltd.) | |
| compound 1-1: $(CH_3O)_3Si—(CH_2)_3—NH_2$ | 5.53 parts by weight |
| compound 2-1 | 2.93 parts by weight |
| compound 2-1 | |

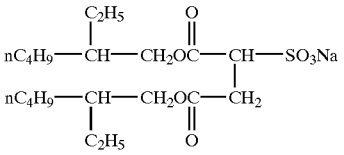

| | |
|---|---|
| SEAHOSTA KEP 50 (amorphous spherical silica having an average grain diameter of 0.5 μm, manufactured by Nippon Shokubai Kagaku Kogyo Co., Ltd.) | 88.00 parts by weight |

The components according to the prescription described above were stirred for 10 minutes. After that, the following was diacetone alcohol added in an mount 252.93 parts by weight.

While the above-mentioned liquid was ice-cooled and stirred, the liquid was subjected to a dispersing treatment for 3 hours using an ultrasonic homogenizer "SONIFIER 450" (manufactured by BRANSON Co., Ltd.). In this way, a dispersion liquid of spherical inorganic grains [c1] was prepared.

(3) Preparation of a Dispersion Liquid of Spherical Organic Grains

A dispersion liquid of spherical organic grains [c2] was prepared according to the following prescription.

| | |
|---|---|
| XC99-A8808 (manufactured by Toshiba Silicon Co., Ltd., spherical crosslinked polysiloxane grains having an average grain diameter of 0.9 μm) | 60 parts by weight |
| methyl ethyl ketone | 120 parts by weight |
| cyclohexanone (a 20%-solids liquid in a solvent mixture comprising methyl ethyl ketone/cyclohexanone (1/1)) | 120 parts by weight |

While the above-mentioned liquid was ice-cooled and stirred, the liquid was subjected to a dispersing treatment for 2 hours using an ultrasonic homogenizer "SONIFIER 450" (manufactured by BRANSON Co., Ltd.). In this way, a dispersion liquid of spherical organic grains [c2] was prepared.

(4) Preparation of a Coating Liquid for the Third Layer

The coating liquid for the third layer was prepared by adding the following to 542 g of the undiluted solution of the slicking agent described above.

| | |
|---|---|
| diacetone alcohol | 5950 g |
| cyclohexanone | 176 g |
| ethyl acetate | 1700 g |
| the above-described dispersion liquid of SEAHOSTA KEP 50 [c1] | 53.1 g |
| the above-described dispersion liquid of spherical organic grains [c2] | 300 g |
| FC431 (manufactured by 3M Limited, solid content: 50%, solvent: ethyl acetate) | 2.65 g |
| BYK310 (manufactured by BYK Chemical Japan Ltd., solid content: 25%) | 5.3 g |

The coating liquid for the third layer was applied onto the second layer at a rate of 10.35 mL/m$^2$. The coated layer was dried at 110° C. and further dried for 3 minutes at 97° C.

4) Formation of Photosensitive Layers

Next, the side opposite to the side having the above-described back layers was coated with the following layers successively so as to prepare a color negative film.

| The first layer (the first antihalation layer) | | |
|---|---|---|
| black colloidal silver | silver | 0.122 |
| 0.07 μm silver iodobromide emulsion | silver | 0.01 |
| gelatin | | 0.919 |
| ExC-1 | | 0.002 |
| ExC-3 | | 0.002 |
| Cpd-2 | | 0.001 |
| HBS-1 | | 0.005 |
| HBS-2 | | 0.002 |
| **The second layer (the second antihalation layer)** | | |
| black colloidal silver | silver | 0.055 |
| gelatin | | 0.425 |
| ExF-1 | | 0.002 |
| solid-dispersed dye ExF-9 | | 0.120 |
| HBS-1 | | 0.074 |

-continued

| The third layer (low-speed red-photosensitive emulsion layer) | | |
|---|---|---|
| Em-D | silver | 0.577 |
| Em-C | silver | 0.347 |
| ExC-1 | | 0.188 |
| ExC-2 | | 0.011 |
| ExC-3 | | 0.075 |
| ExC-4 | | 0.121 |
| ExC-5 | | 0.010 |
| ExC-6 | | 0.007 |
| Cpd-2 | | 0.025 |
| Cpd-4 | | 0.025 |
| Cpd-7 | | 0.050 |
| Cpd-8 | | 0.050 |
| HBS-1 | | 0.114 |
| HBS-5 | | 0.038 |
| gelatin | | 1.474 |
| **The fourth layer (medium-speed red-photosensitive emulsion layer)** | | |
| Em-B | silver | 0.431 |
| Em-C | silver | 0.432 |
| ExC-1 | | 0.154 |
| ExC-2 | | 0.068 |
| ExC-3 | | 0.018 |
| ExC-4 | | 0.103 |
| ExC-5 | | 0.023 |
| ExC-6 | | 0.010 |
| Cpd-2 | | 0.036 |
| Cpd-4 | | 0.028 |
| Cpd-7 | | 0.010 |
| Cpd-8 | | 0.010 |
| HBS-1 | | 0.129 |
| gelatin | | 1.086 |
| **The fifth layer (high-speed red-photosensitive emulsion layer)** | | |
| Em-A | silver | 1.108 |
| ExC-1 | | 0.180 |
| ExC-3 | | 0.035 |
| ExC-6 | | 0.029 |
| Cpd-2 | | 0.064 |
| Cpd-4 | | 0.077 |
| Cpd-7 | | 0.040 |
| Cpd-8 | | 0.040 |
| HBS-1 | | 0.329 |
| HBS-2 | | 0.120 |
| gelatin | | 1.245 |
| **The sixth layer (interlayer)** | | |
| Cpd-1 | | 0.094 |
| Cpd-9 | | 0.369 |
| solid-dispersed dye ExF-4 | | 0.030 |
| HBS-1 | | 0.049 |
| poly(ethyl acrylate) latex | | 0.088 |
| gelatin | | 0.886 |
| **The seventh layer (a layer providing an interimage effect to red-photosensitive layers)** | | |
| Em-J | silver | 0.293 |
| Em-K | silver | 0.293 |
| Cpd-4 | | 0.030 |
| ExM-2 | | 0.120 |
| ExM-3 | | 0.016 |
| ExY-1 | | 0.016 |
| ExY-6 | | 0.036 |
| Cpd-6 | | 0.011 |
| HBS-1 | | 0.090 |
| HBS-3 | | 0.003 |
| HBS-5 | | 0.030 |
| gelatin | | 0.610 |
| **The eighth layer (low-speed green-photosensitive emulsion layer)** | | |
| Em-H | silver | 0.329 |
| Em-G | silver | 0.333 |

-continued

| | | |
|---|---|---|
| Em-I | silver | 0.088 |
| ExM-2 | | 0.378 |
| ExM-3 | | 0.047 |
| ExY-1 | | 0.017 |
| HBS-1 | | 0.098 |
| HBS-3 | | 0.010 |
| HBS-4 | | 0.077 |
| HBS-5 | | 0.548 |
| Cpd-5 | | 0.010 |
| Cpd-6 | | 0.007 |
| gelatin | | 1.470 |
| The ninth layer (medium-speed green-photosensitive emulsion layer) | | |
| Em-F | silver | 0.457 |
| ExM-2 | | 0.032 |
| ExM-3 | | 0.029 |
| ExM-4 | | 0.029 |
| ExY-1 | | 0.007 |
| ExC-6 | | 0.010 |
| HBS-1 | | 0.065 |
| HBS-3 | | 0.002 |
| HBS-5 | | 0.020 |
| Cpd-5 | | 0.004 |
| Cpd-6 | | 0.011 |
| Cpd-7 | | 0.010 |
| gelatin | | 0.446 |
| The tenth layer (high-speed green-photosensitive emulsion layer) | | |
| Em-E | silver | 0.794 |
| ExC-6 | | 0.002 |
| ExM-1 | | 0.013 |
| ExM-2 | | 0.011 |
| ExM-3 | | 0.030 |
| ExM-4 | | 0.017 |
| ExY-5 | | 0.003 |
| Cpd-3 | | 0.004 |
| Cpd-4 | | 0.007 |
| Cpd-5 | | 0.010 |
| Cpd-7 | | 0.010 |
| HBS-1 | | 0.148 |
| HBS-5 | | 0.037 |
| poly(ethyl acrylate) latex | | 0.099 |
| gelatin | | 0.939 |
| The eleventh layer (yellow filter layer) | | |
| Cpd-1 | | 0.094 |
| solid-dispersed dye ExF-2 | | 0.150 |
| solid-dispersed dye ExF-5 | | 0.010 |
| oil-soluble dye ExF-7 | | 0.010 |
| HBS-1 | | 0.049 |
| gelatin | | 0.630 |
| The twelfth layer (low-speed blue-photosensitive emulsion layer) | | |
| Em-O | silver | 0.112 |
| Em-M | silver | 0.320 |
| Em-N | silver | 0.240 |
| ExC-1 | | 0.027 |
| ExY-1 | | 0.027 |
| ExY-2 | | 0.890 |
| ExY-6 | | 0.120 |
| Cpd-2 | | 0.100 |
| Cpd-3 | | 0.004 |
| Cpd-6 | | 0.009 |
| HBS-1 | | 0.222 |
| HBS-5 | | 0.074 |
| gelatin | | 2.058 |
| The thirteenth layer (high-speed blue-photosensitive emulsion layer) | | |
| Em-L | silver | 0.714 |
| ExY-2 | | 0.211 |
| Cpd-2 | | 0.075 |
| Cpd-3 | | 0.001 |
| HBS-1 | | 0.071 |
| gelatin | | 0.678 |
| The fourteenth layer (first protective layer) | | |
| 0.07 μm silver iodobromide emulsion | silver | 0.301 |
| UV-1 | | 0.211 |
| UV-2 | | 0.132 |

-continued

| | |
|---|---|
| UV-3 | 0.198 |
| UV-4 | 0.026 |
| F-18 | 0.009 |
| S-1 | 0.086 |
| HBS-1 | 0.175 |
| HBS-4 | 0.050 |
| gelatin | 1.984 |
| The fifteenth layer (second protective layer) | |
| H-1 | 0.400 |
| B-1 (having a diameter of 1.7 μm) | 0.050 |
| B-2 (having a diameter of 1.7 μm) | 0.150 |
| B-3 | 0.050 |
| S-1 | 0.200 |
| gelatin | 0.750 |

In addition, as needed, in order to improve storability, processability, pressure resistance, fungi and bacteria resistance, antistatic property, and coatability, each layer contains Z-1~Z-5, B-4~B-6, F-1~F-17, a lead salt, a platinum salt, an iridium salt, or a rhodium salt.

Preparation of Dispersions of Organic, Solid-dispersed Dyes

ExF-2 of the eleventh layer was dispersed in the following way.

| | |
|---|---|
| wet cake of ExF-2 (containing 17.6 weight % water) | 2.800 kg |
| sodium octylphenyldiethoxymethanesulfonate (31 weight % aqueous solution) | 0.376 kg |
| F-15 (7% aqueous solution) | 0.011 kg |
| Water | 4.020 kg |
| Total (adjusted to pH 7.2 by NaOH) | 7.210 kg |

A slurry having the composition described above was coarsely dispersed by means of a dissolver. The slurry was further dispersed by means of an agitator mill "LMK-4" until the light absorbance of the dispersed liquid became 0.29 under the following conditions to thereby obtain a dispersion of solid fine grains. The peripheral speed was 10 m/s; the flow rate was 0.6 kg/min; and the packing percentage of zirconia beads was 80%. The average grain diameter of the dye fine grains was 0.29 μm.

Similarly, the solid dispersions of ExF-4 and ExF-9 were obtained. The average grain diameters of the dye fine grains were 0.28 μm and 0.49 μm, respectively. ExF-5 was dispersed by a method based on microprecipitation described in Example 1 of European Patent No. 549,489A. The average grain diameter of the dye fine grains was 0.06 μm.

The compounds used for the preparation of the layers, excluding those compounds illustrated in Example B-1, are indicated below.

Cpd-5
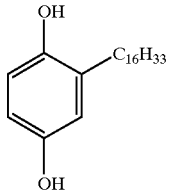
Z-6
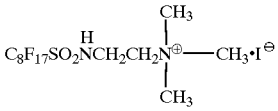
Cpd-6
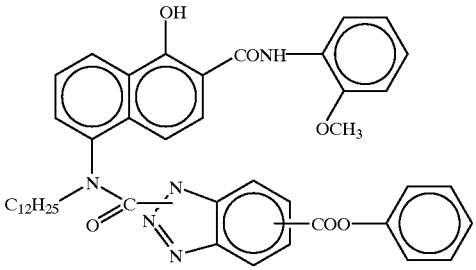
Cpd-7
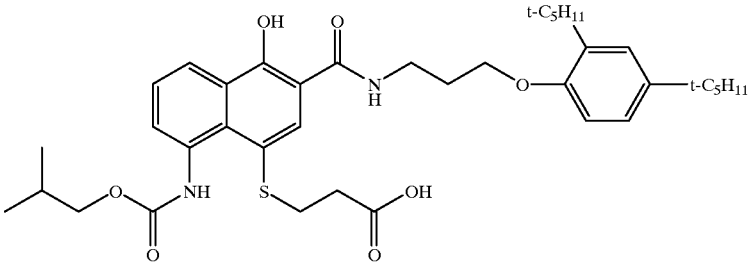
Cpd-8
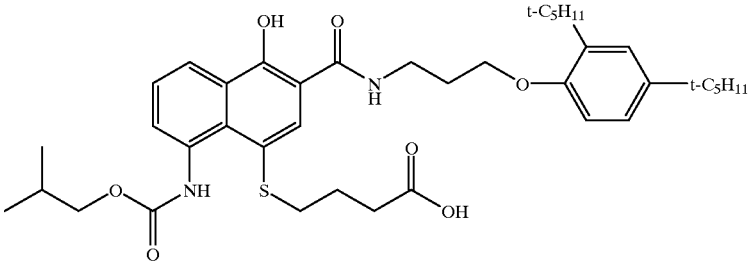
Cpd-9
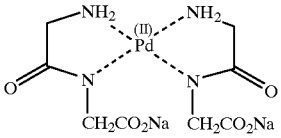
HBS-5
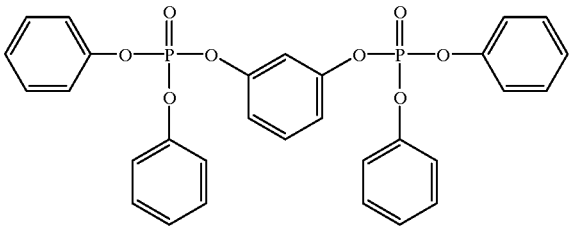

-continued

ExF-10

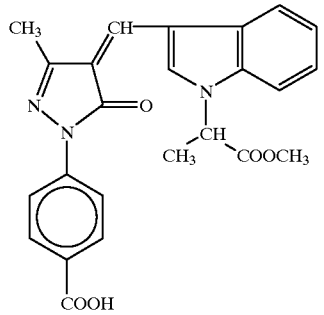

ExF-9

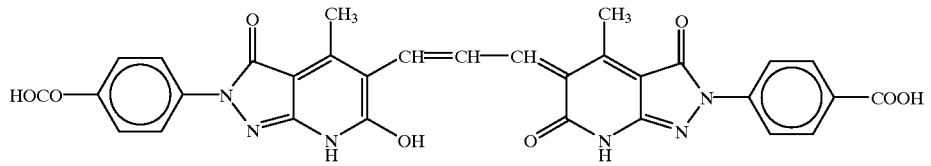

The color negative film prepared in the above-described way was designated as Sample 101.

Sample E101 thus prepared was processed into a shape of 135-24Ex (i.e., an ordinary 35 mm film loaded in a patrone for 24 exposures), in compliance with ISO 1007 and used in the following tests.

2. Development Process (1) Development Process in Example E-1 of the Present Invention As an apparatus for the development process and reading image information according to the method of the present invention, use was made of an experimental development processor which was equipped with an image-reading device, and which was obtained by remodeling an automatic development processor (FP-363SC, manufactured by Fuji Photo Film Co., Ltd.) in the following way including attaching thereto an image-reading device and an intermediate thermal drying zone. By using the experimental development processor, the image processing and reading of image information were carried out according to the development specification described below. The remodeling comprised converting the bleaching tank of the automatic development processor (FP-363SC, manufactured by Fuji Photo Film Co., Ltd.) into a tank for coating a stopping solution; providing a transfer passageway, which enables removal of the film via a squeezing blade from the tank for coating of the stopping solution; and disposing in the following in the following order on the transfer passageway, a reservoir, a first image-reading zone, a thermal drying zone, a reservoir, and a second image-reading zone. Additionally, wherein the transfer passageway was altered so as to enable selection of a passageway discharging film already read from the second image-reading zone, or a passageway returning the film back to the desilvering treating tank of the development process apparatus.

In the above-mentioned apparatus, the film flowed therethrough in the following way. First, the color film is developed in the developing tank. After that, the development is stopped in the tank for coating with the stopping solution, and fed from the stopping solution coating tank by means of a transfer mechanism. Via a reservoir, the film then arrives at the first image-reading zone, in which the first image information reading is carried out. After this reading, the film is delivered by means of a transfer mechanism and arrives at the thermal drying zone in which drying is carried out. After being dried, the film arrives according to the transfer passageway and via the reservoir at the second image-reading zone in which the second image information reading is carried out by using transmitted light.

The thermal drying zone is provided with a combination dryer shown in FIG. 30 comprising infrared drying and contact electrical heating in which a temperature sensor 385 shown in FIG. 30 is set to 80° C. The drying step is rapid, comprising a total of 17 seconds of which 7 seconds is dwell time in a heating chamber 387, and of which 10 seconds is passage time through a conditioning chamber 390.

In the method of the present invention, the color film may be discovered after being read twice. The color film after being read may be used as digital image information, or otherwise a color print or the like may be output from the color film. In addition, the color film after being read may be preserved as a development-processed film. For such purposes, in the above-described experimental apparatus, the original stabilizing tanks (1) and (2) were converted into a bleach-fixing tank, filled with a bleach-fixing solution, while the stabilizing tank (3) was filled with a stabilizing solution. Accordingly, a development-processed film having the same image quality as that of a development-processed film obtained in a commercial color laboratory can also be obtained by desilvering the film after being read in the bleach-fixing tank, stabilizing the images of the desilvered film in the stabilizing tank, and passing the stabilized film through the drying zone. However, in this case, the developing tank needs to use a standard color developing solution or a developing solution similar thereto.

The specification for the processing in Example E-1 is as follows.

(Processing Steps)

| step | processing time | processing temperature | replenished amount* | tank capacity |
|---|---|---|---|---|
| color development | 3 minutes and 5 seconds | 38.0° C. | 15 ml | 10.3 L |
| stopping | 10 seconds | 38.0° C. | 10 ml | coating |
| the first readout of images | | | | |
| thermal drying | 17 seconds | 80.0° C. (maximum temperature) | | |
| the second readout of images | | | | |

*The replenished amount is based on a photosensitive material having a width of 35 mm and a length of 1.1 m (corresponding to one roll of 24 Ex.).

The compositions of the processing solutions are as follows.

(Color Developing Solution)

The same color developing solution as in Example D-1 was used.

(Stopping Solution)

The same stopping solution as in Example D-1 was used.

The following does not constitute part of the processing of the present invention, but rather, is for additional processing.

(Bleach-fixing Solution)

The same bleach-fixing solution as in Example D-1 was used.

(Stabilizing Solution)

The same stabilizing solution as in Example D-1 was used.

(2) Development Process in Comparative Example E-1

By using the same development process apparatus as in Example E-1 of the present invention, the same development and coating were carried out, but, without carrying out the reading of image information and image processing, a color print was prepared by a printer processor based on a surface exposure system described later.

(3) Development Process in Comparative Example E-2

By using the same development process apparatus as in Example E-1 of the present invention, a color print was prepared by the method in Example E-1 of the present invention, except that the thermal heating zone was eliminated (i.e., short-circuiting of the transfer passageway).

(4) Referential Example (Standard Development Process)

In order to show that the quality of the images obtained by the method described in this example of the present invention was equivalent to the quality of the images obtained by general-purpose processing usually adopted in the color photography market, development process was also carried out by the same standard processing as in Example B-1.

3. Reading Out of Images and Image Processing

The first and second image information read out in the first and second image information-reading zones 312 and 314 illustrated in FIG. 22 and FIG. 23, was formed into positive images in the digital image-processing zone 270 illustrated in FIG. 23, and the positive images were output to a printer.

In Example E-1 of the present invention and Comparative Example E-2, as an example of commercially available inputting machines capable of converting images for input which were prepared in the way described above into electric image signals and forming positive images by inputting the signals, a high-speed scanner/image processing workstation, SP-1500 (manufactured by Fuji Photo Film Co., Ltd.), was used. As an example of commercially available outputting machines, a laser printer/paper processor, LP-1500SC (FRONTIER 350, manufactured by Fuji Photo Film Co., Ltd.), was used. As for SP-1000, the program software was altered so that the above-described image processing could be carried out.

In the standard processing and Comparative Example E-1, MINI LABO PP-1257V was used, which is now generally used as a surface exposure system. This apparatus is a printer processor usually employed currently in the market. It is mounted with a printer based on a simultaneous whole image exposure system, printing on a sheet of color paper with light transmitted through a color negative after being developed, and adjusting color balance and exposure amount for printing by controlling the filters.

For printing the films after being developed of Sample E-1 of the present invention, Comparative Example E-1, Comparative Example E-2, and Referential Example (according to standard processing), FUJI COLOR PAPER SUPER FA Type D was used, which is commercially available as color paper. For development process, a color paper processing prescription, CP-48S, and processing solutions therefor (all manufactured by Fuji Photo Film Co., Ltd.) were used.

4. Methods for Testing Photographic Properties

By using each experimental film, a person and a Macbeth chart were photographed under the illumination of a standard light source C described in ISO 5800 (method for measuring the sensitivity of color negative films) at 3 levels of exposure amounts, i.e., a standard exposure amount, an overexposure at 16 times the standard exposure amount, and an overexposure at 64 times the standard exposure amount. After that, development process was carried out according to the processing requirements, including image processing requirements. Next, exposure of color paper and development process thereof were carried out to thereby prepare image prints for evaluation. The overall image qualities, attaching importance to the color, of the images for evaluation, were assessed by 50 persons randomly selected. The rating was made by the following 5 point-method and averages were used as the criteria.

| Point | Meaning |
|---|---|
| 1 | poor |
| 2 | slightly poor |
| 3 | ordinary (on the same level as ordinarily seen print quality) |
| 4 | fair |
| 5 | good |

5. Test Results

The test results are shown in Table 24.

TABLE 24

| Processing | Steps included in the processing: Thermal drying | Steps included in the processing: Image processing | Exposure amount when photographing: Standard exposure | Exposure amount when photographing: 4 grades plus in aperture scale | Exposure amount when photographing: 6 grades plus in aperture scale |
|---|---|---|---|---|---|
| Present invention E-1 | Yes | Yes | 3.7 | 3.6 | 3.6 |
| Comparative Example E-1 | Yes | No | 1.3 | 1.2 | 1.0 |
| Comparative Example E-2 | No | Yes | 2.8 | 2.5 | 1.5 |
| Referential example | Standard development process | No | 3.4 | 3.1 | 2.8 |

As can be seen from Table 24, in the negative of Comparative Example E-1 in which only the development process was performed and thereafter drying was carried out, non-image portions had a high density and were undistinguishable, although images in image portions and non-image portions could be visually observed by reflected light and also by transmitted light. Almost no image was obtained in color prints. Comparative Example E-2, which underwent the first and the second readings without being dried and underwent image processing, provided improved images but the image quality was still insufficient. The insufficiency was remarkable in an extreme overexposure range, i.e., 6 grades greater in aperture scale. Example E-1 of the present invention, in which image processing was performed by reading the second image information after carrying out the thermal drying treatment, was found to exhibit image quality approximately equivalent to or better than that of the referential example according to the standard processing. Example E-1 of the present invention has a smaller number of steps and is superior to the standard processing in simplicity and speed. In addition, Example E-1 of the present invention provides an economical advantage in that processing agents for desilvering and stabilizing tanks are not required.

The color film of Example E-1 of the present invention, which had undergone a series of processing steps including development, thermal drying, and readout of image information (this film may be discovered in the present invention), were further subjected to a bleaching treatment and a stabilization treatment in a bath. After that, as in the referential example, a color print was prepared by using MINI LABO PP-1257V (manufactured by Fuji Photo Film Co., Ltd.) based on use as a surface exposure system. The image quality evaluation results of the print were virtually equivalent to the evaluation results of the color print of the referential example. Accordingly, it was shown that the color film of Example E-1 of the present invention enabled the preservation of the film by carrying out the desilvering and the treatment with a stabilizing solution.

Example E-2

(1) Example E-2 of the Present Invention

A test was conducted by using the same color negative film sample, apparatus, and method as in Example E-1 of the present invention, except that the color developing and thermal drying steps were replaced by the following black-and-white developing step, readout of images, thermal drying step, and treatment prescriptions therefor.

The processing, reading step, and specifications of the prescriptions are as follows.

(Processing Steps)

| Step | processing time | processing temperature | replenished amount* | tank capacity |
|---|---|---|---|---|
| black-and-while development | 60 seconds | 38.0° C. | 10 ml | 10.3 L |
| Stopping | 10 seconds | 38.0° C. | 10 ml | coating |
| the first readout of images | | | | |
| thermal drying | 17 seconds | 80.0° C. (maximum temperature) | | |
| the second readout of images | | | | |

*The replenished amount is based on photosensitive material having a width of 35 mm and a length of 1.1 m (corresponding to one roll of 24 Ex.).

| [black-and-white developing solution] | [tank solution] |
|---|---|
| nitro-N,N,N-trimethylenesulfonic acid pentasodium salt | 1.5 g |
| diethylenetriamine-pentaacetic acid pentasodium salt | 2.0 g |
| sodium sulfite | 30 g |
| potassium hydroquinonemonosulfonate | 25 g |
| potassium carbonate | 15 g |
| potassium hydrogencarbonate | 12 g |
| 1-phenyl-4-methyl-4-hydroxymethyl-3-pyrazolidone | 2.0 g |
| potassium bromide | 2.0 g |
| potassium thiocyanate | 1.5 g |
| potassium iodide | 1.3 mg |
| diethylene glycol | 13 g |
| water to make | 1000 ml |
| pH | 9.80 |

The pH was controlled by sulfuric acid or potassium hydroxide.

The replenisher solution is the same as the freshly filled tank solution (i.e., replenishment using the mother solution)

(Stopping Solution)

The same stopping solution as in Example E-1 was used.

(2) Comparative Example E-3

Comparative Example E-3 was obtained by carrying out the development process and image processing according to the same method as in Example E-2 of the present invention, except that the thermal drying was not carried out and the first and second image reading operations were carried out using samples in a wet state.

After the completion of the processing, the samples of Example E-2 of the present invention and Comparative Example E-3 were subjected to image evaluation in the same way as for Example E-1.

The results are shown in Table 25.

TABLE 25

| Processing | Steps included in the processing: Thermal drying | Steps included in the processing: Image processing | Exposure amount when photographing: Standard exposure | Exposure amount when photographing: 4 grades plus in aperture scale | Exposure amount when photographing: 6 grades plus in aperture scale |
|---|---|---|---|---|---|
| Present invention E-2 | Yes | Yes | 4.0 | 4.0 | 3.8 |
| Comparative Example E-3 | No | Yes | 2.5 | 2.2 | 1.7 |

As shown in Table 25, the sample of Example E-2 of the present invention provides satisfactory image qualities equivalent to those of the referential example shown in Table 24, but Comparative Example E-3 exhibits very poor evaluation results.

In addition, the comparison between Example E-1 of the present invention in Table 24 using a color developing solution and Example E-2 of the present invention in Table 25 using a black-and-white developing solution indicates that the development process using a black-and-white developing solution is faster and provides image qualities of greater rating due to images with less fogging. Furthermore, a long-term experiment gave the result that, in the case of the development process using a black-and-white developing solution, that the stability of the developing solution was greater despite the amount of the replenisher solution being smaller.

Example E-3

Example E-3 of the Present Invention

The test procedure of Example E-2 of the present invention was repeated, except that, instead of introduction into the thermal heating zone, the color film after completion of the first readout of images was introduced into a household electronic oven in which the microwave heating was carried out at 3 levels of 10, 20, and 30 seconds and thereafter put on the transfer passageway for the second readout of images. The results were assessed in the same way as in Example E-2 of the present invention. In the test, in order to prevent the oven from being heated dry, cotton soaked with water was placed in a corner of the microwave chamber.

At the point of 10 seconds of heating time, the surface of the color film was dry. The surface of the color film after 10~30 seconds of drying time was free of any sign of excessive dryness and increase of curling was slight. Hence, there is an additional advantage in that there was observed an ample tolerance to variation in drying conditions.

Regardless of the drying times of 10~30 seconds, the color prints obtained in this test were substantially equivalent to the color print of Example E-2 of the present invention.

Example F-1

1. Preparation of a Color Negative Film Sample

A color negative film sample F101 was prepared by the same method as in the preparation of the color negative film sample E101 for Example E-1.

The color negative film sample F101 thus prepared was processed into an APS shape of 240-25Ex (loaded in a patrone for 25 exposures) in compliance with ISO 1007 and used in the following tests.

2. Development Process (1) Development Process of Example F-1 of the Present Invention A developing apparatus shown in FIG. 32, comprising a combination of development by coating based on a roller coating system and contact heating based on a heat drum system, was used as the apparatus for development process and readout of image information by the method of the present invention. The revolution rate of the heat drum was one rotation per minute, and therefore the heating time by contact of the color film with the drum is 30 seconds. The surface temperature of the drum is controlled to remain at 80° C. by means of electrical heating.

In the above-mentioned apparatus, the film flows in the following way. First, the color film is fed from the film loading chamber 400 in the direction indicated by the arrow A. The photosensitive layer side of the film is coated with a developing solution by contact with coating rollers (not shown) of the tank (giesser) filled with the developing solution for 5 seconds. After that, the film is heated while rotating around the heat drum clockwise in such a manner that the photosensitive layer surface of the film is covered with a cover film. The film, after being separated from the cover film by means of a removing roller 375, arrives via the transfer passage way by means of guide rollers 377 at the first image-reading zone 312 in which the reading of the first image information is carried out using reflected light. After this reading, the film arrives at the second image-reading zone 314 in which the reading of the second image information is carried out by using transmitted light.

The developing solution for Example F-1 of the present invention is a viscous developing solution having the following composition.

| (color developing solution) | amounts (in gram) |
|---|---|
| diethylenetriaminepentaacetic acid | 4.0 |
| sodium 4,5-dihydroxybenzene-1,3-disulfonate | 0.5 |
| hydroxylamine | 15.0 |
| sodium sulfite | 9.0 |
| diethylene glycol | 17.0 |
| potassium carbonate | 59.0 |
| ethyleneurea | 5.5 |
| potassium bromide | 1.4 |
| 2-methyl-4-[N-ethyl-N-(β-hydroxyethyl)amino]aniline sulfuric acid salt | 15.0 |
| hydroxymethylcellulose | 6.0 |
| water for preparation | 1.0 L |
| pH (controlled by potassium hydroxide and sulfuric acid) | 10.50 |

The above-described amount of hydroxymethylcellulose was added after being mixed sufficiently with 15 mL of a 10% NaOH aqueous solution.

(2) Comparative Example F-1

In Comparative Example F-1, a color print was obtained by exposure and development using an ordinary printer processor, without the utilization of the information obtained by reading the images of the sample after the development process in Example F-1 of the present invention.

(3) Comparative Example F-2

In Comparative Example F-2, the coating of the developing solution, reading of images, and preparation of a color print were carried out by the same method as in Example F-1 of the present invention, except that the temperature of the heat drum of the developing apparatus equipped with the heat drum shown in FIG. 32, was kept at room temperature (about 25° C.) and the duration of the development was 200 seconds by adding 170 seconds, during which the rotation of the drum in contact with the film is stopped, to the time during which the rotation of the drum is continued.

(4) Referential Example (i.e., Example of a Standard Development Process)

In order to show that the quality of the images obtained by the method described of the present invention was equivalent to the quality of the images obtained by general-purpose processing (i.e., standard processing) adopted in the color photography market, development process was also carried out by the standard processing described previously as a referential example. The standard processing was carried out by the following development processor for color negatives according to the following processing specification. Specifically, an automatic development processor, FP-363SC, manufactured by Fuji Photo Film Co., Ltd., was used as the automatic development processor; and the processing steps and the compositions of the processing solutions were as follows.

(Processing steps)

| step | processing time | processing temperature | replenished amount* | tank capacity |
|---|---|---|---|---|
| color development | 3 minutes and 5 seconds | 38.0° C. | 20 ml | 10.3 L |
| bleaching | 50 seconds | 38.0° C. | 5 ml | 3.6 L |
| fixing (1) | 50 seconds | 38.0° C. | — | 3.6 L |
| fixing (2) | 50 seconds | 38.0° C. | 7.5 ml | 3.6 L |
| stabilization (1) | 20 seconds | 38.0° C. | — | 1.9 L |
| stabilization (2) | 20 seconds | 38.0° C. | — | 1.9 L |
| Stabilization (3) | 20 seconds | 38.0° C. | 30 ml | 1.9 L |
| drying | 1 minute and 30 seconds | 60° C. | | |

*The replenished amount is based on 0.039 $m^2$ of a photosensitive material.

The stabilizing solution was in a state of a counter-current flow of (3)→(2)→(1); and the piping for the fixing solution was also in a state of a counter-current flow of (2)→(1). The amounts of carryover of the developing solution to the bleaching step, carryover of the bleaching solution to the fixing step, carryover of the fixing solution to the water-rinsing step were 2.5 ml, 2.0 ml, and 2.0 ml, respectively, based on 0.039 $m^2$ of photosensitive material. The crossover times were each 6 seconds. Each crossover time was included in the processing time of the preceding step.

The compositions of the processing solutions are described below.

| (color developing solution) | tank solution (g) replenisher | solution (g) |
|---|---|---|
| diethylenetriamine-pentaacetic acid | 2.0 | 4.0 |
| sodium 4,5-dihydroxybenzene-1,3-disulfonate | 0.4 | 0.5 |
| hydroxylamine | 10.0 | 15.0 |
| sodium sulfite | 4.0 | 9.0 |
| diethylene glycol | 10.0 | 17.0 |
| potassium carbonate | 39.0 | 59.0 |
| ethyleneurea | 3.0 | 5.5 |
| potassium bromide | 1.4 | — |
| 2-methyl-4-[N-ethyl-N-(β-hydroxyethyl) amino]aniline sulfuric acid salt | 4.7 | 11.4 |
| water for preparation | 1.0 L | 1.0 L |
| pH (controlled by potassium hydroxide and sulfuric acid) | 10.05 | 10.25 |

(Bleaching Solution)

The same bleaching as in Example B-1 was used.

(Fixing Solution)

The same fixing solution as in Example B-1 was used.

(Stabilizing Solution)

The same stabilizing solution as in Example B-1 was used.

3. Reading Out of Images and Image Processing

The first and second image information read out in the first and second image information-reading zones 312A and 312B illustrated in FIG. 31 was formed into positive images in the digital image-processing zone 270 illustrated in FIG. 25, and the positive images were output to a printer.

As an example of commercially available inputting machines capable of converting images for input into electric image signals and forming positive images by inputting the signals, a high-speed scanner/image processing workstation, SP-1000 (manufactured by Fuji Photo Film Co., Ltd.), was used. As an example of commercially available outputting machines, a laser printer/paper processor, LP-1000P (manufactured by Fuji Photo Film Co., Ltd.), was used. As for SP-1000, the program software was altered so that the above-described image processing could be carried out.

For the purpose of standard processing, MINI LABO PP-1257V, which is now generally used as a surface exposure system, was used. This apparatus is a printer processor usually employed currently in the market. It is mounted with a printer based on a simultaneous whole image exposure system, printing on a sheet of color paper with light transmitted through a color negative after being developed and adjusting color balance and exposure amount for printing by controlling the filters.

For printing the films after being developed of Samples B101~B114 and Referential Example (according to standard processing), FUJI COLOR PAPER SUPER FA Type D, which is commercially available as color paper, was used. For development process, a color paper processing prescription, CP-48S, and processing solutions therefor (all manufactured by Fuji Photo Film Co., Ltd.) were used.

4. Methods for Testing Photographic Properties

By using each experimental film, snapshots of a person were taken against a gray wall background under the illumination of a standard light source C described in ISO 5800 (method for measuring the sensitivity of color negative films) by 3 exposure amount levels, i.e., a standard exposure amount, an underexposure by ½, and an overexposure at 4 times the standard exposure amount. After that, development process was carried out according to the processing condition described above to thereby prepare negative films for evaluation. Next, prints of color images were obtained from the above-described negative images. The overall image qualities, attaching importance to color and gradation, of the color prints for evaluation, were assessed by 10 persons specialized in photography evaluation. The rating was made by the following 5 point-method and averages were used as the criteria.

| Rating | Points |
|---|---|
| very poor and unacceptable | 1 |
| slightly poor and unacceptable | 2 |
| relatively poor but acceptable | 3 |
| relatively good and desirable | 4 |
| very desirable | 5 |

5. Test Results

The test results are shown in Table 27. Although the procedures of the tests shown in Table 27 were described above, these are again described below for convenient reference.

(1) Example F-1 of the Present Invention

In the processing apparatus described above, the development step comprising dip coating of a viscous developing solution and heating by means of a heat drum, the first readout of image information, and the second readout of image information were carried out; and the first and second image information was processed and converted into red, blue, and green digital image information. Using the image information thus obtained, printing and color paper development were carried out by LP-1500S and a color print obtained.

(2) Comparative Example F-1

(Without Image Processing)

Without carrying out the readout and image processing of the film after being developed, a color print for comparison was obtained by PP-1257V based on a surface exposure system.

(3) Comparative Example F-2

(Without Thermal Treatment)

By using the processing apparatus of Example F-1 of the present invention, the film was subjected to development process for 200 seconds while the temperature of the heat drum was set to room temperature. After that, the film underwent the first and second readout of image information, and the first and second image information was processed and converted into red, blue, and green digital image information. Using the image information thus obtained, printing and positive development were carried out by LP-1500S and a color print for comparison obtained.

(4) Referential Example

Using the film obtained by the treatment according to the aforedescribed standard processing procedure, a color print as a referential example was obtained by printing and color paper development using PP-1257V based on a surface exposure system.

TABLE 27

| | Steps included in the processing | | Exposure amount when photographing | | |
|---|---|---|---|---|---|
| Processing | Thermal drying | Image processing | 2 grades less in aperture scale | Standard exposure | 4 grades greater in aperture scale |
| Present invention F-1 | Yes | Yes | 3.8 | 3.8 | 3.8 |
| Comparative Example F-1 | Yes | No | 1.5 | 2.0 | 1.5 |
| Comparative Example F-2 | No | Yes | 2.0 | 2.5 | 2.5 |
| Referential example | Standard development process | No | 3.6 | 3.8 | 3.7 |

As can be seen from Table 27, the color print image of Comparative Example F-1, which had undergone the development process of the present invention, but was obtained by PP-1257V based on a surface exposure system, was inferior because of low contrast and low color density. The color print image of Comparative Example F-2, which had undergone the drum development for a prolonged period of time instead of being heated, the first and second readout, and image processing, was still unsatisfactory, although improvement was observed. The color print image of Example F-1 of the present invention, which had undergone the heat development of the film by a developing solution supplied by means of a heat drum, the first and second readout, and image processing, was found to exhibit image quality approximately equivalent to that of the referential example according to the standard processing. Example F-1 of the present invention has a shorter process comprised merely of coating and heating and is superior to the standard processing in simplicity and speed. In addition, Example F-1 of the present invention provides an economical advantage in that processing agents for desilvering and stabilizing tanks are not required.

Example F-2

(1) Example F-2 of the Present Invention

A test was conducted by using the same color negative film sample, apparatus, and method as in Example F-1 of the present invention, except that the coating step of color developing solution and the thermal drying step were replaced by the following coating step of black-and-white developing solution and thermal drying step.

The prescription for the developing solution, temperature, and time are as follows.

(Processing Step)

| step | processing time | processing temperature |
|---|---|---|
| black-and-white development | 10 seconds | 90.0° C. |

The surface temperature of the heat drum was set to 90° C. and the contact heating time of the film was set to 10 seconds by setting the rotation rate to 3 rpm.

| (black-and-white developing solution) | ingredients |
|---|---|
| nitro-N,N,N-trimethylenesulfonic acid pentasodium salt | 1.5 g |
| diethylenetriamine-pentaacetic acid pentasodium salt | 2.0 g |
| sodium sulfite | 30 g |
| potassium hydroquinonemonosulfonate | 20 g |
| potassium carbonate | 15 g |
| potassium hydrogencarbonate | 12 g |
| 1-phenyl-4-methyl-4-hydroxymethyl-3-pyrazolidone | 1.5 g |
| potassium bromide | 2.5 g |
| potassium thiocyanate | 1.2 g |
| potassium iodide | 2.0 mg |
| diethylene glycol | 13 g |
| hydroxymethylcellulose | 6.0 g |
| water to make | 1.0 L |
| pH (controlled by potassium hydroxide and sulfuric acid) | 10.60 |

The above-described amount of hydroxymethylcellulose was added after being mixed sufficiently with 15 mL of a 10% NaOH aqueous solution.

(2) Comparative Example F-3

In Comparative Example F-3, a color print was obtained by exposure and development using an ordinary printer processor without the utilization of the information obtained by reading the images of the sample after the development process in Example F-2 of the present invention.

(3) Comparative Example F-4

In Comparative Example F-4, the coating of the developing solution, reading of images, and preparation of a color print were carried out by the same method as in Example F-1 of the present invention, except that the temperature of the heat drum of the developing apparatus equipped with the heat drum shown in FIG. 32 was kept at room temperature (about 25° C.), the rotation rate was set to one rotation per 3 minutes, the duration of the contact of the film with the heat drum was set to 90 seconds, and the developing solution was a black-and-white developing solution.

After the completion of the processing, the samples of Example F-2 of the present invention and Comparative Example F-3 and Comparative Example F-4 were subjected to image evaluation in the same way as in Example F-1.

The results are shown in Table 28.

TABLE 28

| | Steps included in the processing | | Exposure amount when photographing | | |
|---|---|---|---|---|---|
| | | | 2 grades less in | | 4 grades greater in |
| Processing | Thermal drying | Image processing | aperture scale | Standard exposure | aperture scale |
| Present invention F-2 | Yes | Yes | 3.8 | 4.0 | 4.0 |
| Comparative Example F-3 | Yes | No | 2.0 | 2.0 | 1.7 |
| Comparative Example F-4 | No | Yes | 2.5 | 2.5 | 2.0 |

As shown in Table 28, the sample of Example F-2 of the present invention provides satisfactory image qualities equivalent to those of the referential example shown in Table 27, but Comparative Example F-3 and Comparative Example F-4 exhibit very poor evaluation results.

In addition, the comparison between Example E-1 of the present invention in Table 27 using a color developing solution and Example F-2 of the present invention in Table 28 using a black-and-white developing solution indicates that the development process using a black-and-white developing solution is faster and provides image qualities of greater rating due to images with less fogging.

Example F-3

Example F-3 is an example of the present invention in which a development process web is used.

The development process apparatus shown in FIG. 32 was remodeled as follows. The coating zone 406 was removed and, in place thereof, a coating zone having the same construction as the coating zone 406 was provided between the delivery rollers 378 of the cover film 374 and the delivery detection mechanism 404 so that the cover film absorbs the developing solution to thereby become a development process web when the cover film passes through the coating zone. On the cover film, an unhardened gelatin layer having a thickness of 20 $\mu$m was provided so that it became a liquid layer having a thickness of 80 $\mu$m when swelled. The rotation rates of the heat drum were set to 2 rpm, 3 rpm, and 5 rpm; and the heat development times were set to 15 seconds, 10 seconds, and 6 seconds. The developing solution used for the development process web was the black-and-white development solution shown in Example F-2 of the present invention, but did not contain hydroxymethylcellulose as a thickening agent.

Testing was conducted by the same method as in Example F-2 of the present invention except the above-described remodeling, and results evaluated.

Each color print obtained by the above-described test was substantially equivalent to the color print of Example F-2 of the present invention. The fact that practically the same color prints were obtained despite a wide difference of developing time ranging from 6 seconds to 15 seconds indicates that the image forming method of the present invention has a wide latitude in heat developing conditions with respect to the image qualities because the supply amount of the developing solution is limited as image processing is performed.

Example G-1

1. Preparation of a Color Negative Film Sample

A color negative film sample G101 was prepared by the same method as in the preparation of the color negative film sample E101 in Example E-1.

The color negative film sample G101 thus prepared was processed into an APS shape of 240-25Ex (loaded in a patrone for 25 exposures) in compliance with ISO 1007 and used in the following tests.

2. Development Process

A. Test by Freshly Prepared Processing Solutions (1) Development process of Example G-1 of the Present Invention A developing apparatus shown in FIG. 32, comprising a combination of coating of a developing agent solution based on a roller coating system and contact heating using a processing web impregnated with an alkali agent based on a heat drum system, was used as the apparatus for development process and readout of image information. The rotation rate of the heat drum was one rotation per minute and therefore the heating time by the contact of the color film with the drum is 45 seconds. The surface temperature of the drum is controlled to remain at 85° C. by means of electrical heating.

In the above-mentioned apparatus, the film flows in the following way. First, the color film is fed from the film loading chamber 400 in the direction indicated by the arrow A. The photosensitive layer side of the film is coated with a developing agent solution by contact for 5 seconds with coating rollers half immersed in the developing agent solution in the coating zone 406 of the developing agent solution. After that, the film is heated while rotating around the heat drum clockwise in such a manner that the photosensitive layer surface of the film is brought into contact with the layer impregnated with an alkali agent of the alkali-impregnated processing web. The film, after being separated from the processing web by means of a removing roller 375, arrives via the transfer passage way by means of guide rollers 377 at the image-reading zone in which the readout of image information is carried out. Although readout by reflected light and readout by transmitted light are possible in the apparatus shown in FIG. 32, the readout was carried out by transmitted light using a readout device 314 comprising a light source 411T and a sensor 409T.

The developing agent solution and alkali agent solution for Example G-1 of the present invention are viscous developing solutions having the following compositions.

| | amounts (in grams) |
|---|---|
| (developing agent solution) | |
| sodium 4,5-dihydroxybenzene-1,3-disulfonate | 0.5 |
| sodium sulfite | 3.0 |
| 2-methyl-4-[N-ethyl-N-(β-hydroxyethyl)amino]aniline sulfuric acid salt | 20.0 |

-continued

| | amounts (in grams) |
|---|---|
| hydroxymethylcellulose | 3.0 |
| water to make | 0.5 L |
| pH (controlled by potassium hydroxide and sulfuric acid) | 1.0 |
| (alkali agent solution) | |
| diethylenetriamine-pentaacetic acid | 4.0 |
| hydroxylamine | 7.0 |
| diethylene glycol | 17.0 |
| potassium carbonate | 59.0 |
| ethyleneurea | 5.5 |
| potassium bromide | 1.4 |
| hydroxymethylcellulose | 3.0 |
| water to make | 0.5 L |
| pH (controlled by potassium hydroxide and sulfuric acid) | 12.0 |

The above-described amount of hydroxymethylcellulose was added after being mixed sufficiently with 15 mL of a 10% NaOH aqueous solution.

(2) Comparative Example G-1

In Comparative Example G-1, a color print was prepared by carrying out the development process and obtaining digital information according to the same method as in Example G-1 of the present invention, except that the coating zone 403 of the developing agent solution shown in FIG. 32 was filled with a developing solution prepared by blending the above-described developing agent solution and alkali agent solution; and a cover film, instead of the processing web impregnated with an alkali agent, is fed from the delivery rollers 378 so that development could be performed on the heat drum while the color film containing the developing solution is covered.

(3) Comparative Example G-2

In Comparative Example F-1, the development process was carried out according to the same method as in Example G-1 of the present invention, except that a color print was prepared using an ordinary printer processor (PP-1257V manufactured by Fuji Photo Film Co., Ltd.) based on an ordinary uniform surface exposure system, instead of reading out and using the image information.

(4) Referential Example (i.e., Example of a Standard Development Process)

In order to show that the quality of the images obtained by the method of the present invention was equivalent to the quality of the images obtained by general-purpose processing (i.e., standard processing) adopted in the color photography market, development process was also carried out by the same standard processing as in Example F-1 described previously, as a referential example.

B. Test by Using an Aged Processing Solution.

In Example G-1 of the present invention and Comparative Example G-1, after completion of the development process, the development process apparatuses filled with the processing solutions were left to stand for 5 days and the tests described above were repeated by using the same processing solutions. These examples were designated as Example G-1' of the present invention and Comparative Example G-1', respectively.

3. Reading Out of Images and Image Processing

The image information was read from the samples of Example G-1 of the present invention and Comparative Example G-1, respectively. The image information was formed into positive images in the digital image-processing zone 270 illustrated in FIG. 25, and the positive images were output to a printer.

As an example of commercially available inputting machines capable of converting images for input into electric image signals and forming positive images by inputting the signals, a high-speed scanner/image processing workstation, SP-1500 (manufactured by Fuji Photo Film Co., Ltd.), was used. As an example of commercially available outputting machines, a laser printer/paper processor, LP-1500SC (FRONTIER 350, manufactured by Fuji Photo Film Co., Ltd.), was used. As for SP-1500, the program software was altered so that the above-described image processing could be carried out.

For the purpose of standard processing, MINI LABO PP-1257V, was used which is now generally used as a surface exposure system. This apparatus is a printer processor usually employed currently in the market. It is mounted with a printer based on a simultaneous whole image exposure system, printing on a sheet of color paper with light transmitted through a color negative after being developed and adjusting color balance and exposure amount for printing by controlling the filters.

For printing the films after being developed of Examples G-1 and G-1' of the present invention, Comparative Examples G-1 and G-1', and Referential Example (according to standard processing), FUJI COLOR PAPER SUPER FA Type D, which is commercially available as color paper, was used. For development process, a color paper processing prescription, CP-48S, and processing solutions therefor (all manufactured by Fuji Photo Film Co., Ltd.) were used.

4. Method for Testing Photographic Properties

By using each experimental film, snapshots of a person were taken against a gray wall background under the illumination of a standard light source C described in ISO 5800 (method for measuring the sensitivity of color negative films) by 3 exposure amounts levels, i.e., a standard exposure amount, an underexposure by ½, and an overexposure at 4 times the standard exposure amount. After that, development process was carried out under the condition of the example of the present invention or under the altered conditions of comparative examples described above to thereby prepare negative films for evaluation. Next, prints of color images were obtained by using the color paper and the printer processor described above. The overall image qualities, attaching importance to the smoothness of image granularity, of the color prints for evaluation, were assessed by ten persons specialized in photography evaluation. The rating was made by the following 5 point-method and averages were used as the criteria.

| Rating | Points |
|---|---|
| very poor and unacceptable | 1 |
| slightly poor and unacceptable | 2 |
| relatively poor but acceptable | 3 |
| relatively good and desirable | 4 |
| very desirable | 5 |

5. Test Results

Test by the Processing Solution Newly Prepared

As can be seen from Table 29, the color print image of Comparative Example G-2, which had undergone the development process of the present invention but was obtained by PP-1257V based on a surface exposure system, was inferior because of low contrast and low color density. In Comparative Example G-1, the development process solution was not separated into a developing agent solution and an alkali agent solution, and was therefore based on a one-component system, but image processing was implemented. Although the color print image of Comparative Example G-1 provided good results when fresh solution was used, the color print image of Comparative Example G-1', in which development process was carried out using processing solution after standing for 5 days, was inferior due to reduced density. In Example G-1 of the present invention, the color film, after being supplied with a developing agent solution, is placed together with a processing web impregnated with an alkali agent and underwent heat development on the heading drum. After that, the image information was read and image processing implemented. The image quality of Example G-1 of the present invention thus obtained was found to exhibit image quality approximately equivalent to that of the referential example according to the standard processing. In addition, it was found that this quality was also maintained in Example G-1' of the present invention, in which the processing was carried out by using the developing agent solution after standing for 5 days, and the alkali agent solution. Therefore, it full performance can be achieved exhibited even when processing is not busy. The results are shown in Table 29.

TABLE 29

| | Steps included in the processing | | Immediately after being preparation | | | After standing for 5 days | | |
|---|---|---|---|---|---|---|---|---|
| Processing | Development process | Image processing | 2 grades less in aperture scale | Standard exposure | 3 grades greater in aperture scale | 2 grades less in aperture scale | Standard exposure | 3 grades greater in aperture scale |
| Present invention G-1 | 2-component | Yes | 3.6 | 3.8 | 3.8 | 3.5 | 3.7 | 3.7 |
| Comparative Example G-1 | One-component solution by blending | Yes | 3.6 | 3.6 | 3.7 | 3.0 | 3.1 | 3.0 |
| Comparative Example G-2 | 2-component | No | 2.0 | 2.7 | 2.2 | — | — | — |
| Referential example | Standard development process | No | 3.6 | 3.8 | 3.7 | — | — | — |

Example G-2

(1) Example G-2 of the Present Invention

A test was conducted by using the same color negative film sample, apparatus, and method as in Example G-1 of the present invention, except that the color developing agent solution, the processing step of alkali agent solution, and the thermal drying step in Example G-1 were replaced by the following black-and-white developing agent solution, processing step by an alkali agent solution, and thermal drying step.

The prescription of the developing solution, temperature, and time are as follows.

(Black-and-white Development Process Step)

| step | processing time | processing temperature |
|---|---|---|
| black-and-white development | 10 seconds | 90.0° C. |

The surface temperature for the heat drum was set to 90° C. and the contact heating time of the film was set to 10 seconds by setting the revolution speed to 3 rpm.

| | amounts |
|---|---|
| [black-and-white developing agent solution] | |
| nitro-N,N,N-trimethylenesulfonic acid pentasodium salt | 1.5 g |
| potassium hydrogencarbonate | 15 g |
| potassium hydroquinonemonosulfonate | 30 g |
| 1-phenyl-4-methyl-4-hydroxymethyl-3-pyrazolidone | 1.5 g |
| hydroxymethylcellulose | 3.0 g |
| water for preparation | 0.5 L |
| pH (controlled by potassium hydroxide and sulfuric acid) | 2.0 |
| [alkali agent solution] | |
| diethylenetriamine-pentaacetic acid pentasodium salt | 2.0 g |
| potassium carbonate | 20 g |
| potassium hydrogencarbonate | 12 g |
| potassium bromide | 2.5 g |
| potassium thiocyanate | 1.2 g |
| potassium iodide | 2.0 mg |
| diethylene glycol | 13 g |
| hydroxymethylcellulose | 3.0 g |
| water to make | 0.5 L |
| pH (controlled by potassium hydroxide and sulfuric acid) | 10.60 |

The above-described amount of hydroxymethylcellulose for the two solutions was added after being mixed sufficiently with 15 mL of a 10% NaOH aqueous solution.

(2) Comparative Example G-3

In Comparative Example F-3, the processing was carried out in the same way as in Comparative Example G-1 of Example G-1, except that the black-and-white developing agent solution and the alkali agent solution of Example G-2 of the present invention were blended to thereby prepare a black-and-white developing solution (having a pH value of 10.0).

(3) Comparative Example G-4

In Comparative Example G-4, the coating of the developing solution, reading of images, and preparation of a color print were carried out by the same method as in Example G-1 of the present invention, except that the temperature of the heat drum of the developing apparatus equipped with the heat drum shown in FIG. 32 was set to 30° C., the rotation rate was set to one rotation per 3 minutes, the duration of the contact of the film with the heat drum was set to 90 seconds, and the developing solution was a black-and-while developing solution.

Furthermore, after being left to stand for 3 days, Example G-2 of the present invention and Comparative Example G-3 were processed again as in Example G-1.

After the completion of the processing, the samples of Example G-2 of the present invention and Comparative Example G-3 and Comparative Example G-4 were subjected to image evaluation in the same way as in Example G-1.

The results are shown in Table 30.

TABLE 30

| | Steps included in the processing | | photograph Exposure amount (fresh) | | | photograph Exposure amount After standing for 3 days | | |
|---|---|---|---|---|---|---|---|---|
| Processing | Image processing | Image processing | 2 grades less in aperture scale | Standard exposure | 3 grades greater in aperture scale | 2 grades less in aperture scale | Standard exposure | 3 grades greater in aperture scale |
| Present invention G-2 | 2-component | Yes | 3.0 | 3.5 | 3.5 | 3.0 | 3.4 | 3.4 |
| Comparative Example G-3 | One-component solution by blending | Yes | 3.0 | 3.5 | 3.5 | 2.1 | 2.4 | 2.4 |
| Comparative Example G-4 | Without heating | Yes | 2.5 | 3.0 | 3.0 | — | — | — |

As shown in Table 30, whereas the sample of Example G-2 of the present invention provides satisfactory images even when the same liquid as that of Referential Example shown in Table 29 is aged, Comparative Example G-3 provides unsatisfactory results when processed with an aged processing liquid and Comparative Example G-4 provides unsatisfactory results even when processed with a fresh liquid. The comparison between Example G-1 of the present invention using a color developing solution shown in Table 29 and Example G-2 of the present invention using a black-and-white developing solution shown in Table 30 indicates that the use of the black-and-white developing solution speeds the development process, but the use of a color developing solution that reads the dye image of Example G-1 of the present invention has better image quality in the assessment.

Example G-3

(1) Examples G-3~G-12 of the Present Invention

The procedure of Example G-1 of the present invention in Example G-1 was repeated, except that the duration of heat development was shortened to 30 seconds and the following transparentization treatment was carried out after the heat development and before the readout of images.

The photosensitive layer of the color film and the processing sheet for transparentization were placed together and heated for 40 seconds at 70° C. The sheet comprises a 80 μm-thick PET film having thereon a 20 μm-thick gelatin layer containing 2,4-dichloro-6-hydroxy-1,3,5-triazine in an amount equivalent to 0.5% weight of the gelatin so that the gelatin layer becomes a liquid layer having a thickness of 80 μm when swelled. The gelatin layer is impregnated in advance with a saturated amount (impregnated by immersion for 6 minutes at 28° C.) of the following clarification solution.

| (clarification solution) | (g) |
|---|---|
| ammonium methanesulfinate | 20 |
| ammonium methanethiosulfonate | 4 |
| aqueous solution of ammonium thiosulfate (700 g/L) | 280 mL |
| fixing accelerator (refer to Table 30) | 5 |
| ethylenediamine-tetraacetic acid | 15 |
| carboxymethylcellulose | 2 |
| water for preparation | 1.0 L |
| pH (controlled by ammonia water and acetic acid) | 7.4 |

The test results are shown in Table 31.

TABLE 31

| | | Photograph Exposure amount | | |
|---|---|---|---|---|
| Test No. | Fixing accelerator | 2 grades less in aperture scale | Standard exposure | 3 grades greater in aperture scale |
| Present invention G-3 | — | 3.0 | 3.5 | 3.0 |
| Present invention G-4 | FI-1 | 3.5 | 3.8 | 3.6 |
| Present invention G-5 | FI-5 | 3.7 | 3.8 | 3.7 |
| Present invention G-6 | FI-37 | 3.5 | 3.8 | 3.7 |
| Present invention G-7 | FII-1 | 3.8 | 3.9 | 3.9 |
| Present invention G-8 | FII-3 | 3.7 | 3.8 | 3.5 |
| Present invention G-9 | FII-42 | 3.8 | 3.7 | 3.6 |
| Present invention G-10 | FII-85 | 3.9 | 3.8 | 3.6 |
| Present invention G-11 | FII-86 | 3.7 | 3.8 | 3.8 |
| Present invention G-12 | FIII ($R_4$=$CH_2CH_2OH$) | 3.6 | 3.6 | 3.4 |

As shown in Table 31, the samples of Examples G-4~G-12 of the present invention, which underwent the transparentization treatment, had better evaluation results relative to Example G-3 of the present invention. This indicates that the mode of the present invention, in which a fixing accelerator is added to the clarification solution, contributes to the speed of the transparentization treatment, and that the increased speed of the transparentization treatment provides advantageous results such as prevention of the deterioration of image qualities or improvement of image qualities. The comparison between Examples G-4~G-12 of the present invention and Referential Example of Table 29 indicates that the samples of Examples G-4~G-12 of the present invention provide image qualities substantially equivalent to those obtained by the standard development process.

Despite the shorter developing time, the color prints obtained in this test exhibited image qualities substantially equivalent to or better than those obtained in Example G-1 of the present invention.

Example H-1

(Color Paper to be Tested)

The surface of a support, comprising a sheet of paper with both sides were coated with a polyethylene resin, was subjected to a corona discharge treatment and thereafter coated with a gelatin subbing layer containing sodium dodecylbenzenesulfonate. Next, the first to seventh photographic constituent layers were successively applied onto the subbing layer. In this way, a silver halide color photosensitive material sample (001) having the following layer construction was prepared.

1-oxy3,5-dichloro-s-triazine sodium salt (HA-1) was used as a gelatin hardener for each layer.

Furthermore, Ab-1, Ab-2, Ab-3, and Ab-4 in amounts of 15.0 mg/m$^2$, 60.0 mg/m$^2$, 5.0 mg/m$^2$, and 10.0 mg/m$^2$, respectively, were added to each layer.

(Ab-1) antiseptic

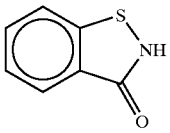

(Ab-2) antiseptic

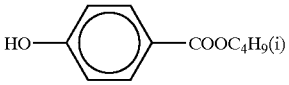

(Ab-3) antiseptic

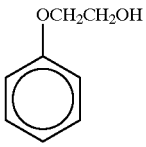

(Ab-4) antiseptic

-continued

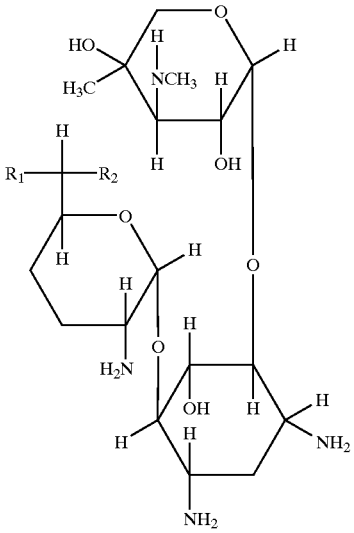

1:1:1:1 blend of a,b,c and d

| | $R_1$ | $R_2$ |
|---|---|---|
| a | —$CH_3$ | —$NHCH_3$ |
| b | —$CH_3$ | —$NH_2$ |
| c | —H | —$NH_2$ |
| d | —H | —$NHCH_3$ |

(HA-1)

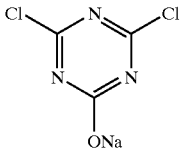

(HA-2)

$CH_2{=}CHSO_2CH_2SO_2CH{=}CH_2$

The following spectral sensitizing dyes were used in the silver chlorobromide emulsions of the photosensitive emulsion layers, respectively.

Blue-photosensitive Emulsion Layer (sensitizing dye A)

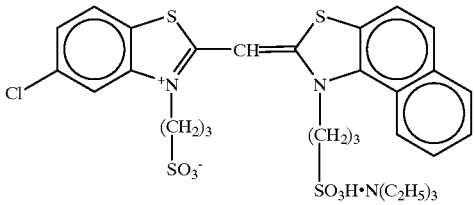

(sensitizing dye B)

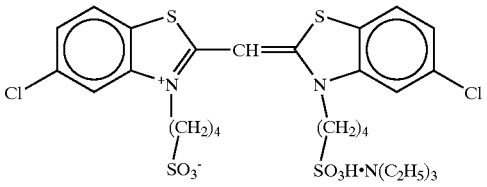

(sensitizing dye C)

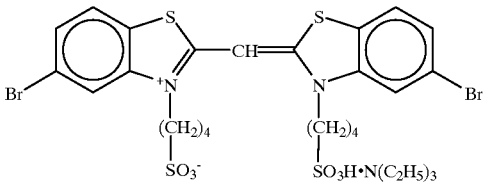

(The sensitizing dyes A, B, and C in amounts of $1.4\times10^{-4}$mole, respectively, per mole of silver halide were added to emulsions comprising large-size grains; and the sensitizing dyes A, B, and C in amounts of $1.7\times10^{-4}$ mole, respectively, per mole of silver halide were added to emulsions comprising small-size grains.)

Green-photosensitive Emulsion Layer (Sensitizing dye D)

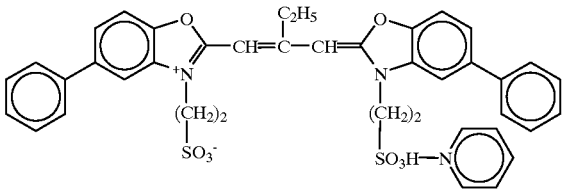

(Sensitizing dye E)

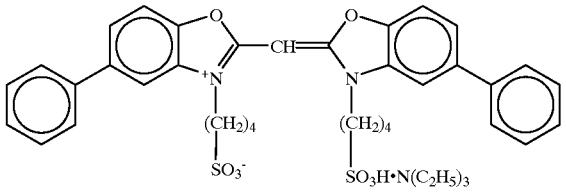

(The sensitizing dye D in an amount of $3.0\times10^{-3}$ mole per mole of silver halide was added to emulsions comprising large-size grains; and the sensitizing dye D in an amount of $3.6\times10^{-4}$mole per mole of silver halide was added to emulsions comprising small-size grains. The sensitizing dye E in an amount of $4.0\times10^{-6}$mole per mole of silver halide was added to emulsions comprising large-size grains; and the sensitizing dye E in an amount of $7.0\times10^{-5}$ mole per mole of silver halide was added to emulsions comprising small-size grains. The sensitizing dye F in an amount of $2.0\times10^{-2}$mole per mole of silver halide was added to emulsions comprising large-size grains; and the sensitizing dye F in an amount of $2.8\times10^{-4}$ mole per mole of silver halide was added to emulsions comprising small-size grains.)

Red-photosensitive Emulsion Layer (Sensitizing dye G)

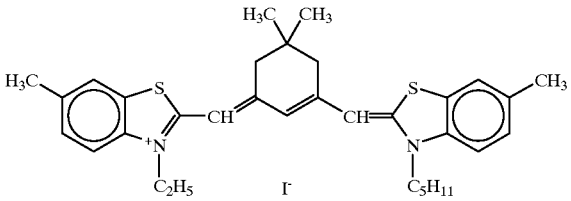

(Sensitizing dye H)

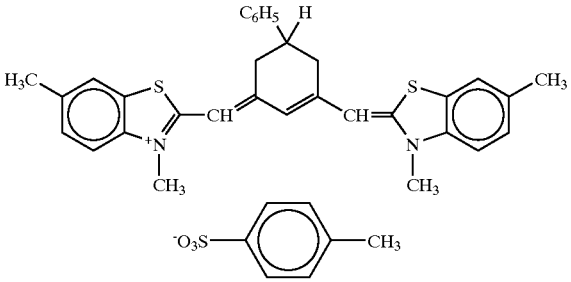

(The sensitizing dyes G and H in amounts of $6.0\times10^{-5}$ mole, respectively, per mole of silver halide were added to emulsions comprising large-size grains; and the sensitizing dyes G and H in amounts of $9.0\times10^{-5}$ mole, respectively, per mole of silver halide were added to emulsions comprising small-size grains.)

Further, the following compound I in an amount of $2.5\times10^{-3}$ mole per mole of silver halide was added to the red-photosensitive emulsion layer.

(Sensitizing dye F)

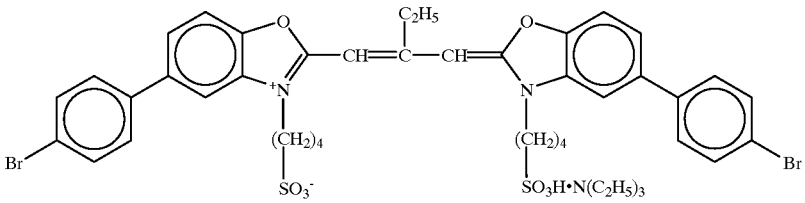

(Compound I)

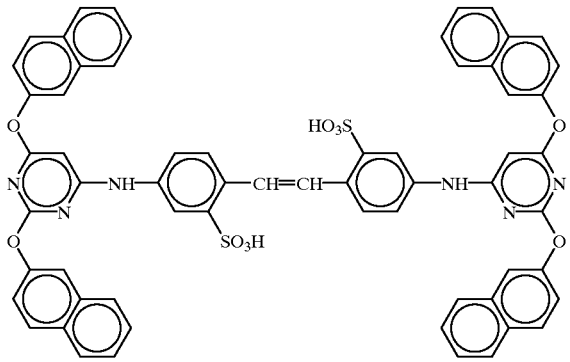

1-(3-methylureidophenyl)-5-mercaptotetrazole, in amounts of $3.3\times10^{-4}$ mole, $1.01\times10^{-3}$ mole, and $5.9\times10^{-4}$ mole, respectively, per mole of silver halide, was added to the blue-photosensitive emulsion layer, the green-photosensitive emulsion layer, and the red-photosensitive emulsion layer.

Furthermore, 1-(3-methylureidophenyl)-5-mercaptotetrazole, in amounts of 0.2mg/m$^2$, 0.2 mg/m$^2$, 0.6 mg/m$^2$, and 0.1 mg/m$^2$, respectively, was added to the second layer, the fourth layer, the sixth layer, and the seventh layer.

4-hydroxy-6-methyl-1,3,3a,7-tetrazaindene, in amounts of $1\times10^{-4}$ mole and $2\times10^{-2}$ mole, respectively, per mole of silver halide, was added to the blue-photosensitive emulsion layer and the green-photosensitive emulsion layer.

A methacrylic acid/butyl acrylate copolymer (a 1:1 by weight copolymer having an average molecular weight of 200,000 to 400,000) in an amount of 0.05 mg/m$^2$ was added to the red-photosensitive emulsion layer.

Catechol-3,5-disulfonic acid disodium salt, in amounts of 6 mg/m$^2$, 6 mg/m$^2$, 18 mg/m$^2$, and 18 mg/m$^2$, respectively, was added to the second layer, the fourth layer, and the sixth layer.

In order to prevent irradiation, the following dyes (the figure in brackets indicates coating weight) were added to the emulsion layers.

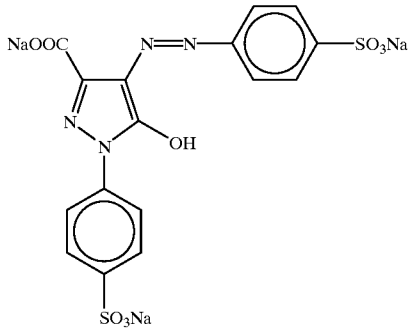

(2 mg/m$^2$)

-continued

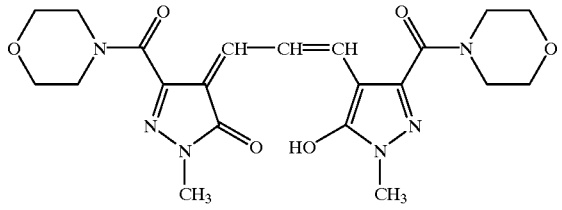

(5 mg/m$^2$)

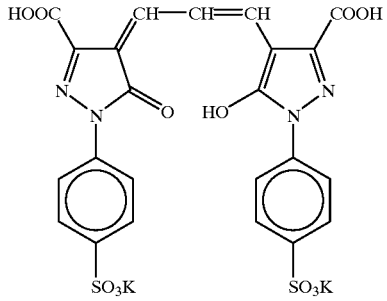

(1 mg/m$^2$)

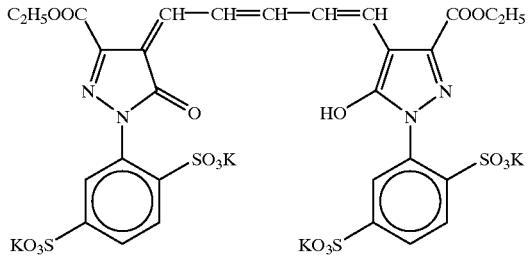

(10 mg/m$^2$)

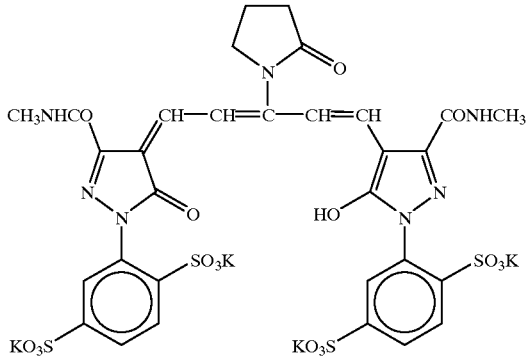

(10 mg/m$^2$)

(Layer Construction)

The construction of each layer is shown below. The figures indicate coating weights (g/m$^2$). The coating amount of the silver halide emulsion indicates the coating weight equivalent to the coating amount of silver.

Support

Paper Laminated With a Polyethylene Resin

[The polyethylene resin on the first layer side contains white pigments ($TiO_2$ content: 16 weight % and ZnO content: 4 weight %), fluorescent brighteners (content of a 8/2 blend of 4,4'-bis(benzoxazolyl)stilbene and 4,4'-bis(5-methylbenzoxazolyl)stilbene: 0.05 weight %), and a bluing dye (ultramarine blue).]

The first layer (blue-photosensitive emulsion layer)

| | |
|---|---|
| silver chlorobromide emulsion A (a 3:7 mixture (in silver molar ratio) of a large-size emulsion A composed of cubic grains having an average grain size of 0.72 μm and a small-size emulsion A composed of cubic grains having an average grain size of 0.60 μm. The variation coefficients of grain size distributions were 0.08 and 0.10, respectively. In both of the large-size and small-size emulsions, 0.3 mol % silver bromide was present locally on a part of the surface of grains based on silver chloride.) | 0.25 |
| gelatin | 1.35 |
| yellow coupler (ExY-1) | 0.41 |
| yellow coupler (ExY-2) | 0.21 |
| color image-stabilizing agent (Cpd-1) | 0.08 |
| color image-stabilizing agent (Cpd-2) | 0.04 |
| color image-stabilizing agent (Cpd-3) | 0.08 |
| color image-stabilizing agent (Cpd-8) | 0.04 |
| solvent (Solv-1) | 0.23 |

The second layer (layer for prevention of color mixing)

| | |
|---|---|
| gelatin | 1.00 |
| color mixing-preventing agent (Cpd-4) | 0.05 |
| color mixing-preventing agent (Cpd-5) | 0.07 |
| color image-stabilizing agent (Cpd-6) | 0.007 |
| color image-stabilizing agent (Cpd-7) | 0.14 |
| color image-stabilizing agent (Cpd-13) | 0.006 |
| color image-stabilizing agent (Cpd-21) | 0.01 |
| solvent (Solv-1) | 0.06 |
| solvent (Solv-2) | 0.22 |

The third layer (green-photosensitive emulsion layer)

| | |
|---|---|
| sliver chlorobromide emulsion B (a 1:3 (silver molar ratio) blend of a large-size emulsion B composed of cubic grains having an average grain size of 0.45 μm and a small-size emulsion B composed of cubic grains having an average grain size of 0.35 μm. The variation coefficients of grain size distributions were 0.10 and 0.08, respectivly. In both of the large-size and small-size emulsions, 0.4 mol% silver bromide was present locally on a part of the surface of grains based on silver chloride.) | 0.12 |
| gelatin | 1.20 |
| magenta coupler (ExM-1) | 0.13 |
| ultraviolet absorber (UV-1) | 0.05 |
| ultraviolet absorber (UV-2) | 0.02 |
| ultraviolet absorber (UV-3) | 0.02 |
| ultraviolet absorber (UV-4) | 0.03 |
| color image-stabilizing agent (Cpd-2) | 0.01 |
| color image-stabilizing agent (Cpd-4) | 0.002 |
| color image-stabilizing agent (Cpd-7) | 0.08 |
| color image-stabilizing agent (Cpd-8) | 0.01 |
| color image-stabilizing agent (Opd-9) | 0.03 |
| color image-stabilizing agent (Cpd-10) | 0.01 |
| color image-stabilizing agent (Cpd-11) | 0.0001 |
| color image-stabilizing agent (Cpd-3) | 0.004 |
| solvent (Solv-3) | 0.10 |
| solvent (Solv-4) | 0.19 |

The fourth layer (layer for prevention of color mixing)

| | |
|---|---|
| gelatin | 0.71 |
| color mixing-preventing agent (Cpd-4) | 0.04 |
| color mixing-preventing agent (Cpd-5) | 0.05 |
| color image-stabilizing agent (Cpd-6) | 0.005 |

-continued

| | |
|---|---|
| color image-stabilizing agent (Cpd-7) | 0.10 |
| color image-stabilizing agent (Cpd-13) | 0.004 |
| color image-stabilizing agent (Cpd-21) | 0.01 |
| solvent (Solv-1) | 0.04 |
| solvent (Solv-2) | 0.16 |

The fifth layer (red-photosensitive emulsion layer)

| | |
|---|---|
| silver chlorobromide emulsion C (a 1:4 (silver molar ratio) blend of a large-size emulsion C composed of cubic grains having an average grain size of 0.50 μm and a small-size emulsion C composed of cubic grains having an average grain size of 0.41 μm. the variation coefficients of grain size distributions were 0.09 and 0.11, respectivly. In both of the large-size and small-size emulsions, 0.8 mol% silver bromide was present locally on a part of the surface of grains based on silver cholride) | 0.16 |
| gelatin | 1.00 |
| cyan coupler (ExC-1) | 0.05 |
| cyan coupler (ExC-2) | 0.18 |
| cyan coupler (ExC-3) | 0.024 |
| ultraviolet absorber (UV-1) | 0.04 |
| ultraviolet absorber (UV-3) | 0.01 |
| ultraviolet absorber (UV-4) | 0.01 |
| color image-stabilizing agent (Cpd-1) | 0.23 |
| color image-stabilizing agent (Cpd-9) | 0.01 |
| color image-stabilizing agent (Cpd-12) | 0.01 |
| color image-stabilizing agent (Cpd-13) | 0.01 |
| solvent (Solv-6) | 0.23 |

The sixth layer (layer for absorption of ultraviolet light)

| | |
|---|---|
| gelatin | 0.46 |
| ultraviolet absorber (UV-1) | 0.14 |
| ultraviolet absorber (UV-2) | 0.05 |
| ultraviolet absorber (UV-3) | 0.05 |
| ultraviolet absorber (UV-4) | 0.04 |
| ultraviolet absorber (UV-5) | 0.03 |
| ultraviolet absorber (UV-6) | 0.04 |
| solvent (Solv-7) | 0.18 |

The seventh layer (protective layer)

| | |
|---|---|
| gelatin | 1.00 |

(ExY-1) yellow coupler
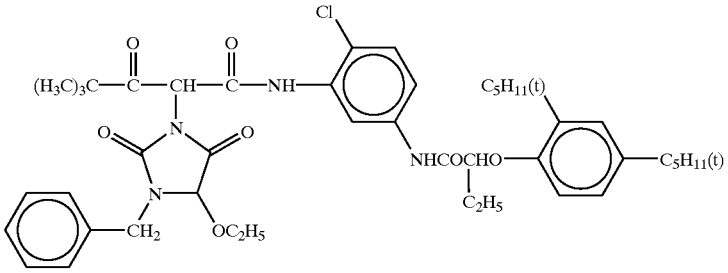
(ExY-2) yellow coupler
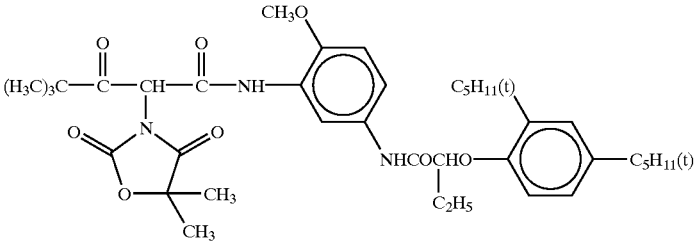
(ExM-1) magenta coupler
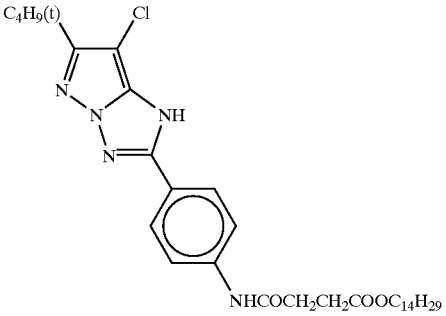
(ExC-1) cyan coupler
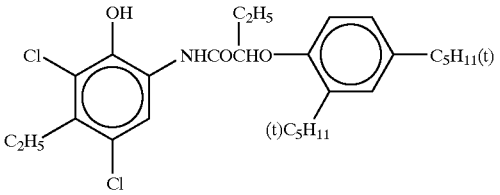
(ExC-2) cyan coupler
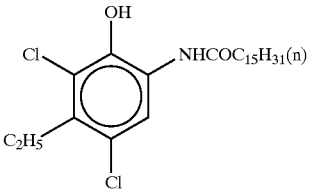
(ExC-3) cyan coupler
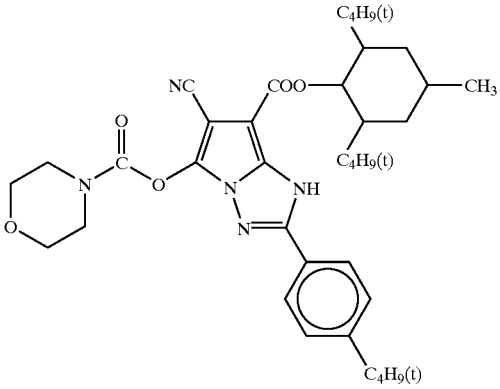
(Cpd-1) color image-stabilizing agent
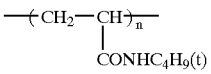
number average molecular weight: 60,000
(Cpd-2) color image-stabilizing agent
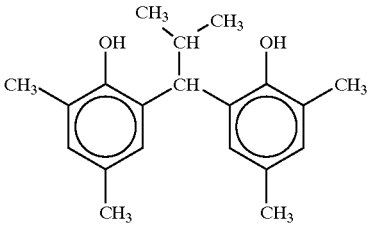

-continued
(Cpd-3) color image-stabilizing agent
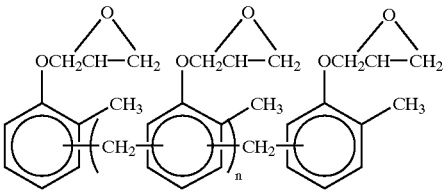
n = 7~8 (average)
(Cpd-4) color mixing-preventing agent
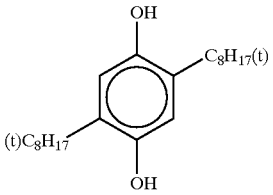
(Cpd-5) color mixing-preventing agent
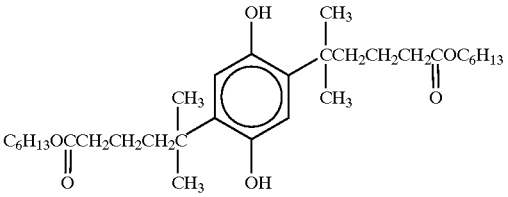
(Cpd-6) color mixing-preventing agent
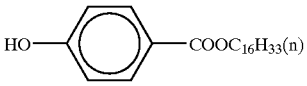
(Cpd-7) stabilizing agent
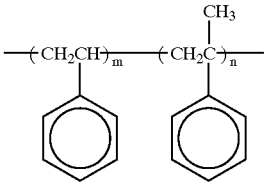
number average molecular weight: 600, m/n = 10/90
(Cpd-8) color mixing-preventing agent
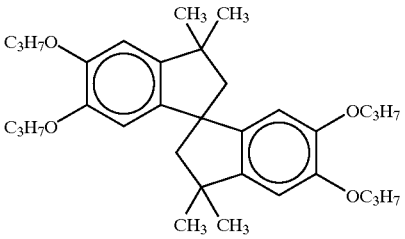
(Cpd-9) color mixing-preventing agent
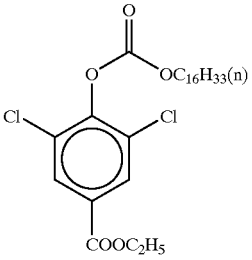
(Cpd-10) color mixing-preventing agent
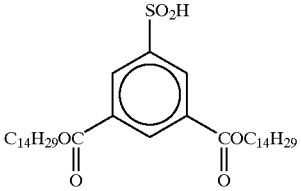
(Cpd-11)
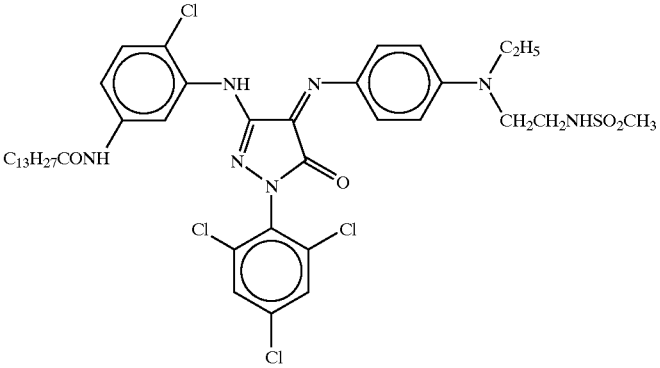

-continued
(Cpd-12) color image-stabilizing agent
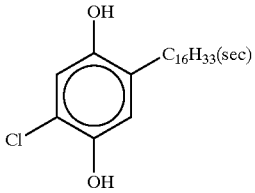
(Cpd-13) color image-stabilizing agent
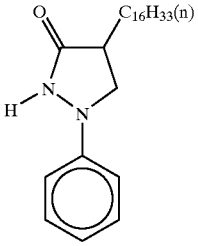
(Cpd-14) surfactant
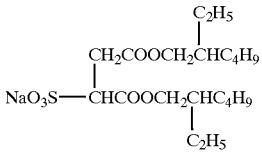
(Cpd)-15) surfactant
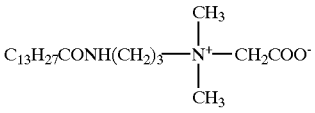
(Cpd-16)
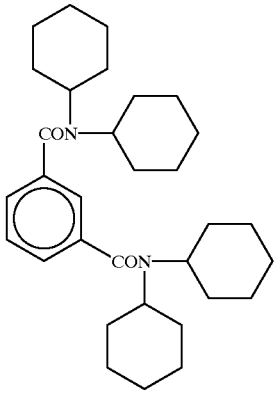
(Cpd-17) 1:1 blend of
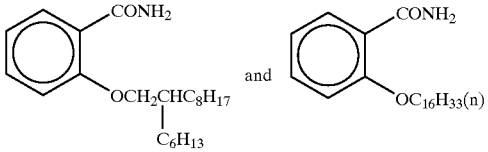
(Cpd-18)
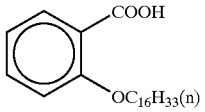
(Cpd-19)
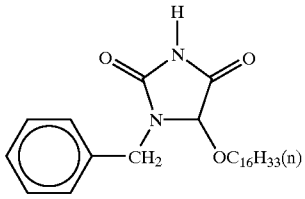
(Cpd-20)
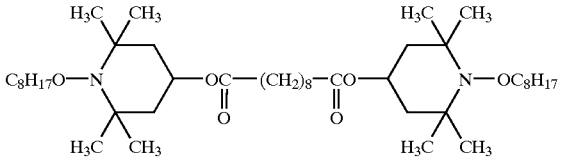
(Cpd-21) color image-stabilizing agent
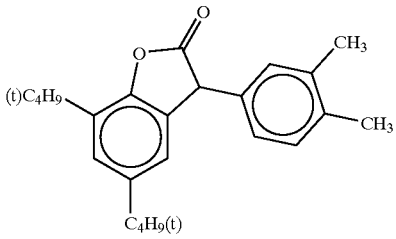
(UV-1) ultraviolet absorber
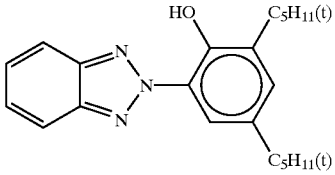

-continued
(UV-2) ultraviolet absorber
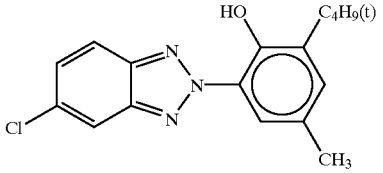
(UV-3) ultraviolet absorber
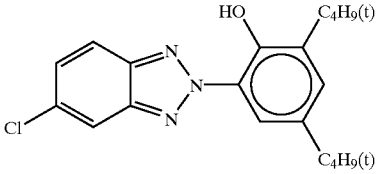
(UV-4) ultraviolet absorber
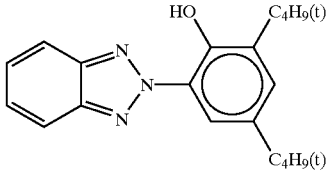
(UV-5) ultraviolet absorber
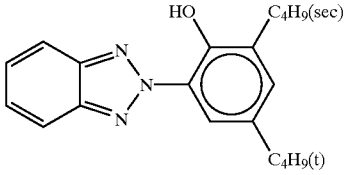
(UV-6) ultraviolet absorber
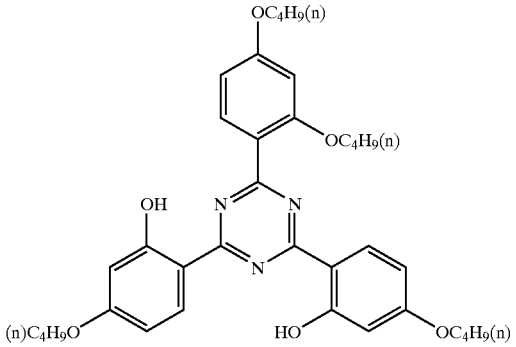
(Solv-1)
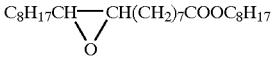
(Solv-2) 1:1 (by weight) blend of
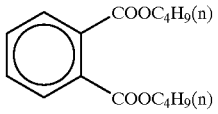
and
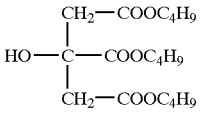
(Solv-3)
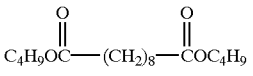
(Solv-4)
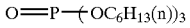
(Solv-5)
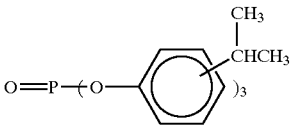
(Solv-6) 1:1 (by weight) blend of
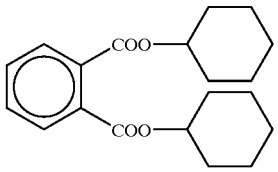
and
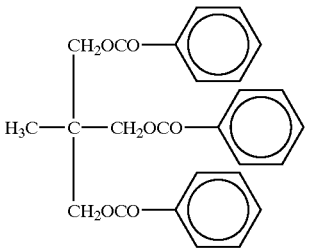
(Solv-7)
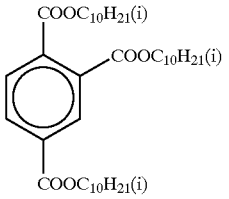

(Color Developing Solution)

The developing solution is a viscous developing solution according to the following prescription.

| | |
|---|---|
| Water | 800 mL |
| ethylenediaminetetraacetic acid | 4.0 g |
| sodium 4, 5-dihydroxybenzene-1, 3-disulfonate | 0.5 g |
| triisopropanolamine | 10.0 g |
| potassium chloride | 10.0 g |
| potassium bromide | 0.04 g |
| sodium p-toluenesulfonate | 20.0 g |
| potassium carbonate | 27.0 g |
| triazinylaminostilbene-based fluorescent brightner (HACKOL FWA-SF manufactured by Showa Kagaku Co., Ltd.) | 3.5 g |
| sodium sulfite | 0.1 g |
| triisopropylnaphthalene (β) sulfonic acid | 0.1 g |
| N-ethyl-N-(β-methanesulfonamidoethyl)-3-methyl-4-aminoaniline 3/2 sulfate monohydrate | 10.0 g |
| Hydroxymethylcellulose | 6.0 g |
| water for preparation | 1000 mL |

The above-described amount of hydroxymethylcellulose was added after being mixed sufficiently with 15 mL of a 10% NaOH aqueous solution.

(Bleach-fixing Sheet)

A bleach-fixing sheet having the following construction was prepared.

| layer contruction | materials added | amounts added(mg/m$^2$) |
|---|---|---|
| The fourth layer protective layer | acid-treated gelatin | 510 |
| | hardener (ag) | 255 |
| | surfactant (r) | 6 |
| | surfactant (aa) | 7 |
| | surfactant (ab) | 60 |
| | matting agent (z) | 30 |
| The third layer acidic layer | lime-treated gelatin | 4880 |
| | acid polymer A-16 | 5965 |
| | silver halide solvent C-4 | 6240 |
| | surfactant (af) | |
| The second layer bleaching layer | lime-treated gelatin | 4880 |
| | water-soluble polymer (ad) | 1210 |
| | silver halide solvent C-b | 6240 |
| | bleaching agent CHELEST PDFN | 3200 |
| | surfactant (y) | |
| The first layer subbing layer | acid-treated gelatin | 510 |
| | water-soluble polymer (v) | 27 |
| | surfactant (r) | 17 |
| | hardener (ag) | 280 |

Transparent Support (63 μm)

(A-16)

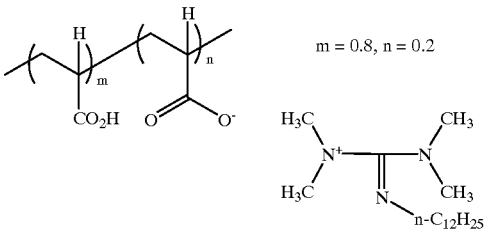

-continued (A-17)

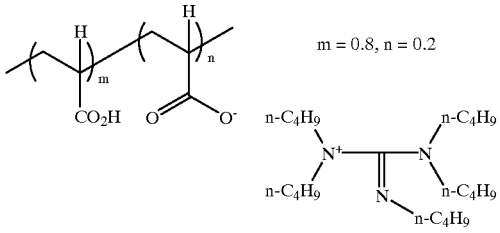

(A-18)

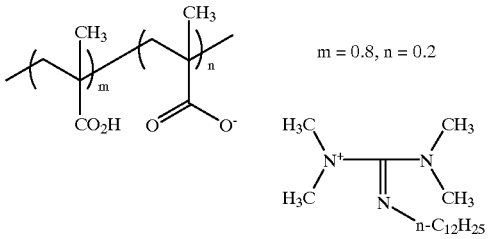

(A-19)

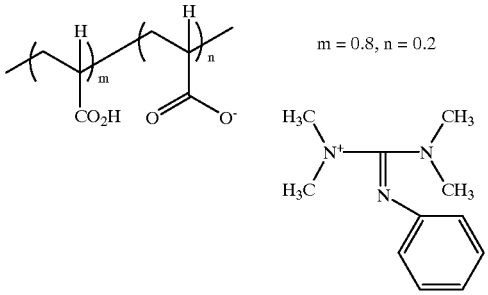

(A-20)

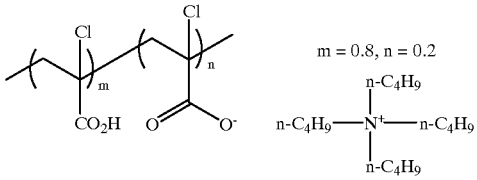

Compound (C-1)

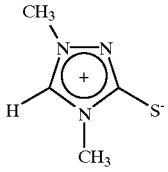

Compound (C-2)

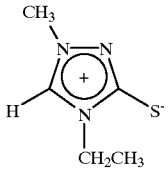

-continued
Compound (C-3)
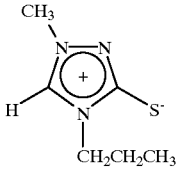
Compound (C-4)
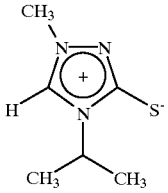
Compound (C-5)
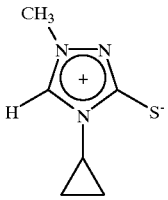
Compound (C-6)
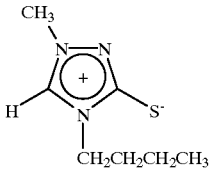
Compound (C-7)
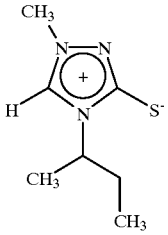
Compound (C-8)
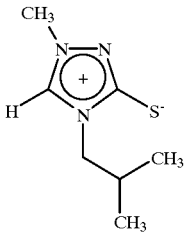
Compound (C-9)
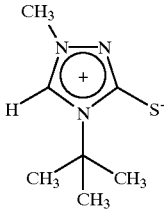
-continued
Compound (C-10)
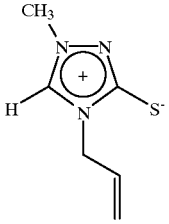
Compound (C-11)
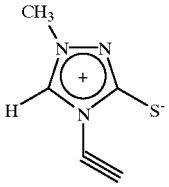
Compound (C-12)
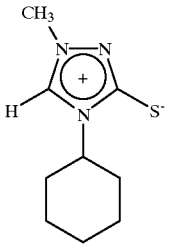
Surfactant (q)
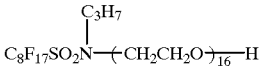
Surfactant (r)
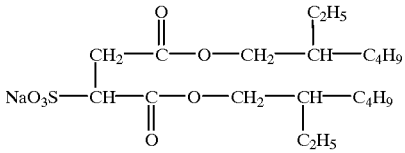
Water-soluble polymer (s)
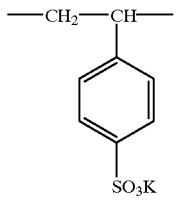
Hardener (t)
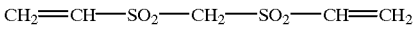
Formalin scavenger (u)
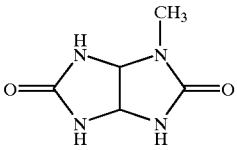
Water-soluble polymer (v)
κ-carrageenan -continued Water-soluble polymer (w)

SUMIKAGEL L-5H (manufactured by Sumitomo Chemical Co., Ltd.)

Additive (x)

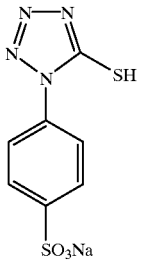

Surfactant (y)

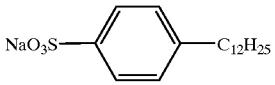

Matting agent (z)

SYLOID 79

(manufactured by Fuji Davidson Co., Ltd.)

Surfactant (aa)

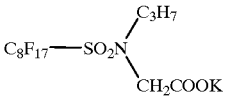

Surfactant (ab)

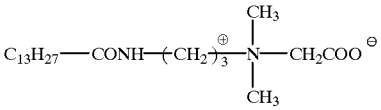

Hardener (ac)

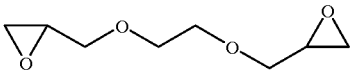

Water-soluble polymer (ad)

Dextran (having a molecular weight of 70,000)

Water-soluble polymer (ae)

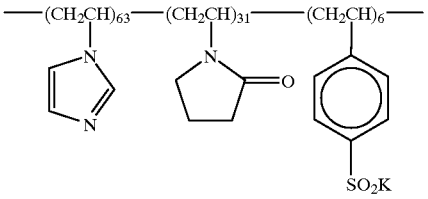

Polymer based on maleic acid

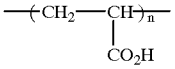

n (degree of polymerization)

: about 1000

Polymer based on maleic acid

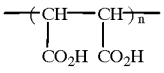

n (degree of polymerization)

: about 500

-continued

CHELEST FNO

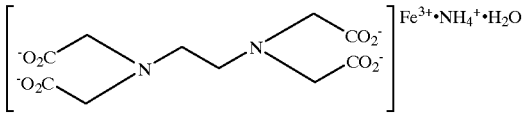

CHELEST PDFN

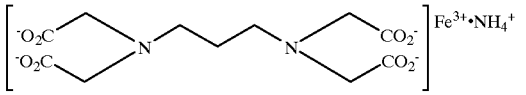

Surfactant (af)

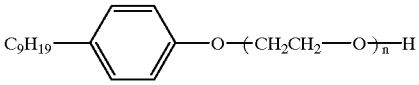

n ≈ 8.5

Hardener (ag)

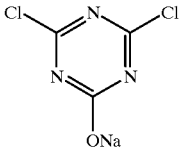

(Development Process)

As a development process apparatus relating to the present invention, use was made of the developing apparatus shown in FIG. 41, comprising a combination of development by coating (in which the temperature of the developing solution was 25° C.), non-contact heating by means of a far infrared heater 416 (a far infrared-emitting, hollow-type ceramic heater whose radiation wavelengths ranged from 3000 to 25000 nm, manufactured by AMK, Inc.), and bleach-fixing by means of a bleach-fixing sheet 420. By using this apparatus, images were formed on color paper P. Since the transfer speed is 5 mm/s, the heating time, during which the color paper P faces the far infrared heater, is 30 seconds. The surface temperature of the far infrared heater is controlled to 200° C. and the surface temperature of the color paper P is controlled to become 70° C. The surface temperature of the heat drum 418 in the bleach-fixing zone is 70° C. and the heating time is 30 seconds. The surface temperature of the heat drum 418 is preferably 60 to 80° C.

The color paper P is fed in the direction indicated by the arrow A and undergoes digital exposure by an exposing mechanism 412 and thereafter is coated with a developing solution in a developing zone 414. Next, the color paper P is heated by the far infrared heater 414 and the development is accelerated. Thereafter, the color paper P is wound around the heat drum 418 and brought into contact with a bleach-fixing sheet 420 so that bleach-fixing is performed. After that, the color paper P is discharged.

Comparative Example H-1

The procedure of Comparative Example H-1 was the same as in Example H-1, except that a halogen heater (radiation wavelength: 1000 nm, QIR (100V 500W/B) manufactured by Ushio Electric Co., Ltd.) was used as the heating means in the developing apparatus in Example H-1.

Comparative Example H-2

The procedure of Comparative Example H-2 was the same as in Example H-1, except that a microwave heating device (oscillation frequency: 2450 MHz) was used as the heating means in the developing apparatus in Example H-1.

Comparative Example H-3

The procedure of Comparative Example H-3 was the same as in Example H-1, except that a heat roller (surface temperature: 80° C.) was used as the heating means in the developing apparatus in Example H-1.

Comparative Example H-4

The procedure of Comparative Example H-4 was the same as in Example H-1, except that non-contact heating was carried out by using a hot-air circulating device (surface temperature: 80° C., air-blow rate: 10 m/s) as the heating means in the developing apparatus in Example H-1.

Example H-2

The procedure of Example H-2 was the same as in Example H-1, except that the far infrared heater was controlled so that the surface temperature of the color paper became 50° C. in Example H-1.

Example H-3

The procedure of Example H-3 was the same as in Example H-1, except that the far infrared heater was controlled so that the surface temperature of the color paper became 90° C. in Example H-1.

Example H-5

The procedure of Example H-5 was the same as in Example H-1, except that the far infrared heater was controlled so that the surface temperature of the color paper became 45° C. in Example H-1.

Example H-6

The procedure of Example H-6 was the same as in Example H-1, except that the far infrared heater was controlled so that the surface temperature of the color paper became 95° C. in Example H-1.

(Assessment)

Examples and Comparative Examples were assessed with regard to aptitude for development and aptitude with apparatus. The results are shown in Table 32. In Table 32, ○ indicates very good aptitude; Δ indicates problematic aptitude; and X indicates impracticality for use.

TABLE 32

| | | Color paper | | | | | |
|---|---|---|---|---|---|---|---|
| | Heating means | Surface temperature of paper | Heating efficiency | Stain/fogging/ density unevenness | Aptitude with apparatus | Deformation of paper | Overall rating |
| Example H-1 | Far infrared heater | 70° C. | ○ | ○ | ○ | ○ | ○ |
| Comparative Example H-1 | Near infrared heater | 70° C. | Δ | X | ○ | ○ | X |
| Comparative Example H-2 | Microwave | 70° C. | ○ | Δ | Δ | ○ | Δ |
| Comparative Example H-3 | Heat roller | 70° C. | ○ | X | Δ | ○ | Δ |
| Comparative Example H-4 | Circulation of hot air | 70° C. | Δ | ○ | X | ○ | X |
| Example H-2 | Far infrared heater | 50° C. | ○ | ○ | ○ | ○ | ○ |
| Example H-3 | Far infrared heater | 90° C. | ○ | ○ | ○ | ○ | ○ |
| Comparative Example H-5 | Far infrared heater | 45° C. | ○ | Poor color development | ○ | ○ | X |
| Comparative Example H-6 | Far infrared heater | 95° C. | ○ | ○ | ○ | X | X |

As in Example H-1, when the color paper was heated so that the surface temperature became 80° C. by using a far infrared heater as a heating means, heating efficiency was good; stain or fogging was not found; the apparatus was not complicated or large-sized; control of the apparatus was easy; cost of the apparatus did not increase; and the color paper was not deformed.

By contrast, when a near infrared heater was used as a heating means as in Comparative Example H-1, the heating efficiency was not good and the development process required a long time because the near infrared radiation waves did not resonate with the vibration of the molecules of water and therefore was not absorbed. In addition, fogging due to near infrared radiation waves near to visible light was found.

As in Comparative Example H-2, when a microwave heating device was used as a heating means, uneven development due to large nonuniformity of radiation was found and the size of the apparatus for development process was large, although the heating time was short.

As in Example H-3, when the color paper was heated by contact heating using a heat roller as a heating means, stain was transferred from the heat roller to the color paper, although heating efficiency was good. In addition, the size of the apparatus was large, because a means for driving the heat roller was necessary.

As in Comparative Example H-4, when a hot-air circulating device was used as a heating means, heating efficiency was not good and development process required a longer time. In addition, the size of the apparatus for development process was large.

As in Example H-2, when the color paper was heated so that the surface temperature became 50° C. by using a far infrared heater, heating efficiency was good; stain or fogging was not found; the apparatus was not complicated or large-sized; control of the apparatus was easy; cost of the apparatus did not increase; and the color paper was not deformed.

As in Example H-3, when the color paper was heated so that the surface temperature became 90° C. by using a far infrared heater, heating efficiency was good; stain or fogging was not found; the apparatus was not complicated or large-sized; control of the apparatus was easy; cost of the apparatus did not increase; and the color paper was not deformed.

By contrast, when the color paper was heated so that the surface temperature became 45° C. by means of a far infrared heater as in Comparative Example H-5, heat development did not proceed satisfactorily and poor color development occurred.

As in Comparative Example H-6, when the color paper was heated so that the surface temperature became 95° C. by using a far infrared heater, wavy deformation of the color paper occurred.

As apparent from the results described above, good heat development is carried out by heating the color paper so that the surface temperature falls within a range of 50° C. to 90° C. using a far infrared heater as a heating means or method.

Example H-4

1. Preparation of a Color Negative Film

A color negative film sample H101 was prepared in the same way as in the preparation of the color negative film sample E101 in Example E-1.

Sample H101 thus prepared was processed into a shape of 135-24Ex (i.e., a film loaded in a patrone for 24 exposures) in compliance with ISO 1007 and used in the following tests.

2. Development Process

As an apparatus for development process and image readout relating to the present invention, use was made of the developing apparatus shown in FIG. 40, comprising a combination of a developing device by roller coating and a non-contact heating device by means of a far infrared heater (a far infrared-emitting, hollow-type ceramic heater whose radiation wavelengths ranged from 3000 to 25000 nm, manufactured by AMK, Inc.). Since the transfer speed is 5 mm/s, the heating time, during which the color film faces the far infrared heater, is 30 seconds. The surface temperature of the far infrared heater was controlled to 200° C. and the surface temperature of the film was controlled to become 80° C. In order to prevent the film surface from being dried, steam was applied to the surface by means of a humidifier (KA-510D, manufactured by Toshiba Corporation, steam flow rate: 0.1 g/sec).

The developing solution for Example H-4 described above is a viscous developing solution having the following composition.

| (color developing solution) | amount (in gram) |
|---|---|
| diethylenetriamine-pentaacetic acid | 4.0 |
| sodium 4,5-dihydroxybenzene-1,3-disulfonate | 0.5 |
| hydroxylamine | 15.0 |
| sodium sulfite | 9.0 |
| diethylene glycol | 17.0 |
| potassium carbonate | 59.0 |
| ethyleneurea | 5.5 |
| potassium bromide | 1.4 |
| 2-methyl-4-[N-ethyl-N-(β-hydroxyethyl)amino]aniline sulfuric acid salt | 15.0 |
| hydroxymethylcellulose | 6.0 |
| water for preparation | 1.0 L |
| pH (controlled by potassium hydroxide and sulfuric acid) | 10.50 |

The above-described amount of hydroxymethylcellulose was added after being sufficiently mixed with 15 mL of a 10% NaOH aqueous solution.

Comparative Example H-7

The procedure of Comparative Example H-7 was the same as in Example H-4, except that a halogen heater (radiation wavelength: 1000 nm, QIR (100V 500 W/B) manufactured by Ushio Electric Co., Ltd.) was used as the heating means in the developing apparatus in Example H-4.

Comparative Example H-8

The procedure of Comparative Example H-8 was the same as in Example H-4, except that a microwave heating device (oscillation frequency: 2450 MHz) was used as the heating means in the developing apparatus in Example H-4.

Comparative Example H-9

The procedure of Comparative Example H-9 was the same as in Example H-4, except that a heat roller (surface temperature: 80° C.) was used as the heating means in the developing apparatus in Example H-4.

Comparative Example H-10

The procedure of Comparative Example H-10 was the same as in Example H-4, except that non-contact heating was carried out by using a hot-air circulating device (surface temperature: 80° C., air-blow rate: 10 m/s) as the heating means in the developing apparatus in Example H-4.

(Reading Out of Images and Image Processing)

The first and second image information read out in the first and second image information-reading zones 312A, 312B, and 314 illustrated in FIG. 40 was formed into positive images in the digital image-processing zone 270 illustrated in FIG. 25, and the positive images were output to a printer.

In Example H-4 and Comparative Examples H-7~H-10, as an example of commercially available inputting machines capable of converting images for input, which were prepared by the procedure described above, into electric image signals and forming positive images by inputting the signals, a high-speed scanner/image processing workstation, SP-1000 (manufactured by Fuji Photo Film Co., Ltd.), was used. As an example of commercially available outputting machines, a laser printer/paper processor, LP-1000P (manufactured by Fuji Photo Film Co., Ltd.), was used. As for SP-1000, the program software was altered so that the above-described image processing could be carried out.

For printing the films after being developed of Samples of Example H-4 and Comparative Examples H-7~H-10, FUJI COLOR PAPER SUPER FA Type D, which is commercially available as color paper, was used. For development process, a color paper processing prescription, CP-48S, and processing solutions therefor (all manufactured by Fuji Photo Film Co., Ltd.) were used.

Example H-5

The procedure of Example H-5 was the same as in Example H-4, except that the far infrared heater was controlled so that the surface temperature of the color film became 50° C. in Example H-4.

Example H-6

The procedure of Example H-6 was the same as in Example H-4, except that the far infrared heater was controlled so that the surface temperature of the color film became 90° C. in Example H-4.

Example H-11

The procedure of Example H-11 was the same as in Example H-4, except that the far infrared heater was controlled so that the surface temperature of the color film became 45° C. in Example H-4.

Example H-12

The procedure of Example H-12 was the same as in Example H-4, except that the far infrared heater was controlled so that the surface temperature of the color film became 95° C. in Example H-4.

(Assessment)

Examples and Comparative Examples were assessed with regard to aptitude for development and aptitude with apparatus. The results are shown in Table 33. In Table 33, ○ indicates very good aptitude; Δ indicates problematic aptitude; and X indicates impracticality for use.

TABLE 33

| | Color negative film | | | | |
|---|---|---|---|---|---|
| | Heating means | Surface temperature of film | Heating efficiency | Stain/fogging/ density unevenness | Aptitude with apparatus |
| Example H-4 | Far infrared heater | 80° C. | ○ | ○ | ○ |
| Comparative Example H-7 | Near infrared heater | 80° C. | Δ | X | ○ |
| Comparative Example H-8 | Micrcrowave | 80° C. | ○ | Δ | Δ |
| Comparative Example H-9 | Heat roller | 80° C. | ○ | X | Δ |
| Comparative Example H-10 | Circulation of hot air | 80° C. | Δ | ○ | X |
| Example H-5 | Far infrared heater | 50° C. | ○ | ○ | ○ |
| Example H-6 | Far infrared heater | 90° C. | ○ | ○ | ○ |
| Comparative Example H-11 | Far infrared heater | 45° C. | ○ | Poor color development | ○ |
| Comparative Example H-12 | Far infrared heater | 95° C. | ○ | ○ | ○ |

As in Example H-4, when the color film was heated so that the surface temperature became 80° C. by using a far infrared heater as a heating means, heating efficiency was good; stain or fogging was not found; the apparatus was not complicated or large-sized; control of the apparatus was easy; cost of the apparatus did not increase; and the color film was not deformed.

By contrast, when a near infrared heater was used as a heating means as in Comparative Example H-7, the heating efficiency was not good and the development process required a long time because the near infrared radiation waves did not resonate with the vibration of the molecules of water and therefore were not absorbed. In addition, fogging due to near infrared radiation waves near to visible light was found.

As in Comparative Example H-8, when a microwave heating device was used as a heating means, uneven development due to large nonuniformity of radiation was found and the size of the apparatus for development process was large, although the heating time was short.

As in Example H-9, when the color film was heated by contact heating using a heat roller as a heating means, stain was transferred from the heat roller to the color film, although heating efficiency was good. In addition, the size of the apparatus was large, because a means for driving the heat roller was necessary.

As in Comparative Example H-10, when a hot-air circulating device was used as a heating means, heating efficiency was not good and development process required a long time. In addition, the size of the apparatus for development process was large.

As in Example H-5, when the color film was heated so that the surface temperature became 50° C. by using a far infrared heater as a heating means, heating efficiency was good; stain or fogging was not found; the apparatus was not complicated or large-sized; control of the apparatus was easy; cost of the apparatus did not increase; and the color film was not deformed.

As in Example H-6, when the color film was heated so that the surface temperature became 90° C. by using a far infrared heater as a heating means, heating efficiency was good; stain or fogging was not found; the apparatus was not complicated or large-sized; control of the apparatus was easy; cost of the apparatus did not increase; and the color film was not deformed.

By contrast, when the color film was heated so that the surface temperature became 45° C. by means of a far infrared heater as in Comparative Example H-10, heat development did not proceed satisfactorily and poor color development occurred.

As in Comparative Example H-11, when the color film was heated so that the surface temperature became 95° C., wavy deformation of the color film occurred.

As can be seen from the results described above, good heat development is carried out by heating the color film so that the surface temperature falls within a range of 50° C. to 90° C. using a far infrared heater as a heating means.

What is claimed is:

1. A method of reading an image, which comprises the steps of:

exposing a color photosensitive material having at least three photosensitive layers containing blue-, green- and red-photosensitive silver halide emulsions, respectively, on a transparent support;

processing the exposed color photosensitive material at a processing temperature of 50° C. or more to form a silver image; and reading the silver image.

2. The method of reading an image according to claim 1, wherein 60% or more of the density of the image is based on the developed silver.

3. The method of reading an image according to claim 1, wherein said color photosensitive material includes a developing agent.

4. A method of reading an image according to claim 1, wherein said processing comprises multiple bath immersions.

5. A method of reading an image, which comprises the steps of:

exposing a color photosensitive material having at least three photosensitive layers containing blue-, green- and red-photosensitive silver halide emulsions, respectively, on a transparent support;

processing the exposed color photosensitive material at a processing termperature of 50° C. or more to form a silver image; and reading the silver image, wherein said color photosensitive material includes a developing agent, wherein the exposed color photosensitive material incorporated a developing agent therein and a processing material containing a processing layer containing at least one of a base and a base precursor on a support are attached and developed by heating in the presence of water therebetween in an amount of 1/10- to 1-fold relative to the amount of water required for the maximum swelling of the whole coated layers including the photosensitive material and the processing material.

6. A method of reading an image, which comprises the steps of:

exposing a color photosensitive material having at least three photosensitive layers containing blue-, green- and red-photosensitive silver halide emulsions, respectively, on a transparent support, processing the exposed color photosensitive material at a processing temperature of 50° C. or more to form a silver image; and reading the silver image, wherein the silver image is formed by use of a developing agent represented by the general formula (1), (2), (3) or (4):

General formula (1)

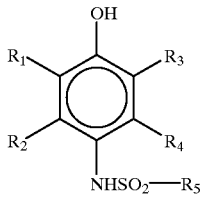

General formula (2)

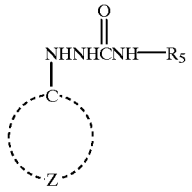

General formula (3)

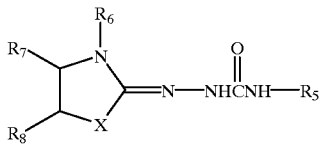

-continued

General formula (4)

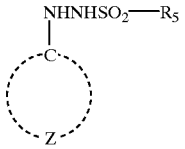

wherein $R_1$ to $R_4$ represent a hydrogen atom, halogen atom, alkyl group, aryl group, alkyl carbon amide group, aryl carbon amide group, alkyl sulfone amide group, aryl sulfone amide group, alkoxy group, aryloxy group, alkylthio group, arylthio group, alkyl carbamoyl group, aryl carbamoyl group, carbamoyl group, alkyl sulfamoyl group, aryl sulfamoyl group, sulfamoyl group, cyano group, alkyl sulfonyl group, aryl sulfonyl group, alkoxy carbonyl group, aryloxy carbonyl group, alkyl carbonyl group, aryl carbonyl group or acyloxy group, $R_5$ represents an alkyl group, aryl group or heterocyclic group, Z represents an atomic group forming a (hetero) aromatic ring, and when Z is a benzene ring, the total of Hammett's constants (σ) of its substituent groups is 1 or more, $R_6$ represents an alkyl group, X represents an oxygen atom, sulfur atom, selenium atom, or an alkyl- or aryl-substituted tertiary nitrogen atom, $R_7$ and $R_8$ represent a hydrogen atom or substituent group, whereupon $R_7$ and $R_8$ may be bound to each other to form a double bond or a ring, provided that in each of the general formula (1) to (4), at least one ballast group containing 8 or more carbon atoms to confer oil solubility on the molecule.

7. A method of forming a color image, which comprises the step of forming a color image on the basis of the silver image information read by a method of reading an image comprising the steps of:

exposing a color photosensitive material having at least three photosensitive layers containing blue-, green- and red-photosensitive silver halide emulsions, respectively, on a transparent support;

processing the exposed color photosensitive material at a processing temperature of 50° C. or more to form a silver image; and reading the silver image.

8. A method of forming a color image, which comprises the steps of:

subjecting an exposed silver halide color photosensitive material to development processing;

reading image information photoelectrically from the obtained image; and converting the read image information into electrical digital image information, wherein, (1) the silver halide color photosensitive material contains a decolorizable anti-halation dye, (2) the reading of image information comprises photoelectric reading of first image information by using light reflected from and photoelectric reading of second image information by light transmitted through the processed silver halide photosensitive material, and (3) the read first and second image information is converted into electrical blue, green and red digital image information.

9. The method of forming a color image according to claim 8, wherein said electrical blue, green and red digital image information obtained by conversion of the first and second image information is subjected to image processing and the image-processed digital image information is outputted to a printer.

10. A method of forming a color image, which comprises the steps of:

subjecting an exposed silver halide color photosensitive material to development processing;

reading image information photoelectrically from the obtained image; and convertin the read image information into electrical digital image information, wherein, (1) the silver halide color photosensitive material contains a decolorizable anti-halation dye, (2) the reading of image information comprises photoelectric reading of first image information by using light reflected from and photoelectric reading of second image information by light transmitted through the processed silver halide photosensitive material and (3) the read first and second image information is converted into electrical blue, green and red digital image information, wherein the decolorizable anti-halation dye is an anti-halation dye represented by the general formula (I):

$$D—(X)_y \quad (I)$$

wherein D represents a compound having a chromophere, and X represents a dissociable proton bound to D directly or via a divalent linking group, or a group having said dissociable proton, and y is an integer of 1 to 7.

11. A method of forming a color image, which comprises the steps of:

subjecting an exposed silver halide color photosensitive material to development processing;

reading image information photoelectrically from the obtained image; and converting the read image information into electrical digital image information, wherein, (1) the silver halide color photosensitive material has at least one interlayer containing an infrared absorbing dye, (2) the reading of image information comprises photoelectric reading of first image information by light reflected from and photoelectric reading of second image information by light transmitted through the processed photosensitive material, and (3) the read first and second image information is converted into electrical blue, green and red digital image information.

12. The method of forming a color image according to claim 11, wherein the silver halide color photosensitive material has an anti-halation layer containing a decolorizable anti-halation dye.

13. The method of forming a color image according to claim 11, wherein the electrical blue, green and red digital image information obtained by conversion of the first and second image information is subjected to image processing and the image-processed digital image information is output to a printer.

14. The method of forming a color image according to claim 11, wherein said first image information includes two kinds of image information comprising the image information recorded on a lowermost photosensitive layer read from the back side of the photosensitive material and the image information recorded on an uppermost photosensitive layer read from the front side of the photosensitive material.

15. The method of forming a color image according to claim 11, wherein the light for reading the first image information is an infrared radiation.

16. A silver halide color photosensitive material, for use in photoelectric reading of image information by light reflected from and photoelectric reading of image information by light transmitted through the silver halide color photosensitive material after being development processed, and converting the two kinds of read information into digital image information, which has at least one interlayer containing an infrared absorbing dye having a transmission density of at least 0.05.

17. A silver halide color photosensitive material, which comprises on a support at least one silver halide emulsion layer, at least one interlayer containing an infrared absorbing dye having at a transmission density of at least 0.5, and an anti-halation layer containing a decolonzable anti-halation dye.

18. A method of forming a color image, which comprises the steps of:

subjecting an exposed silver halide color photosensitive material to development processing;

reading image information photoelectrically from the obtained image; and converting the read image information into electrical digital image information, wherein, (1) the reading of image information comprises photoelectric reading of first image information by using light reflected from and photoelectric reading of second image information by using light transmitted through the silver halide color photosensitive material after being processed, (2) the silver halide color photosensitive material is subjected to clarification process between the operations of reading the first and second image information, and (3) the read first and second image information is converted into electrical blue, green and red digital image information.

19. The method of forming a color image according to claim 18, wherein said electrical blue, green and red digital image information obtained by conversion of the first and second image information is subjected to image processing and the image-processed digital image information is output to a printer.

20. The method of forming a color image according to claim 18, wherein the first image information includes two kinds of image information comprising the image information recorded on a lowermost photosensitive layer read by a reflected light from the back side of the photosensitive material and the image information recorded on an uppermost photosensitive layer read by a reflected light from the front side of the photosensitive material.

21. The method of forming a color image according to claim 18, wherein the development process to which the silver halide color photosensitive material is subjected is black and white development, and the second image information is an image information obtained by reading light transmitted through the processed photosensitive material on which superposed images are formed on three layers comprising a lowermost photosensitive layer, an uppermost photosensitive layer and an intermediate photosensitive layer therebetween.

22. The method of forming a color image according to claim 18, wherein the clarification process is conducted by use of a processing solution containing a fixing agent selected from the group consisting of a meso-ion compound represented by the general formula [FI], a thiourea derivative represented by the general formula [FII], and a mercaptotetrazole represented by the general formula [FIII]:

[FI]

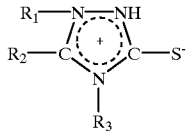

wherein $R_1$, $R_2$ and $R_3$ independently represent a hydrogen atom, alkyl group, cycloalkyl group, alkenyl group, alkynyl group, aralkyl group, aryl group, heterocyclic group, amino group, acylamino group, sulfonamide group, ureido group, sulfamoyl amino group, acyl group, thioacyl group, carbamoyl group and thiocarbamoyl group, provided that $R_1$ and $R_2$ are not simultaneously hydrogen atoms,

[FII]

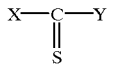

wherein X and Y independently represent an alkyl group, alkenyl group, aralkyl group, aryl group, heterocyclic group, $—N(R_{11})R_{12}$, $—N(R_{13})N(R_{14})R_{15}$, $—OR_{16}$ and $—SR_{17}$, and X and Y may form a ring provided that X and/or Y is substituted with at least one carboxylic acid or salt thereof, sulfonic acid or salt thereof, phosphonic acid or salt thereof, or amino group, ammonium group or hydroxyl group, $R_{11}$, $R_{12}$, $R_{13}$, $R_{14}$ and $R_{15}$ independently represent a hydrogen atom, alkyl group, alkenyl group, aralkyl group, aryl group and heterocyclic group, and $R_{16}$ and $R_{17}$ independently represent a hydrogen atom, cation, alkyl group, alkenyl group, aralkyl group, aryl group and heterocyclic group,

[FIII]

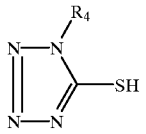

wherein $R_4$ represents a hydroxy alkyl group.

23. A device for forming a color image, which comprises a development process part for subjecting an exposed silver halide color photosensitive material to development process, a first image information reading part for photoelectric reading of first image information by using light reflected from the obtained image, a second image information reading part for photoelectric reading of second image information by using light transmitted through the image, a clarification process part for subjecting the silver halide color photosensitive material to clarification process between the first and second image information reading part, and an arithmetic processing part for converting the read first and second image information into electrical blue, green and red digital image information.

24. A method of forming a color image, which comprises the steps of:

subjecting an exposed silver halide color photosensitive material to development process;

reading image information photoelectrically from the obtained image; and converting the read image information into electrical digital image information, wherein, (1) the reading of image information includes photoelectric reading of first image information by light reflected from and photoelectric reading of second image information by light transmitted through the processed photosensitive material, (2) the silver halide color photosensitive material is dried between the reading operations of the first and second image information, and (3) the read first and second image information is converted into electrical blue, green and red digital image information.

25. The method of forming a color image according to claim 24, wherein the silver halide color photosensitive material has a support mainly made from polyester.

26. The method of forming a color image according to claim 24, wherein said electrical blue, green and red digital image information obtained by conversion of the first and second image information is subjected to image processing and the image-processed digital image information is output to a printer.

27. The method of forming a color image according to claim 24, wherein the first image information includes two kinds of image information comprising the image information recorded on a lowermost photosensitive layer read from the back side of the photosensitive material and the image information recorded on an uppermost photosensitive layer read from the front side of the photosensitive material.

28. The method of forming a color image according to claim 24, wherein the development process to which the silver halide color photosensitive material is subjected is black and white development, and the second image information is image information obtained by reading light transmitted through the processed photosensitive material on which superposed images are formed on three layers comprising a lowermost photosensitive layer, an uppermost photosensitive layer and an intermediate photosensitive layer therebetween.

29. A device for forming a color image, which comprises a development process part for subjecting an exposed silver halide color photosensitive material to development process, a first image information reading part for photoelectric reading of the first image information by light reflected from the obtained image, a second image information reading part for photoelectric reading of the second image information by light transmitted through the image, a heat drying part for drying the silver halide color photosensitive material between the first and second image reading parts, and an arithmetic processing part for converting the read first and second image information into electrical blue, green and red digital image information.

30. A method of forming a color image, which comprises the steps of:

subjecting an exposed silver halide color photosensitive material to development process;

reading image information photoelectrically from the obtained image; and converting the read image information into electrical digital image information, wherein, (1) the development processing is development process by applying a developing solution to the silver halide color photosensitive material and heating the photosensitive material, (2) the reading of image information includes photoelectric reading of first image information by using light reflected from and photoelectric reading of second image information by using light transmitted through the processed photosensitive material, and (3) the read first and second image information is converted into electrical blue, green and red digital image information.

31. The method of forming a color image according to claim 30, wherein the silver halide color photosensitive material has a support mainly made from polyester.

32. The method of forming a color image according to claim 30, wherein said electrical blue, green and red digital image information obtained by conversion of the first and second image information is subjected to image processing and the image-processed digital image information is output to a printer.

33. The method of forming a color image according to claim 30, wherein the first image information includes two kinds of image information comprising the image information recorded on a lowermost photosensitive layer read by reflected light from the back side of photosensitive material and the image information recorded on an uppermost photosensitive layer read by reflected light from the front side of the photosensitive material.

34. The method of forming a color image according to claim 30, wherein the development process to which the photosensitive material is subjected is black and white development, and the second image information is image information obtained by reading light transmitted through the processed photosensitive material on which superposed images are formed on three layers comprising a lowermost photosensitive layer, an uppermost photosensitive layer and an intermediate photosensitive layer therebetween.

35. A device for forming a color image, which comprises a conveying part for conveying an exposed silver halide color photosensitive material, a development process part arranged above the conveying part, a first image information reading part for photoelectric reading of the first image information by using light reflected from the image on the developed silver halide color photosensitive material, a second image information reading part for photoelectric reading of the second image information by using light transmitted through the image, and said development part includes a supplying part for supplying a developing solution to the silver halide color photosensitive material and a heating part for heating the silver halide color photosensitive material containing the supplied developing solution, wherein the heating part is controlled such that a surface temperature of the color photosensitive material is 50° C. or more to 90° C. or less.

36. A method of forming a color image, which comprises the steps of:

subjecting an exposed silver halide color photosensitive material to development process;

reading image information photoelectrically from the obtained image; and converting the read image information into electrical digital image information, wherein, (1) the developing solution used in development process is composed of a developing agent-containing solution having a pH value of 7 or less and an alkali agent-containing solution, and (2) the development process is development process by supplying the developing agent-containing solution and the alkali agent-containing solution to the silver halide color photosensitive material and heating the silver halide color photosensitive material to which the developing solution was supplied, wherein heating is performed such that a surface temperature of the color photosensitive material is 50° C. or more to 90° C. or less.

37. The method of forming a color image according to claim 36, wherein the silver halide color photosensitive material has a support mainly made from polyester.

38. The method of forming a color image according to claim 36, wherein an exposed silver halide color photosensitive material is subjected to development process and then to clarification process, and successively the image information is photoelectrically read from the obtained image.

39. The method of forming a color image according to claim 38, wherein said clarification process comprises improving image quality upon overexposure comprising:

treatment of dissolution; and removal of silver halide in a non-developed layer in the developed photosensitive material.

40. The method of forming a color image according to claim 36, wherein the digital image information obtained by converting the photoelectrically read image is subjected to image processing and the image-processed digital image information is output to a printer.

41. The method of forming a color image according to claim 36, wherein the developing agent contained in the developing agent-containing solution is a color developing agent.

42. A photosensitive material processing device for processing a photosensitive material in which an exposed color photosensitive material is subjected to development process by supplying a developing solution thereto and heating thereof to form an image, wherein a heating device for the heating is provided with a far infrared-light-emitting heater, wherein the heating device is controlled such that the surface temperature of the color photosensitive material is 50° C. or more to 90° C. or less.

* * * * *